US007775290B2

(12) United States Patent
Brisco et al.

(10) Patent No.: US 7,775,290 B2
(45) Date of Patent: Aug. 17, 2010

(54) APPARATUS FOR RADIALLY EXPANDING AND PLASTICALLY DEFORMING A TUBULAR MEMBER

(75) Inventors: David Paul Brisco, Duncan, OK (US); Brock Wayne Watson, Carrollton, TX (US); Harold Otis Treece, Duncan, OK (US)

(73) Assignee: Enventure Global Technology, LLC, Houston, TX (US)

( * ) Notice: Subject to any disclaimer, the term of this patent is extended or adjusted under 35 U.S.C. 154(b) by 669 days.

(21) Appl. No.: 10/553,566

(22) PCT Filed: Apr. 15, 2004

(86) PCT No.: PCT/US2004/011973
§ 371 (c)(1),
(2), (4) Date: Aug. 28, 2007

(87) PCT Pub. No.: WO2004/094766
PCT Pub. Date: Nov. 4, 2004

(65) Prior Publication Data
US 2008/0142229 A1 Jun. 19, 2008

Related U.S. Application Data

(63) Continuation-in-part of application No. 10/552,790, filed as application No. PCT/US2004/010712 on Apr. 7, 2004, which is a continuation-in-part of application No. 10/522,253, filed as application No. PCT/US2004/010762 on Apr. 6, 2004, which is a continuation-in-part of application No. 10/551,880, filed as application No. PCT/US2004/010317 on Apr. 2, 2004, which is a continuation-in-part of application No. 10/551,906, filed as application No. PCT/US2004/009434 on Mar. 26, 2004, which is a continuation-in-part of application No. 10/548,934, filed as application No. PCT/US2004/007711 on Mar. 11, 2004, which is a continuation-in-part of application No. 10/528,497, filed as application No. PCT/US03/29460 on Sep. 22, 2003, which is a continuation-in-part of application No. 10/513,614, filed as application No. PCT/US2003/014153 on May 6, 2003, which is a continuation-in-part of application No. 10/507,567, filed as application No. PCT/US2003/004837 on Feb. 19, 2003, which is a continuation-in-part of application No. 10/495,347, filed as application No. PCT/US2002/036157 on Nov. 12, 2002, and a continuation-in-part of application No. 10/495,344, filed as application No. PCT/US2002/036267 on Nov. 12, 2002.

(60) Provisional application No. 60/461,094, filed on Apr. 8, 2003, provisional application No. 60/461,038, filed on Apr. 7, 2003, provisional application No. 60/459,776, filed on Apr. 2, 2003, provisional application No. 60/457,960, filed on Mar. 27, 2003, provisional application No. 60/453,678, filed on Mar. 11, 2003, provisional application No. 60/412,488, filed on Sep. 20, 2002, provisional application No. 60/380,147, filed on May 6, 2002, provisional application No. 60/363,829, filed on Mar. 13, 2002, provisional application No. 60/338,996, filed on Nov. 12, 2001, provisional application No. 60/339,013, filed on Nov. 12, 2001.

(51) Int. Cl.
*E21B 23/01* (2006.01)
*E21B 29/00* (2006.01)

(52) U.S. Cl. ..... 166/384; 166/207; 166/212

(58) Field of Classification Search ..... 166/380, 166/384, 206, 207, 216, 217, 212
See application file for complete search history.

(56) References Cited

U.S. PATENT DOCUMENTS 46,818 A 3/1865 Patterson
(Continued)

FOREIGN PATENT DOCUMENTS

AU 767364 2/2004
(Continued)

OTHER PUBLICATIONS

Arbuckle, "Advanced Laser Texturing Tames Tough Tasks," Metal Forming Magazine.
(Continued)

*Primary Examiner*—Kenneth Thompson
(74) *Attorney, Agent, or Firm*—Conley Rose, P.C.

(57) ABSTRACT

An apparatus for radially expanding and plastically deforming a tubular member.

103 Claims, 250 Drawing Sheets

U.S. PATENT DOCUMENTS

| | | | |
|---|---|---|---|
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |
| 1,494,128 | A | 5/1924 | Primrose |
| 1,597,212 | A | 10/1924 | Spengler |
| 1,589,781 | A | 6/1926 | Anderson |
| 1,590,357 | A | 6/1926 | Feisthamel |
| 1,613,461 | A | 1/1927 | Johnson |
| 1,756,531 | A | 4/1930 | Aldeen et al. |
| 1,880,218 | A | 10/1932 | Simmons |
| 1,981,525 | A | 11/1934 | Price |
| 2,046,870 | A | 7/1936 | Clasen et al. |
| 2,087,185 | A | 7/1937 | Dillom |
| 2,122,757 | A | 7/1938 | Scott |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,214,226 | A | 9/1940 | English |
| 2,226,804 | A | 12/1940 | Carroll |
| 2,246,038 | A | 6/1941 | Graham |
| 2,273,017 | A | 2/1942 | Boynton |
| 2,301,495 | A | 11/1942 | Abegg |
| 2,305,282 | A | 12/1942 | Taylor Jr. et. al. |
| 2,371,840 | A | 3/1945 | Otis |
| 2,383,214 | A | 8/1945 | Prout |
| 2,447,629 | A | 8/1948 | Beissinger et al. |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et. al. |
| 2,627,891 | A | 2/1953 | Clark |
| 2,647,847 | A | 8/1953 | Black et al |
| 2,664,952 | A | 1/1954 | Losey |
| 2,691,418 | A | 10/1954 | Connolly |
| 2,723,721 | A | 11/1955 | Corsette |
| 2,734,580 | A | 2/1956 | Layne |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,477,506 | A | 11/1969 | Malone |
| 3,489,220 | A | 1/1970 | Kinley |
| 3,498,376 | A | 3/1970 | Sizer et al. |
| 3,504,515 | A | 4/1970 | Reardon |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,578,081 | A | 5/1971 | Bodine |
| 3,579,805 | A | 5/1971 | Kast |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinely et al. |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |
| 3,834,742 | A | 9/1974 | McPhillips |
| 3,866,954 | A | 2/1975 | Slator et al. |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,935,910 | A | 2/1976 | Gaudy et al. |
| 3,942,824 | A | 3/1976 | Sable |
| 3,945,444 | A | 3/1976 | Knudson |
| 3,948,321 | A | 4/1976 | Owen et al. |
| 3,970,336 | A | 7/1976 | O'Sickey et al. |
| 3,977,473 | A | 8/1976 | Page, Jr. |
| 3,989,280 | A | 11/1976 | Schwarz |
| 3,997,193 | A | 12/1976 | Tsuda et al. |
| 3,999,605 | A | 12/1976 | Braddick |
| 4,011,652 | A | 3/1977 | Black |
| 4,019,579 | A | 4/1977 | Thuse |
| 4,026,583 | A | 5/1977 | Gottlieb |
| 4,053,247 | A | 10/1977 | Marsh, Jr. |
| 4,069,573 | A | 1/1978 | Rogers, Jr. et al. |
| 4,076,287 | A | 2/1978 | Bill et al. |

4,096,913 A 6/1978 Kenneday et al.
4,098,334 A 7/1978 Crowe
4,099,563 A 7/1978 Hutchison et al.
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,501,327 A 2/1985 Retz
4,505,017 A 3/1985 Schukei
4,505,987 A 3/1985 Yamada et al.
4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,530,231 A 7/1985 Main
4,541,655 A 9/1985 Hunter
4,550,782 A 11/1985 Lawson
4,553,776 A 11/1985 Dodd
4,573,248 A 3/1986 Hackett
4,576,386 A 3/1986 Benson et al.
4,581,817 A 4/1986 Kelly
4,590,227 A 5/1986 Nakamura et al.
4,590,995 A 5/1986 Evans
4,592,577 A 6/1986 Ayres et al.
4,595,063 A 6/1986 Jennings et al.
4,601,343 A 7/1986 Lindsey, Jr. et al.
4,605,063 A 8/1986 Ross
4,611,662 A 9/1986 Harrington
4,614,233 A 9/1986 Menard
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,579 A 6/1989 Wester et al.
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi 4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,064,004 A 11/1991 Lundel
5,079,837 A 1/1992 Vanselow
5,083,608 A 1/1992 Abdrakhmanov et al.
5,093,015 A 3/1992 Oldiges
5,095,991 A 3/1992 Milberger
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche et al.
5,242,017 A 9/1993 Hailey
5,253,713 A 10/1993 Gregg et al.
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,413,180 A 5/1995 Ross et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.

5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Woo et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,158,963 A 12/2000 Hollis
6,167,970 B1 1/2001 Stout
6,182,775 B1 2/2001 Hipp
6,196,336 B1 3/2001 Fincher et al.
6,226,855 B1 5/2001 Maine
6,231,086 B1 5/2001 Tierling
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,302,211 B1 10/2001 Nelson et al.
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,724 B2 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B2 10/2002 Cook et al.
6,470,996 B1 10/2002 Kyle et al.
6,478,092 B2 11/2002 Voll et al.
6,491,108 B1 12/2002 Slup et al.
6,497,289 B1 12/2002 Cook et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,640 B1 5/2003 Cook et al.
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Cook et al.
6,578,630 B2 6/2003 Simpson et al.
6,585,053 B2 7/2003 Coon
6,591,905 B2 7/2003 Coon
6,598,677 B1 7/2003 Baugh et al.
6,598,678 B1 7/2003 Simpson
6,604,763 B1 8/2003 Cook et al.
6,607,220 B2 8/2003 Sivley, IV
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,662,876 B2 12/2003 Lauritzen
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.

6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,758,278 B2 7/2004 Cook et al.
6,772,841 B2 8/2004 Gano
6,796,380 B2 9/2004 Xu
6,814,147 B2 11/2004 Baugh
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,902,652 B2 6/2005 Heijnen
6,923,261 B2 8/2005 Metcalfe et al.
6,935,429 B2 8/2005 Badrak
6,935,430 B2 8/2005 Harrall et al.
6,966,370 B2 11/2005 Cook et al.
6,976,539 B2 12/2005 Metcalfe et al.
7,000,953 B2 2/2006 Berghaus
7,007,760 B2 3/2006 Lohbeck
7,021,390 B2 4/2006 Cook et al.
2001/0002626 A1 6/2001 Frank et al.
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Sivley, IV
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0188099 A1 9/2004 Cook et al.
2004/0194966 A1 10/2004 Zimmerman
2004/0216873 A1 11/2004 Frost, Jr. et al.
2004/0221996 A1 11/2004 Burge
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Watson et al.
2005/0056434 A1 3/2005 Ring et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217768 A1 10/2005 Asahi et al.

| | | | |
|---|---|---|---|
| 2005/0217865 | A1 | 10/2005 | Ring et al. |
| 2005/0217866 | A1 | 10/2005 | Watson et al. |
| 2005/0223535 | A1 | 10/2005 | Cook et al. |
| 2005/0224225 | A1 | 10/2005 | Cook et al. |
| 2005/0230102 | A1 | 10/2005 | Cook et al. |
| 2005/0230103 | A1 | 10/2005 | Cook et al. |
| 2005/0230104 | A1 | 10/2005 | Cook et al. |
| 2005/0230123 | A1 | 10/2005 | Cook et al. |
| 2005/0236159 | A1 | 10/2005 | Cook et al. |
| 2005/0236163 | A1 | 10/2005 | Cook et al. |
| 2005/0244578 | A1 | 11/2005 | Van Egmond et al. |
| 2005/0246883 | A1 | 11/2005 | Alliot et al. |
| 2005/0247453 | A1 | 11/2005 | Shuster et al. |
| 2005/0265788 | A1 | 12/2005 | Renkema |
| 2005/0269107 | A1 | 12/2005 | Cook et al. |
| 2006/0032640 | A1 | 2/2006 | Costa et al. |
| 2006/0048948 | A1 | 3/2006 | Noel |
| 2006/0054330 | A1 | 3/2006 | Metcalfe et al. |
| 2006/0065403 | A1 | 3/2006 | Watson et al. |
| 2006/0065406 | A1 | 3/2006 | Shuster et al. |

FOREIGN PATENT DOCUMENTS

| | | | |
|---|---|---|---|
| AU | 770008 | | 7/2004 |
| AU | 770359 | | 7/2004 |
| AU | 771884 | | 8/2004 |
| AU | 776580 | | 1/2005 |
| AU | 780123 | | 3/2005 |
| AU | 2001269810 | | 8/2005 |
| AU | 782901 | | 9/2005 |
| AU | 783245 | | 10/2005 |
| AU | 2001294802 | | 10/2005 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2234386 | | 3/2003 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1555386 | A1 | 7/2005 |
| FR | 1325596 | | 6/1962 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2365898 | A | 2/2002 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |

| | | | |
|---|---|---|---|
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396869 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2404680 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |

| | | | |
|---|---|---|---|
| GB | 2414750 | A | 7/2005 |
| GB | 2414751 | A | 7/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2380503 | B | 10/2005 |
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2418216 | A | 3/2006 |
| GB | 2418217 | A | 3/2006 |
| GB | 2408277 | A | 5/2008 |
| ID | 044.392/2005 | | 9/2005 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |

| | | | |
|---|---|---|---|
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/23007 | A1 | 3/2002 |
| WO | WO02/25059 | A1 | 3/2002 |
| WO | WO02/29199 | A1 | 4/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081346 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |

| | | | |
|---|---|---|---|
| WO | WO2004/083594 | A3 | 9/2004 |
| WO | WO2004/085790 | A2 | 10/2004 |
| WO | WO2004/089608 | A2 | 10/2004 |
| WO | WO2004/092527 | A2 | 10/2004 |
| WO | WO2004/092528 | A2 | 10/2004 |
| WO | WO2004/092528 | A3 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020827 | A2 | 2/2006 |
| WO | WO2006/020913 | A2 | 2/2006 |
| WO | WO2006/020960 | A2 | 2/2006 |
| WO | WO2006/033720 | A2 | 3/2006 |

OTHER PUBLICATIONS

Baker Hughes, "Expatch Expandable Cladding System," Oct. 2002.

Baker Hughes, "Express Expandable Screen System,".

Baker Hughes, "Formlock Expandable Liner Hangers,".

Banabic, "Research Projects," Jan. 30, 1999.

Blasingame et al., "Solid Expandable Tubular Technology in Mature Basins," *Society of Petroleum Engineers* 2003.

Brass et al., "Water Production Management—PDO's Successful Application of Expandable Technology," *Society of Petroleum Engineers*, 2002.

Brizmer et al., "A Laser Surface Textured Parallel Thrust Bearing," *Tribology Transactions*, 46(3):397-403, 2003.

Brock et al., "An Expanded Horizon," Hart's E&P, Feb. 2000.

Buckler et al., "Expandable Cased-hole Liner Remediates Prolific Gas Well and Minimizes Loss of Production," *Offshore Technology Conference*, 15151.

Bullock, "Advances Grow Expandable Applications," *The American Oil & Gas Reporter*, Sep. 2004.

Cales, "The Development and Applications of Solid Expandable Tubular Technology," *Enventure Global Technology*, Paper 2003-136, 2003.

Cales et al., "Reducing Non-Productive Time Through the Use of Solid Expandable Tubulars: How to Beat the Curve Through Pre-Planning," *Offshore Technology Conference*, 16669, 2004.

Cales et al., "Subsidence Remediation—Extending Well Life Through the Use of Solid Expandable Casing Systems," *AADE Houston Chapter*, Mar. 27, 2001.

Campo et al., "Case Histories—Drilling and Recompletion Applications Using Solid Expandable Tubular Technology," *Society of Petroleum Engineers*, SPE/IADC 72304, 2002.

Carstens et al., "Solid Expandable Tubular Technology: The Value of Planned Installations vs. Contingency,".

Case History, "Eemskanaal—2 Groningen," Enventure Global Technology, Feb. 2002.

Case History, "Graham Ranch No. 1 Newark East Barnett Field" Enventure Global Technology, Feb. 2002.

Case History, "K.K. Camel No. 1 Ridge Field Lafayette Parish, Louisiana," Enventure Global Technology, Feb. 2002.

Case History, "Mississippi Canyon 809 URSA TLP, OSC-G 5868, No. A-12," Enventure Global Technology, Mar. 2004.

Case History, "Unocal Sequoia Mississippi Canyon 941 Well No. 2" Enventure Global Technology, 2005.

Case History, "Yibal 381 Oman," Enventure Global Technology, Feb. 2002.

Cook, "Same Internal Casing Diameter From Surface to TD," *Offshore*, Jul. 2002.

Cottrill, "Expandable Tubulars Close in on the Holy Grail of Drilling," *Upstream*, Jul. 26, 2002.

Daigle et al., "Expandable Tubulars: Field Examples of Application in Well Construction and Remediation," *Society of Petroleum Engineers*, SPE 62958, 2000.

Daneshy, "Technology Strategy Breeds Value," E&P, May 2004.

Data Sheet, "Enventure Cased-Hole Liner (CHL) System" Enventure Global Technology, Dec. 2002.

Data Sheet, "Enventure Openhole Liner (OHL) System" Enventure Global Technology, Dec. 2002.

Data Sheet, "Window Exit Applications OHL Window Exit Expansion" Enventure Global Technology, Jun. 2003.

Dean et al., "Monodiameter Drilling Liner—From Concept to Reality," *Society of Petroleum Engineers*, SPE/IADC 79790, 2003.

Demong et al., "Breakthroughs Using Solid Expandable Tubulars to Construct Extended Reach Wells," *Society of Petroleum Engineers*, IADC/SPE 87209, 2004.

Demong et al., "Casing Design in Complex Wells: The Use of Expandables and Multilateral Technology to Attack the size Reduction Issue".

Demong et al., "Expandable Tubulars Enable Multilaterals Without Compromise on Hole Size," *Offshore*, Jun. 2003.

Demong et al., "Planning the Well Construction Process for the Use of Solid Expandable Casing," *Society of Petroleum Engineers*, SPE 85303, 2003.

Demoulin, "Les Tubes Expansibles Changent La Face Du Forage Petrolier," *L'Usine Nouvelle*, 2878:50-52, 3 Juillet 2003.

Dupal et al., "Realization of the MonoDiameter Well: Evolution of a Game-Changing Technology," *Offshore Technology Conference*, OTC 14312, 2002.

Dupal et al., "Solid Expandable Tubular Technology—A Year of Case Histories in the Drilling Environment," *Society of Petroleum Engineers*, SPE/IADC 67770, 2001.

Dupal et al., "Well Design with Expandable Tubulars Reduces Cost and Increases Success in Deepwater Applications," *Deep Offshore Technology*, 2000.

Duphorne, "Letter Re: Enventure Claims of Baker Infringement of Enventure's Expandable Patents," Apr. 1, 2005.

Egge, "Technical Overview Production Enhancement Technology," Baker Hughes, Mar. 10, 2003.

"EIS Expandable Isolation Sleeve" *Expandable Tubular Technology*, Feb. 2003.

Enventure Global Technology, Solid Expandable Tubulars are Enabling Technology, *Drilling Contractor*, Mar.-Apr. 2001.

"Enventure Ready to Rejuvinate the North Sea," *Roustabout*, Sep. 2004.

Escobar et al., "Increasing Solid Expandable Tubular Technology Reliability in a Myriad of Downhole Environments," *Society of Petroleum Engineers*, SPE/IADC 81094, 2003.
Etsion, "Improving Tribological Performance of Mechanical Seals by Laser Surface Texturing," *Surface Technologies, Ltd*.
Etsion, "A Laser Surface Textured Hydrostatic Mechanical Seal," *Sealing Technology*, Mar. 2003.
"Expandable Casing Accesses Remote Reservoirs," *Petroleum Engineer International*, Apr. 1999.
"Expandable Sand Screens," *Weatherford Completion Systems*, 2002.
Filippov et al., "Expandable Tubular Solutions," *Society of Petroleum Engineers*, SPE 56500, 1999.
"First ever SET Workshop Held in Aberdeen," *Roustabout*, Oct. 2004.
Fischer, "Expandables and the Dream of the Monodiameter Well: A Status Report", *World Oil*, Jul. 2004.
Fontova, "Solid Expandable Tubulars (SET) Provide Value to Operators Worldwide in a Variety of Applications," *EP Journal of Technology*, Apr. 2005.
Fraunhofer Iwu, "Research Area: Sheet Metal Forming—Superposition of Vibrations," 2001.
Furlow, "Casing Expansion, Test Process Fine Tuned on Ultra-deepwater Well," *Offshore*, Dec. 2000.
Furlow, "Expandable Casing Program Helps Operator Hit TD With Larger Tubulars," *Offshore*, Jan. 2000.
Furlow, "Expandable Solid Casing Reduces Telescope Effect," *Offshore*, Aug. 1998.
Furlow, "Agbada Well Solid Tubulars Expanded Bottom Up, Screens Expanded Top Down," *Offshore*, 2002.
Gilmer et al., "World's First Completion Set Inside Expandable Screen," *High-Tech Wells*, 2003.
Grant et al., "Deepwater Expandable Openhole Liner Case Histories: Learnings Through Field Applications," *Offshore Technology Conference*, OCT 14218, 2002.
Guichelaar et al., "Effect of Micro-Surface Texturing on Breakaway Torque and Blister Formation on Carbon-Graphite Faces in a Mechanical Seal," *Lubrication Engineering*, Aug. 2002.
Gusevik et al., "Reaching Deep Reservoir Targets Using Solid Expandable Tubulars" *Society of Petroleum Engineers*, SPE 77612, 2002.
Haefke et al., "Microtexturing of Functional Surfaces for Improving Their Tribological Performance," *Proceedings of the International Tribology Conference*, 2000.
Halliburton Completion Products, 1996.
Haut et al., "Meeting Economic Challenges of Deepwater Drilling with Expandable-Tubular Technology," *Deep Offshore Technology Conference*, 1999.
Hull, "Monodiameter Technology Keeps Hole Diameter to TD," *Offshore* Oct. 2002.
"Innovators Chart the Course,".
Langley, "Case Study: Value in Drilling Derived From Application-Specific Technology," Oct. 2004.
Linzell, "Trib-Gel A Chemical Cold Welding Agent," 1999.
Lizotte, "Scratching The Surface," *PT Design*, Jun. 19993.
Lohoefer et al., "Expandable Liner Hanger Provides Cost-Effective Alternative Solution," *Society of Petroleum Engineers*, IADC/SPE 59151, 2000.
Mack et al., "How in Situ Expansion Affects Casing and Tubing Properties," *World Oil*, Jul. 1999. pp. 69-71.
Mack et al., "In-Situ Expansion of Casing and Tubing—Effect on Mechanical Properties and Resistance to Sulfide Stress Cracking,".
Merritt, "Casing Remediation—Extending Well Life Through The Use of Solid Expandable Casing Systems,".
Merritt et al., "Well Remediation Using Expandable Cased-Hole Liners", *World Oil*., Jul. 2002.
Merritt et al., "Well Remediation Using Expandable Cased-Hole Liners—Summary of Case Histories".
Mohawk Energy, :Minimizing Drilling Ecoprints Houston, Dec. 16, 2005.
Moore et al., "Expandable Liner Hangers: Case Histories," *Offshore Technology Conference*, OTC 14313, 2002.
Moore et al., "Field Trial Proves Upgrades to Solid Expandable Tubulars," *Offshore Technology Conference*, OTC 14217, 2002.
News Release, "Shell and Halliburton Agree to Form Company to Develop and Market Expandable Casing Technology," Jun. 3, 1998.
Nor, et al, "Transforming Conventional Wells to Bigbore Completions Using Solid Expandable Tubular Technology," *Offshore Technology Conference*, OTC 14315, 2002.
Patin et al., "Overcoming Well Control Challenges with Solid Expandable Tubular Technology," *Offshore Technology Conference*, OTC 15152, 2003.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.
Rivenbark, "Expandable Tubular Technology—Drill Deeper, Farther, More Economically," Enventure Global Technology.
Rivenbark et al., "Solid Expandable Tubular Technology: The Value of Planned Installation vs. Contingency," *Society of Petroleum Engineers*, SPE 90821, 2004.
Rivenbark et al., "Window Exit Sidetrack Enhancements Through the Use of Solid Expandable Casing," *Society of Petroleum Engineers*, IADC/SPE 88030, 2004.
Roca et al., "Addressing Common Drilling Challenges Using Solid Expandable Tubular Technology," *Society of Petroleum Engineers*, SPE 80446, 2003.
Ronen et al., "Friction-Reducing Surface-Texturing in Reciprocating Automotive Components," *Tribology Transactions*, 44(3):359-366, 2001.
Rky et al., "Experimental Investigation of Laser Surface Texturing for Reciprocating Automotive Components," *Tribology Transactions*, 45(4):444-449, 2002.
Sanders et al., Practices for Providing Zonal Isolation in Conjunction with Expandable Casing Jobs-Case Histories, 2003.
Sanders et al., "Three Diverse Applications on Three Continents for a Single Major Operator," *Offshore Technology Conference*, OTC 16667, 2004.
"Set Technology: The Facts" 2004.
Siemers et al., "Development and Field Testing of Solid Expandable Corrosion Resistant Cased-hole Liners to Boost Gas Production in Corrosive Environments," *Offshore Technology Conference*, OTC 15149, 2003.
"Slim Well:Stepping Stone to MonoDiameter," *Hart's E&P*, Jun. 2003.
Smith, "Pipe Dream Reality," *New Technology Magazine*, Dec. 2003.
"Solid Expandable Tubulars," *Hart's E&P*, Mar. 2002.
Sparling et al., "Expanding Oil Field Tubulars Through a Window Demonstrates Value and Provides New Well Construction Option," *Offshore Technology Conference*, OTC 16664, 2004.
Sumrow, "Shell Drills World's First Monodiameter Well in South Texas," *Oil and Gas*, Oct. 21, 2002.

Touboul et al., "New Technologies Combine to Reduce Drilling Cost in Ultradeepwater Applications," *Society of Petroleum Engineers*, SPE 90830, 2004.
Turcotte et al., "Geodynamics Applications of Continuum Physics to Geological Problems," 1982.
Van Noort et al., "Using Solid Expandable Tubulars for Openhole Water Shutoff," *Society of Petroleum Engineers*, SPE 78495, 2002.
Van Noort et al., "Water Production Reduced Using Solid Expandable Tubular Technology to "Clad," in Fractured Carbonate Formation" *Offshore Technology Conference*, OTC 15153, 2003.
Von Flatern, "From Exotic to Routine—the Offshore Quickstep," *Offshore Engineer*, Apr. 2004.
Von Flatern, "Oilfield Service Trio Target Jules Verne Territory," *Offshore Engineer*, Aug. 2001.
Waddell et al., "Advances in Single-diameter Well Technology: The Next Step to Cost-Effective Optimization," *Society of Petroleum Engineers*, SPE 90818, 2004.
Waddell et al., "Installation of Solid Expandable Tubular Systems Through Milled Casing Windows," *Society of Petroleum Engineers*, IADC/SPE 87208, 2004.
Williams, "Straightening the Drilling Curve," *Oil and Gas Investor*, Jan. 2003.
www.JETLUBE.com, "Oilfield Catalog —Jet-Lok Product Applicatin Descriptions," 1998.
www.MATERIALSRESOURCES.com, "Low Temperature Bonding of Dissimilar and Hard-to-Bond Materials and Metals Including," 2004.
www.MITCHMET.com, "3d Surface Texture Parameters," 2004.
www.SPURIND.com, "Glavanic Protection, Metallurgical Bonds, Custom Fabrications —Spur Industries," 2000.
"Expand Your Opportunities." *Enventure*. CD-ROM. Jun. 1999.
"Expand Your Opportunities." *Enventure*. CD-ROM. May 2001.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct 30, 2001.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477, Oct. 31, 2003.
International Search Report, Application PCT/US02/20477, Apr. 6, 2004.
International Search Report, Application PCT/US02/24399, Feb. 27, 2004.
International Search Report, Application PCT/US02/25608, May 24, 2004.
International Search Report, Application PCT/US02/25727, Feb. 19, 2004.
International Search Report, Application PCT/US02/29856, Dec. 16, 2002.
International Search Report, Application PCT/US02/36157, Sep. 29, 2003.
International Search Report, Application PCT/US02/36267, May 21, 2004.
International Search Report, Application PCT/US02/39418, Mar. 24, 2003.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144, Oct. 31, 2003.
International Search Report, Application PCT/US03/11765, Nov. 13, 2003.
International Search Report, Application PCT/US03/13787, May 28, 2004.
International Search Report, Application PCT/US03/14153, May 28, 2004.
International Search Report, Application PCT/US03/15020, Jul. 30, 2003.
International Search Report, Application PCT/US03/15020, Nov. 14, 2005.
International Search Report, Application PCT/US03/18530, Jun. 24, 2004.
International Search Report, Application PCT/US03/19993, May 24, 2004.
International Search Report, Application PCT/US03/20694, Nov. 12, 2003.
International Search Report, Application PCT/US03/20870, May 24, 2004.
International Search Report, Application PCT/US03/24779, Mar. 3, 2004.
International Search Report, Application PCT/US03/25667, Feb. 26, 2004.
International Search Report, Application PCT/US03/25675, May 25, 2004.
International Search Report, Application PCT/US03/25676, May 17, 2004. .
International Search Report, Application PCT/US03/25677, May 21, 2004.
International Search Report, Application PCT/US03/25707, Jun. 23, 2004.
International Search Report, Application PCT/US03/25715, Apr. 9, 2004.
International Search Report, Application PCT/US03/25716, Jan 13, 2005.

International Search Report, Application PCT/US03/25742, May 27, 2004.
International Search Report, Application PCT/US03/29460, May 25, 2004.
International Search Report, Application PCT/US03/29858, Jun. 30, 2003.
International Search Report, Application PCT/US03/29859, May 21, 2004.
International Search Report, Application PCT/US03/38550, Jun. 15, 2004.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US02/39425, Nov. 16, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15, 2005.
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May. 9, 2005.
International Preliminary Examination Report, Application PCT/US03/15020 (corrected), Nov. 14, 2004.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US03/25676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, Application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/00631, Mar. 2, 2006.
International Preliminary Report on Patentability, Application PCT/US04/02122, May 13, 2005.
International Preliminary Report on Patentability, Application PCT/US04/04740, Apr. 27, 2005.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/11177, Jun. 9, 2005.
International Preliminary Report on Patentability, Application PCT/US04/28438, Sep. 20, 2005.
Written Opinion to Application No. PCT/US01/19014, Dec. 10, 2002.
Written Opinion to Application No. PCT/US01/23815, Jul. 25, 2002.
Written Opinion to Application No. PCT/US01/28960, Dec. 2, 2002.
Written Opinion to Application No. PCT/US01/30256, Nov. 27, 2002.
Written Opinion to Application No. PCT/US02/00093, Apr. 21, 2003.
Written Opinion to Application No. PCT/US02/00677, Apr. 17, 2003.
Written Opinion to Application No. PCT/US02/04353, Apr. 11, 2003.
Written Opinion to Application No. PCT/US02/20256, May 9, 2003.
Written Opinion to Application No. PCT/US02/24399, Apr. 28, 2004.
Written Opinion to Application No. PCT/US02/25608, Sep. 13, 2004.
Written Opinion to Application No. PCT/US02/25608, Feb. 2, 2005.
Written Opinion to Application No. PCT/US02/25727, May 17, 2004.
Written Opinion to Application No. PCT/US02/39418, Jun. 9, 2004.
Written Opinion to Application No. PCT/US02/39425, Nov. 22, 2004.
Written Opinion to Application No. PCT/US02/39425, Apr. 11, 2005.
Written Opinion to Application No. PCT/US03/06544, Feb. 18, 2005.
Written Opinion to Application No. PCT/US03/11765, May 11, 2004.
Written Opinion to Application No. PCT/US03/13787, Nov. 9, 2004.
Written Opinion to Application No. PCT/US03/14153, Sep. 9, 2004.

Written Opinion to Application No. PCT/US03/14153, Nov. 9, 2004.
Written Opinion to Application No. PCT/US03/18530, Sep. 13, 2004.
Written Opinion to Application No. PCT/US03/19993, Oct. 15, 2004.
Written Opinion to Application No. PCT/US03/25675, Nov. 24, 2004.
Written Opinion to Application No. PCT/US03/25675, May 9, 2005.
Written Opinion to Application No. PCT/US03/29858, Jan. 21, 2004.
Written Opinion to Application No. PCT/US03/38550, Dec. 10, 2004.
Written Opinion to Application No. PCT/US04/08171, May 5, 2005.
Combined Search Report and Written Opinion to Application No. PCT/US04/00631, Mar. 28, 2005.
Combined Search Report and Written Opinion to Application No. PCT/US04/02122, Feb. 24, 2005.
Combined Search Report and Written Opinion to Application No. PCT/US04/04740, Jan. 19, 2005.
Combined Search Report and Written Opinion to Application No. PCT/US04/06246, Jan. 26, 2005.
Combined Search Report and Written Opinion to Application No. PCT/US04/08030, Jan. 6, 2005.
Combined Search Report and Written Opinion to Application No. PCT/US04/08073, Mar. 4, 2005.
Combined Search Report and Written Opinion to Application No. PCT/US04/08170, Jan. 13, 2005.
Combined Search Report and Written Opinion to Application No. PCT/US04/08171, Feb. 16, 2005.
Combined Search Report and Written Opinion to Application No. PCT/US04/10762, Sep. 1, 2005.
Combined Search Report and Written Opinion to Application No. PCT/US04/11177, Feb. 14, 2005.
Combined Search Report and Written Opinion to Application No. PCT/US04/11973, Sep. 27, 2005.
Combined Search Report and Written Opinion to Application No. PCT/US04/28423, Jul. 13, 2005.
Combined Search Report and Written Opinion to Application No. PCT/US04/28438, Mar. 14, 2005.
Combined Search Report and Written Opinion to Application No. PCT/US04/28831, Dec. 19, 2005.
Combined Search Report and Written Opinion to Application No. PCT/US04/28889, Nov. 14, 2005.
Search Report to Application No. GB 0003251.6, Jul. 13, 2000.
Search Report to Application No. GB 0004282.0, Jul. 31, 2000.
Search Report to Application No. GB 0004282.0, Jan. 15, 2001.
Search Report to Application No. GB 0004285.3, Jul. 12, 2000.
Search Report to Application No. GB 0004285.3, Jan. 17, 2001.
Search Report to Application No. GB 0005399.1, Jul. 24, 2000.
Search Report to Application No. GB 0005399.1, Feb. 15, 2001.
Search Report to Application No. GB 0013661.4, Oct. 20, 2000.
Search Report to Application No. GB 0013661.4, Apr. 17, 2001.
Search Report to Application No. GB 0013661.4, Feb. 19, 2003.
Search Report to Application No. GB 0219757.2, Nov. 25, 2002.
Search Report to Application No. GB 0219757.2, Jan. 20, 2003.
Search Report to Application No. GB 0220872.6, Dec. 5, 2002.
Search Report to Application No. GB 0220872.6, Mar. 13, 2003.
Search Report to Application No. GB 0225505.7, Mar. 5, 2003.
Search Report to Application No. GB 0415835.8, Dec. 2, 2004.
Search Report to Application No. GB 0415835.8, Mar. 10, 2005.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Search Report to Application No. GB 9930398.4, Jun. 27, 2000.
Examination Report to Application No. GB 0004285.3, Aug. 28, 2002.
Examination Report to Application No. GB 0004285.3, Mar. 28, 2003.
Examination Report to Application No. GB 0005399.1, Oct. 14, 2002.
Examination Report to Application No. GB 0013661.4, Nov. 25, 2003.
Examination Report to Application No. GB 0208367.3, Apr. 4, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Examination Report to Application No. GB 0219757.2, May 10, 2004.
Examination Report to Application No. GB 0219757.2, Oct. 31, 2004.
Examination Report to Application No. GB 0220872.6, Oct. 29, 2004.
Examination Report to Application No. GB 0225505.7, Oct. 27, 2004.
Examination Report to Application No. GB 0225505.7, Feb. 15, 2005.
Examination Report to Application No. GB 0300085.8, Nov. 28, 2003.
Examination Report to Application No. GB 030086.6, Dec. 1, 2003.
Examination Report to Application No. GB 0303220.8, Jun. 30, 2004.
Examination Report to Application No. GB 0306046.4, Sep. 10, 2004.

Examination Report to Application No. GB 0310836.2, Aug. 7, 2003.
Examination Report to Application No. GB 0311596.1, May 18, 2004.
Examination Report to Application No. GB 0314846.7, Jul. 15, 2004.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 0320747.9, May 25, 2004.
Examination Report to Application No. GB 0325071.9, Feb. 2, 2004.
Examination Report to Application No. GB 0325072.7, Feb. 2, 2004.
Examination Report to Application No. GB 0325072.7, Apr. 13, 2004.
Examination Report to Application No. GB 03701281.2, Jan. 31, 2006.
Examination Report to Application No. GB 03723674.2, Feb. 6, 2006.
Examination Report to Application No. GB 0400018.8, Oct. 29, 2004.
Examination Report to Application No. GB 0400018.8, May 17, 2005.
Examination Report to Application No. GB 0400019.6, Oct. 29, 2004.
Examination Report to Application No. GB 0400019.6, May 19, 2005.
Examination Report to Application No. GB 0400019.6, Sep. 2, 2005.
Examination Report to Application No. GB 0400019.6, Nov. 4, 2005.
Examination Report to Application No. GB 0403891.5, Feb. 14, 2005.
Examination Report to Application No. GB 0403891.5, Jun. 30 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5, May 20, 2004.
Examination Report to Application No. GB 0404796.5, Apr. 14, 2005.
Examination Report to Application No. GB 0404830.2, Aug. 17, 2004.
Examination Report to Application No. GB 0404833.6, Aug. 19, 2004.
Examination Report to Application No. GB 0404837.7, Jul. 12, 2004.
Examination Report to Application No. GB 0406257.6, Jun. 28, 2004.
Examination Report to Application No. GB 0406257.6, Jan. 25, 2005.
Examination Report to Application No. GB 0406257.6, Mar. 3, 2005.
Examination Report to Application No. GB 0406257.6, Jun. 16, 2005.
Examination Report to Application No. GB 0406257.6, Sep. 2, 2005.
Examination Report to Application No. GB 0406257.6, Nov. 9, 2005.
Examination Report to Application No. GB 0406258.4, May 20, 2004.
Examination Report to Application No. GB 0406258.4, Jan. 12, 2005.
Examination Report to Application No. GB 0406258.4, Jul. 27, 2005.
Examination Report to Application No. GB 0406258.4, Dec. 20, 2005.
Examination Report to Application No. GB 0408672.4, Jul. 12, 2004.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Examination Report to Application No. GB 0412876.5, Feb. 13, 2006.
Examination Report to Application No. GB 0415835.8, Dec. 23, 2005.
Examination Report to Application No. GB 0416625.2, Jan. 20, 2005.
Examination Report to Application No. GB 0416834.0, Nov. 16, 2004.
Examination Report to Application No. GB 0422419.2, Dec. 8, 2004.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0428141.6, Feb. 9, 2005.
Examination Report to Application No. GB 0428141.6, Sep. 15, 2005.
Examination Report to Application No. GB 0428141.6, Feb. 21, 2006.
Examination Report to Application No. GB 0500184.7, Feb. 9, 2005.
Examination Report to Application No. GB 0500184.7, Sep. 12, 2005.
Examination Report to Application No. GB 0500600.2, Sep. 6, 2005.
Examination Report to Application No. GB 0501667.0, May 27, 2005.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.

Examination Report to Application No. GB 0503470.7, Sep. 22, 2005.
Examination Report to Application No. GB 0506699.8, Sep. 21, 2005.
Examination Report to Application No. GB 0507979.3, Jun. 16, 2005.
Examination Report to Application No. GB 0507979.3, Jan. 17, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509631.8, Feb. 14, 2006.
Examination Report to Application No. GB 0517448.7, Nov. 9, 2005.
Examination Report to Application No. GB 0518025.2, Oct. 27, 2005.
Examination Report to Application No. GB 0518039.3, Nov. 29, 2005.
Examination Report to Application No. GB 0518252.2, Oct. 28, 2005.
Examination Report to Application No. GB 0518799.2, Nov. 9, 2005.
Examination Report to Application No. GB 0518893.3, Dec. 16, 2005.
Examination Report to Application No. GB 0519989.8, Mar. 8, 2006.
Examination Report to Application No. GB 0521024.0, Dec. 22, 2005.
Examination Report to Application No. GB 0522050.4, Dec. 13, 2005.
Examination Report to Application No. GB 0602877.3, Mar. 20, 2006.
Examination Report to Application No. GB 9926450.9, May 15, 2002.
Examination Report to Application No. GB 9926450.9, Nov. 22, 2002.
Search and Examination Report to Application No. GB 0004282.0, Jun. 3, 2003.
Search and Examination Report to Application No. GB 0225505.7, Jul. 1, 2003.
Search and Examination Report to Application No. GB 0308290.6, Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308295.5, Jun. 2, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Search and Examination Report to Application No. GB 0313406.1, Sep. 3, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
Search and Examination Report to Application No. GB 0318545.1, Sep. 3, 2003.
Search and Examination Report to Application No. GB 0318547.7; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.

Search and Examination Report to Application No. GB 0325072.7, Dec. 3, 2003.
Search and Examination Report to Application No. GB 0403891.5, Jun. 9, 2004.
Search and Examination Report to Application No. GB 0403893.1, Jun. 9, 2004.
Search and Examination Report to Application No. GB 0403894.9, Jun. 9, 2004.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Search and Examination Report to Application No. GB 0403926.9, Jun. 10, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Search and Examination Report to Application No. GB 0411698.4, Jun. 30, 2004.
Search and Examination Report to Application No. GB 0411892.3, Jul. 14, 2004.
Search and Examination Report to Application No. GB 0411893.1, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0412876.5, Sep. 27, 2005.
Search and Examination Report to Application No. GB 0416834.0, Aug 11, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3, Sep. 10, 2004.
Search and Examination Report to Application No. GB 0418427.1, Sep. 10, 2004.
Search and Examination Report to Application No. GB 0418429.7, Sep. 10, 2004.
Search and Examination Report to Application No. GB 0418430.5, Sep. 10, 2004.
Search and Examination Report to Application No. GB 0418431.3, Sep. 10, 2004.
Search and Examination Report to Application No. GB 0418432.1, Sep. 10, 2004.
Search and Examination Report to Application No. GB 0418433.9, Sep. 10, 2004.
Search and Examination Report to Application No. GB 0418439.6, Sep. 10, 2004.
Search and Examination Report to Application No. GB 0418442.0, Sep. 10, 2004.
Search and Examination Report to Application No. GB 0422893.8, Nov 24, 2004.
Search and Examination Report to Application No. GB 0423416.7, Nov. 12, 2004.
Search and Examination Report to Application No. GB 0423417.5, Nov. 12, 2004.
Search and Examination Report to Application No. GB 0423418.3, Nov. 12, 2004.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 0426155.8, Jan. 12, 2005.
Search and Examination Report to Application No. GB 0426156.6, Jan. 12, 2005.
Search and Examination Report to Application No. GB 0426157.4, Jan. 12, 2005.
Search and Examination Report to Application No. GB 0500600.2, Feb. 15, 2005.
Search and Examination Report to Application No. GB 0503470.7, Mar. 21, 2005.
Search and Examination Report to Application No. GB 0505039.8, Jul. 22, 2005.
Search and Examination Report to Application No. GB 0506697.2, May 20, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.

Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522155.1, Mar. 7, 2006.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Examination Report to Application No. AU 2003257878, Jan. 19, 2006.
Examination Report to Application No. AU 2003257881, Jan. 19, 2006.
Search Report to Application No. EP 02806451.7; Feb. 9, 2005.
Search Report to Application No. EP 03071281.2; Nov. 14, 2005.
Search Report to Application No. EP 03723674.2; Nov. 22, 2005.
Search Report to Application No. EP 03728326.4; Mar. 13, 2006.
Search Report to Application No. EP 03752486.5; Feb. 8, 2006.
Search Report to Application No. EP 03759400.9; Mar. 3, 2006.
Search Report to Application No. Norway 1999 5593, Aug. 20, 2002.

*Fig. 11A1*
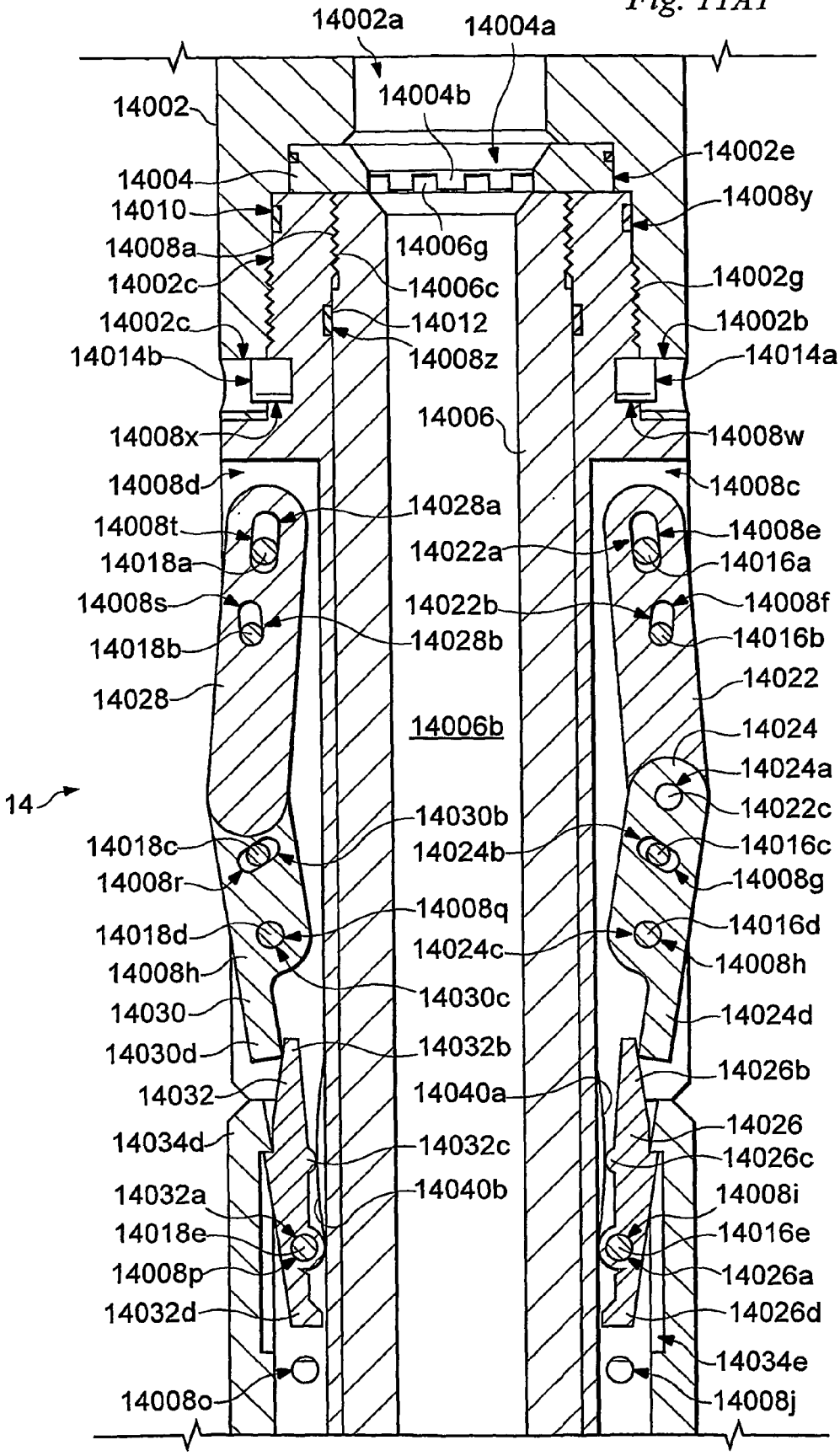

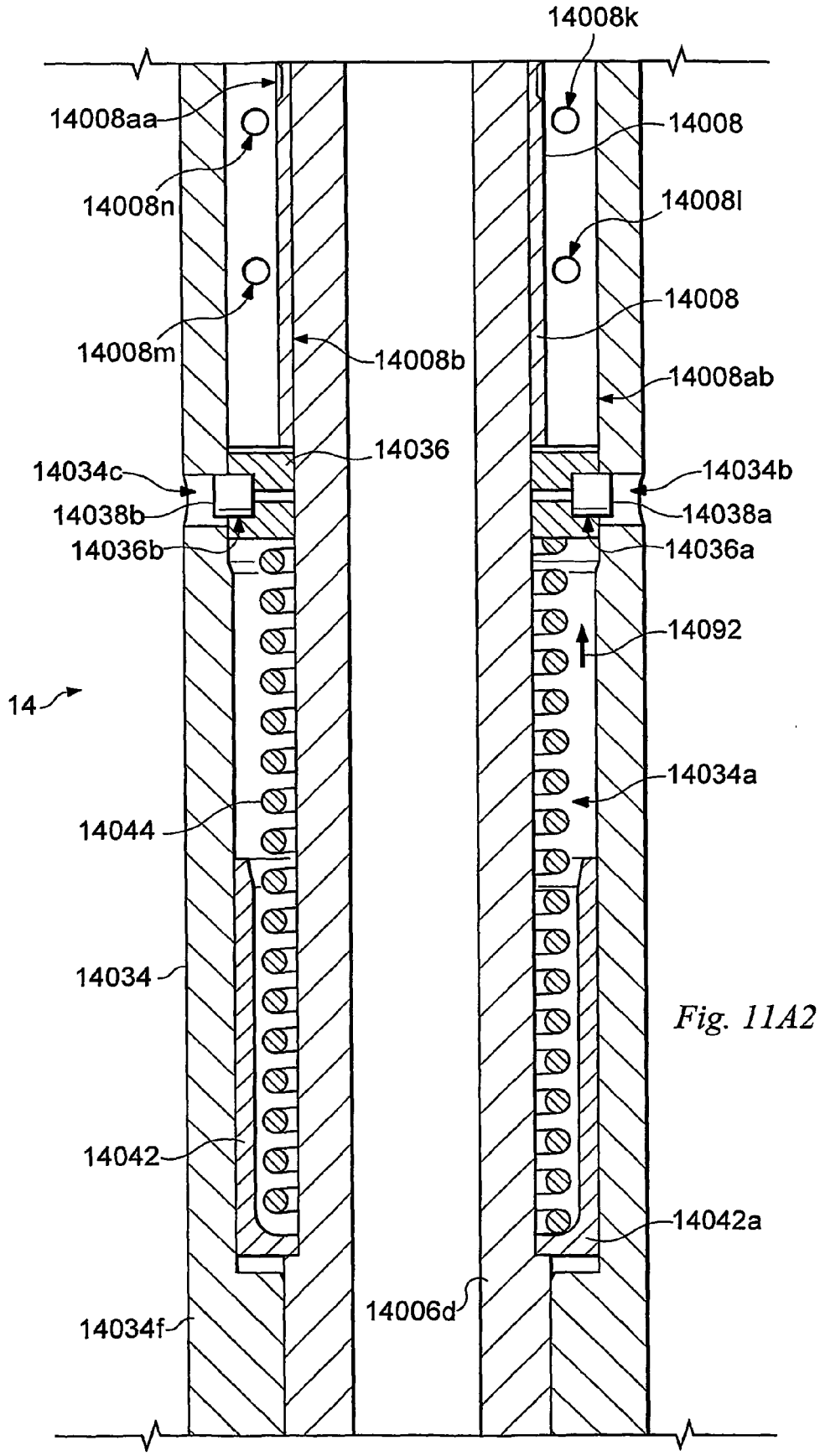
Fig. 11A2

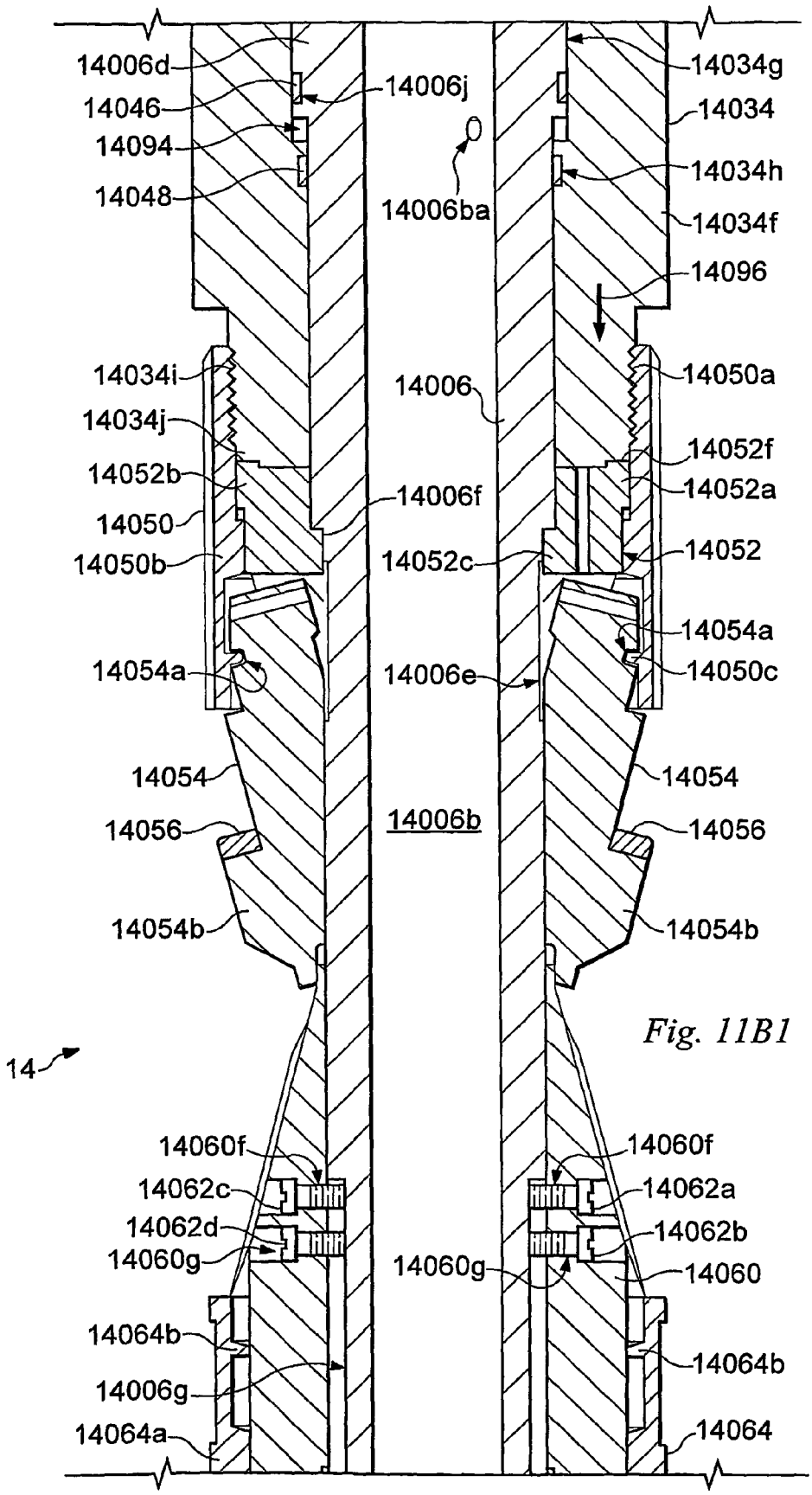
*Fig. 11B1*

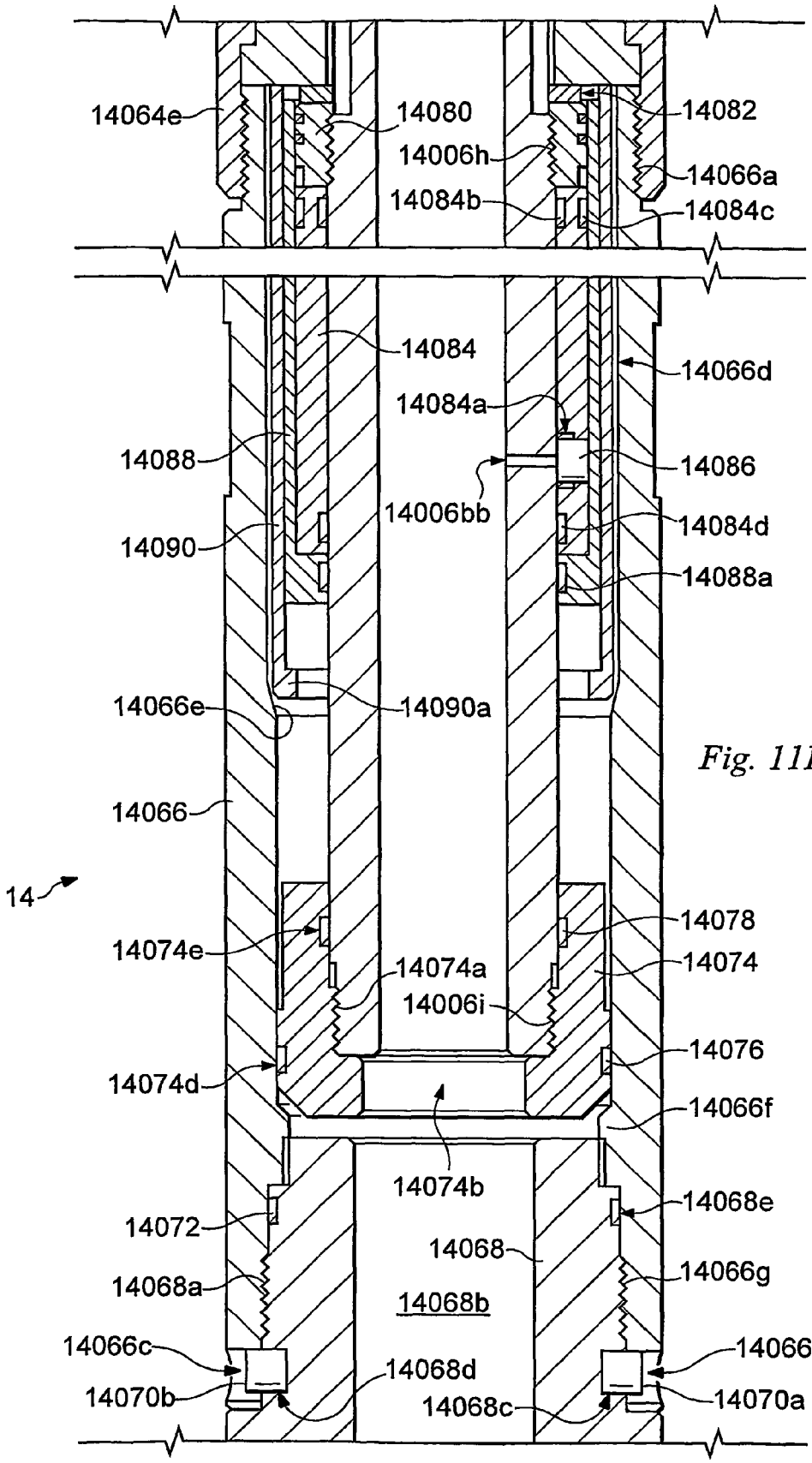
*Fig. 11B2*

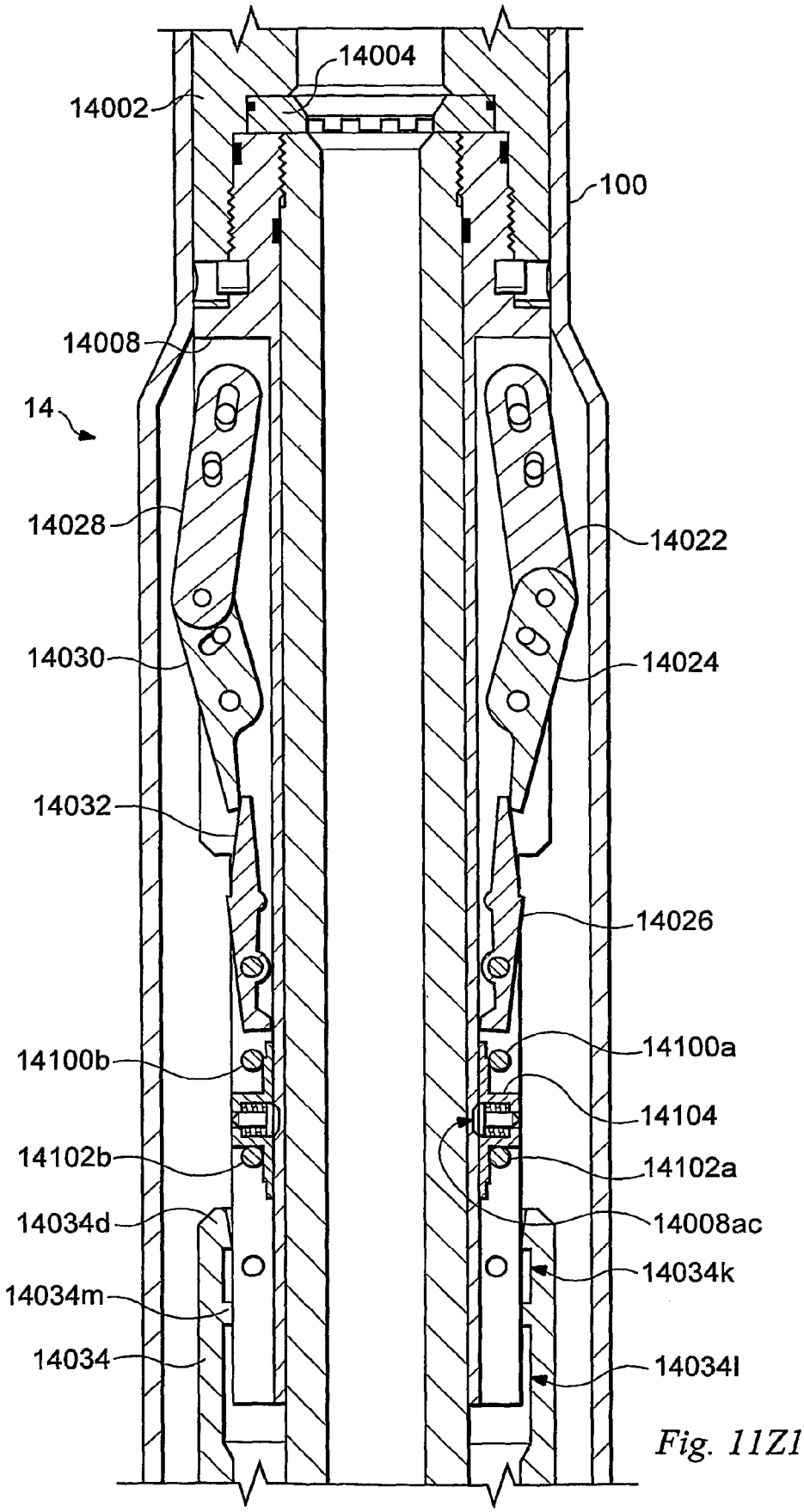
*Fig. 11Z1*

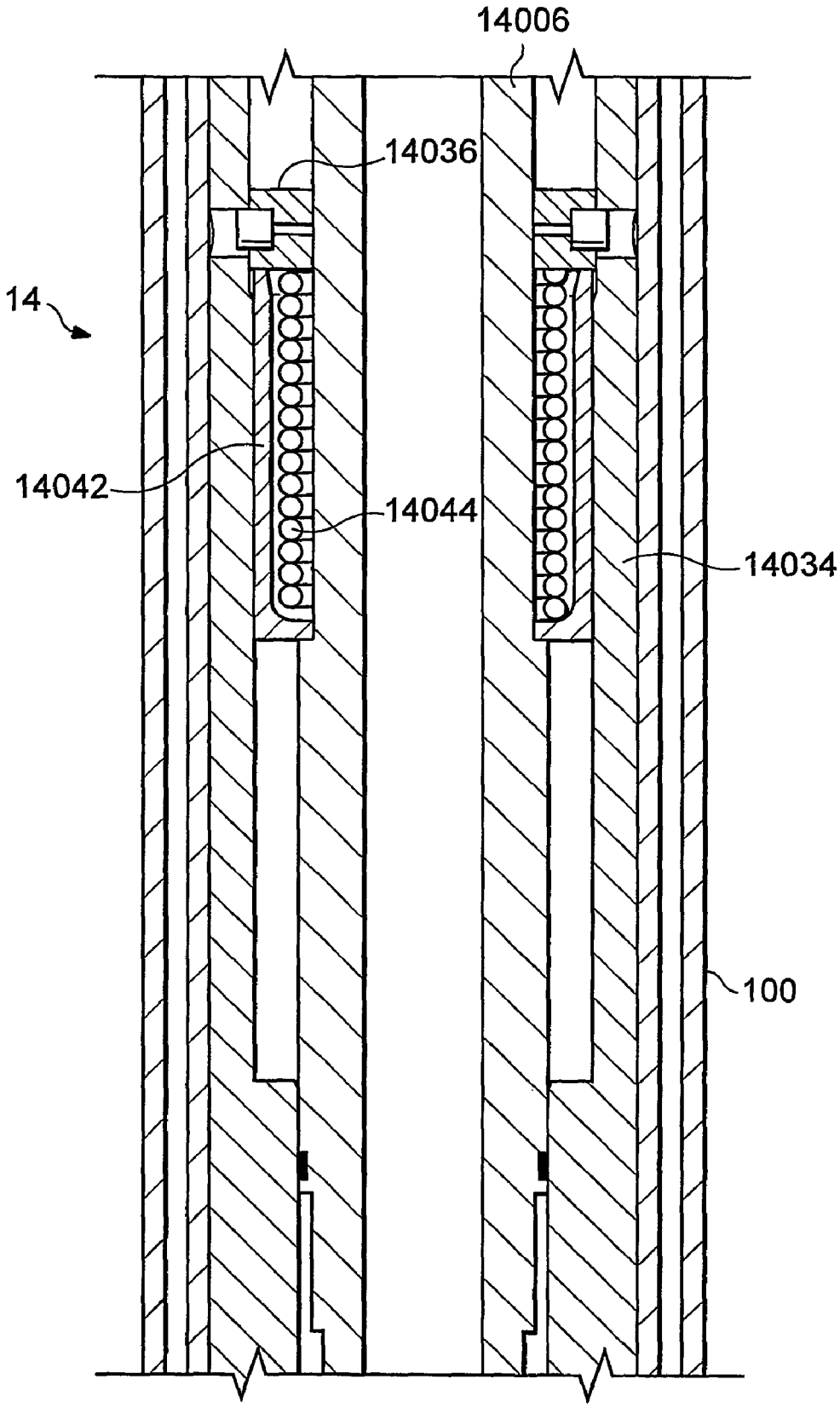
*Fig. 11Z2*

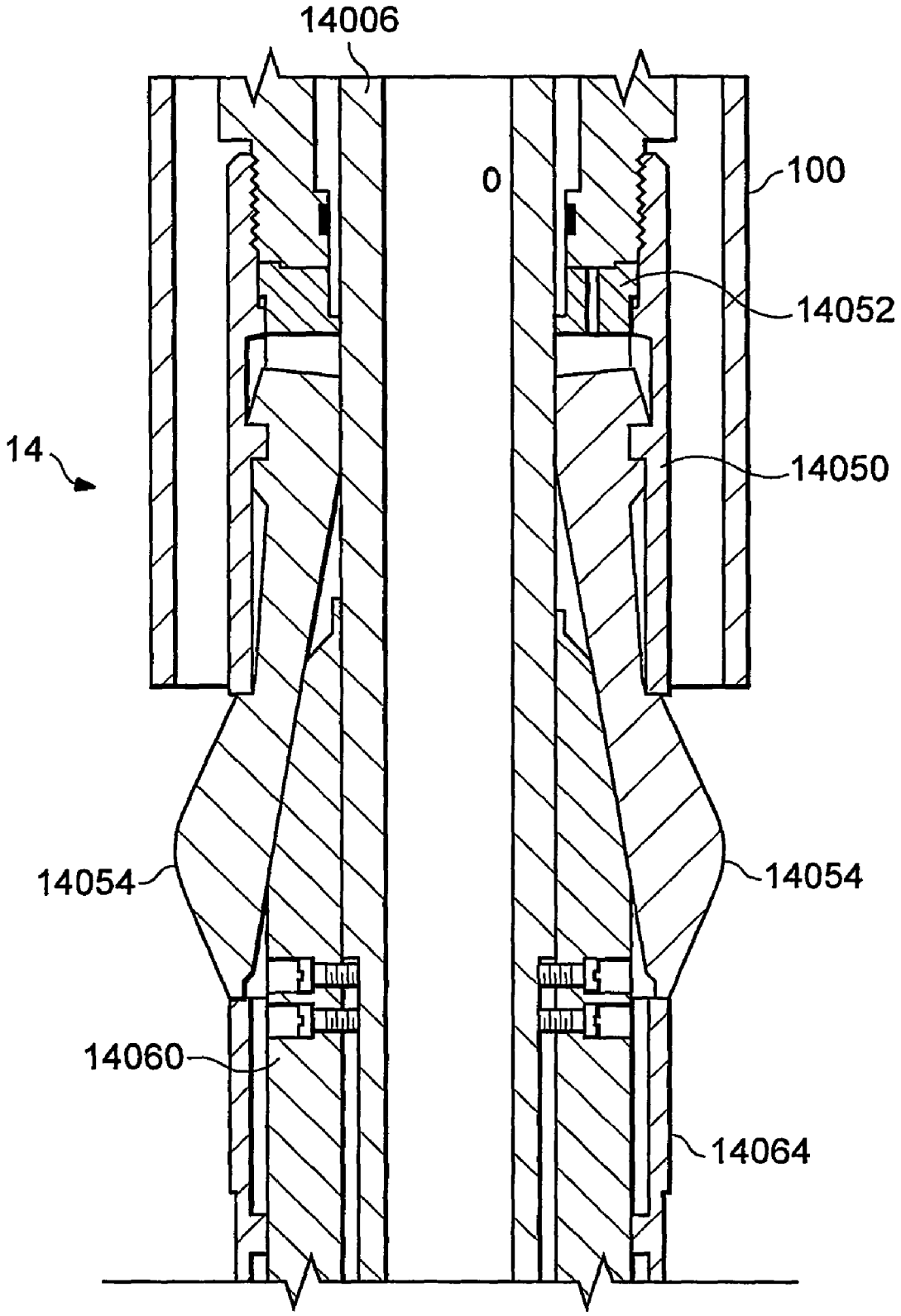
*Fig. 11Z3*

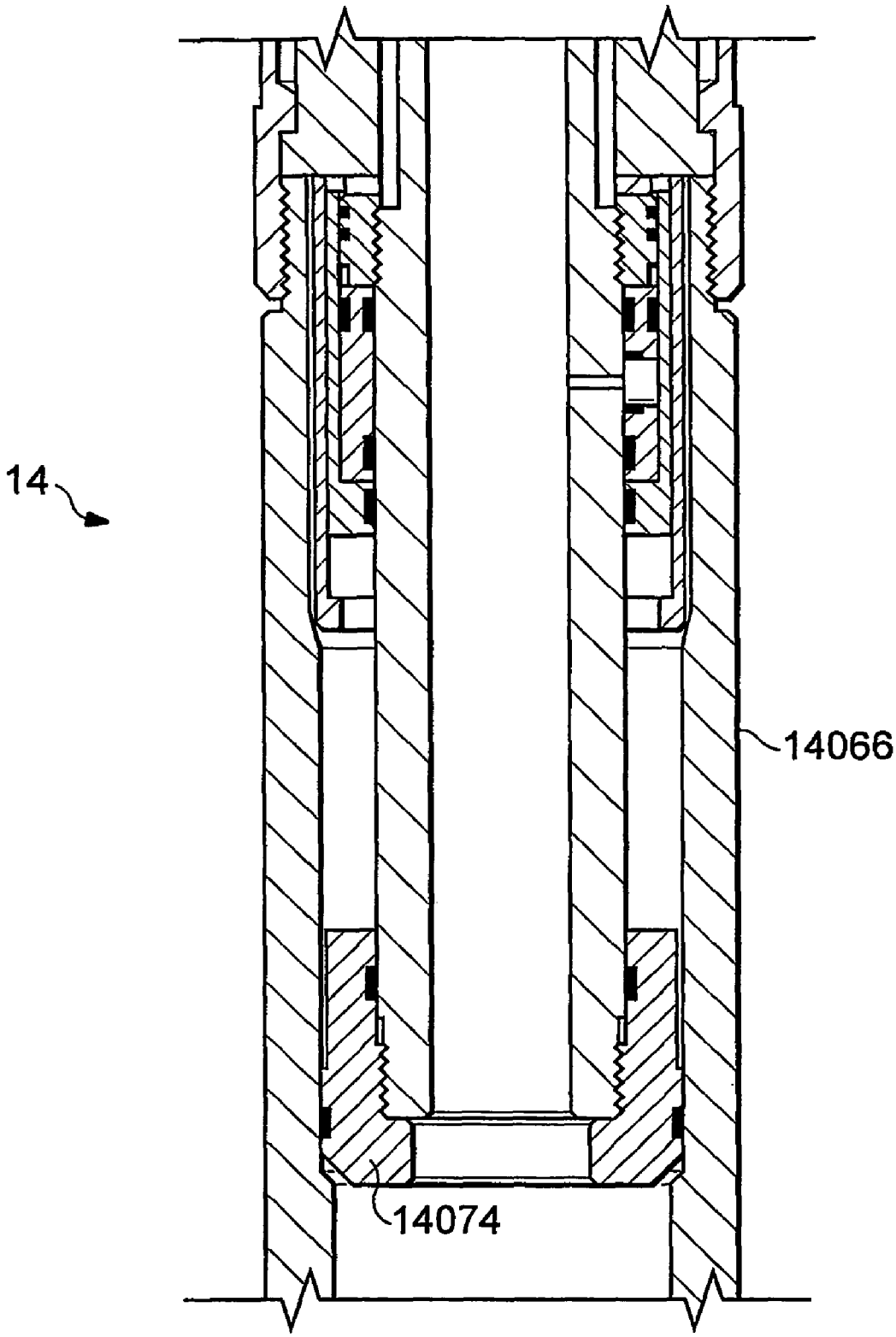
*Fig. 11Z4*

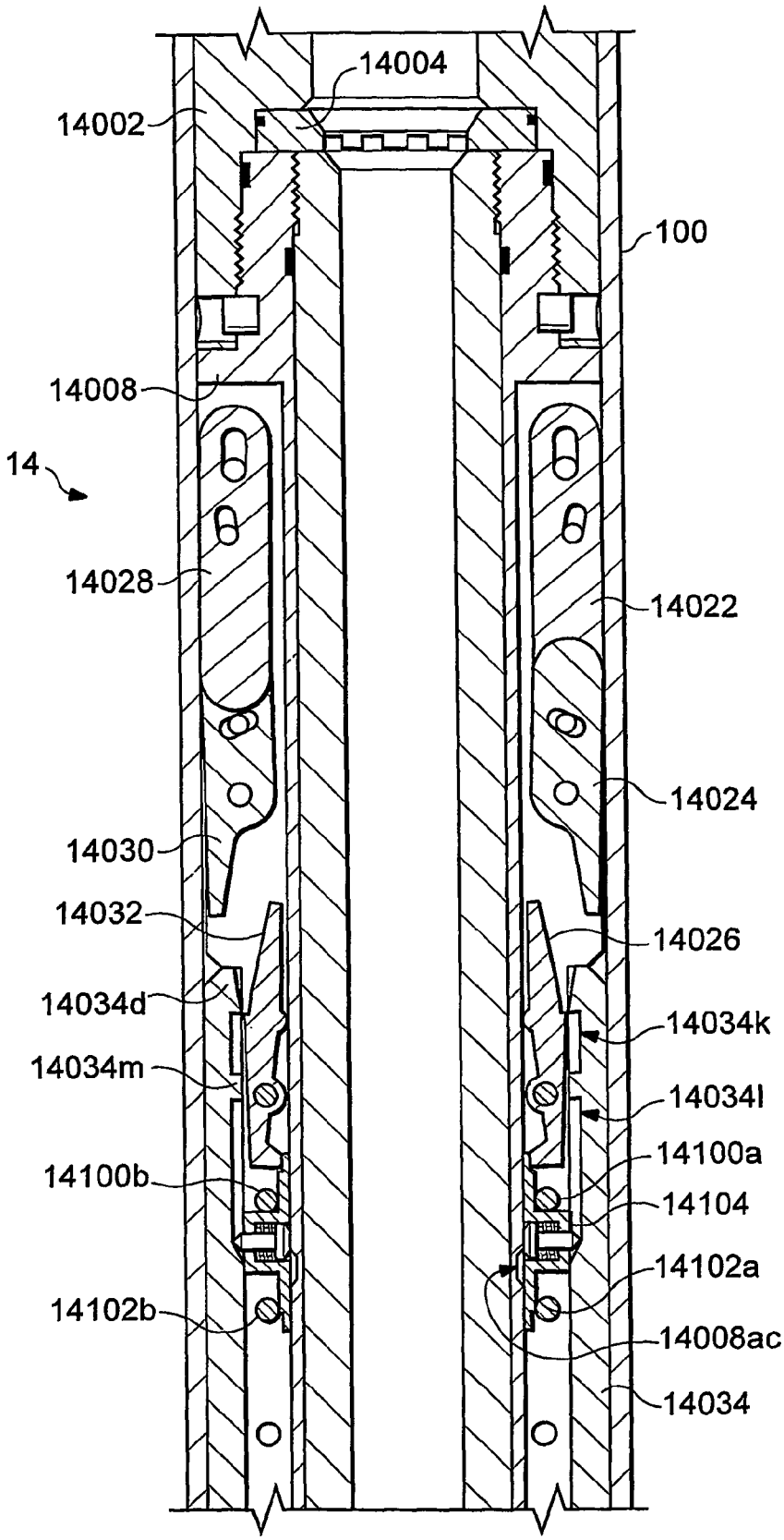
*Fig. 11AA1*

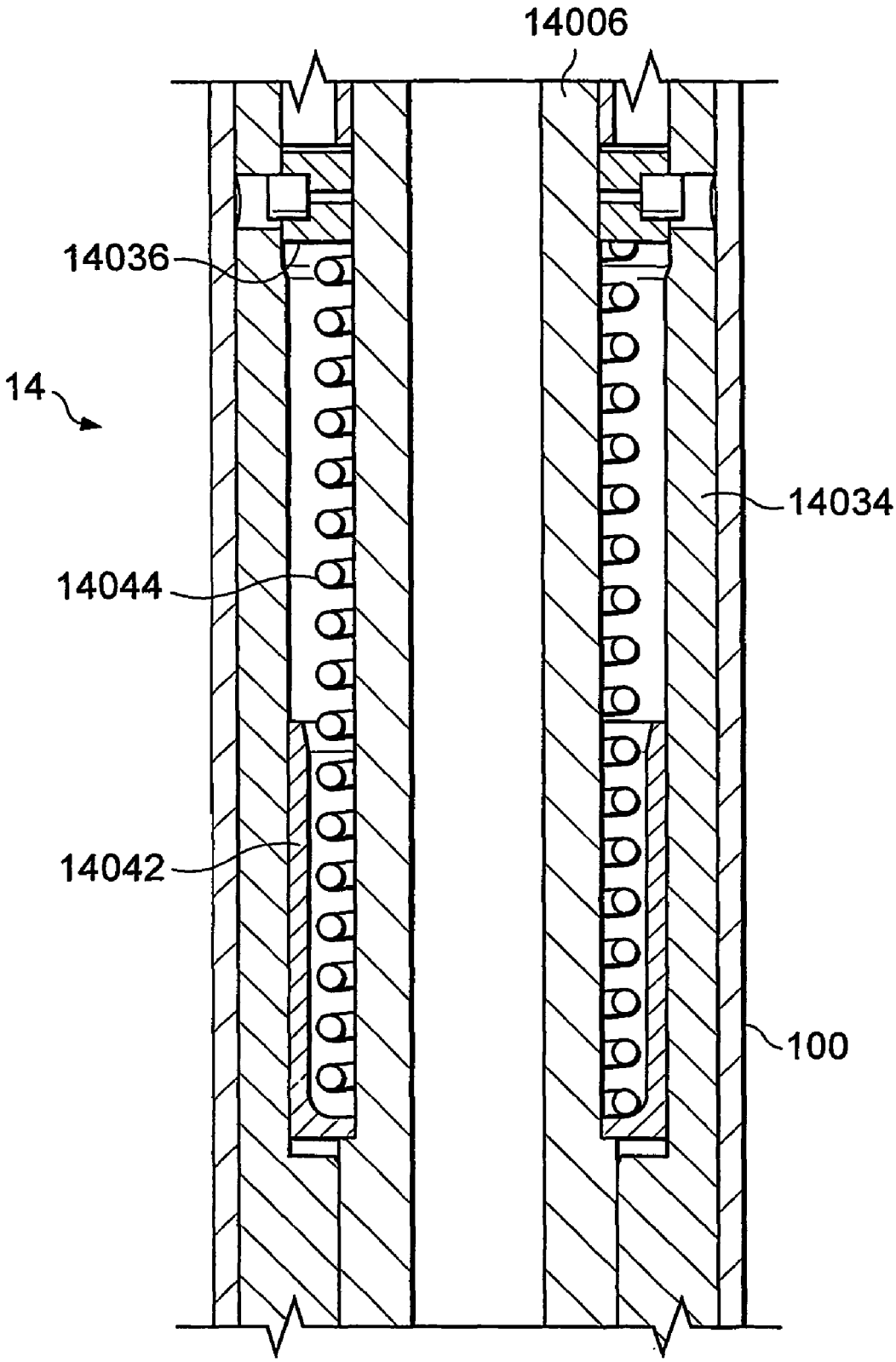
*Fig. 11AA2*

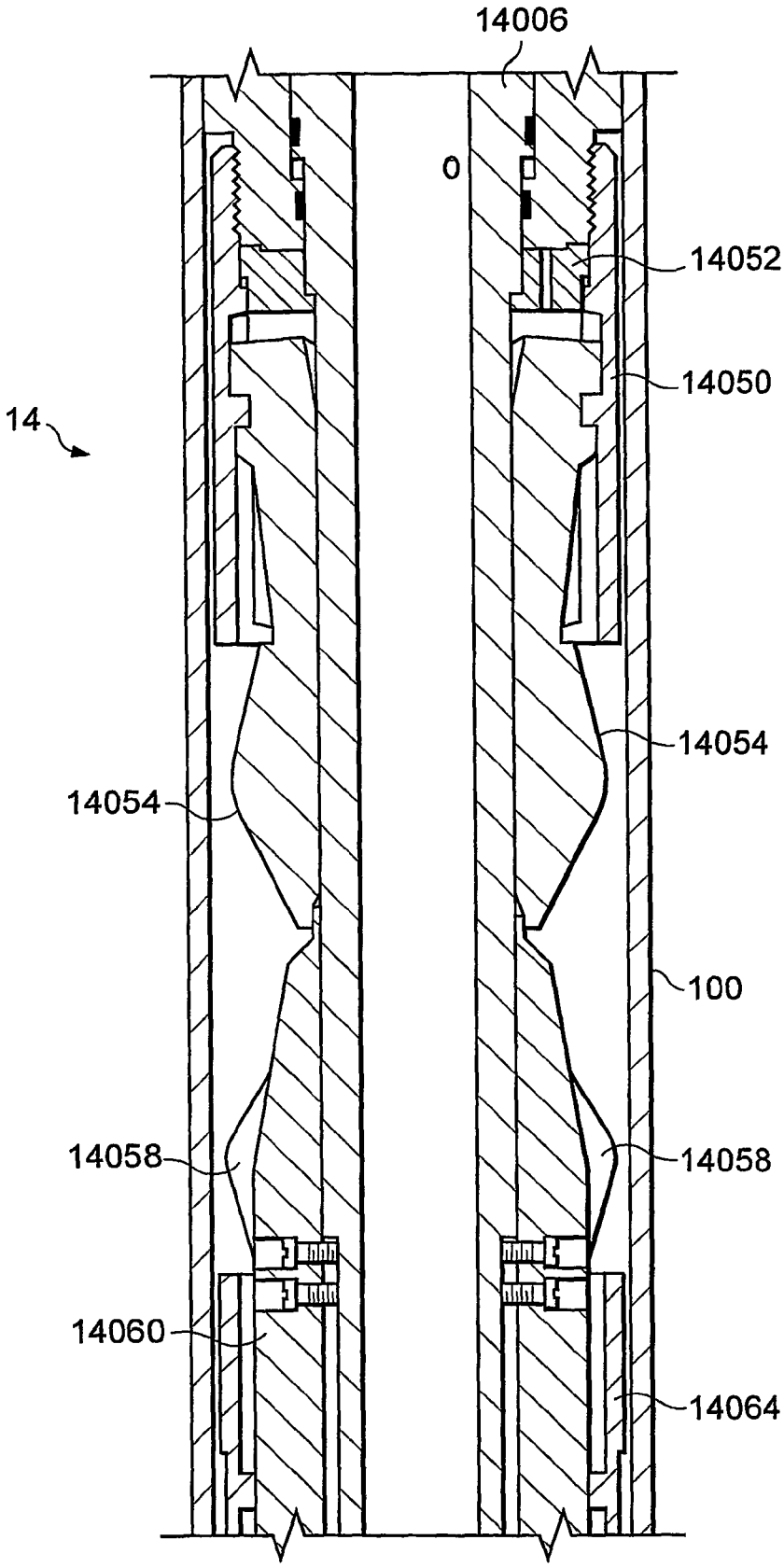
*Fig. 11AA3*

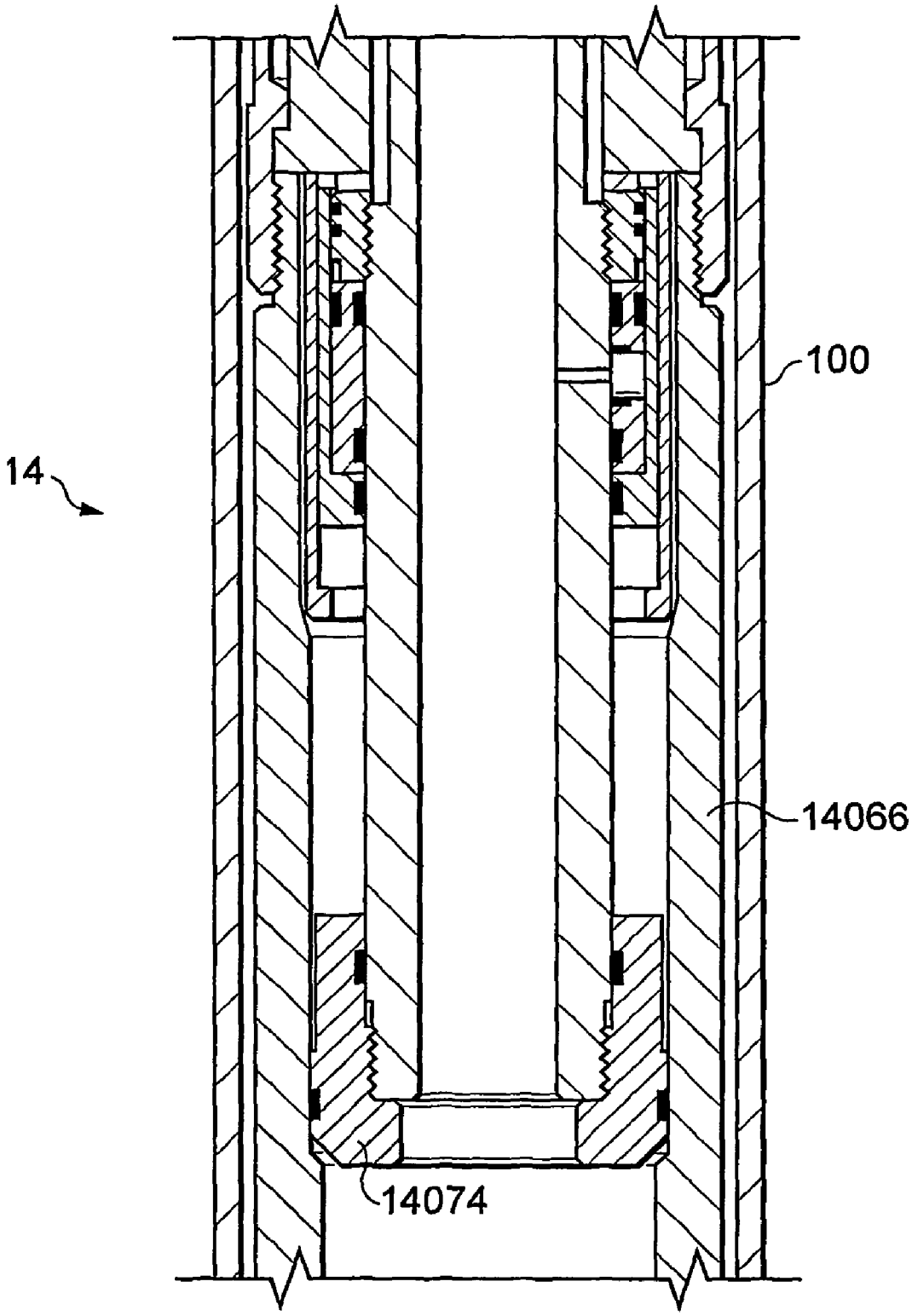
*Fig. 11AA4*

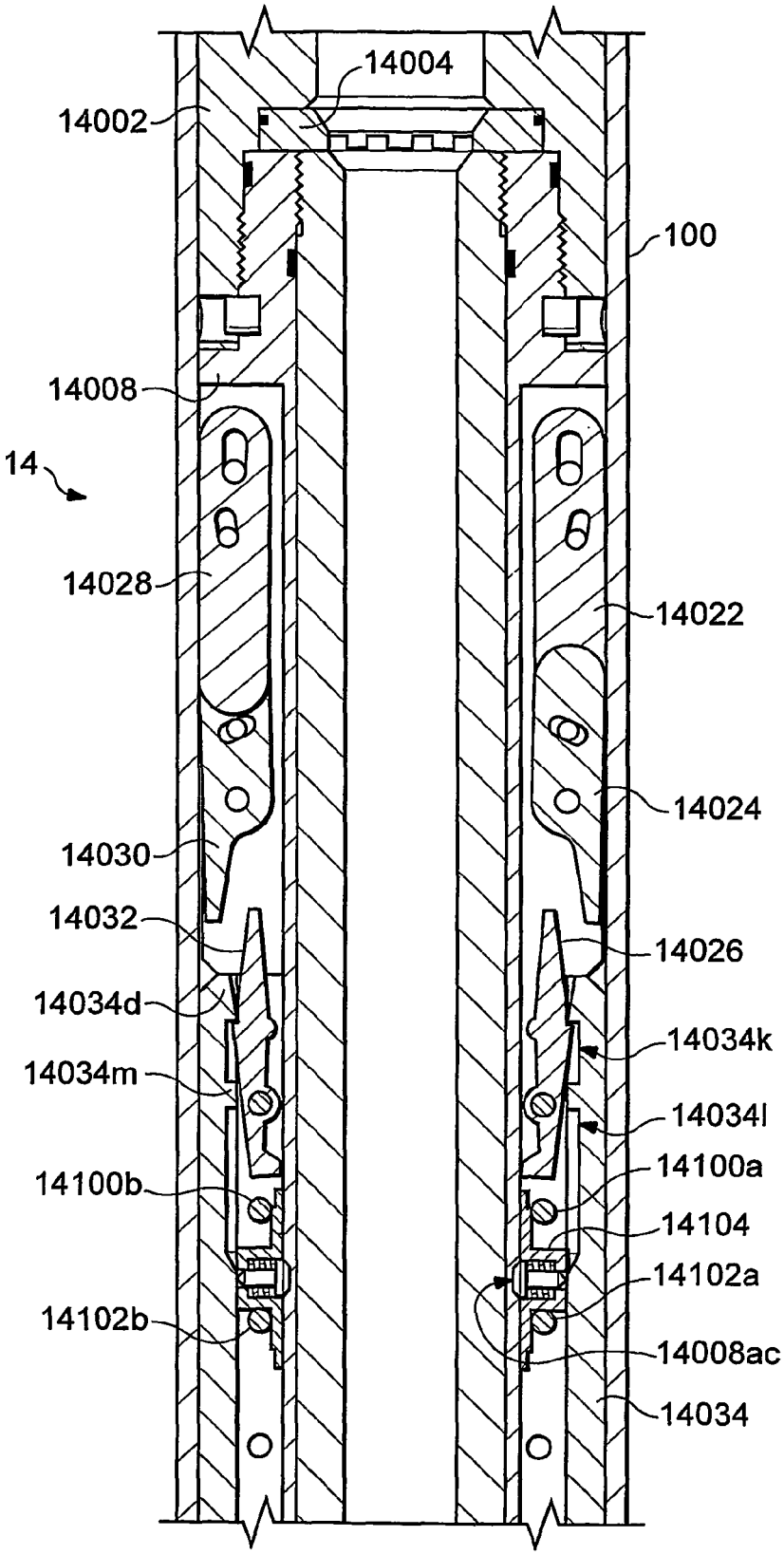
*Fig. 11AB1*

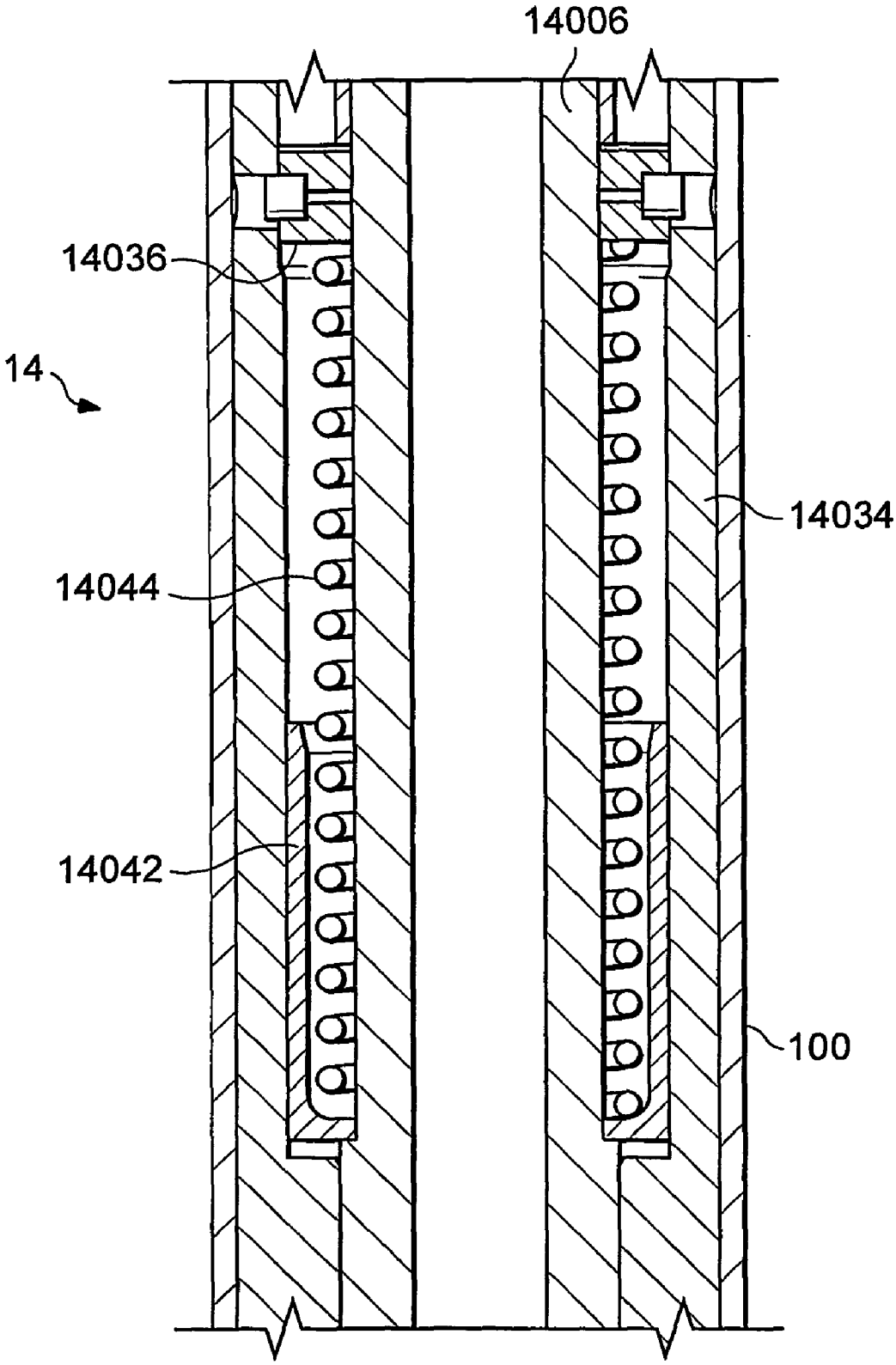
*Fig. 11AB2*

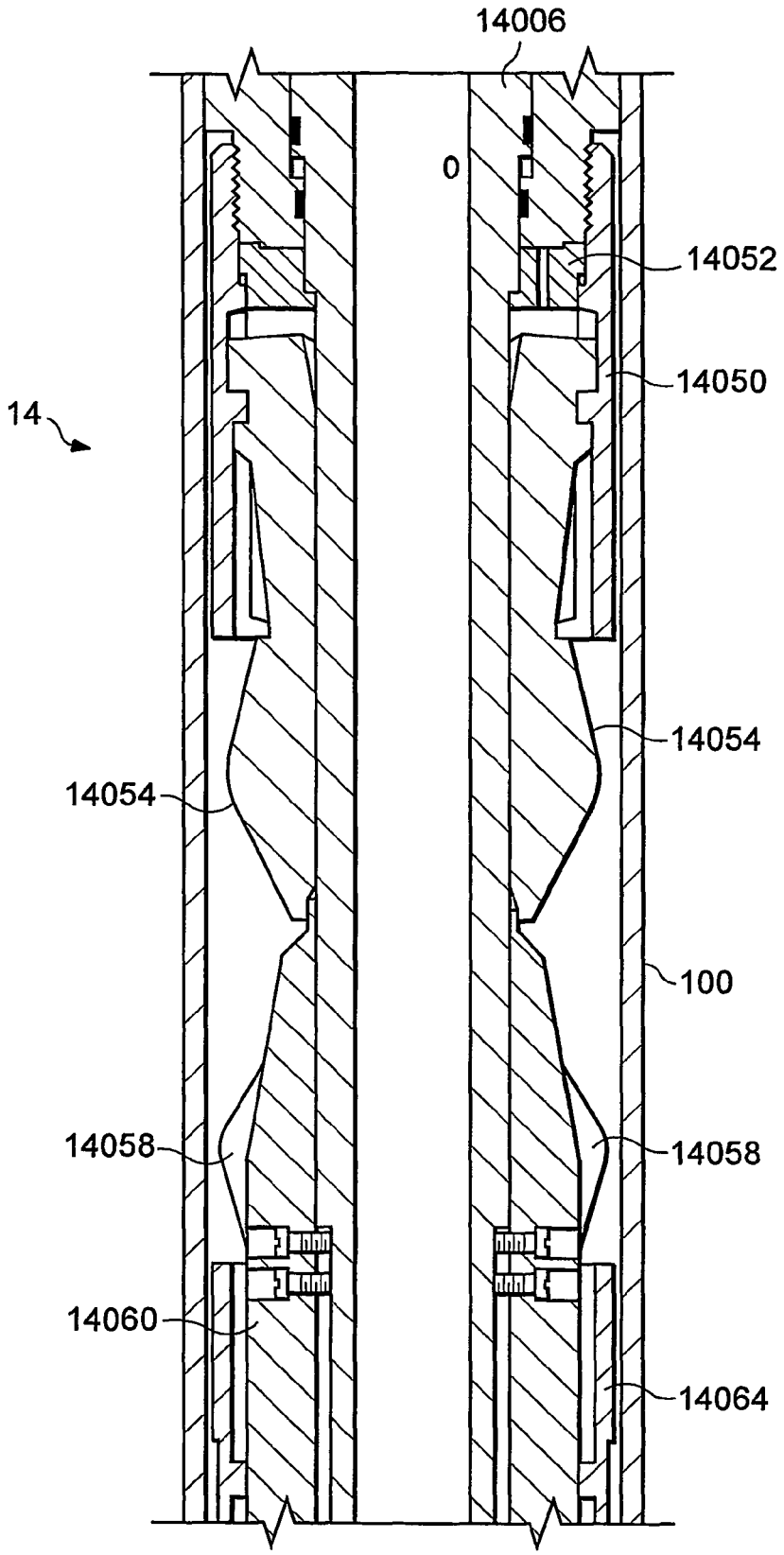
*Fig. 11AB3*

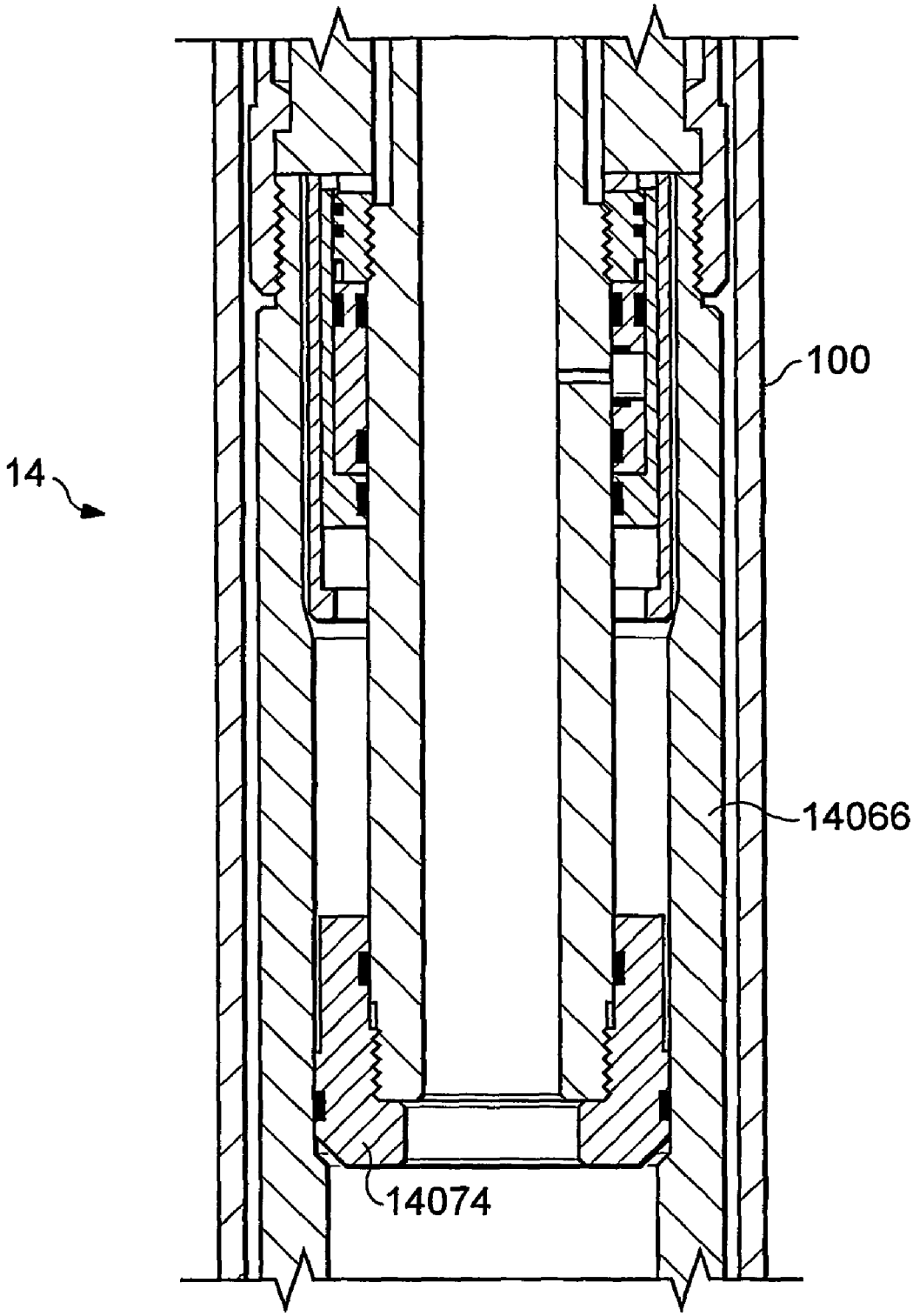
*Fig. 11AB4*

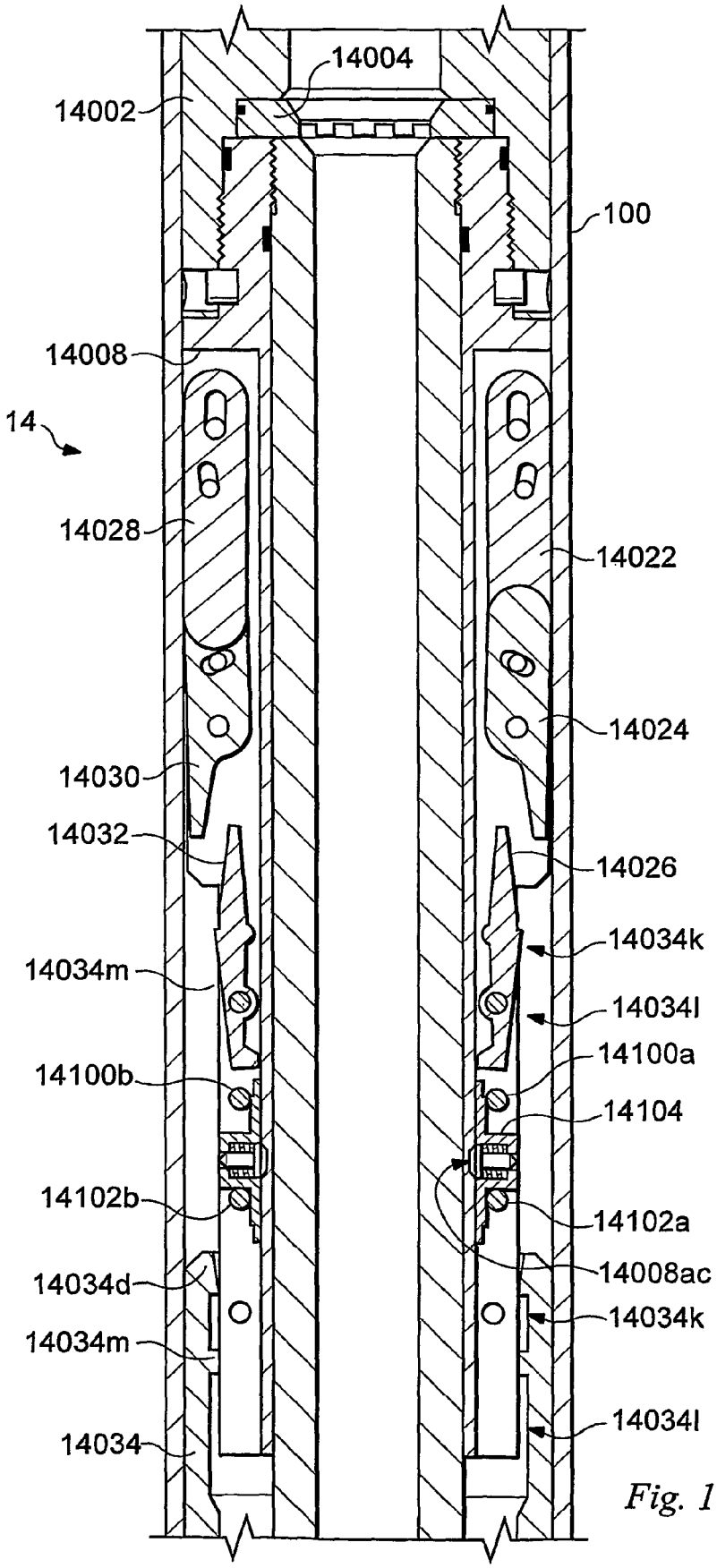
*Fig. 11AC1*

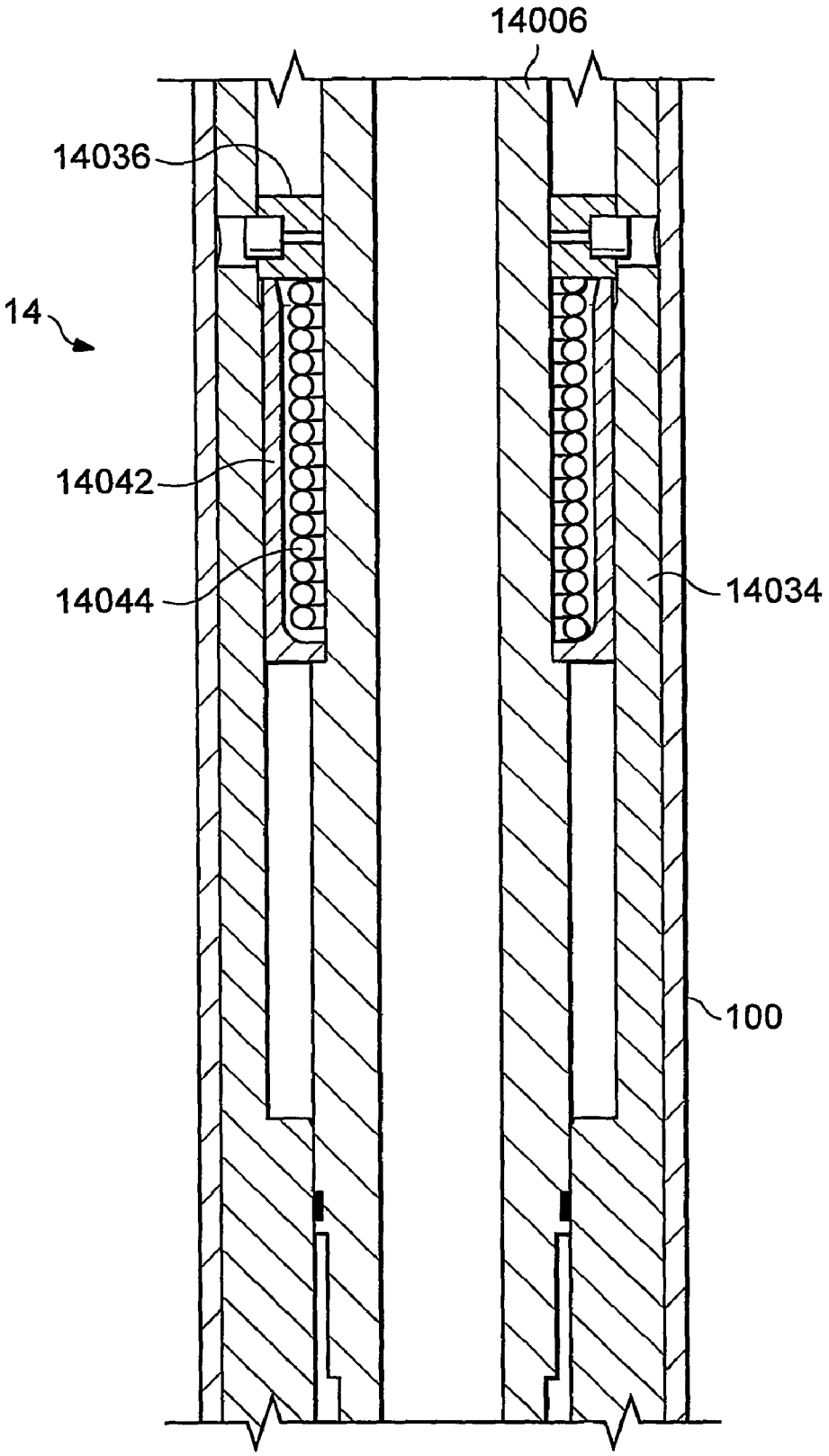
*Fig. 11AC2*

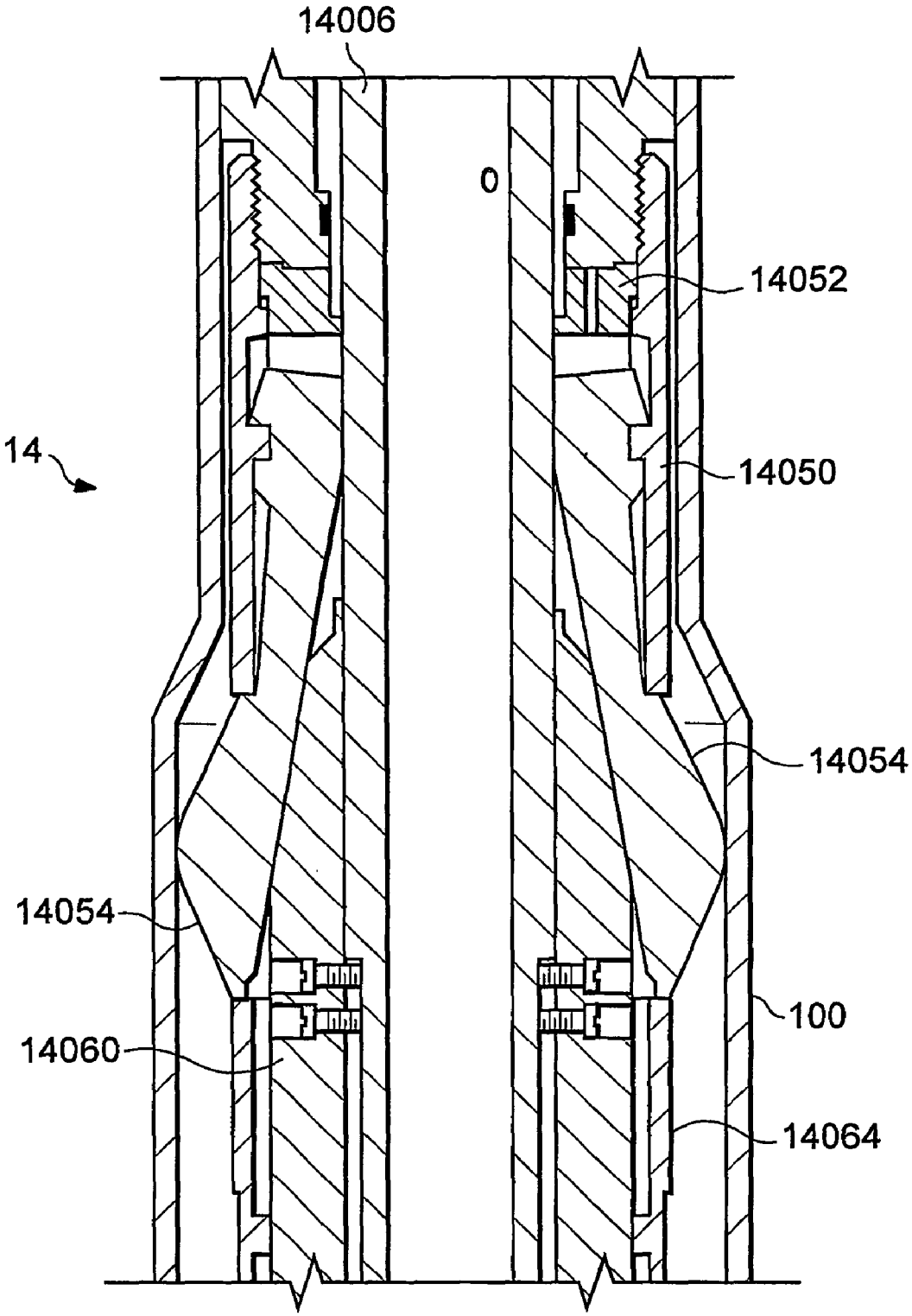
*Fig. 11AC3*

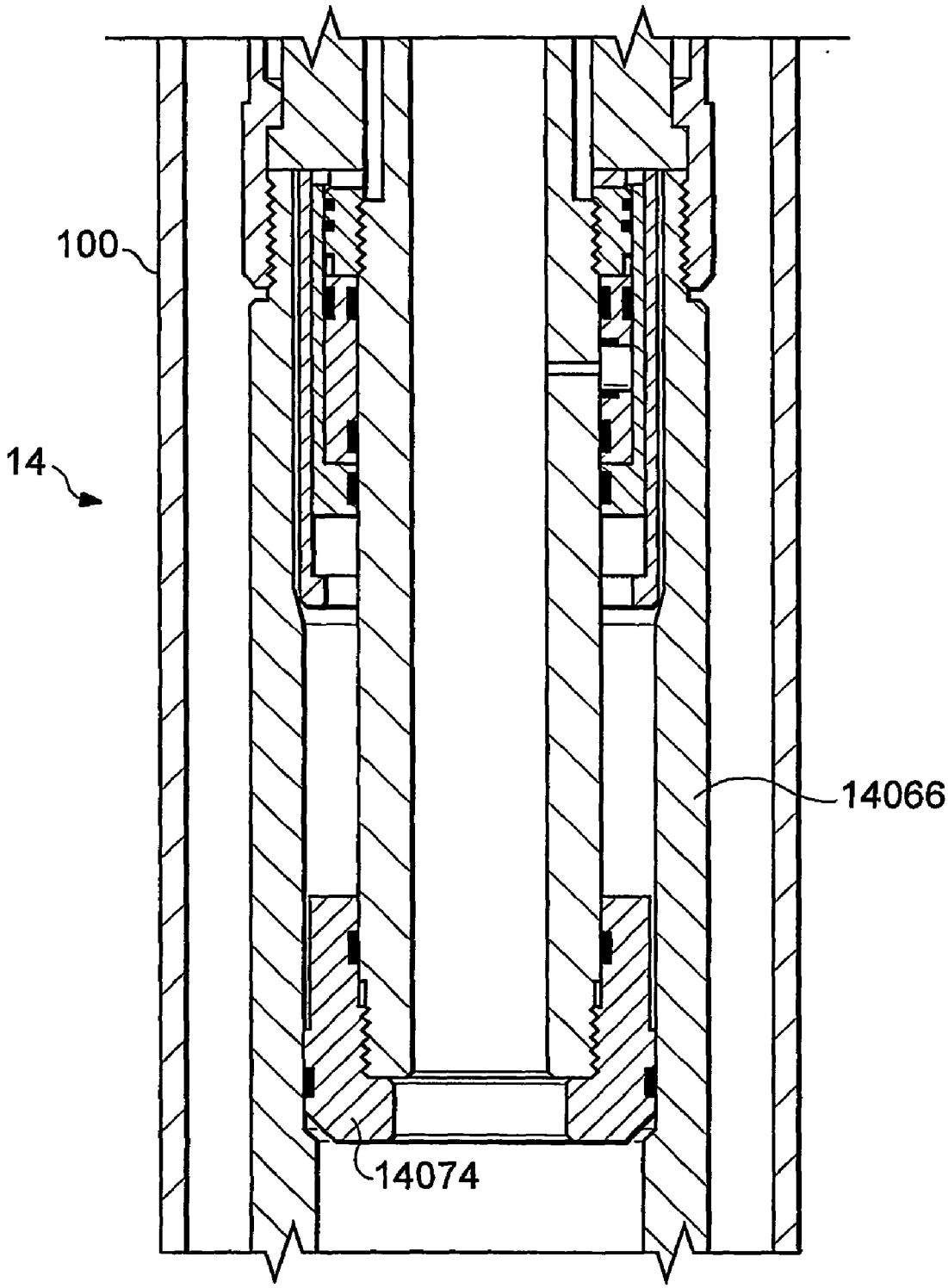
*Fig. 11AC4*

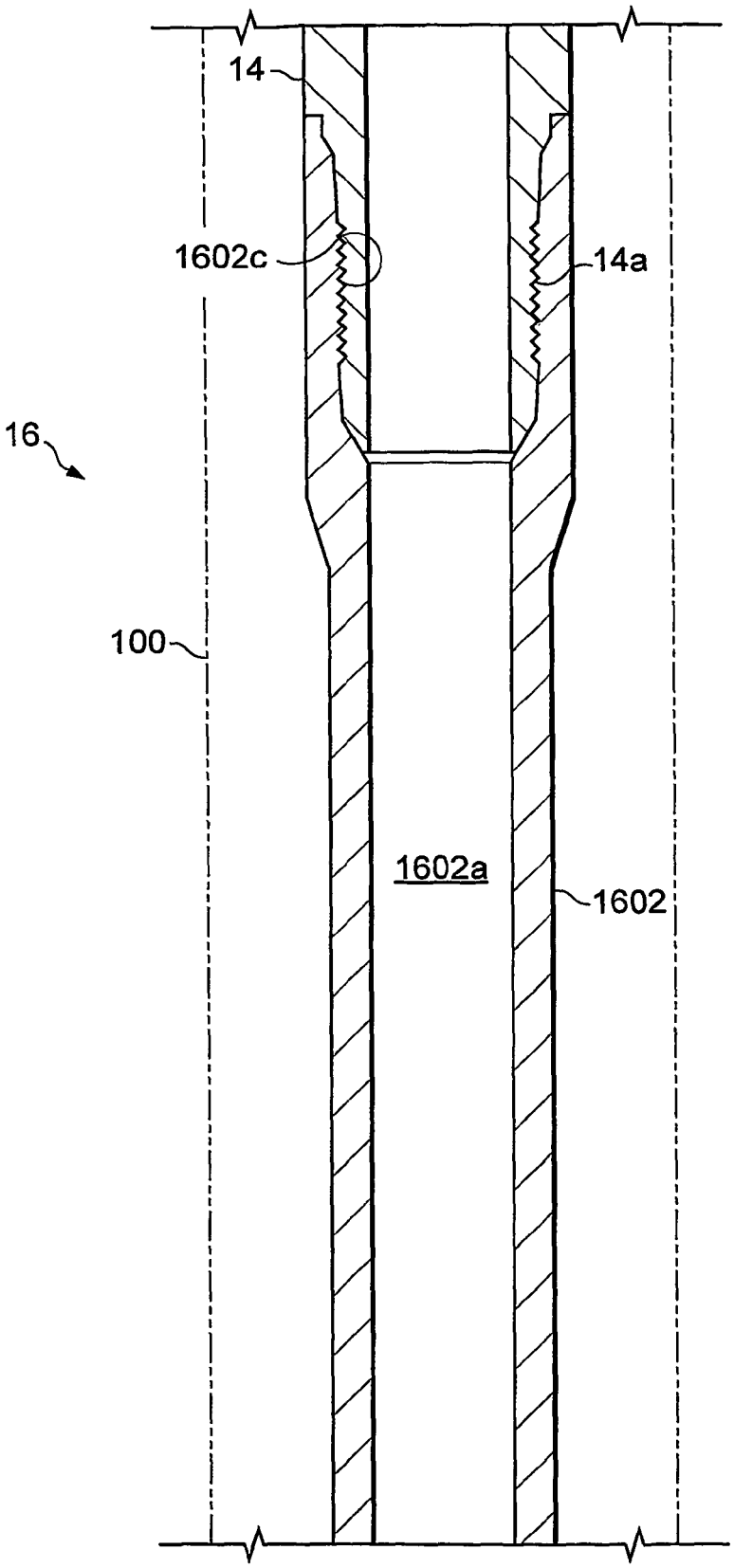
*Fig. 12A1*

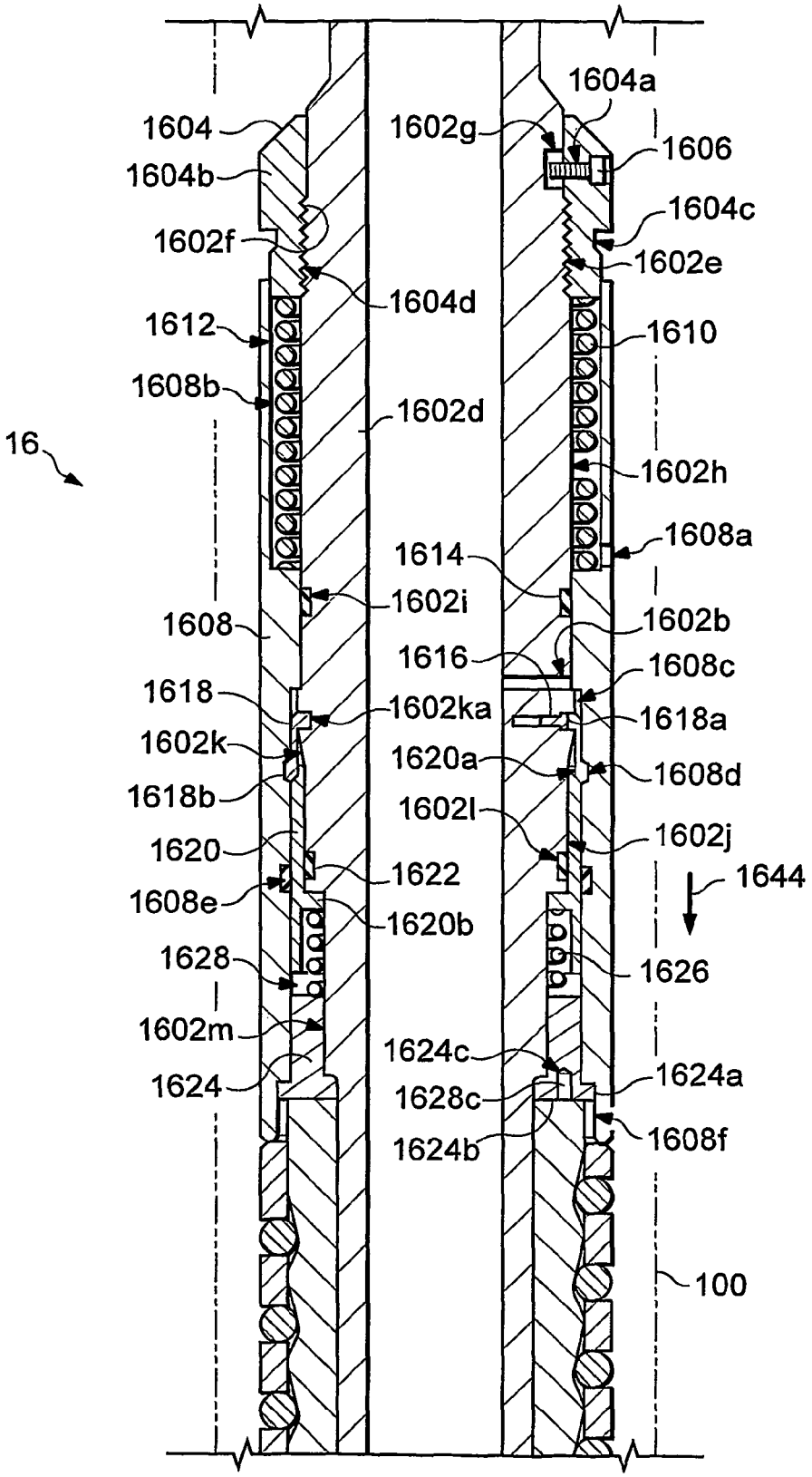
*Fig. 12A2*

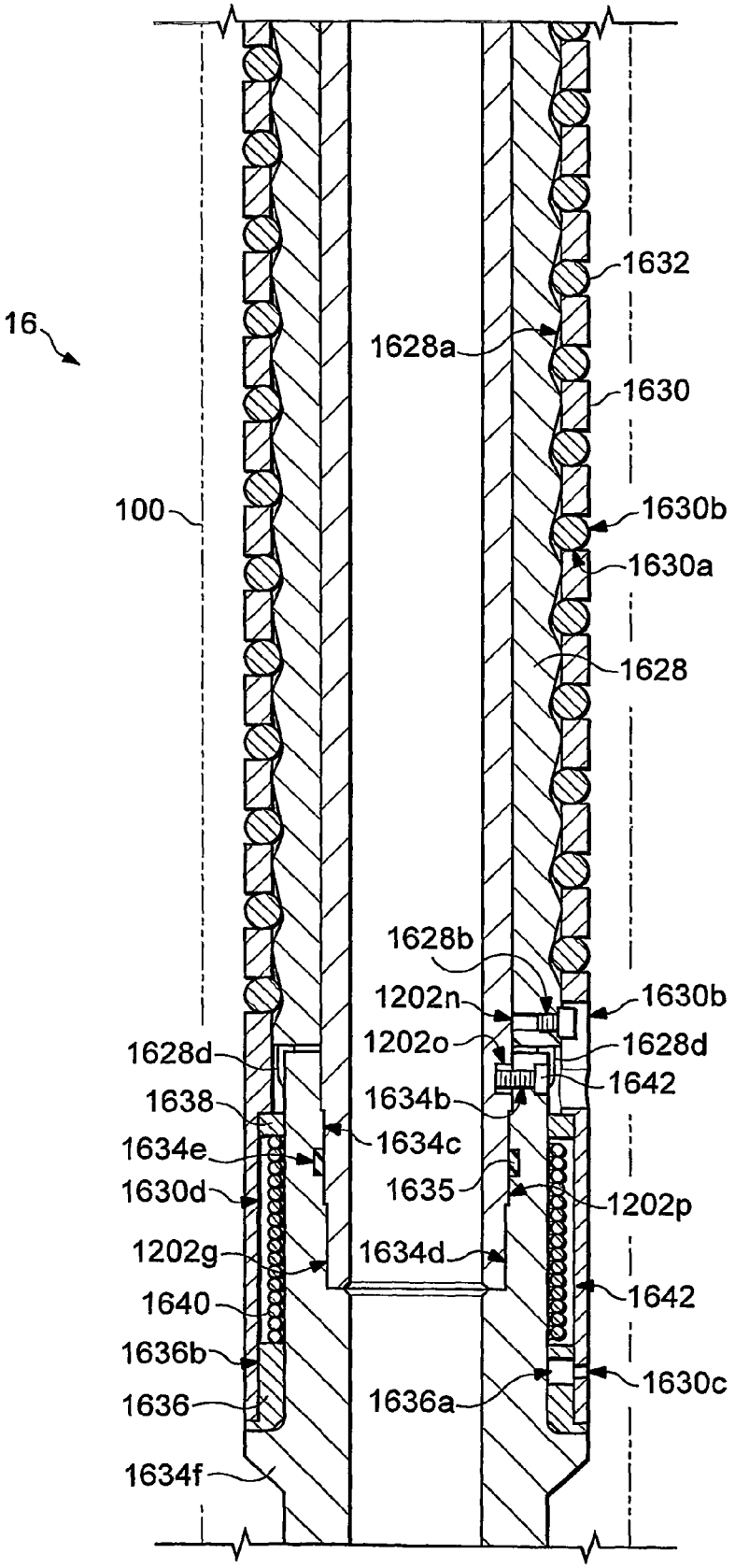
*Fig. 12A3*

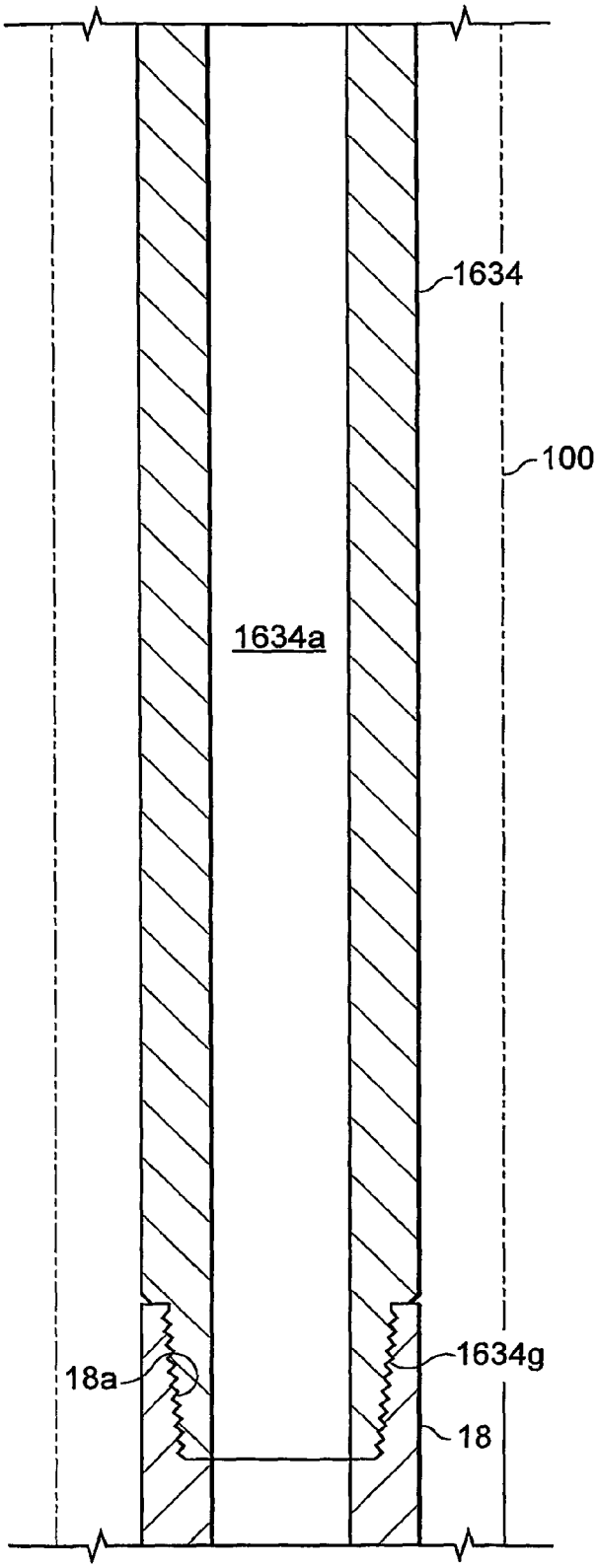
Fig. 12A4
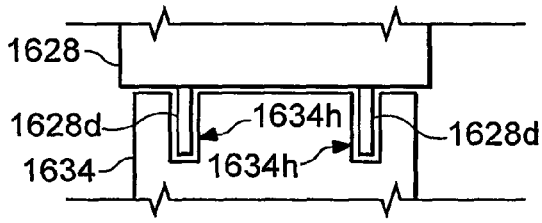
Fig. 12B

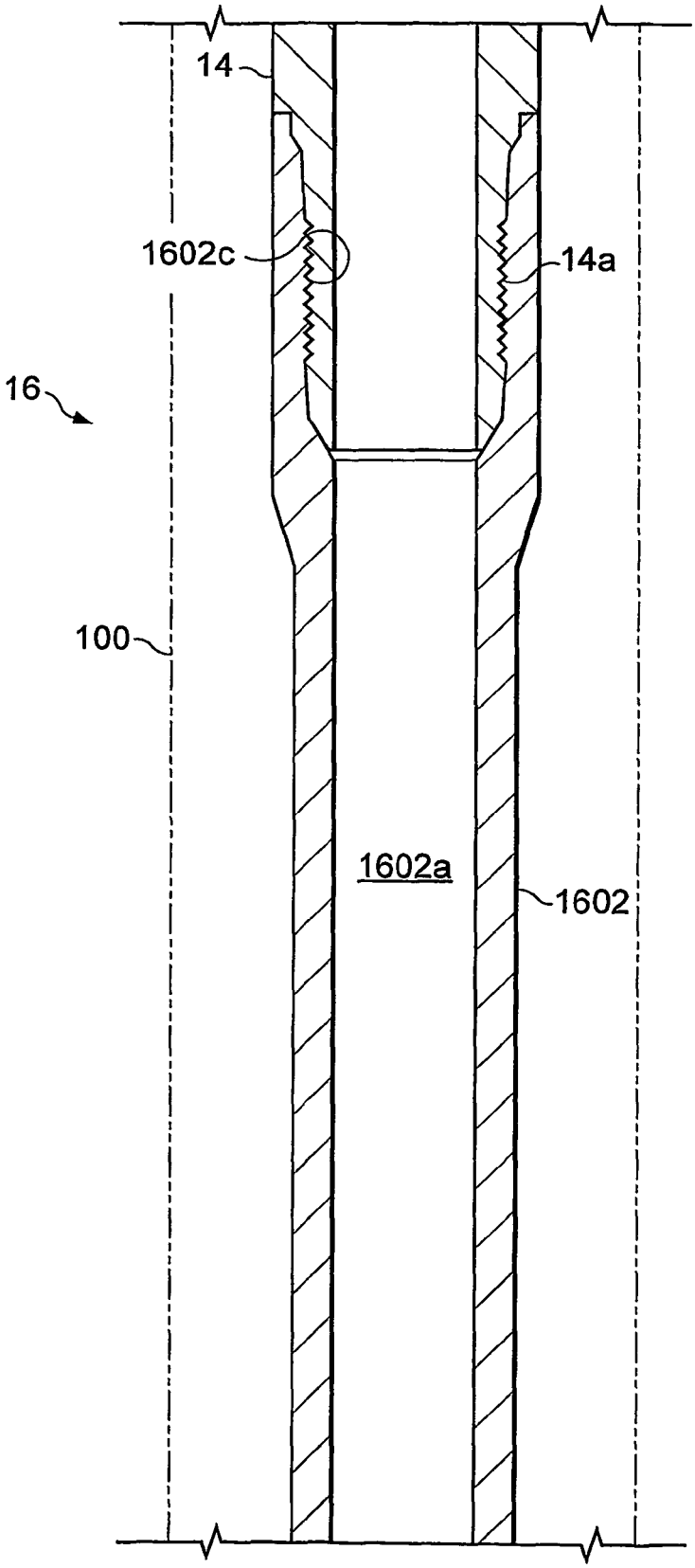
*Fig. 12C1*

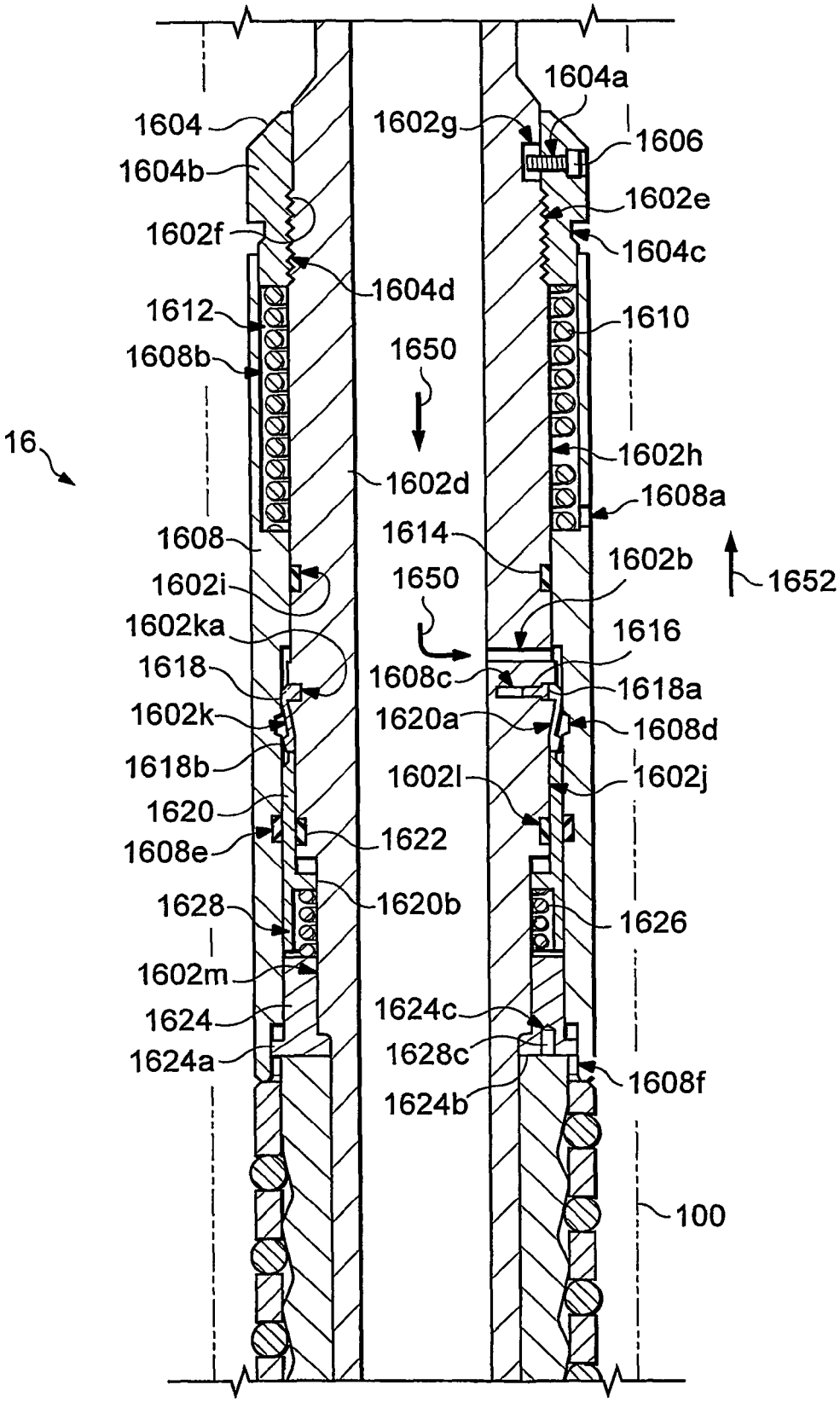
*Fig. 12C2*

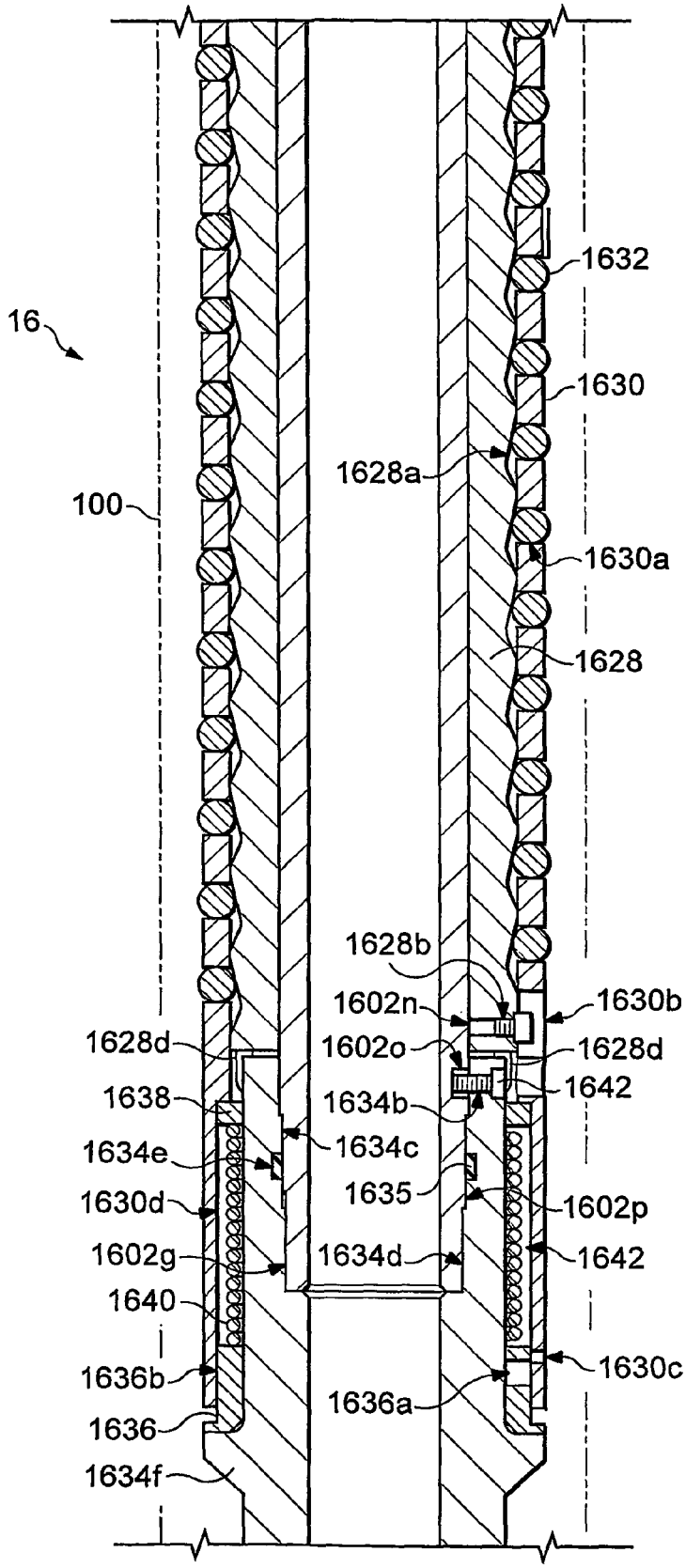
*Fig. 12C3*

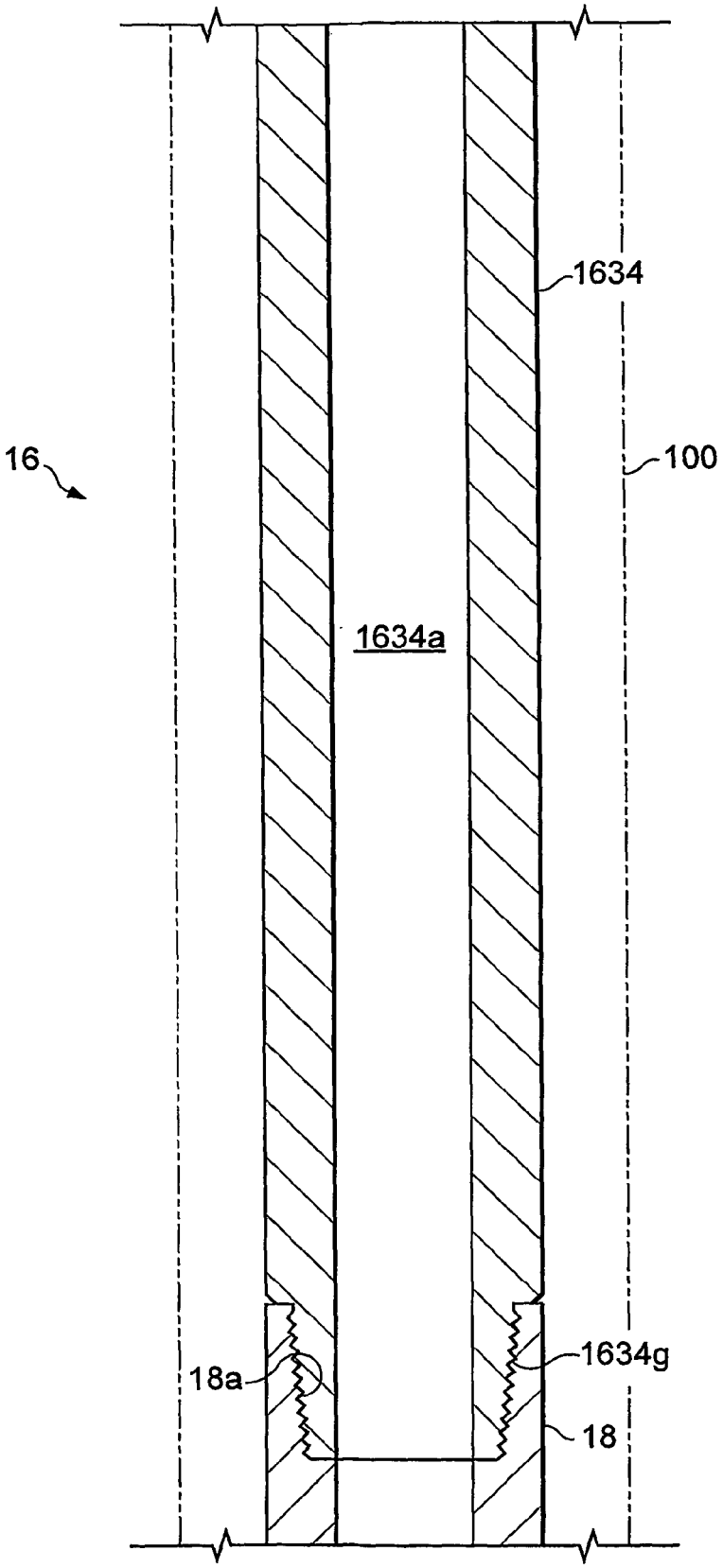
*Fig. 12C4*

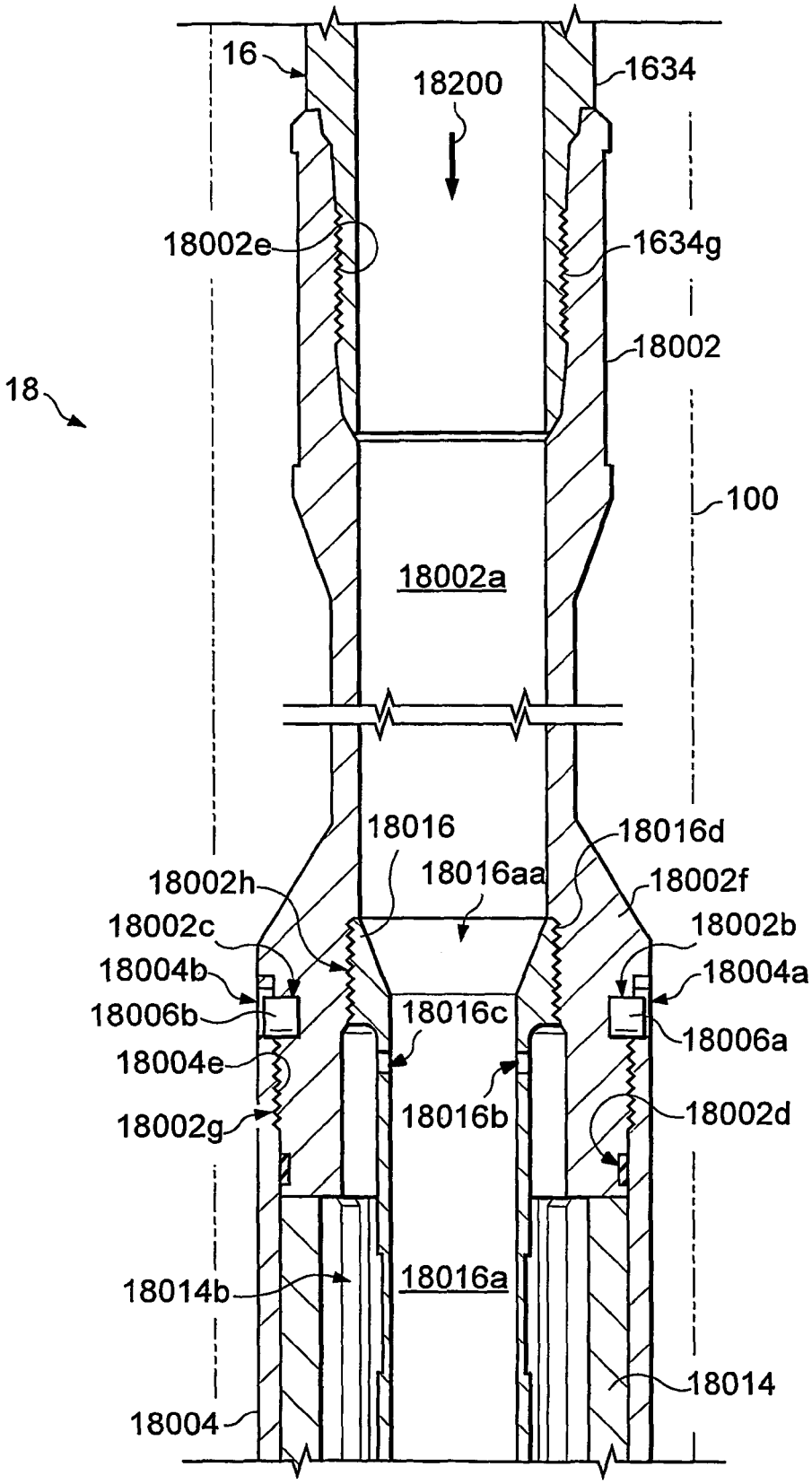
*Fig. 13A1*

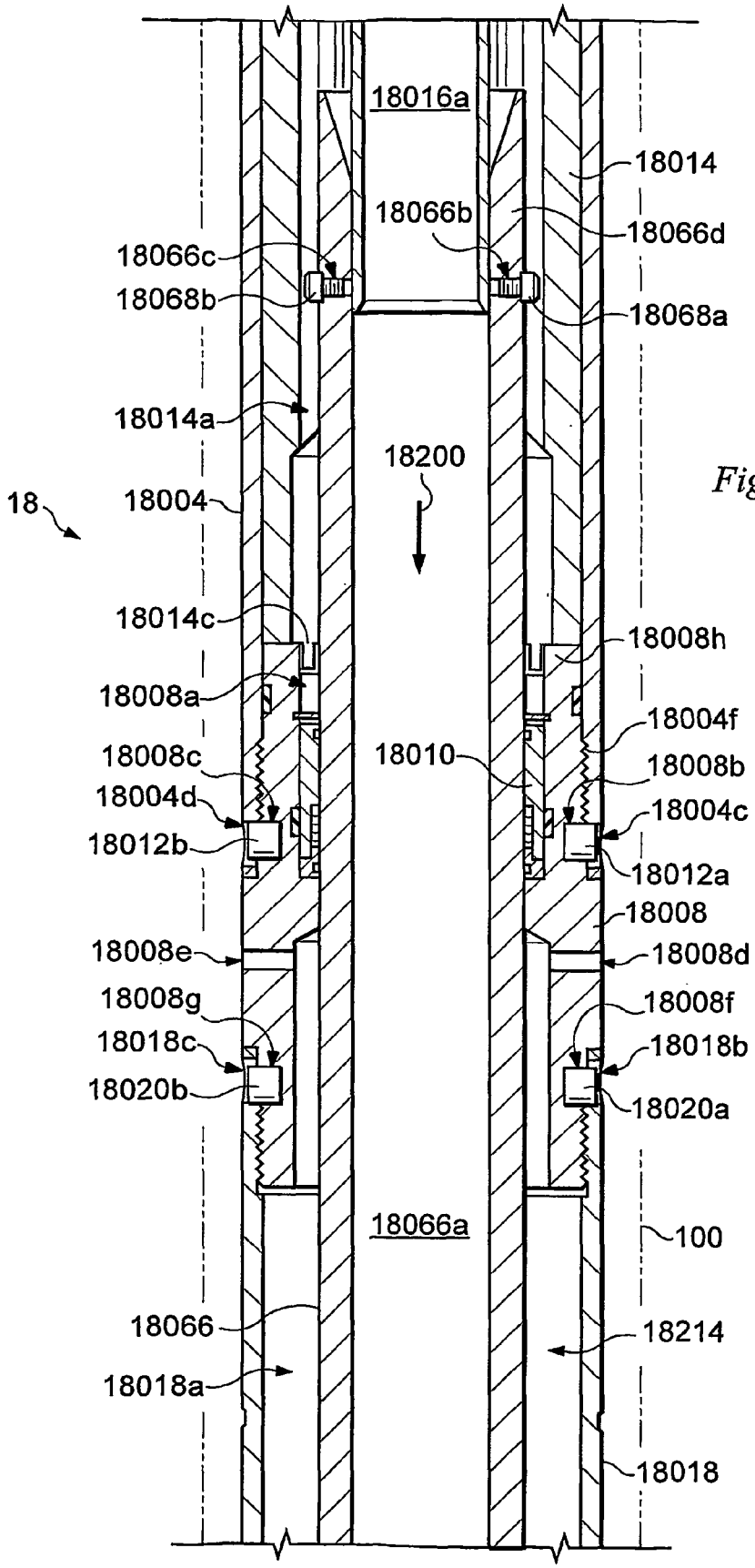
*Fig. 13A2*

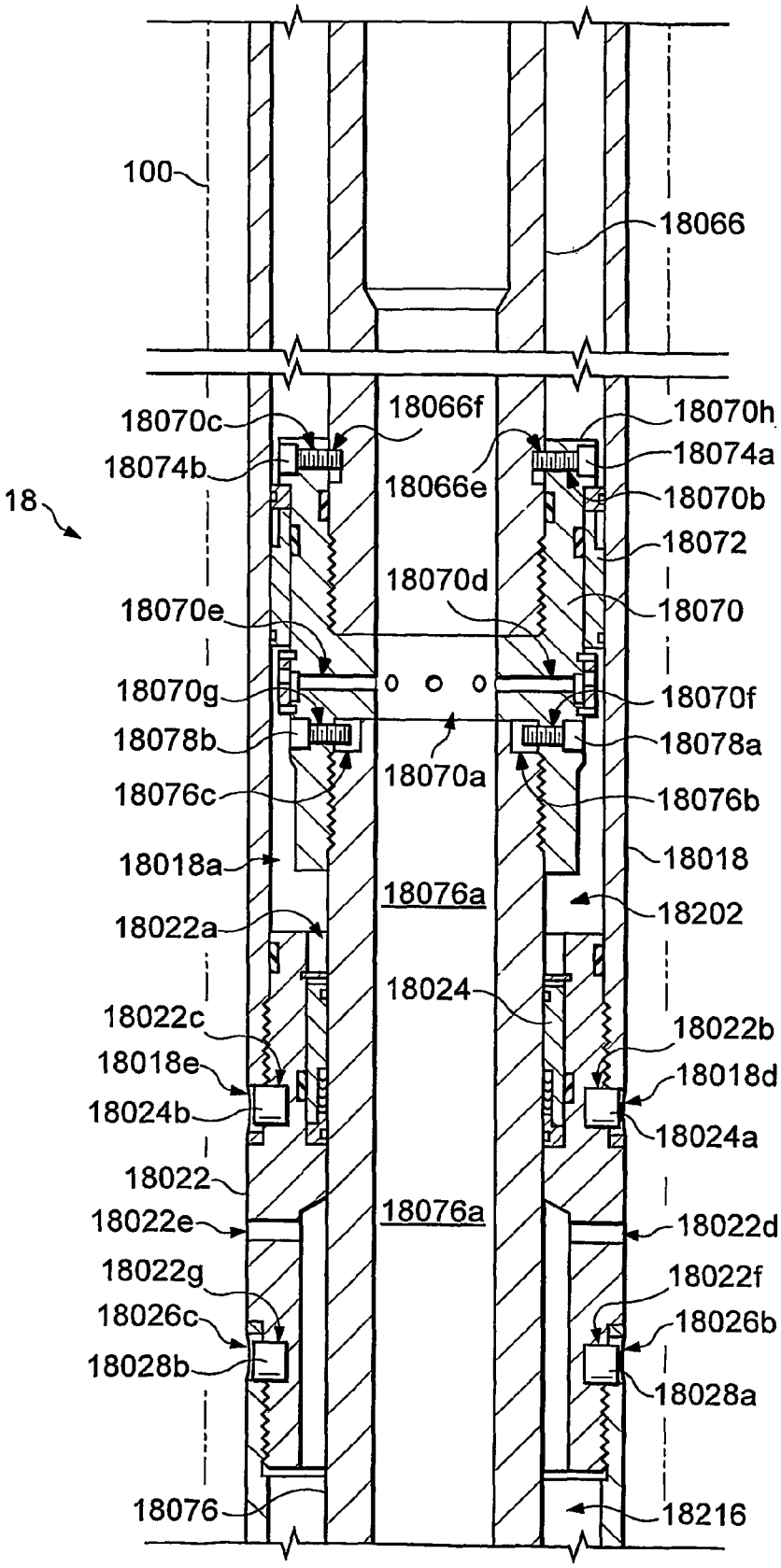
*Fig. 13A3*

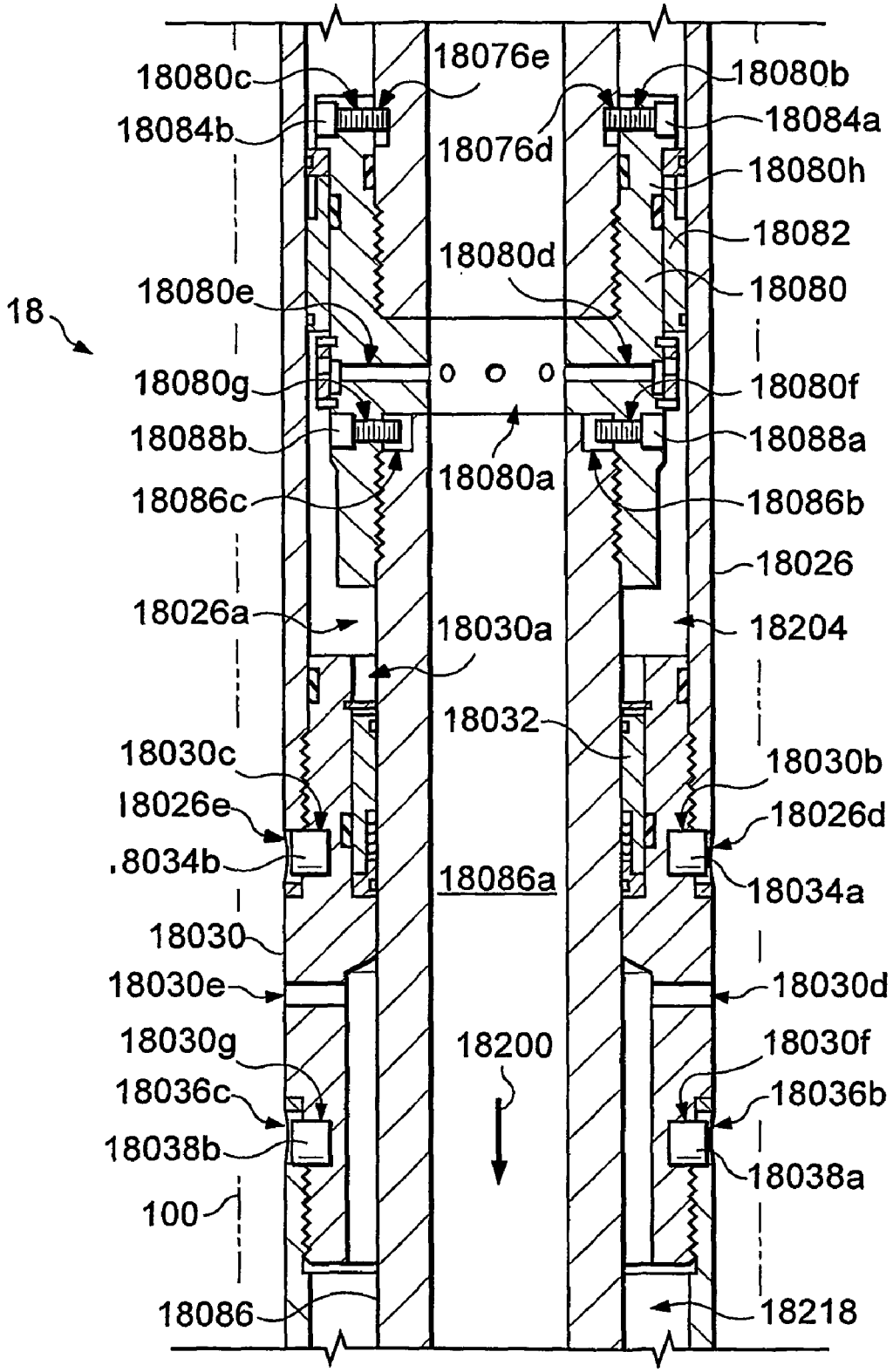
*Fig. 13A4*

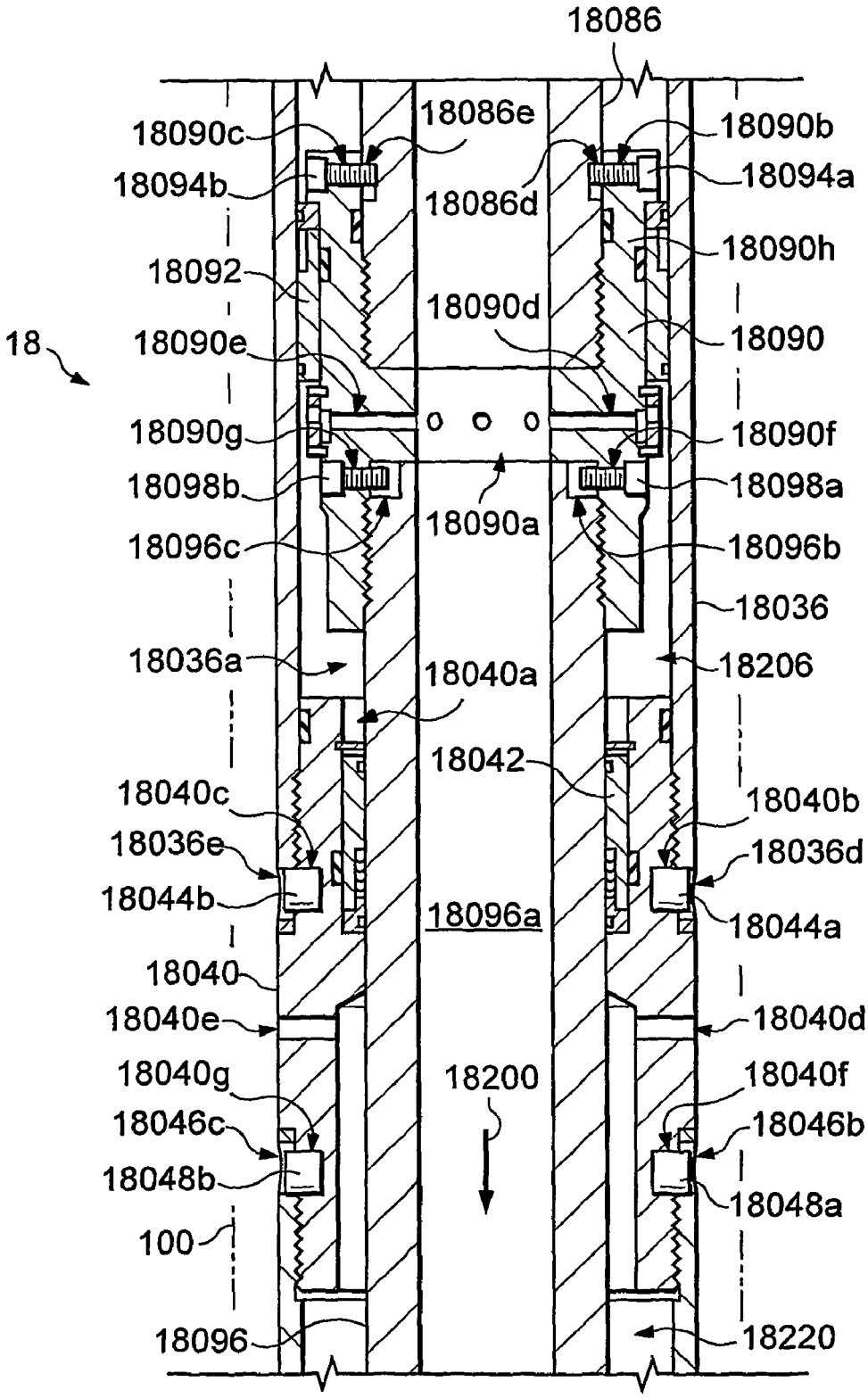
*Fig. 13A5*

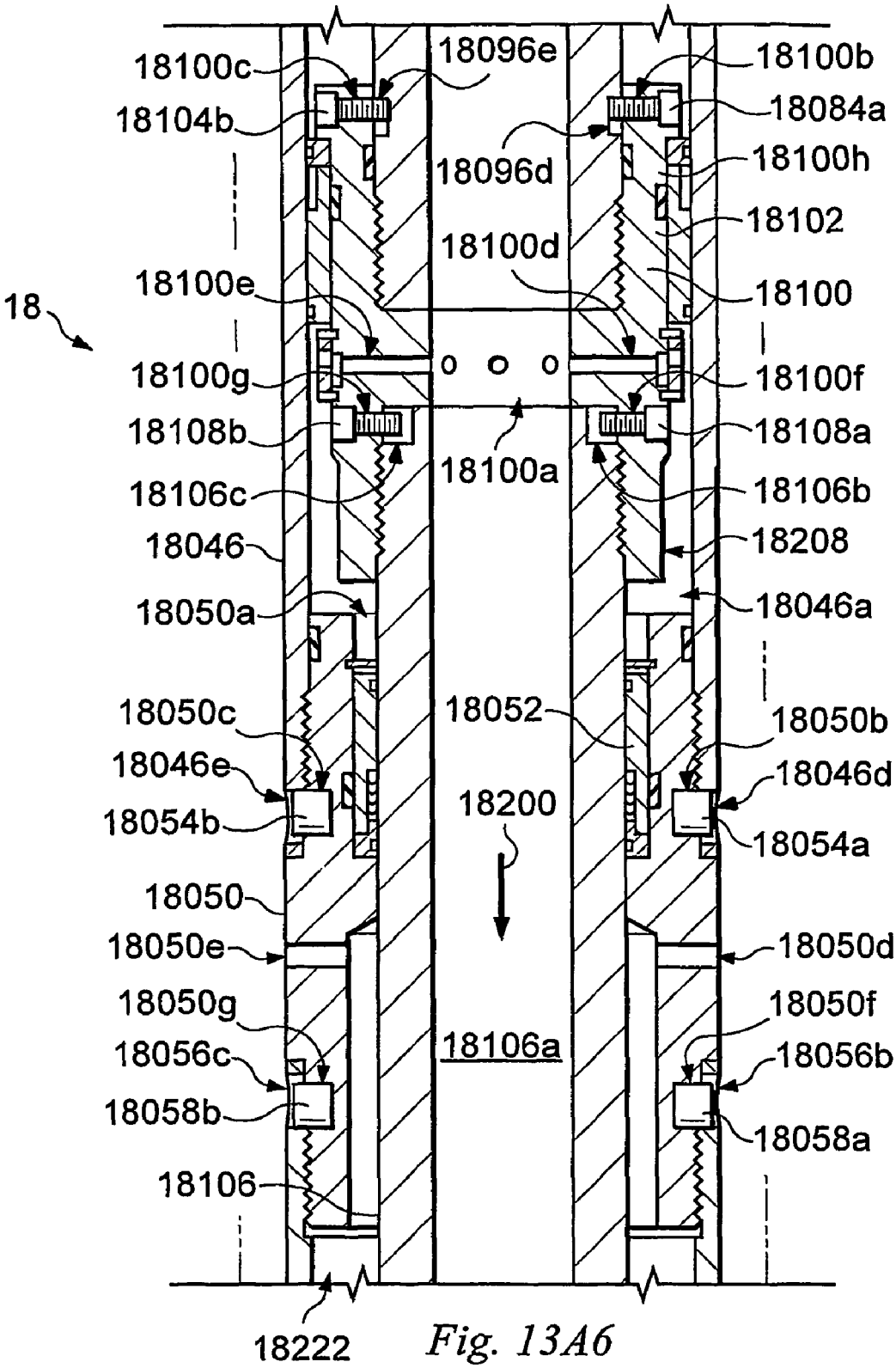
*Fig. 13A6*

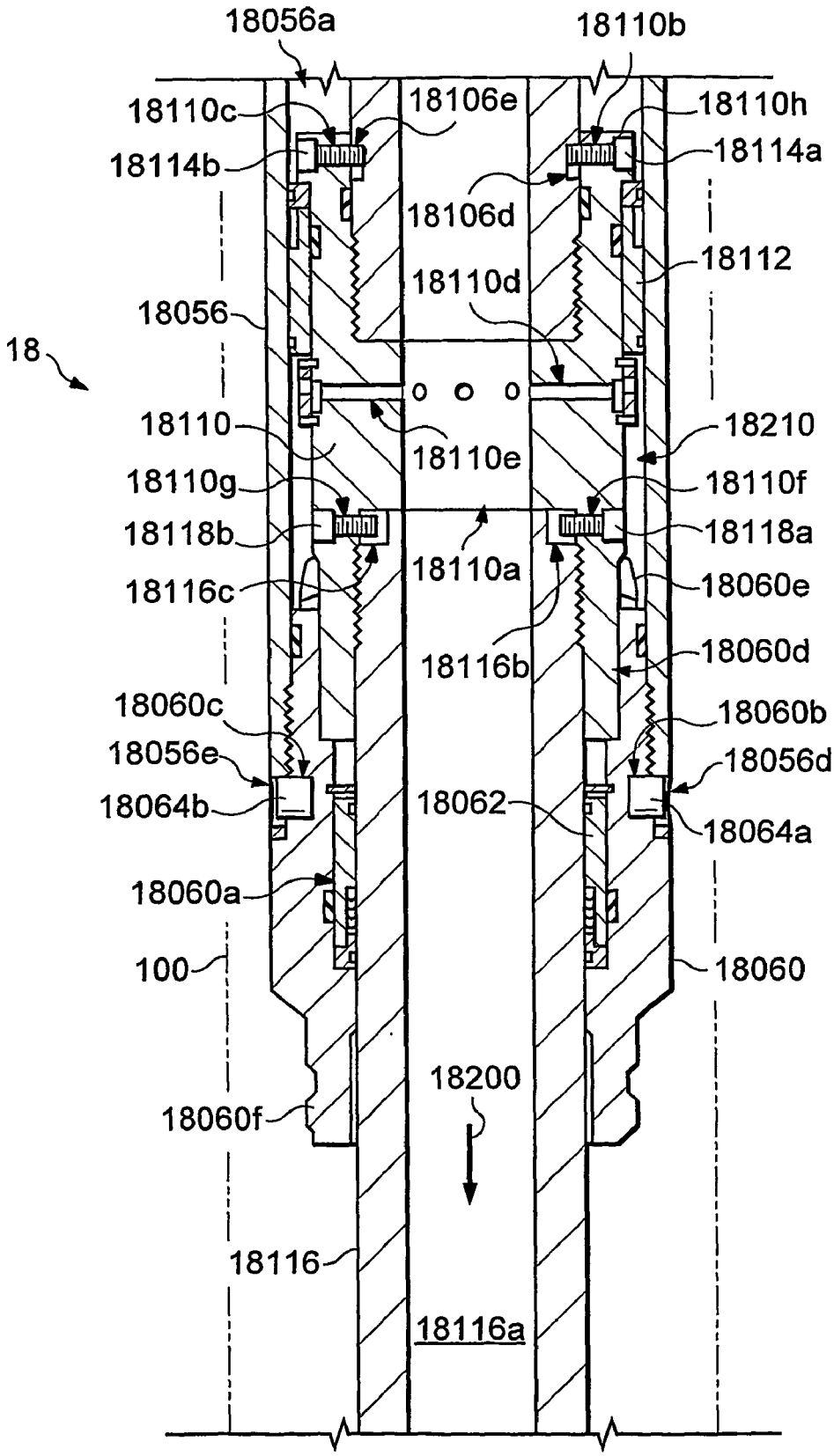
*Fig. 13A7*

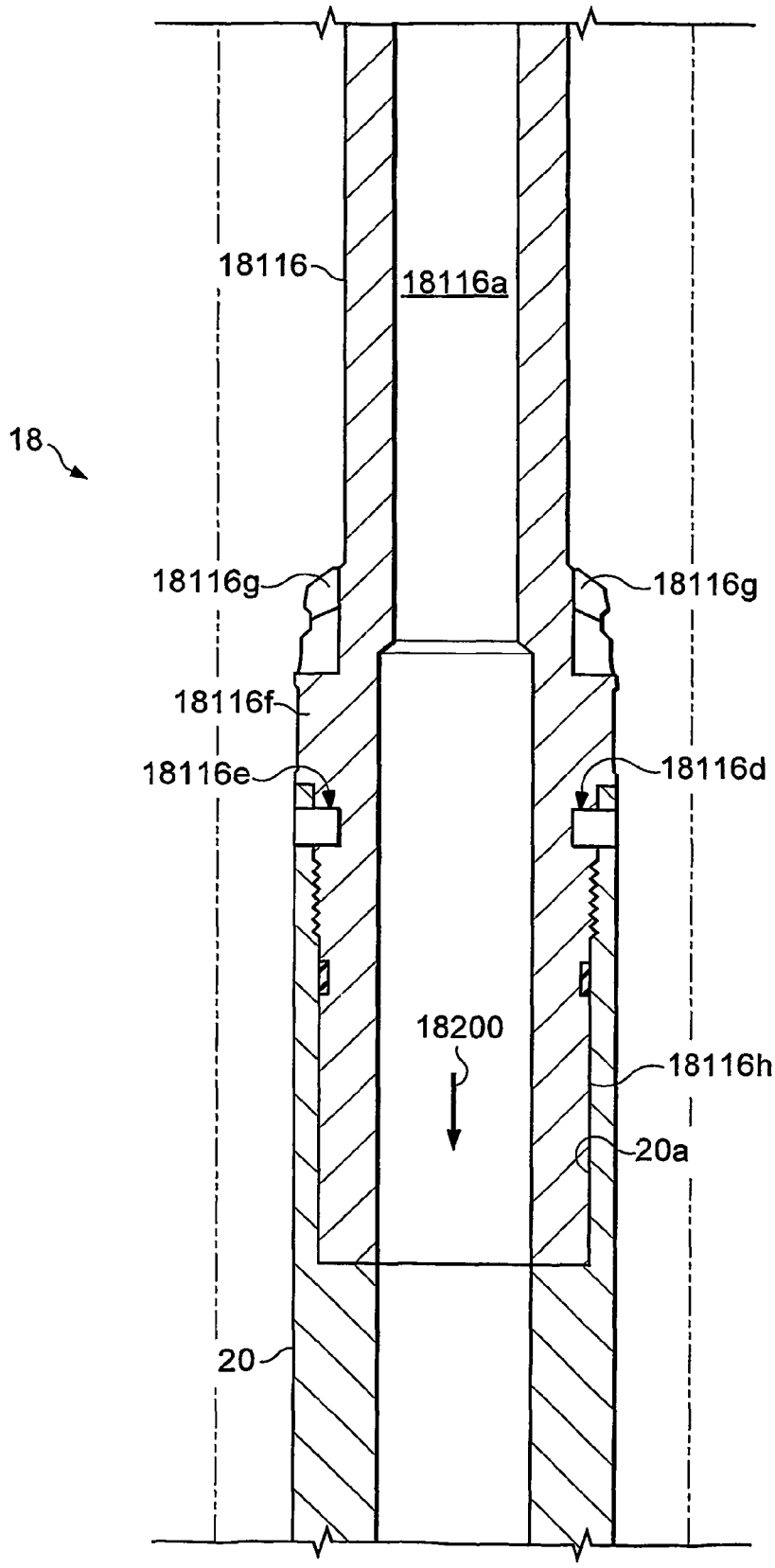
*Fig. 13A8*

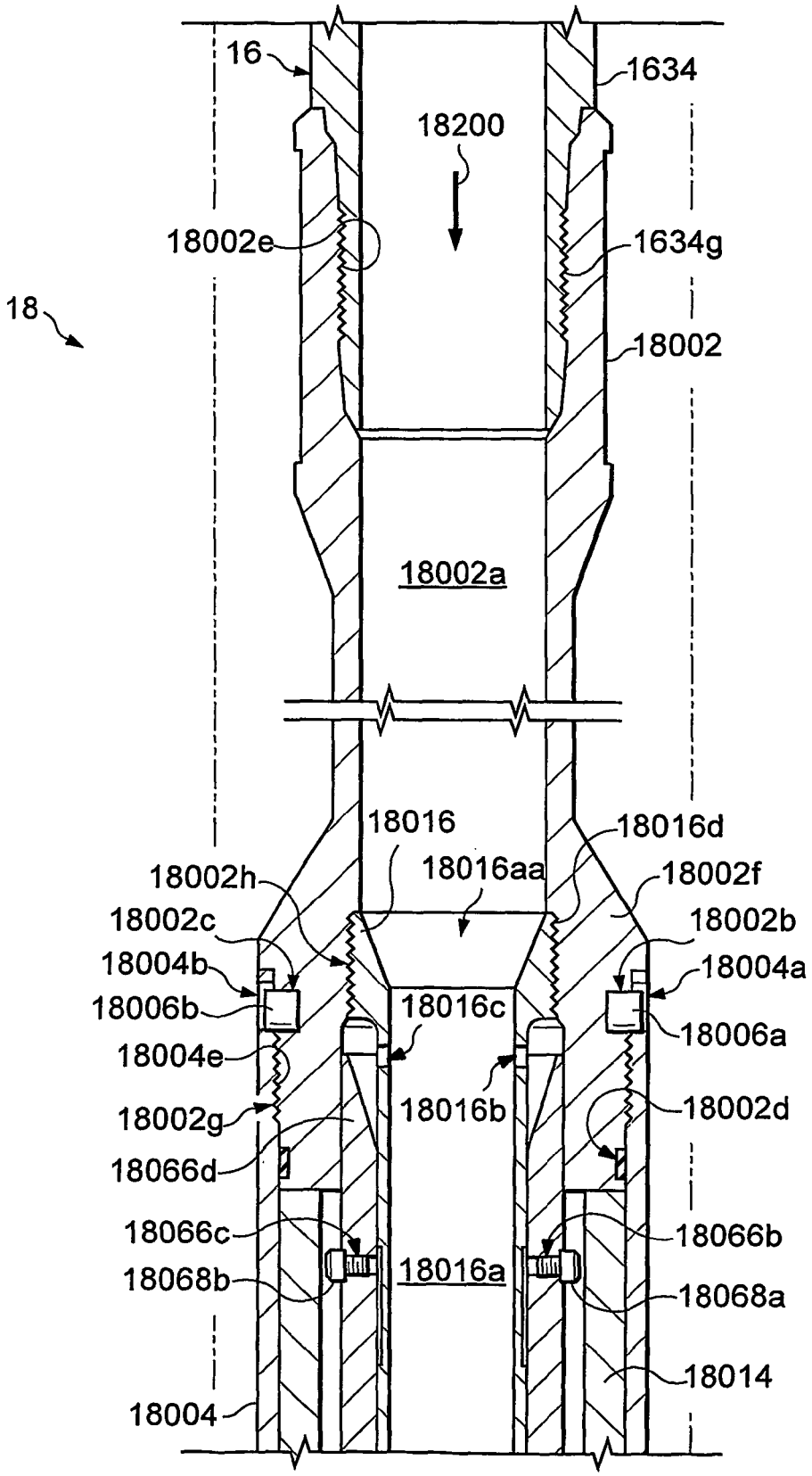
*Fig. 13B1*

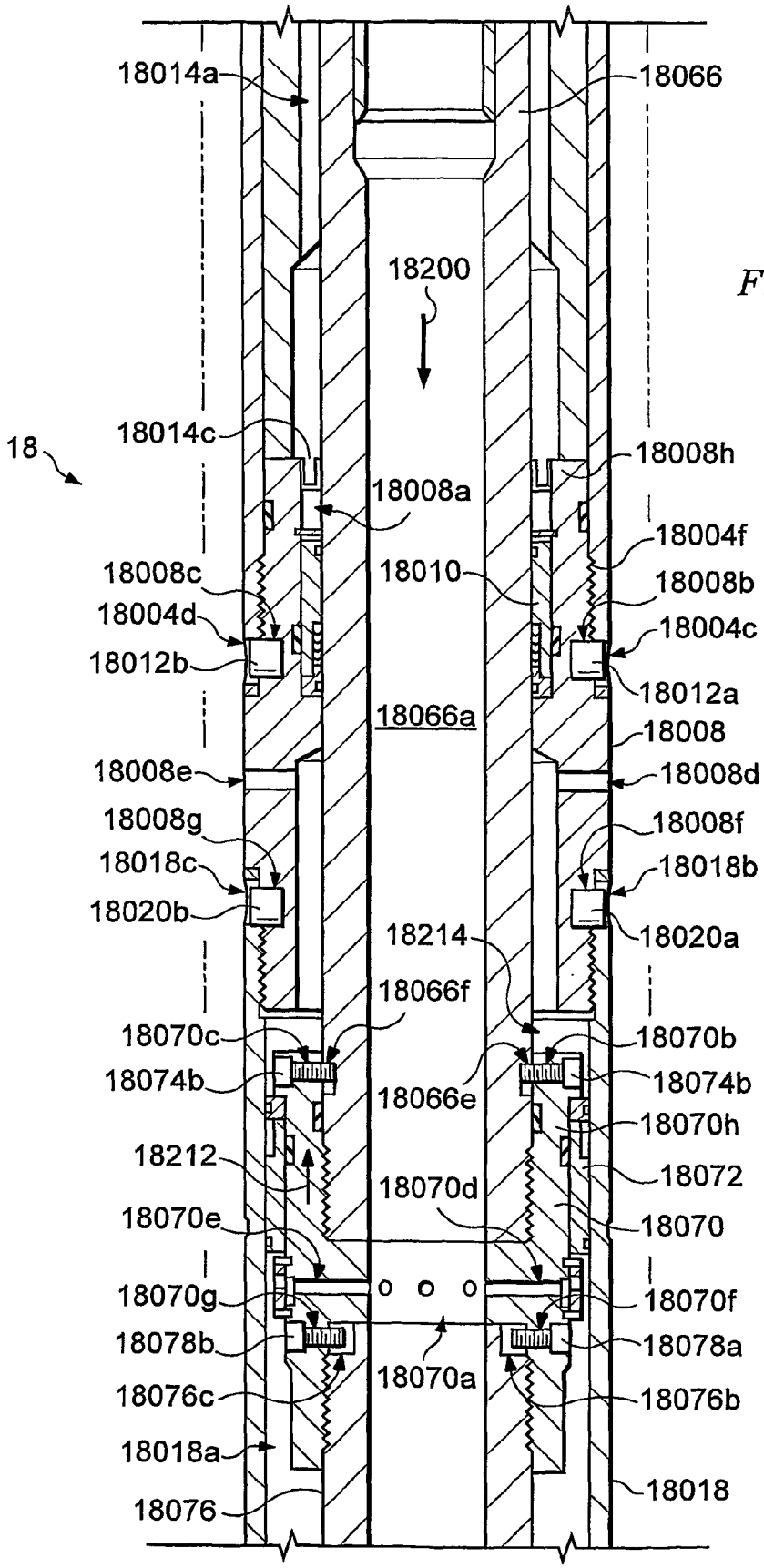
*Fig. 13B2*

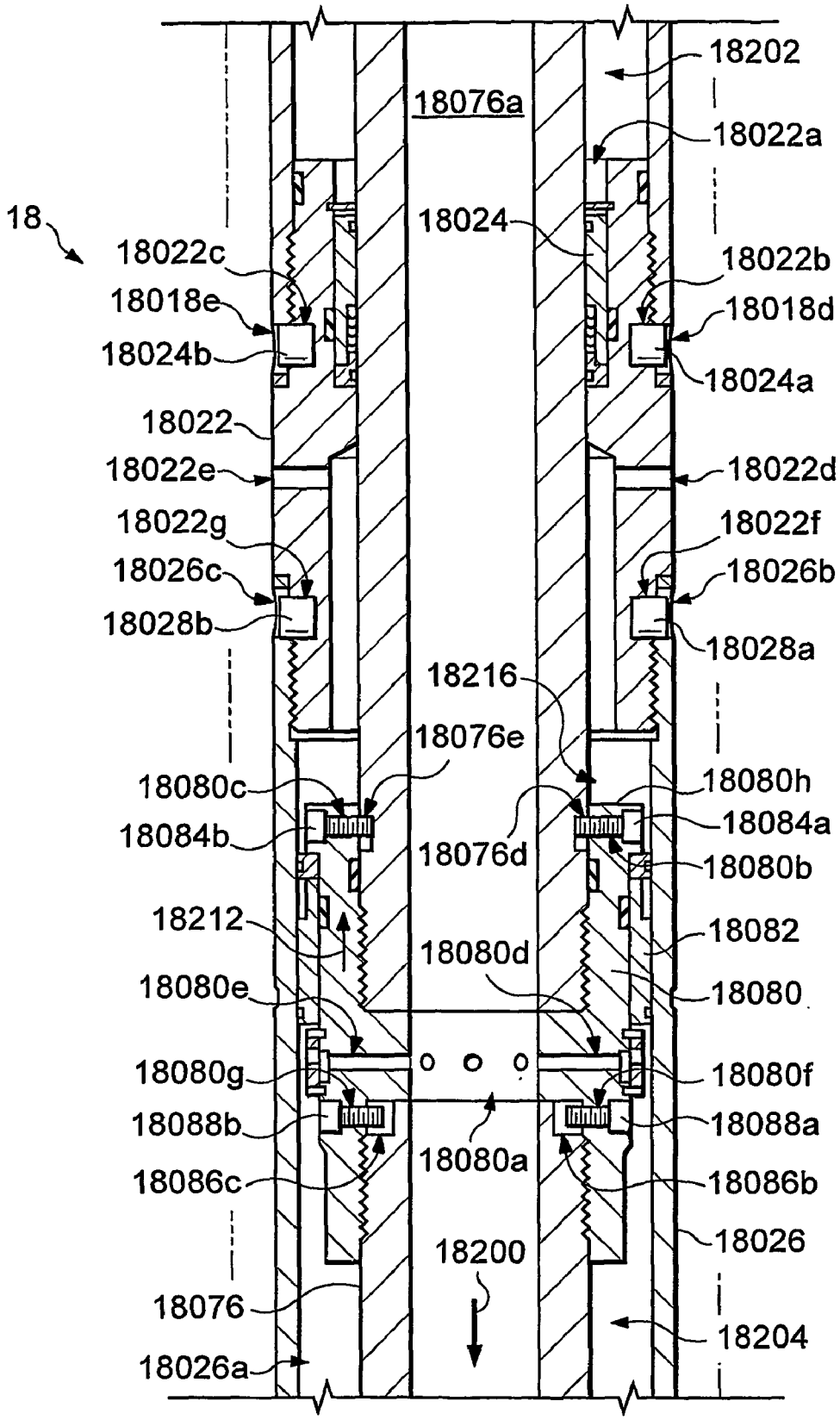
*Fig. 13B3*

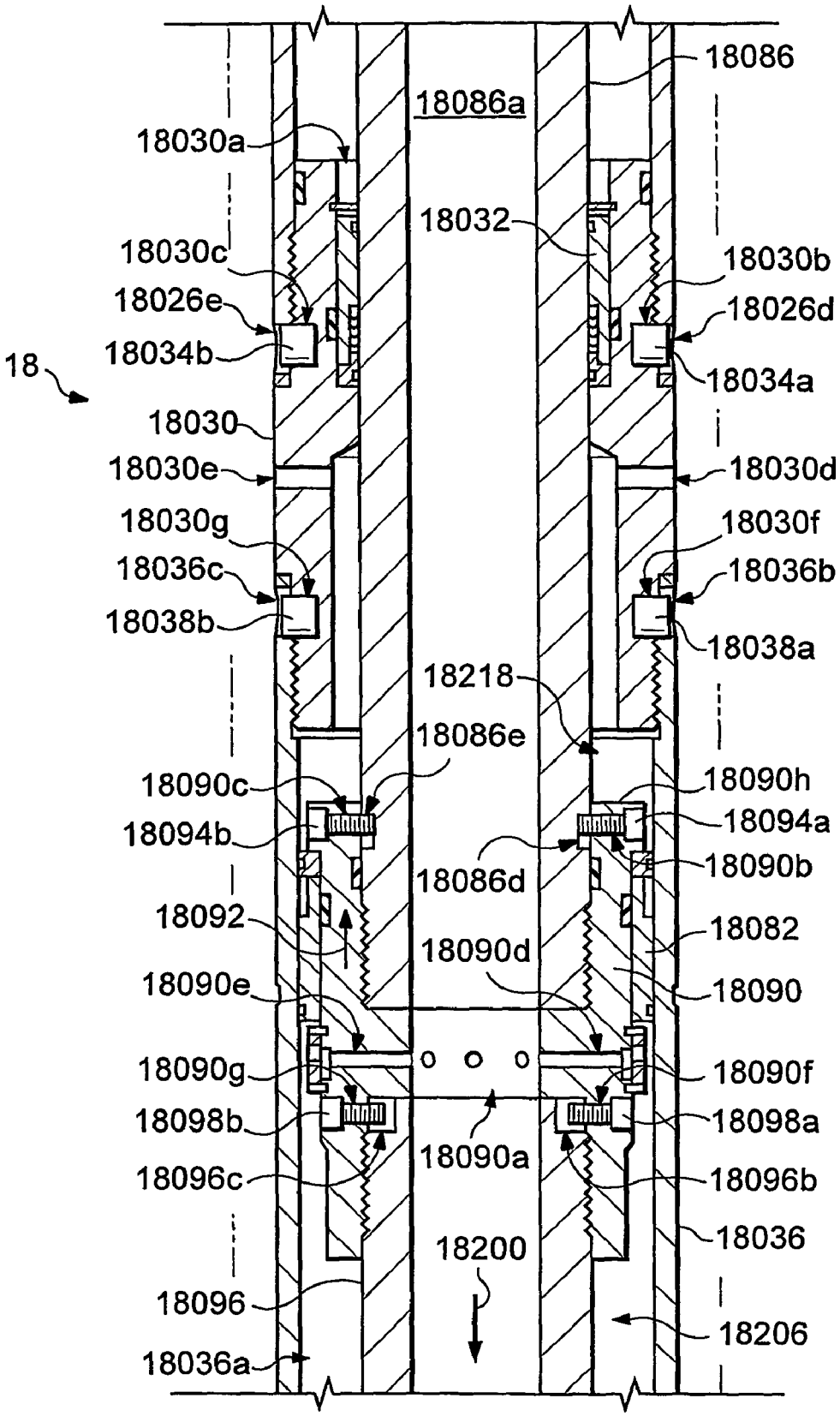
*Fig. 13B4*

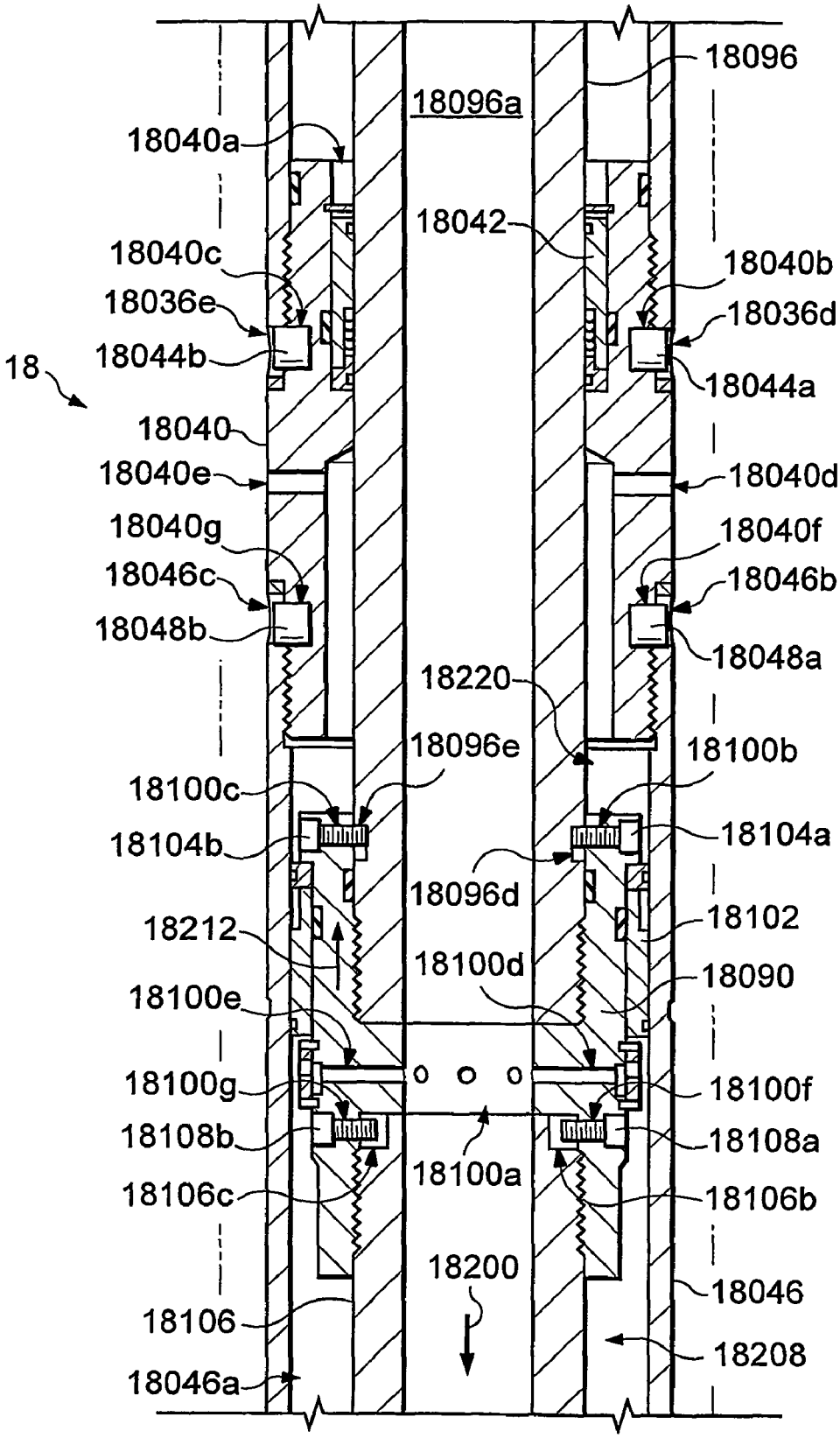
*Fig. 13B5*

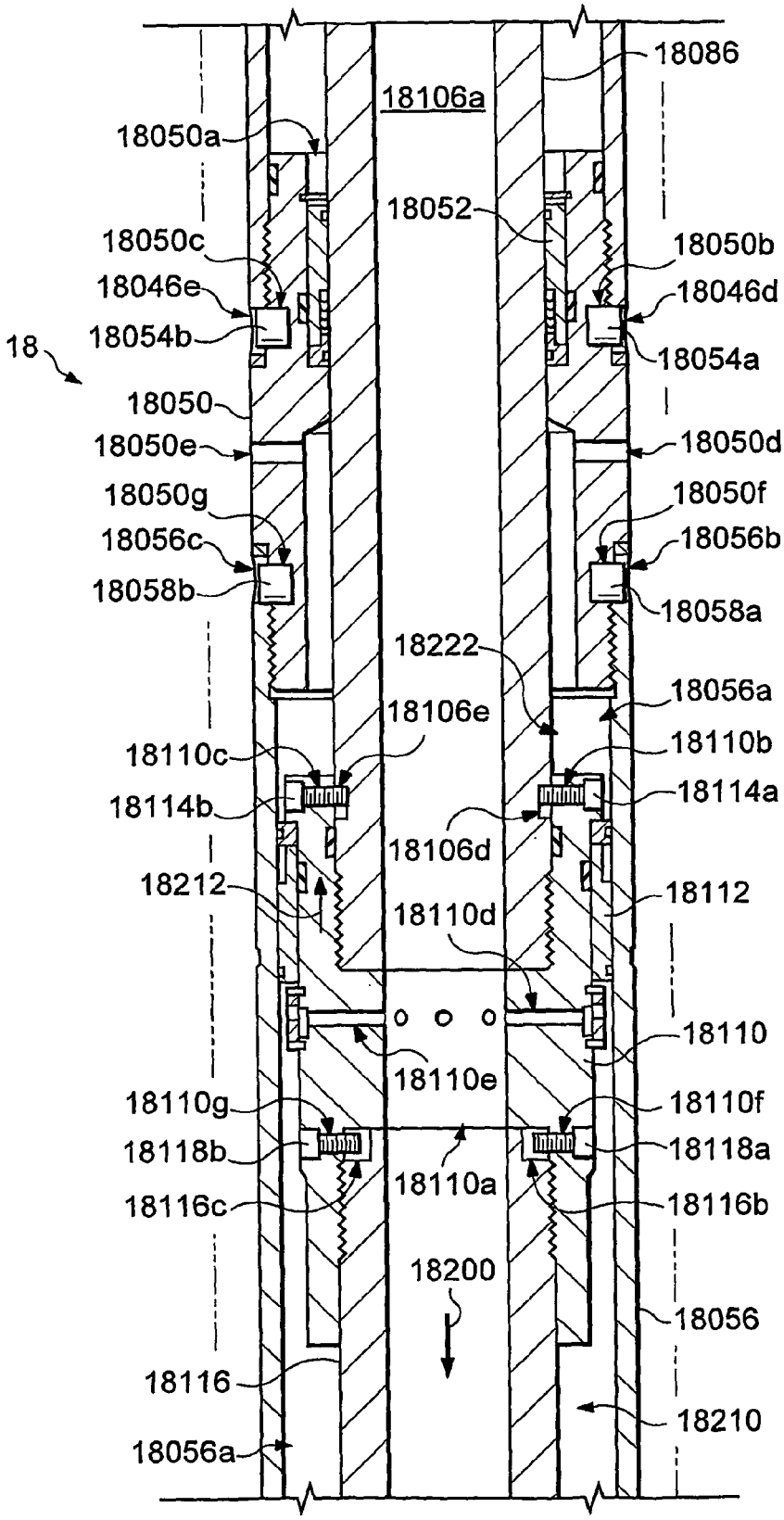
*Fig. 13B6*

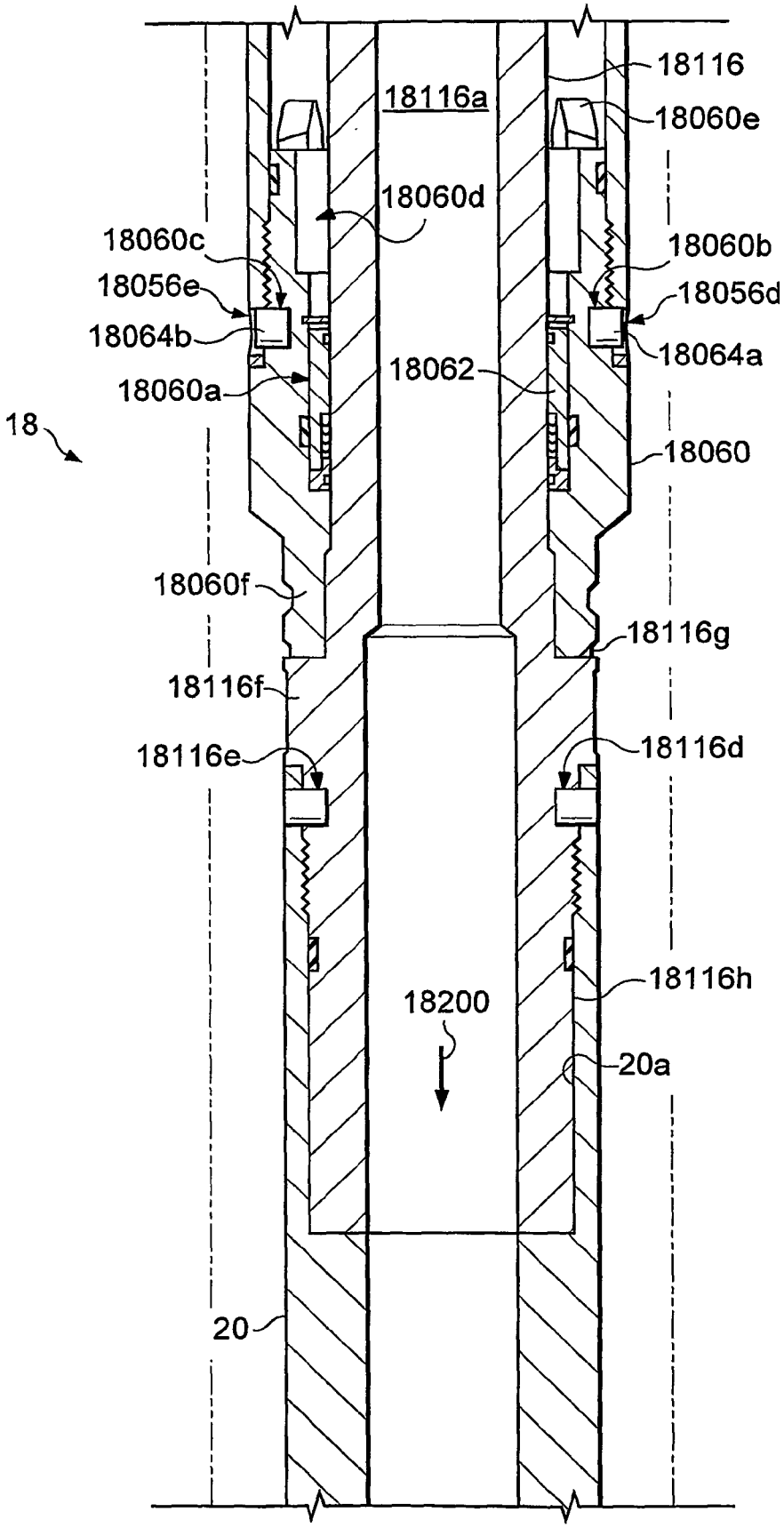
*Fig. 13B7*

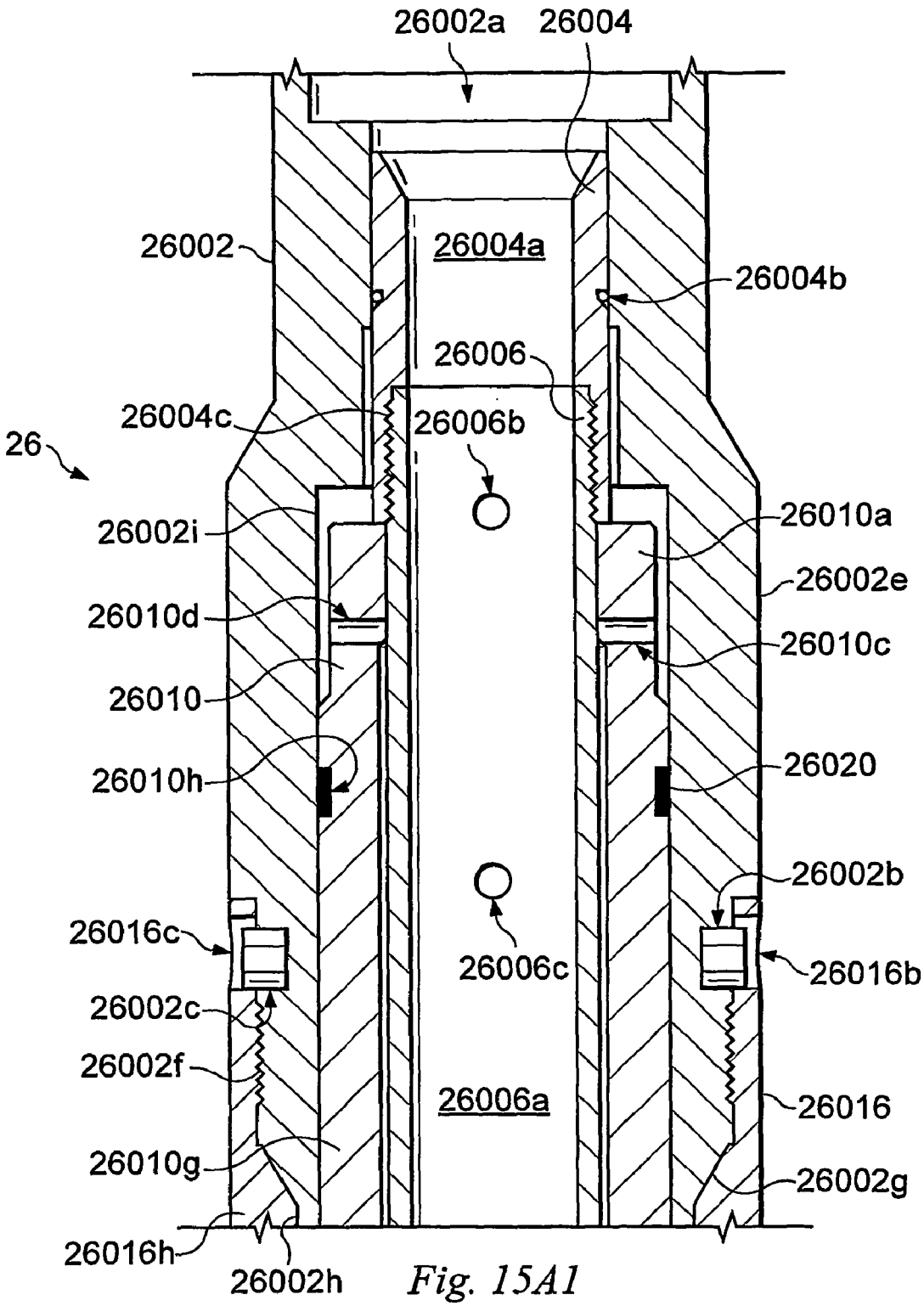
*Fig. 15A1*

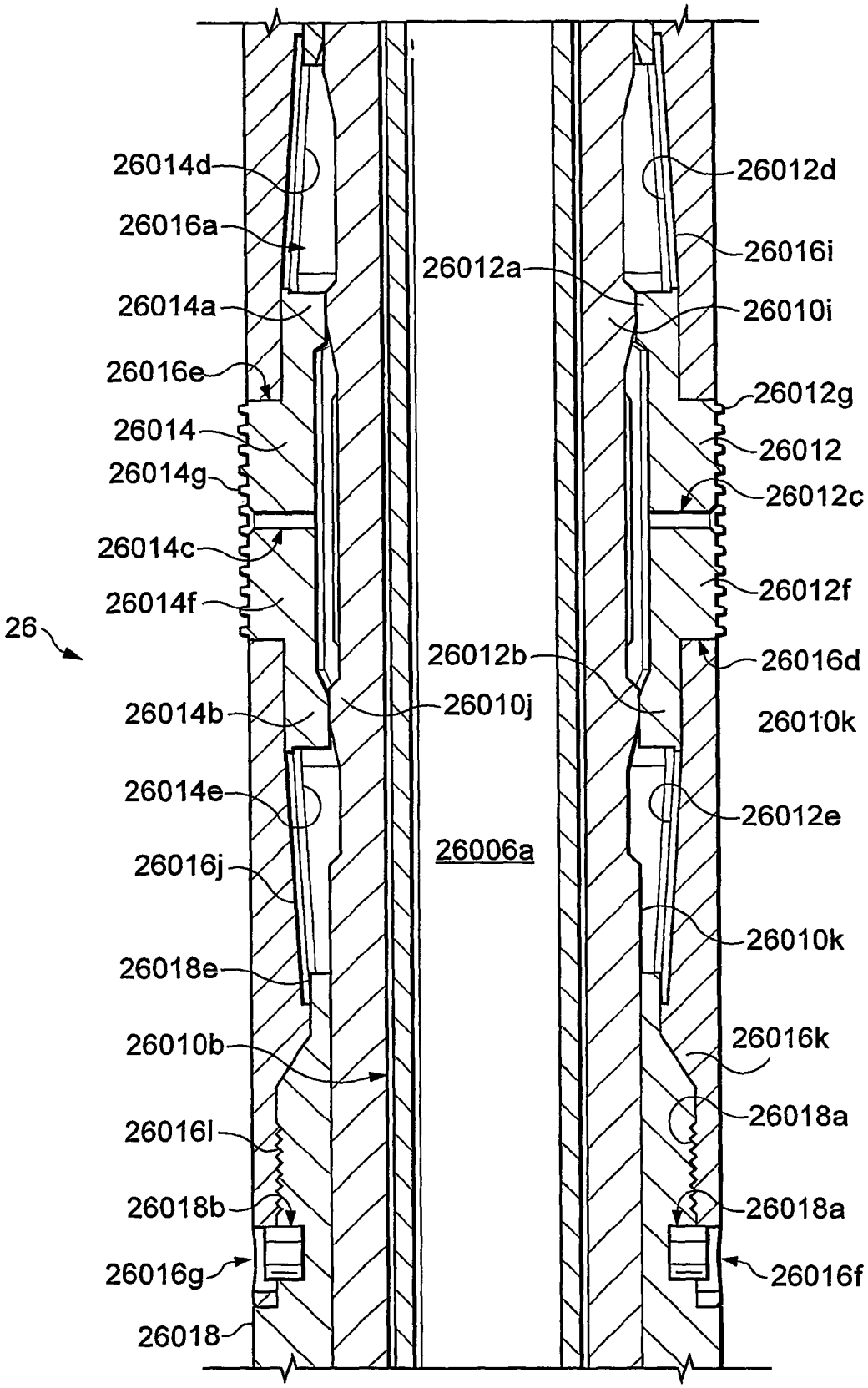
*Fig. 15A2*

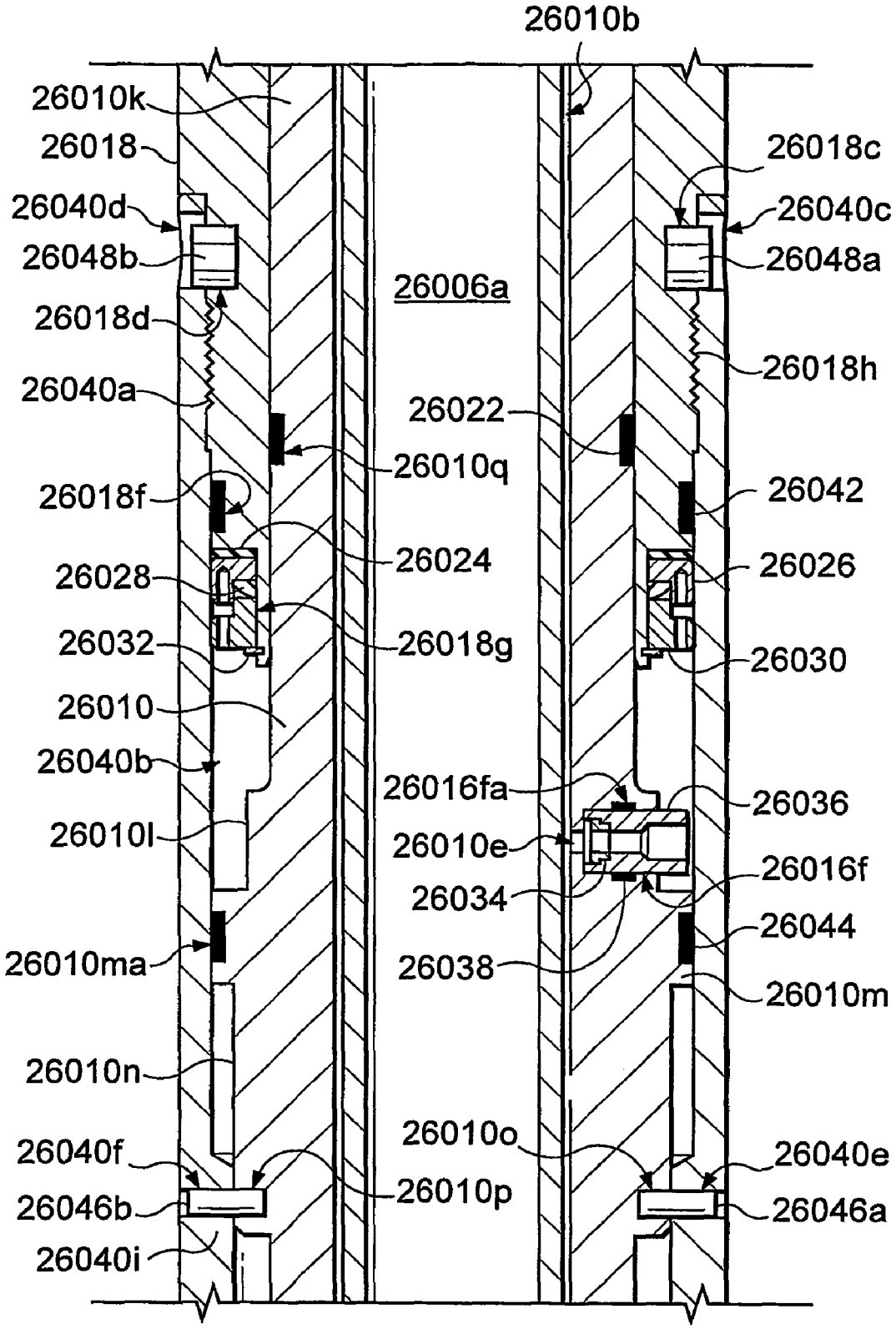
*Fig. 15B1*

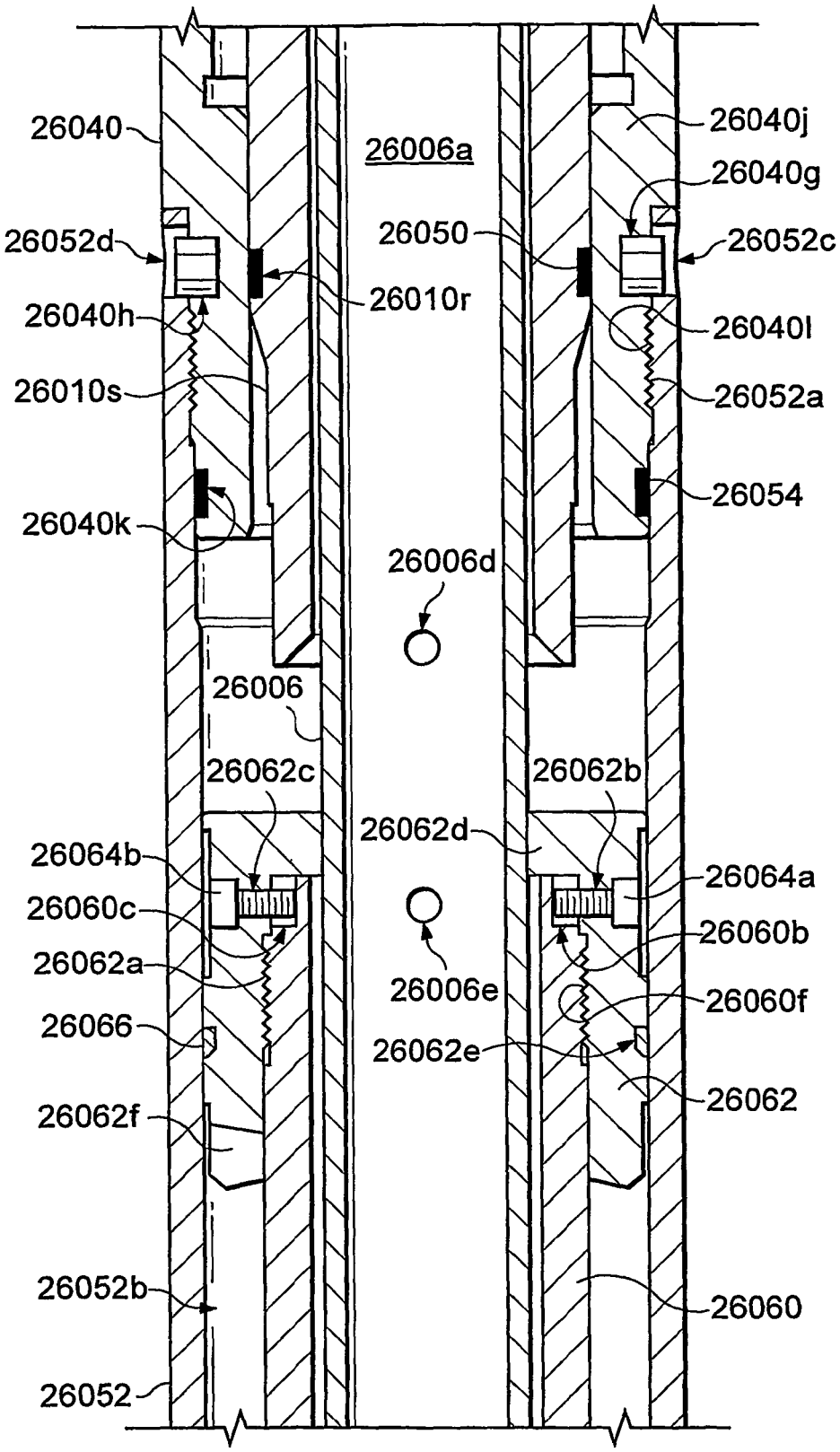
*Fig. 15B2*

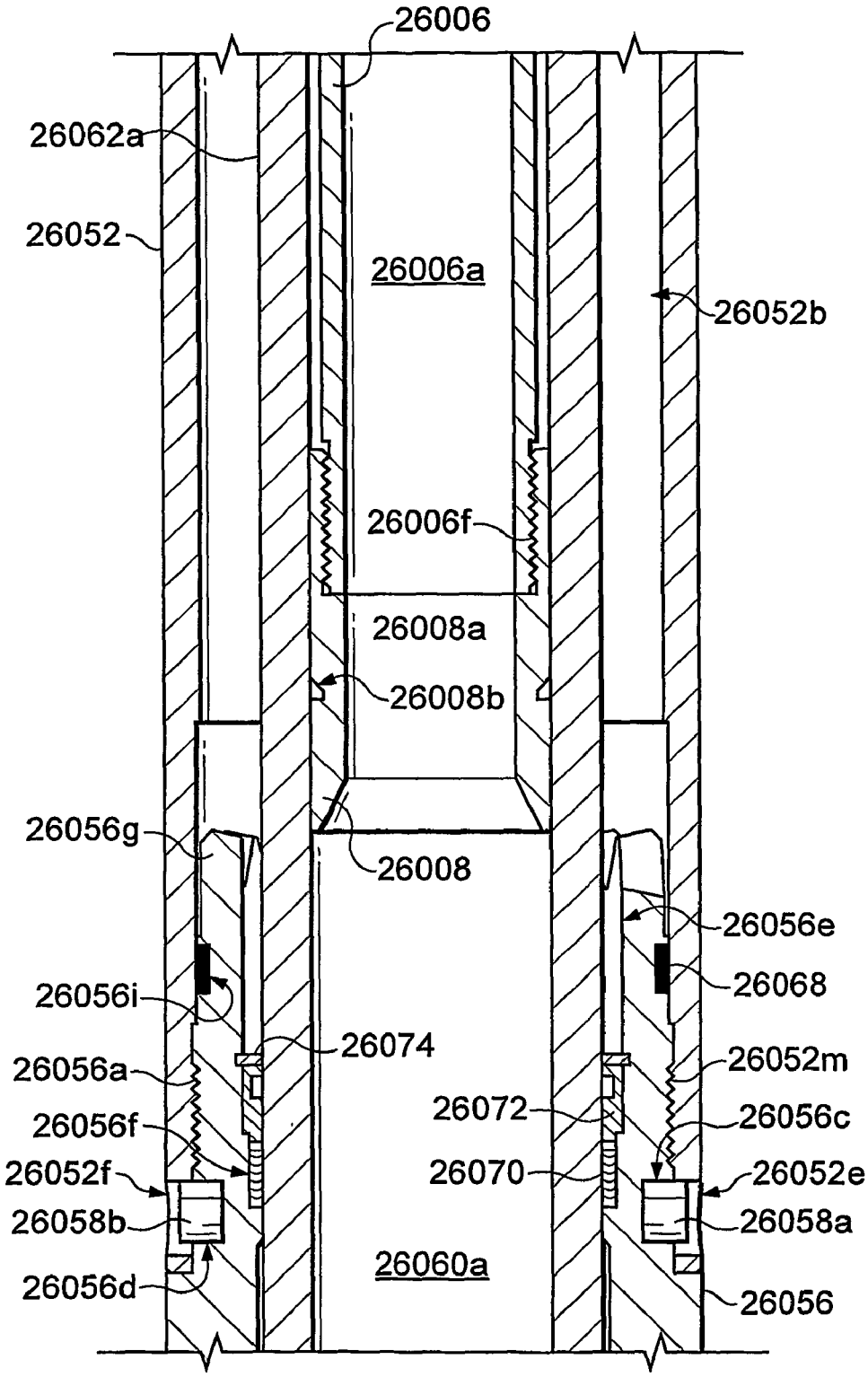
*Fig. 15C1*

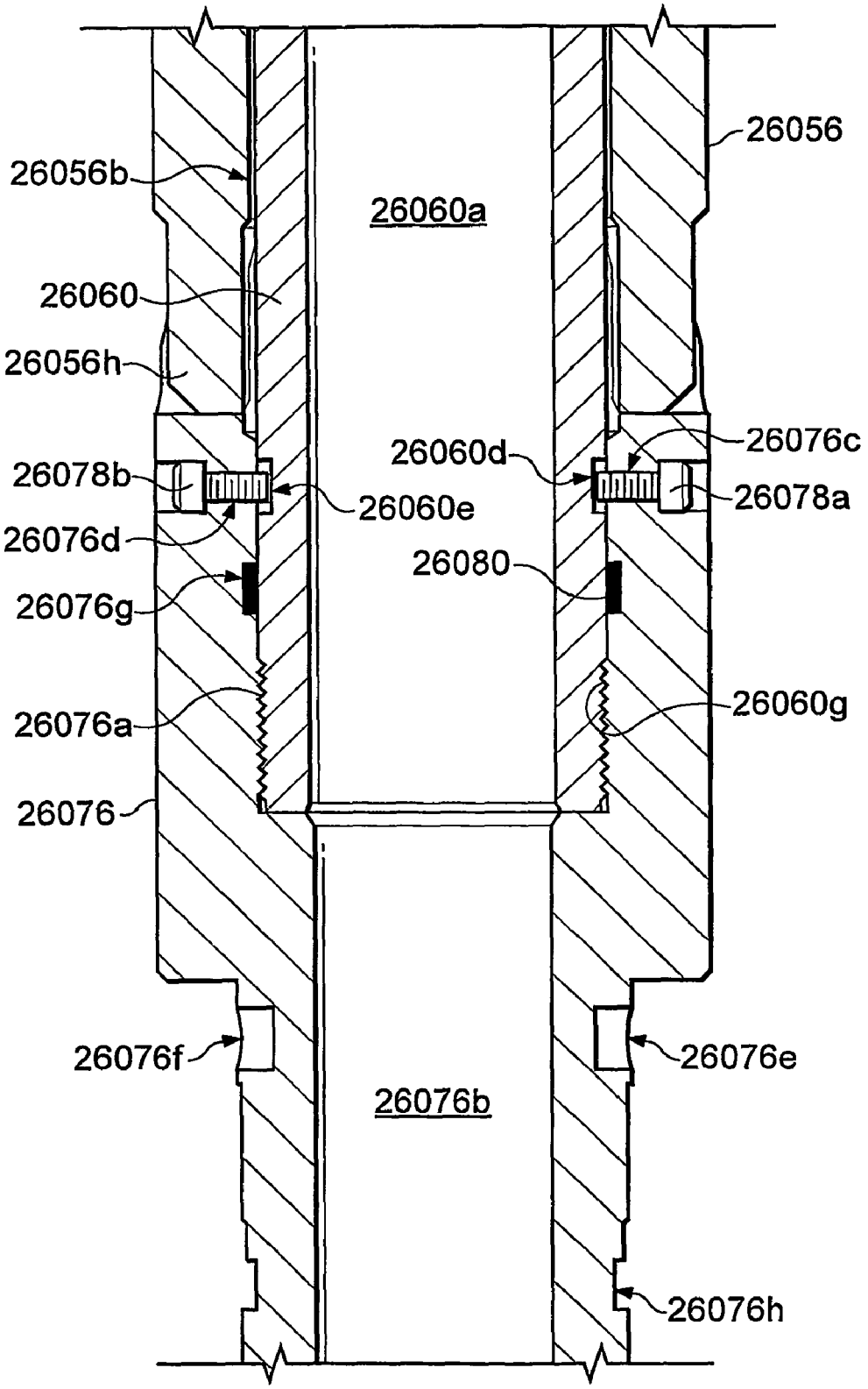
*Fig. 15C2*

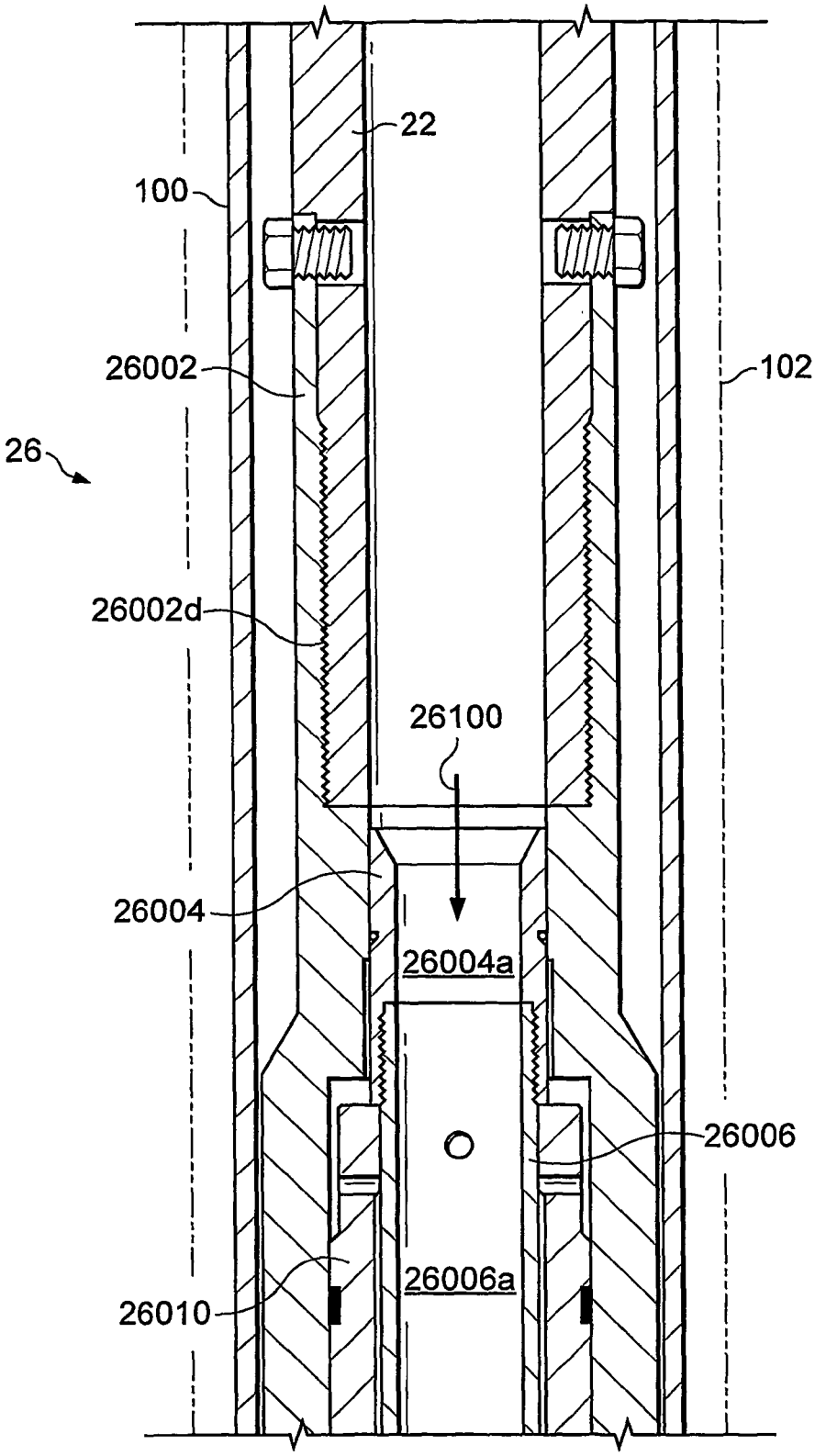
*Fig. 15E1*

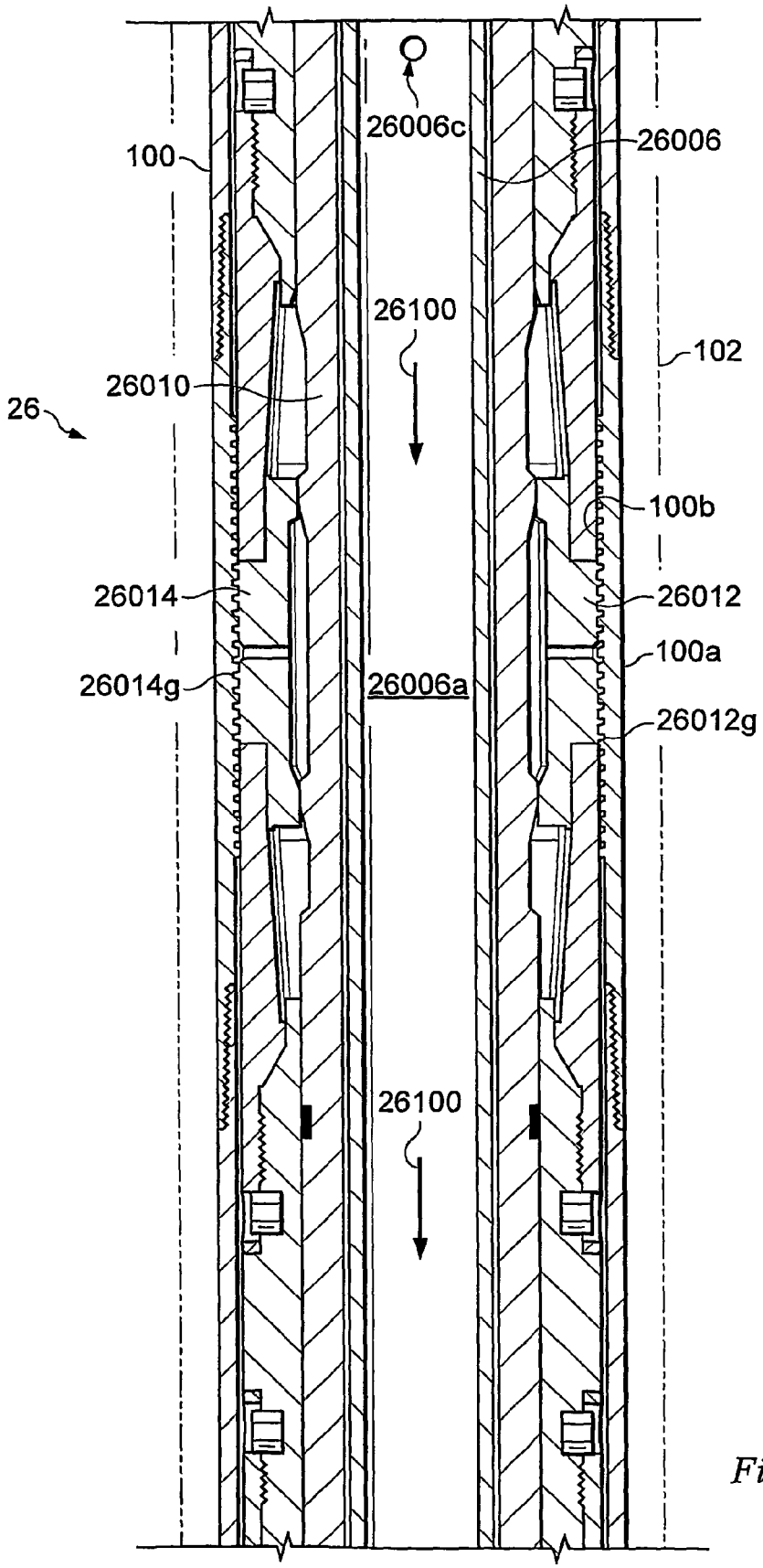
*Fig. 15E2*

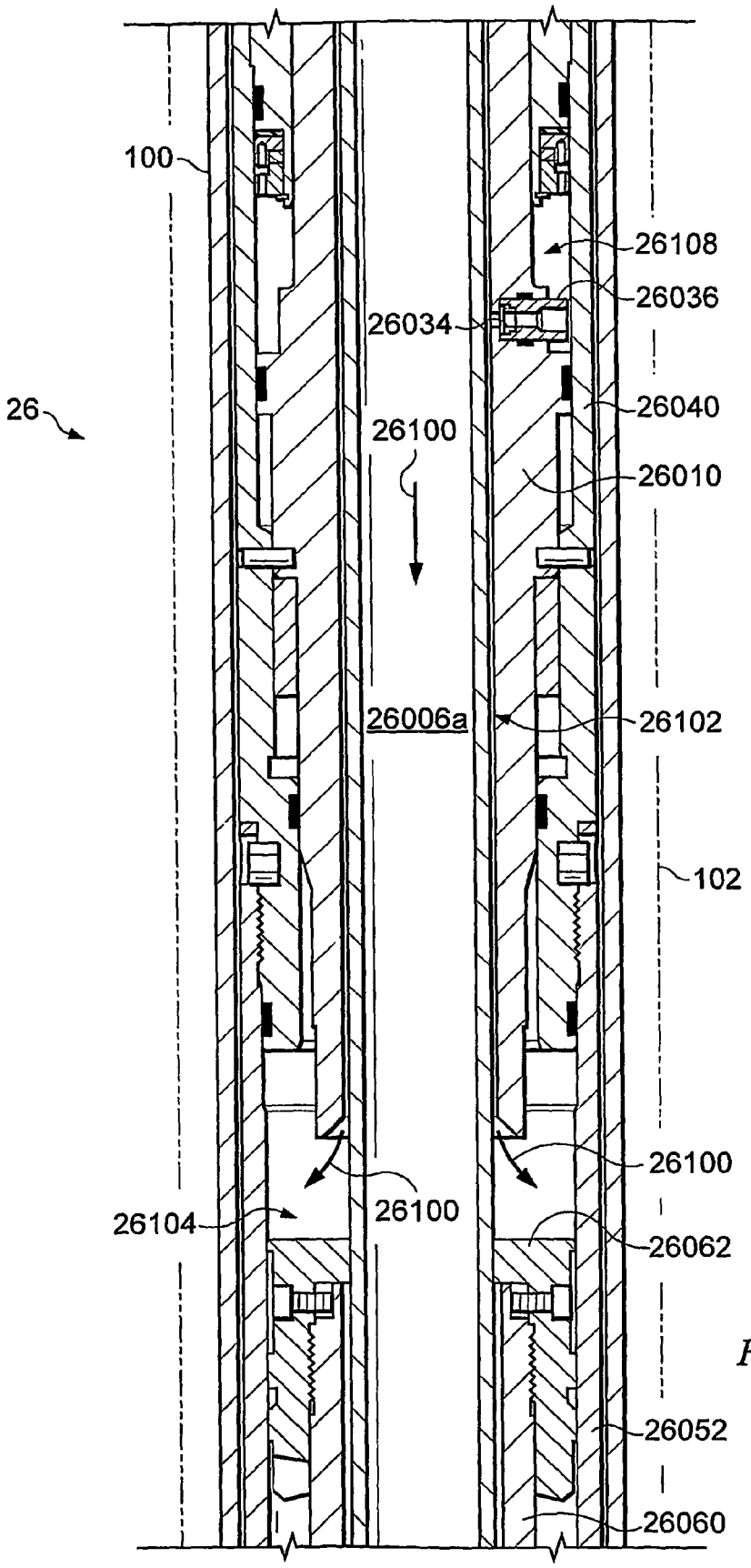
*Fig. 15E3*

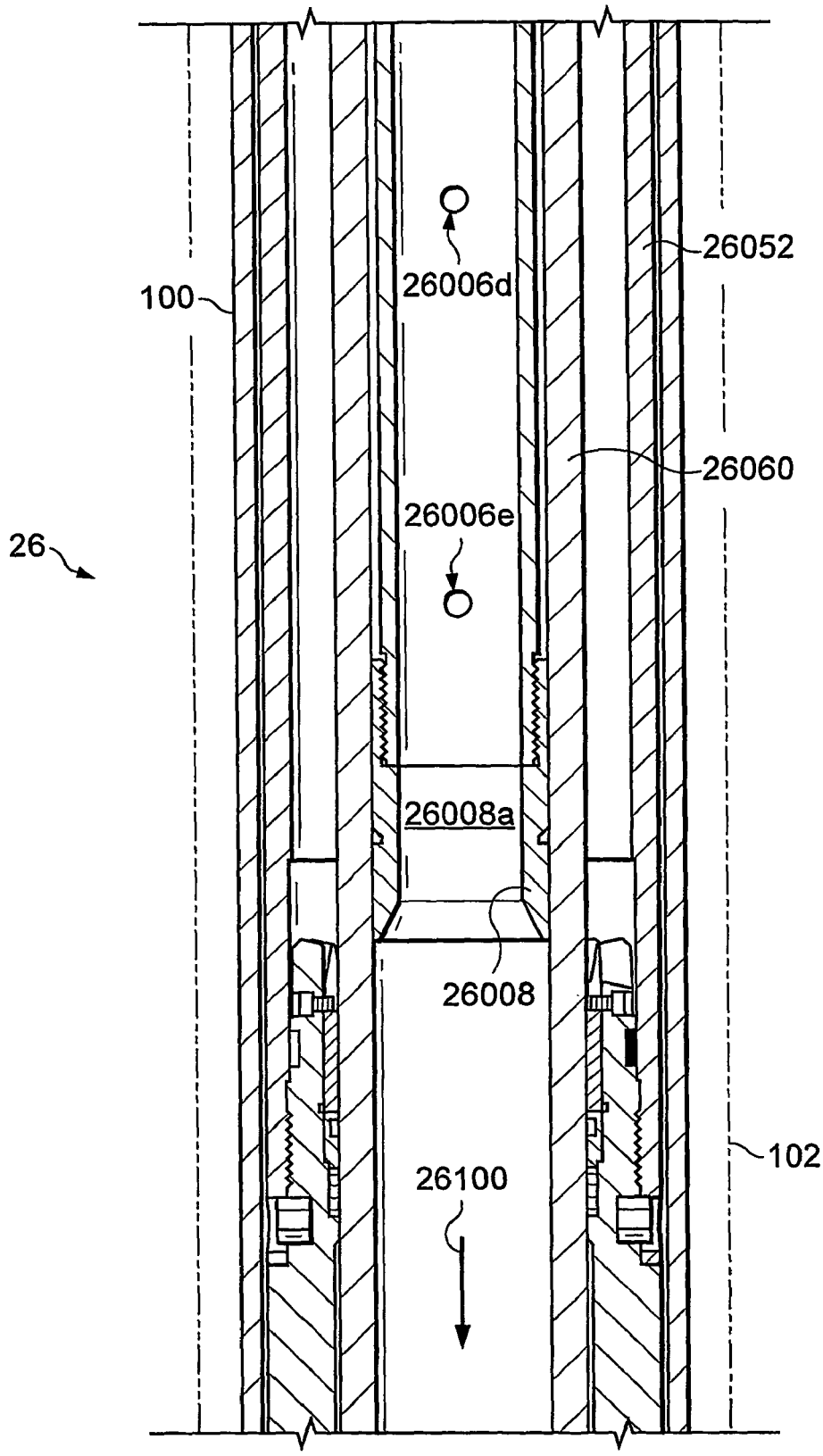
*Fig. 15E4*

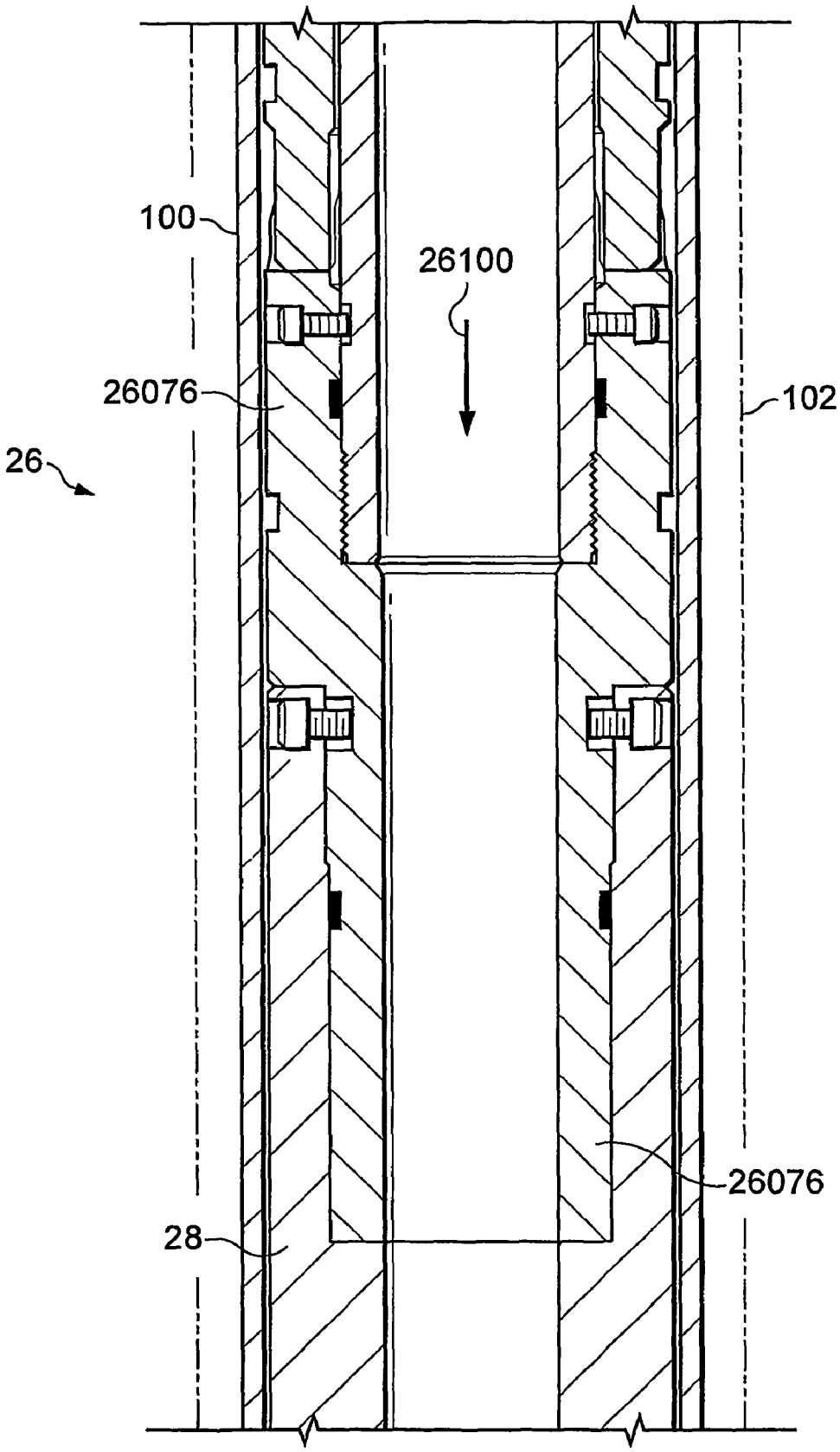
*Fig. 15E5*

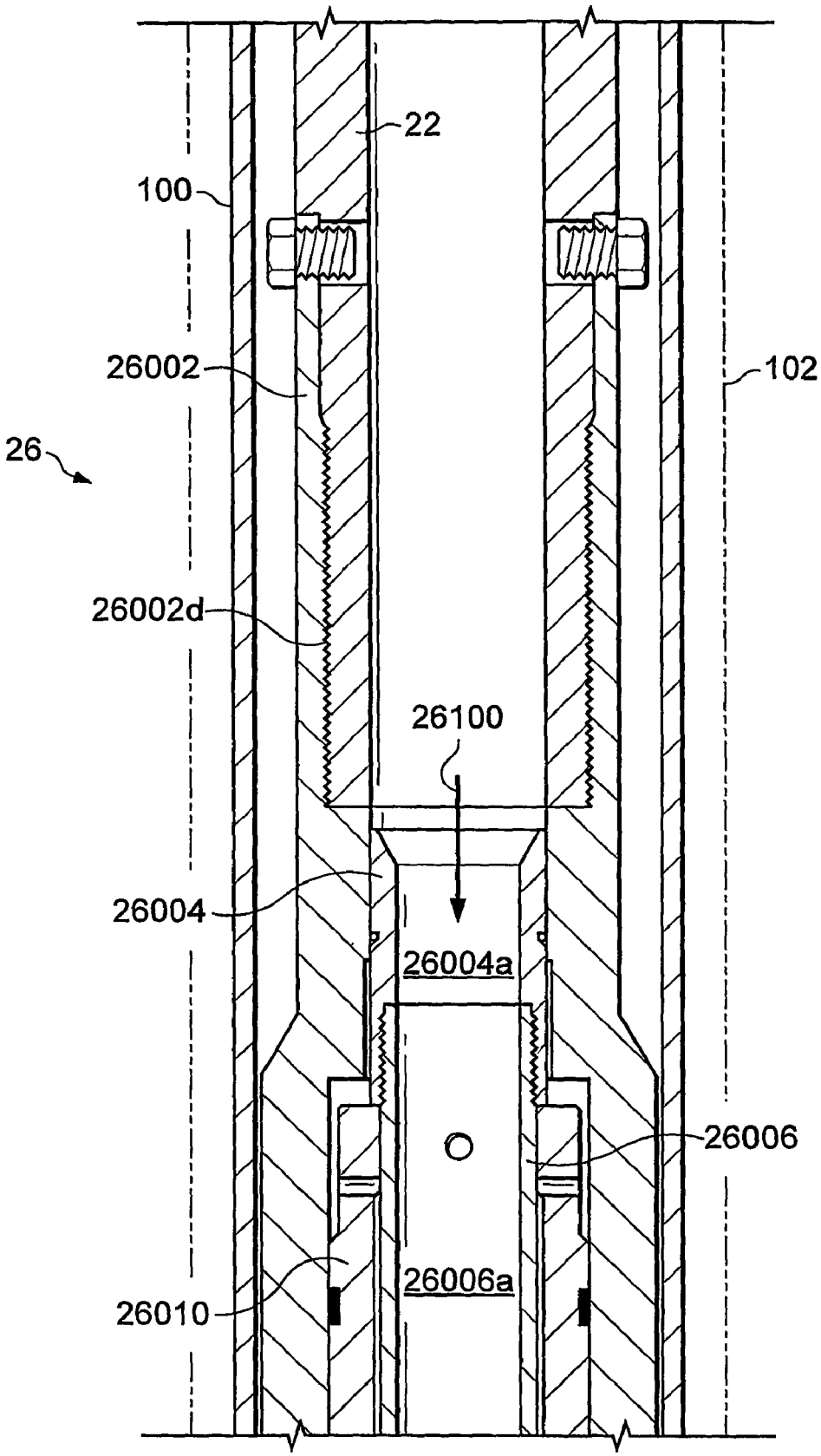
*Fig. 15F1*

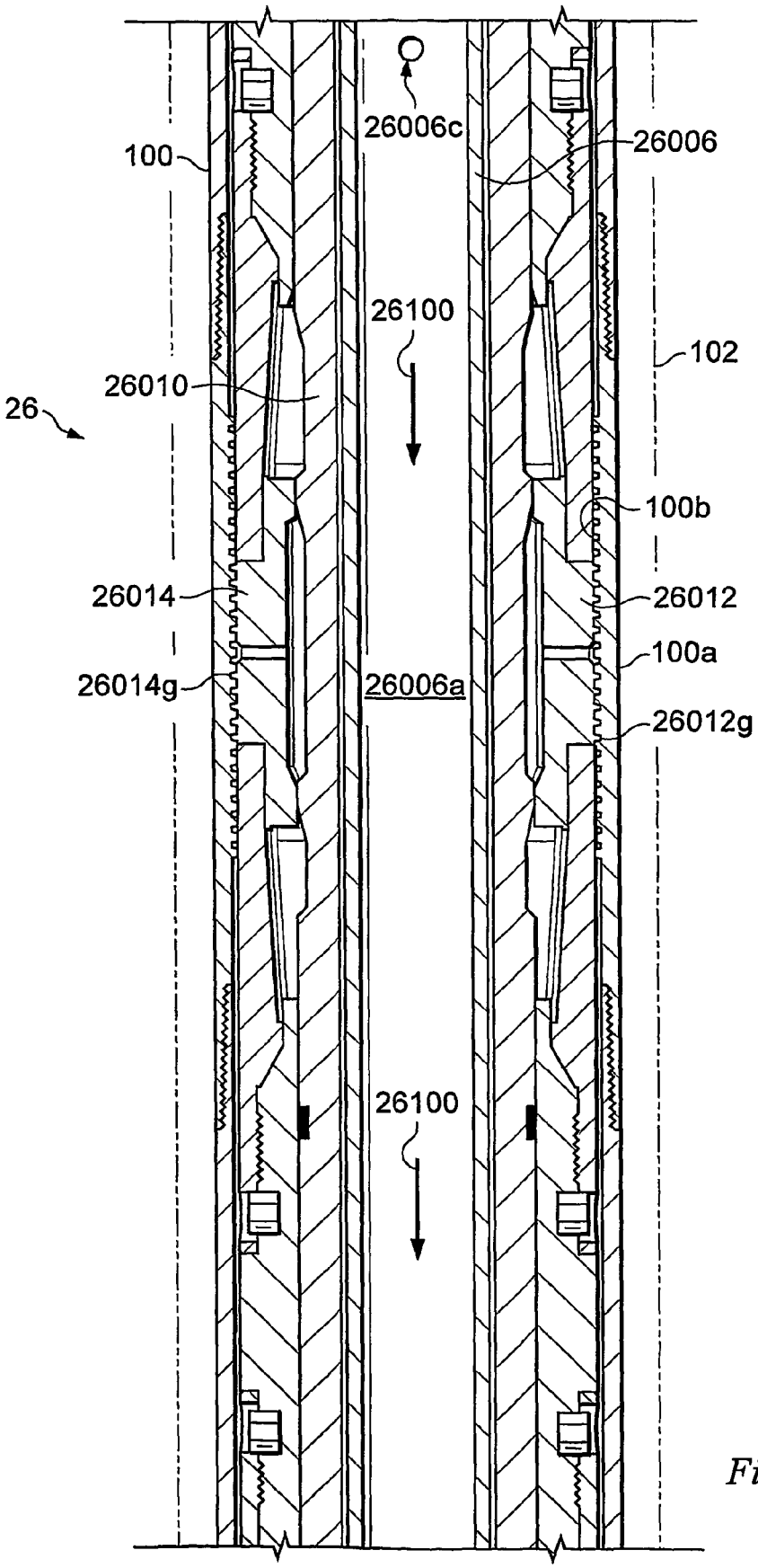
*Fig. 15F2*

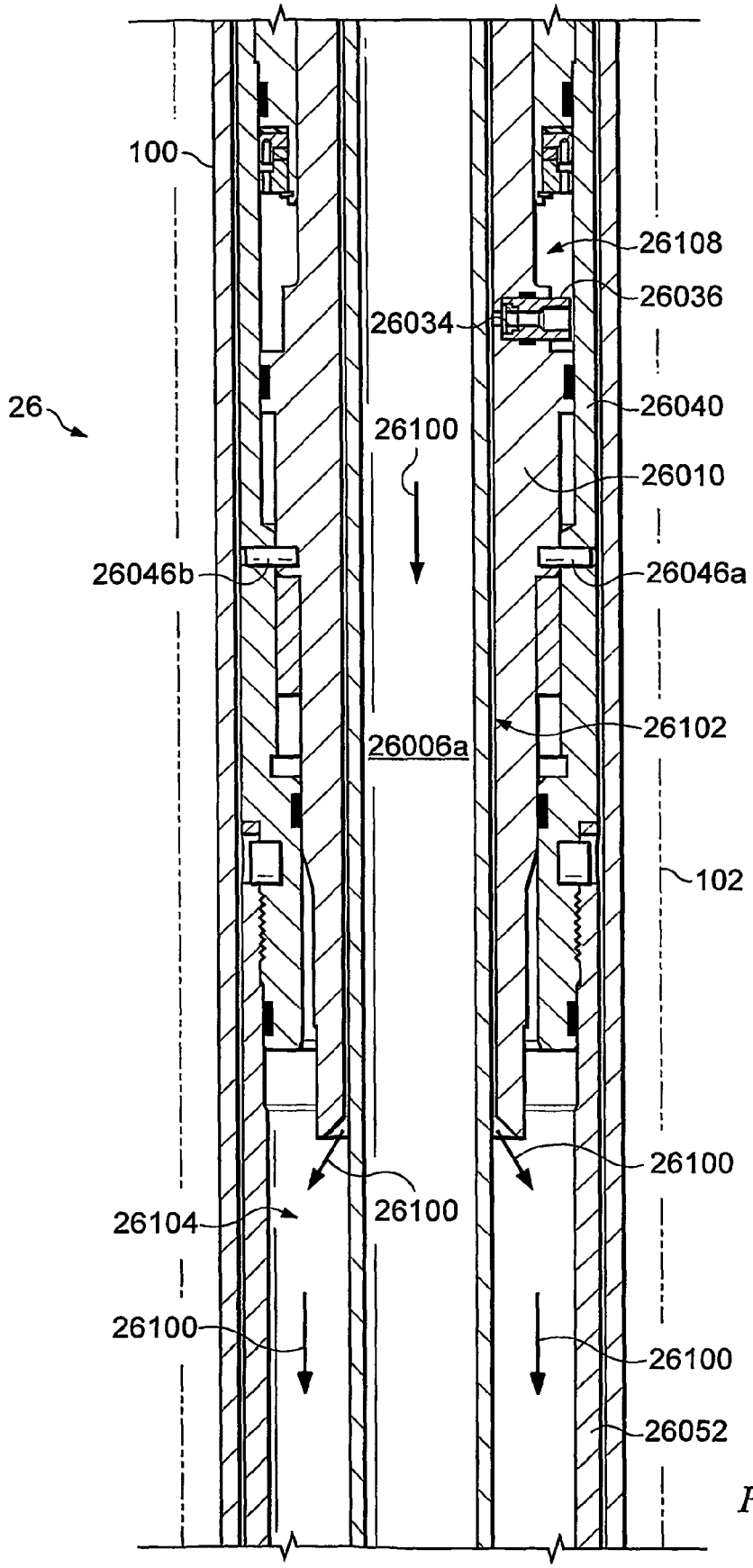
*Fig. 15F3*

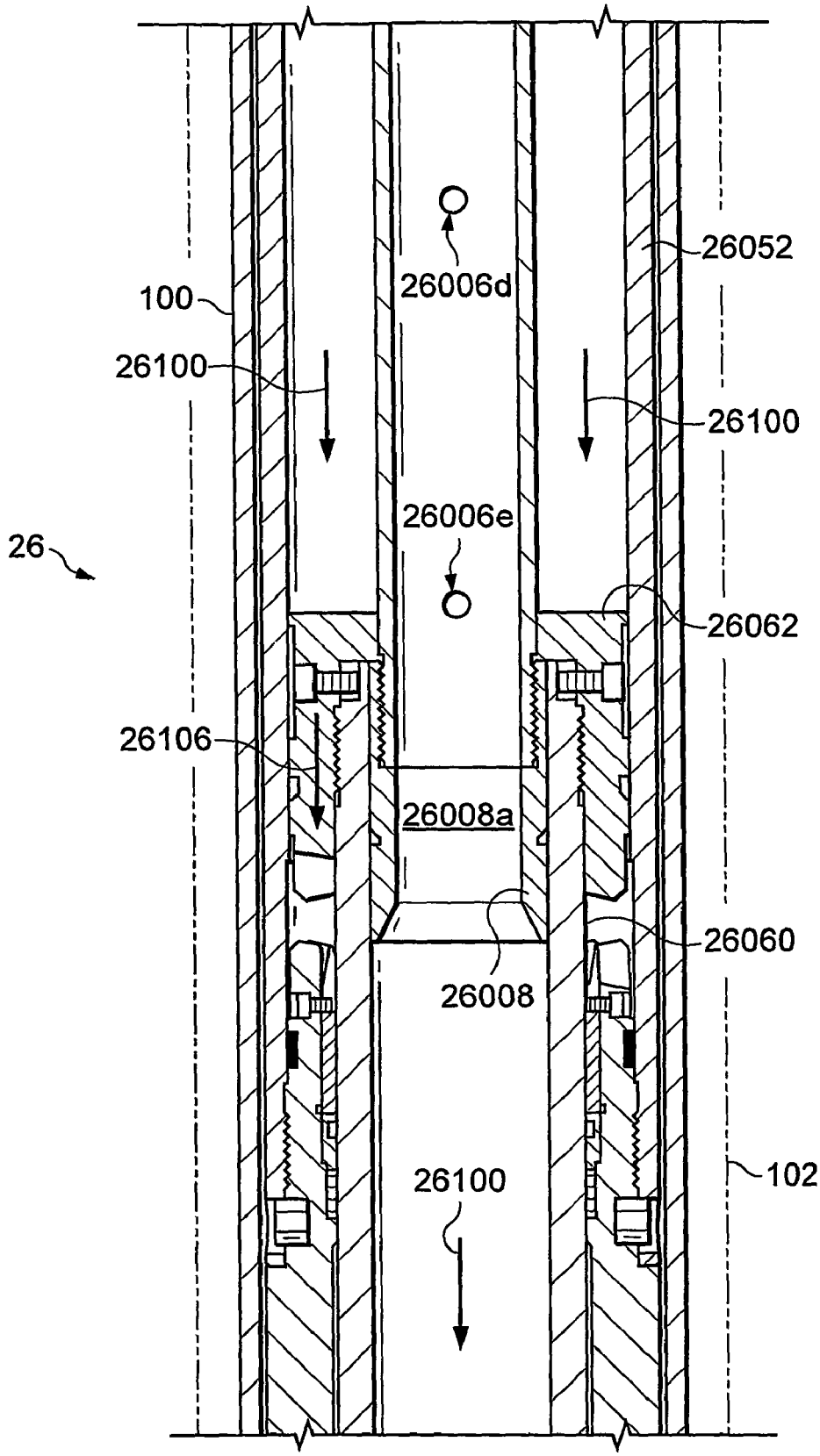
*Fig. 15F4*

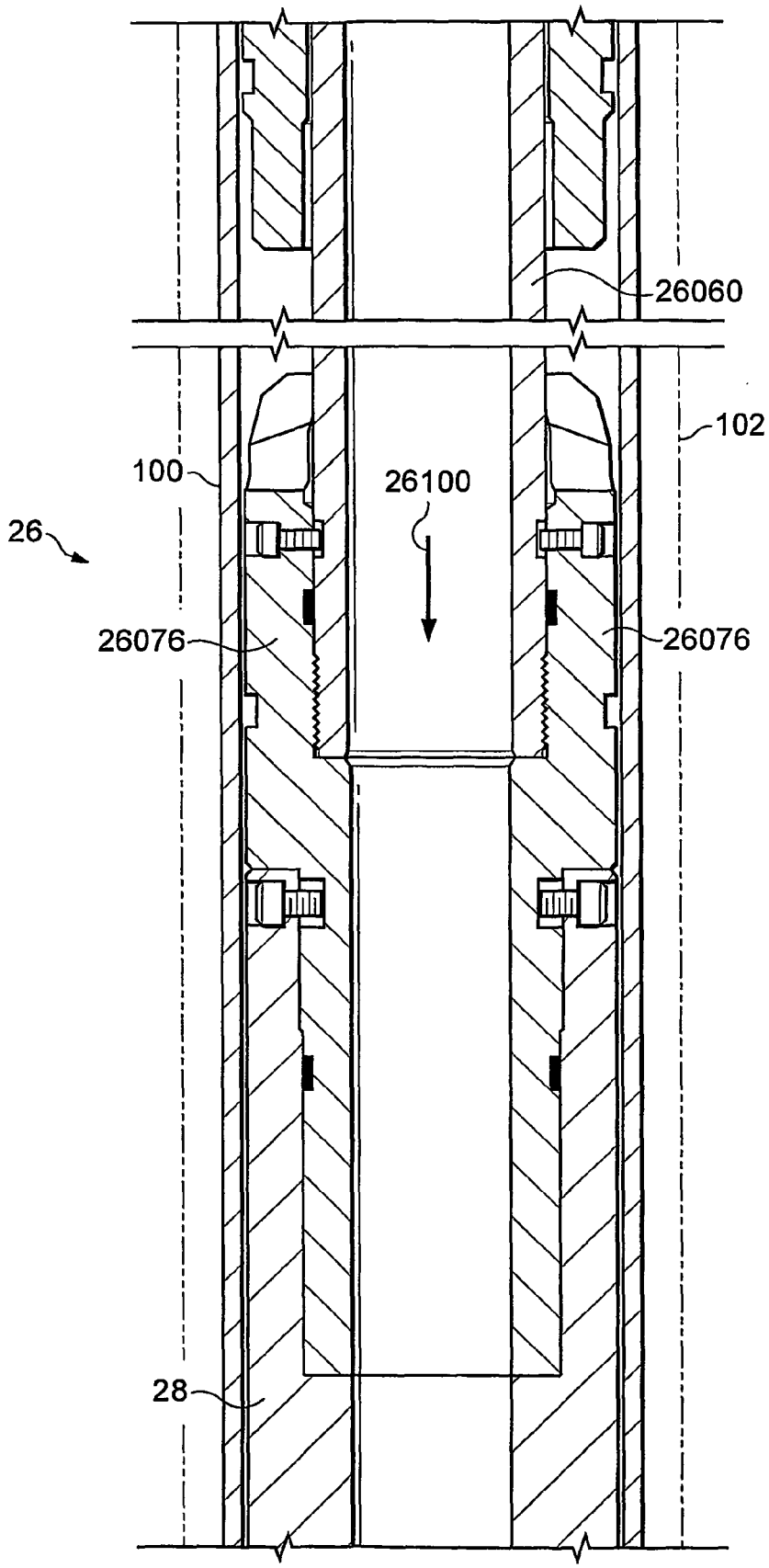
*Fig. 15F5*

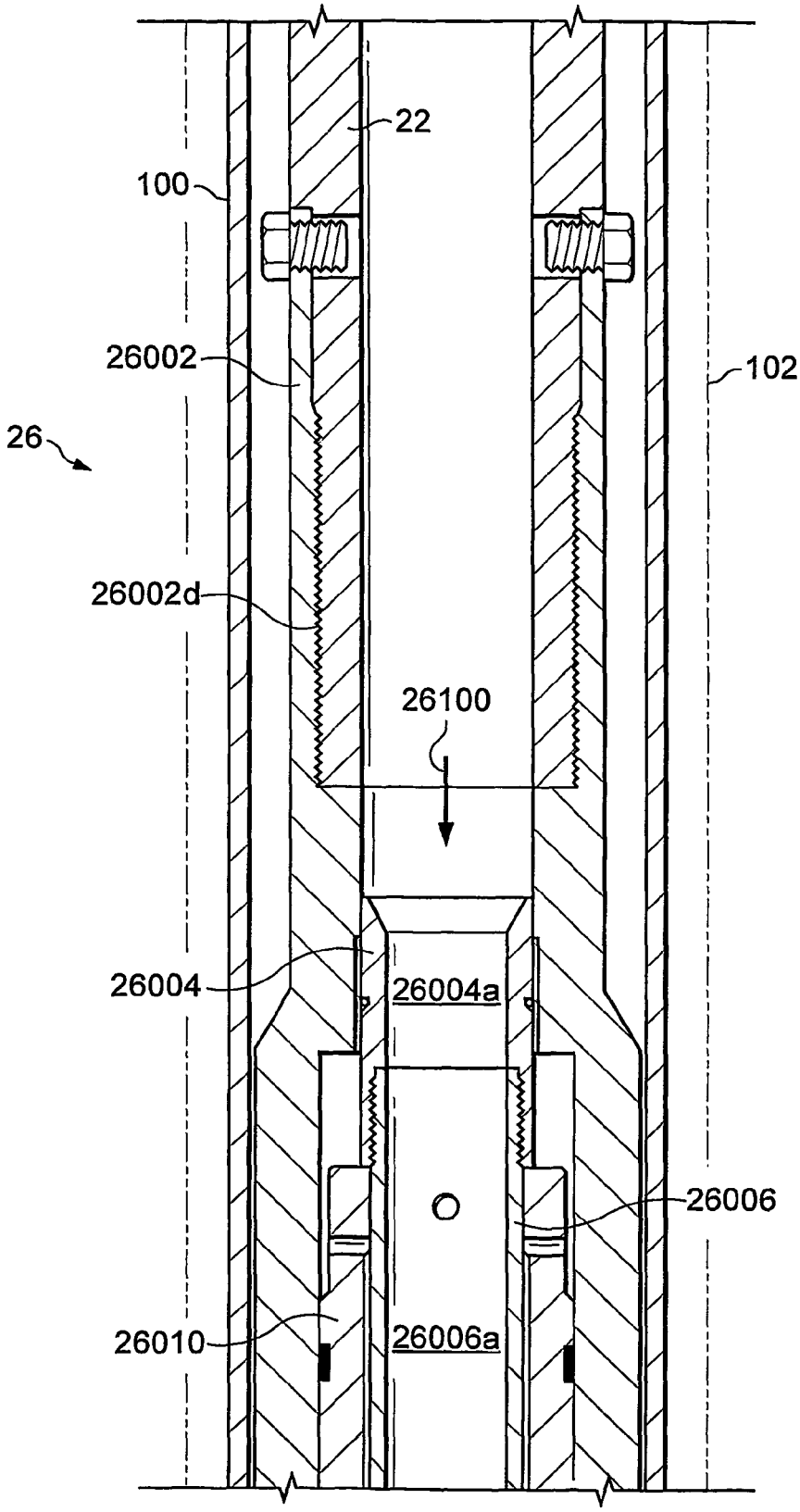
*Fig. 15G1*

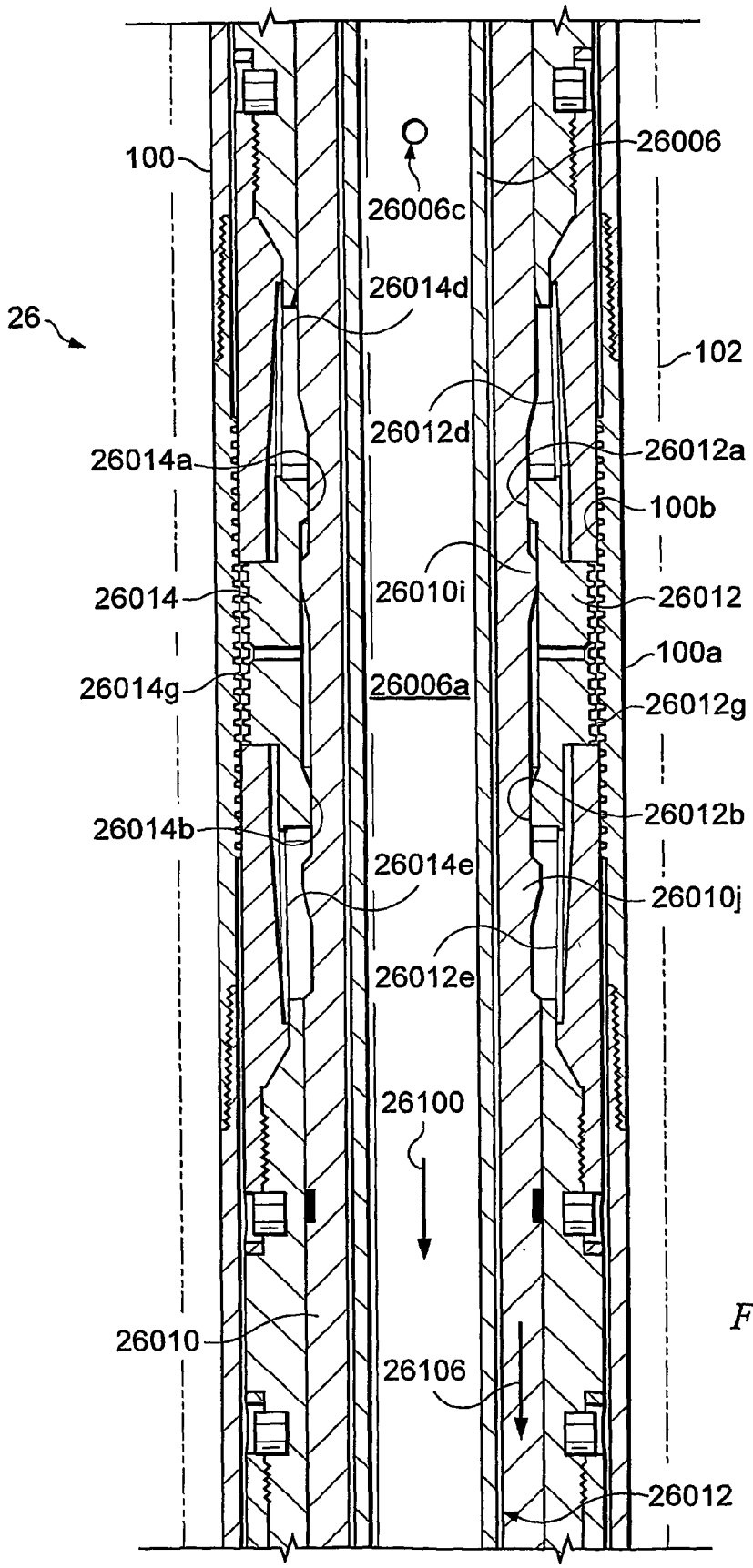
*Fig. 15G2*

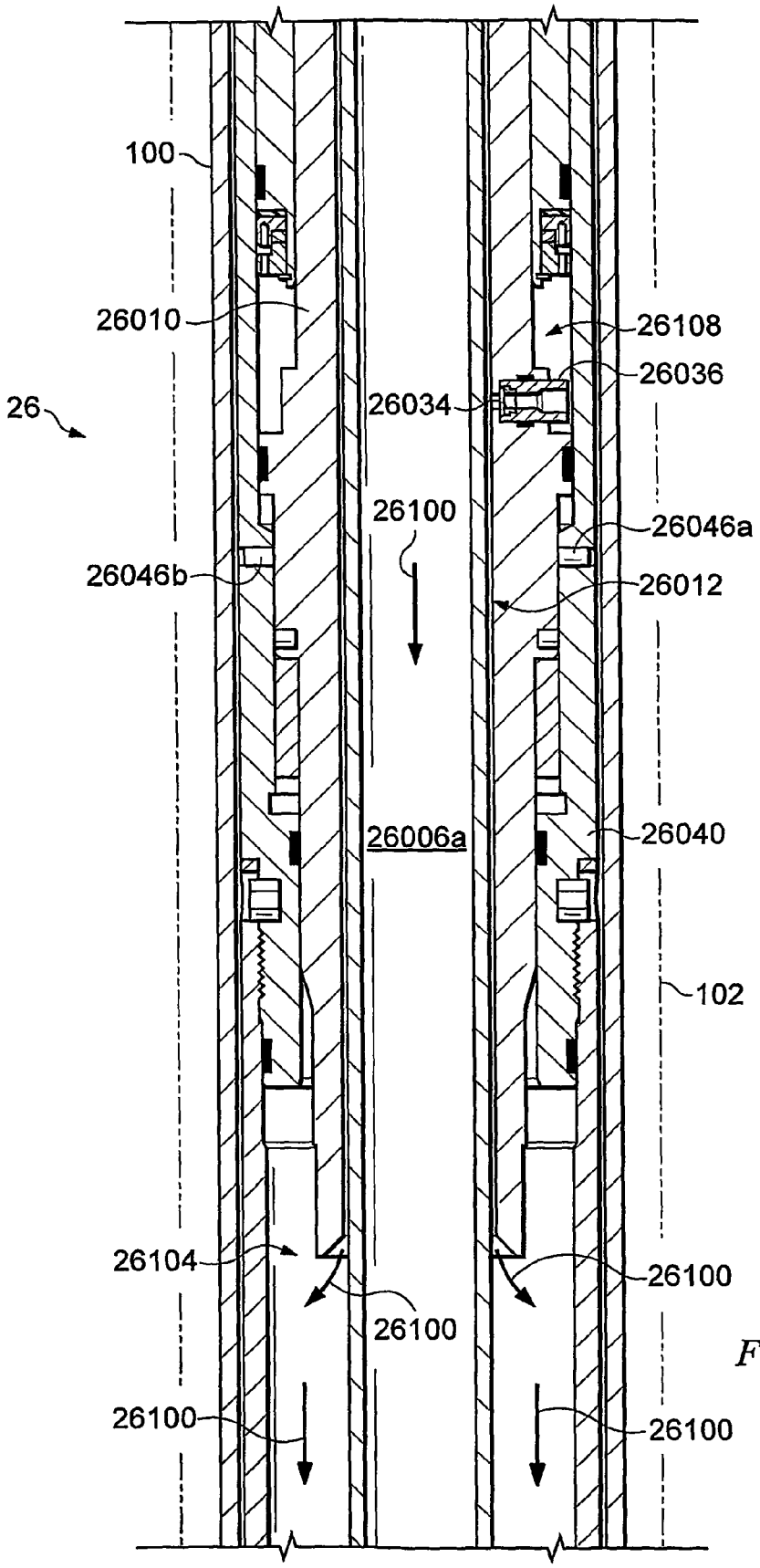
*Fig. 15G3*

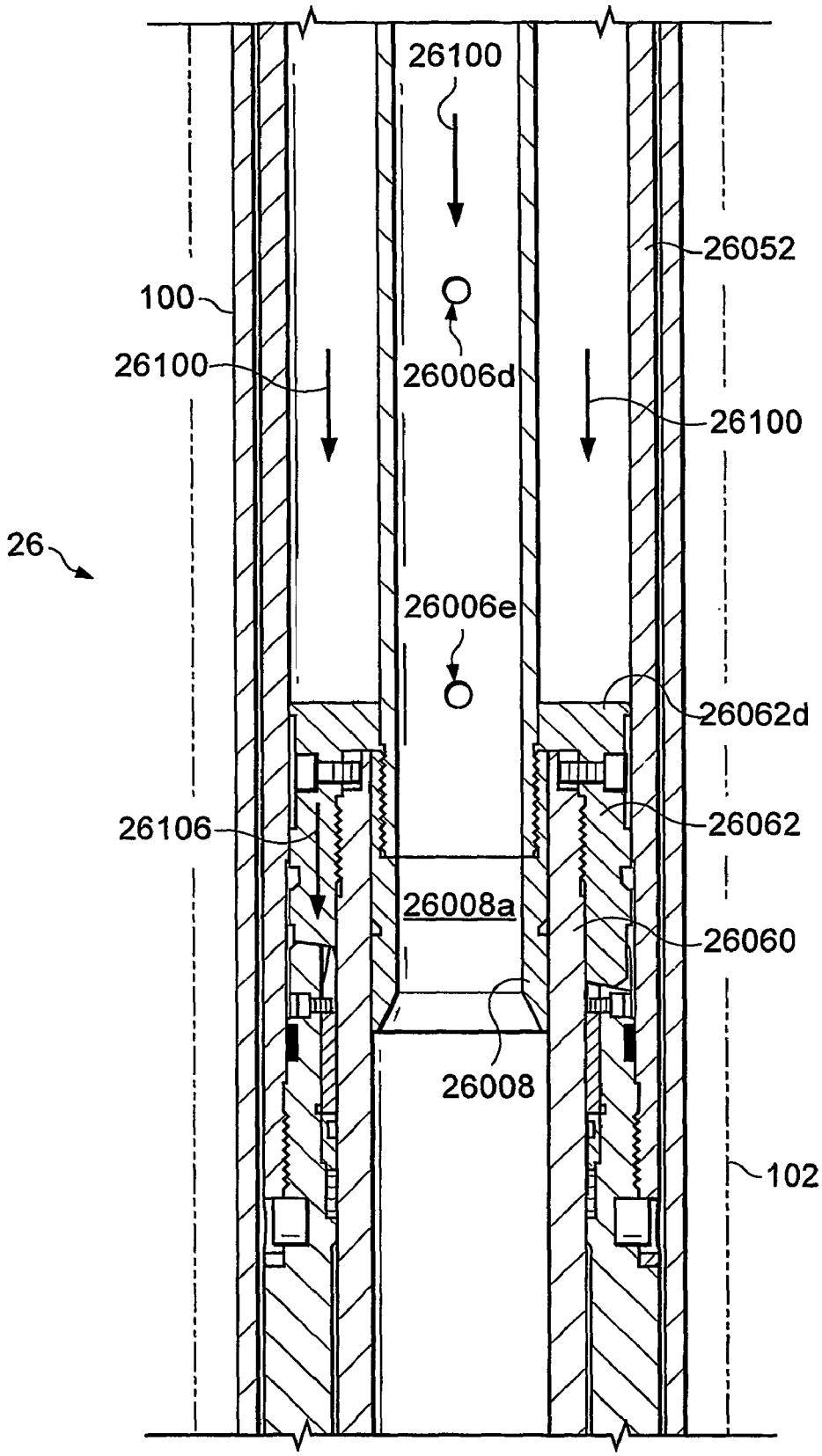
*Fig. 15G4*

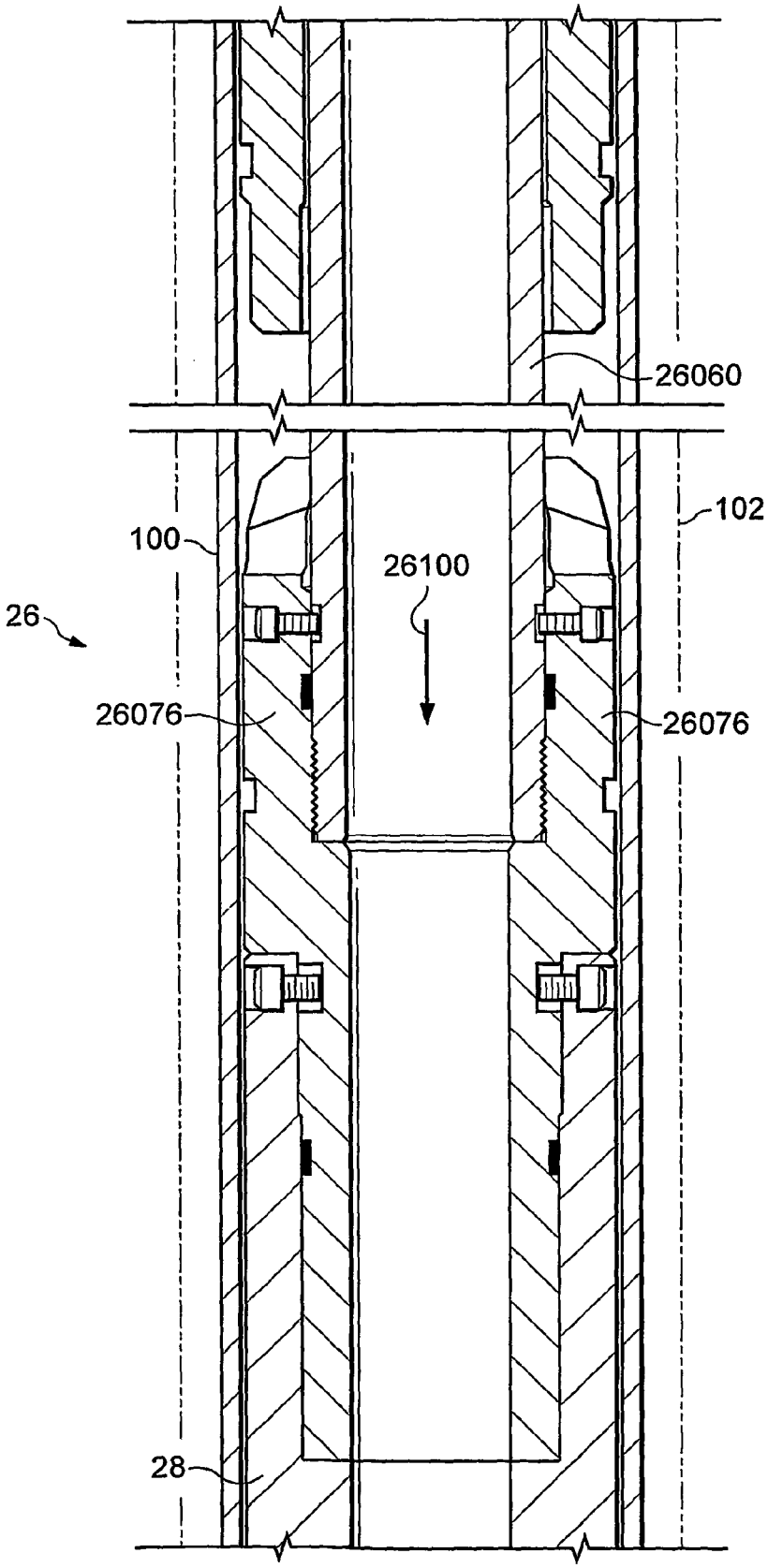
*Fig. 15G5*

*Fig. 16A1*
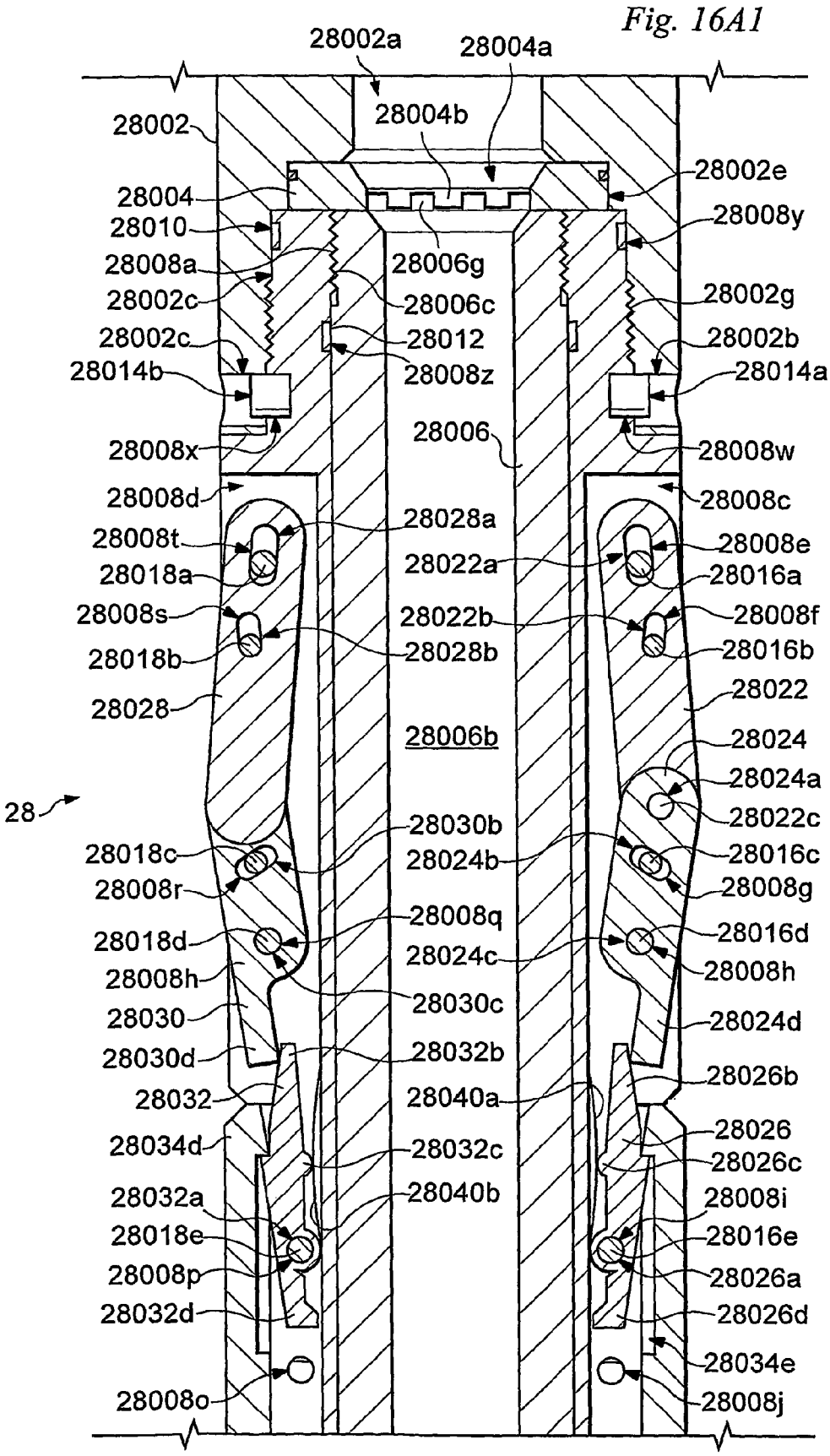

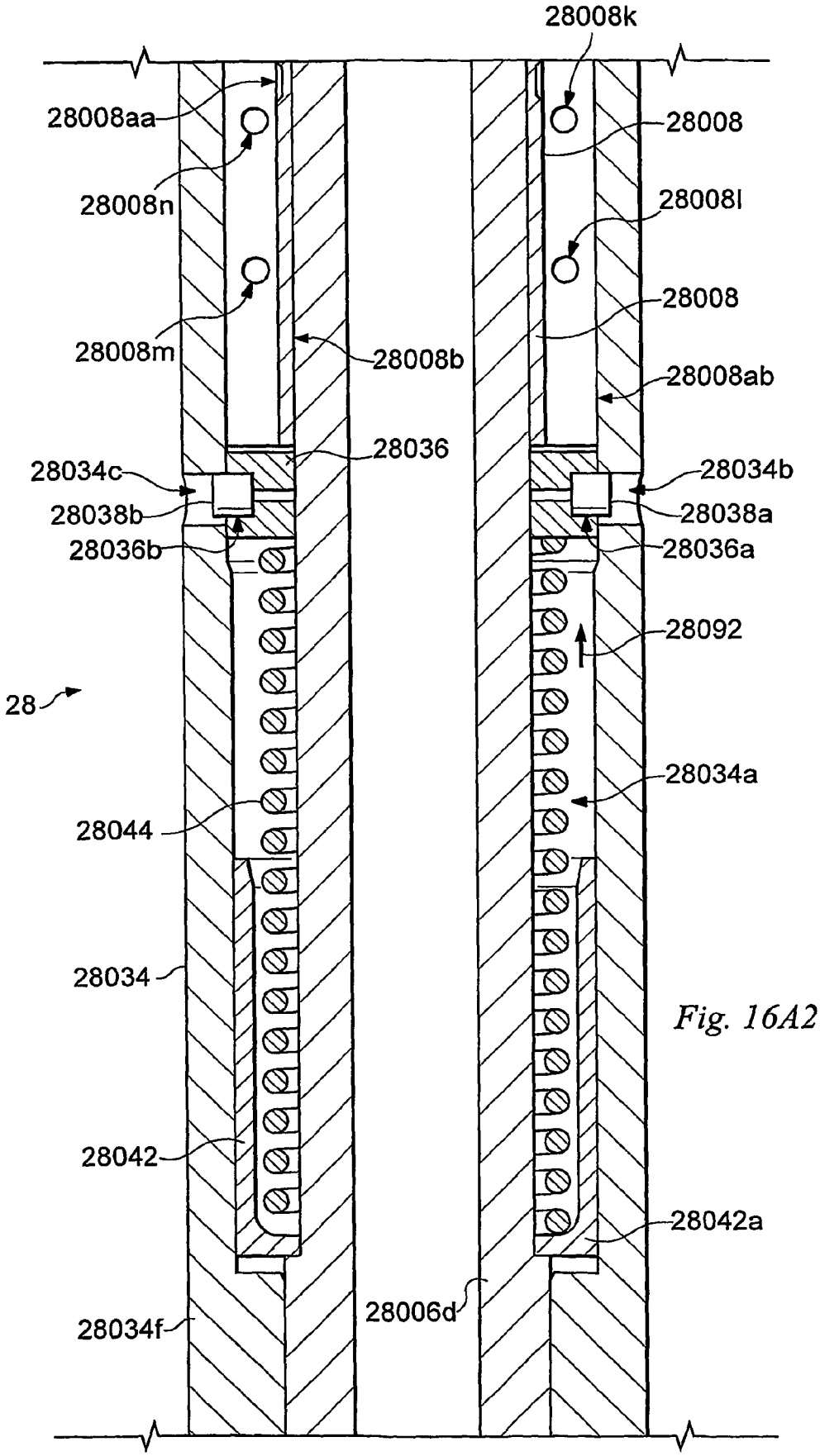
Fig. 16A2

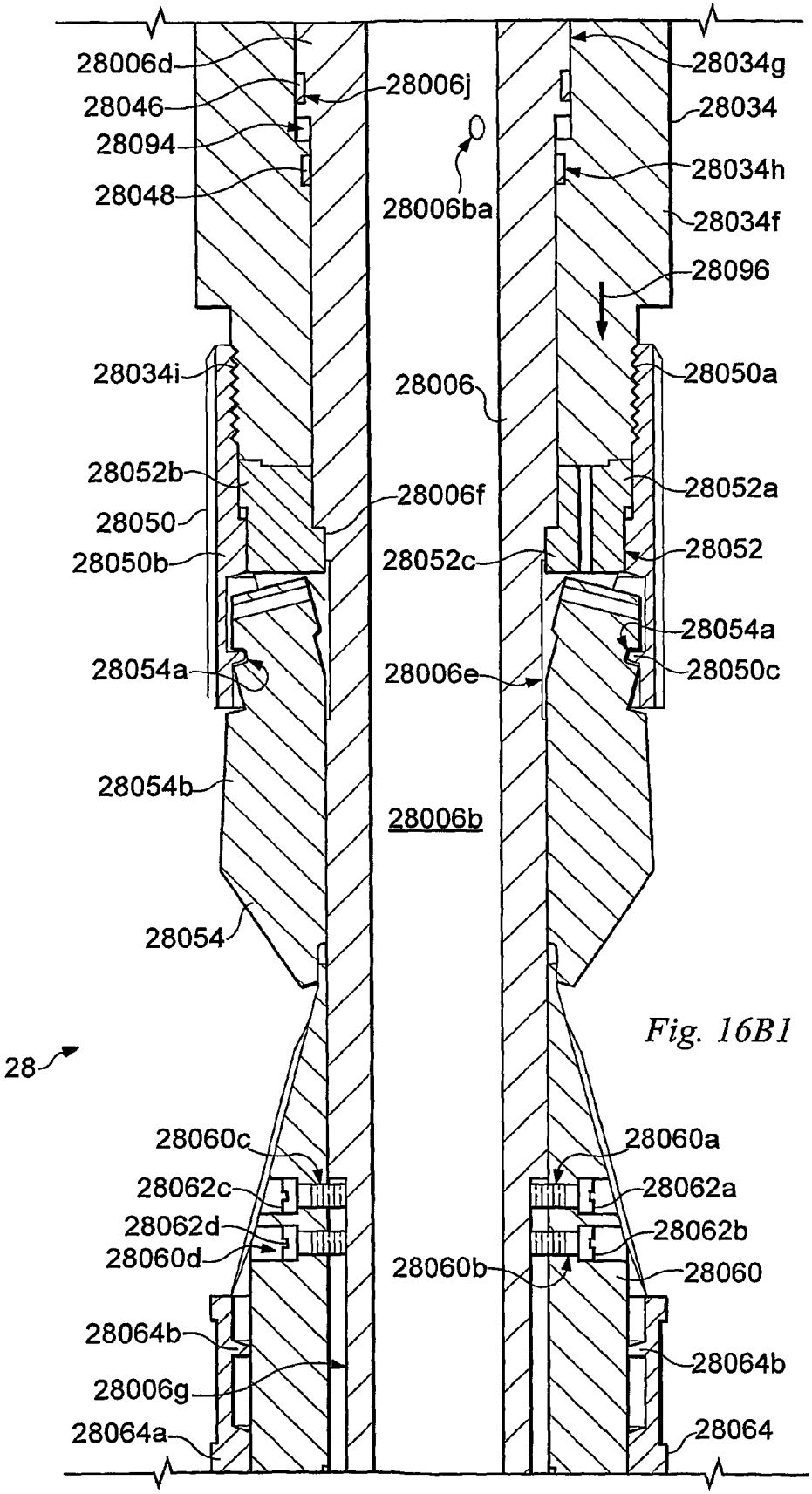
*Fig. 16B1*

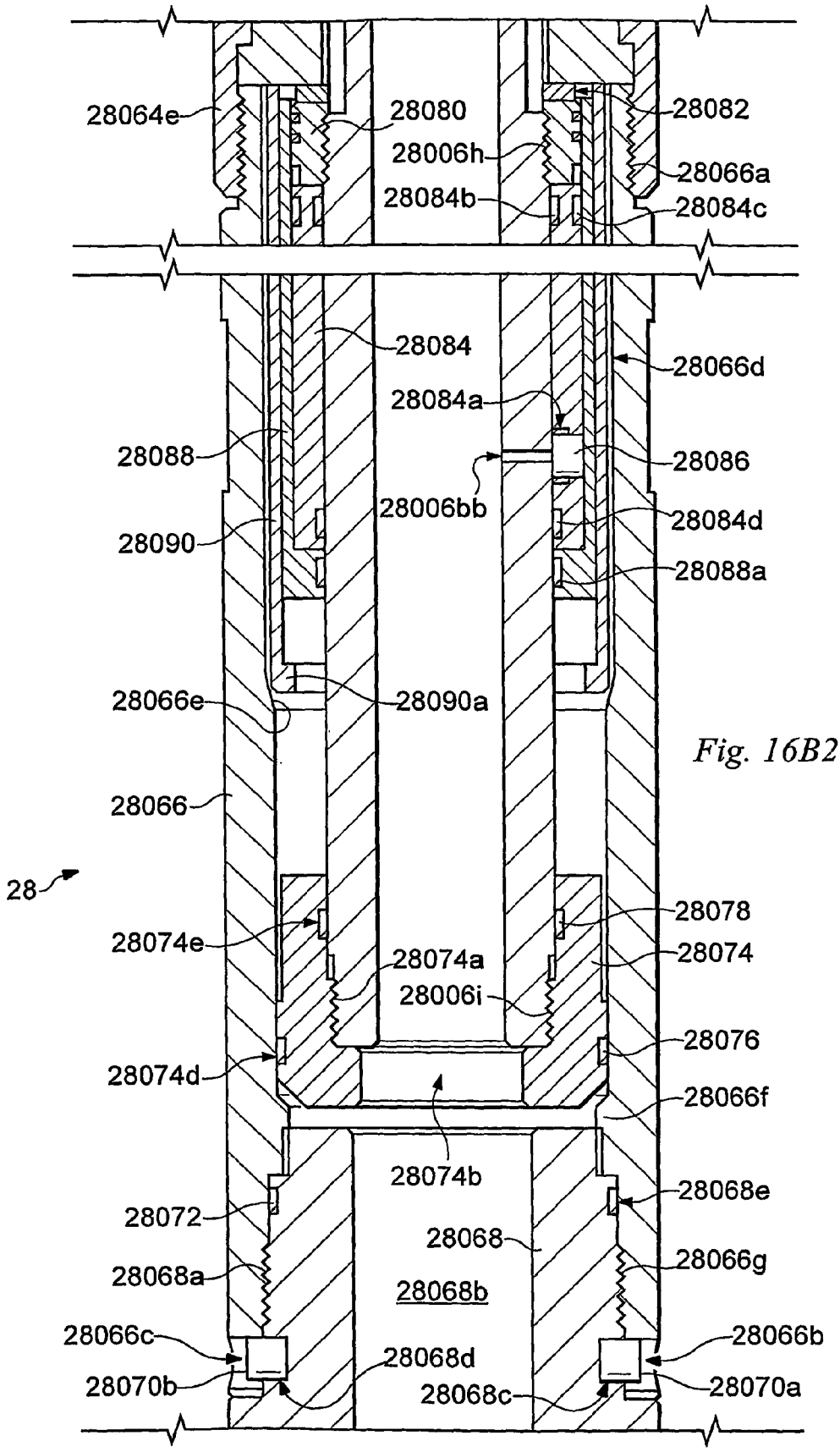
*Fig. 16B2*

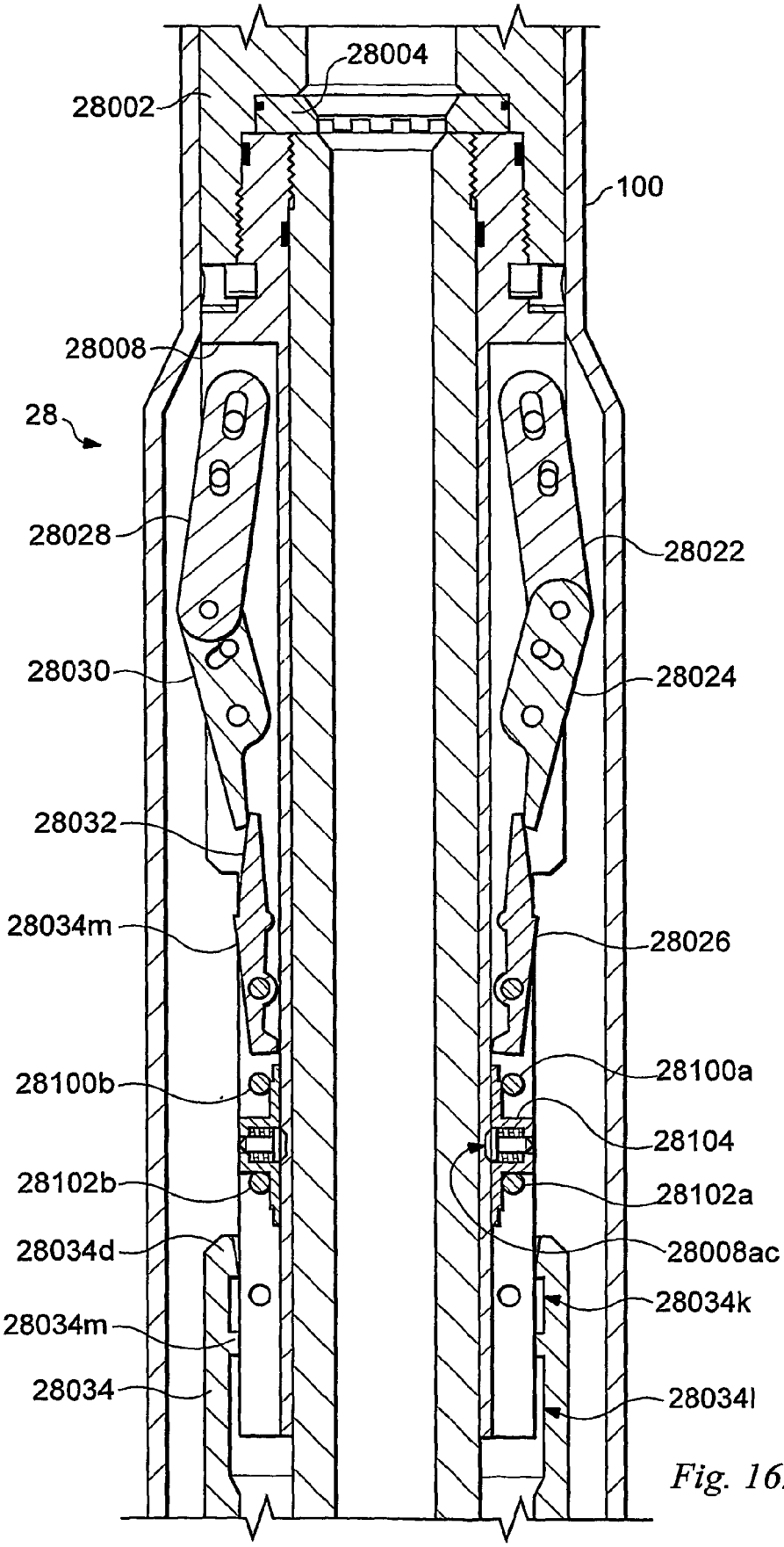
*Fig. 16Z1*

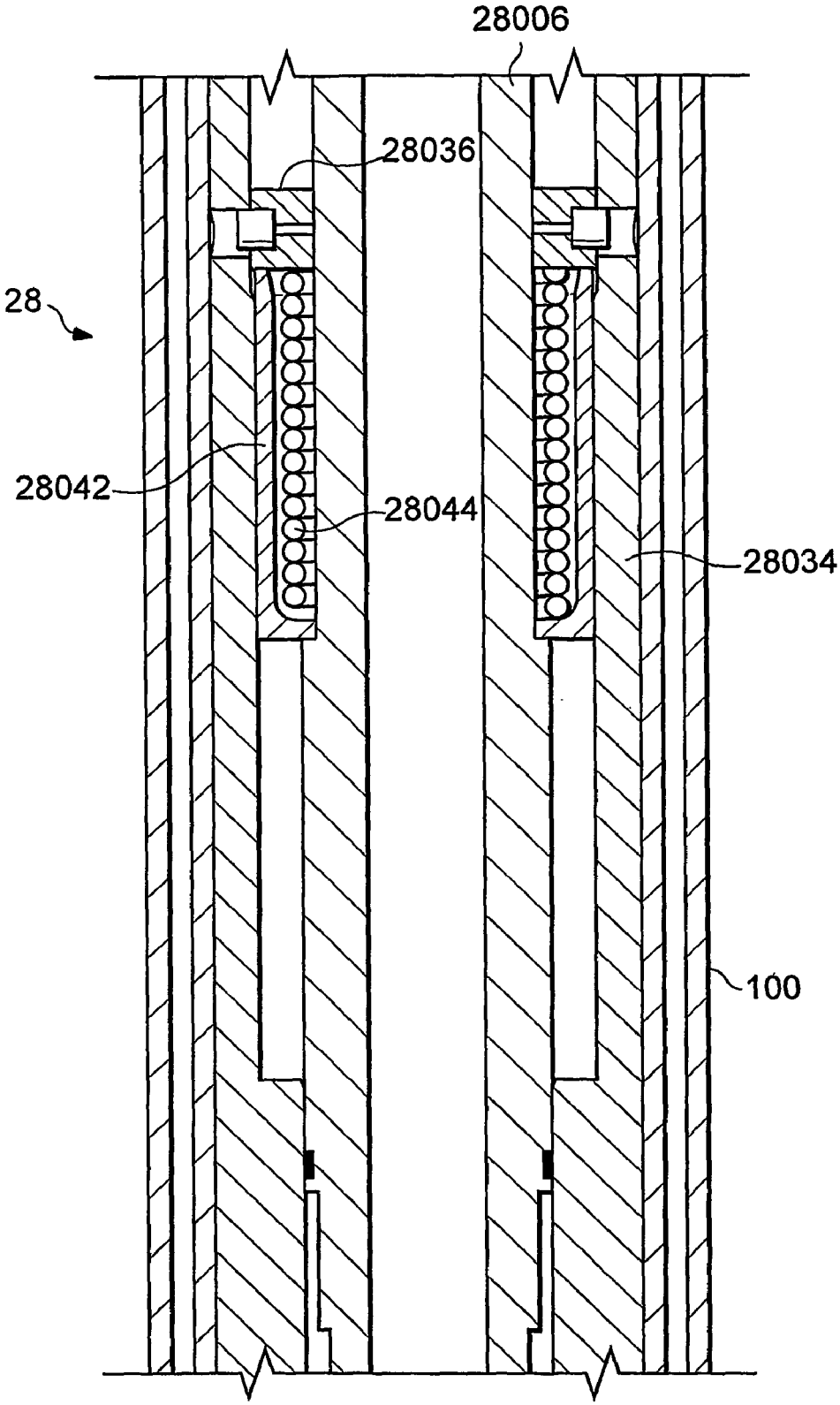
*Fig. 16Z2*

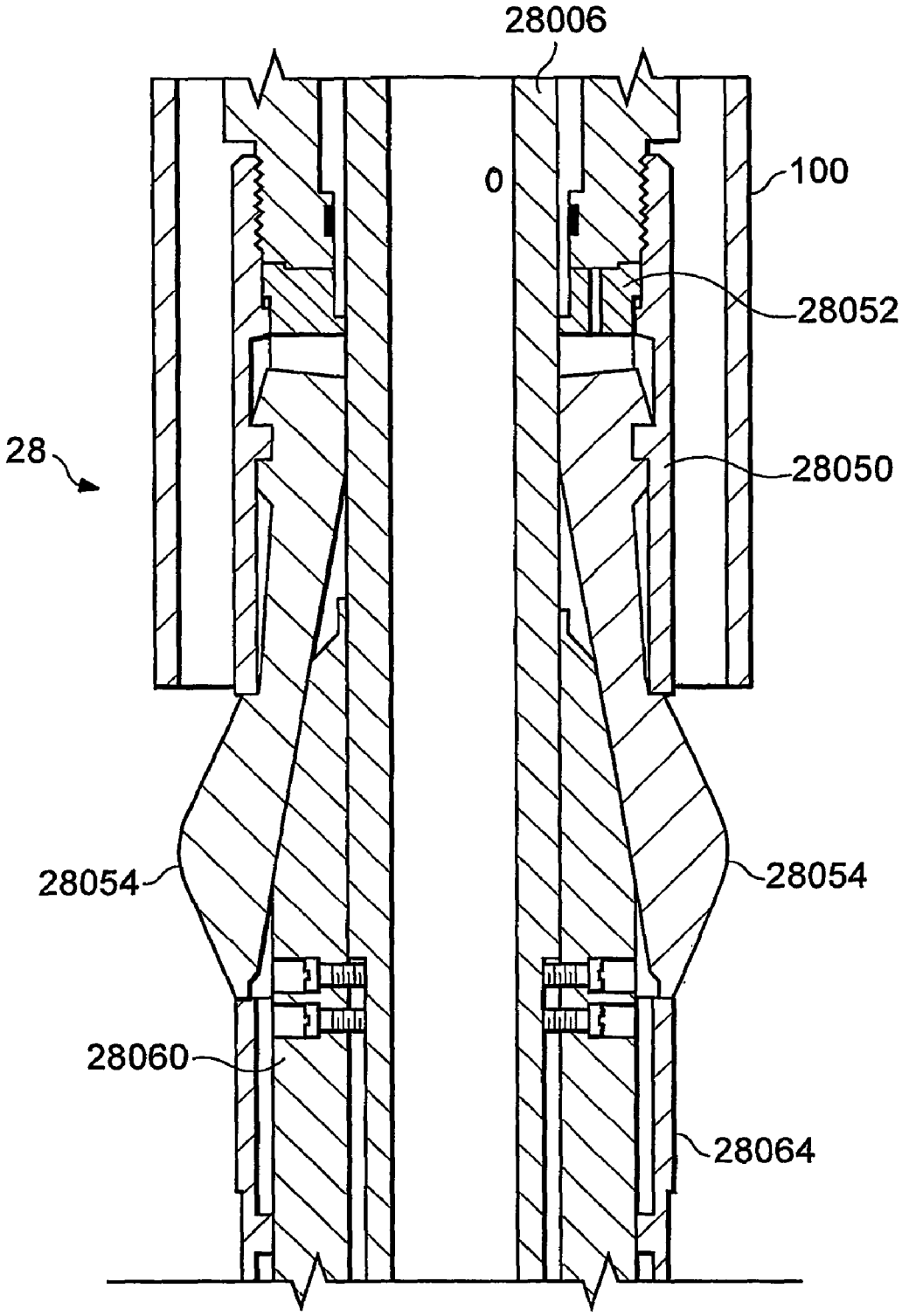
*Fig. 16Z3*

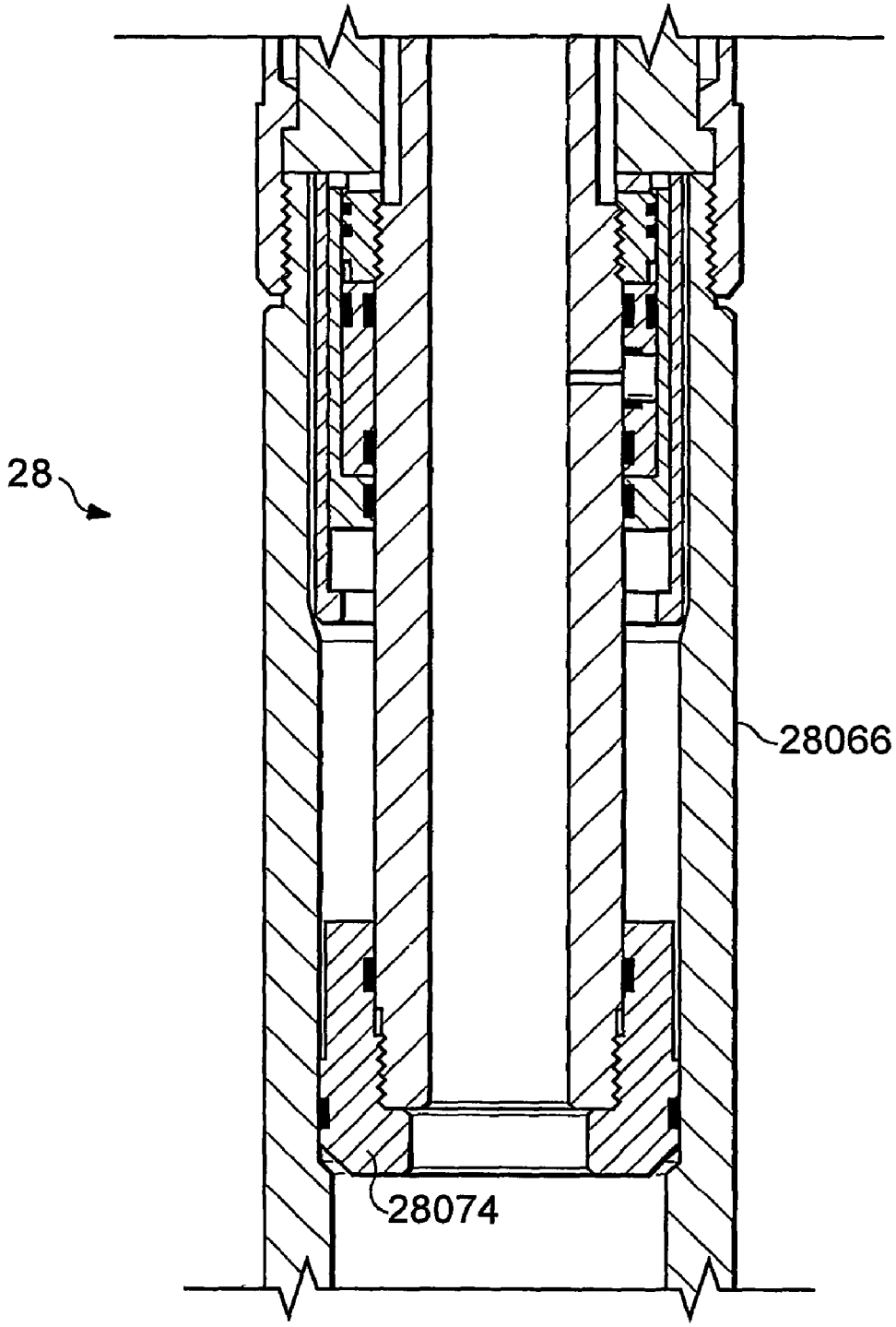
*Fig. 16Z4*

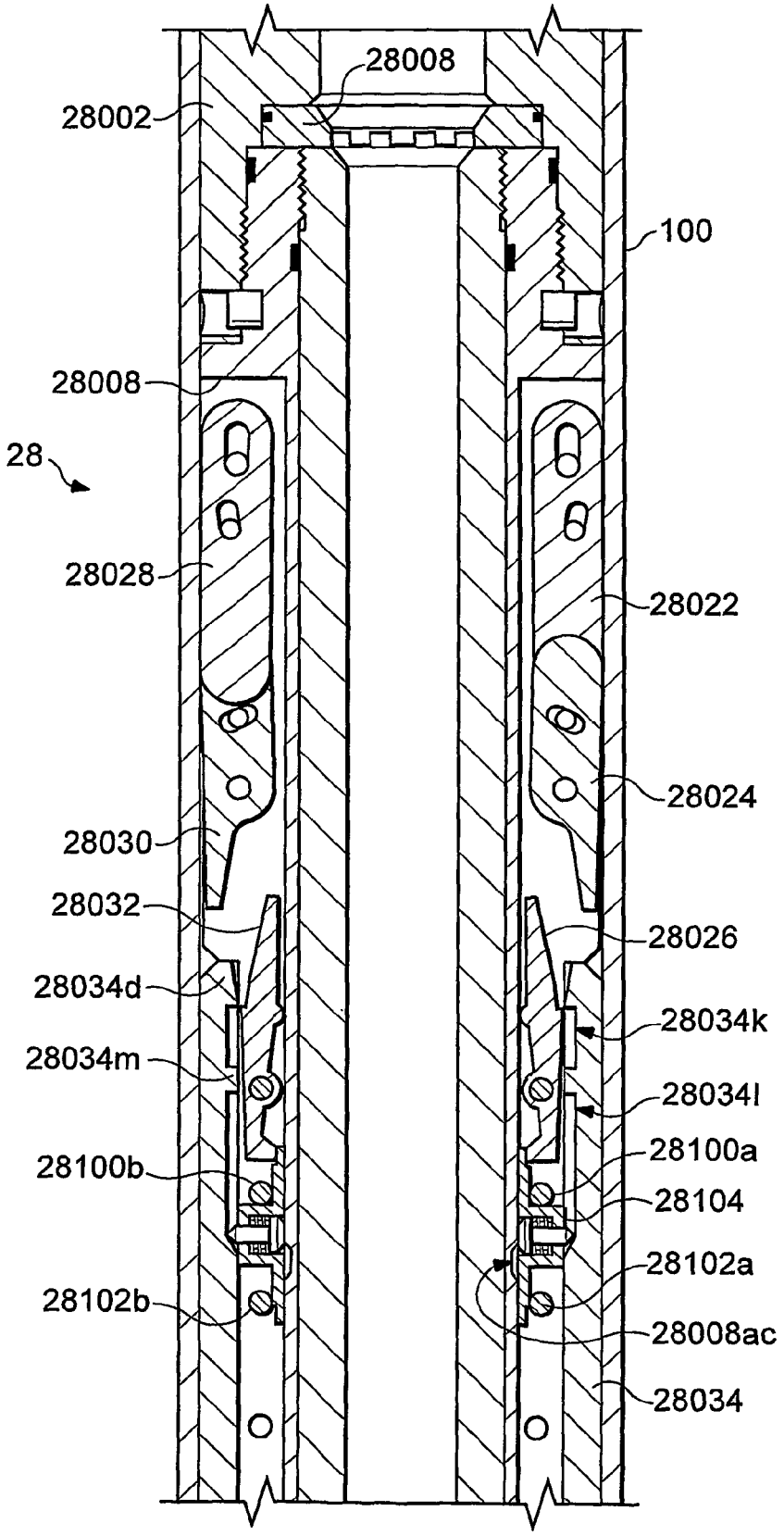
*Fig. 16AA1*

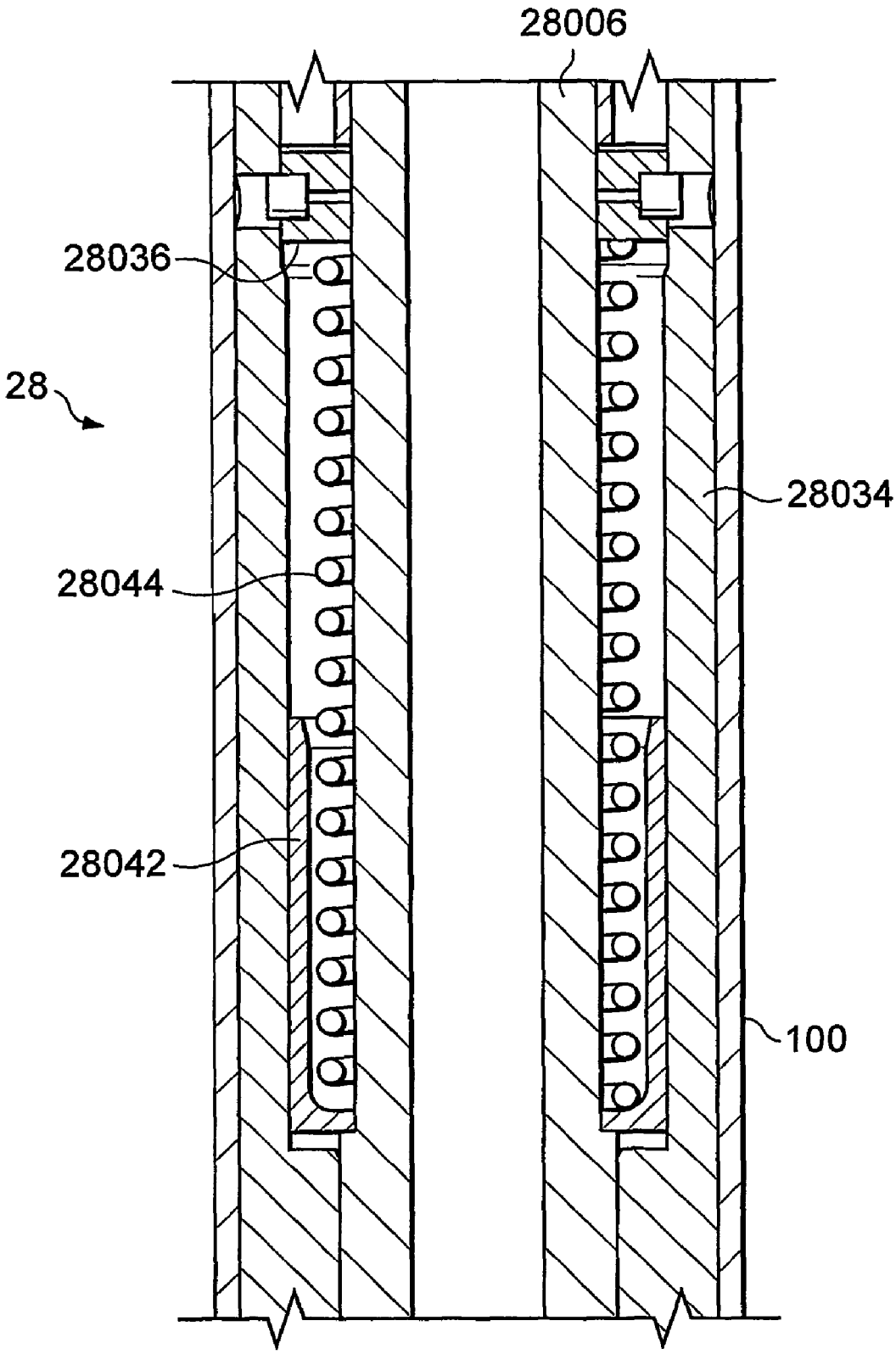
*Fig. 16AA2*

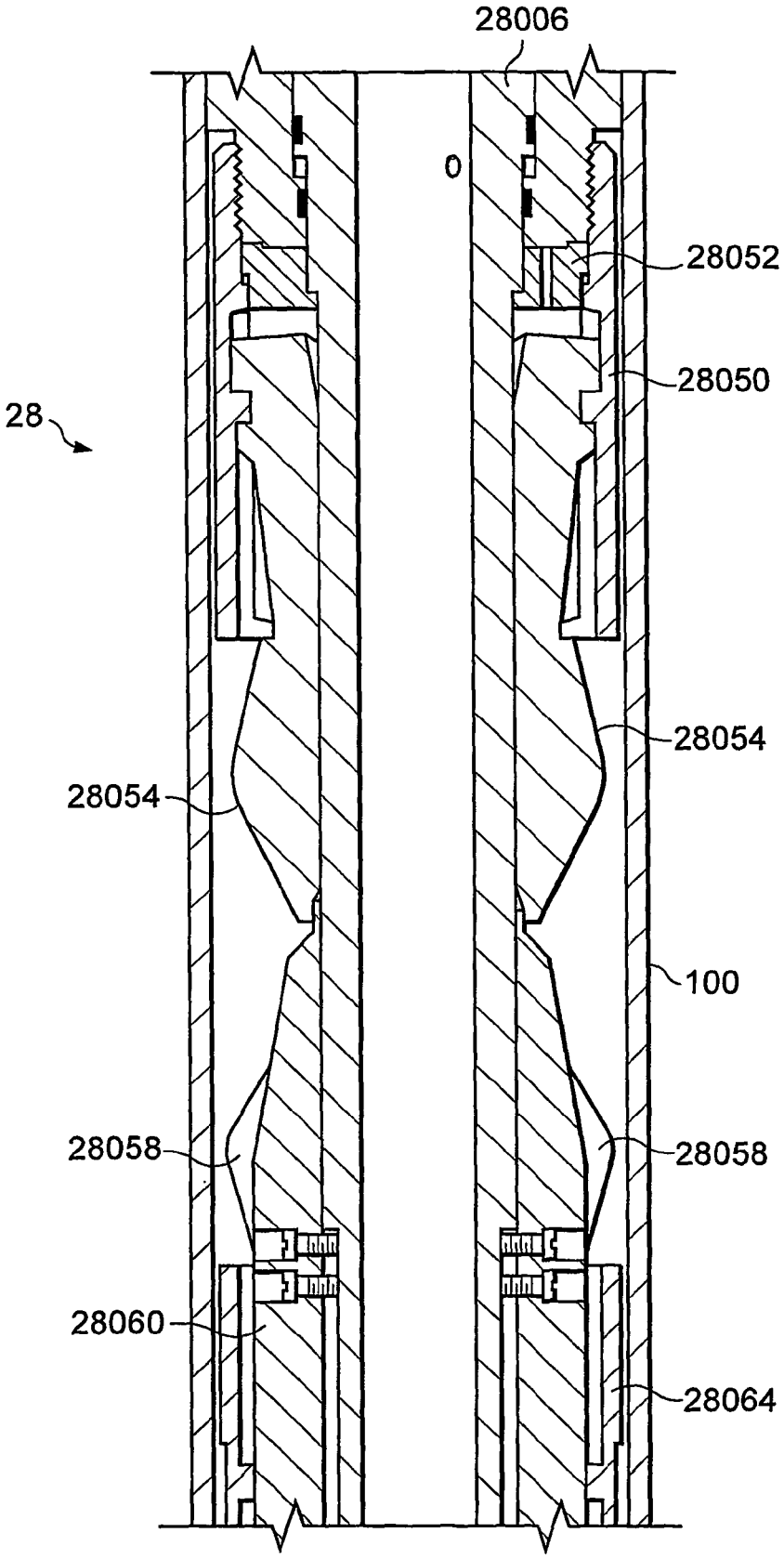
*Fig. 16AA3*

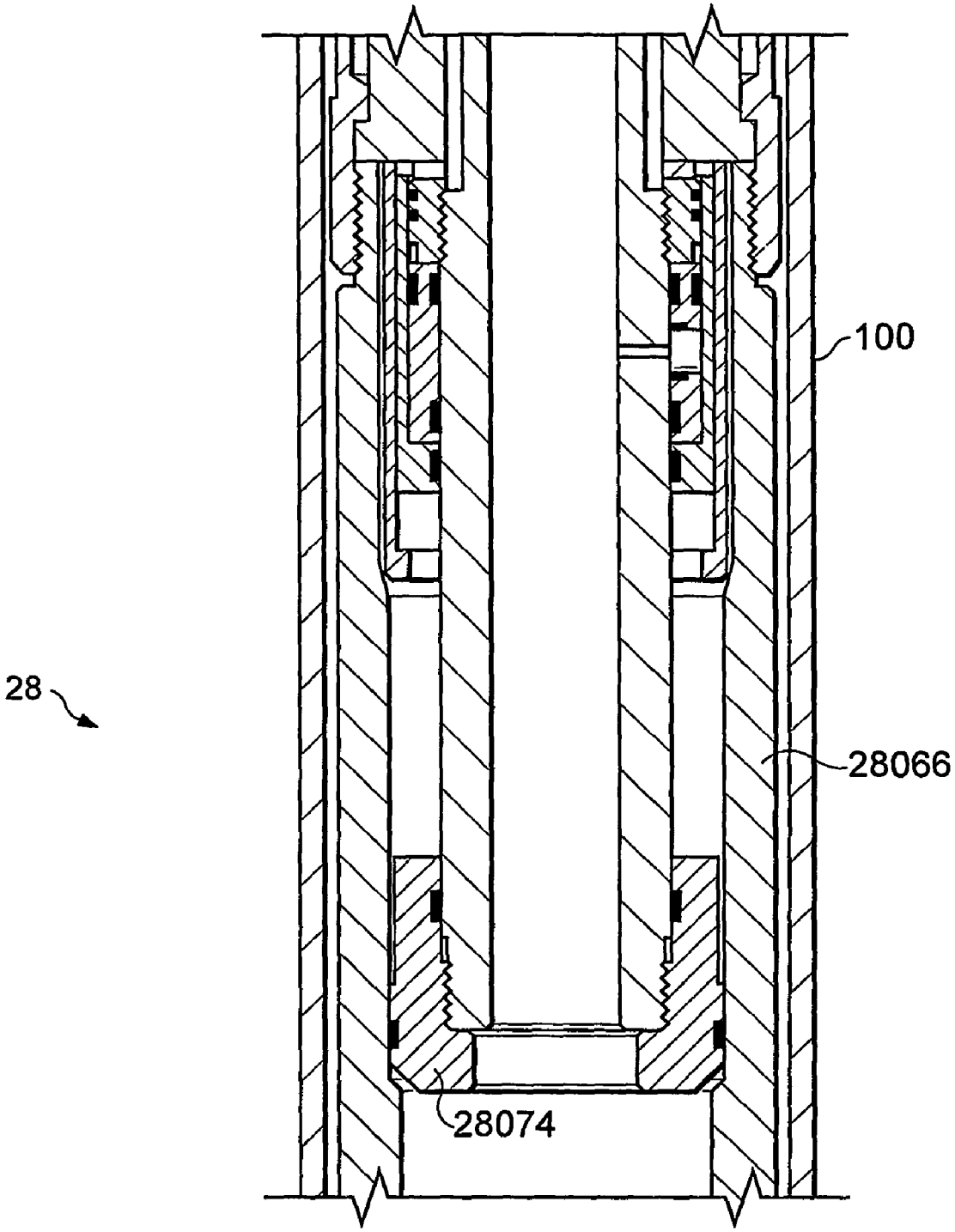
*Fig. 16AA4*

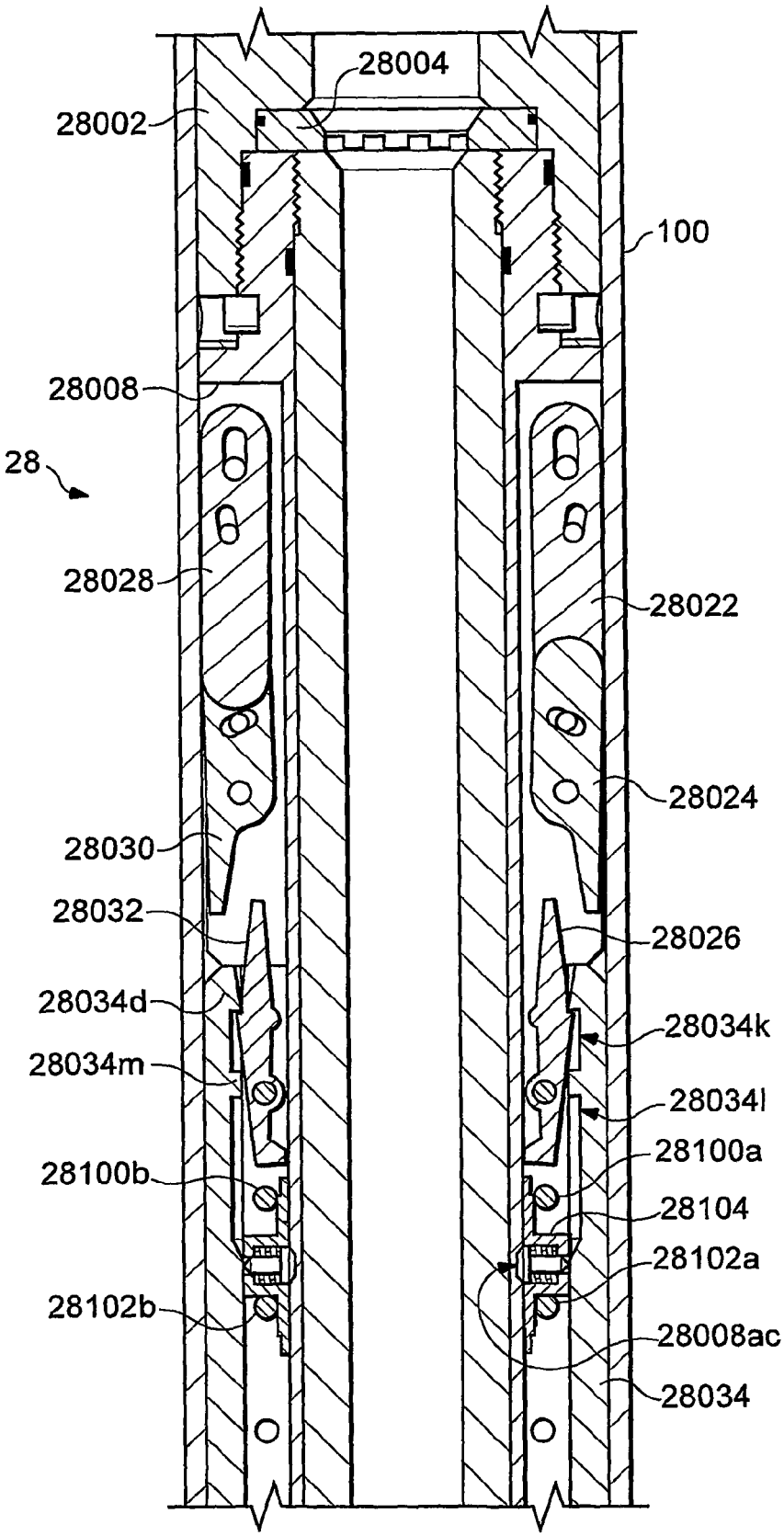
*Fig. 16AB1*

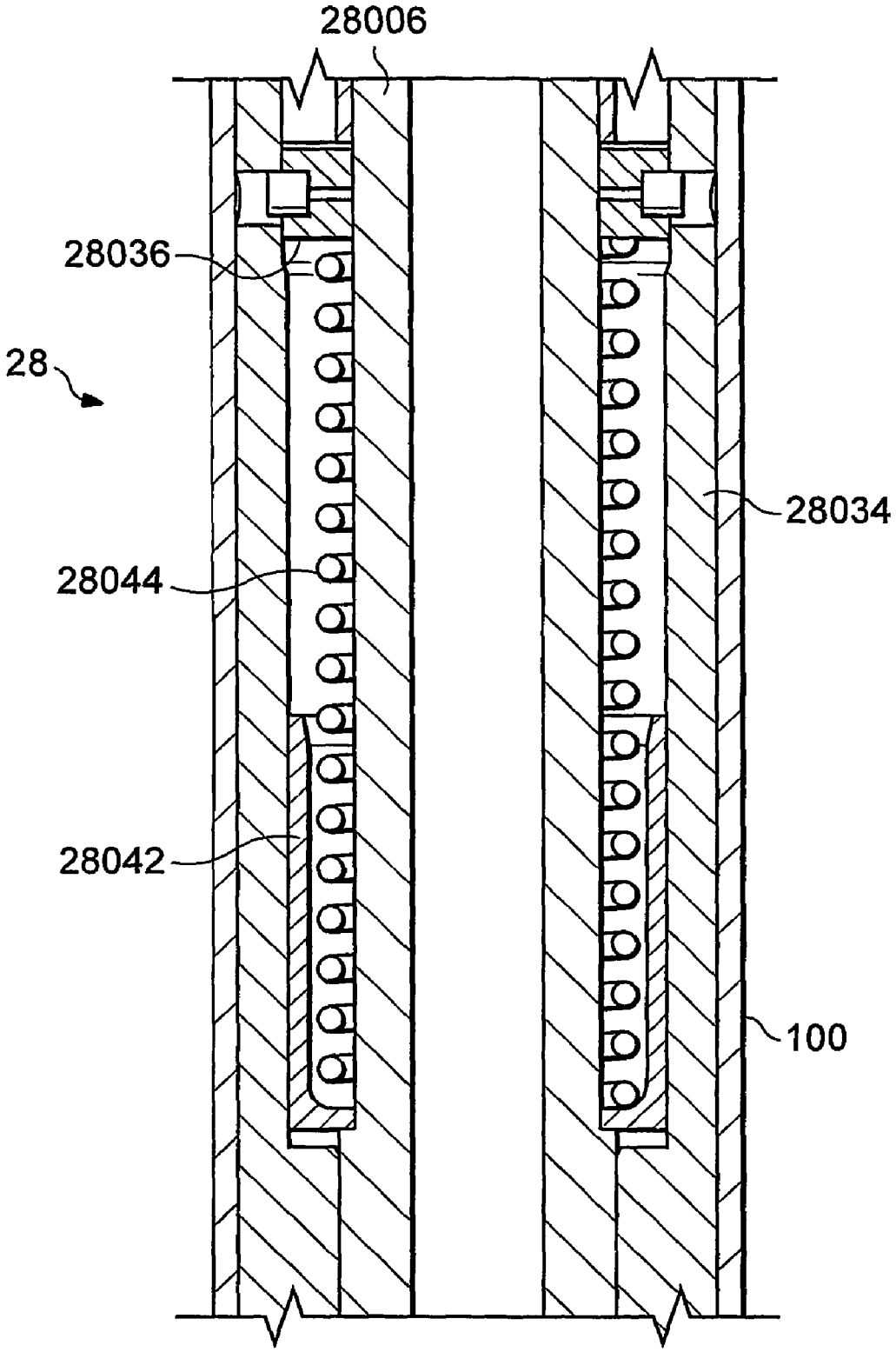
*Fig. 16AB2*

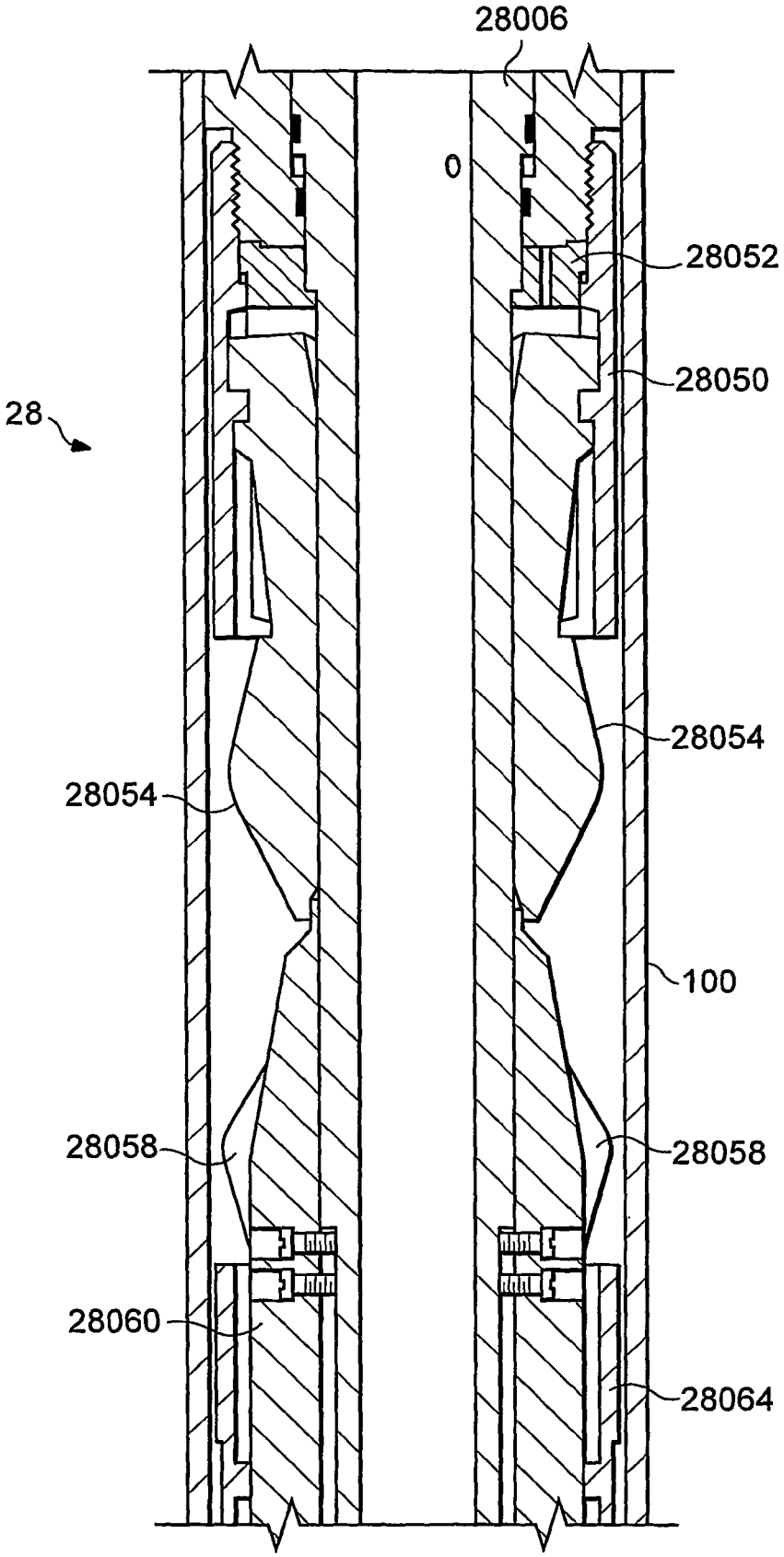
*Fig. 16AB3*

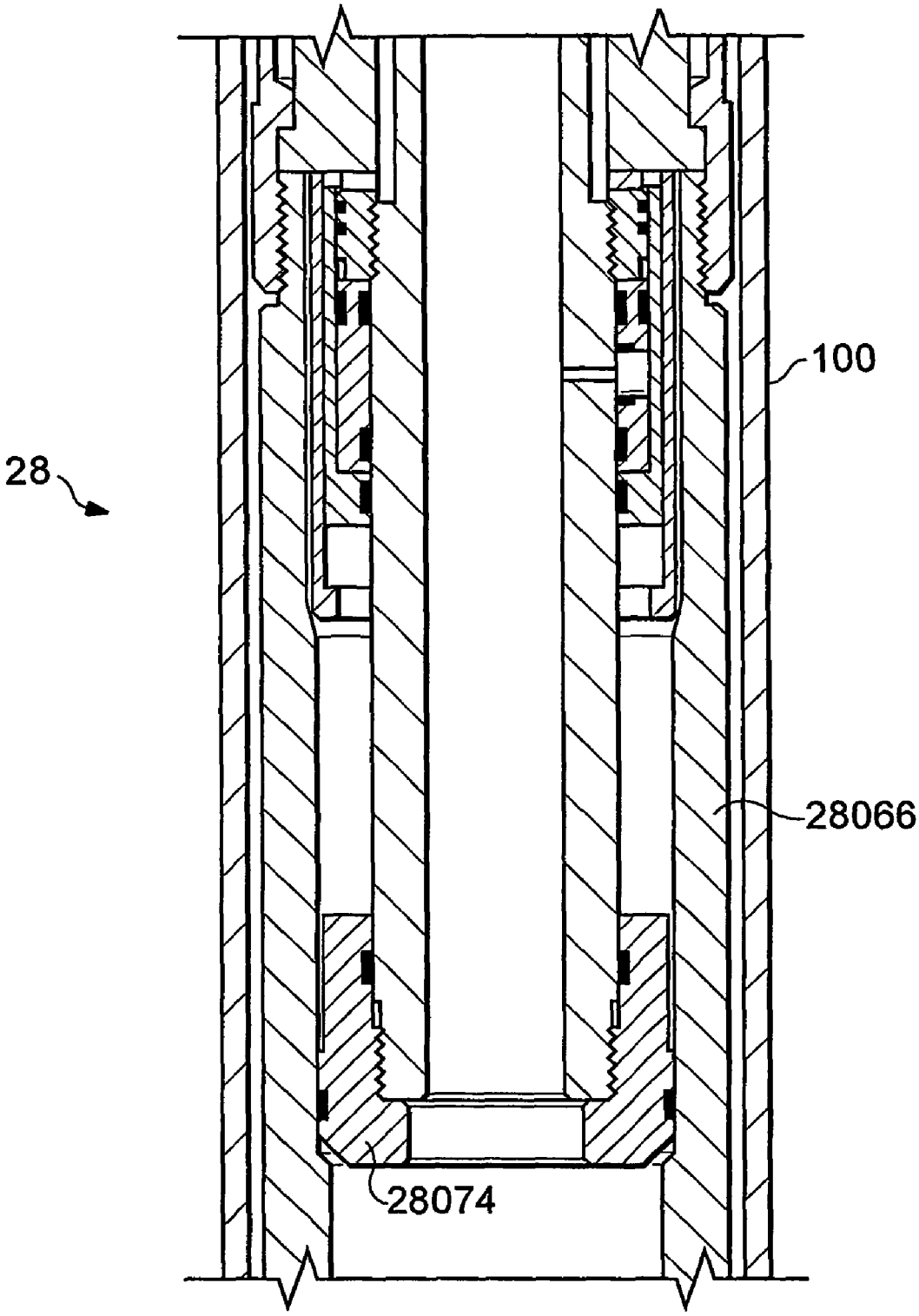
*Fig. 16AB4*

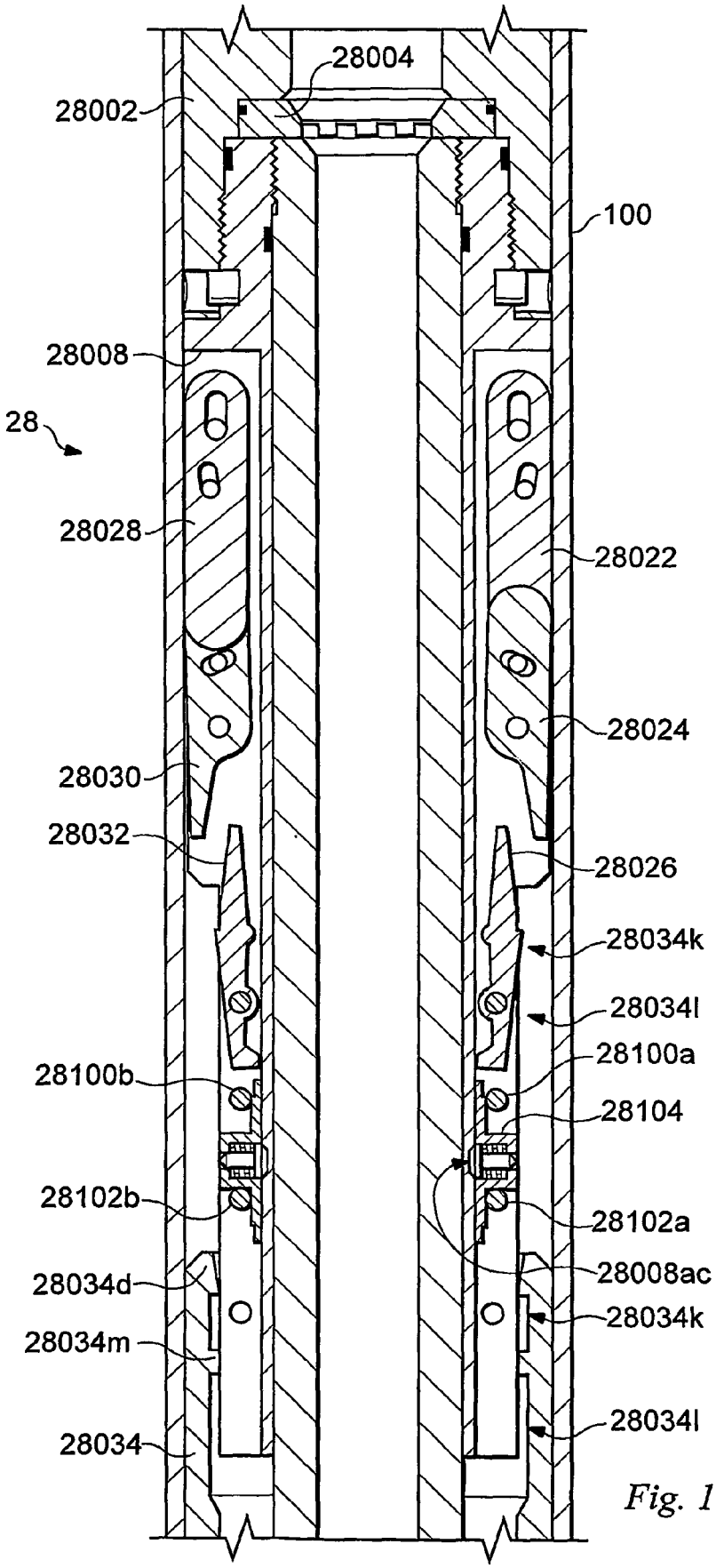
*Fig. 16AC1*

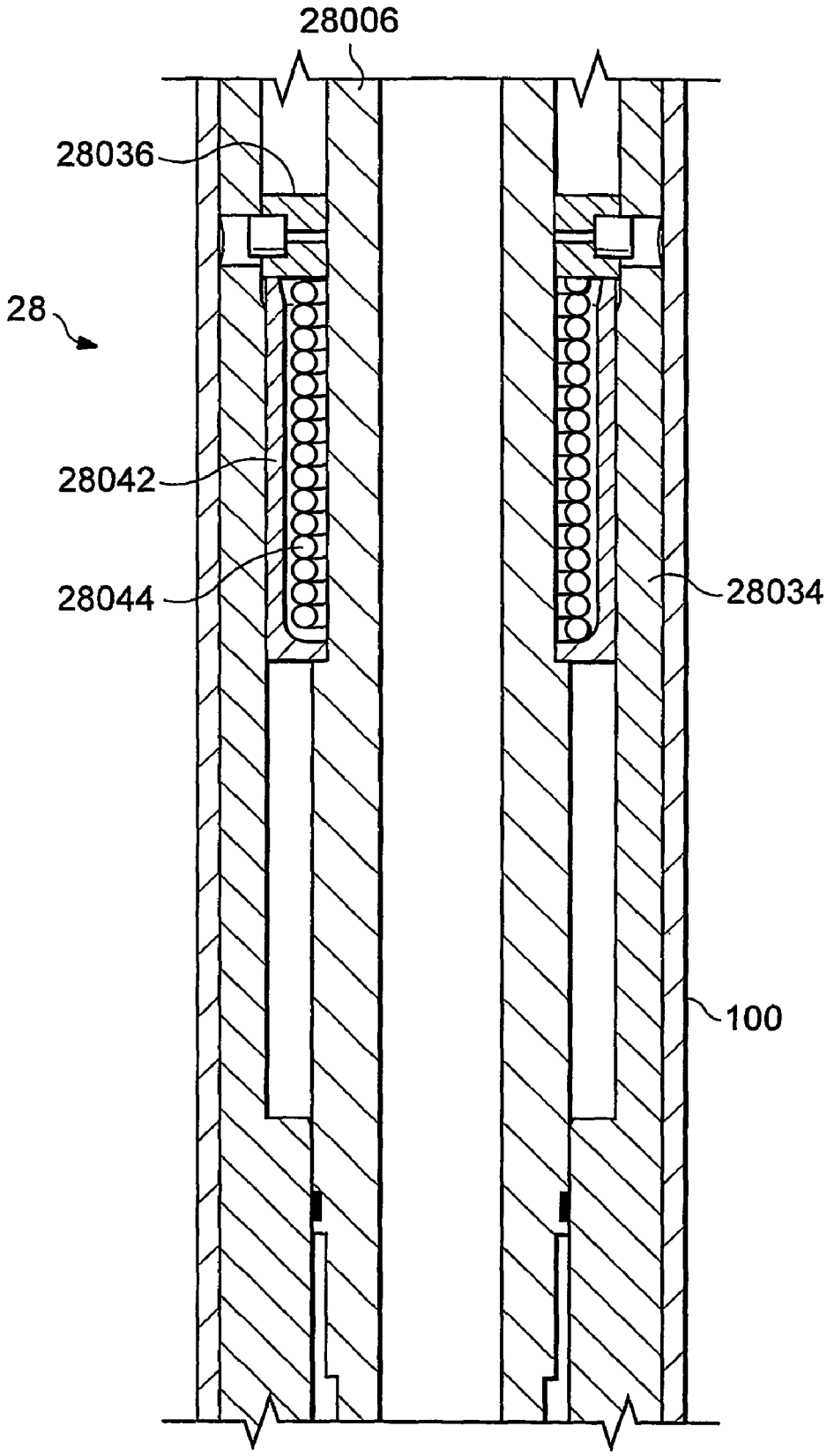
*Fig. 16AC2*

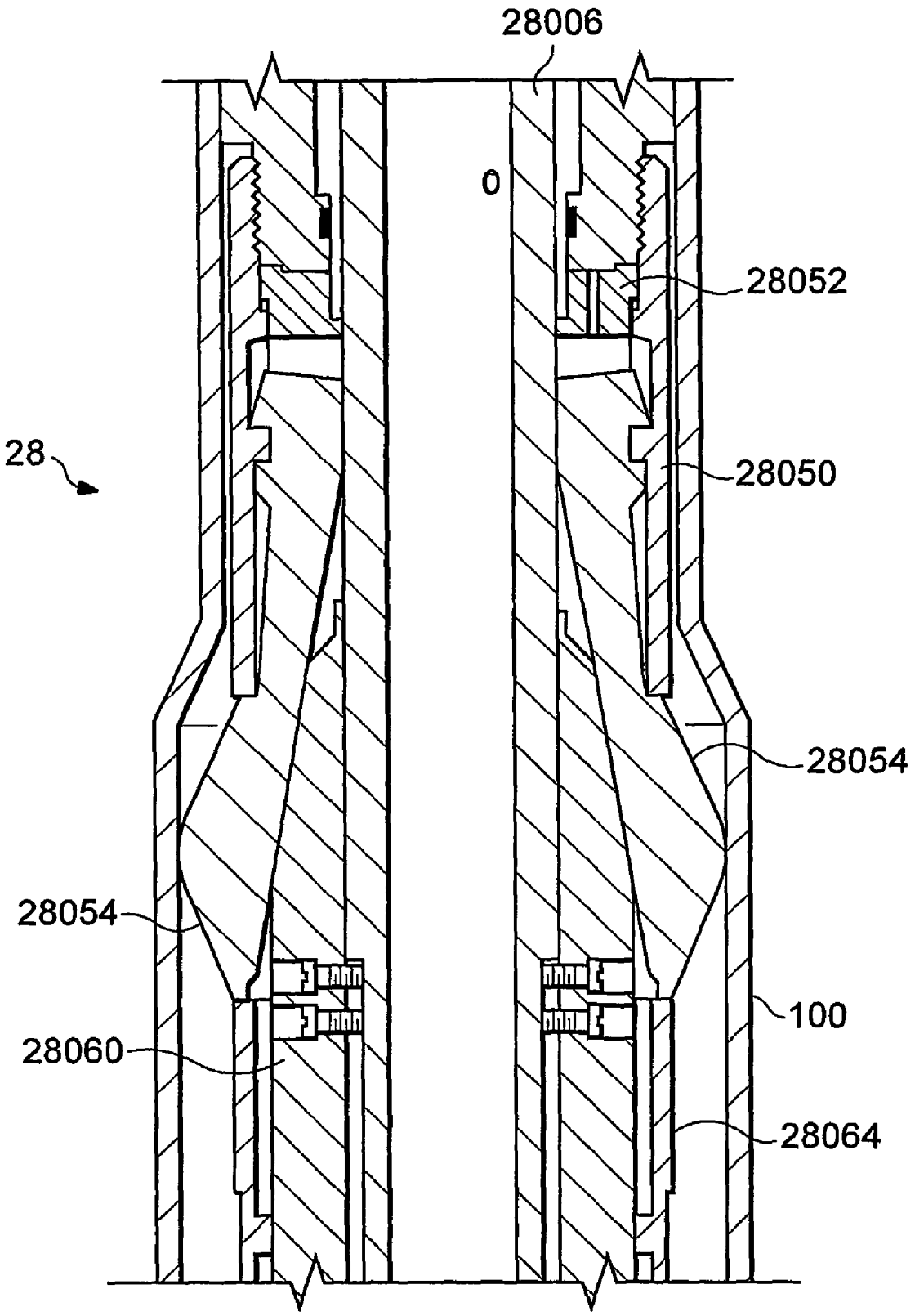
*Fig. 16AC3*

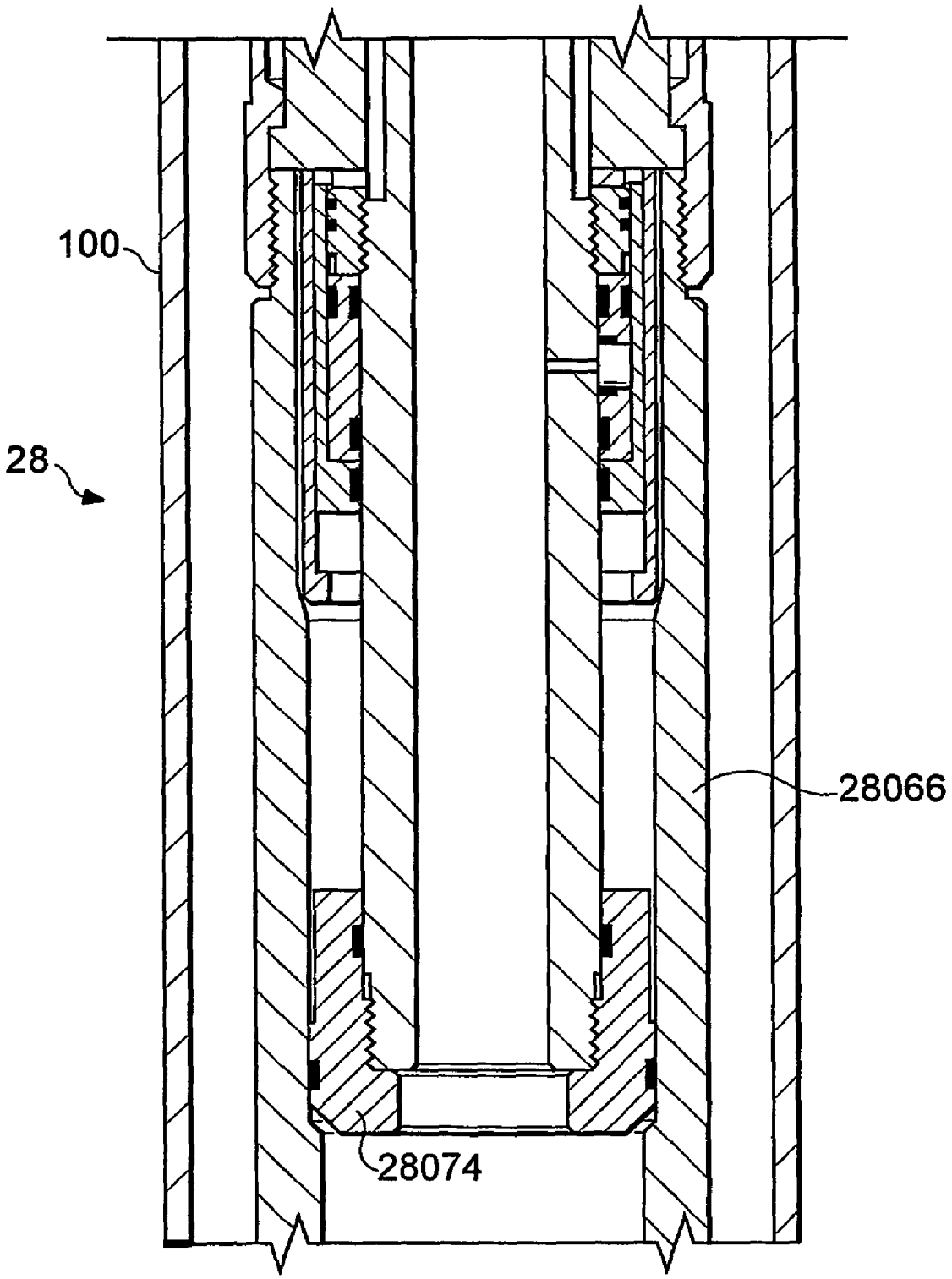
*Fig. 16AC4*

*Fig. 17A1*
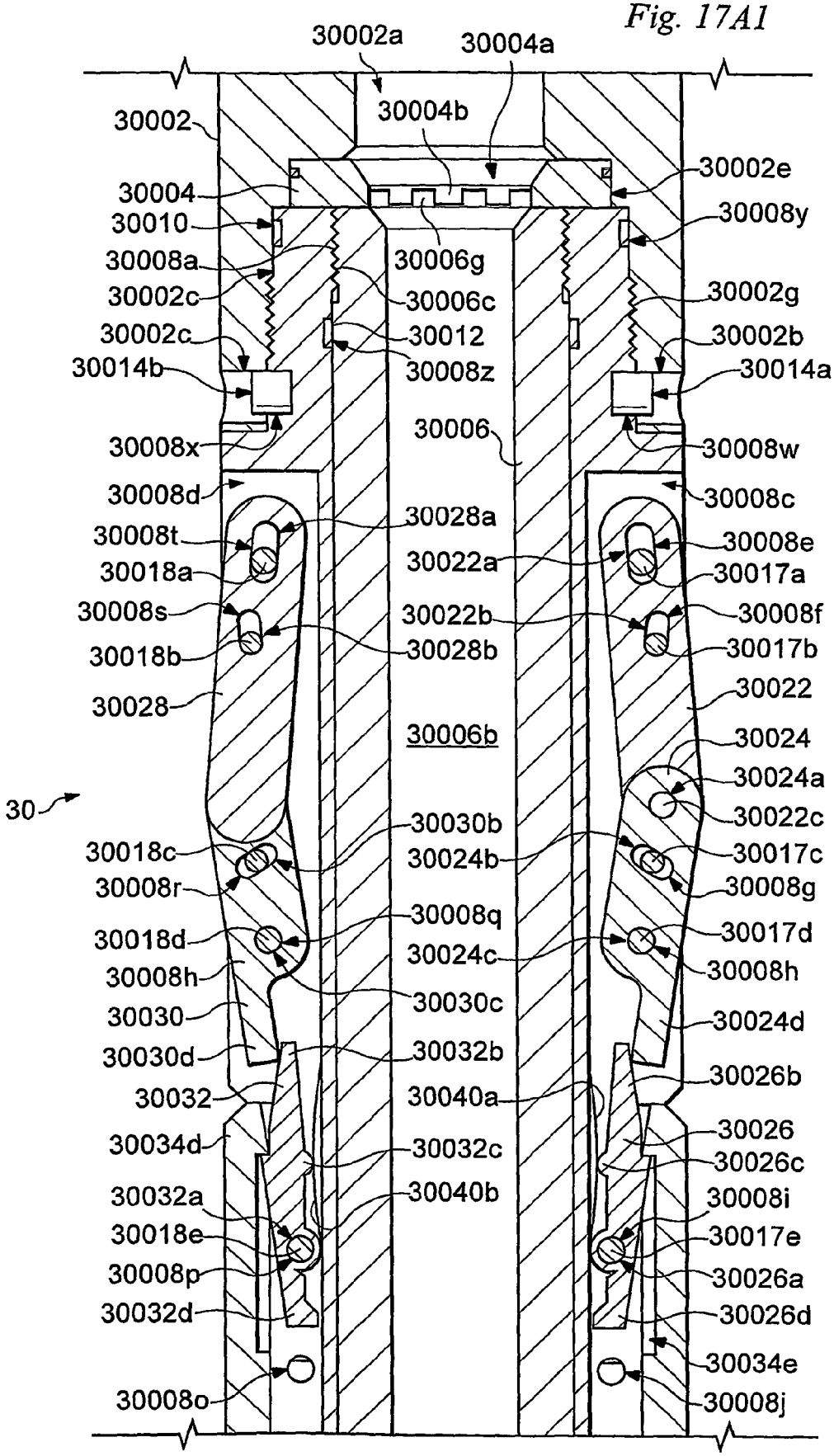

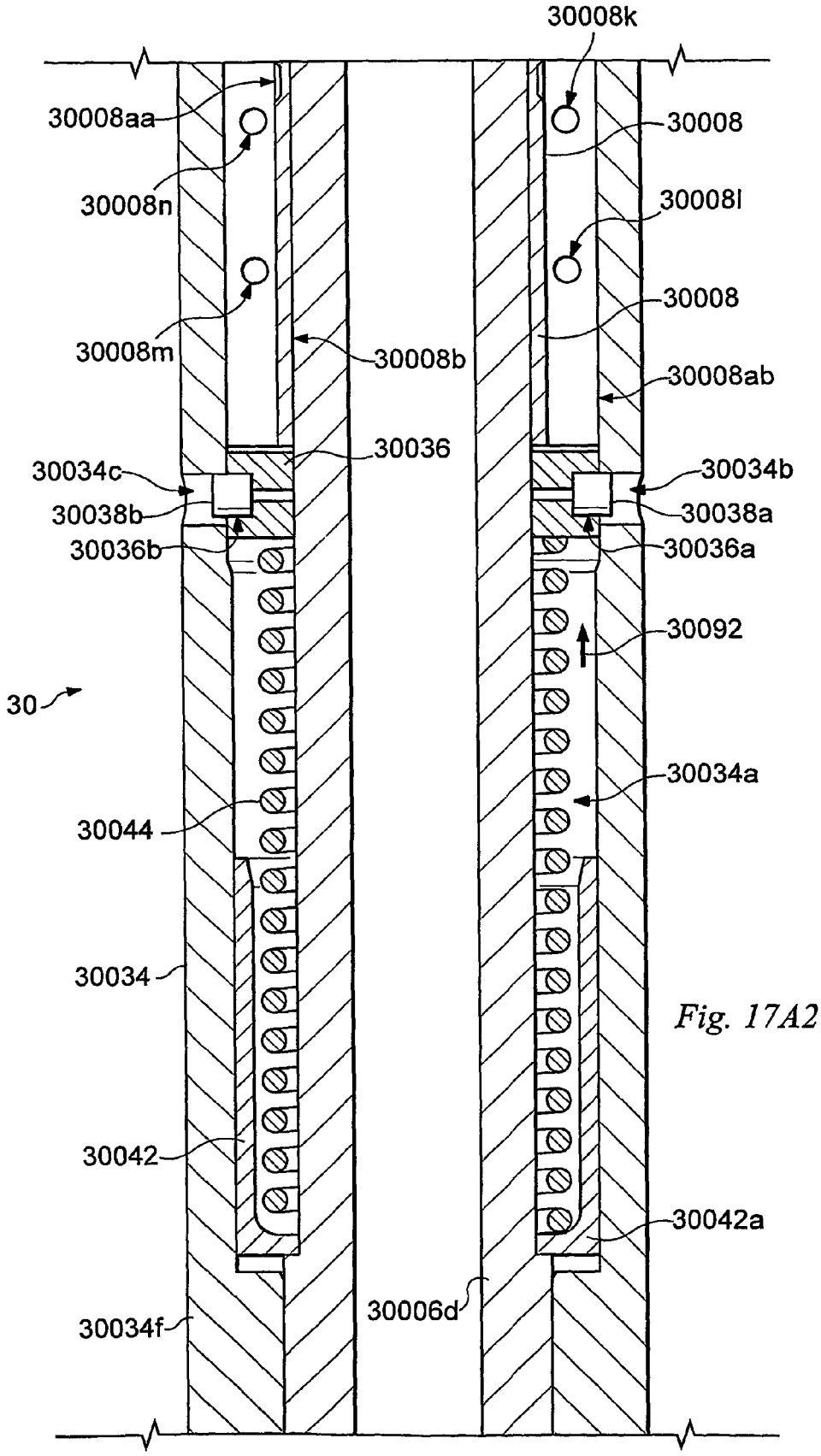
*Fig. 17A2*

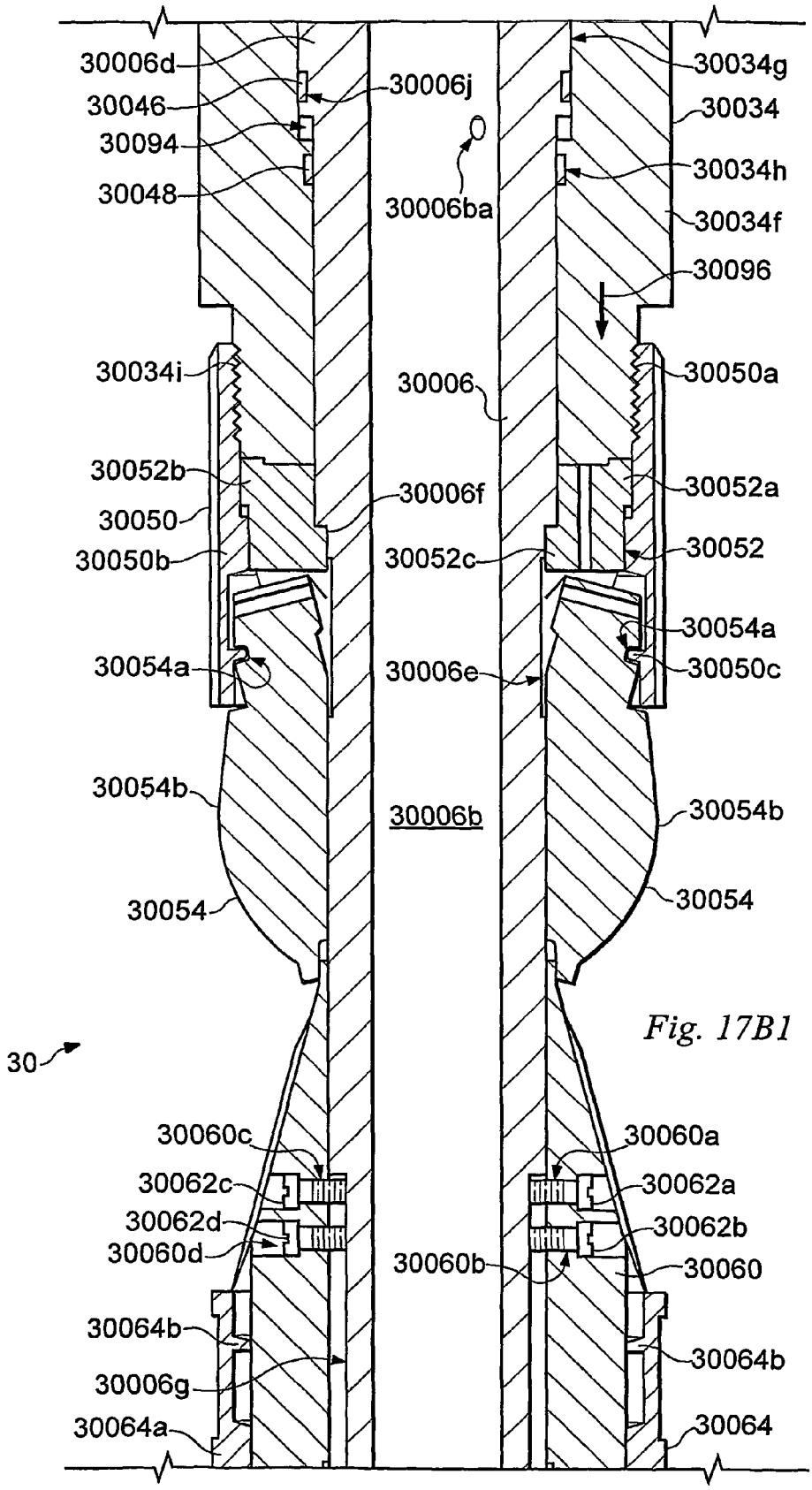
*Fig. 17B1*

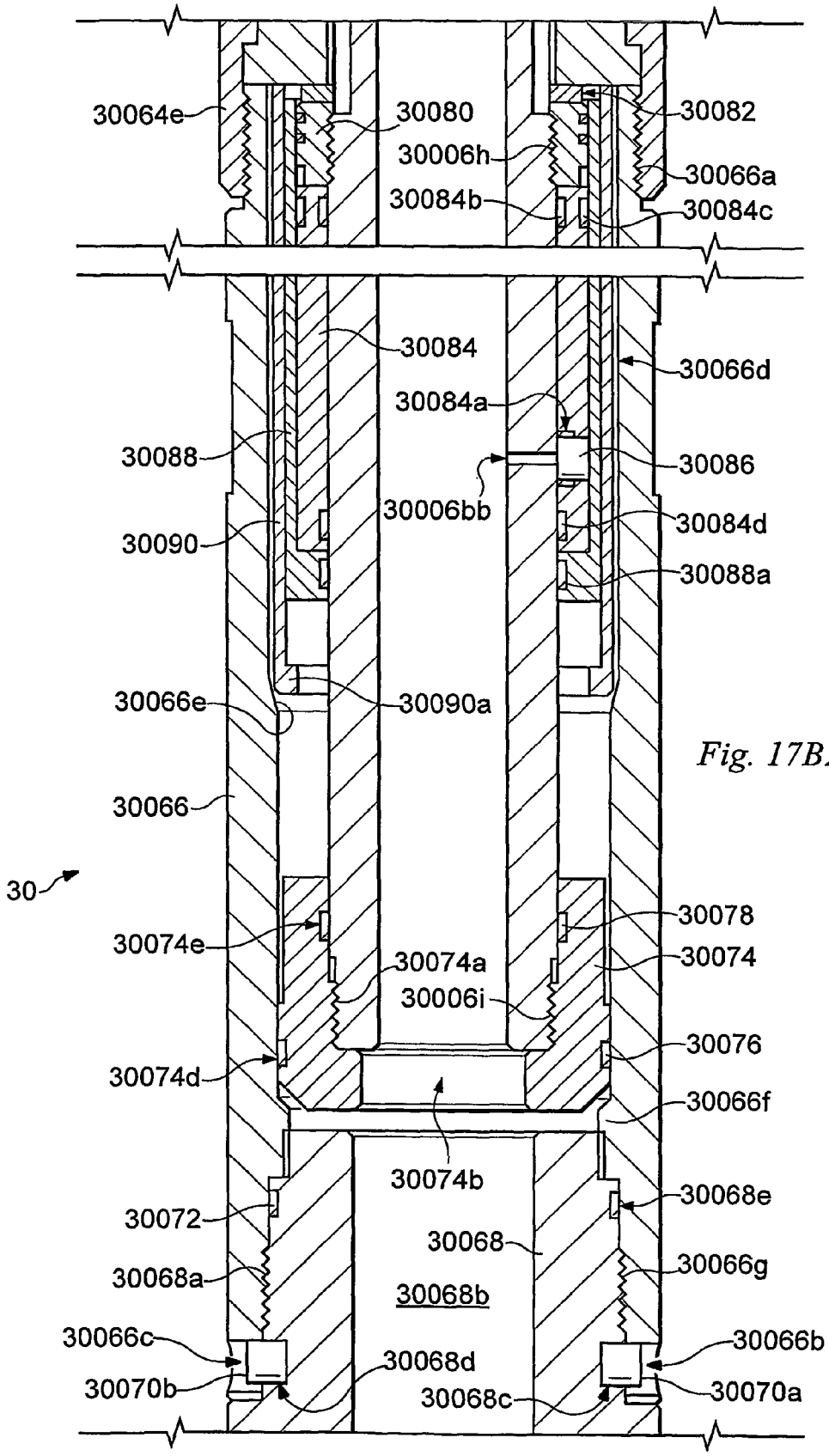
*Fig. 17B2*

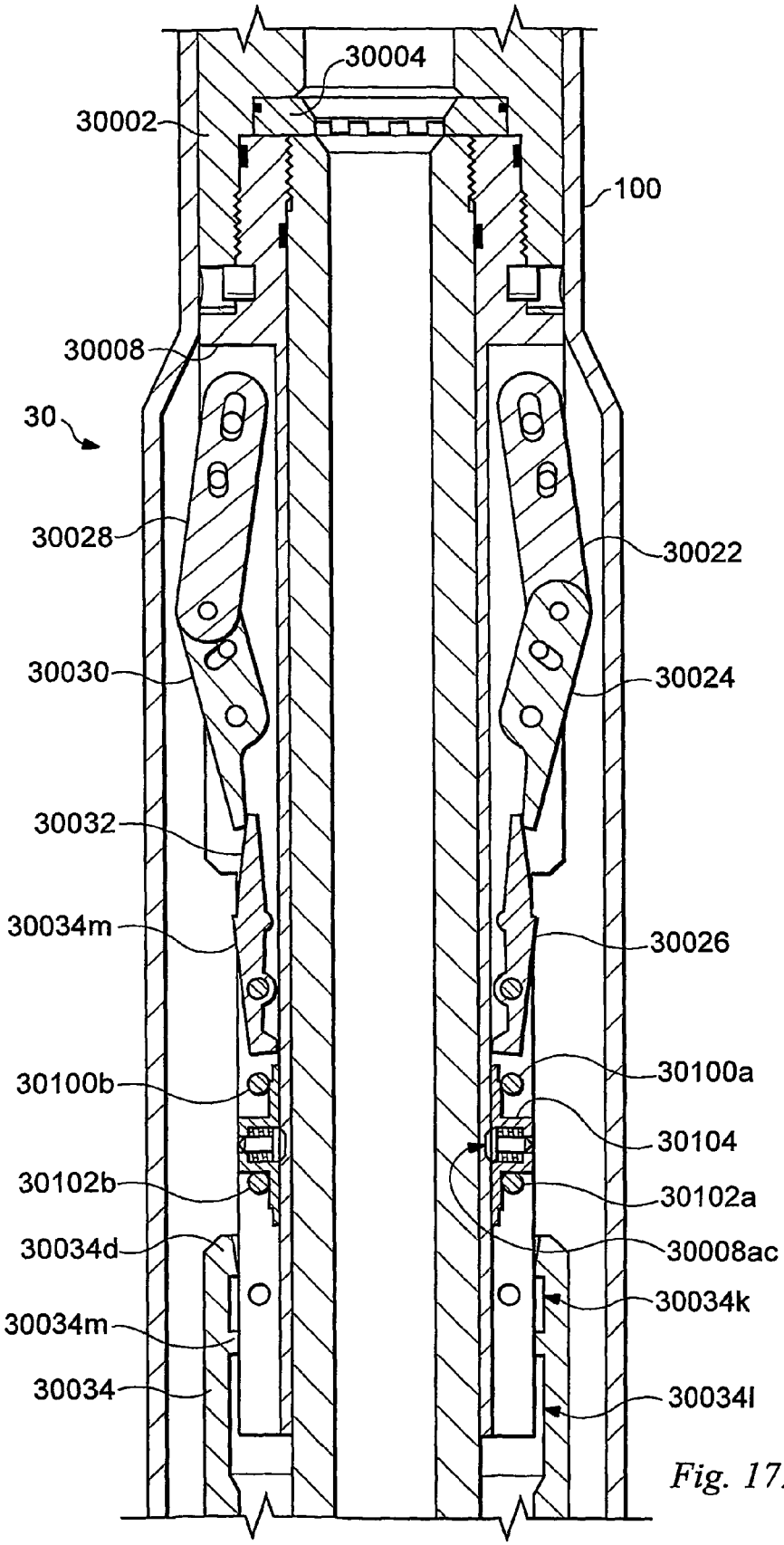
Fig. 17Z1

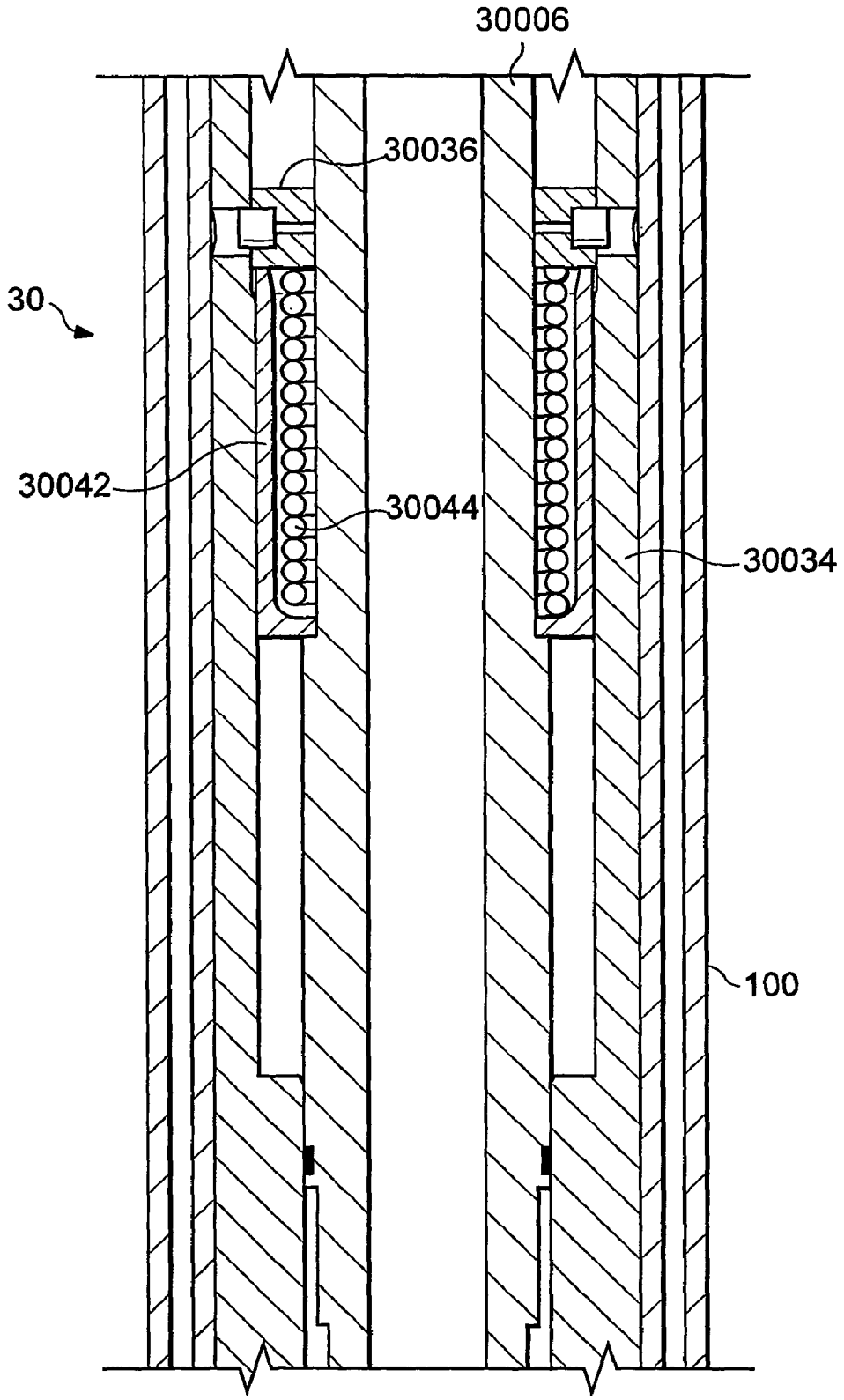
*Fig. 17Z2*

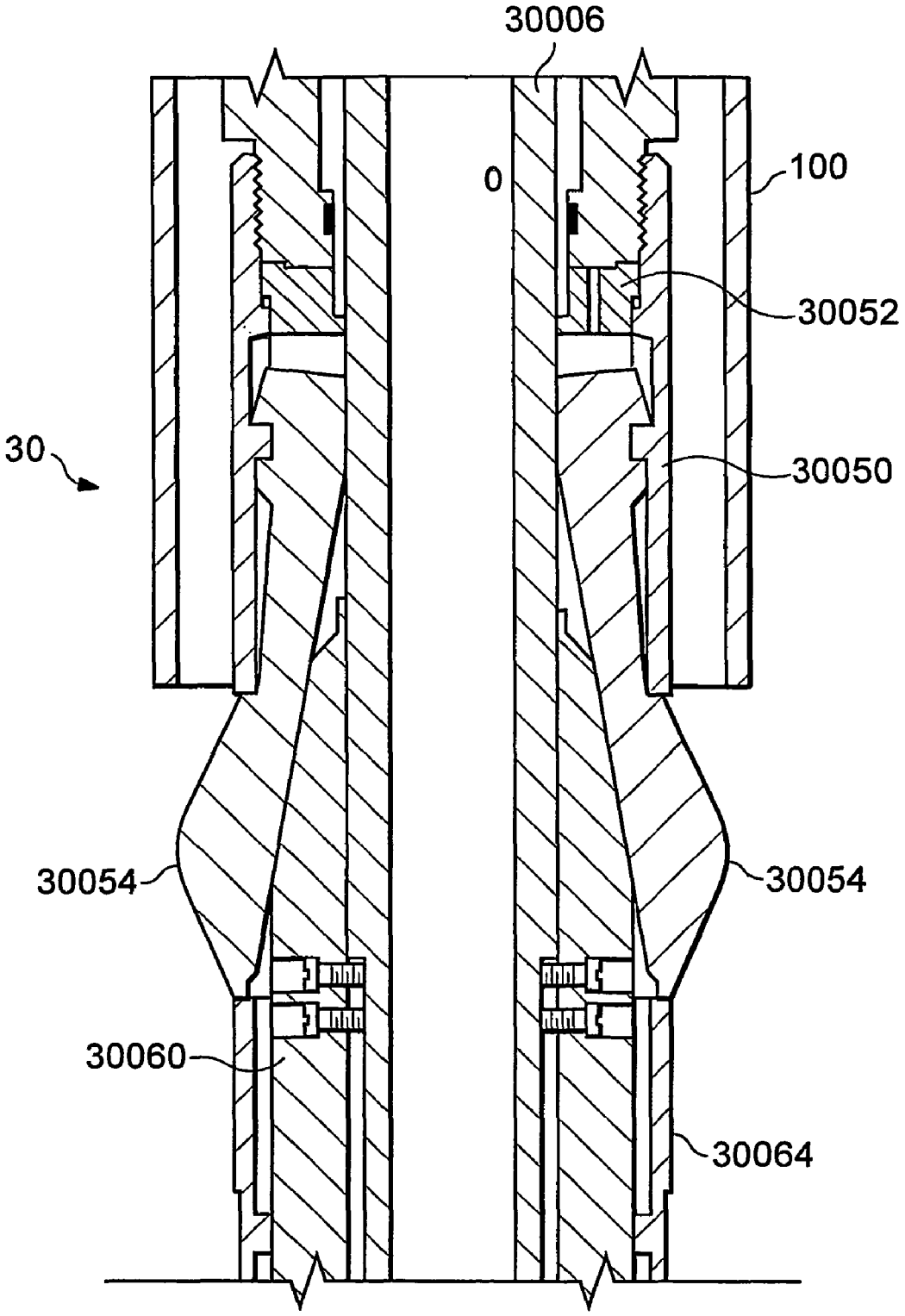
*Fig. 17Z3*

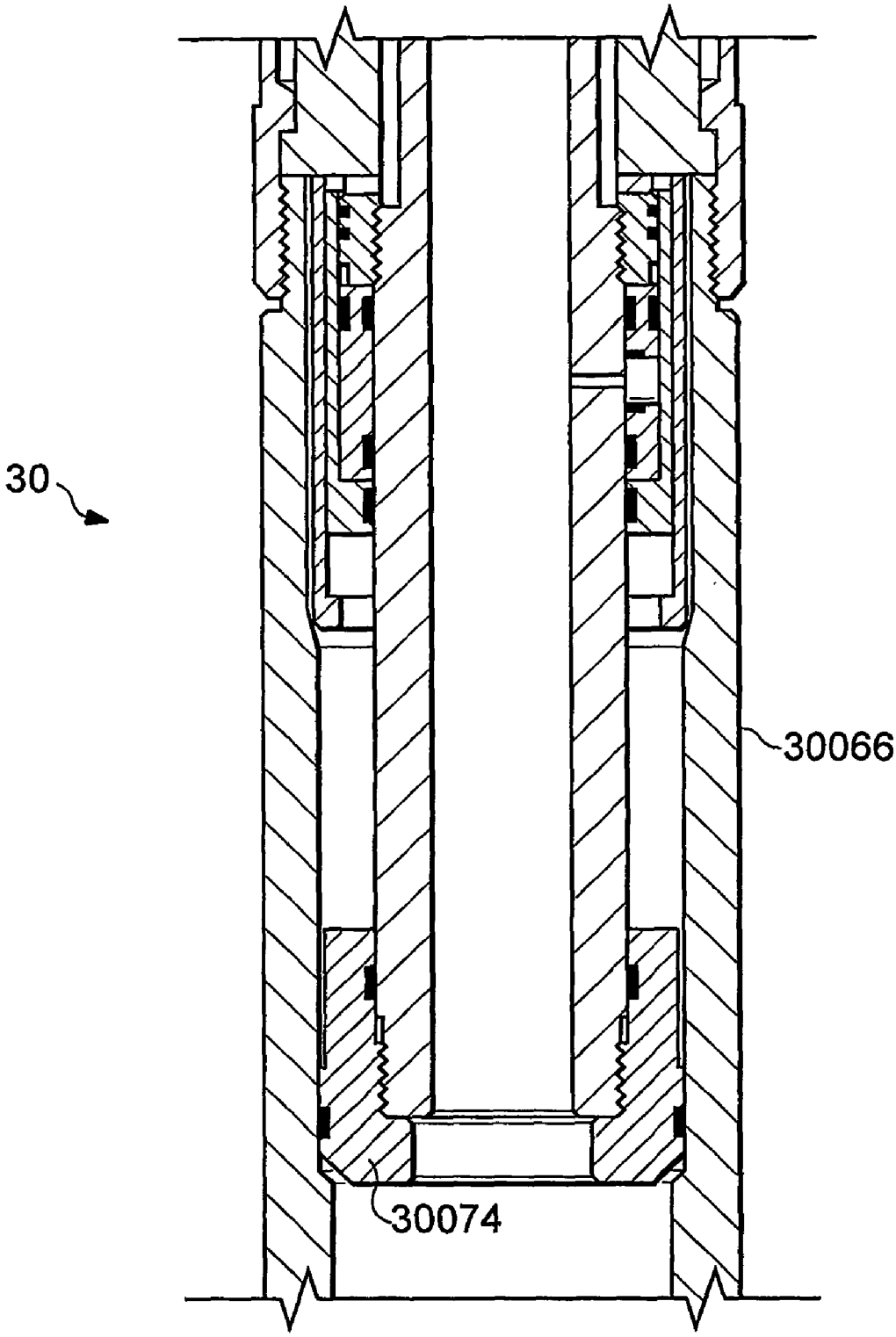
*Fig. 17Z4*

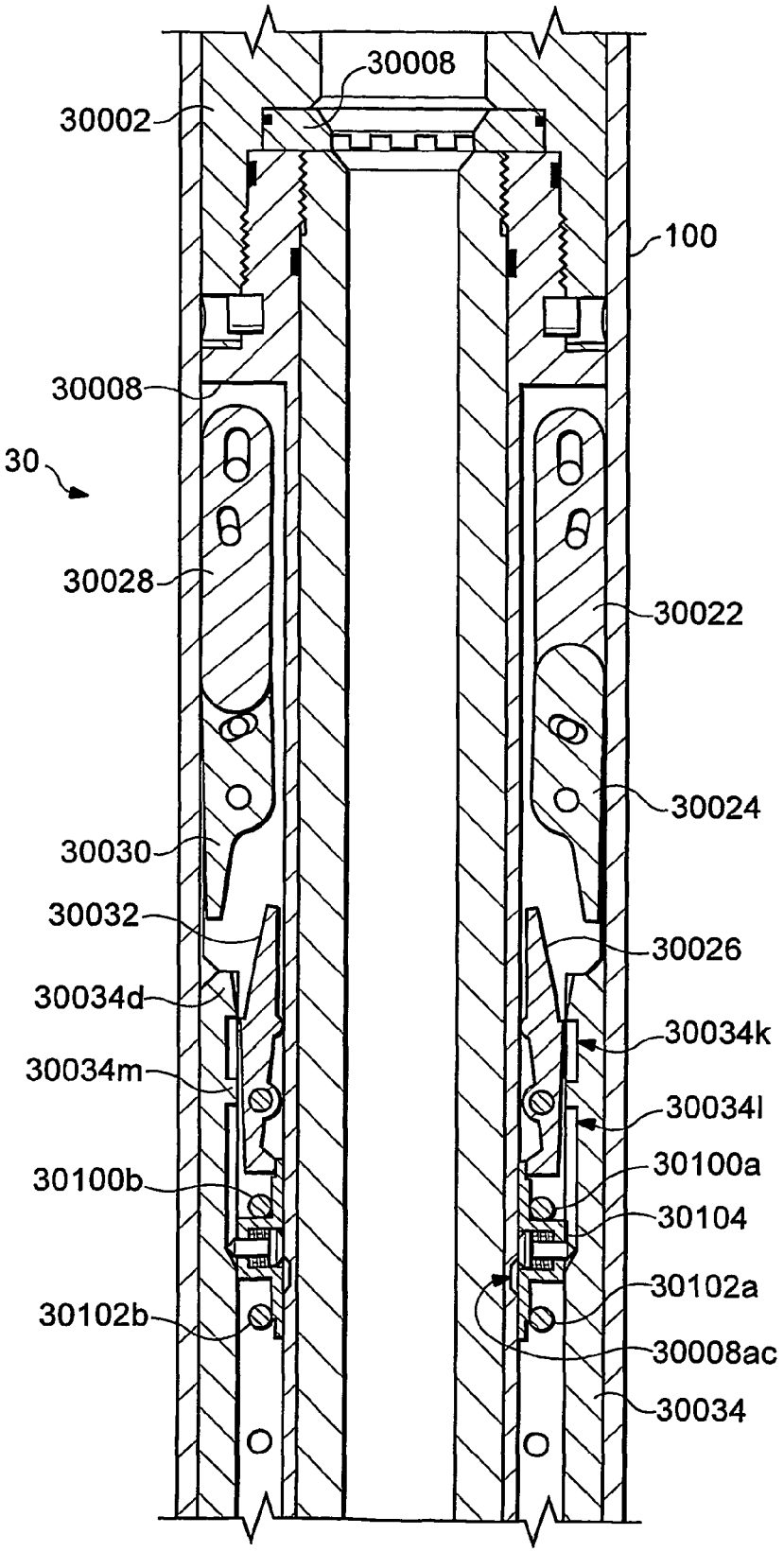
*Fig. 17AA1*

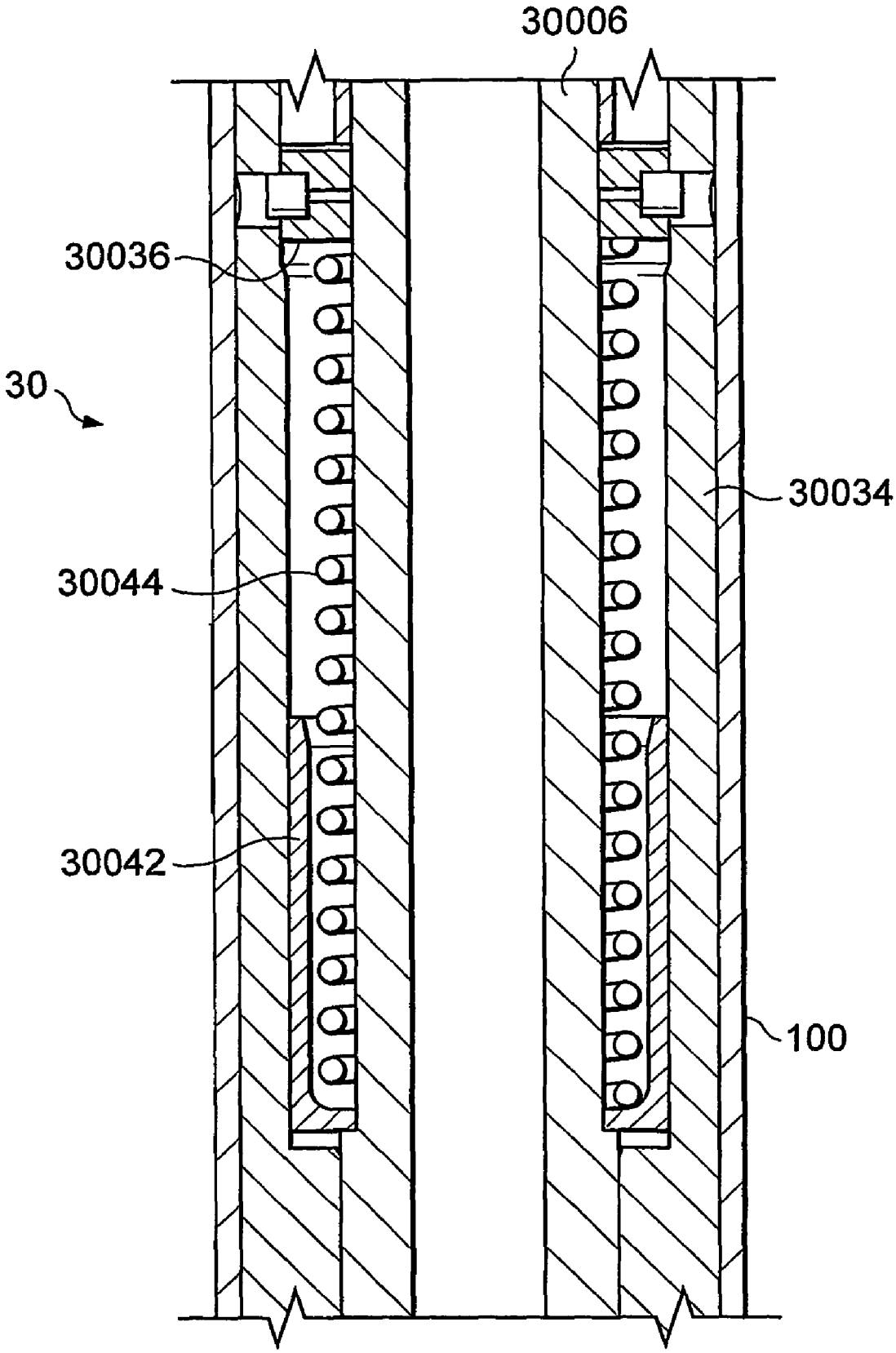
*Fig. 17AA2*

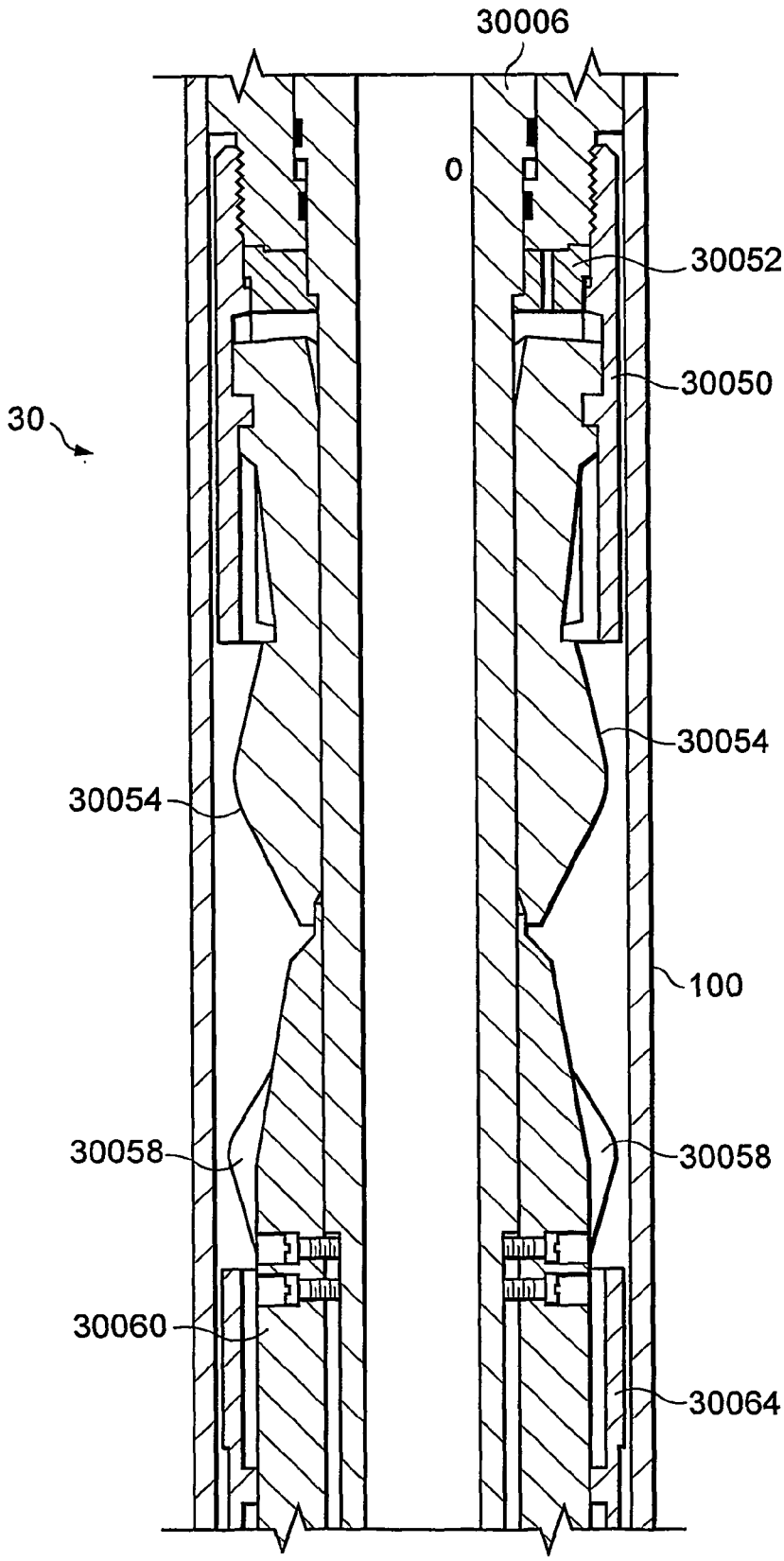
*Fig. 17AA3*

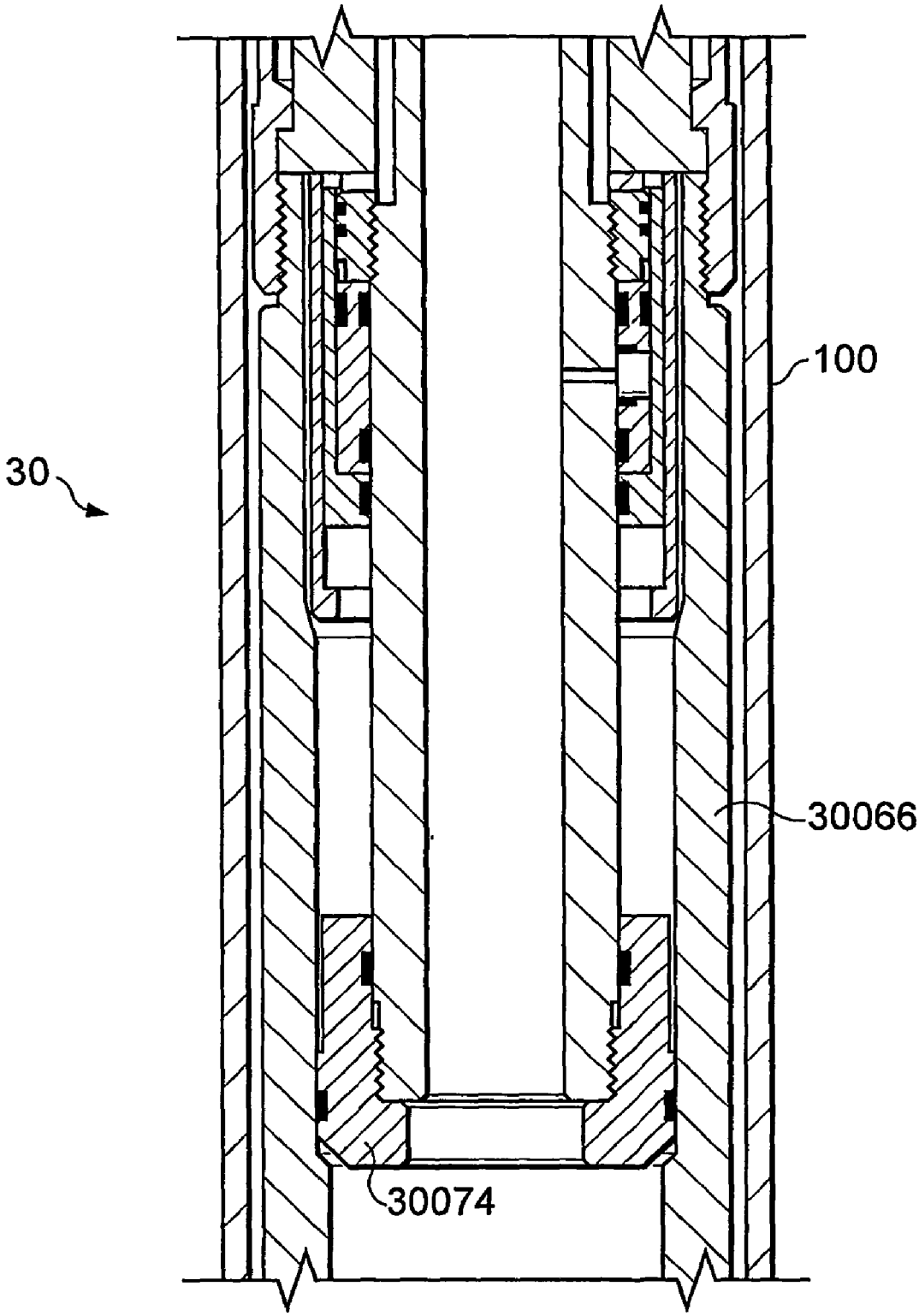
*Fig. 17AA4*

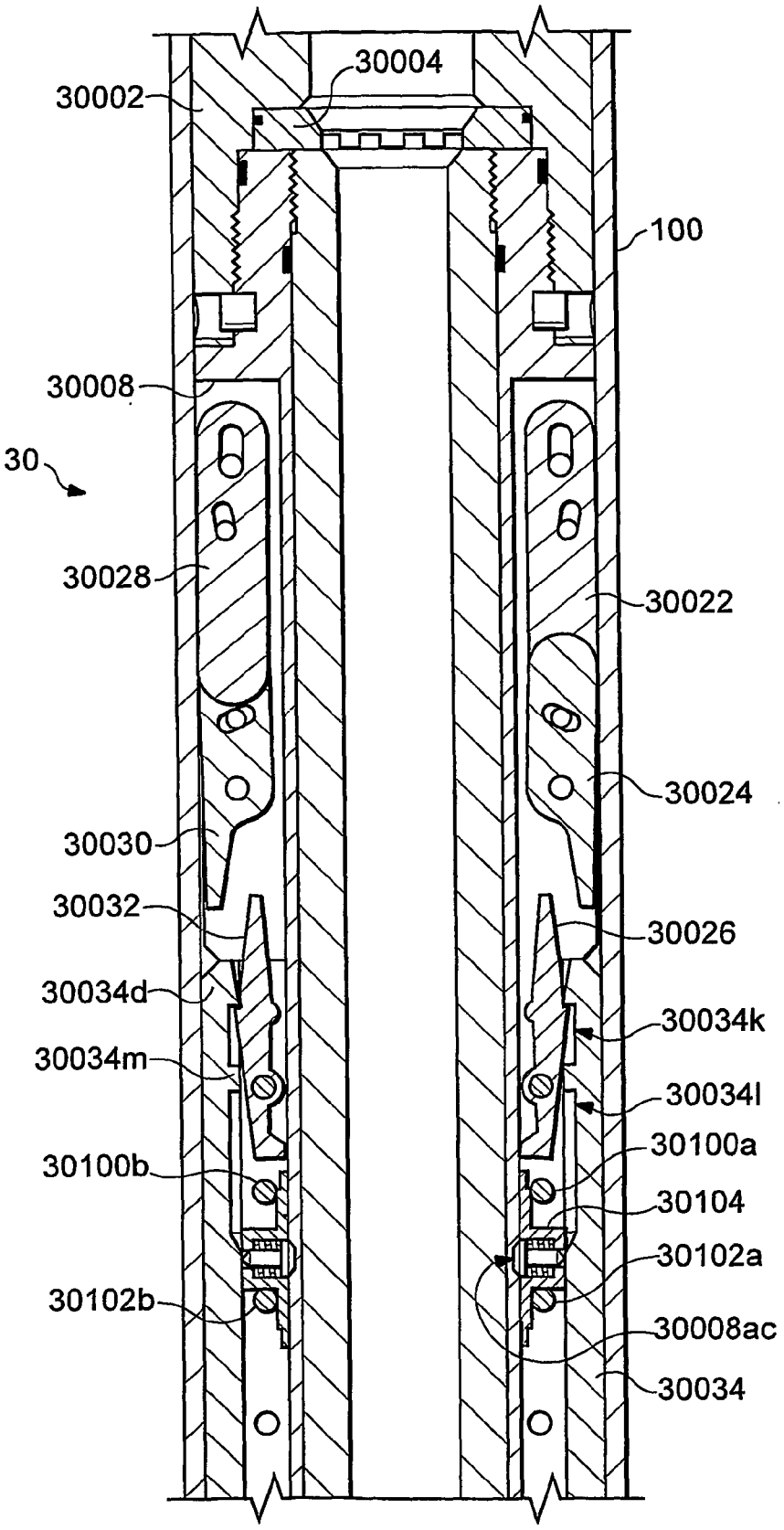
*Fig. 17AB1*

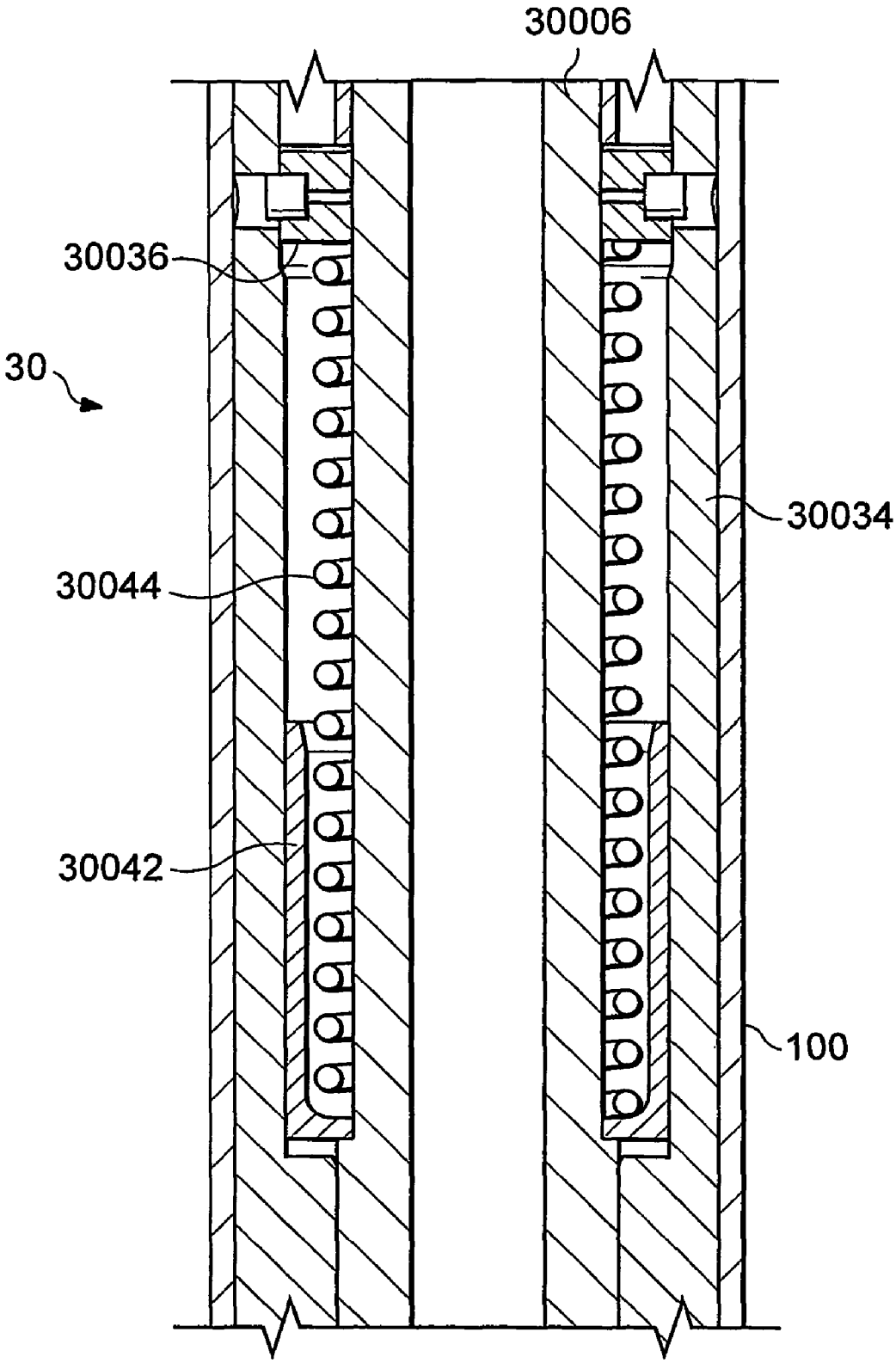
*Fig. 17AB2*

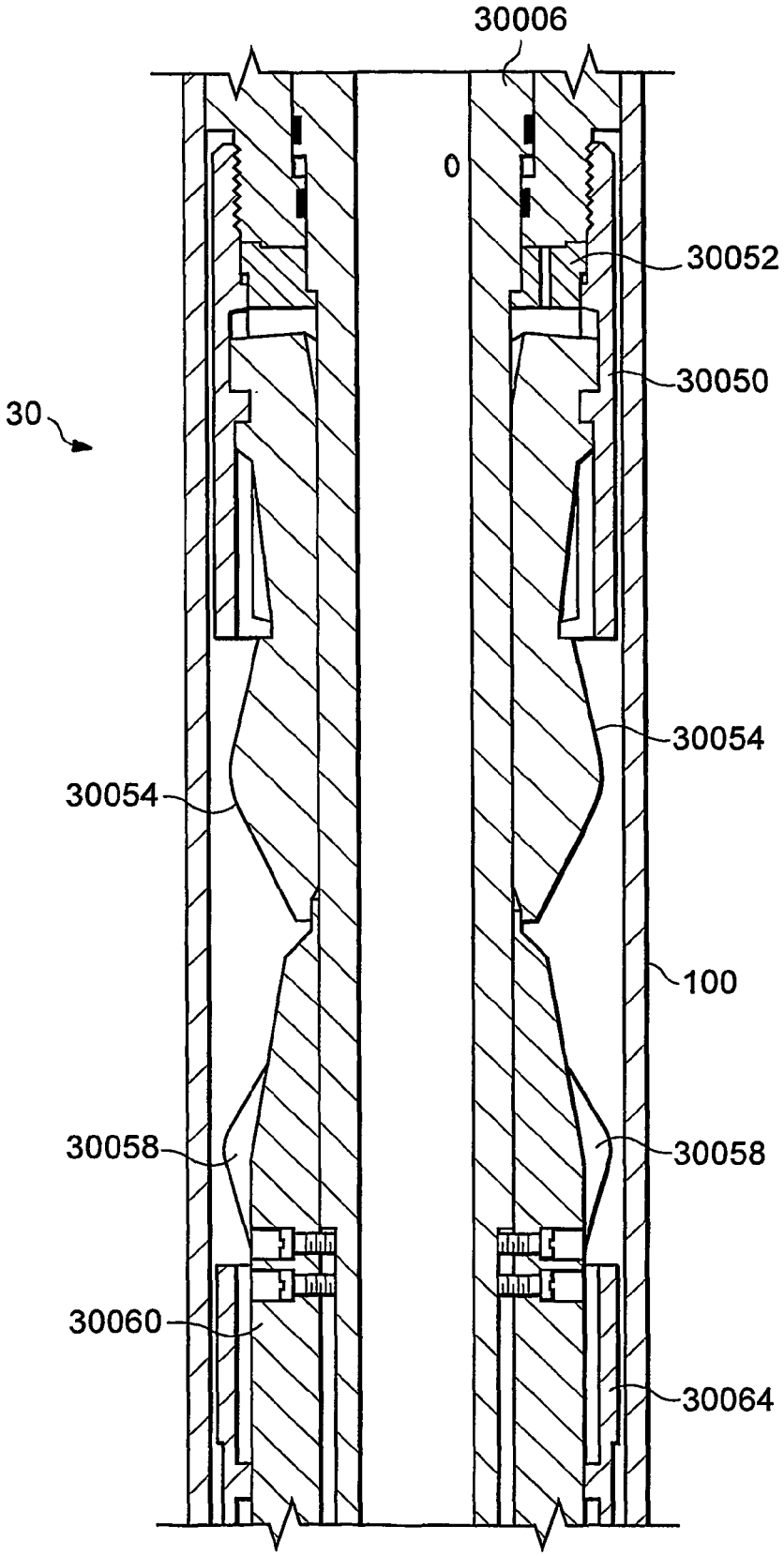
*Fig. 17AB3*

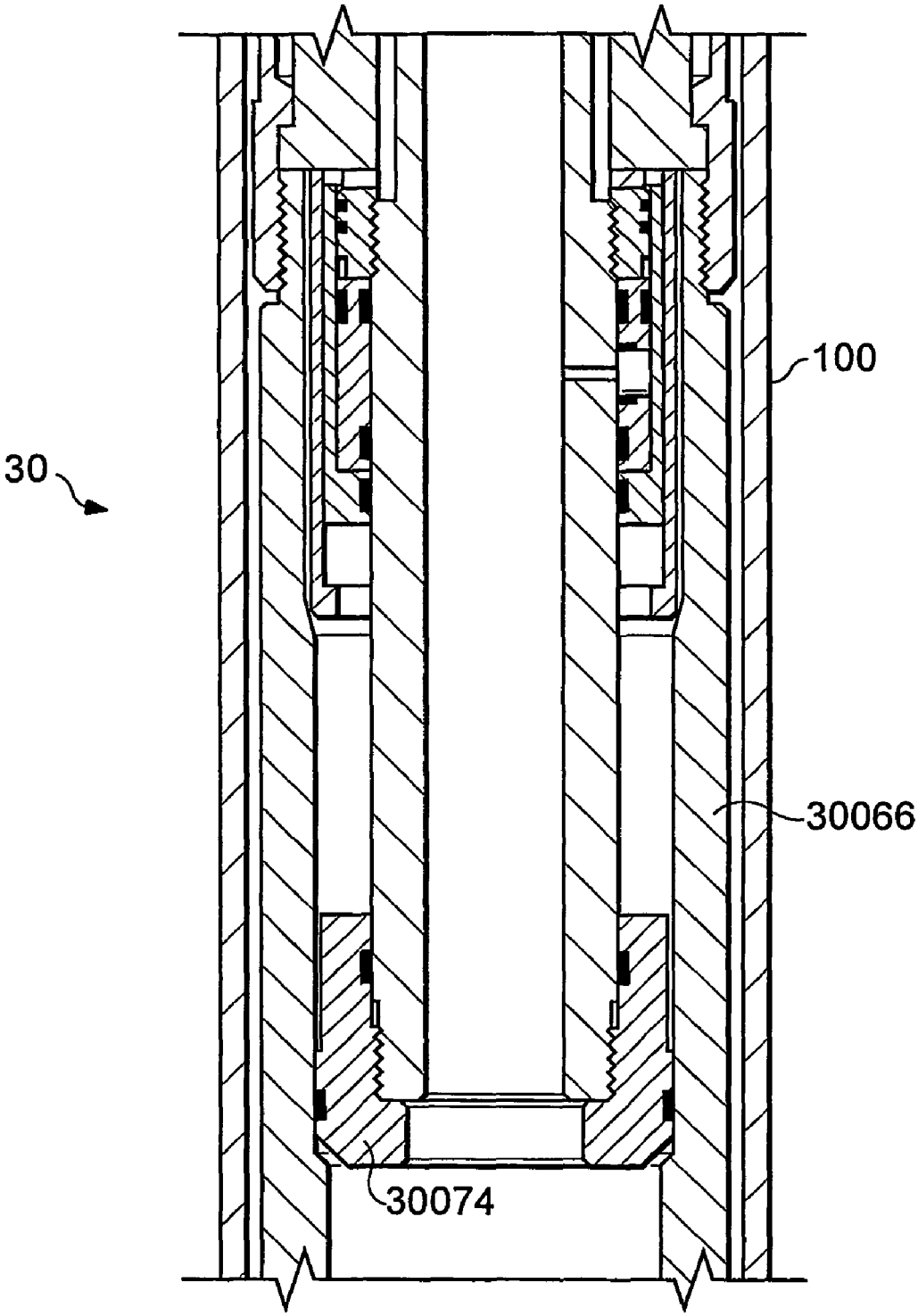
*Fig. 17AB4*

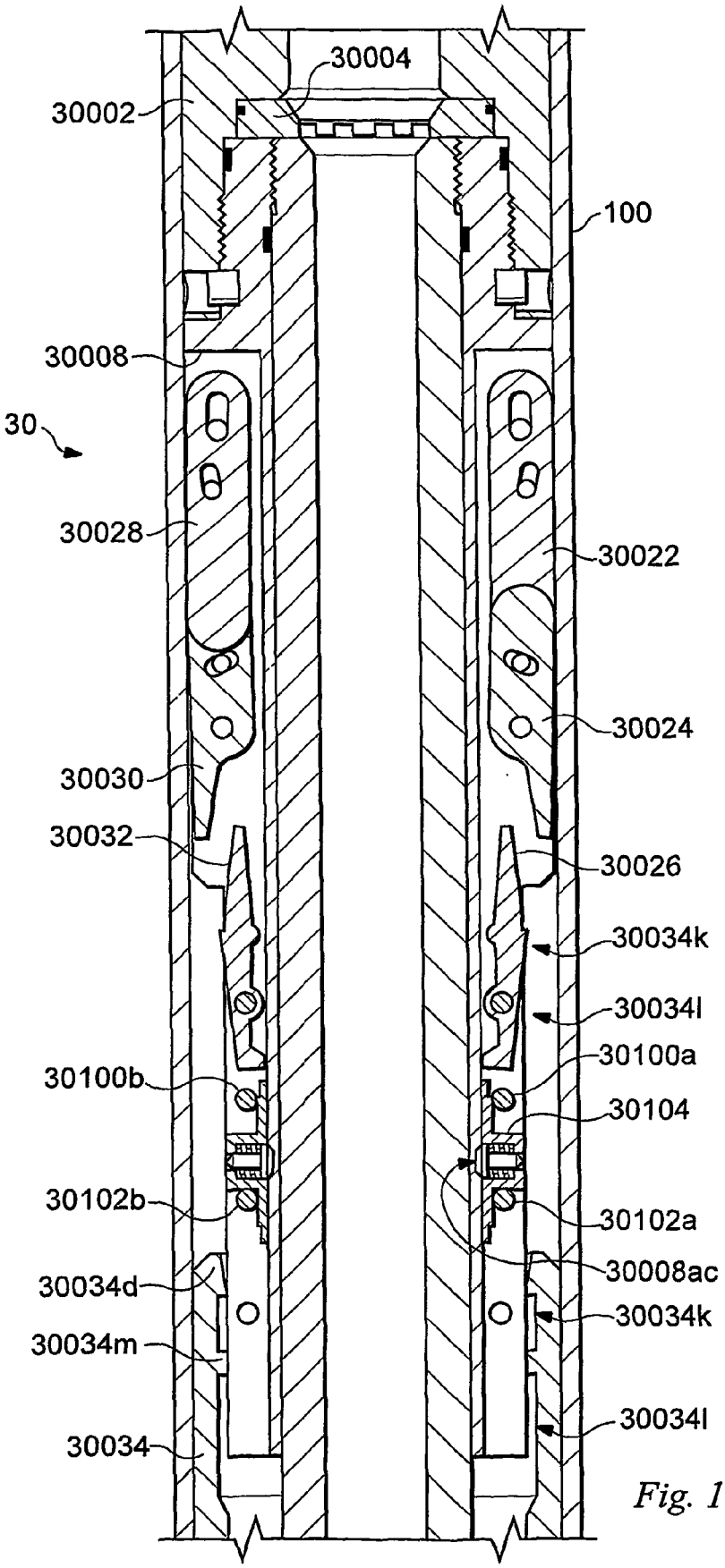
*Fig. 17AC1*

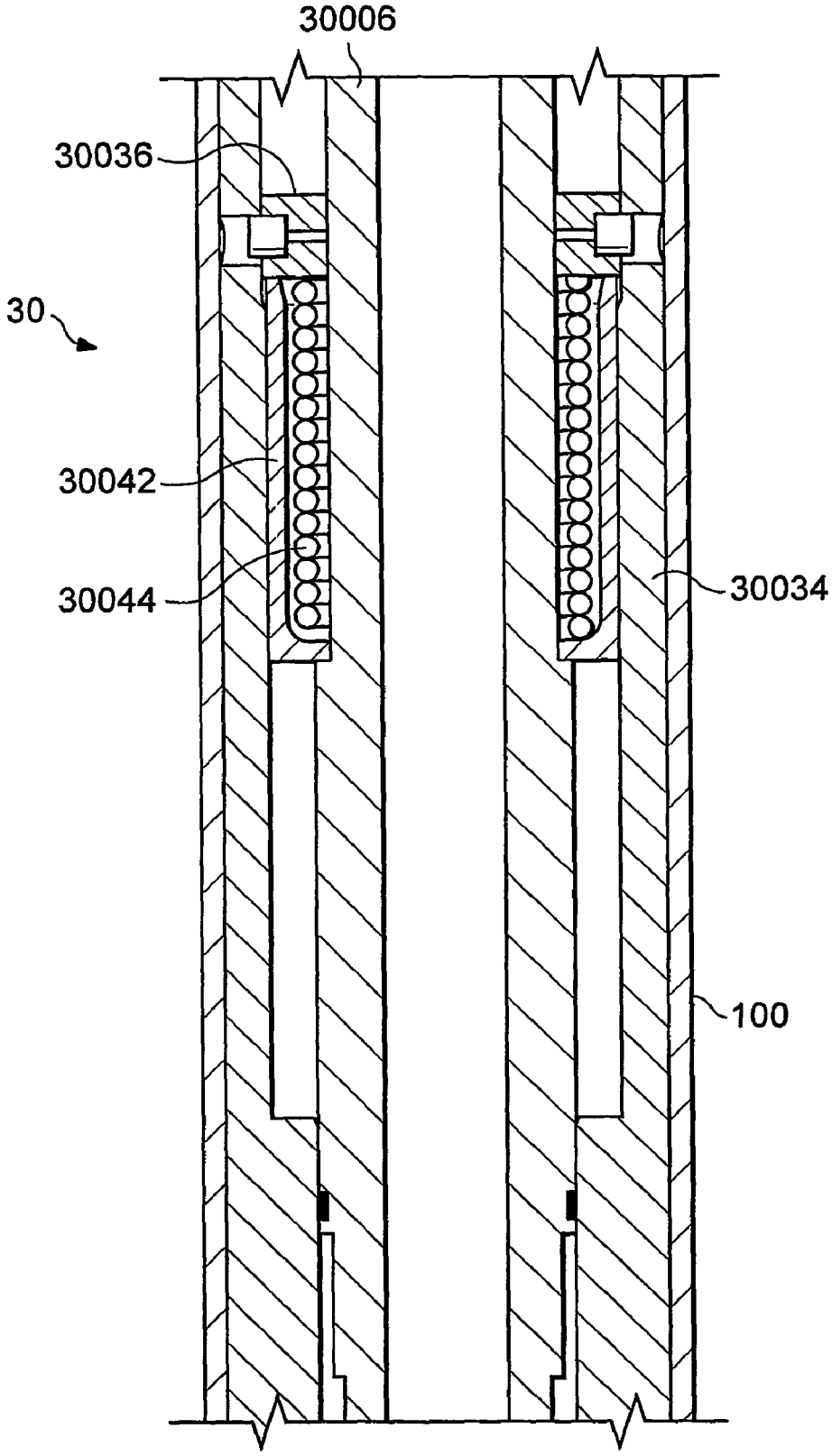
*Fig. 17AC2*

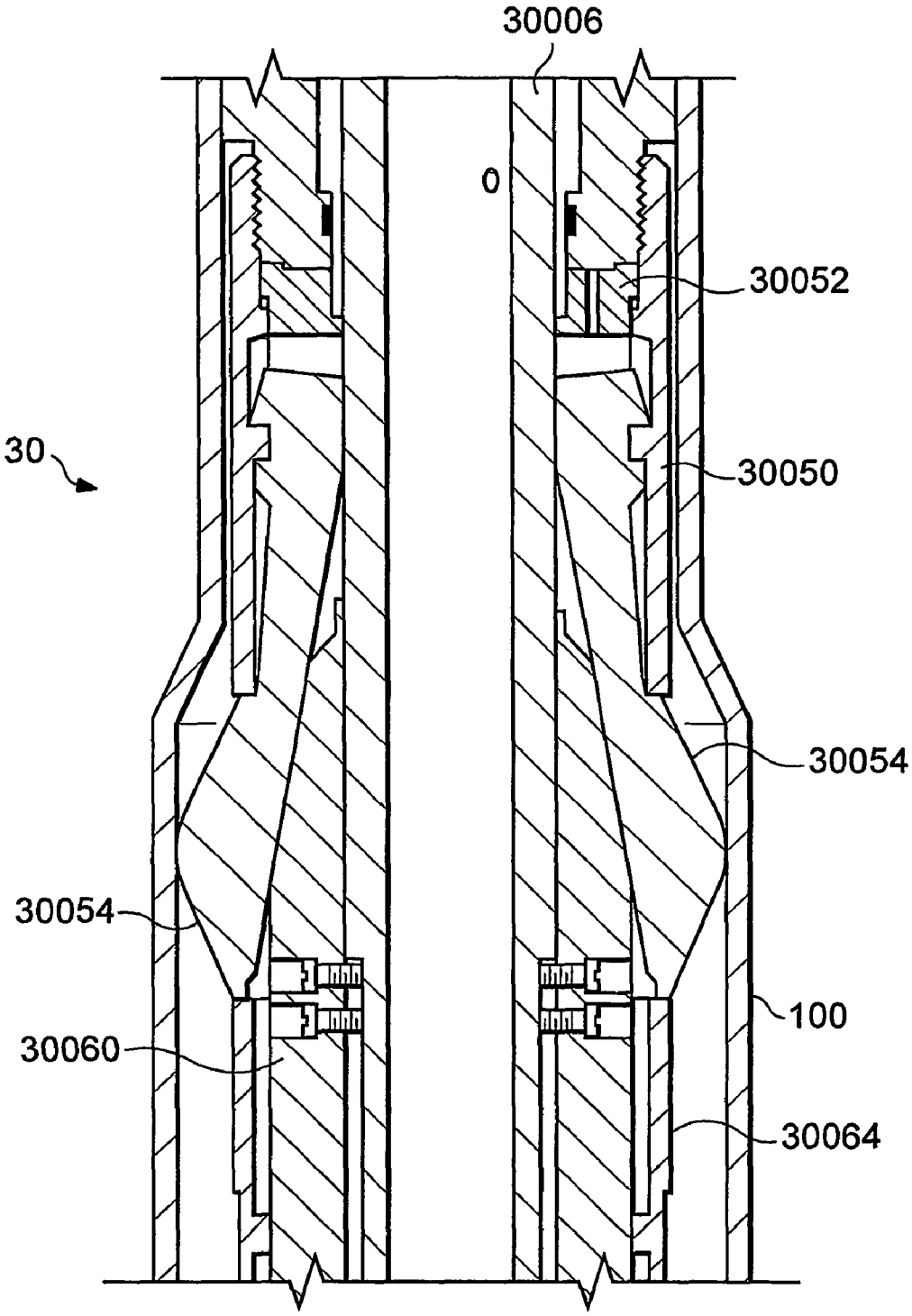
*Fig. 17AC3*

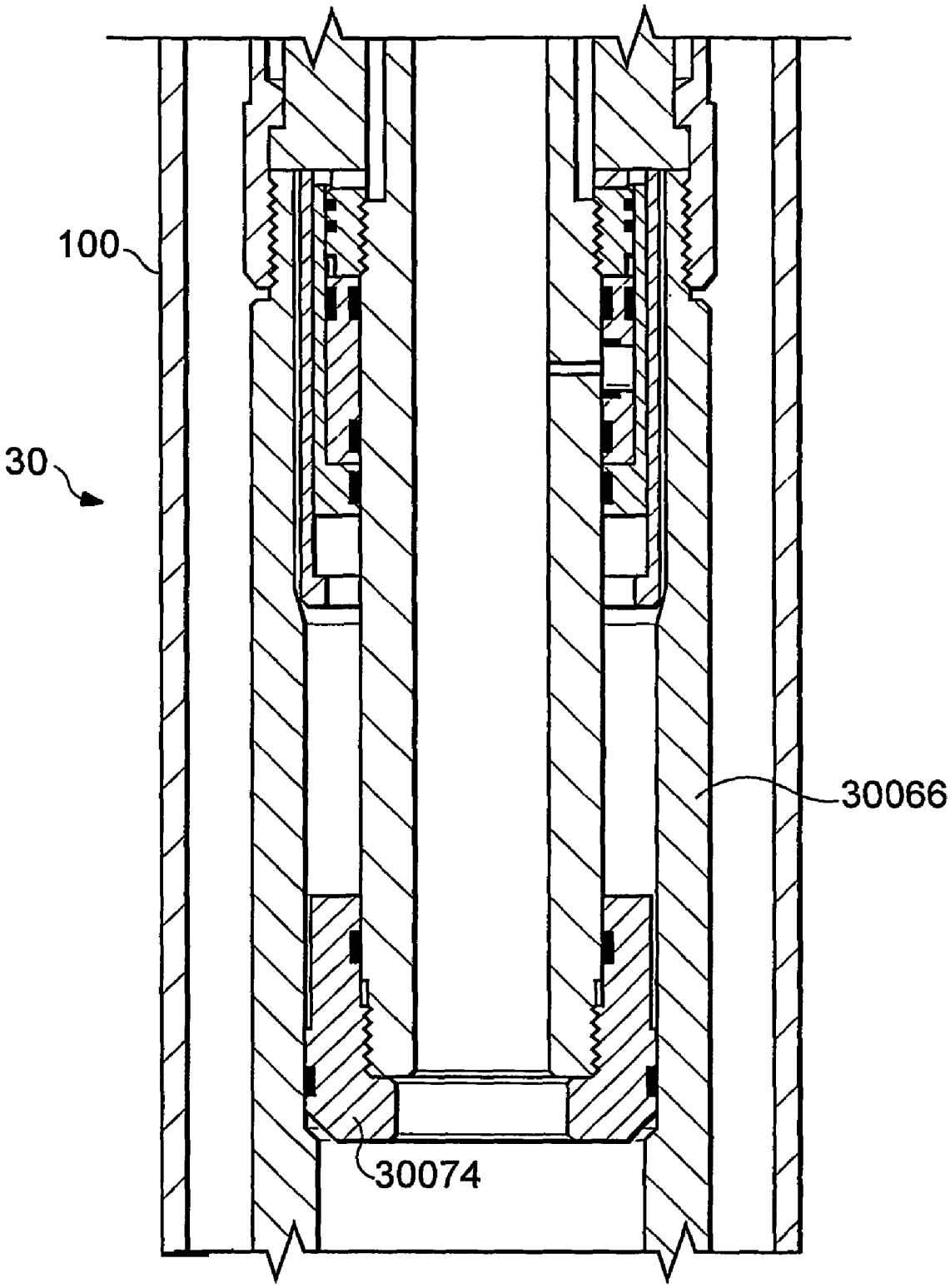
*Fig. 17AC4*

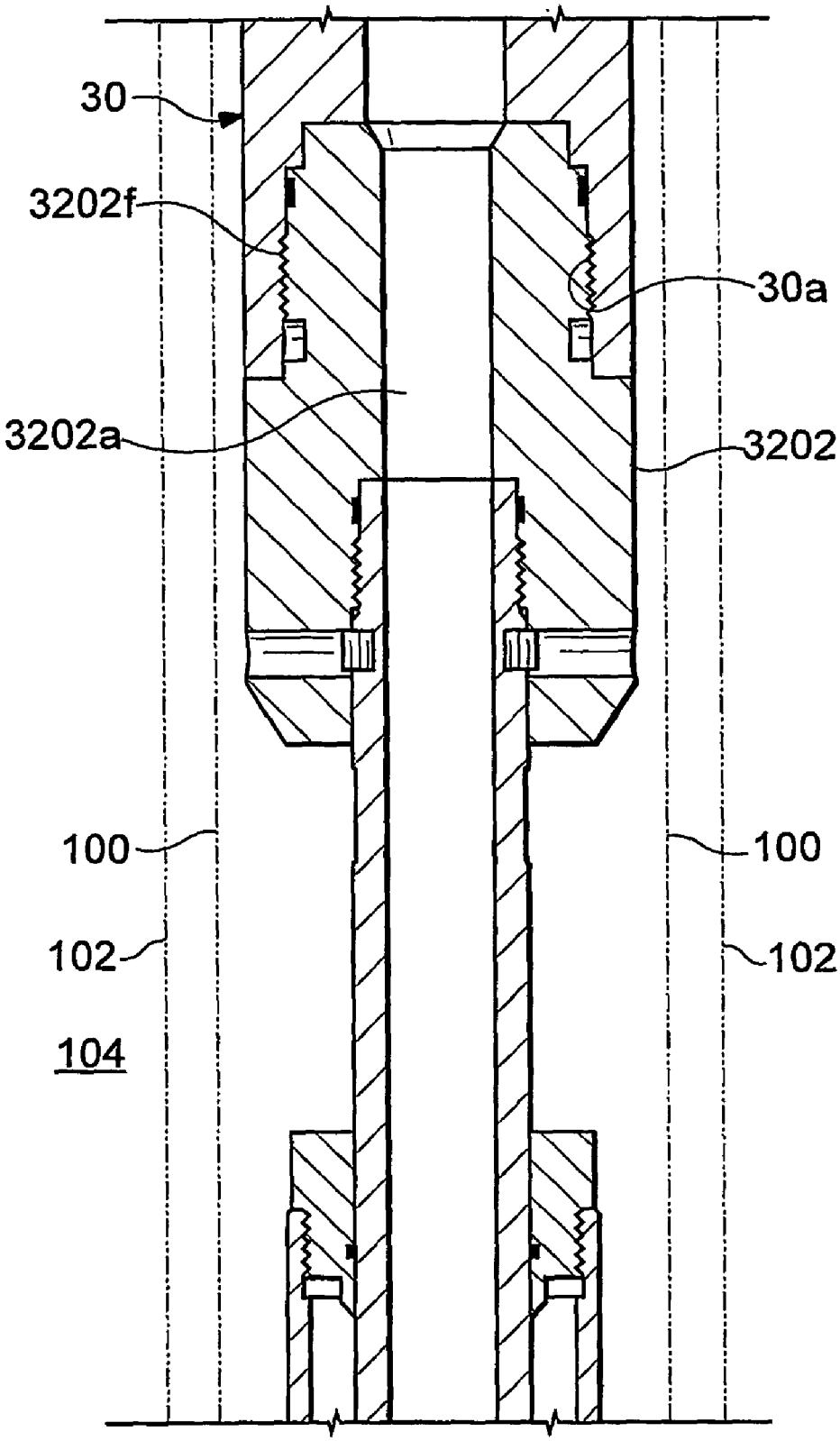
*Fig. 20A1*

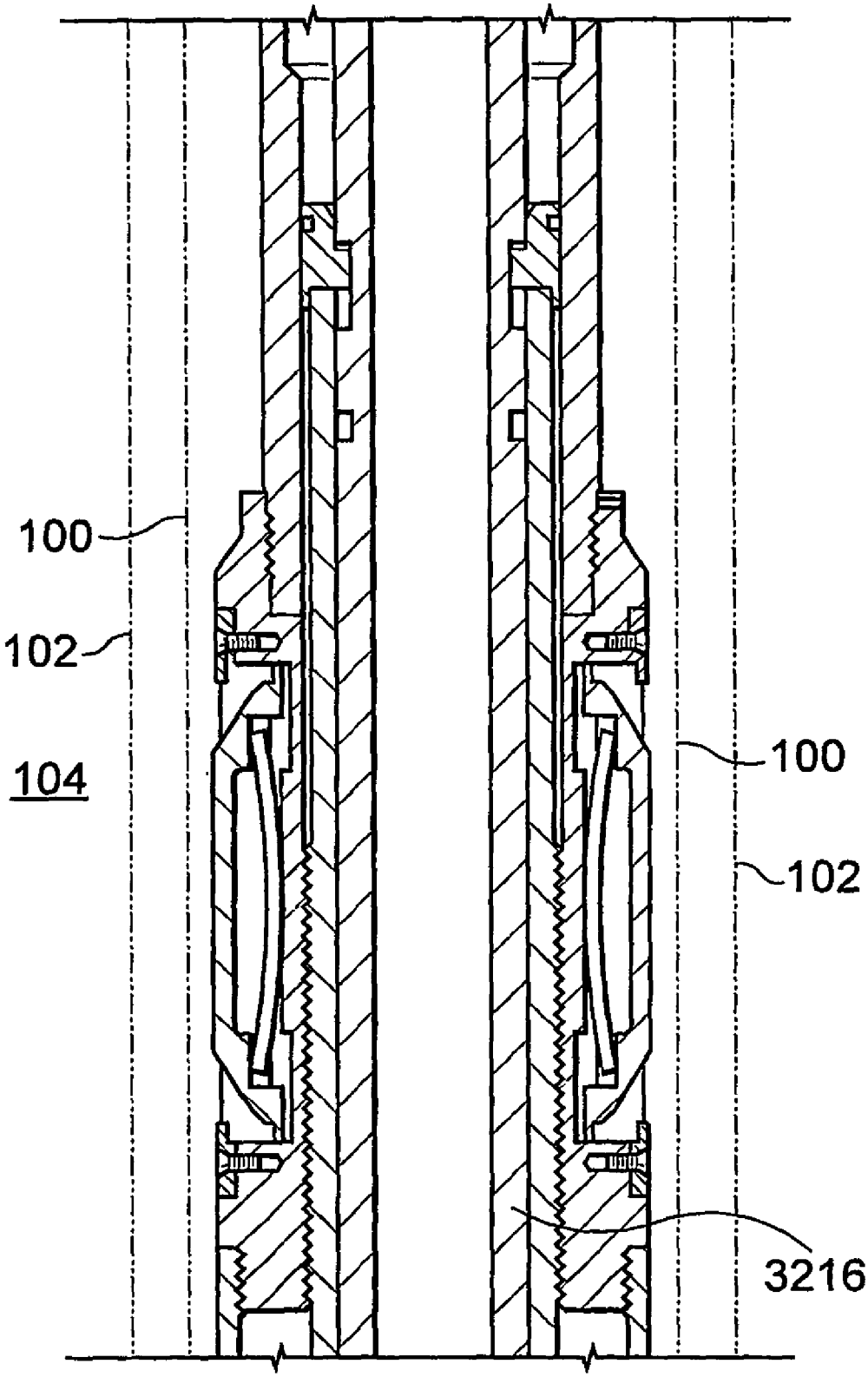
*Fig. 20A2*

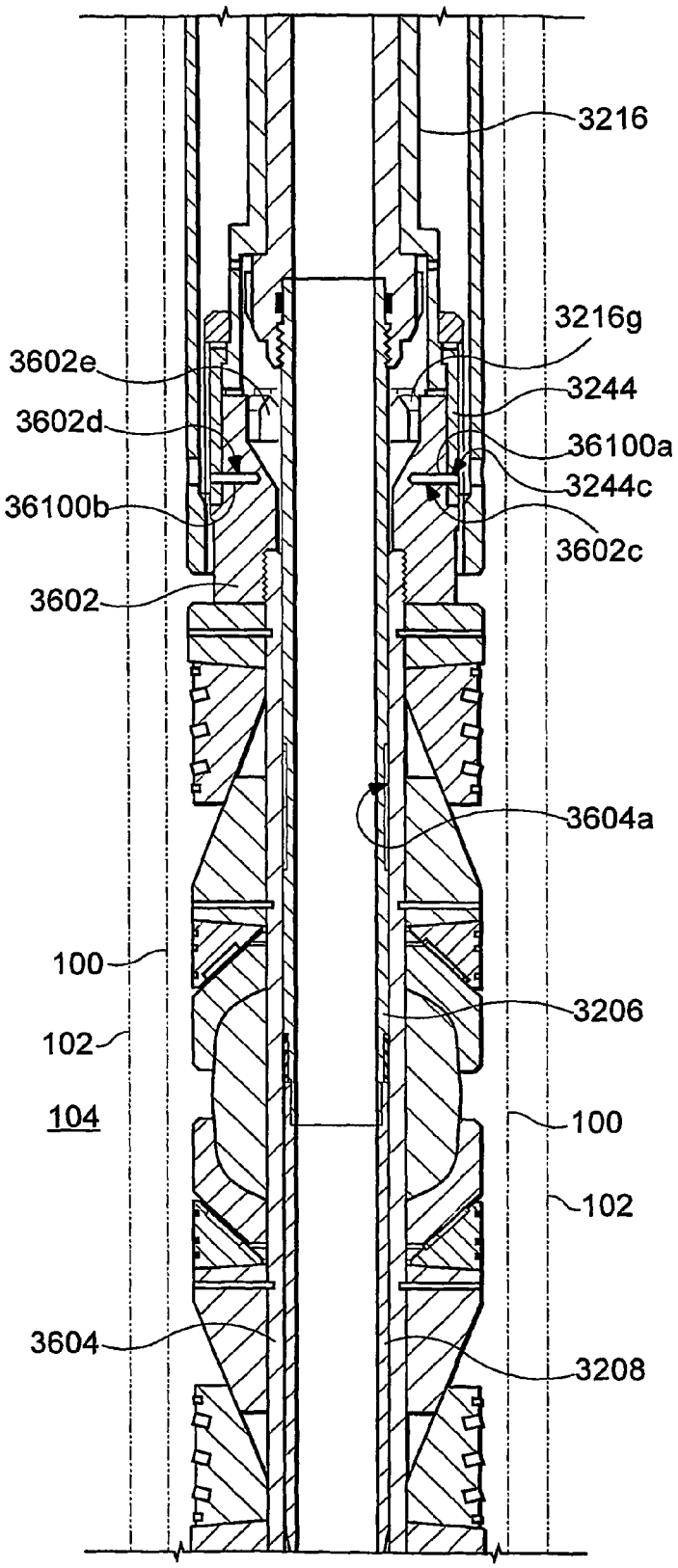
*Fig. 20A3*

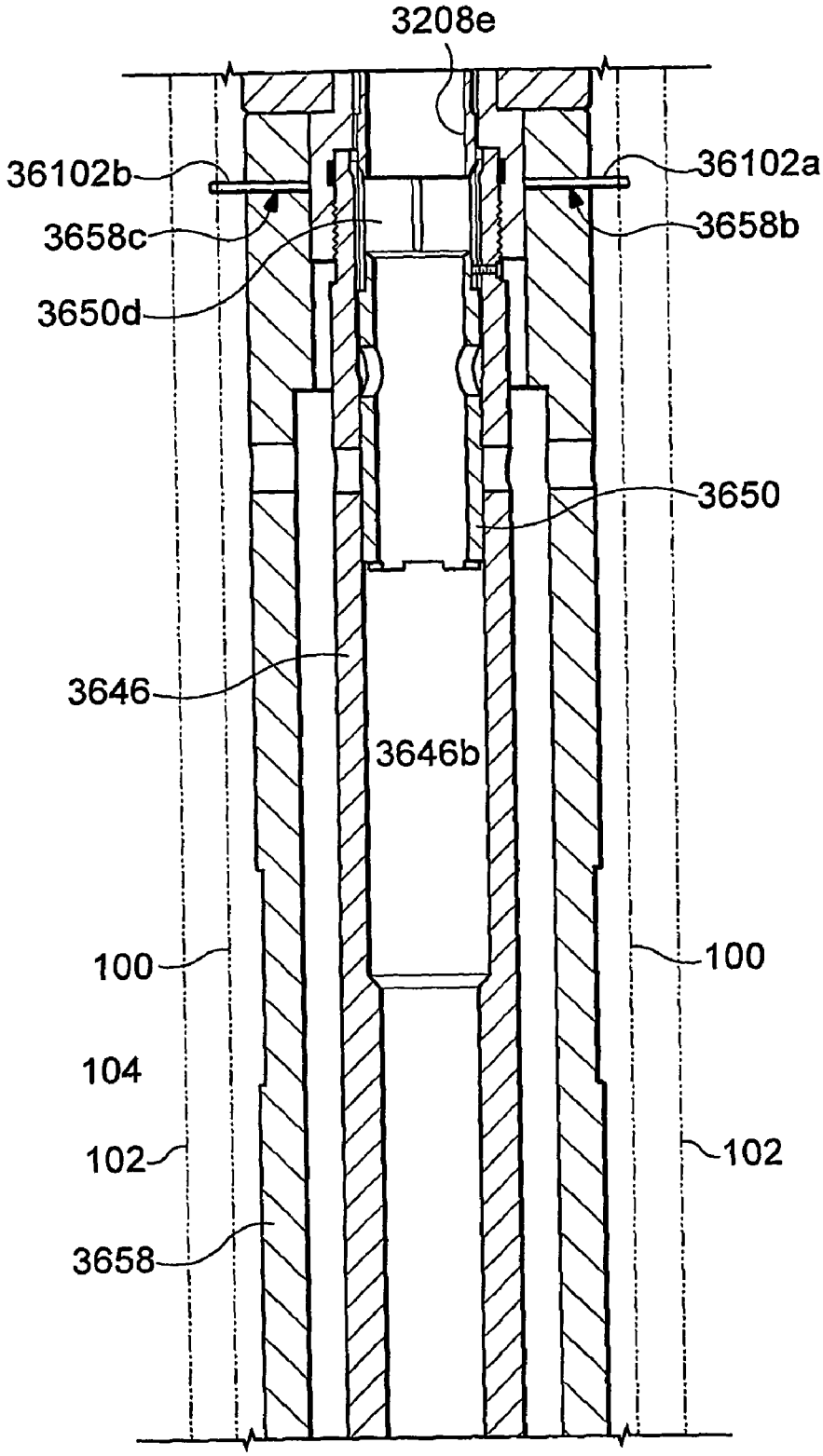
*Fig. 20A4*

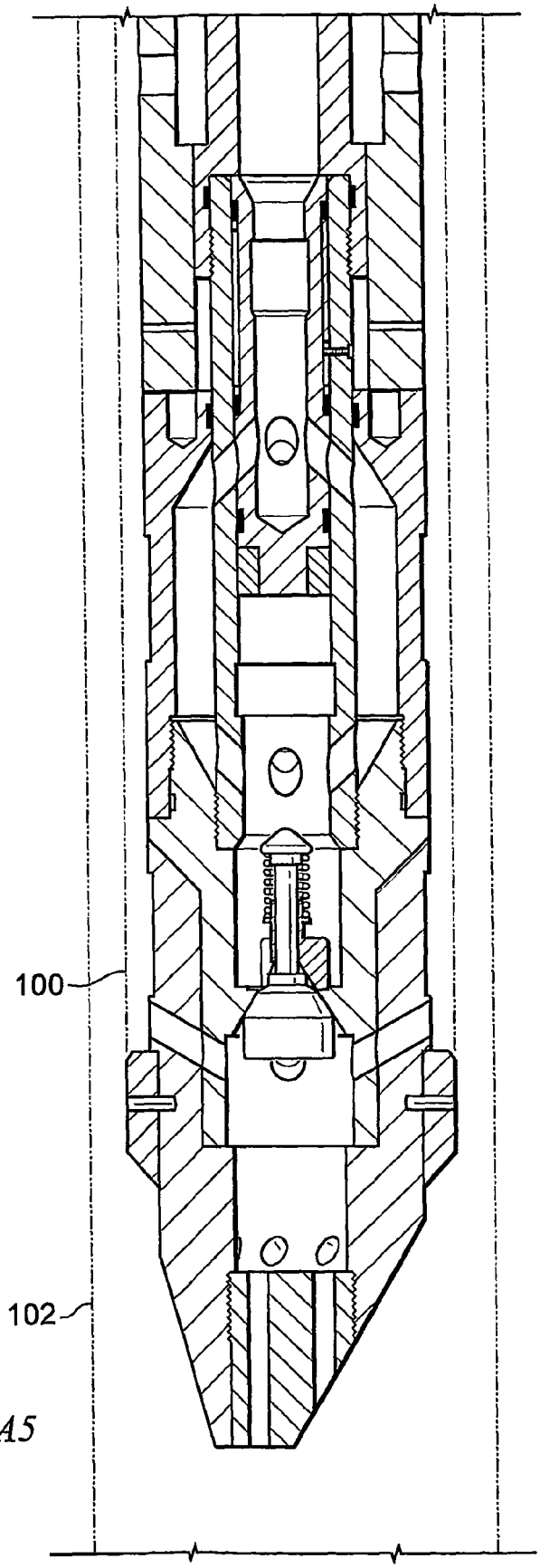
*Fig. 20A5*

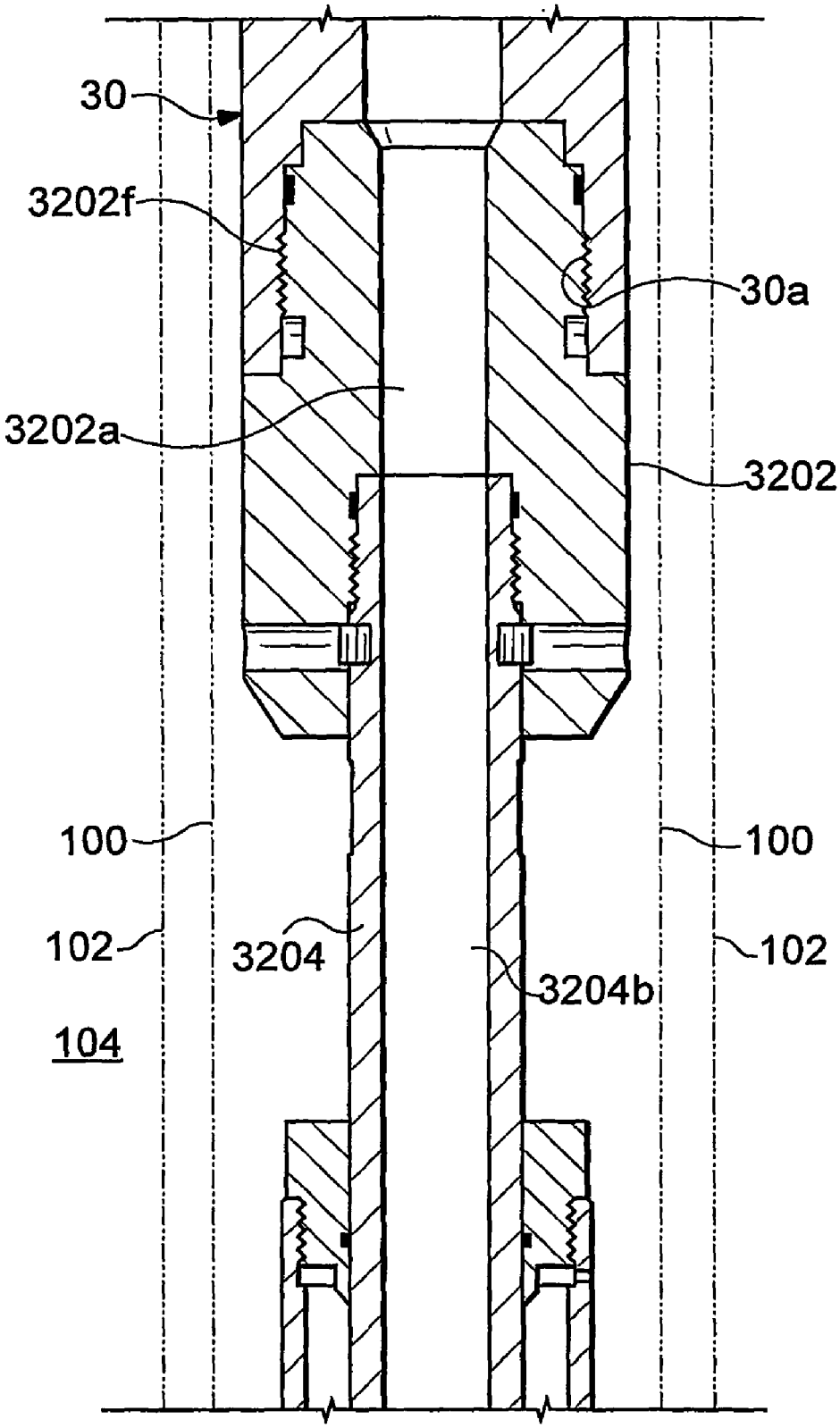
*Fig. 20B1*

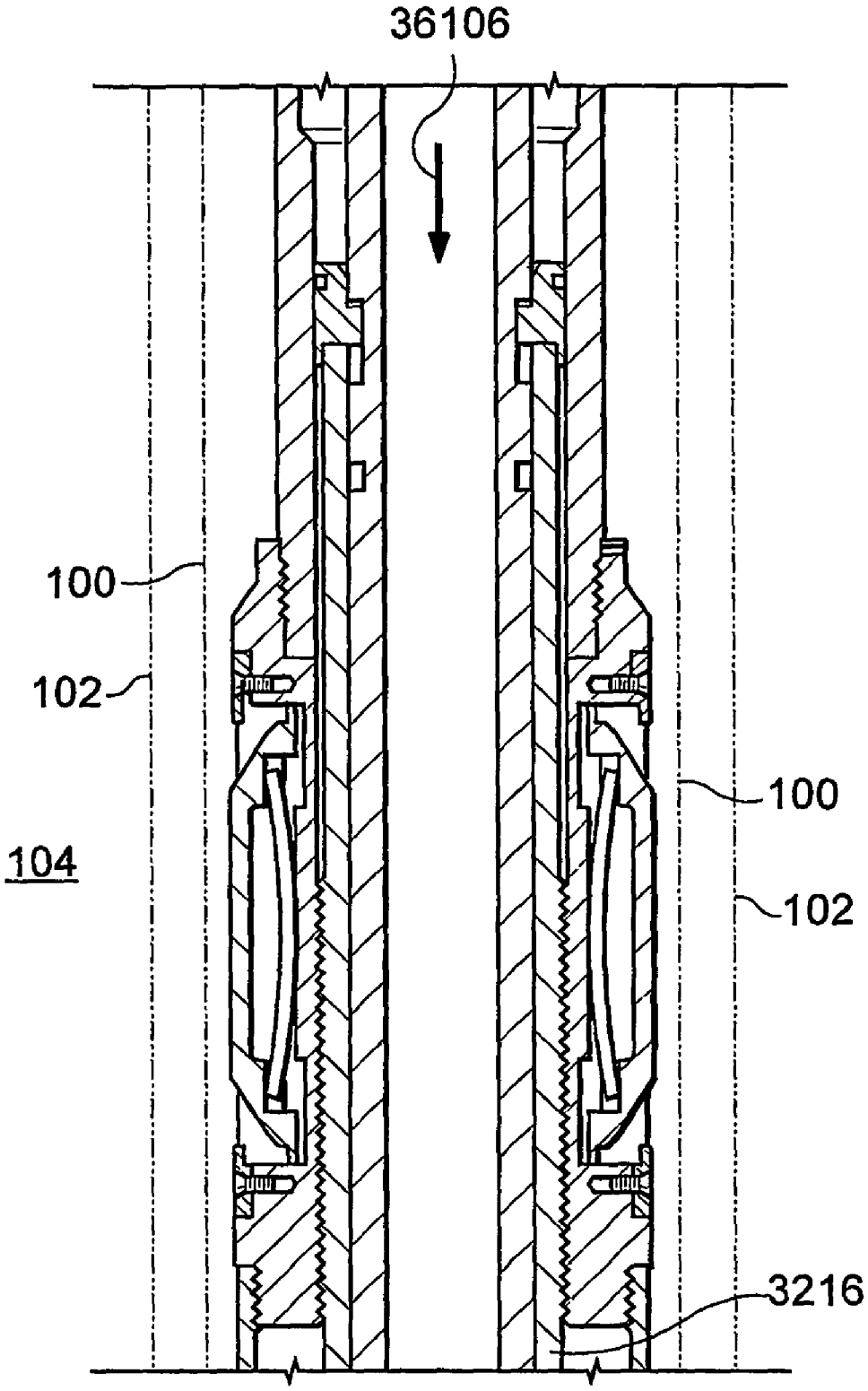
*Fig. 20B2*

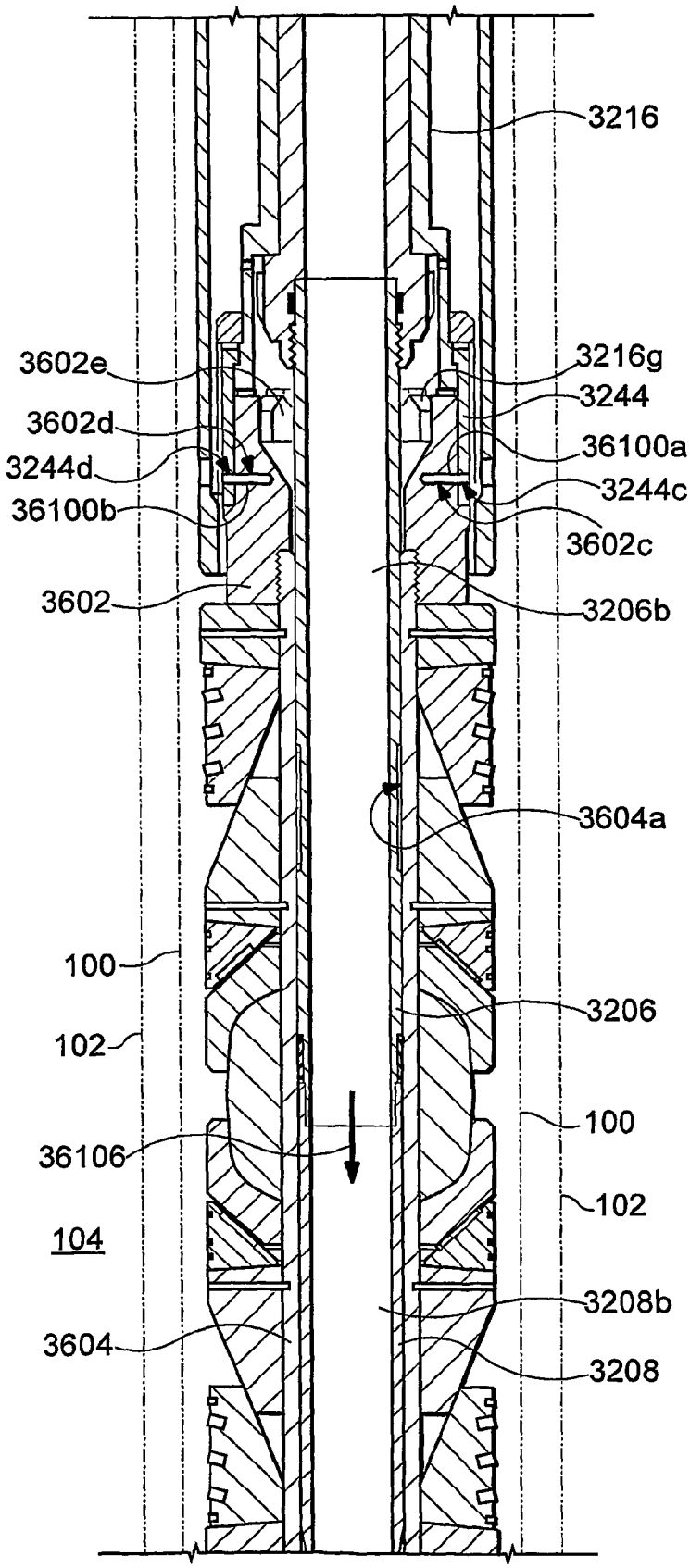
*Fig. 20B3*

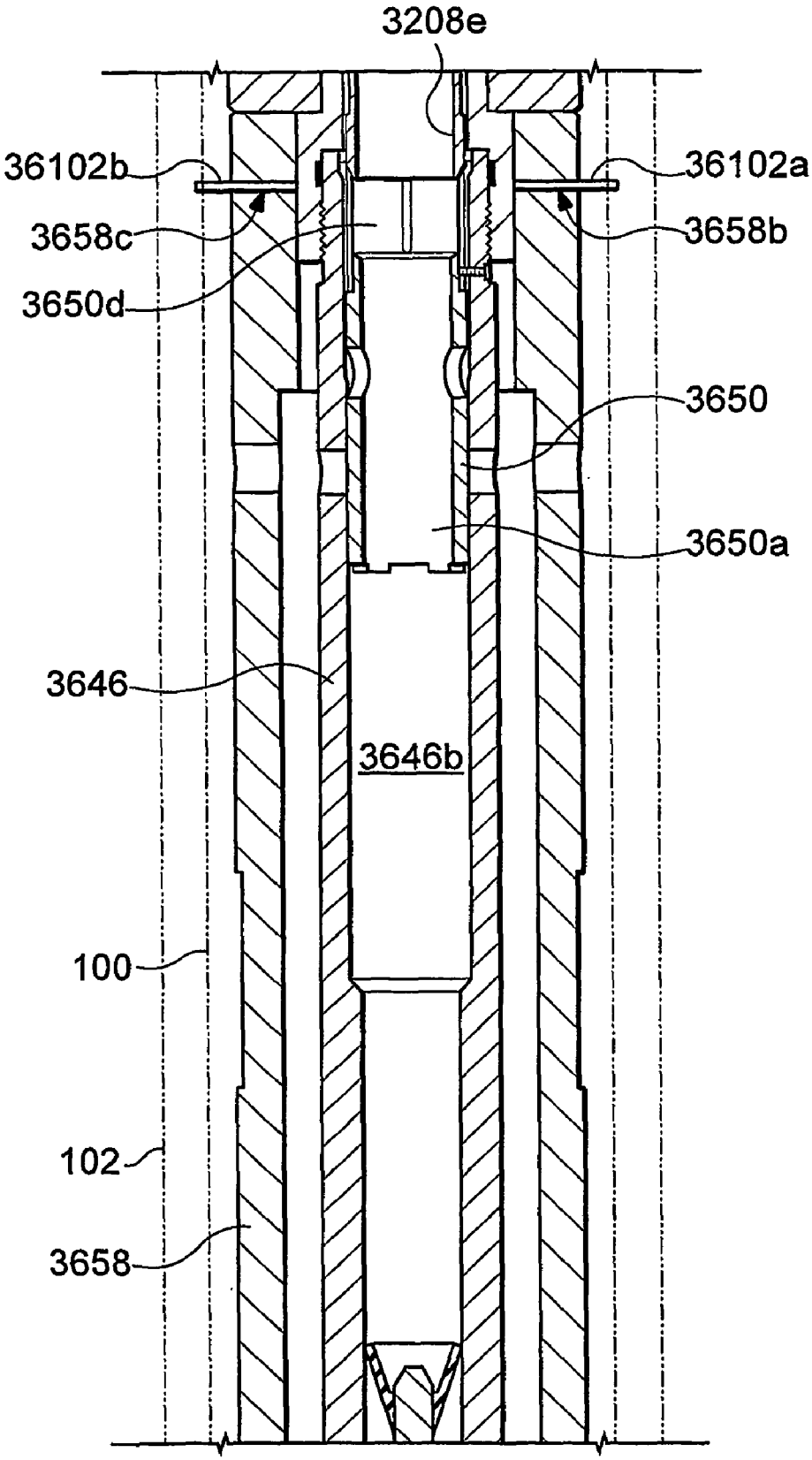
*Fig. 20B4*

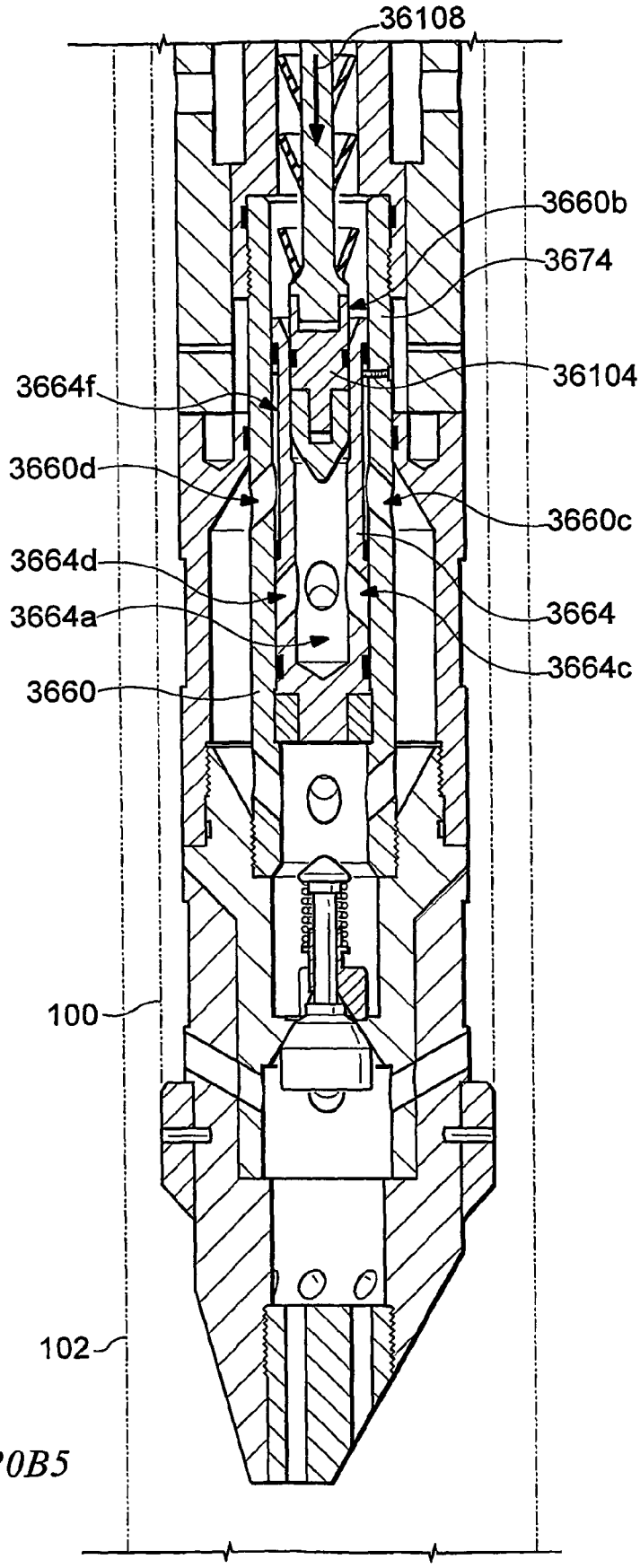
*Fig. 20B5*

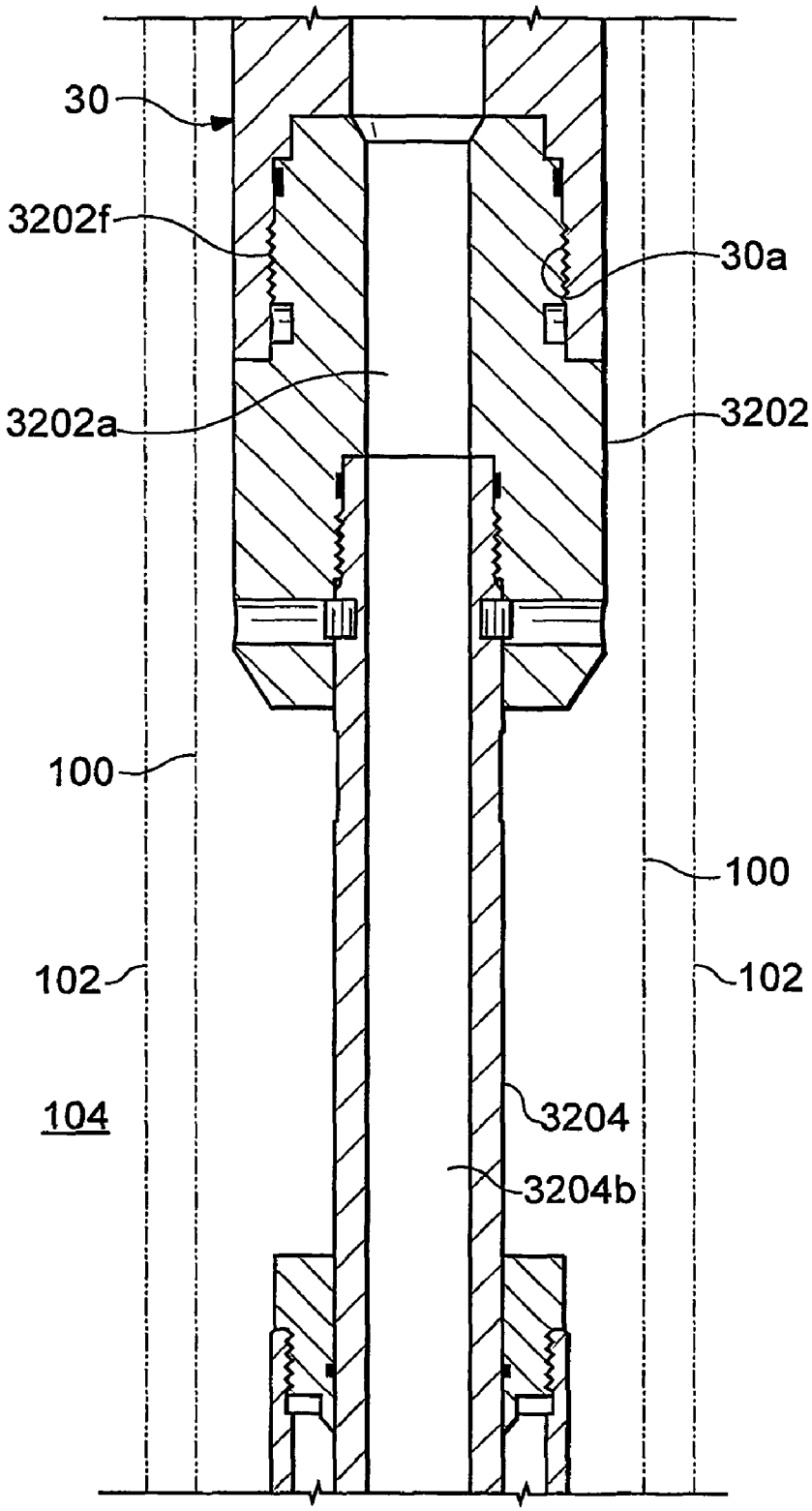
*Fig. 20C1*

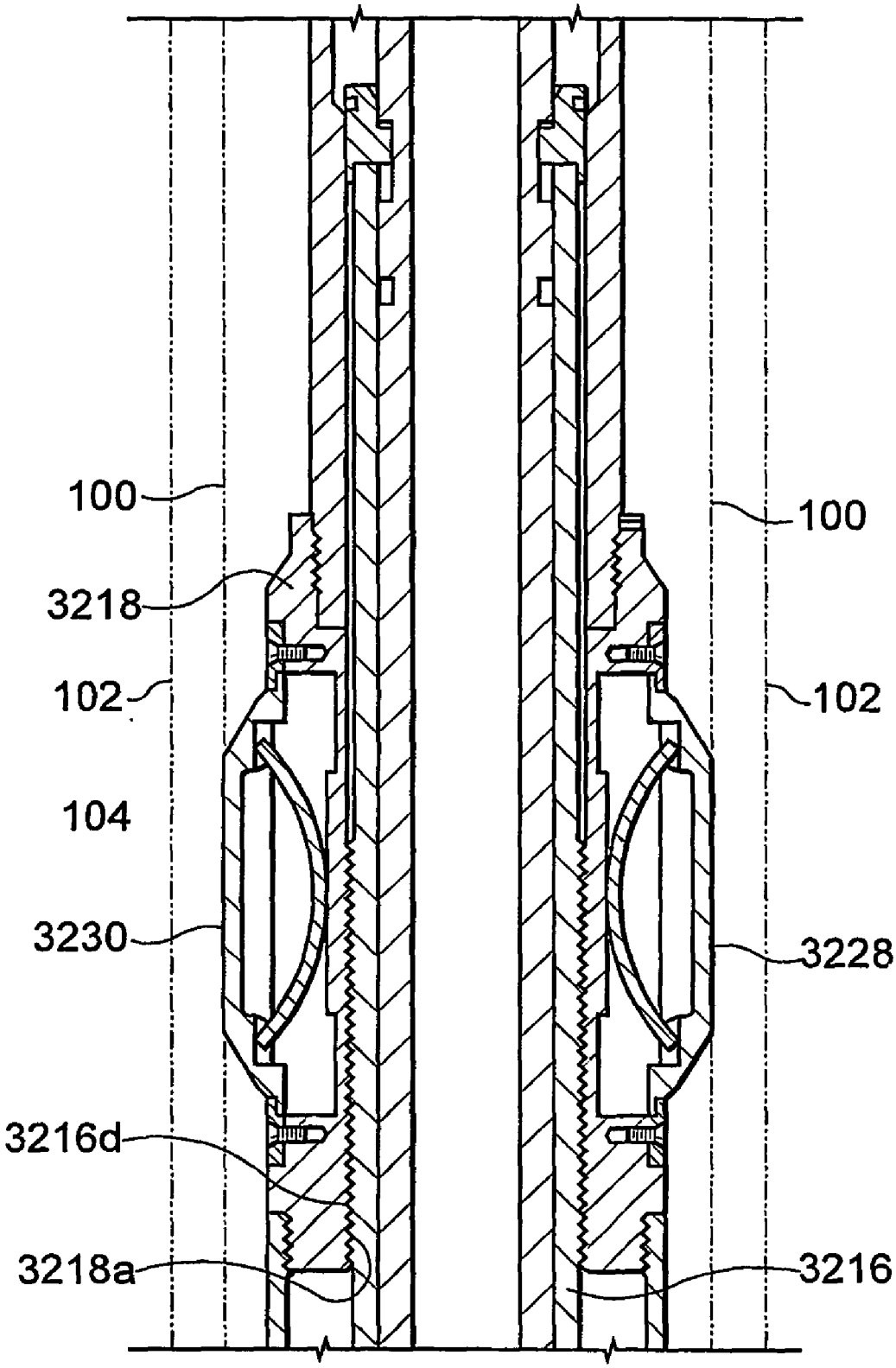
*Fig. 20C2*

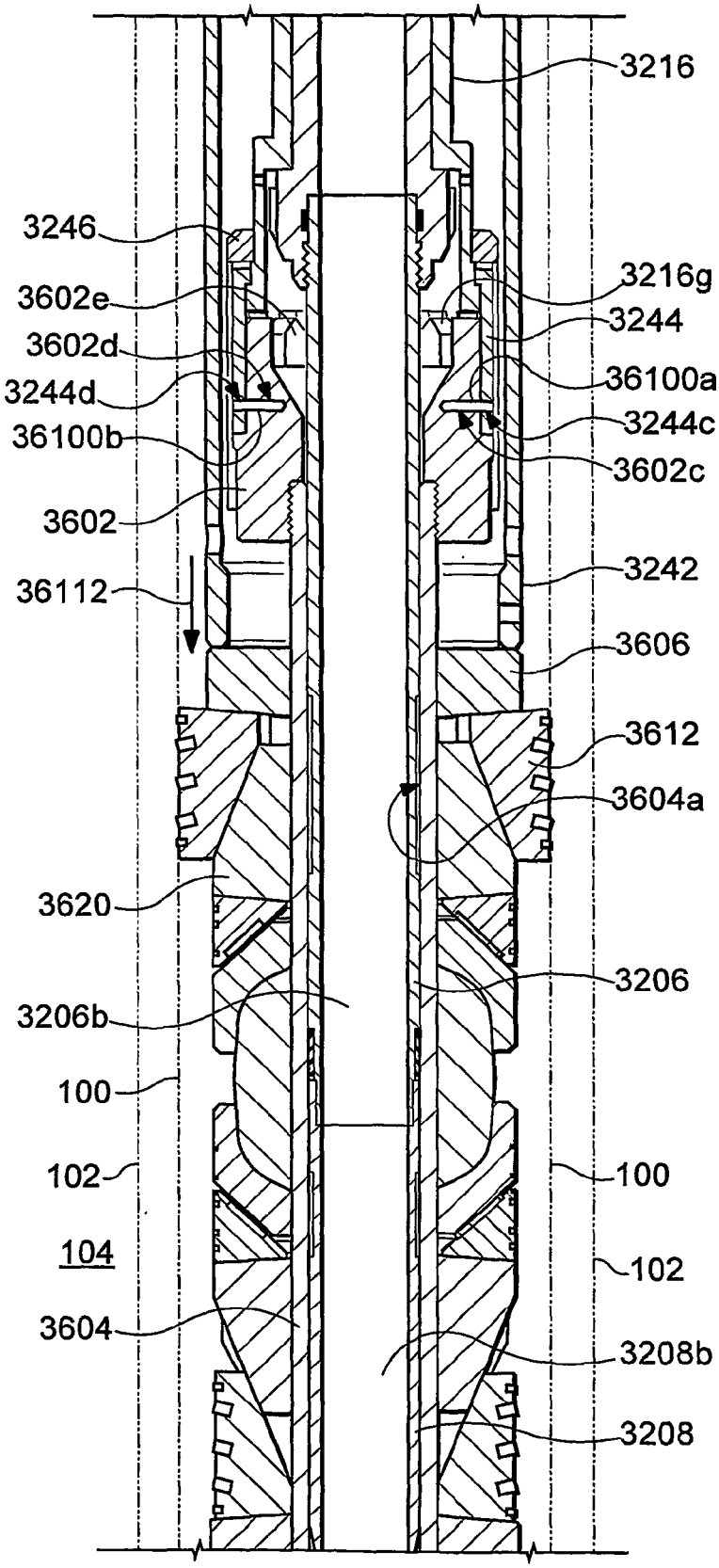
*Fig. 20C3*

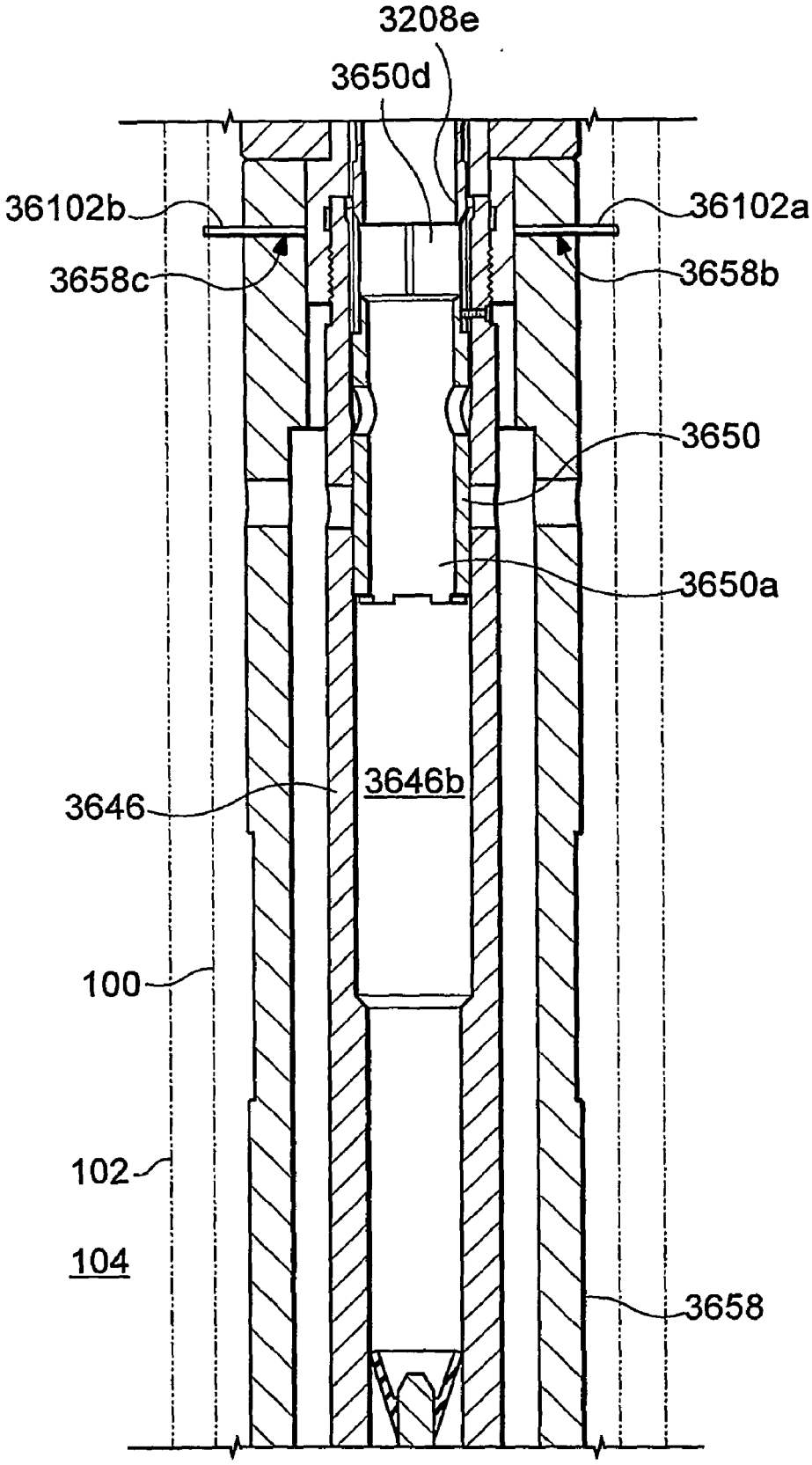
*Fig. 20C4*

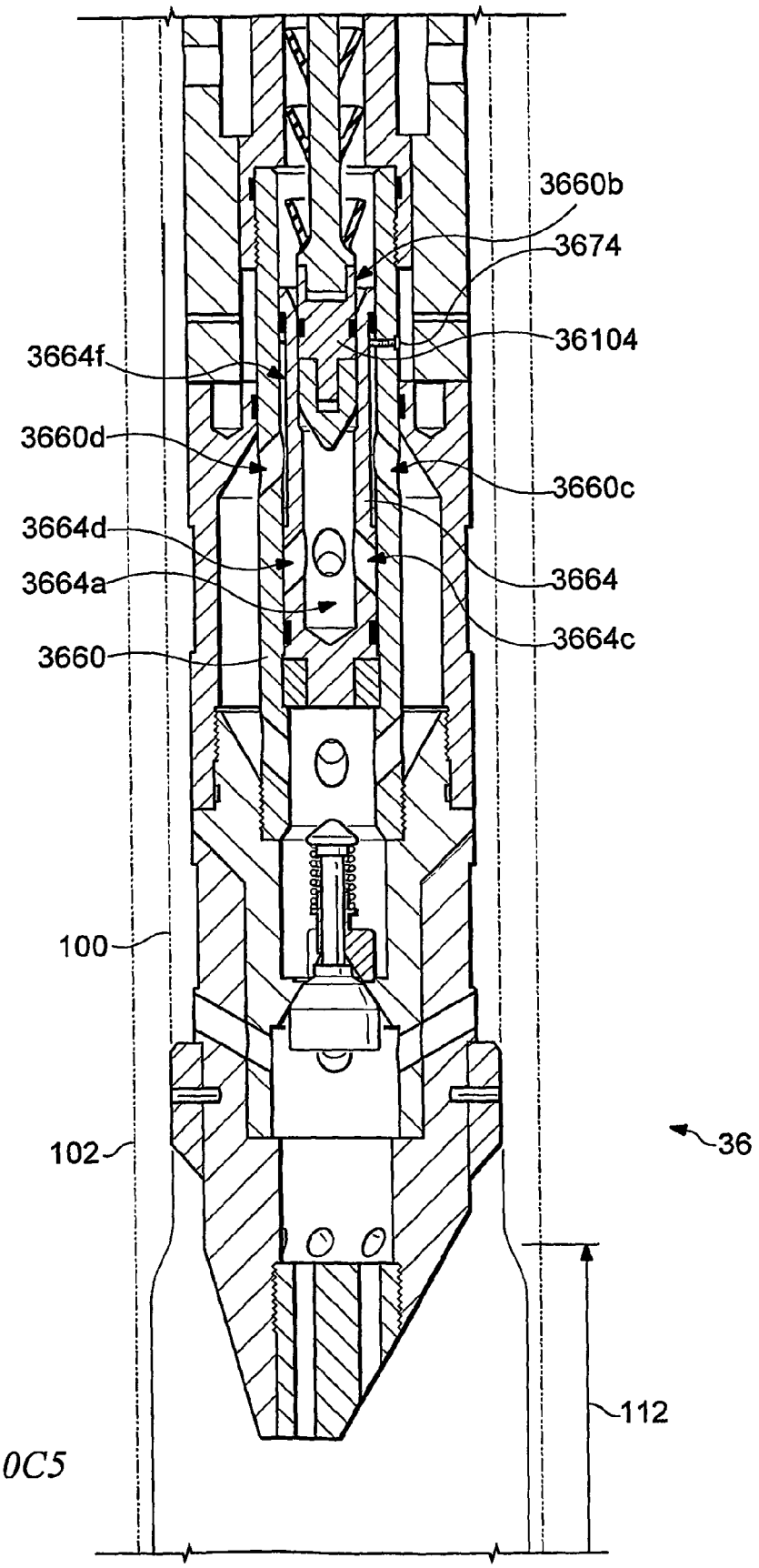
*Fig. 20C5*

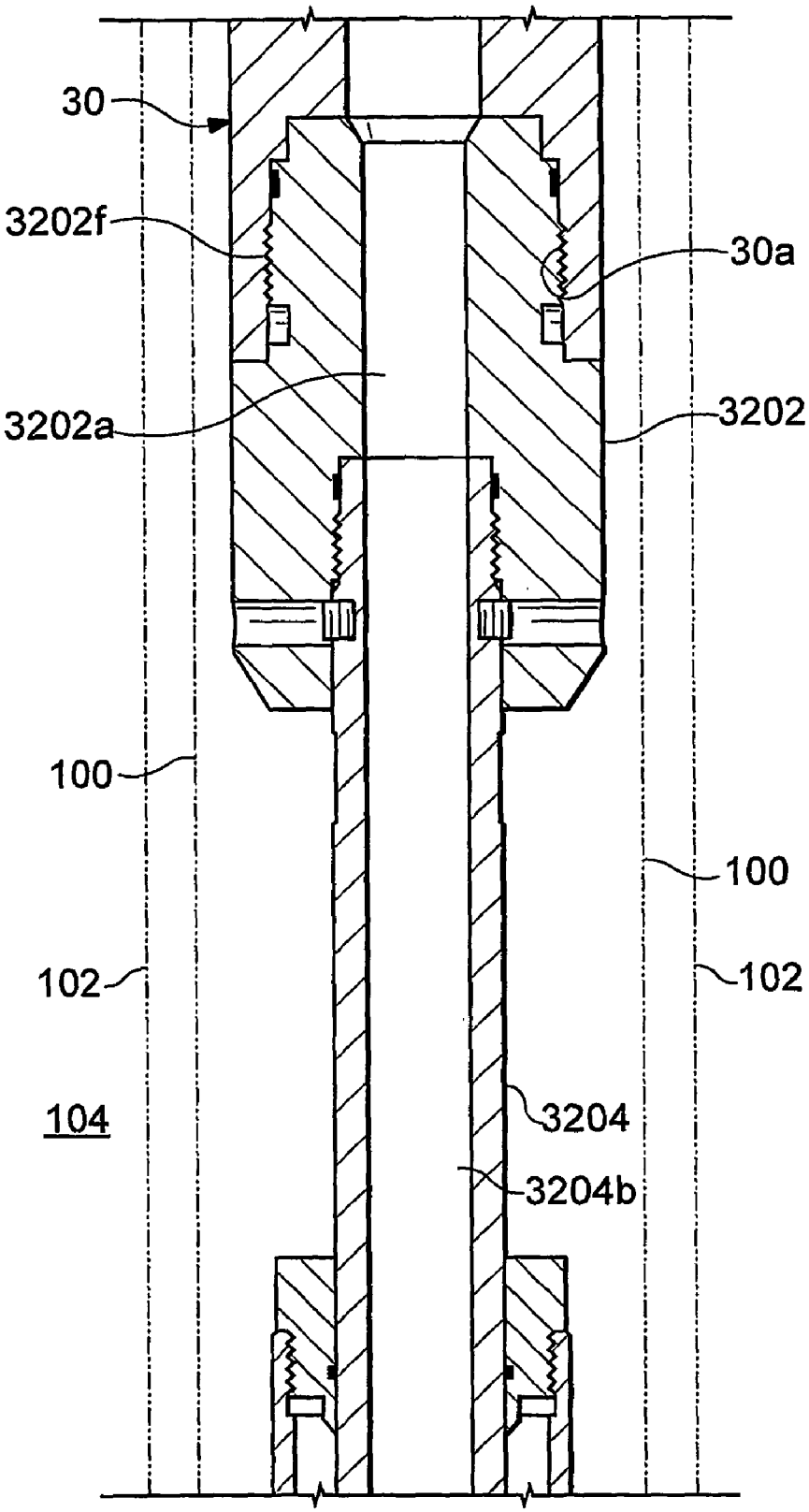
*Fig. 20D1*

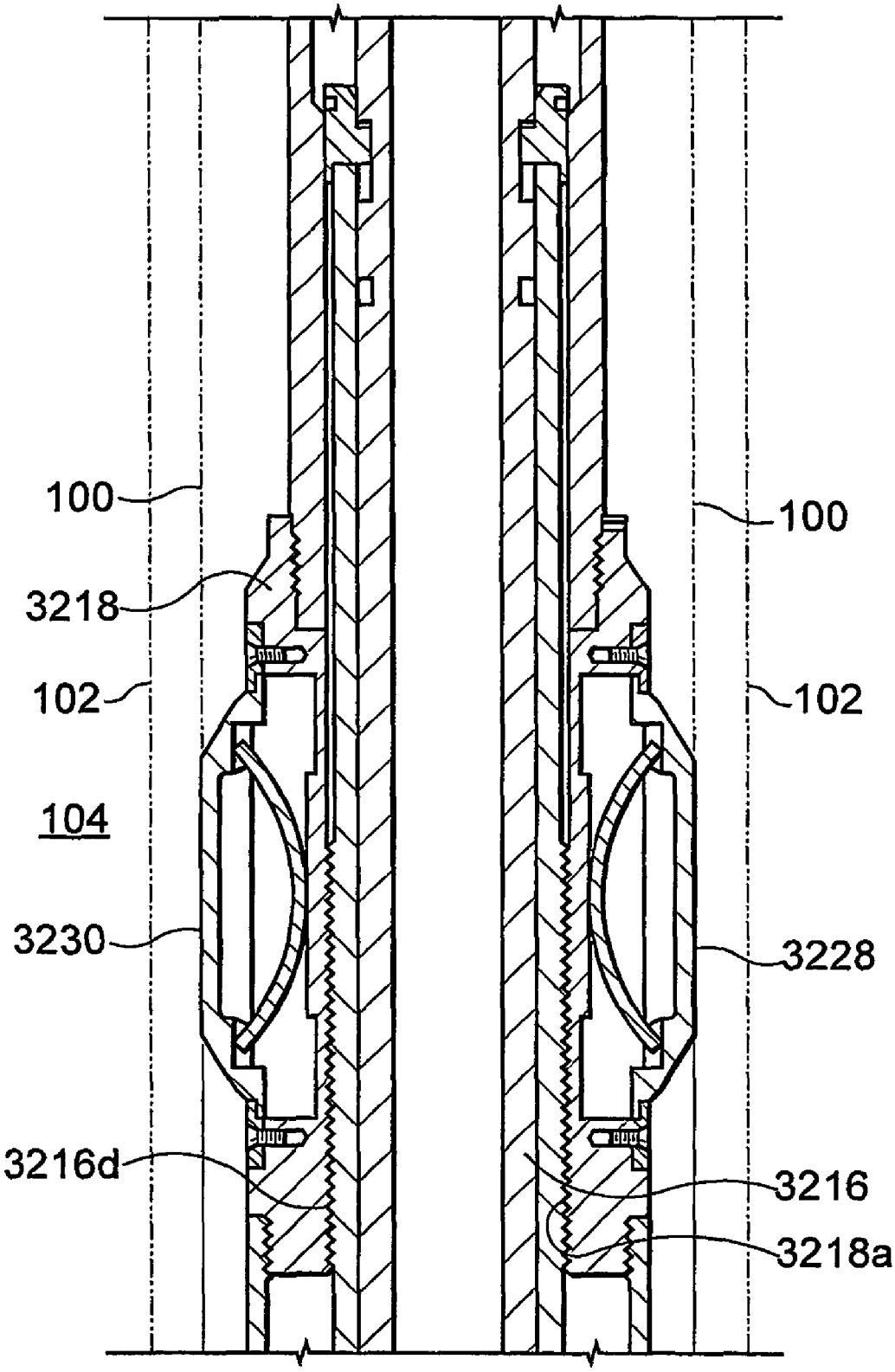
*Fig. 20D2*

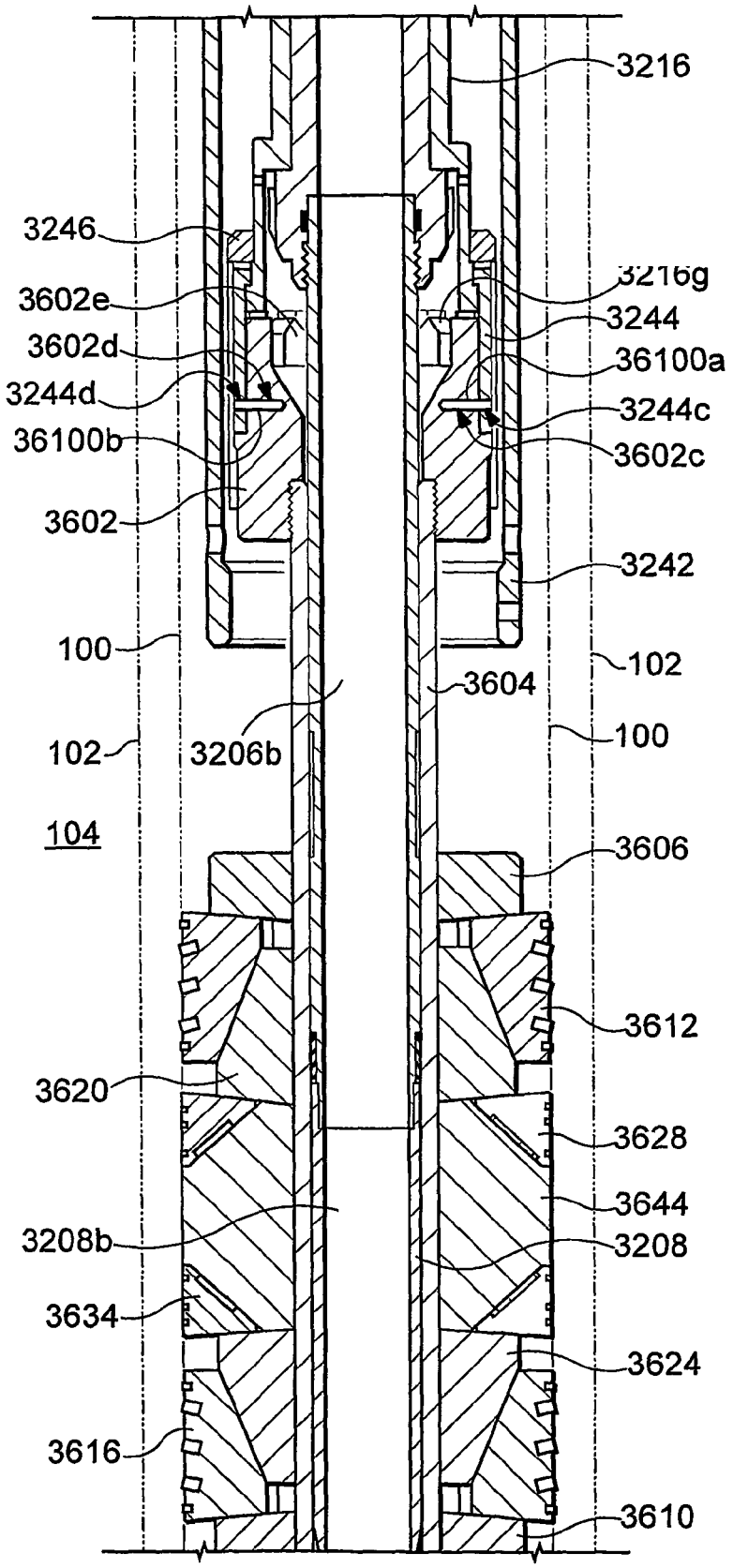
*Fig. 20D3*

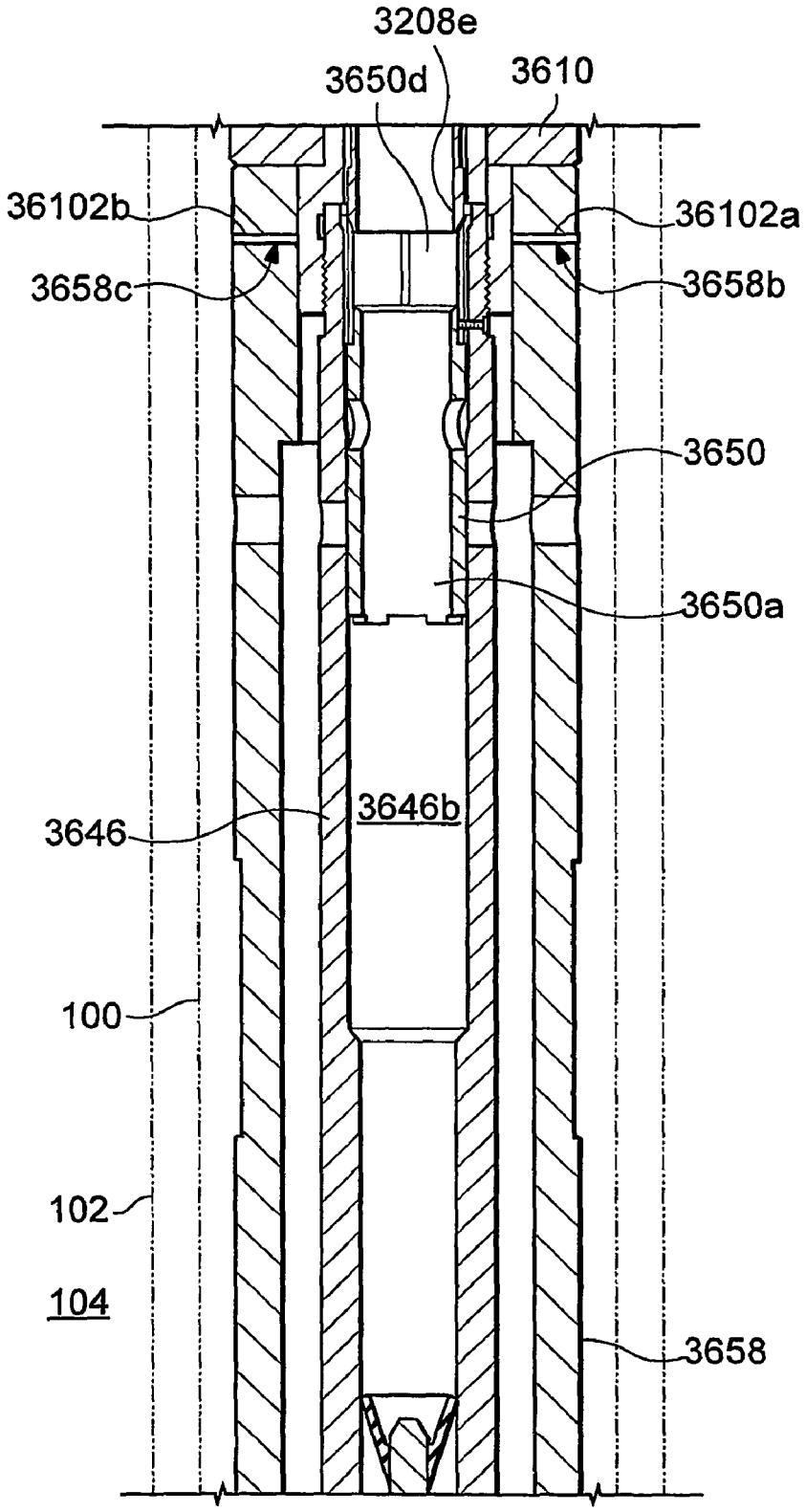
Fig. 20D4

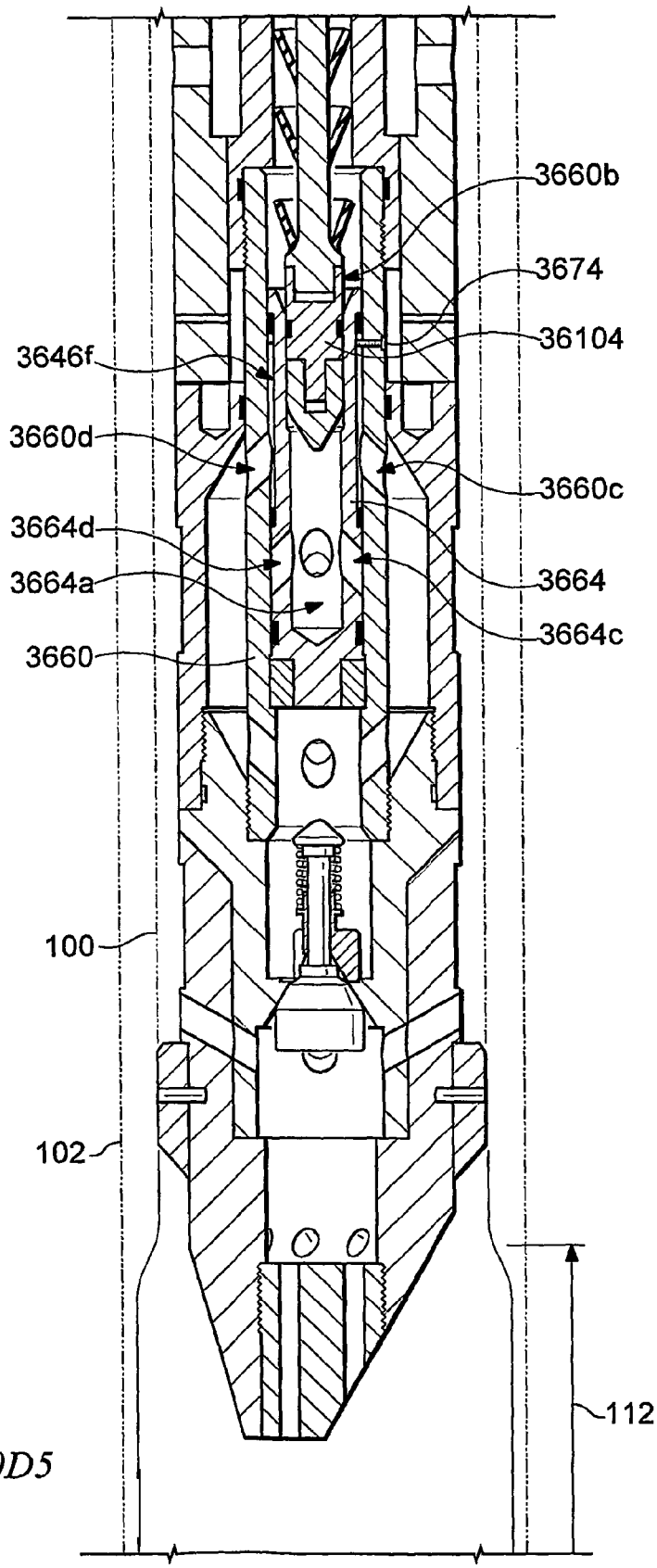
*Fig. 20D5*

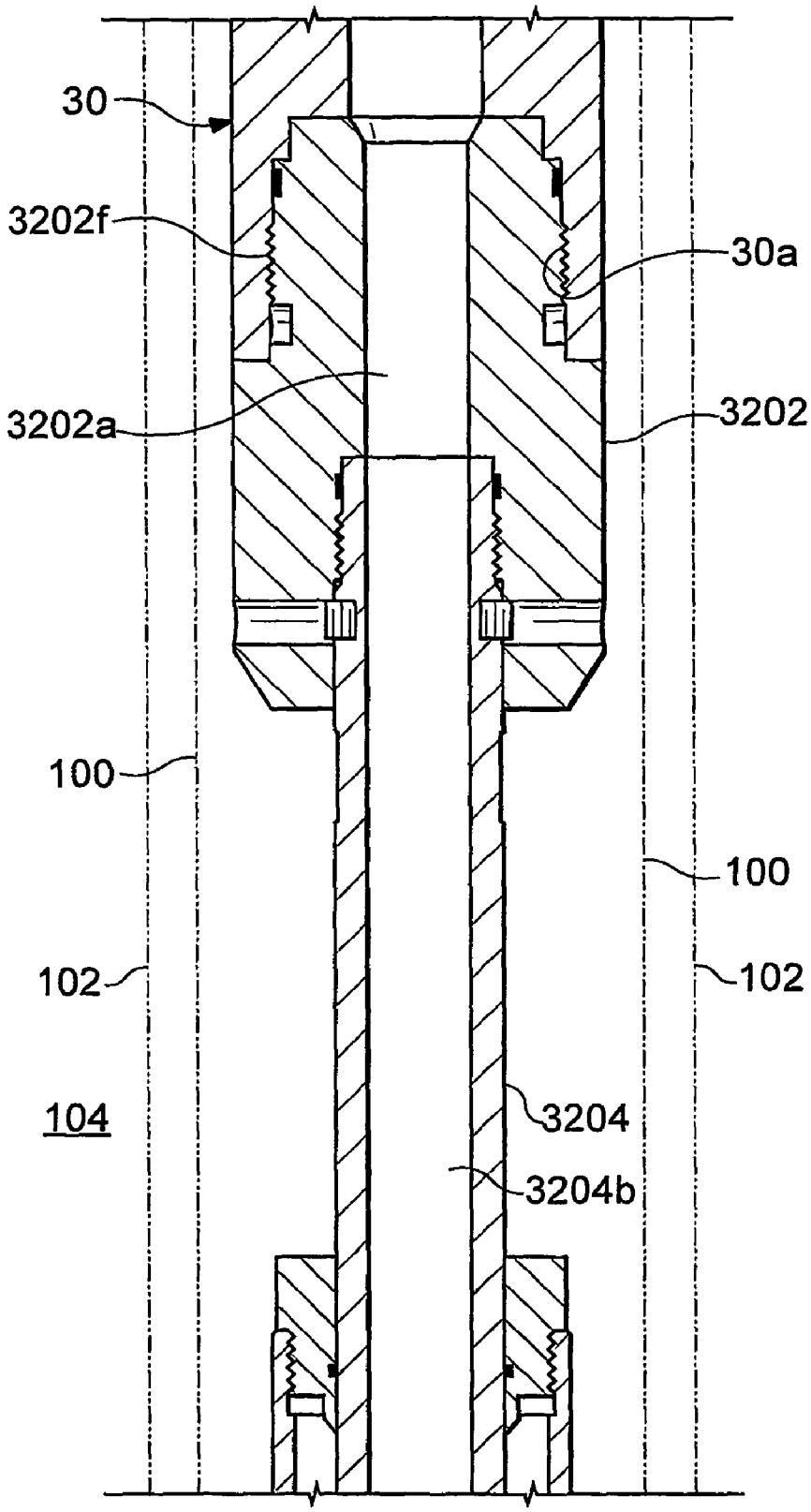
*Fig. 20E1*

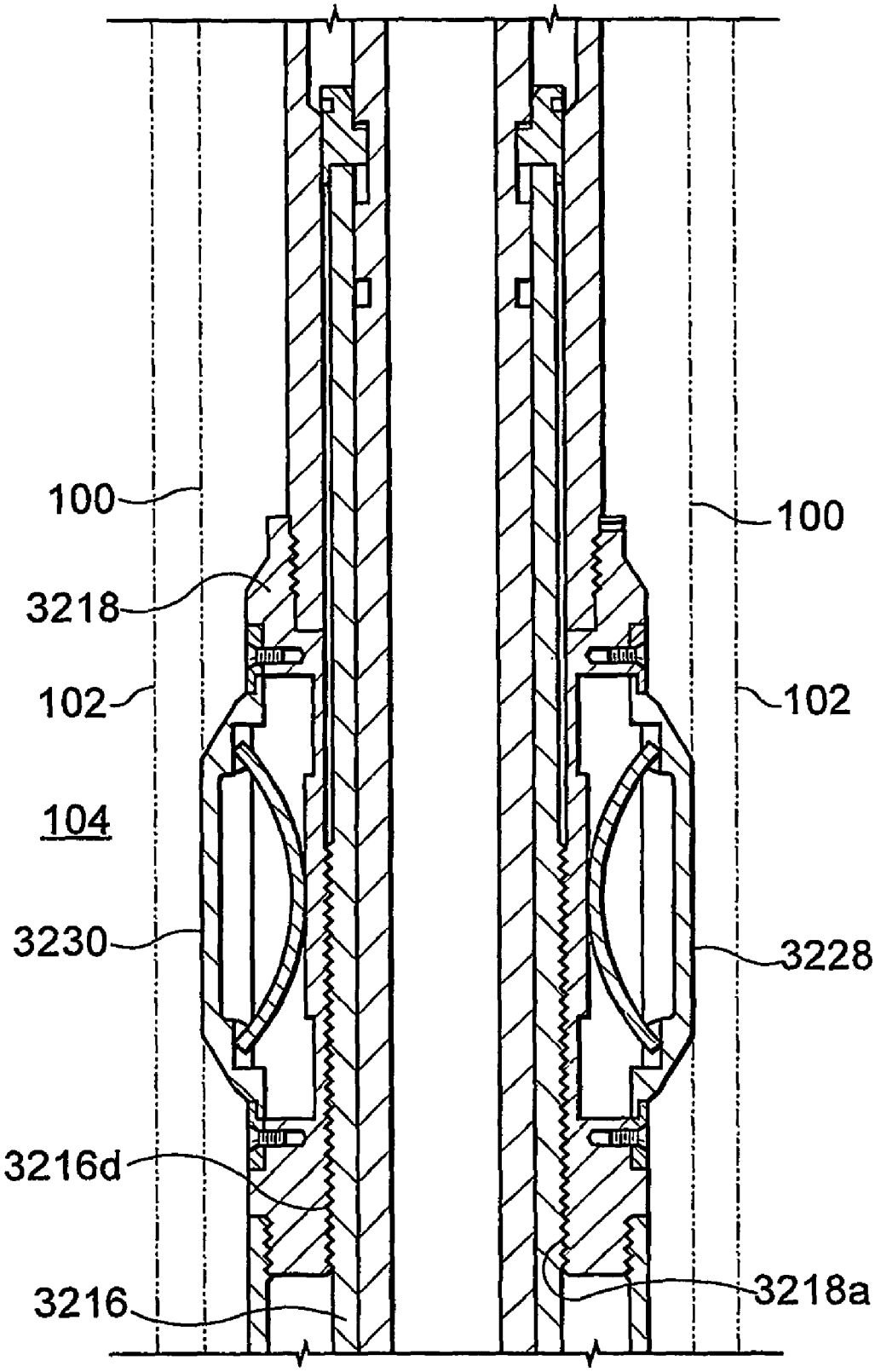
*Fig. 20E2*

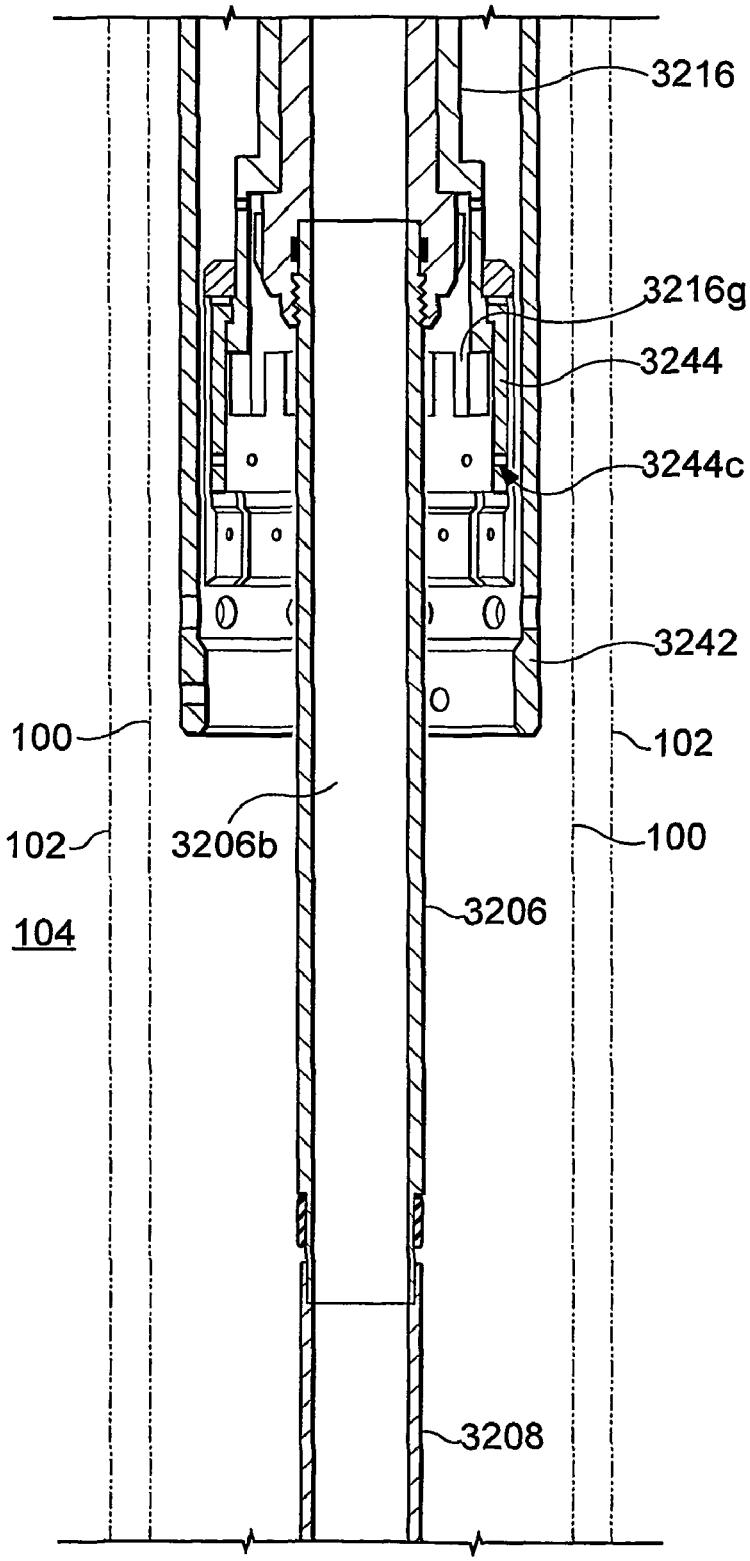
*Fig. 20E3*

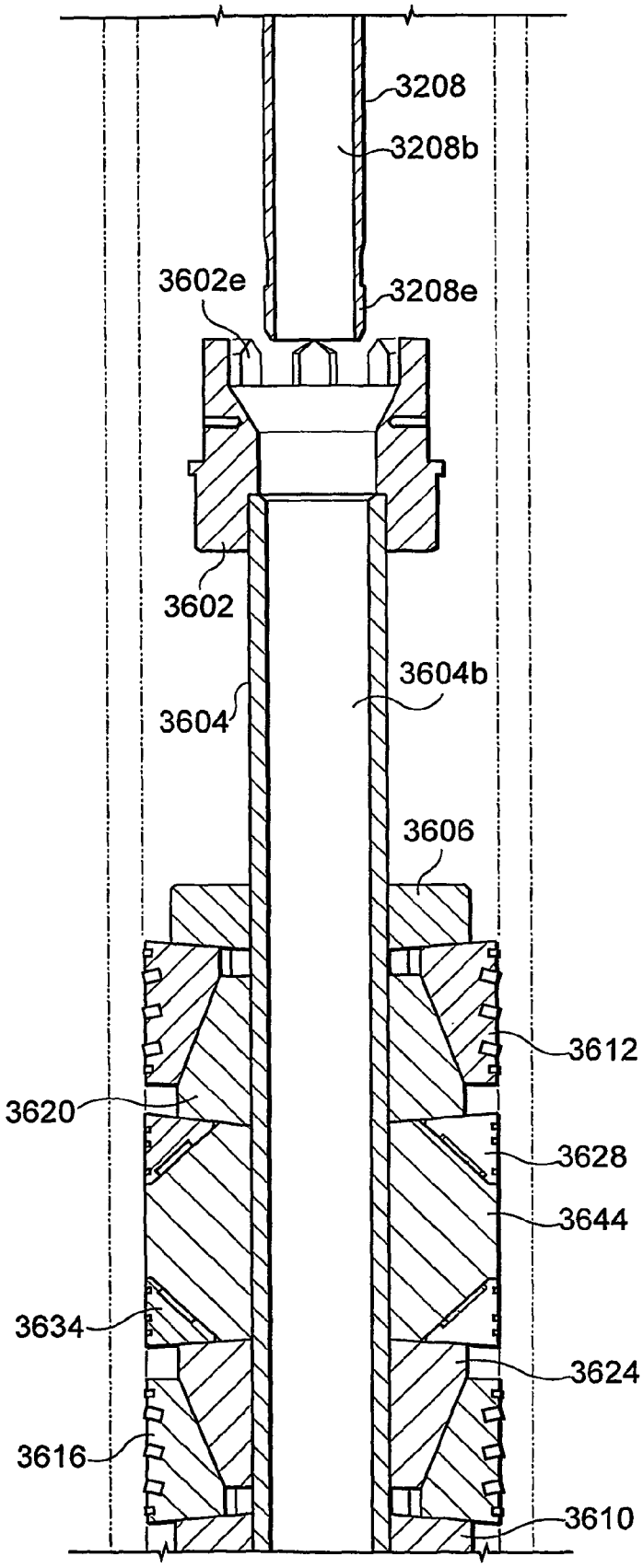
*Fig. 20E4*

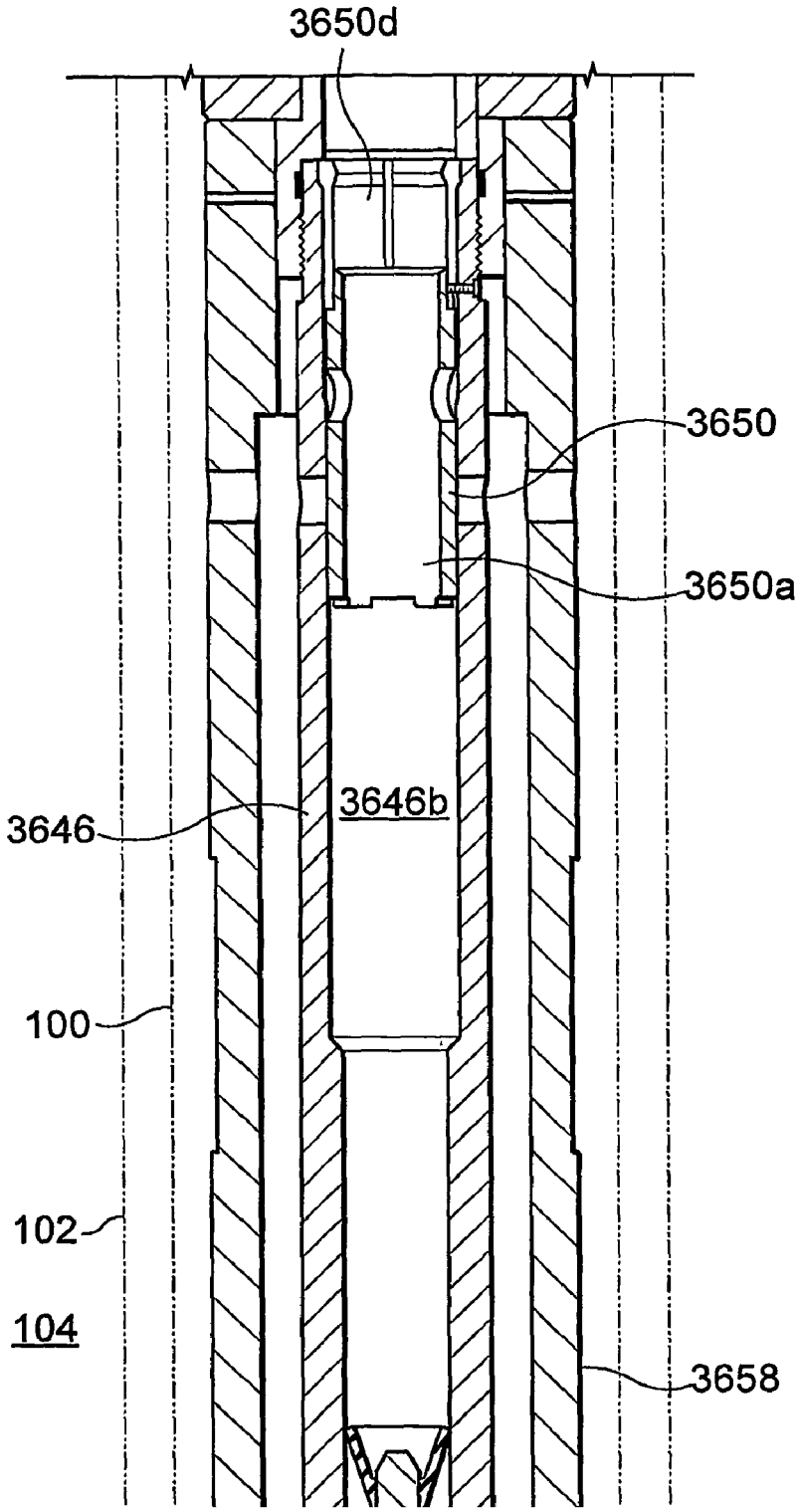
*Fig. 20E5*

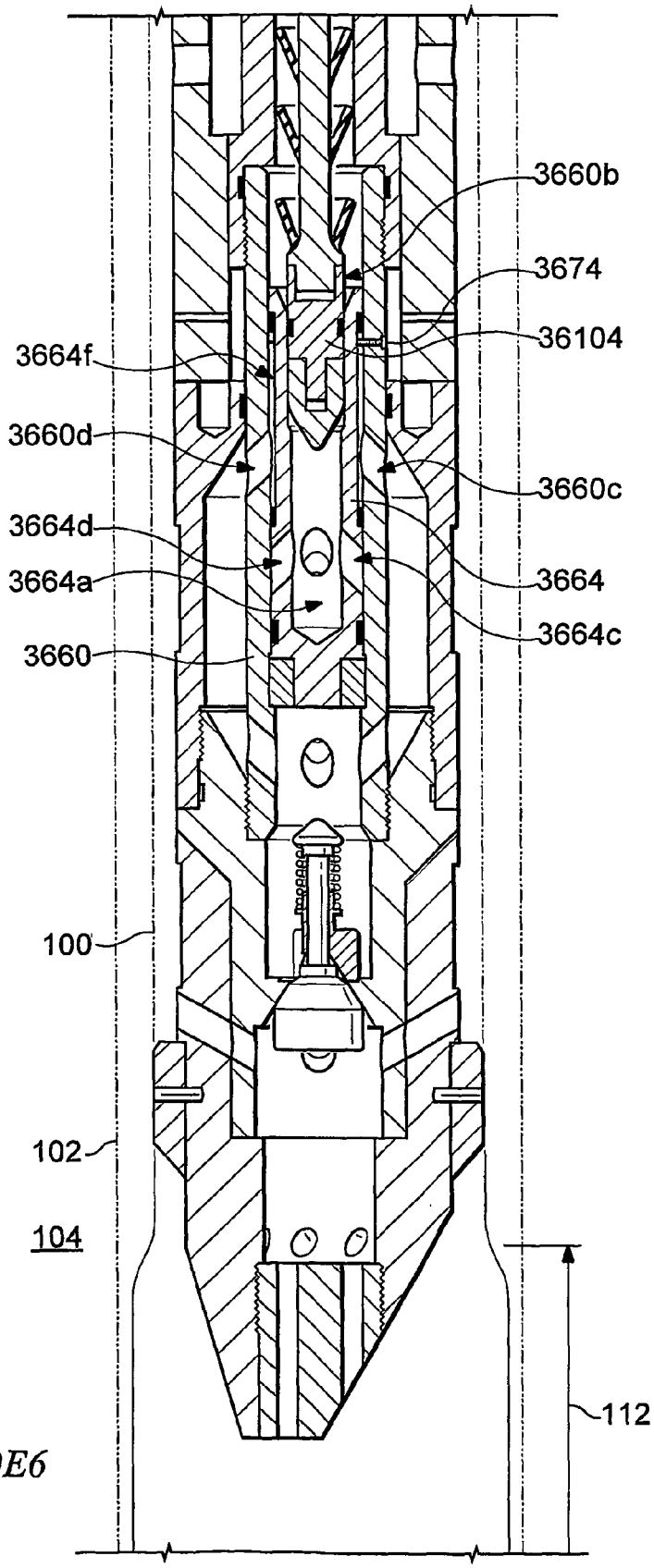
*Fig. 20E6*

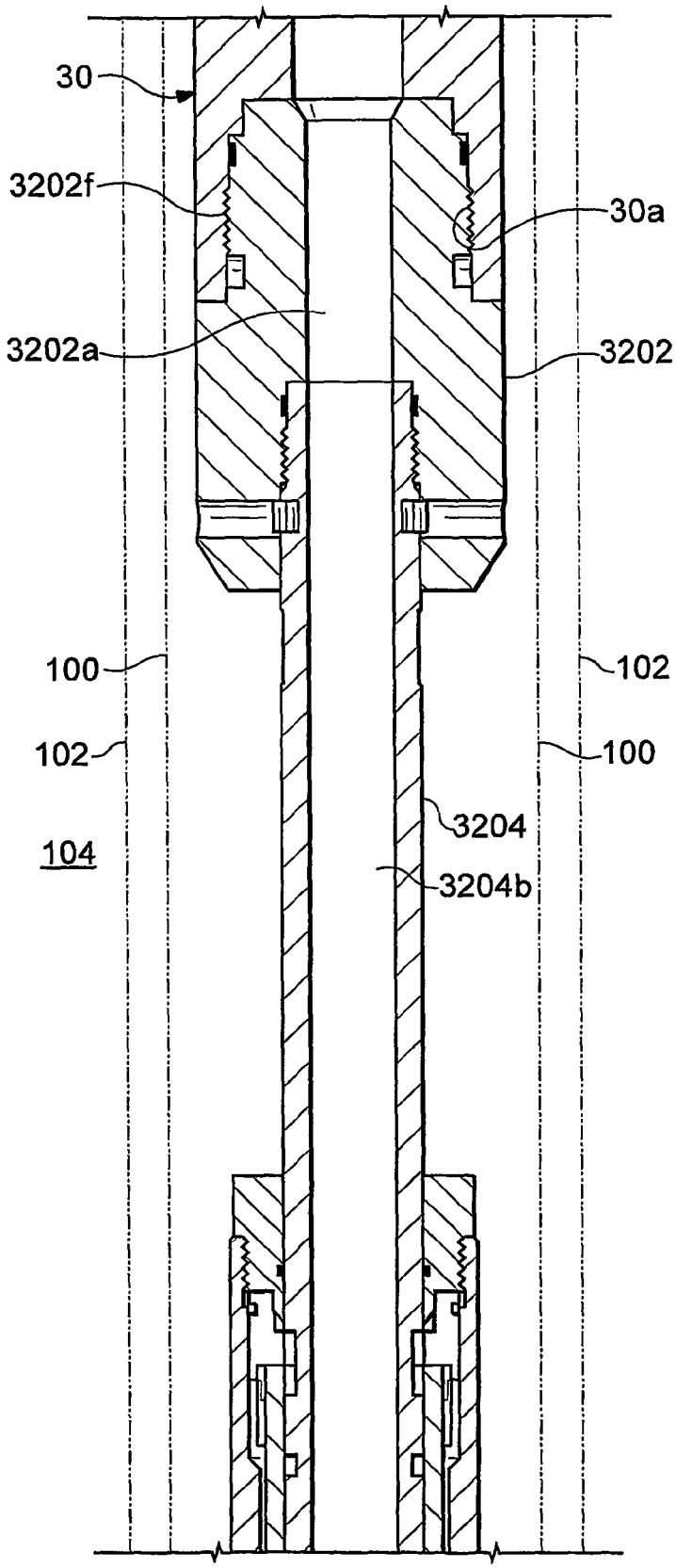
*Fig. 20F1*

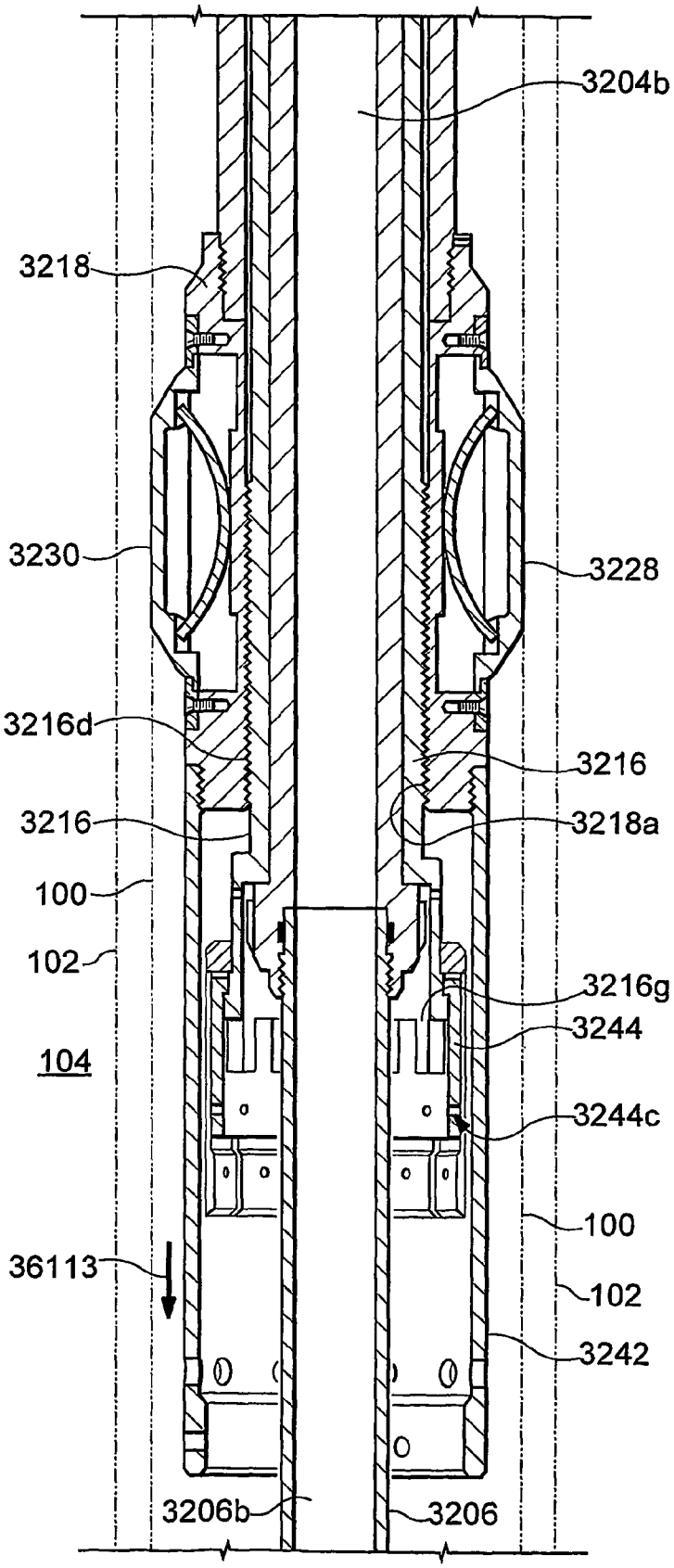
*Fig. 20F2*

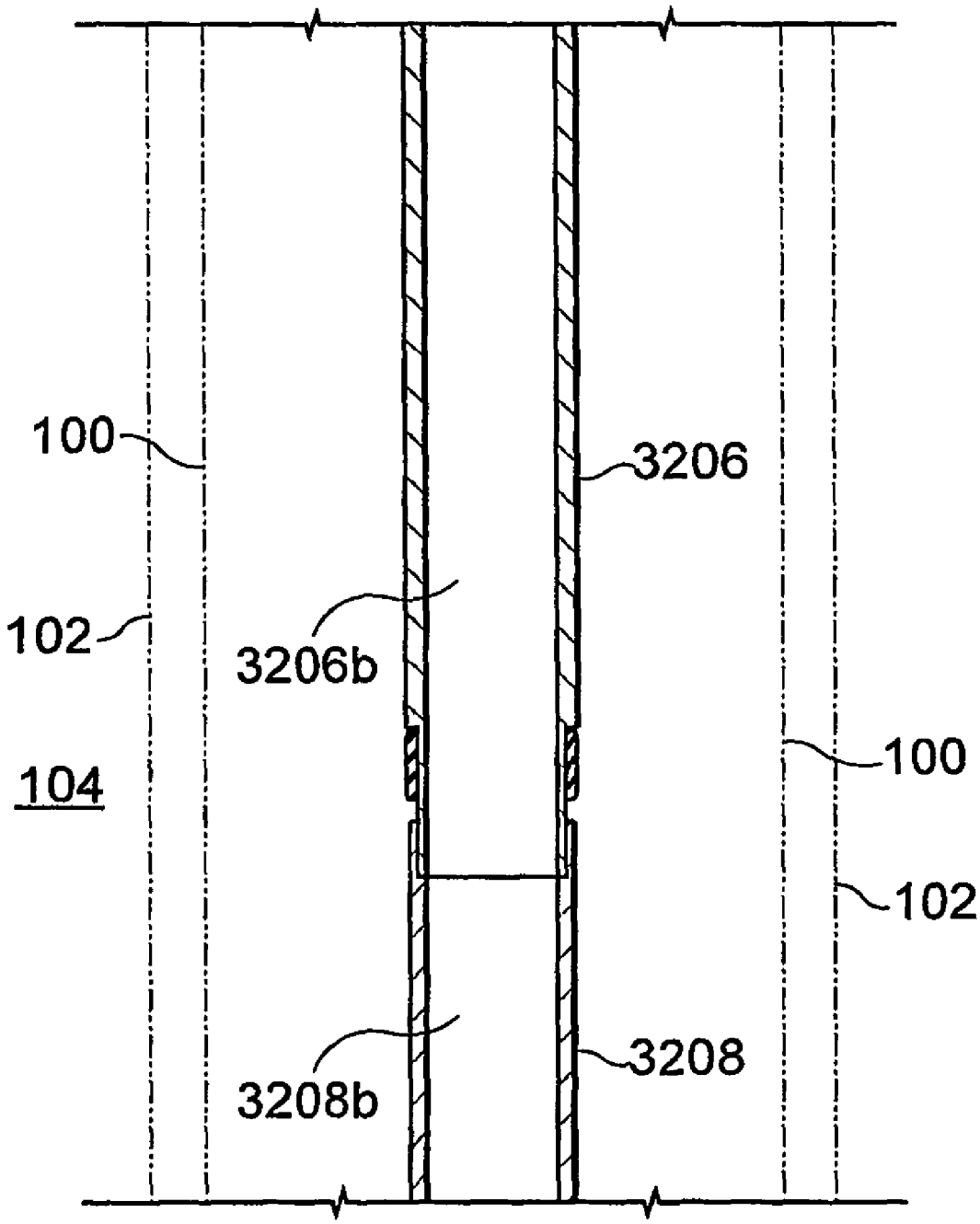
*Fig. 20F3*

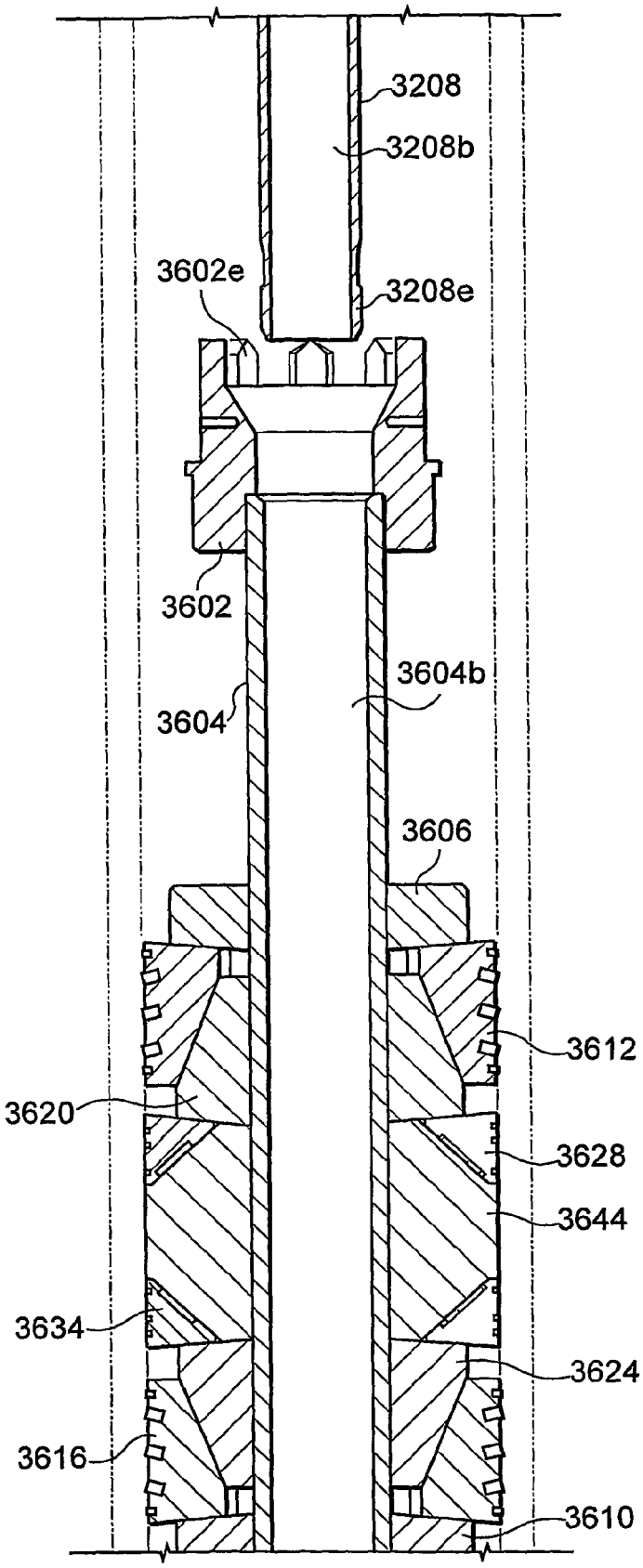
*Fig. 20F4*

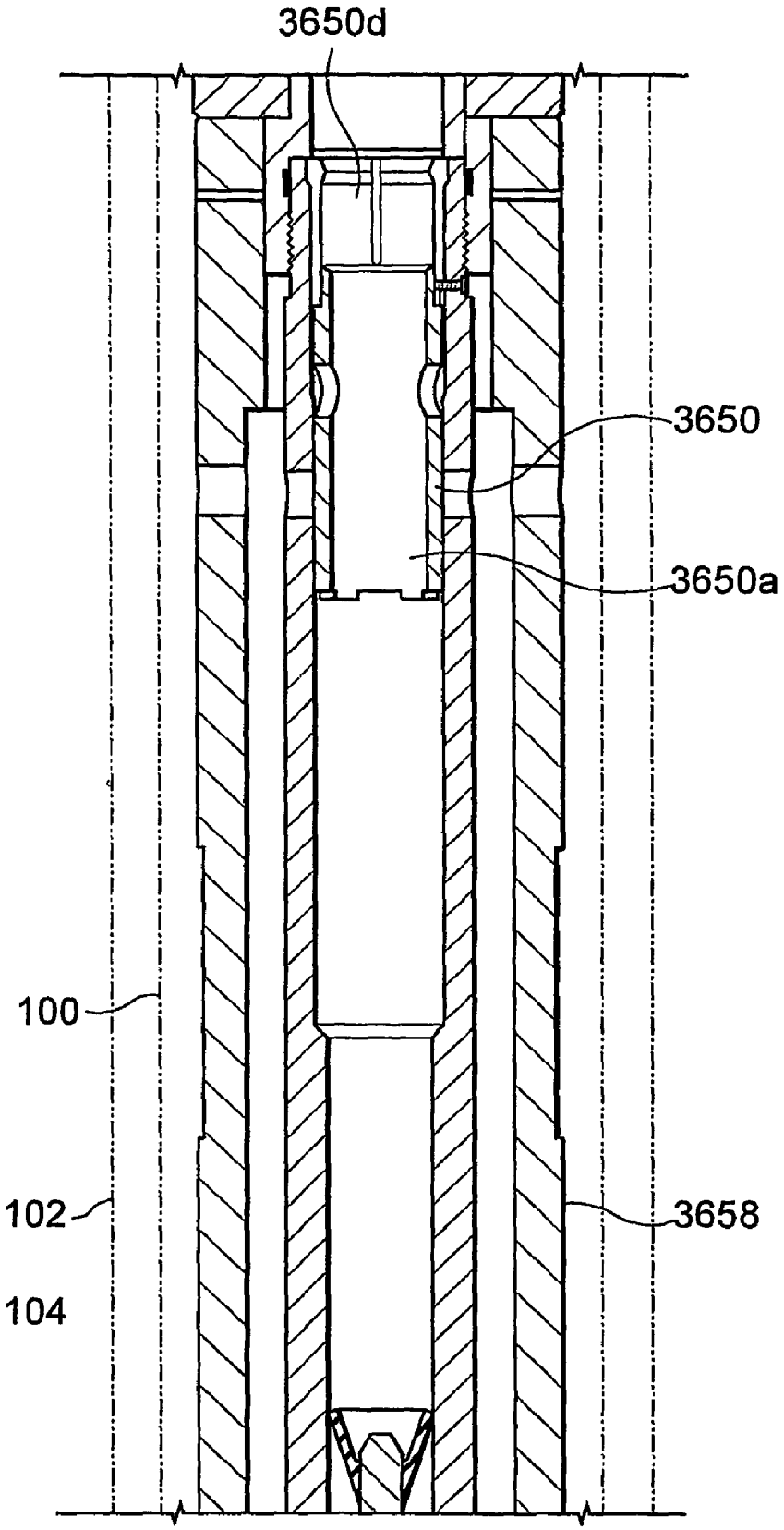
*Fig. 20F5*

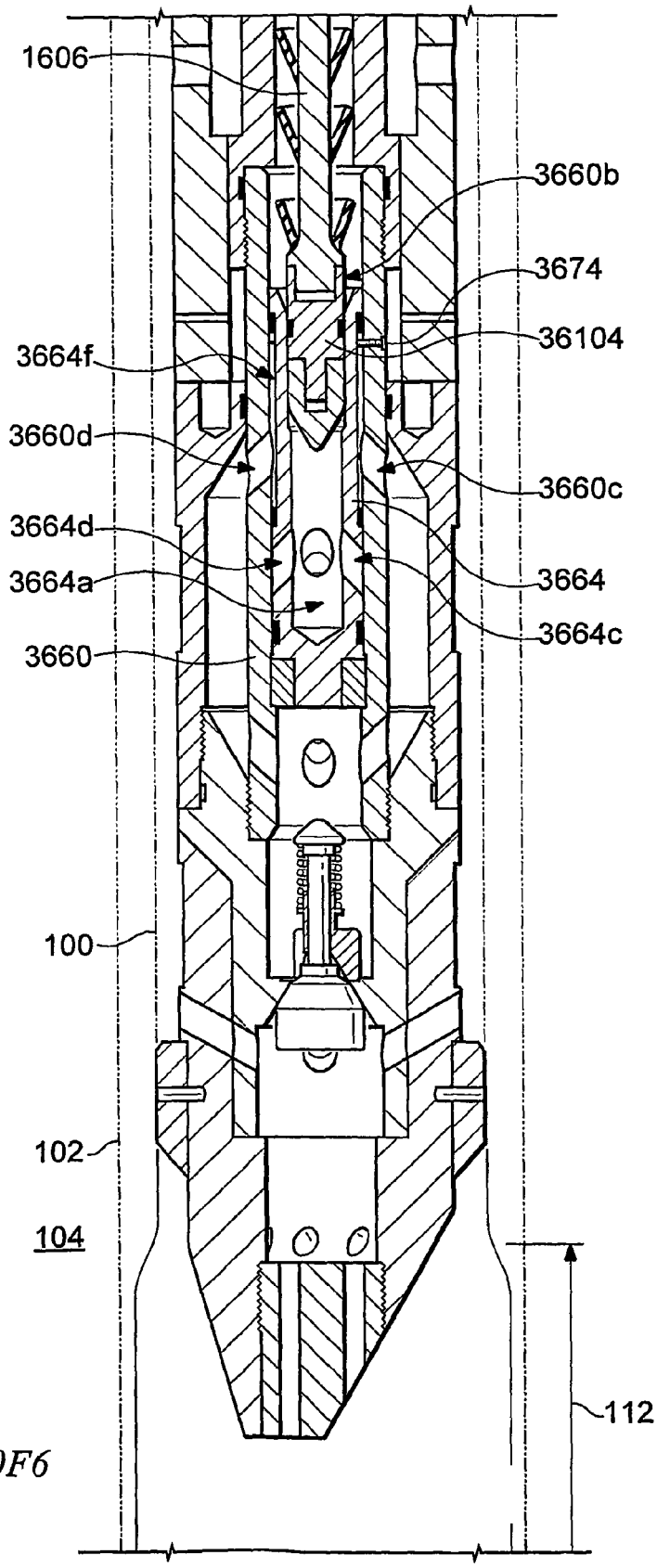
*Fig. 20F6*

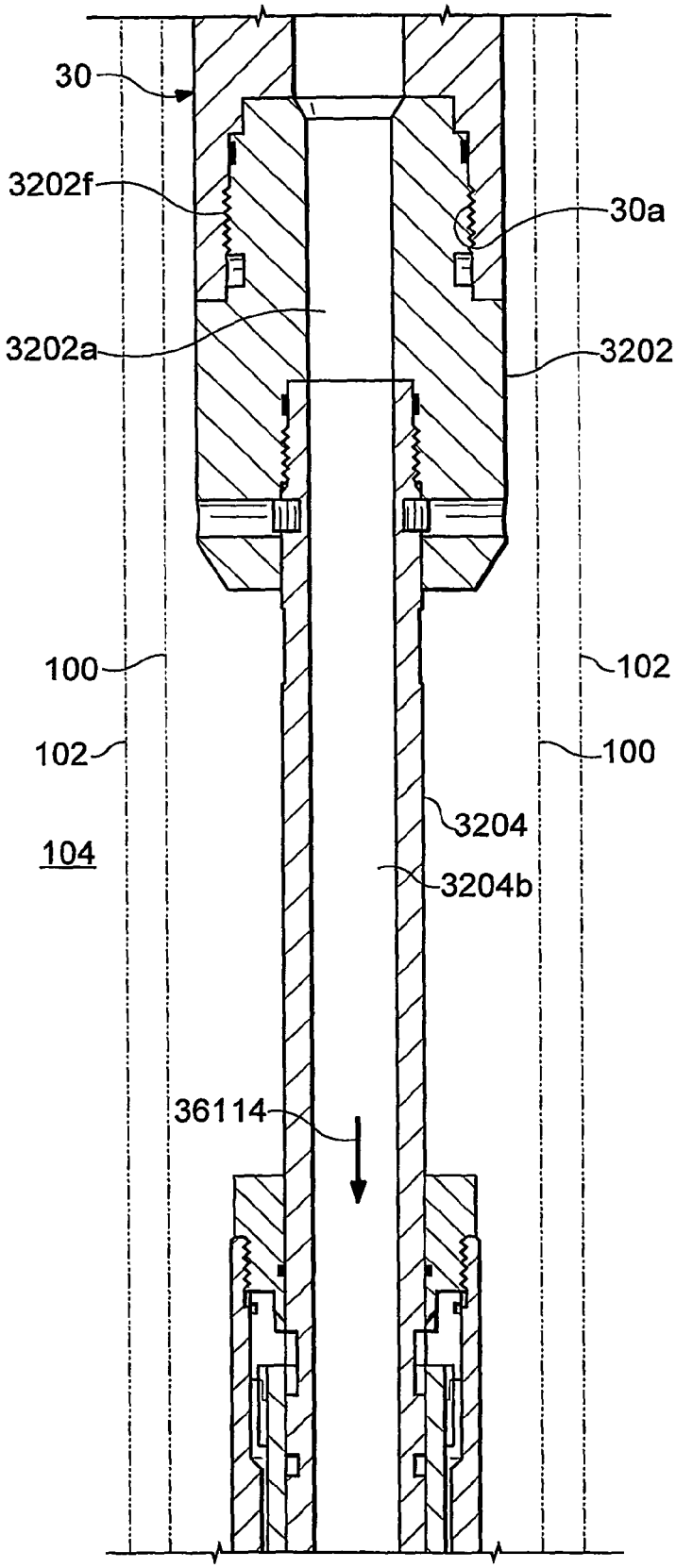
*Fig. 20G1*

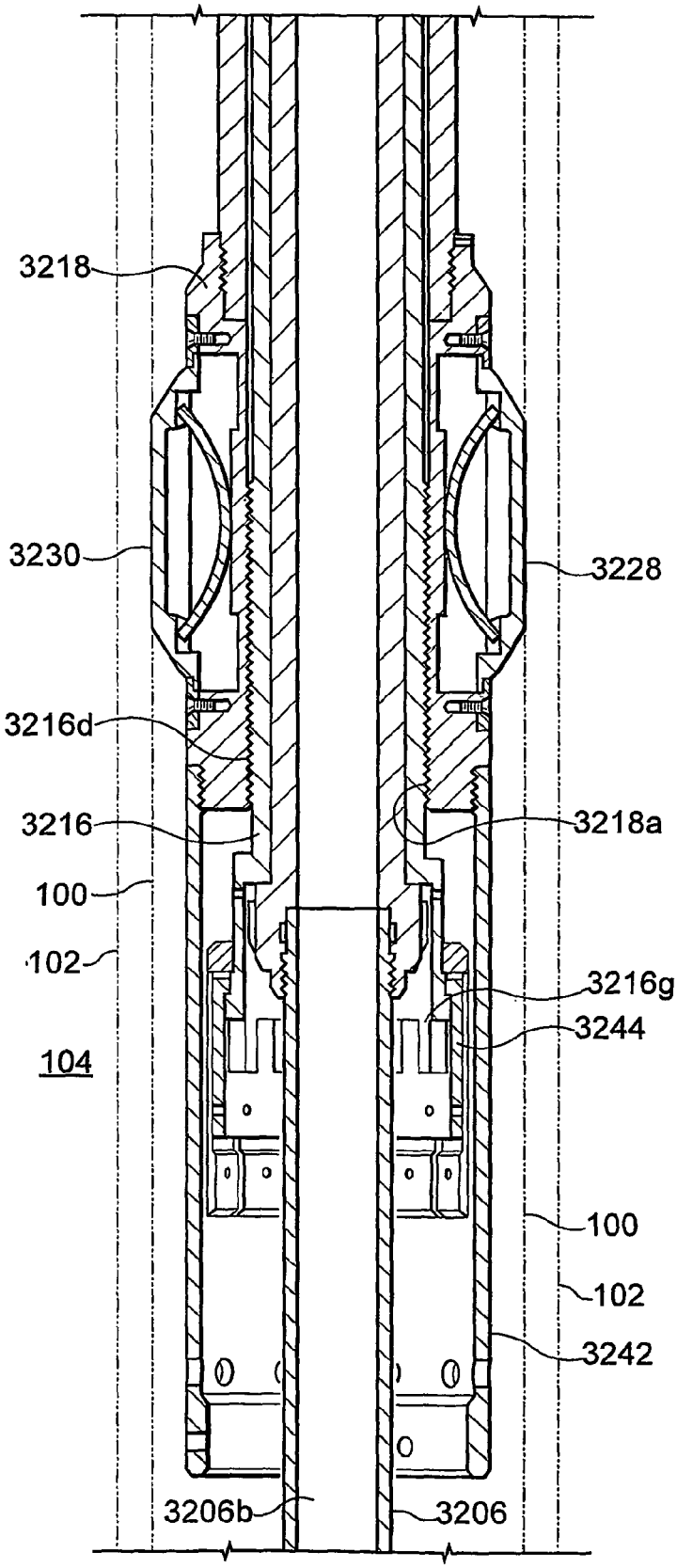
*Fig. 20G2*

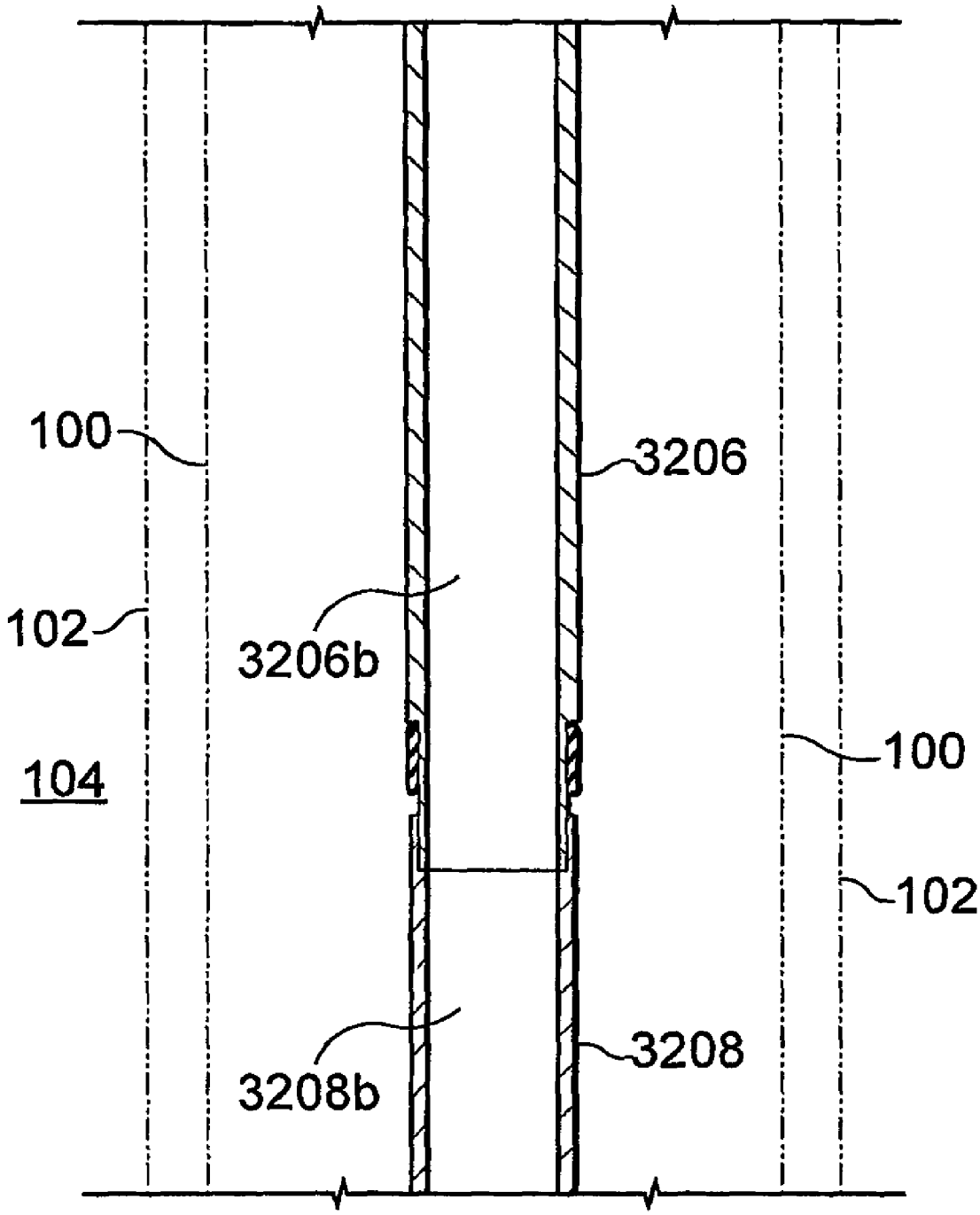
*Fig. 20G3*

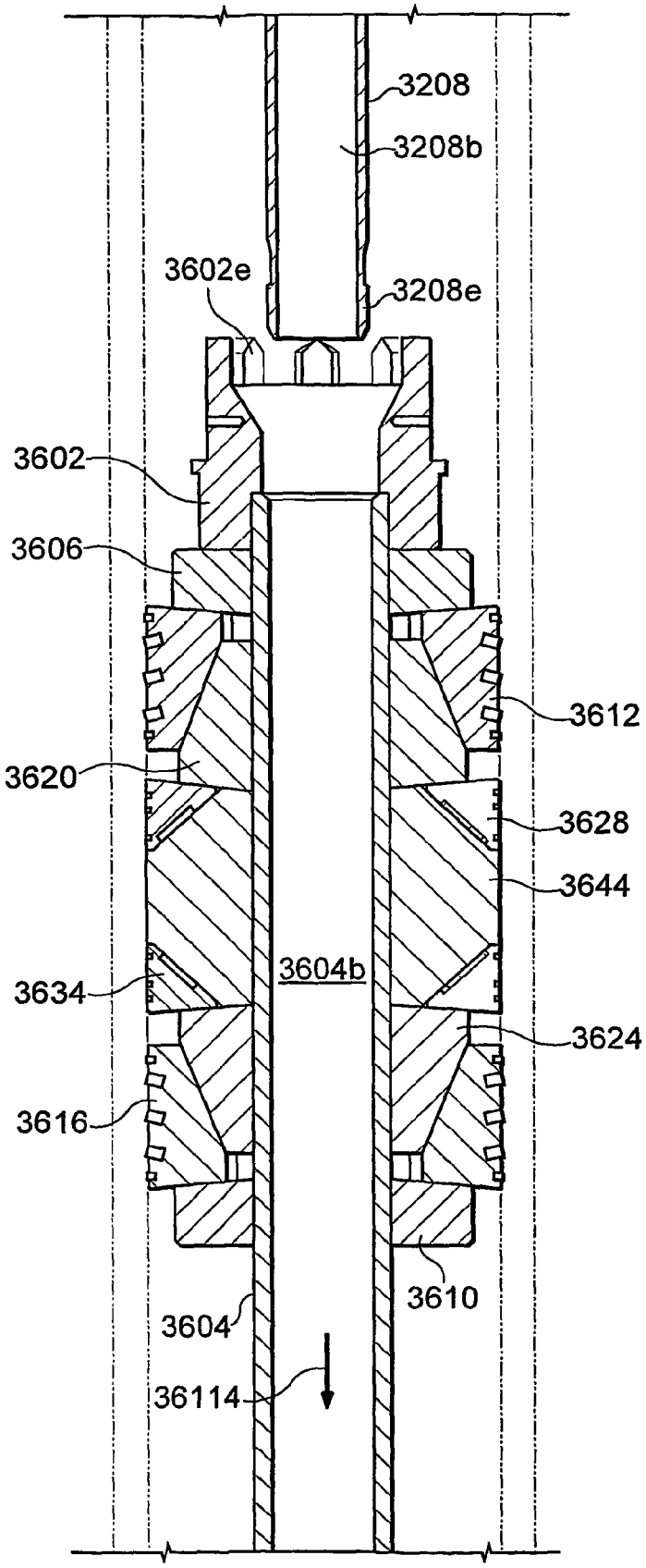
*Fig. 20G4*

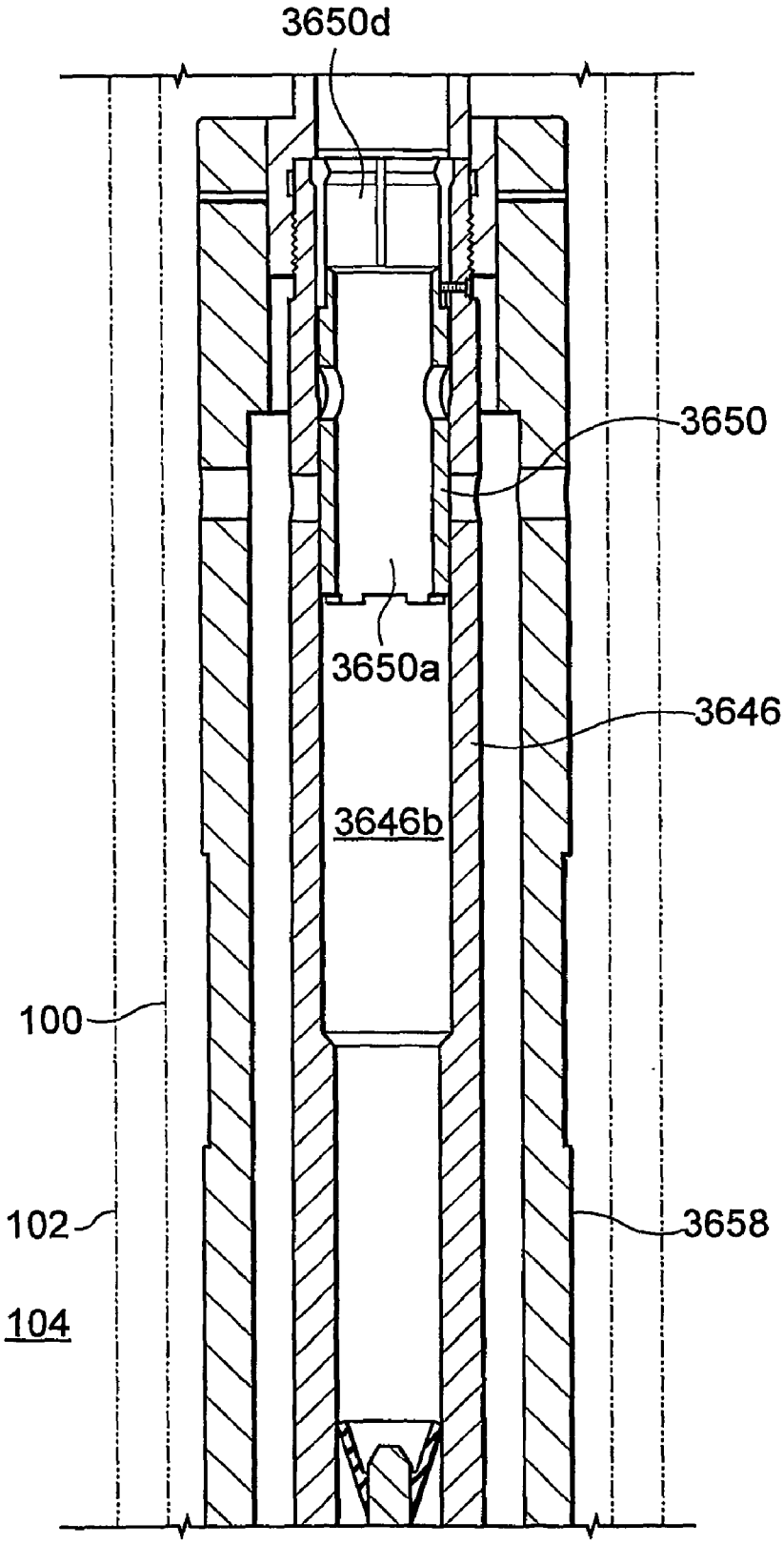
*Fig. 20G5*

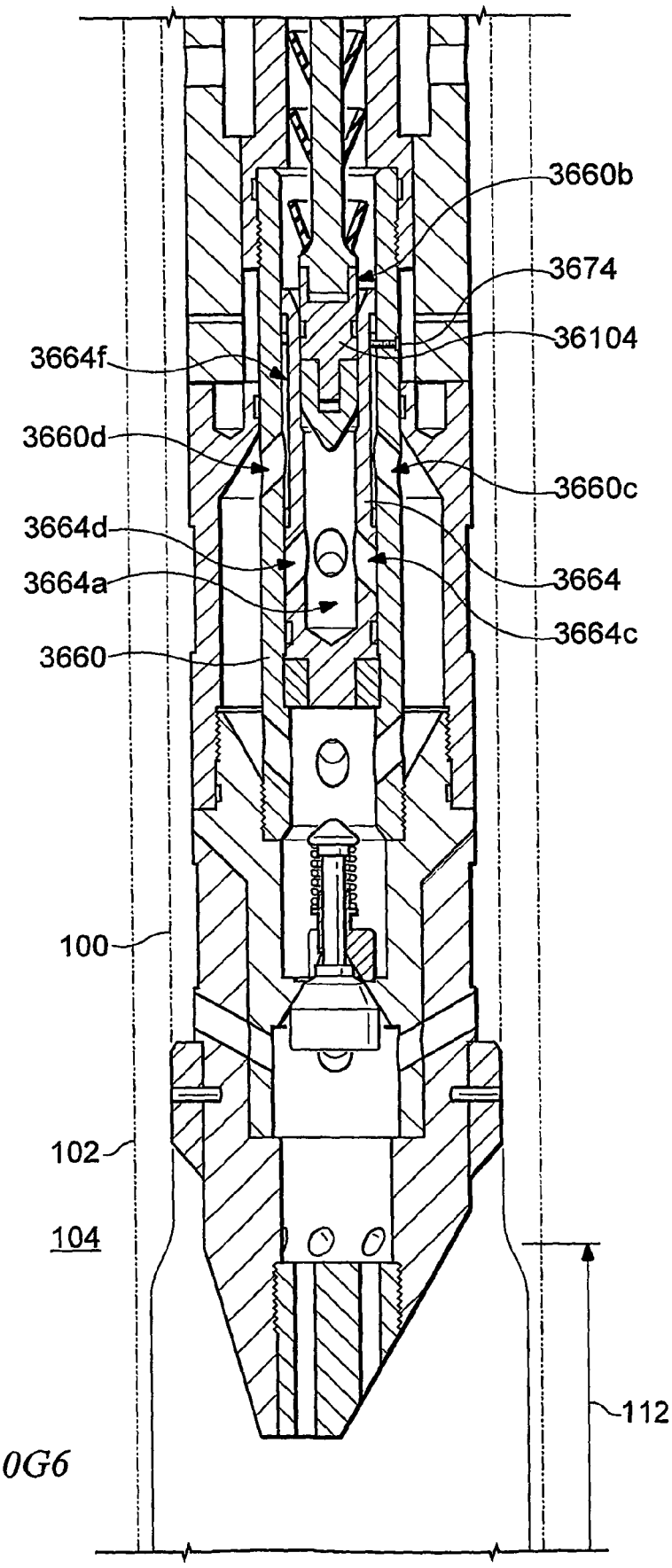
*Fig. 20G6*

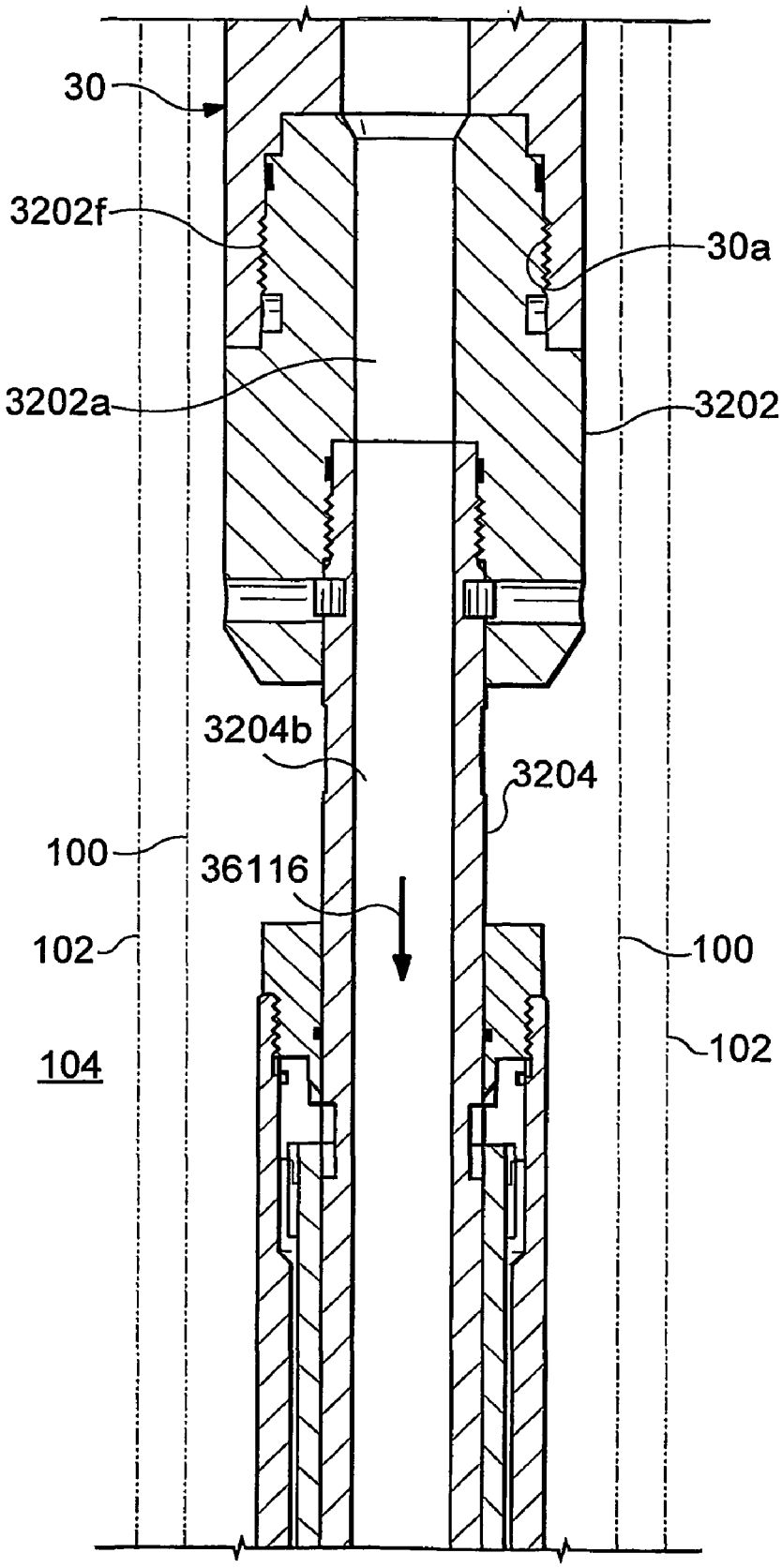
*Fig. 20H1*

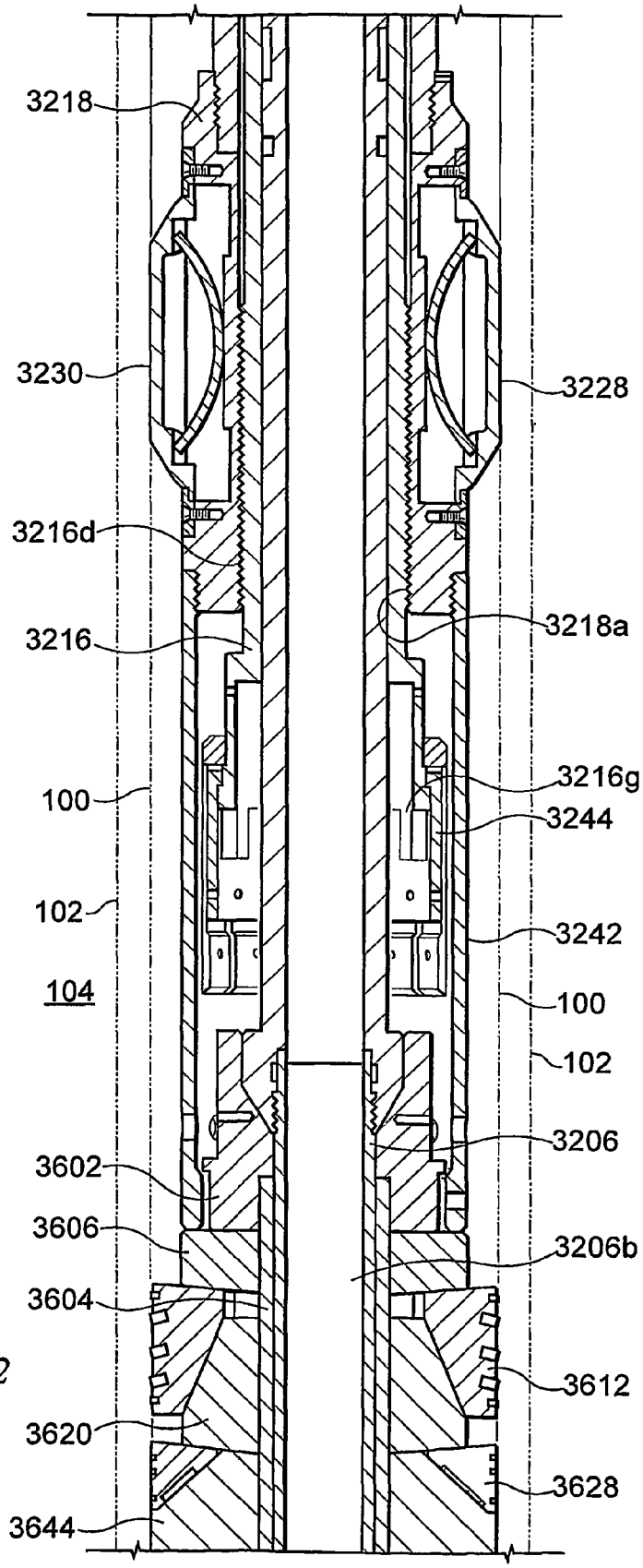
*Fig. 20H2*

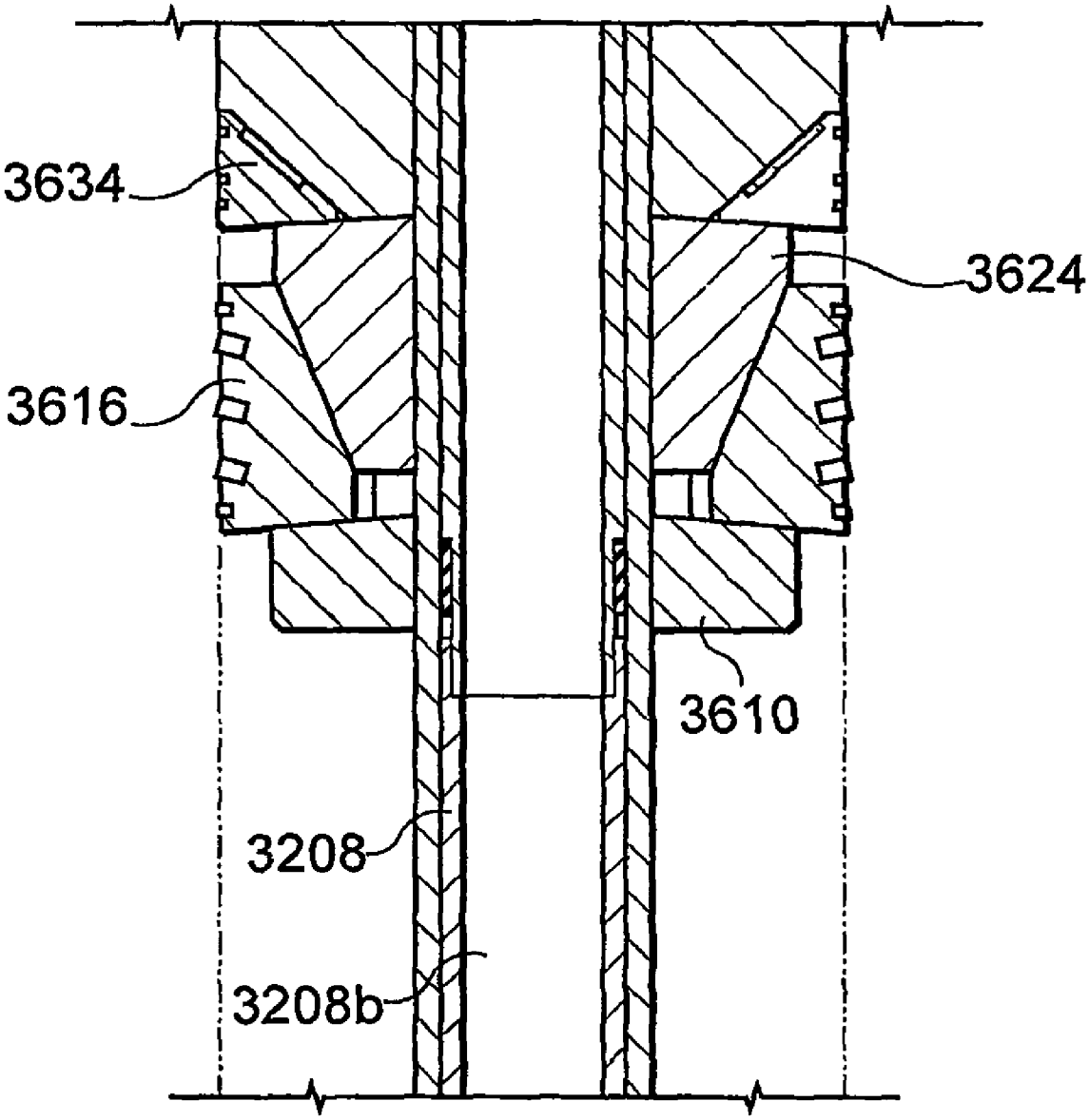
*Fig. 20H3*

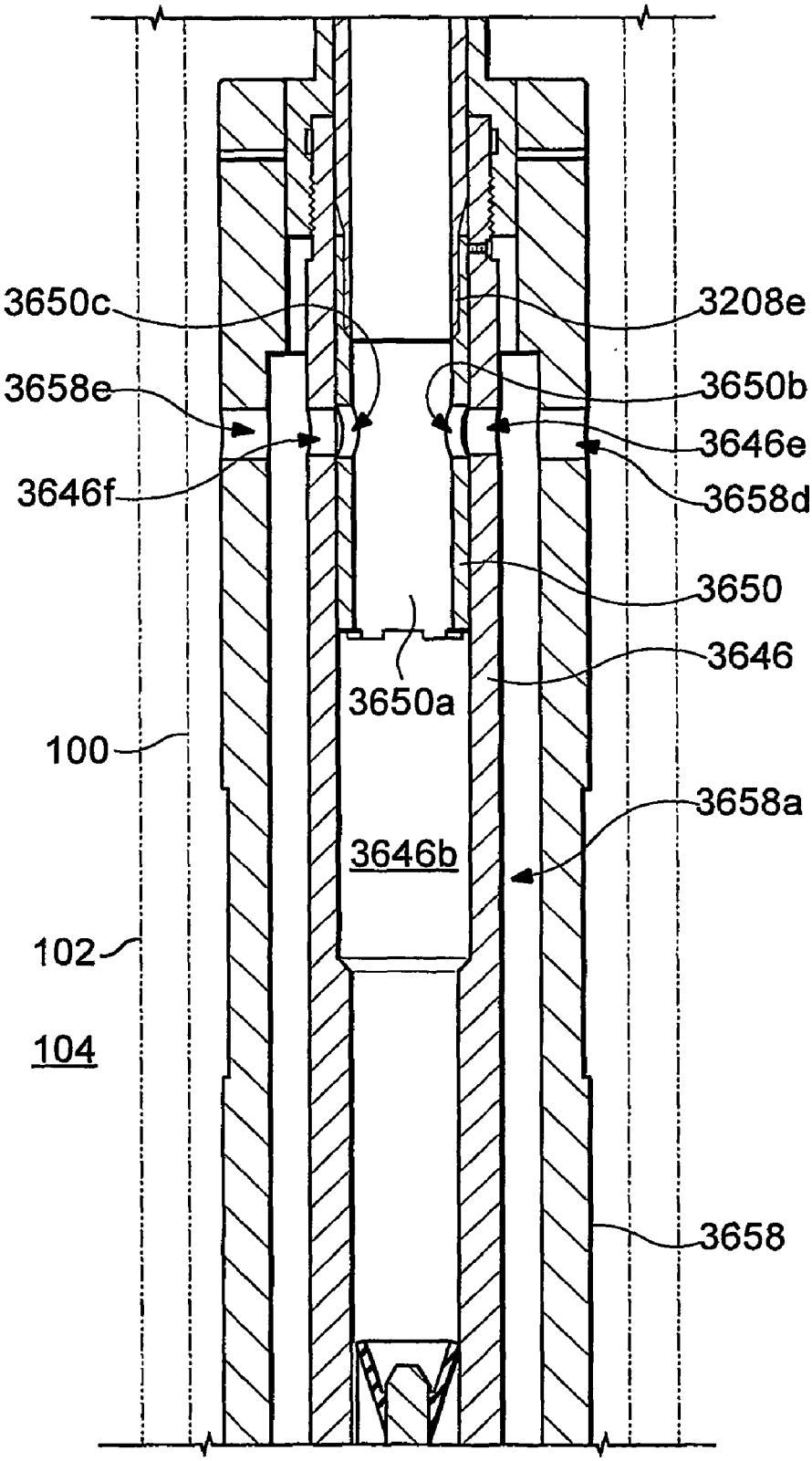
*Fig. 20H4*

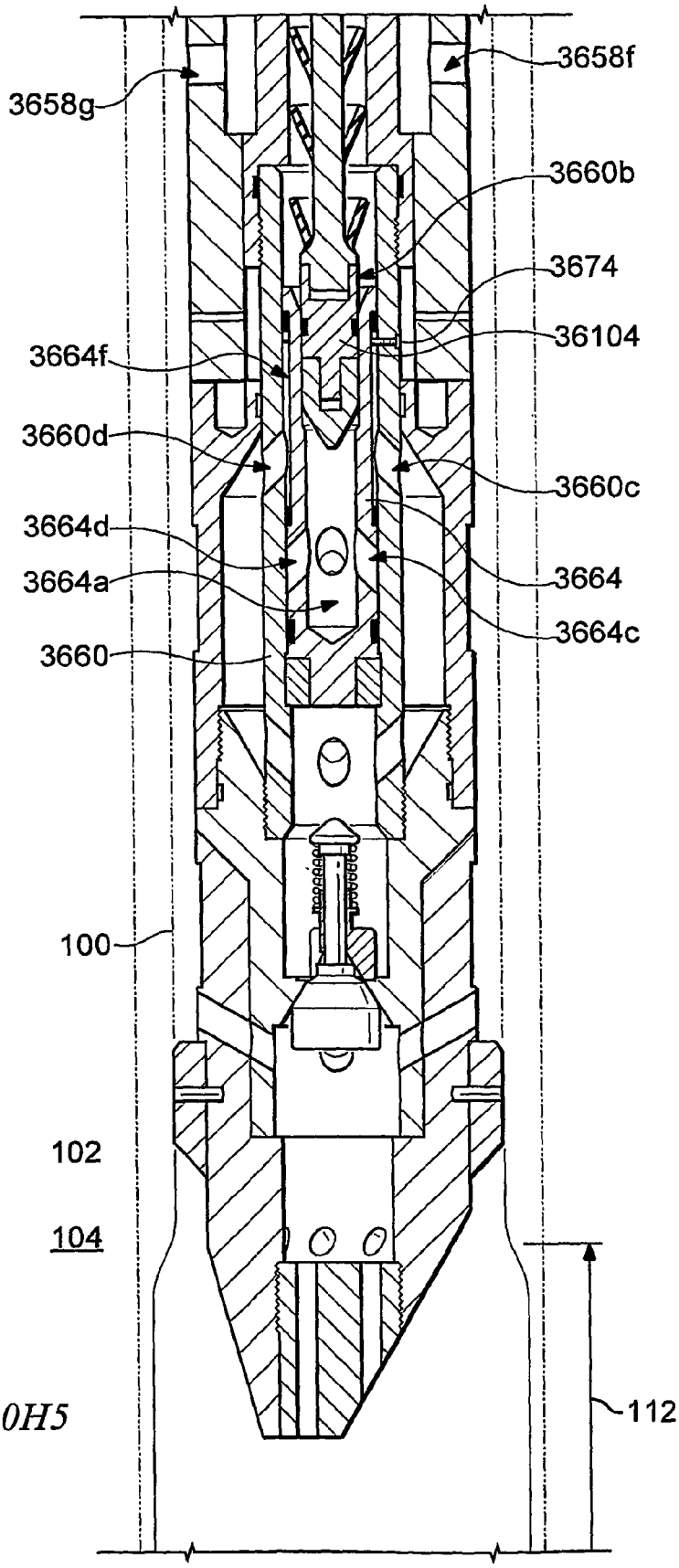
*Fig. 20H5*

APPARATUS FOR RADIALLY EXPANDING AND PLASTICALLY DEFORMING A TUBULAR MEMBER

CROSS REFERENCE TO RELATED APPLICATIONS

The present application claims the benefit of the filing date of U.S. provisional patent application Ser. No. 60/463,586, filed on Apr. 17, 2003, the disclosure of which is incorporated herein by reference.

The present application is a continuation-in-part of the following: (1) PCT patent application serial number PCT/US02/36157, filed on Nov. 12, 2002, (2) PCT patent application serial number PCT/US02/36267, filed on Nov. 12, 2002, (3) PCT patent application serial number PCT/US03/04837, filed on Feb. 29, 2003, (4) PCT patent application serial number PCT/US03/29859, filed on Sep. 22, 2003, (5) PCT patent application serial number PCT/US03/14153, filed on Nov. 13, 2003, (6) PCT patent application serial number PCT/US03/18530, filed on Jun. 11, 2003, (7) PCT patent application serial number PCT/US03/29858, PCT patent application serial number PCT/US03/29460, filed on Sep. 23, 2003, filed on Sep. 22, 2003, (9) PCT patent application serial number PCT/US04/07711, filed on Mar. 11, 2004, (10) PCT patent application serial number PCT/US04/09434, filed on Mar. 26, 2004, (11) PCT patent application serial number PCT/US04/10317, filed on Apr. 2, 2004, (12) PCT patent application serial number PCT/US04/10712, filed on Apr. 7, 2004, and (13) PCT patent application serial number PCT/US04/10762, filed on Apr. 6, 2004, the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No.10/, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on 1217198, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 17, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, (122) PCT patent application serial no. PCT/US04/

06246, filed on 2/26/2004, (123) PCT patent application serial number PCT/US04/08170, filed on Mar. 15, 2004, (124) PCT patent application serial number PCT/US04/08171, filed on Mar. 15, 2004, (125) PCT patent application serial number PCT/US04/08073, filed on Mar. 18, 2004, (126) PCT patent application serial number PCT/US04/07711, filed on Mar. 11, 2004, (127) PCT patent application serial number PCT/US04/09434, filed on Mar. 26, 2004, (128) PCT patent application serial number PCT/US04/10317, filed on Apr. 2, 2004, (129) PCT patent application serial number PCT/US04/10712, filed on 04/06/2004, and (130) PCT patent application serial number PCT/US04/10762, filed on 04/06/2004, the disclosures of which are incorporated herein by reference.

BACKGROUND OF THE INVENTION

This invention relates generally to oil and gas exploration, and in particular to forming and repairing wellbore casings to facilitate oil and gas exploration.

SUMMARY OF THE INVENTION

According to one aspect of the present invention, an apparatus for radially expanding and plastically deforming an expandable tubular member is provided that includes a support member, a cutting device for cutting the tubular member coupled to the support member, and an expansion device for radially expanding and plastically deforming the tubular member coupled to the support member.

According to another aspect of the present invention, an apparatus for radially expanding and plastically deforming an expandable tubular member is provided that includes a support member, an expansion device for radially expanding and plastically deforming the tubular member coupled to the support member, and an actuator coupled to the support member for displacing the expansion device relative to the support member.

According to another aspect of the present invention, an apparatus for radially expanding and plastically deforming an expandable tubular member is provided that includes a support member; an expansion device for radially expanding and plastically deforming the tubular member coupled to the support member; and a sealing assembly for sealing an annulus defined between the support member and the tubular member.

According to another aspect of the present invention, an apparatus for radially expanding and plastically deforming an expandable tubular member is provided that includes a support member; a first expansion device for radially expanding and plastically deforming the tubular member coupled to the support member; and a second expansion device for radially expanding and plastically deforming the tubular member coupled to the support member.

According to another aspect of the present invention, an apparatus for radially expanding and plastically deforming an expandable tubular member is provided that includes a support member; an expansion device for radially expanding and plastically deforming the tubular member coupled to the support member; and a packer coupled to the support member.

According to another aspect of the present invention, an apparatus for radially expanding and plastically deforming an expandable tubular member is provided that includes a support member; a cutting device for cutting the tubular member coupled to the support member; a gripping device for gripping the tubular member coupled to the support member; a sealing device for sealing an interface with the tubular member coupled to the support member; a locking device for locking the position of the tubular member relative to the support member; a first adjustable expansion device for radially expanding and plastically deforming the tubular member coupled to the support member; a second adjustable expansion device for radially expanding and plastically deforming the tubular member coupled to the support member; a packer coupled to the support member; and an actuator for displacing one or more of the sealing assembly, first and second adjustable expansion devices, and packer relative to the support member.

According to another aspect of the present invention, an apparatus for cutting a tubular member is provided that includes a support member; and a plurality of movable cutting elements coupled to the support member.

According to another aspect of the present invention, an apparatus for engaging a tubular member is provided that includes a support member; and a plurality of movable elements coupled to the support member.

According to another aspect of the present invention, an apparatus for gripping a tubular member is provided that includes a plurality of movable gripping elements.

According to another aspect of the present invention, an actuator is provided that includes a tubular housing; a tubular piston rod movably coupled to and at least partially positioned within the housing; a plurality of annular piston chambers defined by the tubular housing and the tubular piston rod; and a plurality of tubular pistons coupled to the tubular piston rod, each tubular piston movably positioned within a corresponding annular piston chamber.

According to another aspect of the present invention, an apparatus for controlling a packer is provided that includes a tubular support member; one or more drag blocks releasably coupled to the tubular support member; and a tubular stinger coupled to the tubular support member for engaging the packer.

According to another aspect of the present invention, a packer is provided that includes a support member defining a passage; a shoe comprising a float valve coupled to an end of the support member; one or more compressible packer elements movably coupled to the support member; and a sliding sleeve valve movably positioned within the passage of the support member.

According to another aspect of the present invention, a method of radially expanding and plastically deforming an expandable tubular member within a borehole having a pre-existing wellbore casing is provided that includes positioning the tubular member within the borehole in overlapping relation to the wellbore casing; radially expanding and plastically deforming a portion of the tubular member to form a bell section; and radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section.

According to another aspect of the present invention, a method for forming a mono diameter wellbore casing is provided that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; positioning the adjustable expansion device within a second expandable tubular member; supporting the second expandable tubular member and the adjustable expansion device within the borehole in overlapping relation to the first expandable tubular member; lowering the adjustable expansion device out of the second expandable tubular member; increasing the outside dimension of the adjustable expansion device; and displacing the adjustable expansion device upwardly relative to the second expandable tubular member n times to radially expand and plastically deform n portions of the second expandable tubular member within the borehole.

According to another aspect of the present invention, a method for radially expanding and plastically deforming an expandable tubular member within a borehole is provided that includes positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device; displacing the adjustable expansion mandrel upwardly relative to the expandable tubular member n times to radially expand and plastically deform n portions of the expandable tubular member within the borehole; and pressurizing an interior region of the expandable tubular member above the adjustable expansion device during the radial expansion and plastic deformation of the expandable tubular member within the borehole.

According to another aspect of the present invention, a method for forming a mono diameter wellbore casing is provided that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; pressurizing an interior region of the first expandable tubular member above the adjustable expansion device during the radial expansion and plastic deformation of the first expandable tubular member within the borehole; positioning the adjustable expansion mandrel within a second expandable tubular member; supporting the second expandable tubular member and the adjustable expansion mandrel within the borehole in overlapping relation to the first expandable tubular member; lowering the adjustable expansion mandrel out of the second expandable tubular member; increasing the outside dimension of the adjustable expansion mandrel; displacing the adjustable expansion mandrel upwardly relative to the second expandable tubular member n times to radially expand and plastically deform n portions of the second expandable tubular member within the borehole; and pressurizing an interior region of the second expandable tubular member above the adjustable expansion mandrel during the radial expansion and plastic deformation of the second expandable tubular member within the borehole.

According to another aspect of the present invention, a method for radially expanding and plastically deforming an expandable tubular member within a borehole is provided that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

According to another aspect of the present invention, a method for forming a mono diameter wellbore casing is provided that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; displacing the first adjustable expansion device and the second adjustable expansion device downwardly relative to the second expandable tubular member; decreasing the outside dimension of the first adjustable expansion device and increasing the outside dimension of the second adjustable expansion device; and displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

According to another aspect of the present invention, a method for radially expanding and plastically deforming an expandable tubular member within a borehole is provided that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; pressurizing an interior region of the expandable tubular member above the first adjustable expansion device during the radial expansion of the lower portion of the expandable tubular member by the first adjustable expansion device; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; and pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

According to another aspect of the present invention, a method for forming a mono diameter wellbore casing is provided that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; pressurizing an interior region of the first expandable tubular member above the first adjustable expansion device during the radial expansion of the lower portion of the first expandable tubular member by the first adjustable expansion device; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; pressurizing an interior region of the first expandable tubular member above the second adjustable expansion device during the radial expansion of the portions of the first expandable tubular member above the lower portion of the first expandable tubular member by the second adjustable expansion device; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; pressurizing an interior region of the second expandable tubular member above the first adjustable expansion device during the radial expansion of the lower portion of the second expandable tubular member by the first adjustable expansion device; displacing the first adjustable expansion device and the second adjustable expansion device downwardly relative to the second expandable tubular member; decreasing the outside dimension of the first adjustable expansion device and increasing the outside dimension of the second adjustable expansion device; displacing the second adjustable expansion device upwardly relative to the second expandable tubular member to radially expand and plastically deform portions of the second expandable tubular member above the lower portion of the second expandable tubular member; and pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

According to another aspect of the present invention, a method for radially expanding and plastically deforming an expandable tubular member within a borehole is provided that includes supporting the expandable tubular member, an hydraulic actuator, and an adjustable expansion device within the borehole; increasing the size of the adjustable expansion device; and displacing the adjustable expansion device upwardly relative to the expandable tubular member using the hydraulic actuator to radially expand and plastically deform a portion of the expandable tubular member.

According to another aspect of the present invention, a method for forming a mono diameter wellbore casing within a borehole that includes a preexisting wellbore casing is provided that includes supporting the expandable tubular member, an hydraulic actuator, and an adjustable expansion device within the borehole; increasing the size of the adjustable expansion device; displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member.

According to another aspect of the present invention, a method of radially expanding and plastically deforming a tubular member is provided that includes positioning the tubular member within a preexisting structure; radially expanding and plastically deforming a lower portion of the tubular member to form a bell section; and radially expanding and plastically deforming a portion of the tubular member above the bell section.

According to another aspect of the present invention, a method of radially expanding and plastically deforming a tubular member is provided that includes applying internal pressure to the inside surface of the tubular member at a plurality of discrete location separated from one another.

According to another aspect of the present invention, a system for radially expanding and plastically deforming an expandable tubular member within a borehole having a pre-existing wellbore casing is provided that includes means for positioning the tubular member within the borehole in overlapping relation to the wellbore casing; means for radially expanding and plastically deforming a portion of the tubular member to form a bell section; and means for radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section.

According to another aspect of the present invention, a system for forming a mono diameter wellbore casing is provided that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for positioning the adjustable expansion device within a second expandable tubular member; means for supporting the second expandable tubular member and the adjustable expansion device within the borehole in overlapping relation to the first expandable tubular member; means for lowering the adjustable expansion device out of the second expandable tubular member; means for increasing the outside dimension of the adjustable expansion device; and means for displacing the adjustable expansion device upwardly relative to the second expandable tubular member n times to radially expand and plastically deform n portions of the second expandable tubular member within the borehole.

According to another aspect of the present invention, a system for radially expanding and plastically deforming an expandable tubular member within a borehole is provided that includes means for positioning an adjustable expansion device within the expandable tubular member; means for supporting the expandable tubular member and the adjustable expansion device within the borehole; means for lowering the adjustable expansion device out of the expandable tubular member; means for increasing the outside dimension of the adjustable expansion device; means for displacing the adjustable expansion mandrel upwardly relative to the expandable tubular member n times to radially expand and plastically deform n portions of the expandable tubular member within the borehole; and means for pressurizing an interior region of the expandable tubular member above the adjustable expansion device during the radial expansion and plastic deformation of the expandable tubular member within the borehole.

According to another aspect of the present invention, a system for forming a mono diameter wellbore casing is provided that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for pressurizing an interior region of the first expandable tubular member above the adjustable expansion device during the radial expansion and plastic deformation of the first expandable tubular member within the borehole; means for positioning the adjustable expansion mandrel within a second expandable tubular member; means for supporting the second expandable tubular member and the adjustable expansion mandrel within the borehole in overlapping relation to the first expandable tubular member; means for lowering the adjustable expansion mandrel out of the second expandable tubular member; means for increasing the outside dimension of the adjustable expansion mandrel; means for displacing the adjustable expansion mandrel upwardly relative to the second expandable tubular member n times to radially expand and plastically deform n portions of the second expandable tubular member within the borehole; and means for pressurizing an interior region of the second expandable tubular member above the adjustable expansion mandrel during the radial expansion and plastic deformation of the second expandable tubular member within the borehole.

According to another aspect of the present invention, a system for radially expanding and plastically deforming an expandable tubular member within a borehole is provided that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

According to another aspect of the present invention, a system for forming a mono diameter wellbore casing is provided that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; displacing the first adjustable expansion device upwardly relative to the first expandable tubular member to radially expand and plastically deform a lower portion of the first expandable tubular member; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the adjustable expansion device upwardly relative to the second expandable tubular member to radially expand and plastically deform a lower portion of the second expandable tubular member; means for displacing the first adjustable expansion device and the second adjustable expansion device downwardly relative to the second expandable tubular member; means for decreasing the outside dimension of the first adjustable expansion device and increasing the outside dimension of the second adjustable expansion device; and means for displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

According to another aspect of the present invention, a system for radially expanding and plastically deforming an expandable tubular member within a borehole is provided that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for pressurizing an interior region of the expandable tubular member above the first adjustable expansion device during the radial expansion of the lower portion of the expandable tubular member by the first adjustable expansion device; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; and means for pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

According to another aspect of the present invention, a system for forming a mono diameter wellbore casing is provided that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; means for displacing the first adjustable expansion device upwardly relative to the first expandable tubular member to radially expand and plastically deform a lower portion of the first expandable tubular member; means for pressurizing an interior region of the first expandable tubular member above the first adjustable expansion device during the radial expansion of the lower portion of the first expandable tubular member by the first adjustable expansion device; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for pressurizing an interior region of the first expandable tubular member above the second adjustable expansion device during the radial expansion of the portions of the first expandable tubular member above the lower portion of the first expandable tubular member by the second adjustable expansion device; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the first adjustable expansion device upwardly relative to the second expandable tubular member to radially expand and plastically deform a lower portion of the second expandable tubular member; means for pressurizing an interior region of the second expandable tubular member above the first adjustable expansion device during the radial expansion of the lower portion of the second expandable tubular member by the first adjustable expansion device; means for displacing the first adjustable expansion device and the second adjustable expansion device downwardly relative to the second expandable tubular member; means for decreasing the outside dimension of the first adjustable expansion device and increasing the outside dimension of the second adjustable expansion device; means for displacing the second adjustable expansion device upwardly relative to the second expandable tubular member to radially expand and plastically deform portions of the second expandable tubular member above the lower portion of the second expandable tubular member; and means for pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

According to another aspect of the present invention, a system for radially expanding and plastically deforming an expandable tubular member within a borehole is provided that includes means for supporting the expandable tubular member, an hydraulic actuator, and an adjustable expansion device within the borehole; means for increasing the size of the adjustable expansion device; and means for displacing the adjustable expansion device upwardly relative to the expandable tubular member using the hydraulic actuator to radially expand and plastically deform a portion of the expandable tubular member.

According to another aspect of the present invention, a system for forming a mono diameter wellbore casing within a borehole that includes a preexisting wellbore casing is provided that includes means for supporting the expandable tubular member, an hydraulic actuator, and an adjustable expansion device within the borehole; means for increasing the size of the adjustable expansion device; means for displacing the adjustable expansion device upwardly relative to the expandable tubular member using the hydraulic actuator to radially expand and plastically deform a portion of the expandable tubular member; and means for displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member.

According to another aspect of the present invention, a system for radially expanding and plastically deforming a tubular member is provided that includes means for positioning the tubular member within a preexisting structure; means for radially expanding and plastically deforming a lower portion of the tubular member to form a bell section; and means for radially expanding and plastically deforming a portion of the tubular member above the bell section.

According to another aspect of the present invention, a system of radially expanding and plastically deforming a tubular member is provided that includes a support member; and means for applying internal pressure to the inside surface of the tubular member at a plurality of discrete location separated from one another coupled to the support member.

According to another aspect of the present invention, a method of cutting a tubular member is provided that includes positioning a plurality of cutting elements within the tubular member; and bringing the cutting elements into engagement with the tubular member.

According to another aspect of the present invention, a method of gripping a tubular member is provided that includes positioning a plurality of gripping elements within the tubular member; bringing the gripping elements into engagement with the tubular member. In an exemplary embodiment, bringing the gripping elements into engagement with the tubular member includes displacing the gripping elements in an axial direction; and displacing the gripping elements in a radial direction.

According to another aspect of the present invention, a method of operating an actuator is provided that includes pressurizing a plurality of pressure chamber.

According to another aspect of the present invention, a method of injecting a hardenable fluidic sealing material into an annulus between a tubular member and a preexisting structure is provided that includes positioning the tubular member into the preexisting structure; sealing off an end of the tubular member; operating a valve within the end of the tubular member; and injecting a hardenable fluidic sealing material through the valve into the annulus between the tubular member and the preexisting structure.

According to another aspect of the present invention, a system for cutting a tubular member is provided that includes means for positioning a plurality of cutting elements within the tubular member; and means for bringing the cutting elements into engagement with the tubular member.

According to another aspect of the present invention, a system for gripping a tubular member is provided that includes means for positioning a plurality of gripping elements within the tubular member; and means for bringing the gripping elements into engagement with the tubular member.

According to another aspect of the present invention, an actuator system is provided that includes a support member; and means for pressurizing a plurality of pressure chambers coupled to the support member. In an exemplary embodiment, the system further includes means for transmitting torsional loads.

According to another aspect of the present invention, a system for injecting a hardenable fluidic sealing material into an annulus between a tubular member and a preexisting structure is provided that includes means for positioning the tubular member into the preexisting structure; means for sealing off an end of the tubular member; means for operating a valve within the end of the tubular member; and means for injecting a hardenable fluidic sealing material through the valve into the annulus between the tubular member and the preexisting structure.

According to another aspect of the present invention, a method of engaging a tubular member is provided that includes positioning a plurality of elements within the tubular member; and bringing the elements into engagement with the tubular member.

According to another aspect of the present invention, a system for engaging a tubular member is provided that includes means for positioning a plurality of elements within the tubular member; and means for bringing the elements into engagement with the tubular member. In an exemplary embodiment, the elements include a first group of elements; and a second group of elements; wherein the first group of elements are interleaved with the second group of elements.

According to another aspect of the present invention, a locking device for locking a tubular member to a support member is provided that includes a plurality of circumferentially spaced apart locking elements coupled to the support member for engaging an interior surface of the tubular member; a plurality of spring elements coupled to the support member for biasing corresponding locking elements out of engagement with the interior surface of the tubular member; a releasable retaining element releasably coupled to the support member for releasably retaining the locking elements in engagement with the interior surface of the tubular member; an actuator coupled to the support member for controllably displacing the retaining element relative to the locking elements; and a sensor coupled to the support member for sensing an operating condition within the tubular member for controllably displacing the retaining element relative to the locking elements.

According to another aspect of the present invention, a method of locking a tubular member to a support member is provided that includes engaging the interior surface of the tubular member at a plurality of circumferentially spaced apart locations using one or more engagement members; and disengaging the engagement members from the interior surface of the tubular member if an operating condition within the tubular member exceeds a predetermined amount; wherein the engagement members are biased out of engagement with the tubular member.

According to another aspect of the present invention, a system for locking a tubular member to a support member is provided that includes means for engaging the interior surface of the tubular member at a plurality of circumferentially spaced apart locations using one or more engagement members; and means for disengaging the engagement members from the interior surface of the tubular member if an operating condition within the tubular member exceeds a predetermined amount; wherein the engagement members are biased out of engagement with the tubular member.

BRIEF DESCRIPTION OF THE DRAWINGS

FIGS. 11-1 and 11-2, 11A1 to 11A2, 11B1 to 11B2, 11C, 11D, 11E, 11F, 11G, 11H, 11I, **11*j*, 11K, 11L, 11M, 11N, 11O, 11P, 11Q, 11R, 11S, 11T, 11U, 11V, 11W, 11X, 11Y, 11Z1 to 11Z4, 11AA1 to 11AA4, 11AB1 to 11AB4, 11AC1 to 11AC4, 11AD, and 11AE** are fragmentary cross-sectional and perspective illustrations of an exemplary embodiment of a casing cutter assembly.

FIGS. 12A1 to 12A4 and 12C1 to 12C4 are fragmentary cross-sectional illustrations of an exemplary embodiment of a ball gripper assembly.

FIG. 12B is a top view of a portion of the ball gripper assembly of FIGS. 12A1 to 12A4 and 12C1 to 12C4.

FIGS. 13A1 to 13A8 and 13B1 to 13B7 are fragmentary cross-sectional illustrations of an exemplary embodiment of a tension actuator assembly.

FIGS. 14A, 14B and 14C are fragmentary cross-sectional and perspective illustrations of an exemplary embodiment of a cup seal assembly.

FIGS. 15-1, 15-2, 15A1, 15A2, 15B1, 15B2, 15C1, 15C2, 15D, 15E1 to 15E5, 15F1 to 15F5, and 15G1 to 15G5 are fragmentary cross sectional illustrations of an exemplary embodiment of an extension actuator and casing lock assembly.

FIGS. 16-1 and 16-2, 16A1 to 16A2, 16B1 to 16B2, 16C, 16D, 16E, 16F, 16G, 16H, 16I, **16*j*, 16K, 16L, 16M, 16N, 16O, 16P, 16R, 16S, 16T, 16U, 16V, 16W, 16*x*, 16Y, 16Z1 to 16Z4, 16M1 to 16AA4, 16AB1 to 16AB4, 16AC1 to 16AC4, 16AD, and 16AE** are fragmentary cross-sectional and perspective illustrations of an exemplary embodiment of an adjustable bell section expansion cone assembly.

FIGS. 17-1 and 17-2, 17A1 to 17A2, 17B1 to 17B2, 17C, 17D, 17E, 17F, 17G, 17H, 17I, **17*j*, 17K, 17L, 17M, 17N, 17O, 17P, 17R, 17S, 17T, 17U, 17V, 17W, 17*x*, 17Y, 17Z1-17Z4, 17AA1 to 17AA4, 17AB1 to 17AB4, 17AC1 to 17AC4, 17AD, and 17AE** are fragmentary cross-sectional and perspective illustrations of an exemplary embodiment of an adjustable casing expansion cone assembly.

FIGS. 19-1 to 19-5 is a fragmentary cross-sectional illustration of an exemplary embodiment of a packer assembly.

FIGS. 20A1 to 20A5, 20B1 to 20B5, 20C1 to 20C5, 20D1 to 20D5, 20E1 to 20E6, 20F1 to 20F6, 20G1 to 20G6, and 20H1 to 20H5, are fragmentary cross-sectional illustrations of an exemplary embodiment of the operation of the packer setting tool and the packer assembly of FIGS. 18A to 18C and 19-1 to 19-5.

DETAILED DESCRIPTION OF THE ILLUSTRATIVE EMBODIMENTS

Figure 1:
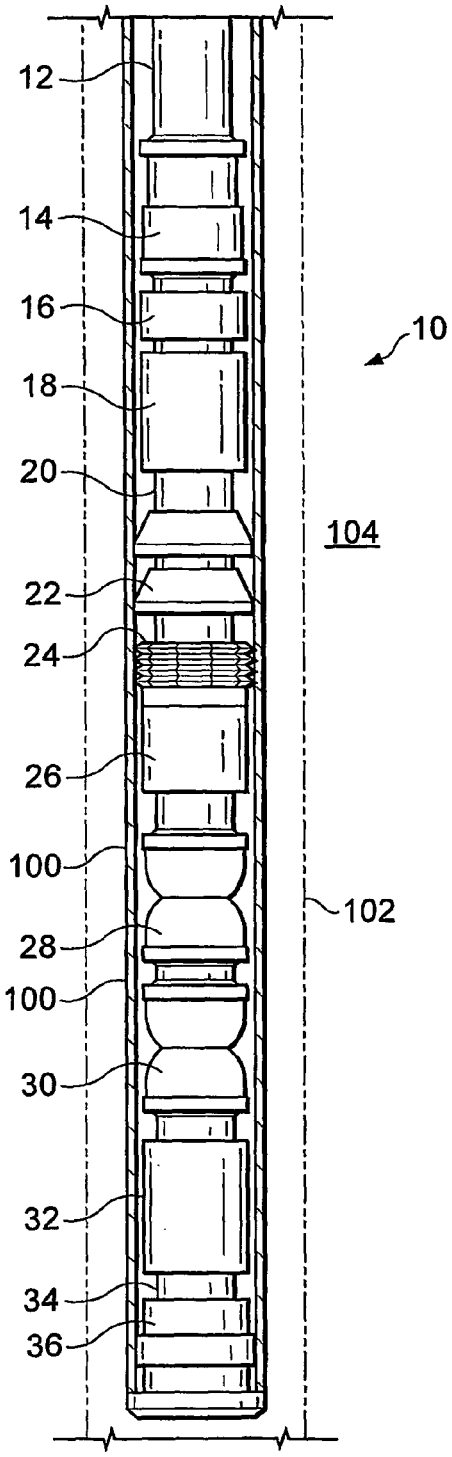
FIG. 1 is a fragmentary cross-sectional illustration of an embodiment of a system for radially expanding and plastically deforming wellbore casing, including a tubular support member, a casing cutter, a ball gripper for gripping a wellbore casing, a force multiplier tension actuator, a safety sub, a cup sub, a casing lock, an extension actuator, a bell section adjustable expansion cone assembly, a casing section adjustable expansion cone assembly, a packer setting tool, a packer, a stinger, and an expandable wellbore casing, during the placement of the system within a wellbore.

Referring initially to FIGS. 1-10, an exemplary embodiment of a system 10 for radially expanding and plastically deforming a wellbore casing includes a conventional tubular support 12 having an end that is coupled to an end of a casing cutter assembly 14. In an exemplary embodiment, the casing cutter assembly 14 may be, or may include elements, of one or more conventional commercially available casing cutters for cutting wellbore casing, or equivalents thereof.

An end of a ball gripper assembly 16 is coupled to another end of the casing cutter assembly 14. In an exemplary embodiment, the ball gripper assembly 14 may be, or may include elements, of one or more conventional commercially available ball grippers, or other types of gripping devices, for gripping wellbore casing, or equivalents thereof.

An end of a tension actuator assembly 18 is coupled to another end of the ball gripper assembly 16. In an exemplary embodiment, the tension actuator assembly 18 may be, or may include elements, of one or more conventional commercially actuators, or equivalents thereof.

An end of a safety sub assembly 20 is coupled to another end of the tension actuator assembly 18. In an exemplary embodiment, the safety sub assembly 20 may be, or may include elements, of one or more conventional apparatus that provide quick connection and/or disconnection of tubular members, or equivalents thereof.

An end of a sealing cup assembly 22 is coupled to another end of the safety sub assembly 20. In an exemplary embodiment, the sealing cup assembly 22 may be, or may include elements, of one or more conventional sealing cup assemblies, or other types of sealing assemblies, that sealingly engage the interior surfaces of surrounding tubular members, or equivalents thereof.

An end of a casing lock assembly 24 is coupled to another end of the sealing cup assembly 22. In an exemplary embodiment, the casing lock assembly 24 may be, or may include elements, of one or more conventional casing lock assemblies that lock the position of wellbore casing, or equivalents thereof.

An end of an extension actuator assembly 26 is coupled to another end of the casing lock assembly 24. In an exemplary embodiment, the extension actuator assembly 26 may be, or may include elements, of one or more conventional actuators, or equivalents thereof.

An end of an adjustable bell section expansion cone assembly 28 is coupled to another end of the extension actuator assembly 26. In an exemplary embodiment, the adjustable bell section expansion cone assembly 28 may be, or may include elements, of one or more conventional adjustable expansion devices for radially expanding and plastically deforming wellbore casing, or equivalents thereof.

An end of an adjustable casing expansion cone assembly 30 is coupled to another end of the adjustable bell section expansion cone assembly 28. In an exemplary embodiment, the adjustable casing expansion cone assembly 30 may be, or may include elements, of one or more conventional adjustable expansion devices for radially expanding and plastically deforming wellbore casing, or equivalents thereof.

An end of a packer setting tool assembly 32 is coupled to another end of the adjustable casing expansion cone assembly 30. In an exemplary embodiment, the packer setting tool assembly 32 may be, or may include elements, of one or more conventional adjustable expansion devices for controlling the operation of a conventional packer, or equivalents thereof.

An end of a stinger assembly 34 is coupled to another end of the packer setting tool assembly 32. In an exemplary embodiment, the stinger assembly 34 may be, or may include elements, of one or more conventional devices for engaging a conventional packer, or equivalents thereof.

An end of a packer assembly 36 is coupled to another end of the stinger assembly 34. In an exemplary embodiment, the packer assembly 36 may be, or may include elements, of one or more conventional packers.

In an exemplary embodiment, one or more of the elements of the system 10 may be omitted, at least in part, and/or combined, at least in part, with one or more of the other elements of the system.

As illustrated in FIG. 1, in an exemplary embodiment, during operation of the system 10, an expandable wellbore casing 100 is coupled to and supported by the casing lock assembly 24 of the system. The system 10 is then positioned within a wellbore 102 that traverses a subterranean formation 104 and includes a preexisting wellbore casing 106.

Figure 2:
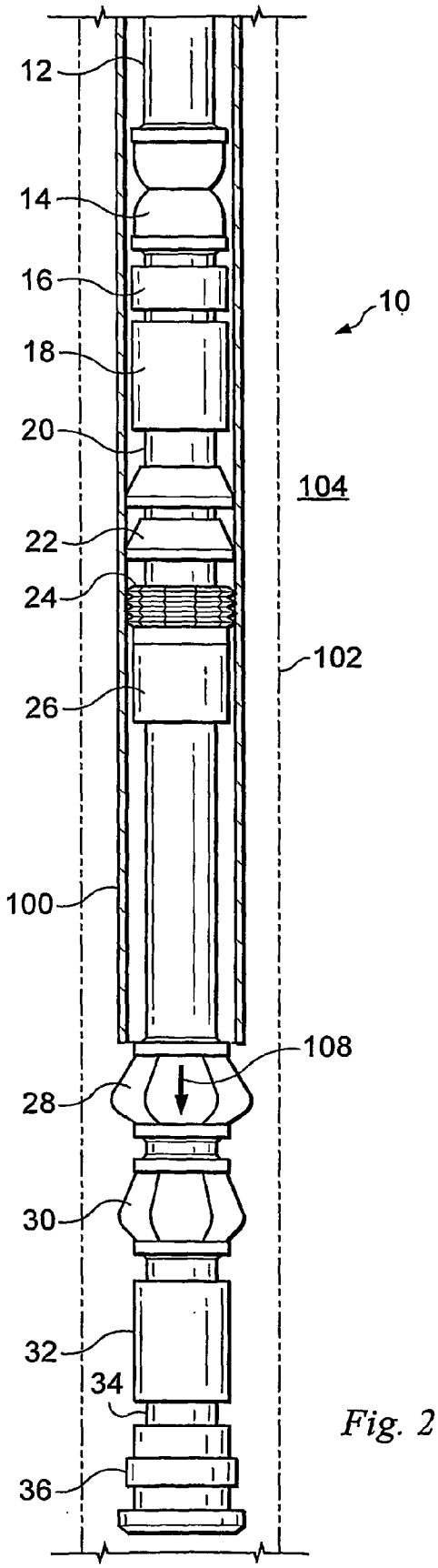
FIG. 2 is a fragmentary cross-sectional illustration of the system of FIG. 1 during the subsequent displacement of the bell section adjustable expansion cone assembly, the casing section adjustable expansion cone assembly, the packer setting tool, the packer, and the stinger downwardly out of the end of the expandable wellbore casing and the expansion of the size of the bell section adjustable expansion cone assembly and the casing section adjustable expansion cone assembly.

As illustrated in FIG. 2, in an exemplary embodiment, the extension actuator assembly 26 is then operated to move the adjustable bell section expansion cone assembly 28, adjustable casing expansion cone assembly 30, packer setting tool assembly 32, stinger assembly 34, packer assembly 36 downwardly in a direction 108 and out of an end of the expandable wellbore casing 100. After the adjustable bell section expansion cone assembly 28 and adjustable casing expansion cone assembly 30 have been moved to a position out of the end of the expandable wellbore casing 100, the adjustable bell section expansion cone assembly and adjustable casing expansion cone assembly are then operated to increase the outside diameters of the expansion cone assemblies. In an exemplary embodiment, the increased outside diameter of the adjustable bell section expansion cone assembly 28 is greater than the increased outside diameter of the adjustable casing expansion cone assembly 30.

Figure 3:
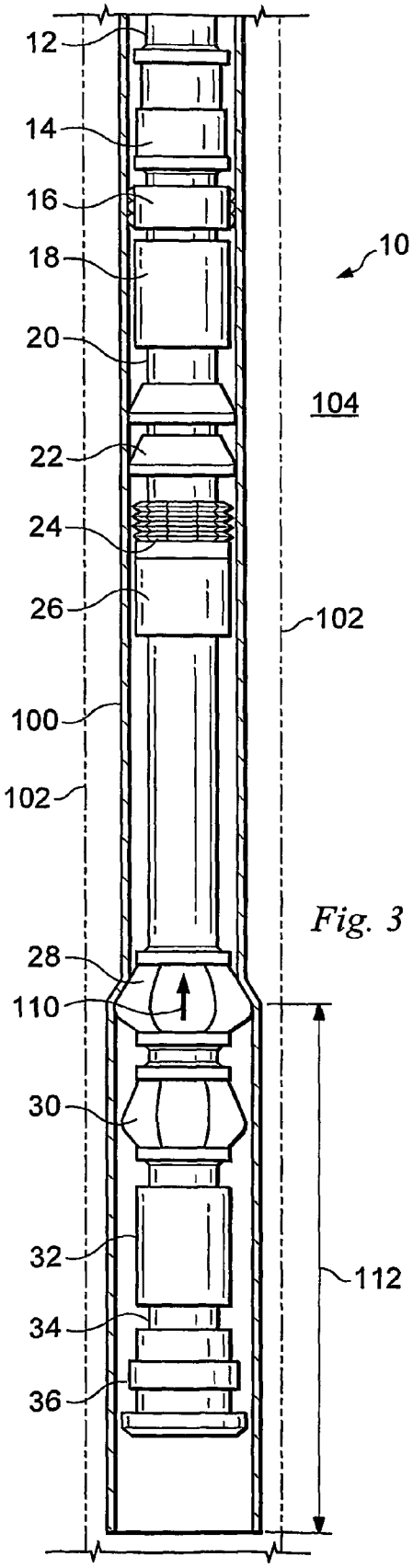
FIG. 3 is a fragmentary cross-sectional illustration of the system of FIG. 2 during the subsequent operation of the tension actuator to displace the bell section adjustable expansion cone assembly upwardly into the end of the expandable wellbore casing to form a bell section in the end of the expandable wellbore casing.

As illustrated in FIG. 3, in an exemplary embodiment, the ball gripper assembly 16 is then operated to engage and hold the position of the expandable tubular member 100 stationary relative to the tubular support member 12. The tension actuator assembly 18 is then operated to move the adjustable bell section expansion cone assembly 28, adjustable casing expansion cone assembly 30, packer setting tool assembly 32, stinger assembly 34, packer assembly 36 upwardly in a direction 110 into and through the end of the expandable wellbore casing 100. As a result, the end of the expandable wellbore casing 100 is radially expanded and plastically deformed by the adjustable bell section expansion cone assembly 28 to form a bell section 112. In an exemplary embodiment, during the operation of the system 10 described above with reference to FIG. 3, the casing lock assembly 24 may or may not be coupled to the expandable wellbore casing 100.

In an exemplary embodiment, the length of the end of the expandable wellbore casing 100 that is radially expanded and plastically deformed by the adjustable bell section expansion cone assembly 28 is limited by the stroke length of the tension actuator assembly 18. In an exemplary embodiment, once the tension actuator assembly 18 completes a stroke, the ball gripper assembly 16 is operated to release the expandable tubular member 100, and the tubular support 12 is moved upwardly to permit the tension actuator assembly to be re-set. In this manner, the length of the bell section 112 can be further extended by continuing to stroke and then re-set the position of the tension actuator assembly 18. Note, that, during the upward movement of the tubular support 12 to re-set the position of the tension actuator assembly 18, the expandable tubular wellbore casing 100 is supported by the expansion surfaces of the adjustable bell section expansion cone assembly 28.

Figure 4:
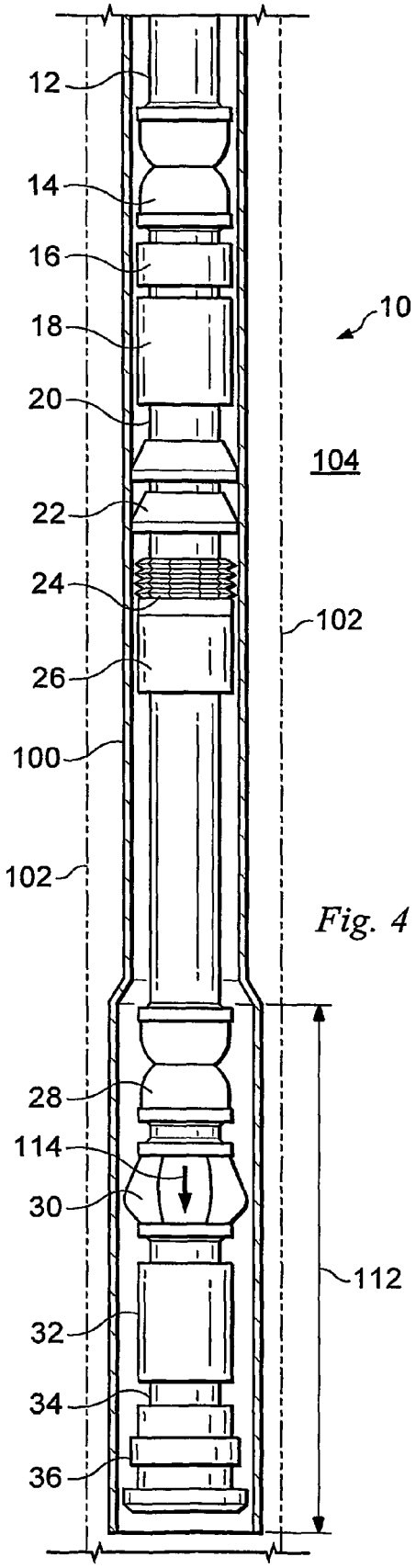
FIG. 4 is a fragmentary cross-sectional illustration of the system of FIG. 3 during the subsequent reduction of the bell section adjustable expansion cone assembly.

As illustrated in FIG. 4, in an exemplary embodiment, the casing lock assembly 24 is then operated to engage and maintain the position of the expandable wellbore casing 100 stationary relative to the tubular support 12. The adjustable bell section expansion cone assembly 28, adjustable casing expansion cone assembly 30, packer setting tool assembly 32, stinger assembly 34, and packer assembly 36 are displaced downwardly into the bell section 112 in a direction 114 relative to the expandable wellbore casing 100 by operating the extension actuator 26 and/or by displacing the system 10 downwardly in the direction 114 relative to the expandable wellbore casing. After the adjustable bell section expansion cone assembly 28 and adjustable casing expansion cone assembly 30 have been moved downwardly in the direction 114 into the bell section 112 of the expandable wellbore casing 100, the adjustable bell section expansion cone assembly is then operated to decrease the outside diameter of the adjustable bell section expansion cone assembly. In an exemplary embodiment, the decreased outside diameter of the adjustable bell section expansion cone assembly 28 is less than the increased outside diameter of the adjustable casing expansion cone assembly 30. In an exemplary embodiment, during the operation of the system illustrated and described above with reference to FIG. 4, the ball gripper 16 may or may not be operated to engage the expandable wellbore casing 100.

Figure 5:
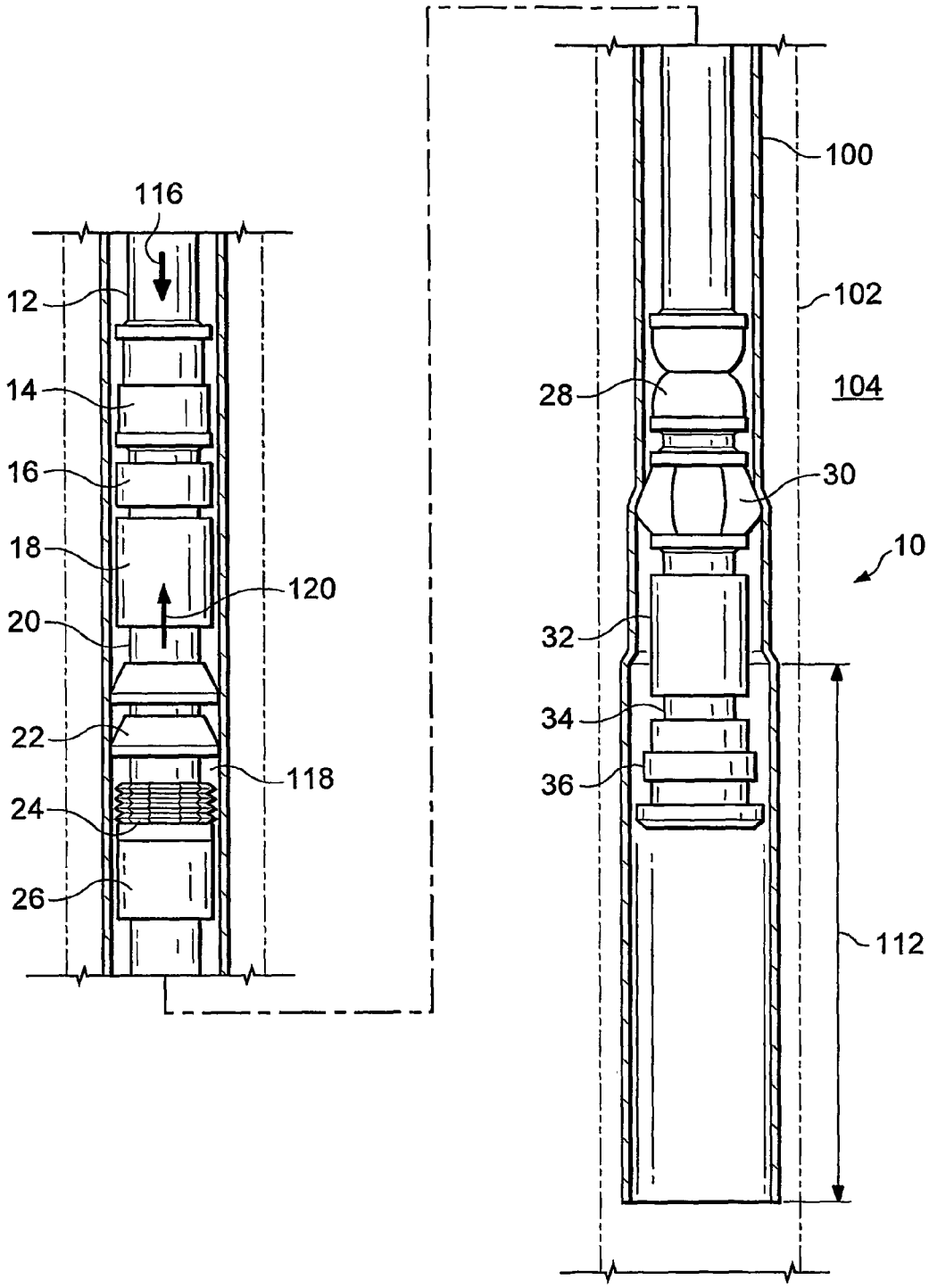
FIG. 5 is a fragmentary cross-sectional illustration of the system of FIG. 4 during the subsequent upward displacement of the expanded casing section adjustable expansion cone assembly to radially expand the expandable wellbore casing.

As illustrated in FIG. 5, in an exemplary embodiment, the casing lock assembly 24 is then disengaged from the expandable wellbore casing 100 and fluidic material 116 is then injected into the system 10 through the tubular support 12 to thereby pressurize an annulus 118 defined within the expandable wellbore casing below the cup sub assembly 22. As a result, a pressure differential is created across the cup seal assembly 22 that causes the cup seal assembly to apply a tensile force in the direction 120 to the system 10. As a result, the system 10 is displaced upwardly in the direction 120 relative to the expandable wellbore casing 100 thereby pulling the adjustable casing expansion cone assembly 30 upwardly in the direction 120 through the expandable wellbore casing thereby radially expanding and plastically deforming the expandable wellbore casing.

In an exemplary embodiment, the tension actuator assembly 16 may also be operated during the injection of the fluidic material 116 to displace the adjustable casing expansion cone assembly 30 upwardly relative to the tubular support 12. As a result, additional expansion forces may be applied to the expandable wellbore casing 100.

Figure 6:
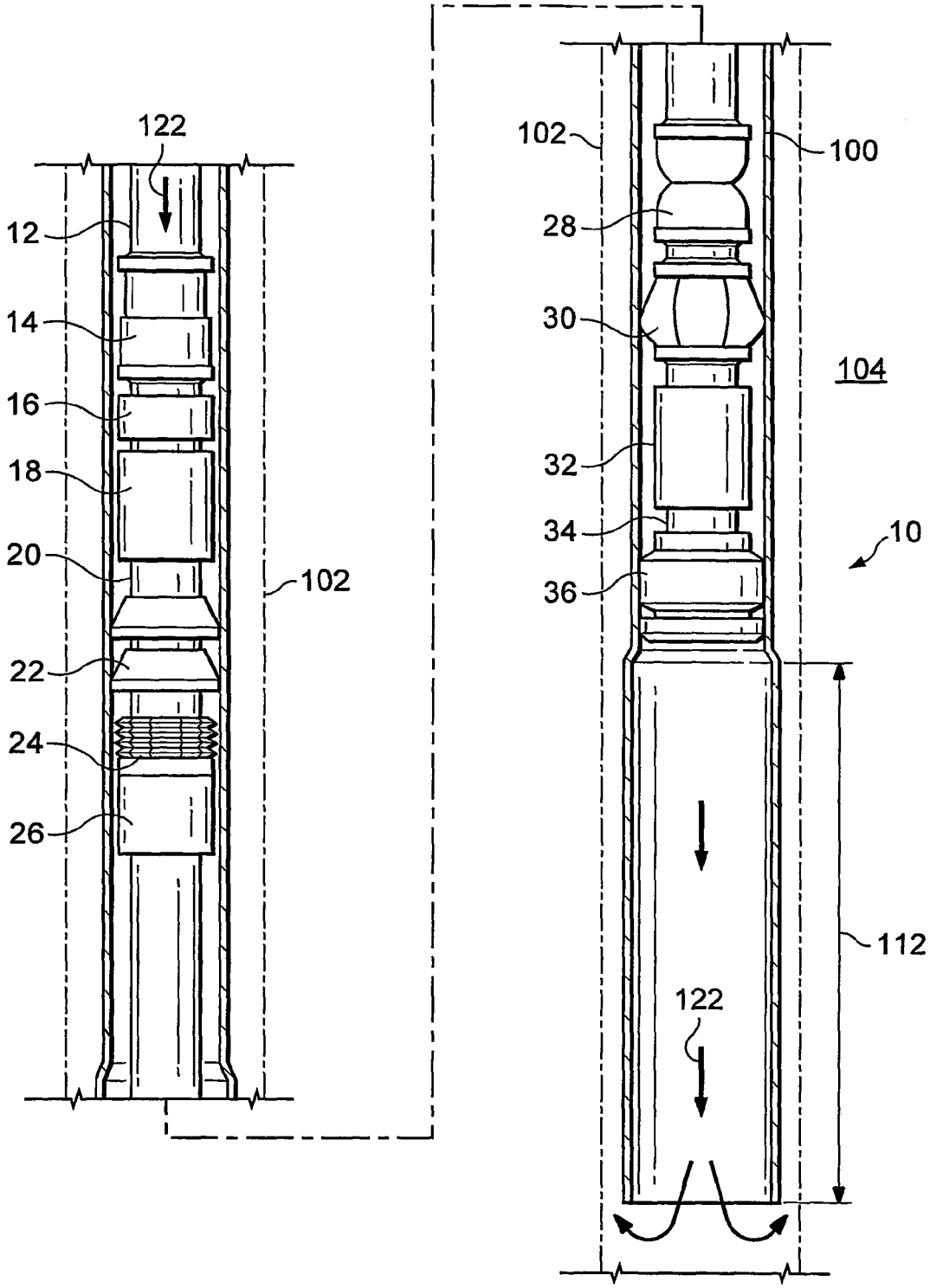
FIG. 6 is a fragmentary cross-sectional illustration of the system of FIG. 5 during the subsequent lowering of the tubular support member, casing cutter, ball gripper, a force multiplier tension actuator, safety sub, cup sub, casing lock, extension actuator, bell section adjustable expansion cone assembly, casing section adjustable expansion cone assembly, packer setting tool, packer, and stinger and subsequent setting of the packer within the expandable wellbore casing above the bell section.

As illustrated in FIG. 6, in an exemplary embodiment, the radial expansion and plastic deformation of the expandable wellbore casing using the adjustable casing expansion cone assembly 30 continues until the packer assembly 36 is positioned within a portion of the expandable tubular member above the bell section 112. The packer assembly 36 may then be operated to engage the interior surface of the expandable wellbore casing 100 above the bell section 112.

In an exemplary embodiment, after the packer assembly 36 is operated to engage the interior surface of the expandable wellbore casing 100 above the bell section 112, a hardenable fluidic sealing material 122 may then be injected into the system 10 through the tubular support 12 and then out of the system through the packer assembly to thereby permit the annulus between the expandable wellbore casing and the wellbore 102 to be filled with the hardenable fluidic sealing material. The hardenable fluidic sealing material 122 may then be allowed to cure to form a fluid tight annulus between the expandable wellbore casing 100 and the wellbore 102, before, during, or after the completion of the radial expansion and plastic deformation of the expandable wellbore casing.

Figure 7:
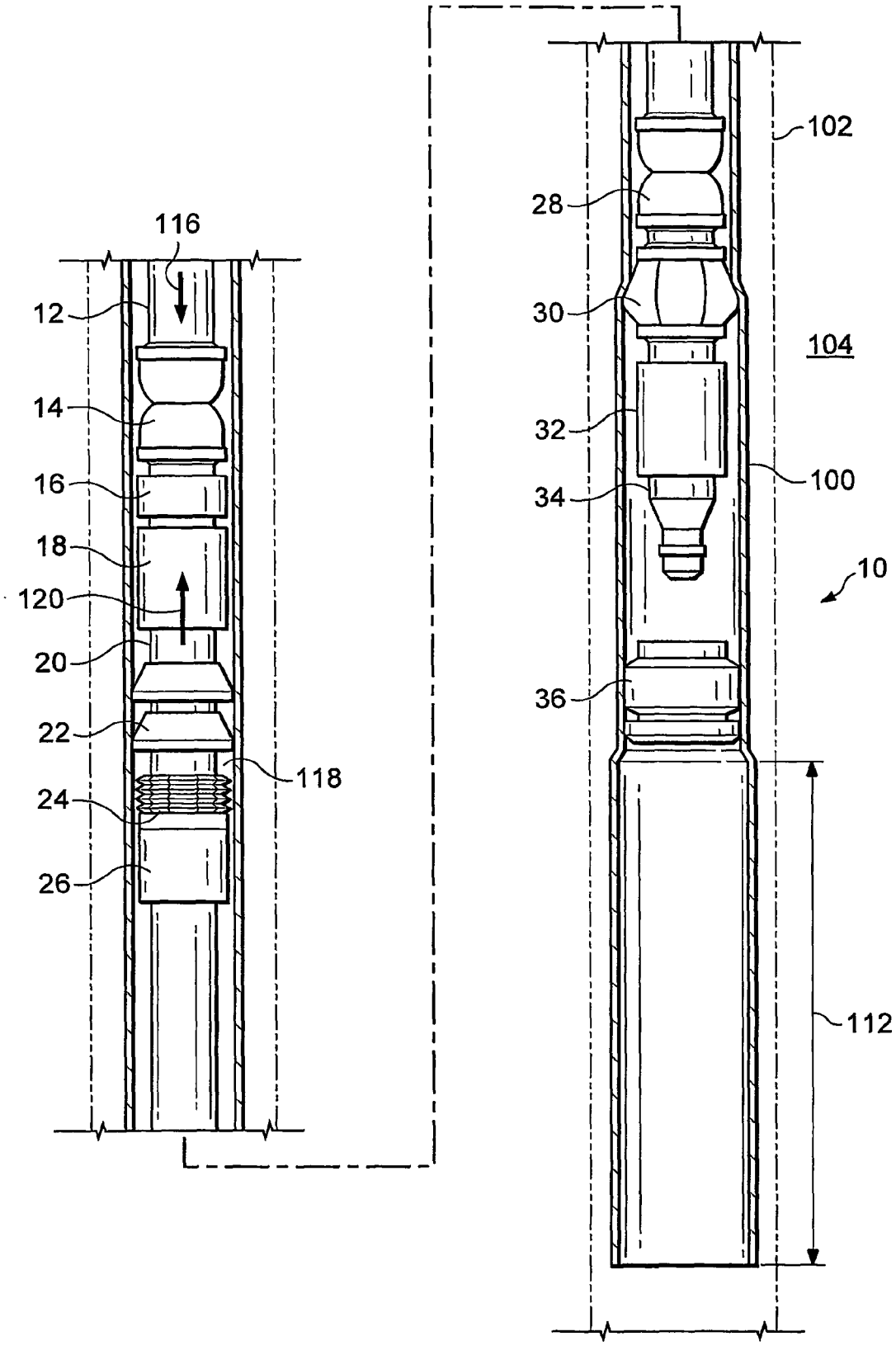
FIG. 7 is a fragmentary cross-sectional illustration of the system of FIG. 6 during the subsequent injection of fluidic materials into the system to displace the expanded casing section adjustable expansion cone assembly upwardly through the expandable wellbore casing to radially expand and plastically deform the expandable wellbore casing.

As illustrated in FIG. 7, in an exemplary embodiment, the fluidic material 116 is then re-injected into the system 10 through the tubular support 12 to thereby re-pressurize the annulus 118 defined within the expandable wellbore casing below the cup sub assembly 22. As a result, a pressure differential is once again created across the cup seal assembly 22 that causes the cup seal assembly to once again apply a tensile force in the direction 120 to the system 10. As a result, the system 10 is displaced upwardly in the direction 120 relative to the expandable wellbore casing 100 thereby pulling the adjustable casing expansion cone assembly 30 upwardly in the direction 120 through the expandable wellbore casing thereby radially expanding and plastically deforming the expandable wellbore casing and disengaging the stinger assembly 34 from the packer assembly 36. In an exemplary embodiment, during this operational mode, the packer assembly 36 prevents the flow of fluidic materials out of the expandable wellbore casing 100. As a result, the pressurization of the annulus 118 is rapid and efficient thereby enhancing the operational efficiency of the subsequent radial expansion and plastic deformation of the expandable wellbore casing 100.

In an exemplary embodiment, the tension actuator assembly 16 may also be operated during the re-injection of the fluidic material 116 to displace the adjustable casing expansion cone assembly 30 upwardly relative to the tubular support 12. As a result, additional expansion forces may be applied to the expandable wellbore casing 100.

Figure 8:
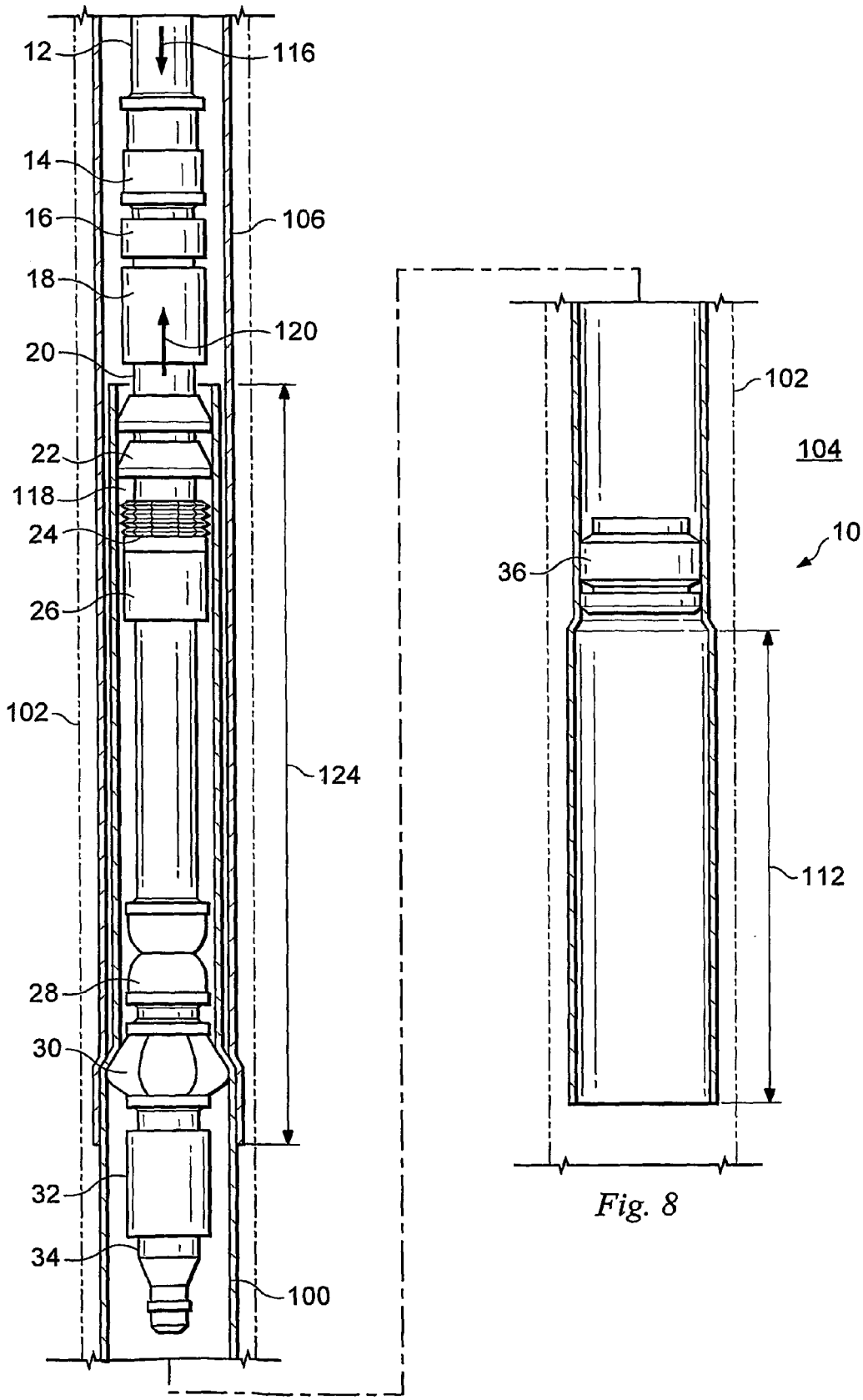
FIG. 8 is a fragmentary cross-sectional illustration of the system of FIG. 7 during the subsequent injection of fluidic materials into the system to displace the expanded casing section adjustable expansion cone assembly upwardly through the expandable wellbore casing and a surrounding preexisting wellbore casing to radially expand and plastically deform the overlapping expandable wellbore casing and the surrounding preexisting wellbore casing.

As illustrated in FIG. 8, in an exemplary embodiment, the radial expansion and plastic deformation of the expandable wellbore casing using the adjustable casing expansion cone assembly 30 continues until the adjustable casing expansion cone assembly 30 reaches the portion 124 of the expandable wellbore casing 100 that overlaps with the preexisting wellbore casing 106. At which point, the system 10 may radially expand the portion 124 of the expandable wellbore casing 100 that overlaps with the preexisting wellbore casing 106 and the surrounding portion of the preexisting wellbore casing. Consequently, in an exemplary embodiment, during the radial expansion of the portion 124 of the expandable wellbore casing 100 that overlaps with the preexisting wellbore casing 106, the tension actuator assembly 16 is also operated to displace the adjustable casing expansion cone assembly 30 upwardly relative to the tubular support 12. As a result, additional expansion forces may be applied to the expandable wellbore casing 100 and the preexisting wellbore casing 106 during the radial expansion of the portion 124 of the expandable wellbore casing that overlaps with the preexisting wellbore casing.

Figure 9:
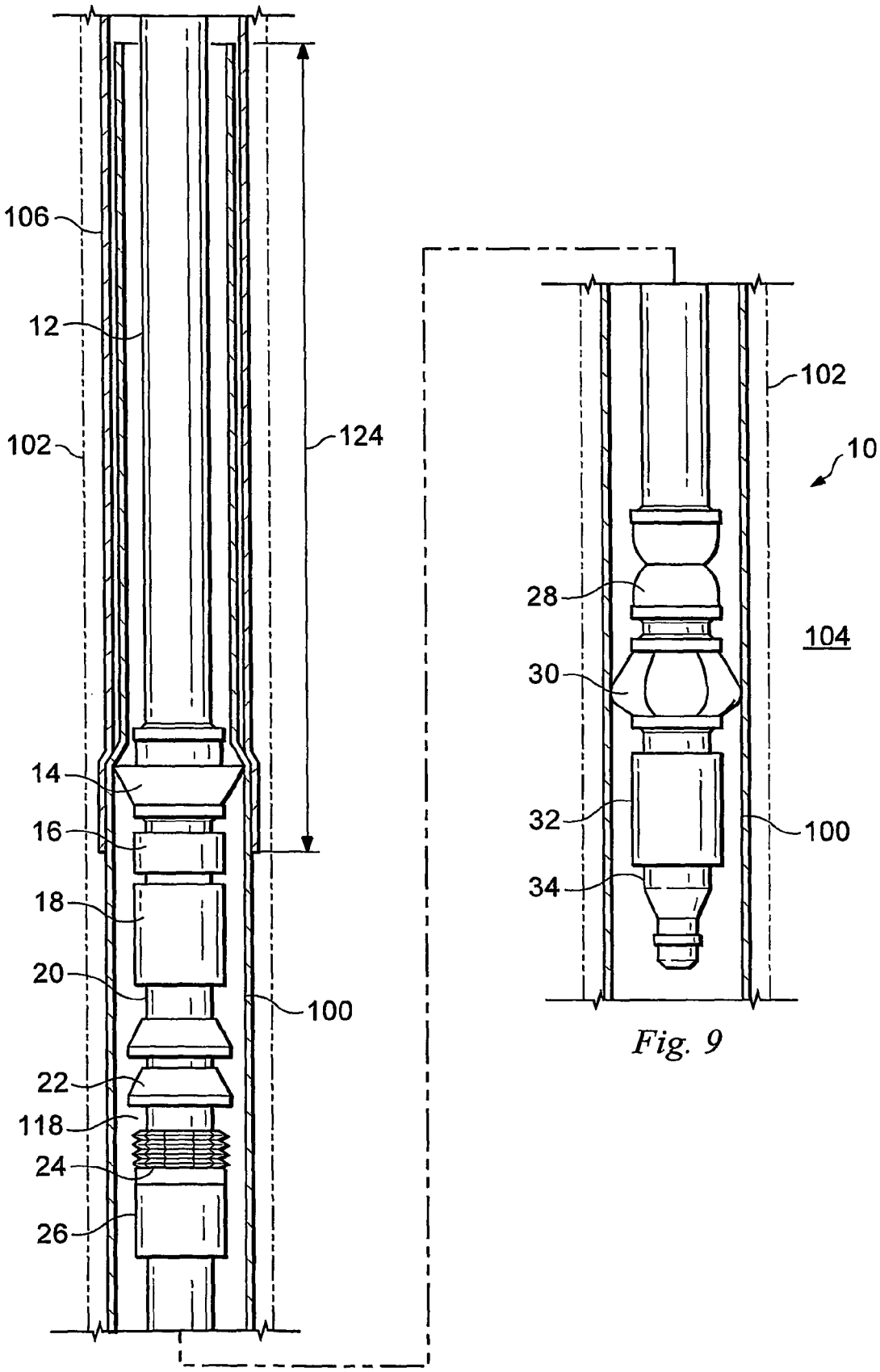
FIG. 9 is a fragmentary cross-sectional illustration of the system of FIG. 8 during the subsequent operation of the casing cutter to cut off an end of the expandable wellbore casing.

As illustrated in FIG. 9, in an exemplary embodiment, the entire length of the portion 124 of the expandable wellbore casing 100 that overlaps with the preexisting wellbore casing 106 is not radially expanded and plastically deformed. Rather, only part of the portion 124 of the expandable wellbore casing 100 that overlaps with the preexisting wellbore casing 106 is radially expanded and plastically deformed. The remaining part of the portion 124 of the expandable wellbore casing 100 that overlaps with the preexisting wellbore casing 106 is then cut away by operating the casing cutter assembly 14.

Figure 10:
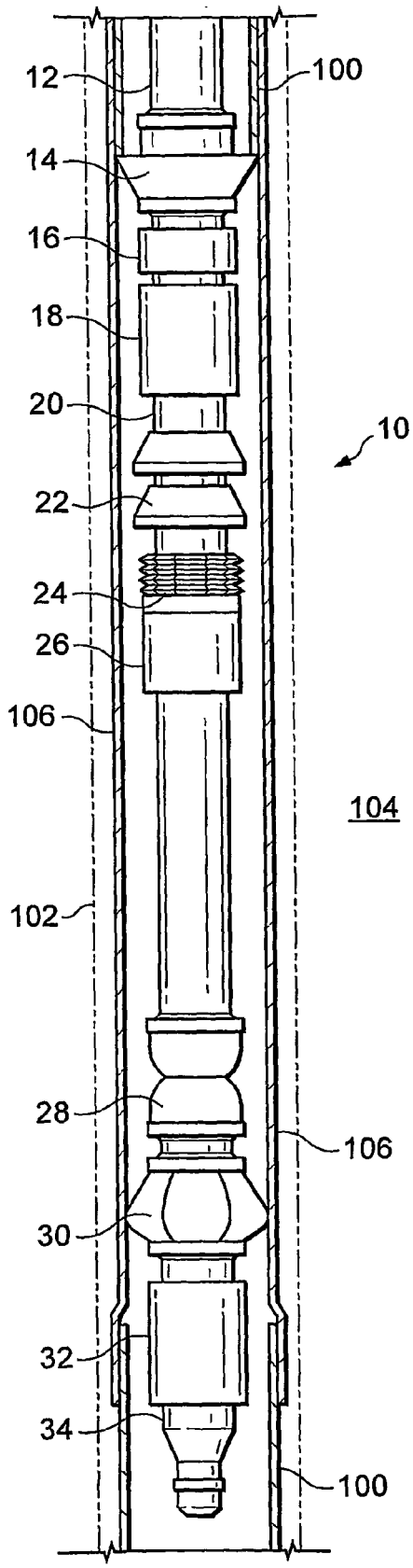
FIG. 10 is a fragmentary cross-sectional illustration of the system of FIG. 9 during the subsequent removal of the cut off end of the expandable wellbore casing.

As illustrated in FIG. 10, the remaining part of the portion 124 of the expandable wellbore casing 100 that overlaps with the preexisting wellbore casing 106 that is cut away by operating the casing cutter assembly 14 is then also carried out of the wellbore 102 using the casing cutter assembly.

Furthermore, in an exemplary embodiment, the inside diameter of the expandable wellbore casing 100 above the bell section 112 is equal to the inside diameter of the portion of the preexisting wellbore casing 106 that does not overlap with the expandable wellbore casing 100. As a result, a wellbore casing is constructed that includes overlapping wellbore casings that together define an internal passage having a constant cross-sectional area.

In an exemplary embodiment, one or more of the operational elements of the system 10 may be omitted, at least in part, and/or combined, at least in part, with one or more of the other operational elements of the system.

In several exemplary embodiments, the system 10 includes one or more of the methods and apparatus disclosed in one or more of the following: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969, 922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074, 244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557, 640, which was filed as patent application Ser. No. 09/588, 946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137, 998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261, 926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557, 640, which was filed as patent application Ser. No. 09/588, 946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, (122) PCT patent application serial no. PCT/US04/06246, filed on Feb. 26, 2004, (123) PCT patent application serial number PCT/US04/08170, filed on Mar. 15, 2004, (124) PCT patent application serial number PCT/US04/08171, filed on Mar. 15, 2004, (125) PCT patent application serial number PCT/US04/08073, filed on Mar. 18, 2004, (126) PCT patent application serial number PCT/US04/07711, filed on Mar. 11, 2004, (127) PCT patent application serial number PCT/US04/09434, filed on Mar. 26, 2004, (128) PCT patent application serial number PCT/US04/10317, filed on Apr. 2, 2004, (129) PCT patent application serial number PCT/US04/10712, filed on Apr. 7, 2004, and (130) PCT patent application serial number PCT/US04/10762, filed on Apr. 6, 2004, the disclosures of which are incorporated herein by reference.

In an exemplary embodiment, the casing cutter assembly 14 is provided and operates substantially, at least in part, as disclosed in one or more of the following: (1) PCT patent application serial number PCT/US03/29858, filed on Sep. 22, 2003, and/or (2) PCT patent application serial number PCT/US04/07711, filed on Mar. 11, 2004, and/or (3) PCT patent application serial number PCT/US04/09434, filed on Mar. 26, 2004, and/or (4) PCT patent application serial number PCT/US04/10317, filed on Apr. 2, 2004, (5) PCT patent application serial number PCT/US04/10712, filed on Apr. 7, 2004, and/or (6) PCT patent application serial number PCT/US04/10762, filed on Apr. 6, 2004, the disclosures of which are incorporated herein by reference.

In an exemplary embodiment, as illustrated in FIGS. 11-1 and 11-2, 11A1 to 11A2, 11B1 to 11B2, 11C, 11D, 11E, 11F, 11G, 11H, 11I, 11*j*, 11K, 11L, 11M, 11N, 11O, 11P, 11Q, 11R, 11S, 11T, 11U, 11V, 11W, 11*x*, 11Y, 11Z1 to 11Z4, 11AA1 to 11AA4, 11AB1 to 11AB4, 11AC1 to 11AC4, 11AD, and 11AE, the casing cutter assembly 14 includes an upper tubular tool joint 14002 that defines a longitudinal passage 14002*a* and mounting holes, 14002*b* and 14002*c*, and includes an internal threaded connection 14002*d*, an inner annular recess 14002*e*, an inner annular recess 14002*f*, and an internal threaded connection 14002*g*. A tubular torque plate 14004 that defines a longitudinal passage 14004*a* and includes circumferentially spaced apart teeth 14004*b* is received within, mates with, and is coupled to the internal annular recess 14002*e* of the upper tubular tool joint 14002.

Circumferentially spaced apart teeth 14006*a* of an end of a tubular lower mandrel 14006 that defines a longitudinal passage 14006*b*, a radial passage 14006*ba*, and a radial passage 14006*bb* and includes an external threaded connection 14006*c*, an external flange 14006*d*, an external annular recess 14006*e* having a step 14006*f* at one end, an external annular recess 14006*g*, external teeth 14006*h*, an external threaded connection 14006*i*, and an external annular recess 14006*j* engage the circumferentially spaced apart teeth 14004*b* of the tubular torque plate 14004. An internal threaded connection 14008*a* of an end of a tubular toggle bushing 14008 that defines a longitudinal passage 14008*b*, an upper longitudinal slot 14008*c*, a lower longitudinal slot 14008*d*, mounting holes, 14008*e*, 14008*f*, 14008*g*, 14008*h*, 14008*i*, 14008*j*, 14008*k*, 140081, 14008*m*, 14008*n*, 14008*o*, 14008*p*, 14008*q*, 14008*r*, 14008*s*, 14008*t*, 14008*u*, 14008*v*, 14008*w*, 14008*x*, 14008*xa*, and 14008*xb*, and includes an external annular recess 14008*y*, internal annular recess 14008*z*, external annular recess 14008*aa*, and an external annular recess 14008*ab* receives and is coupled to the external threaded connection 14006*c* of the tubular lower mandrel 14006.

A sealing element 14010 is received within the external annular recess 14008*y* of the tubular toggle bushing 14008 for sealing the interface between the tubular toggle bushing and the upper tubular tool joint 14002. A sealing element 14012 is received within the internal annular recess 14008*z* of the tubular toggle bushing 14008 for sealing the interface between the tubular toggle bushing and the tubular lower mandrel 14006.

Mounting screws, 14014*a* and 14014*b*, mounted within and coupled to the mounting holes, 14008*w* and 14008*x*, respectively, of the tubular toggle bushing 14008 are also received within the mounting holes, 14002*b* and 14002*c*, of the upper tubular tool joint 14002. Mounting pins, 14016*a*, 14016*b*, 14016*c*, 14016*d*, and 14016*e*, are mounted within the mounting holes, 14008*e*, 14008*f*, 14008*g*, 14008*h*, and 14008*i*, respectively. Mounting pins, 14018*a*, 14018*b*, 14018*c*, 14018*d*, and 14018*e*, are mounted within the mounting holes, 14008*t*, 14008*s*, 14008*r*, 14008*q*, and 14008*p*, respectively. Mounting screws, 14020*a* and 14020*b*, are mounted within the mounting holes, 14008*u* and 14008*v*, respectively.

A first upper toggle link 14022 defines mounting holes, 14022*a* and 14022*b*, for receiving the mounting pins, 14016*a* and 14016*b*, and includes a mounting pin 14022*c* at one end. A first lower toggle link 14024 defines mounting holes, 14024*a*, 14024*b*, and 14024*c*, for receiving the mounting pins, 14022*c*, 14016*c*, and 14016*d*, respectively and includes an engagement arm 14024*d*. A first trigger 14026 defines a mounting hole 14026*a* for receiving the mounting pin 14016*e* and includes an engagement arm 14026*b* at one end, an engagement member 14026*c*, and an engagement arm 14026*d* at another end.

A second upper toggle link 14028 defines mounting holes, 14028*a* and 14028*b*, for receiving the mounting pins, 14018*a* and 14018*b*, and includes a mounting pin 14028*c* at one end. A second lower toggle link 14030 defines mounting holes, 14030*a*, 14030*b*, and 14030*c*, for receiving the mounting pins, 14028*c*, 14018*c*, and 14018*d*, respectively and includes an engagement arm 14030*d*. A second trigger 14032 defines a mounting hole 14032*a* for receiving the mounting pin 14018*e* and includes an engagement arm 14032*b* at one end, an engagement member 14032*c*, and an engagement arm 14032*d* at another end.

An end of a tubular spring housing 14034 that defines a longitudinal passage 14034*a*, mounting holes, 14034*b* and 14034*c*, and mounting holes, 14034*ba* and 14034*ca*, and includes an internal flange 14034*d* and an internal annular recess 14034*e* at one end, and an internal flange 14034*f*, an internal annular recess 14034*g*, an internal annular recess 14034*h*, and an external threaded connection 14034*i* at another end receives and mates with the end of the tubular toggle bushing 14008. Mounting screws, 14035*a* and 14035*b*, are mounted within and coupled to the mounting holes, 14008*xb* and 14008*xa*, respectively, of the tubular toggle bushing 14008 and are received within the mounting holes, 14034*ba* and 14034*ca*, respectively, of the tubular spring housing 14034.

A tubular retracting spring ring 14036 that defines mounting holes, 14036*a* and 14036*b*, receives and mates with a portion of the tubular lower mandrel 14006 and is received within and mates with a portion of the tubular spring housing 14034. Mounting screws, 14038*a* and 14038*b*, are mounted within and coupled to the mounting holes, 14036*a* and 14036*b*, respectively, of the tubular retracting spring ring 14036 and extend into the mounting holes, 14034*b* and 14034*c*, respectively, of the tubular spring housing 14034.

Casing diameter sensor springs, 14040*a* and 14040*b*, are positioned within the longitudinal slots, 14008*c* and 1408*d*, respectively, of the tubular toggle bushing 14008 that engage the engagement members, 14026*c* and 14032*c*, and engagement arms, 14026*d* and 14032*d*, of the first and second triggers, 14026 and 14032, respectively. An inner flange 14042*a* of an end of a tubular spring washer 14042 mates with and receives a portion of the tubular lower mandrel 14006 and an end face of the inner flange of the tubular spring washer is positioned proximate and end face of the external flange 14006*d* of the tubular lower mandrel. The tubular spring washer 14042 is further received within the longitudinal passage 14034*a* of the tubular spring housing 14034.

An end of a retracting spring 14044 that receives the tubular lower mandrel 14006 is positioned within the tubular spring washer 14042 in contact with the internal flange 14042*a* of the tubular spring washer and the other end of the retracting spring is positioned in contact with an end face of the tubular retracting spring ring 14036.

A sealing element 14046 is received within the external annular recess 14006*j* of the tubular lower mandrel 14006 for sealing the interface between the tubular lower mandrel and the tubular spring housing 14034. A sealing element 14048 is received within the internal annular recess 14034*h* of the tubular spring housing 14034 for sealing the interface between the tubular spring housing and the tubular lower mandrel 14006.

An internal threaded connection 14050*a* of an end of a tubular upper hinge sleeve 14050 that includes an internal flange 14050*b* and an internal pivot 14050*c* receives and is coupled to the external threaded connection 14034*i* of the end of the tubular spring housing 14034.

An external flange 14052*a* of a base member 14052*b* of an upper cam assembly 14052, that is mounted upon and receives the lower tubular mandrel 14006, that includes an internal flange 14052*c* that is received within the external annular recess 14006*e* of the lower tubular mandrel 14006 and a plurality of circumferentially spaced apart cam arms 14052*d* extending from the base member mates with and is received within the tubular upper hinge sleeve 14050. The base member 14052*b* of the upper cam assembly 14052 further includes a plurality of circumferentially spaced apart teeth 14052*f* that mate with and are received within a plurality of circumferentially spaced apart teeth 14034*j* provided on the end face of the tubular spring housing 14034 and an end face of the external flange 14052*a* of the base member of the upper cam assembly is positioned in opposing relation to an end face of the internal flange 14050*b* of the tubular upper hinge sleeve 14050. Each of the cam arms 14052*d* of the upper cam assembly 14052 include external cam surfaces 14052*e*. In an exemplary embodiment, the teeth 14052*f* of the base member 14052*b* of the upper cam assembly 14052 and the teeth 14034*j* provided on the end face of the tubular spring housing 14034 permit torsional loads to be transmitted between the tubular spring housing and the upper cam assembly.

A plurality of circumferentially spaced apart upper casing cutter segments 14054 are mounted upon and receive the lower tubular mandrel 14006 and each include an external pivot recess 14054*a* for mating with and receiving the internal pivot 14050*c* of the tubular upper hinge sleeve 14050 and an external flange 14054*b* and are pivotally mounted within the tubular upper hinge sleeve and are interleaved with the circumferentially spaced apart cam arms 14052*d* of the upper cam assembly 14052. A casing cutter element 14056 is coupled to and supported by the upper surface of each upper casing cutter segments 14054 proximate the external flange 14054*b*.

A plurality of circumferentially spaced apart lower casing cutter segments 14058 are mounted upon and receive the lower tubular mandrel 14006, are interleaved among the upper casing cutter segments 14054, are oriented in the opposite direction to the upper casing cutter segments 14054, each include an external pivot recess 14058*a*, and are positioned in opposing relation to corresponding circumferentially spaced apart cam arms 14052*d* of the upper cam assembly 14052.

A lower cam assembly 14060 is mounted upon and receives the lower tubular mandrel 14006 that includes a base member 14060*a* having an external flange 14060*b*, a plurality of circumferentially spaced apart cam arms 14060*d* that extend from the base member that each include external cam surfaces 14060*e* and define mounting holes 14060*f* and 14060*g*. The base member 14060*a* of the lower cam assembly 14060 further includes a plurality of circumferentially spaced apart teeth 14060*h*. The circumferentially spaced apart cam arms 14060*d* of the lower cam assembly 14060 are interleaved among the lower casing cutter segments 14058 and the circumferentially spaced apart cam arms 14052*d* of the upper cam assembly 14052 and positioned in opposing relation to corresponding upper casing cutter segments 14054.

Mounting screws, 14062*a*, 14062*b*, 14062*c*, and 14062*e*, are mounted within the corresponding mounting holes, 14060*f* and 14060*g*, of the lower cam assembly 14060 and are received within the external annular recess 14006*g* of the lower cam assembly 14060.

A tubular lower hinge sleeve 14064 that receives the lower casing cutter segments 14058 and the lower cam assembly 14060 includes an internal flange 14064*a* for engaging the external flange 14060*b* of the base member of the lower cam assembly 14060, an internal pivot 14064*b* for engaging and receiving the external pivot recess 14058*a* of the lower casing cutter segments 14058 thereby pivotally mounting the lower casing cutter segments within the tubular lower hinge sleeve, and an internal threaded connection 14064*c*.

An external threaded connection 14066*a* of an end of a tubular sleeve 14066 that defines mounting holes, 14066*b* and 14066*c*, and includes an internal annular recess 14066*d* having a shoulder 14066*e*, an internal flange 14066*f*, and an internal threaded connection 14066*g* at another end is received within and coupled to the internal threaded connection 14064*c* of the tubular lower hinge sleeve 14064. An external threaded connection 14068*a* of an end of a tubular member 14068 that defines a longitudinal passage 14068*b* and mounting holes, 14068*c* and 14068*d*, and includes an external annular recess 14068*e*, and an external threaded connection 14068*f* at another end is received within and is coupled to the internal threaded connection 14066*g* of the tubular sleeve 14066.

Mounting screws, 14070*a* and 14070*b*, are mounted in and coupled to the mounting holes, 14068*c* and 14068*d*, respectively, of the tubular member 14068 that also extend into the mounting holes, 14066*b* and 14066*c*, respectively, of the tubular sleeve 14066. A sealing element 14072 is received within the external annular recess 14068*e* of the tubular member 14068 for sealing the interface between the tubular member and the tubular sleeve 14066.

An internal threaded connection 14074*a* of a tubular retracting piston 14074 that defines a longitudinal passage 14074*b* and includes an internal annular recess 14074*c* and an external annular recess 14074*d* receives and is coupled to the external threaded connection 14006*i* of the tubular lower mandrel 14006. A sealing element 14076 is received within the external annular recess 14074*d* of the tubular retracting piston 14074 for sealing the interface between the tubular retracting piston and the tubular sleeve 14066. A sealing element 14078 is received within the internal annular recess 14074*c* of the tubular retracting piston 14074 for sealing the interface between the tubular retracting piston and the tubular lower mandrel 14006.

Locking dogs 14080 mate with and receive the external teeth 14006*h* of the tubular lower mandrel 14006. A spacer ring 14082 is positioned between an end face of the locking dogs 14080 and an end face of the lower cam assembly 14060. A release piston 14084 mounted upon the tubular lower mandrel 14006 defines a radial passage 14084*a* for mounting a burst disk 14086 includes sealing elements, 14084*b*, 14084*c*, and 14084*d*. The sealing elements, 14084*b* and 14084*d*, sealing the interface between the release piston 14084 and the tubular lower mandrel 14006. An end face of the release piston 14084 is positioned in opposing relation to an end face of the locking dogs 14080.

A release sleeve 14088 that receives and is mounted upon the locking dogs 14080 and the release piston 14084 includes an internal flange 14088*a* at one end that sealingly engages the tubular lower mandrel 14006. A bypass sleeve 14090 that receives and is mounted upon the release sleeve 14088 includes an internal flange 14090*a* at one end.

In an exemplary embodiment, during operation of the casing cutter assembly 14, the retracting spring 14044 is compressed and thereby applies a biasing spring force in a direction 14092 from the lower tubular mandrel 14006 to the tubular spring housing 14034 that, in the absence of other forces, moves and/or maintains the upper cam assembly 14052 and the upper casing cutter segments 14054 out of engagement with the lower casing cutter segments 14058 and the lower cam assembly 14060. In an exemplary embodiment, during operation of the casing cutter assembly 14, an external threaded connection 12*a* of an end of the tubular support member 12 is coupled to the internal threaded connection 14002*d* of the upper tubular tool joint 14002 and an internal threaded connection 16*a* of an end of the ball gripper assembly 16 is coupled to the external threaded connection 14068*f* of the tubular member 14068.

The upper cam assembly 14052 and the upper casing cutter segments 14054 may be brought into engagement with the lower casing cutter segments 14058 and the lower cam assembly 14060 by pressurizing an annulus 14094 defined between the lower tubular mandrel 14006 and the tubular spring housing 14034. In particular, injection of fluidic materials into the cam cutter assembly 14 through the longitudinal passage 14006*b* of the lower tubular mandrel 14006 and into the radial passage 14006*ba* may pressurize the annulus 14094 thereby creating sufficient operating pressure to generate a force in a direction 14096 sufficient to overcome the biasing force of the retracting spring 14044. As a result, the spring housing 14034 may be displaced in the direction 14096 relative to the lower tubular mandrel 14006 thereby displacing the tubular upper hinge sleeve 14050, upper cam assembly 14052, and upper casing cutter segments 14054 in the direction 14096.

Figures 1, 11:
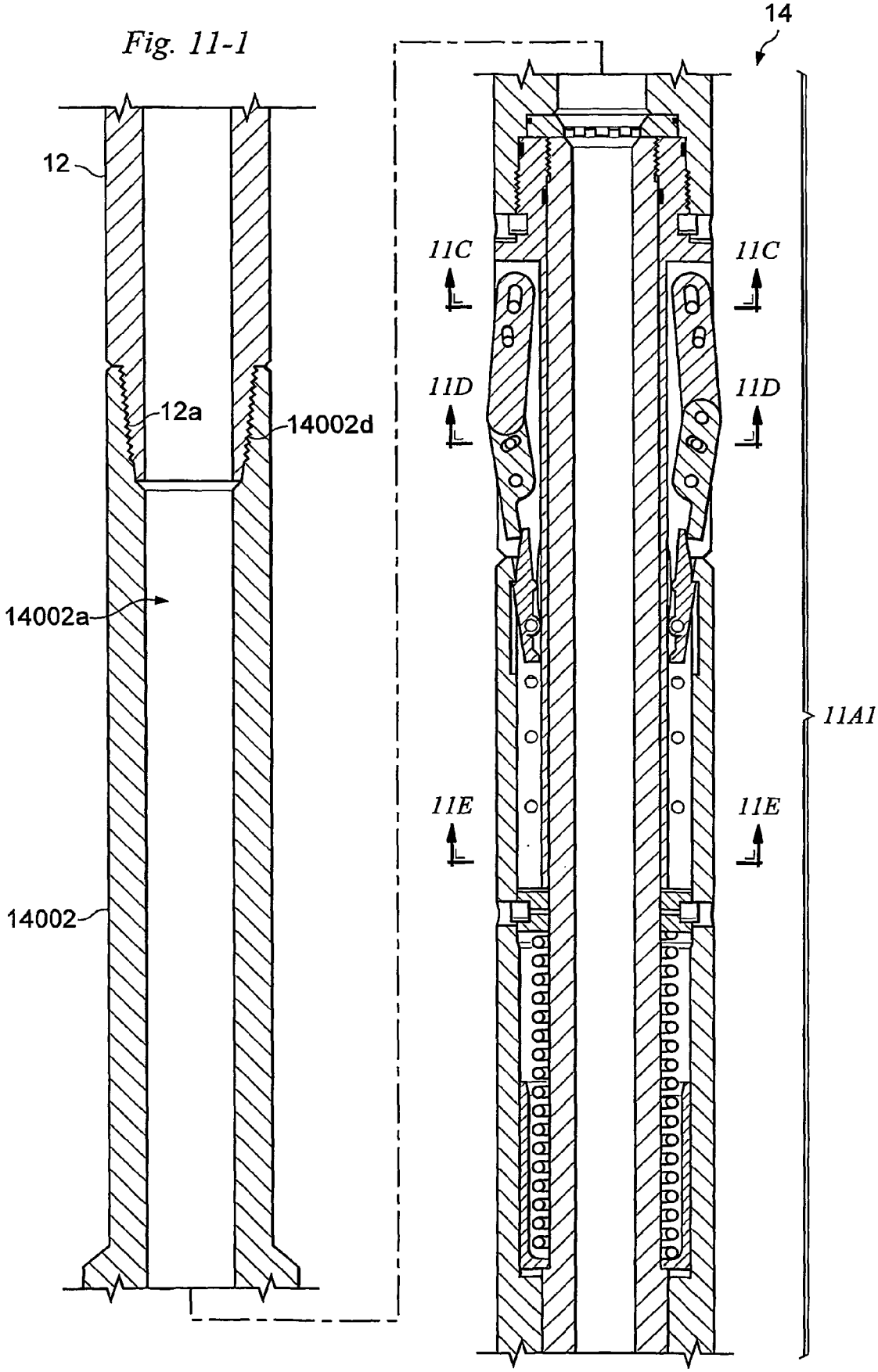
Figures 2, 11:
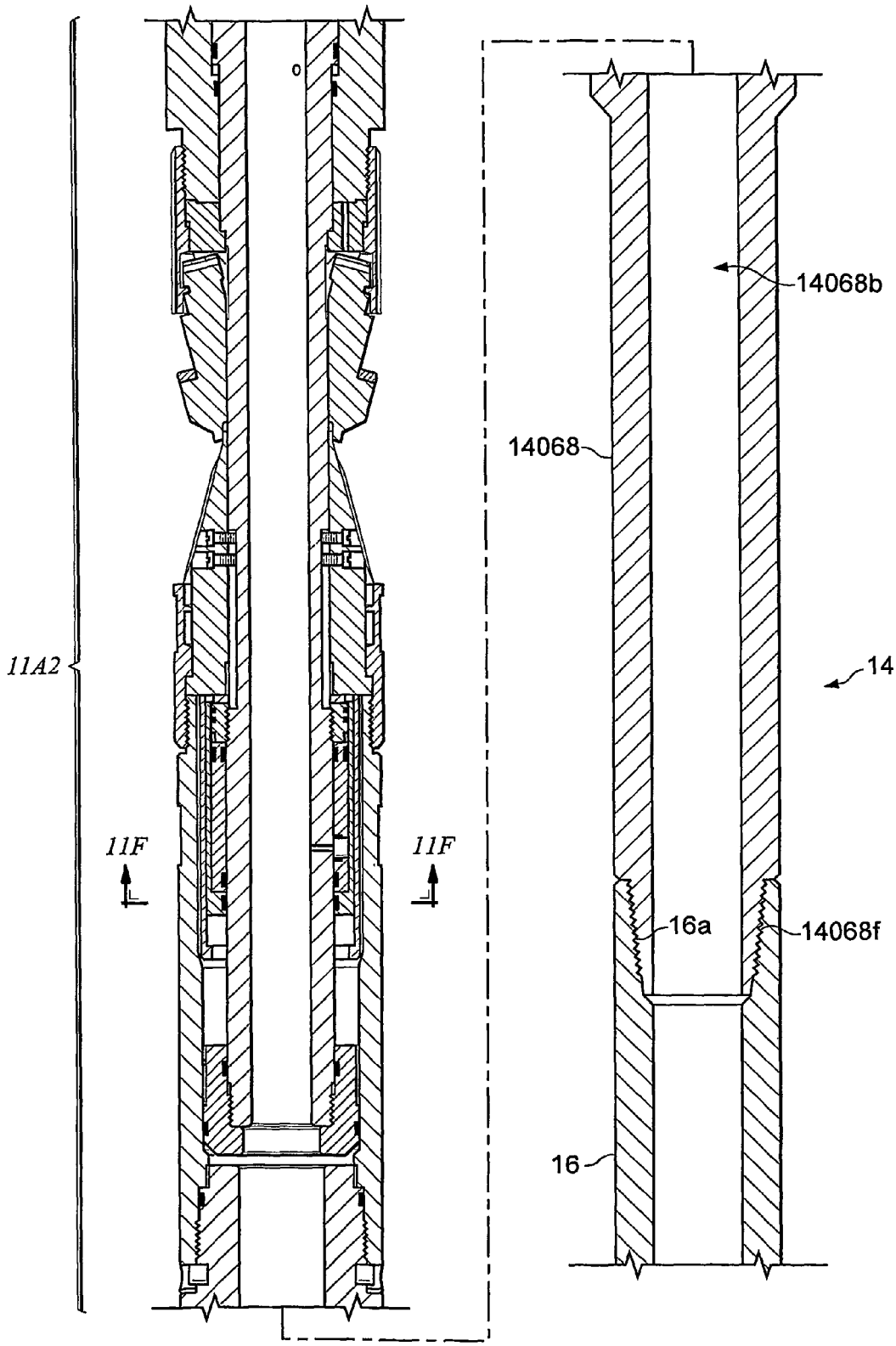
Figure 11C:
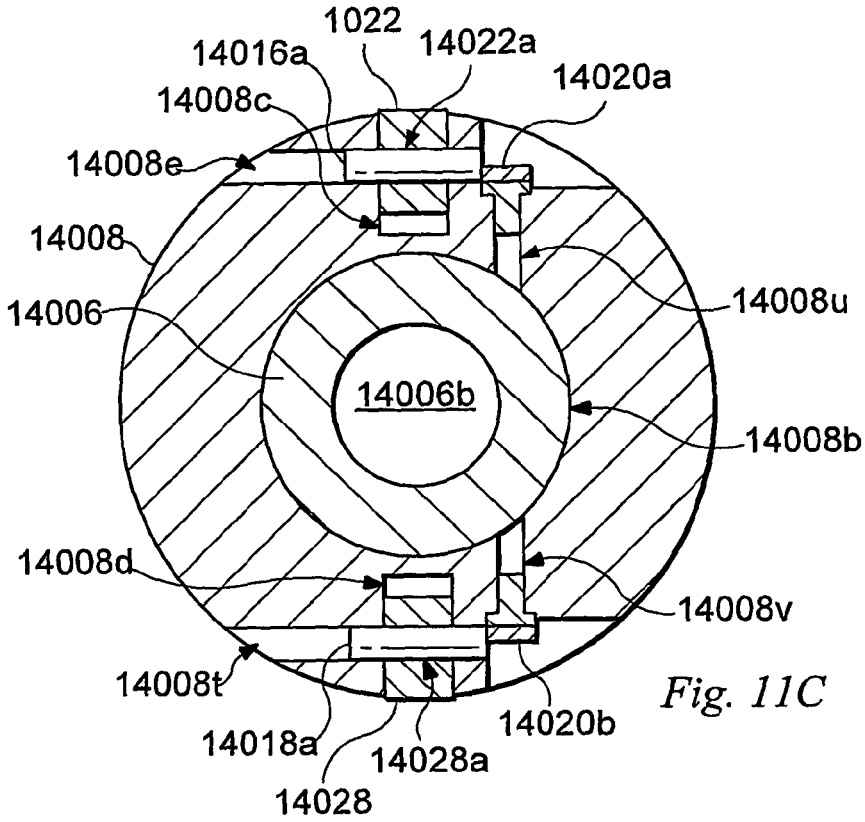
Figure 11D:
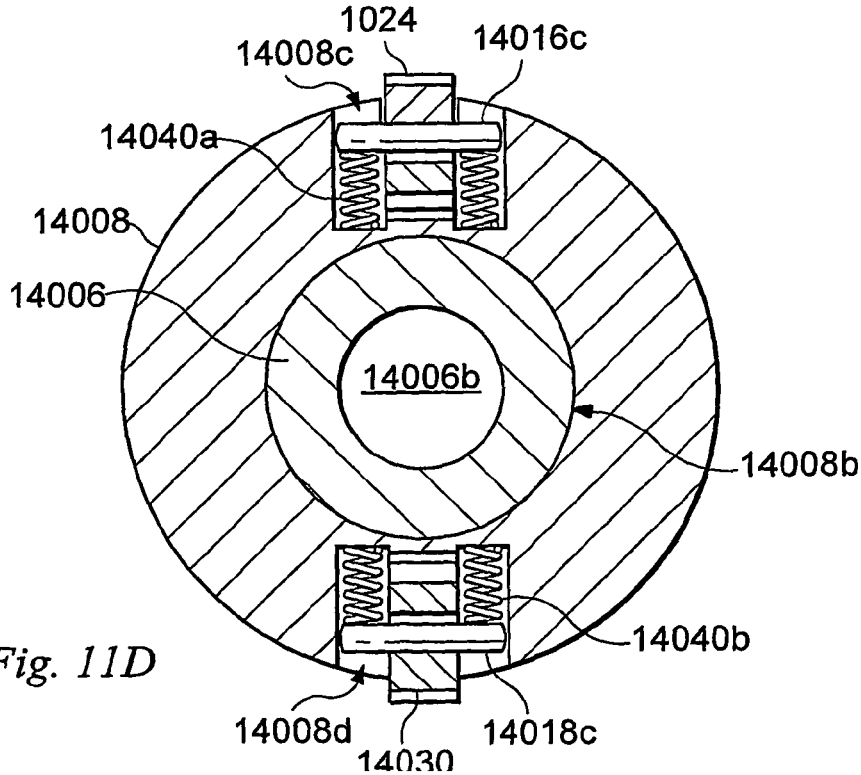
Figure 11E:
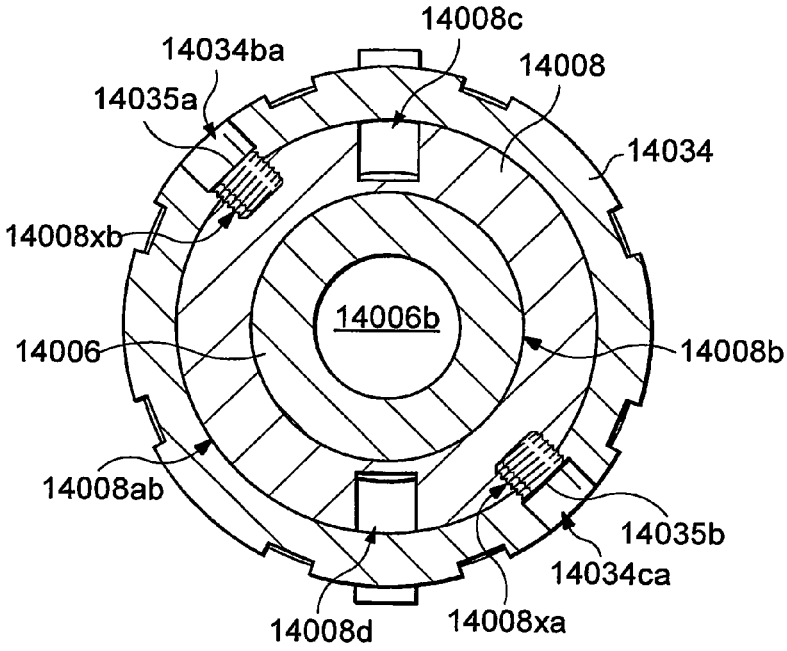
Figure 11F:
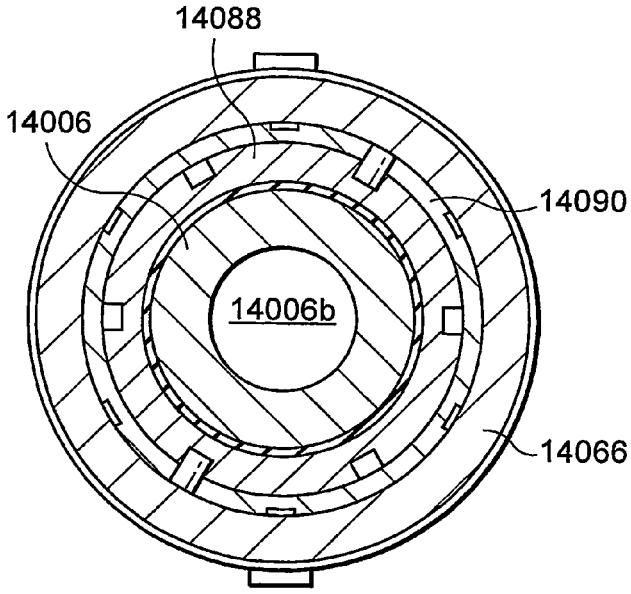
Figure 11G:
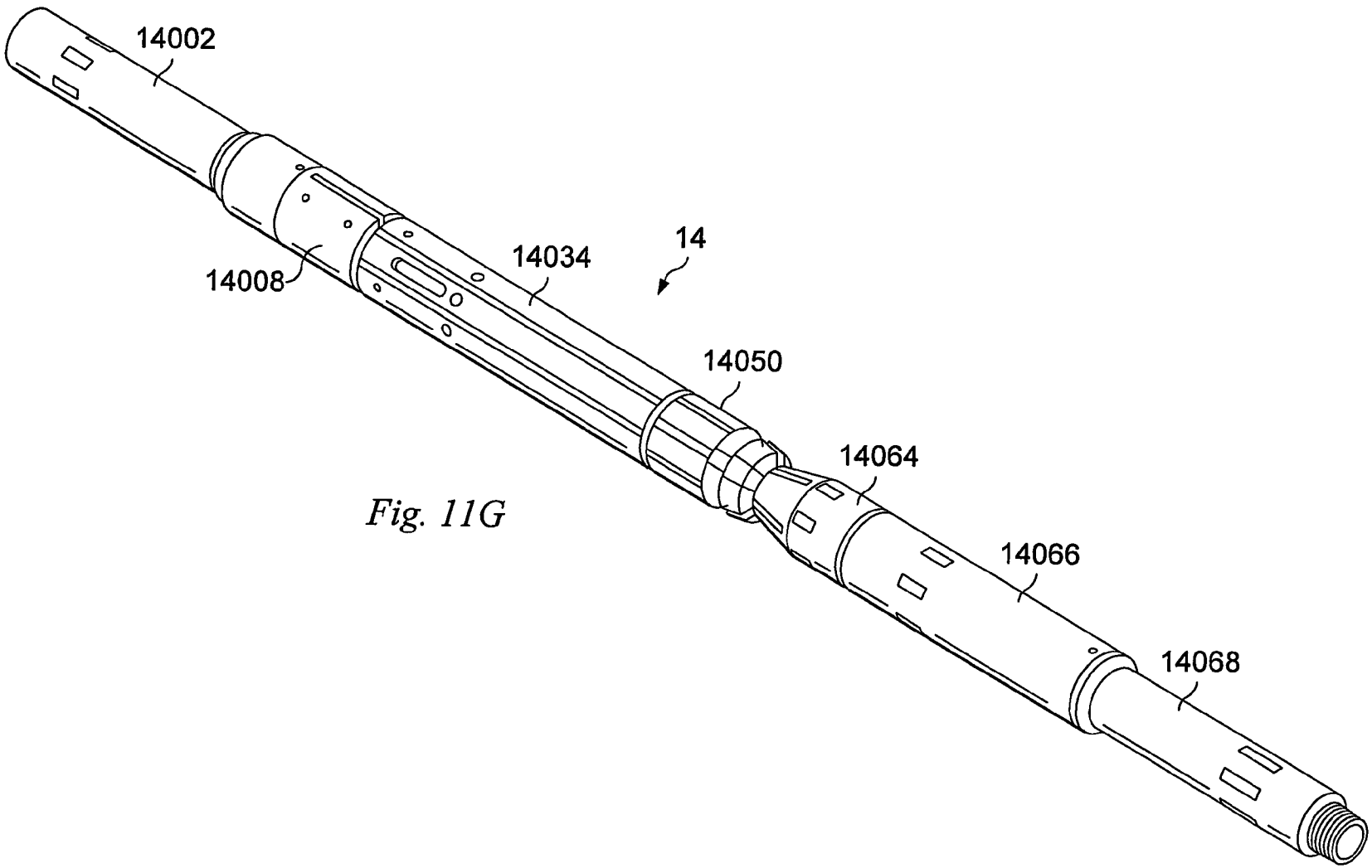
Figure 11H:
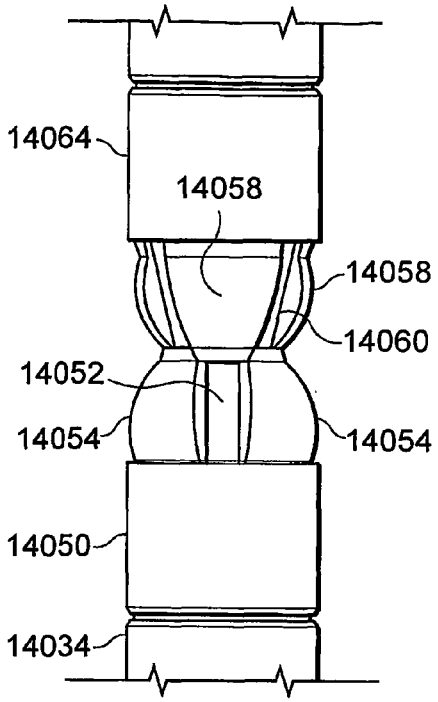
Figure 11I:
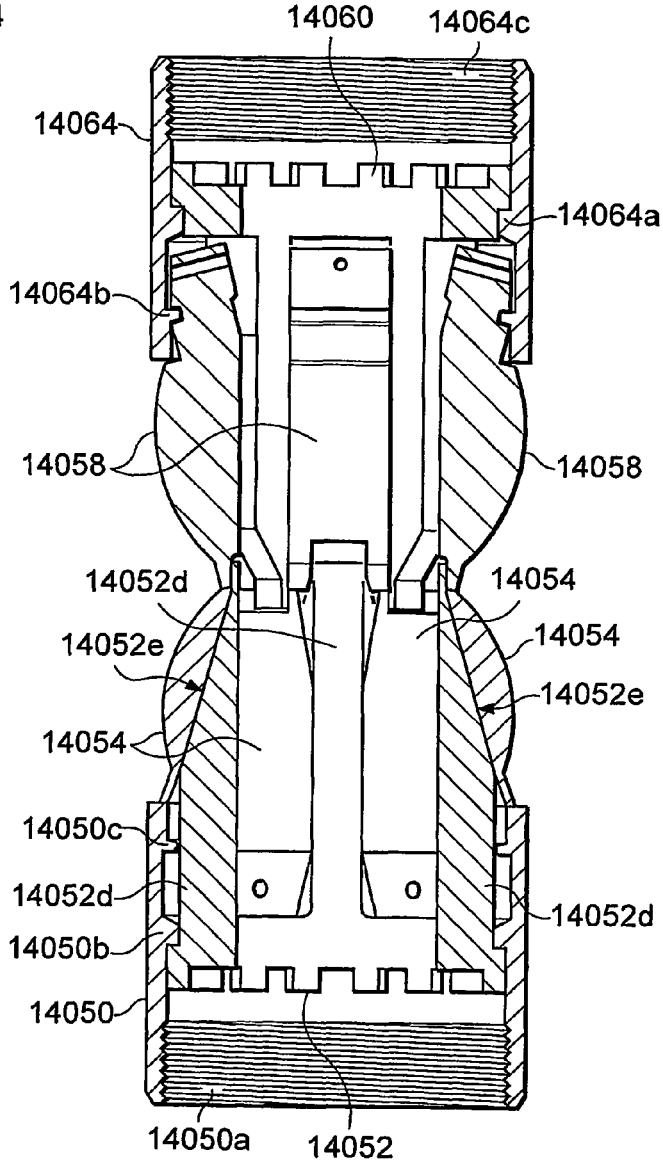
Figure 11J:
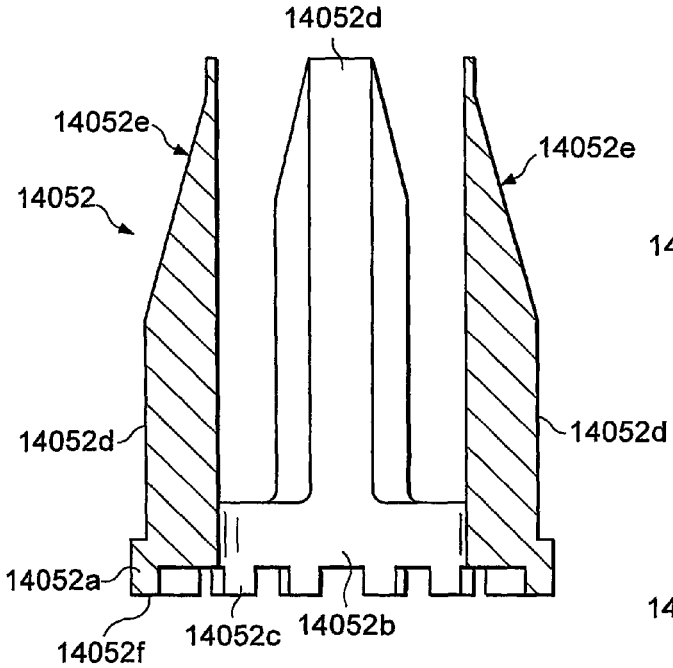
Figure 11K:
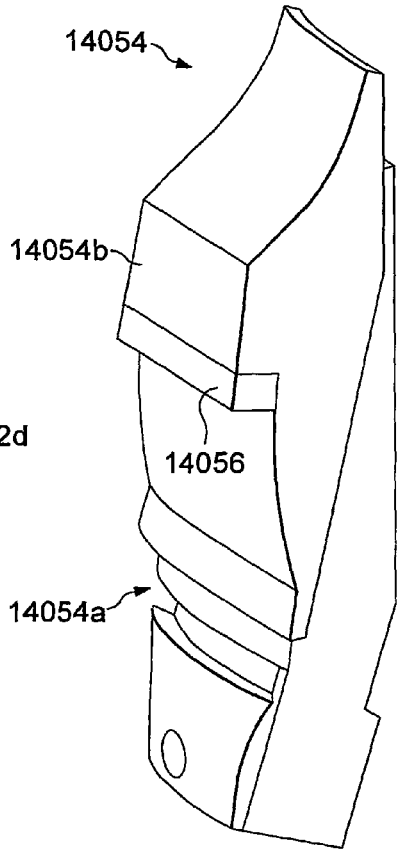
Figure 11M:
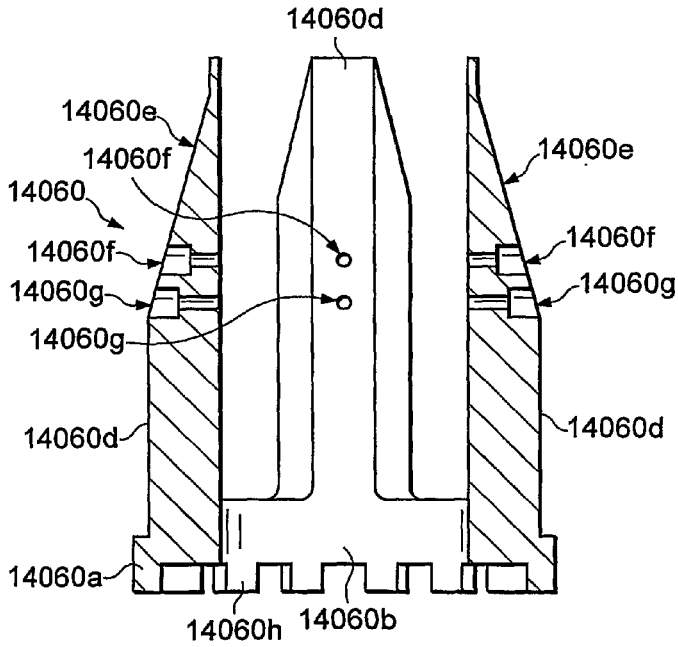
Figure 11L:
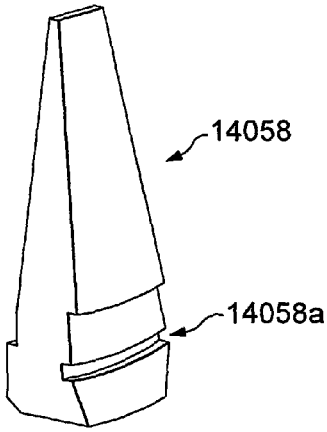
Figure 11N:
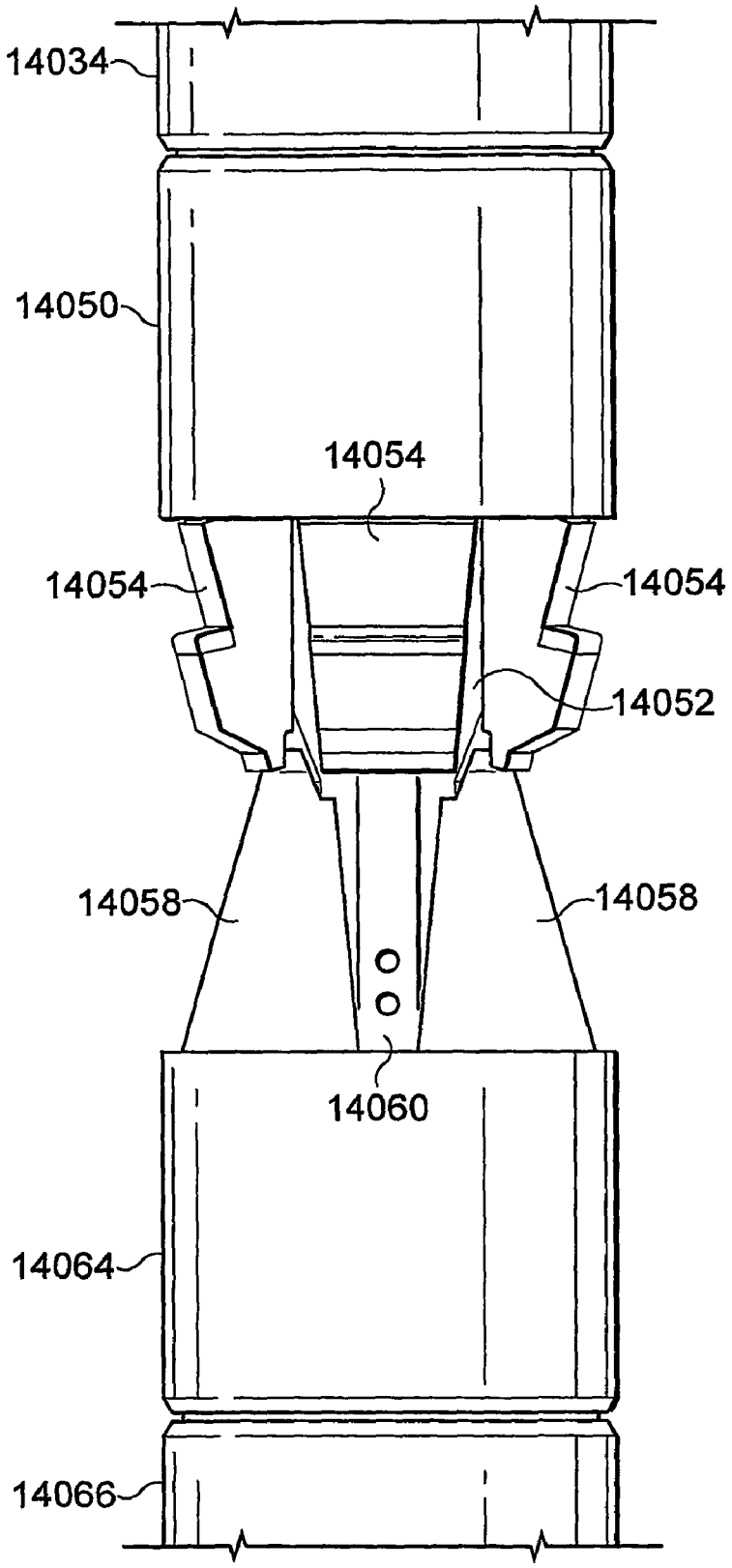
Figure 11O:
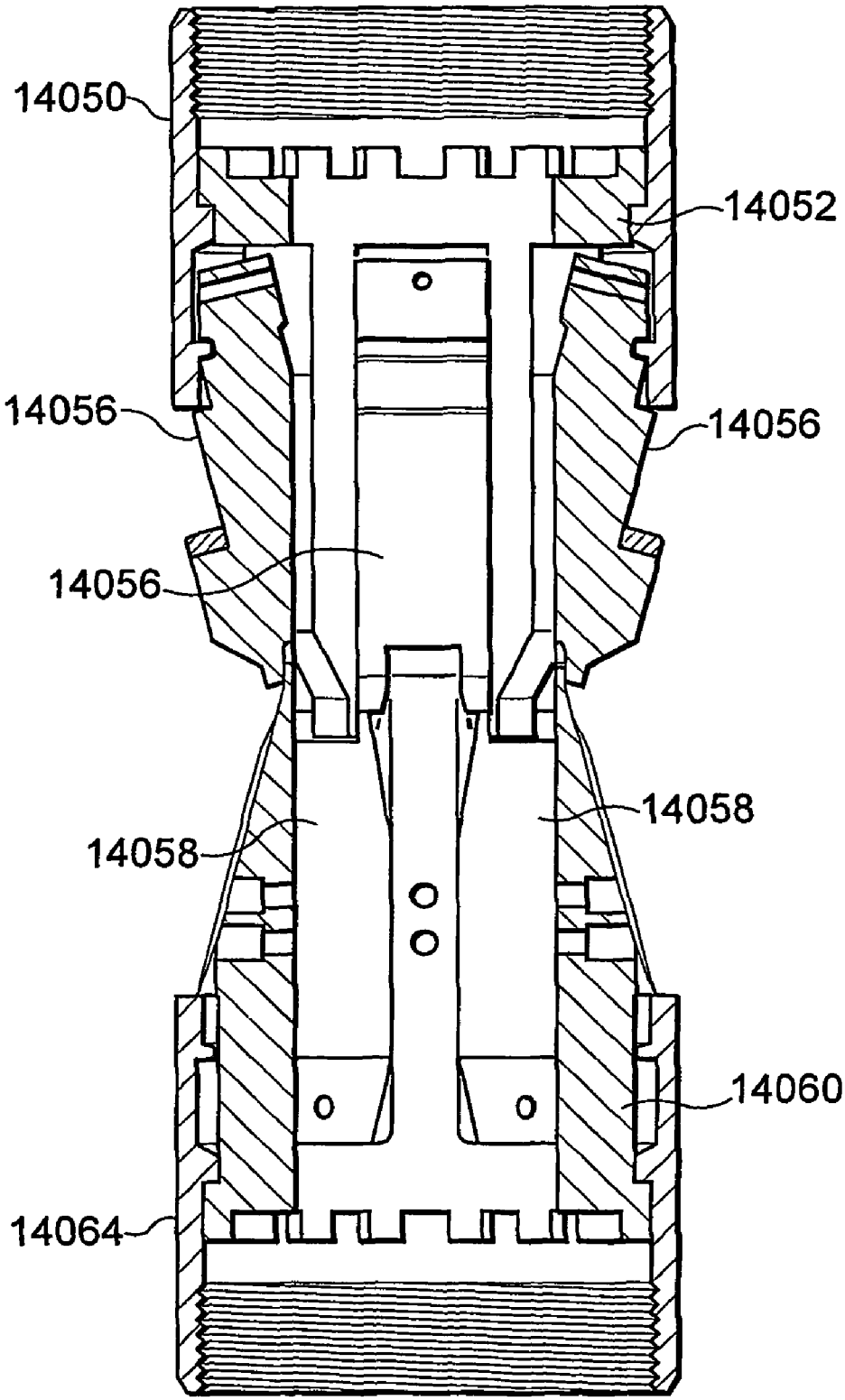
Figure 11P:
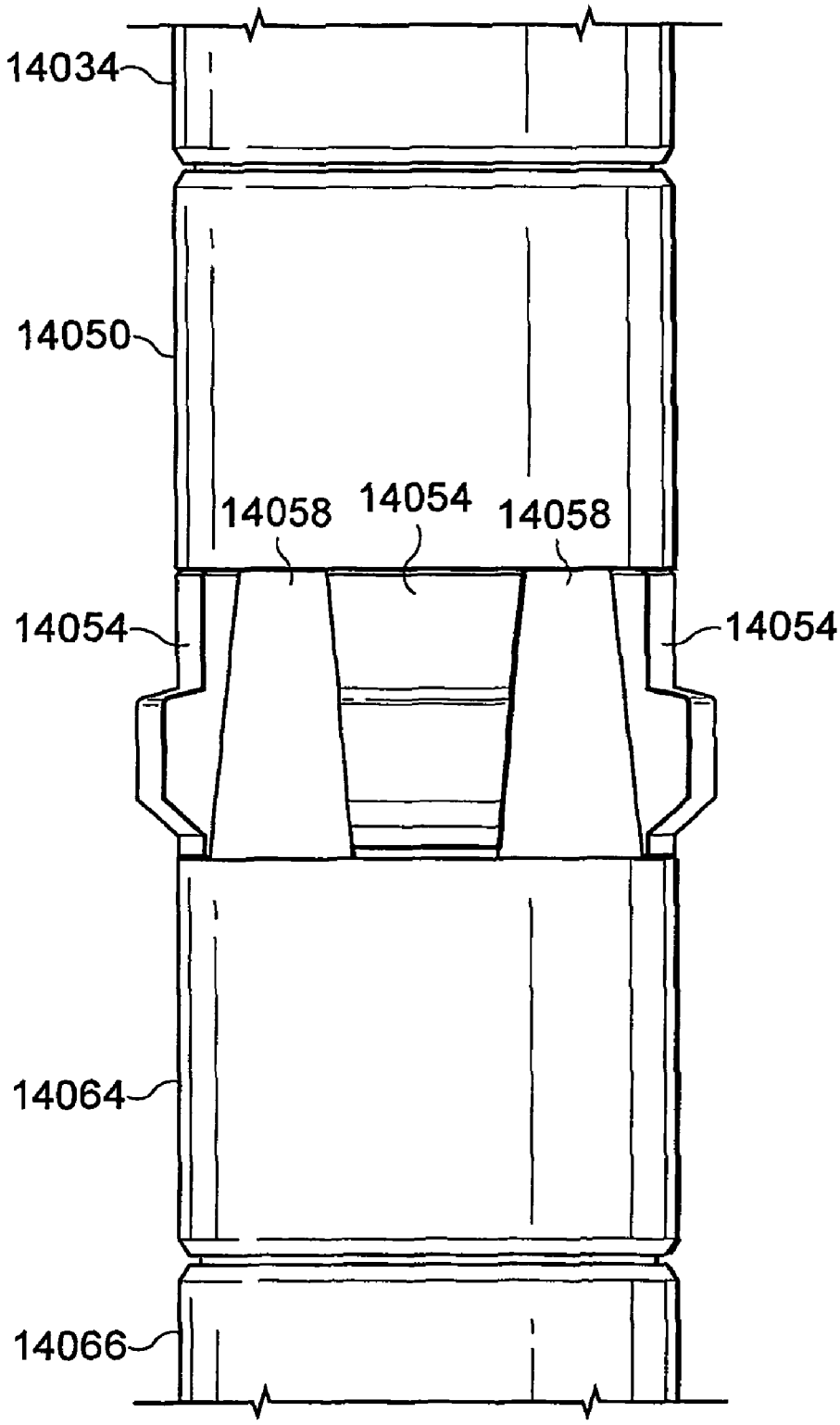
Figure 11Q:
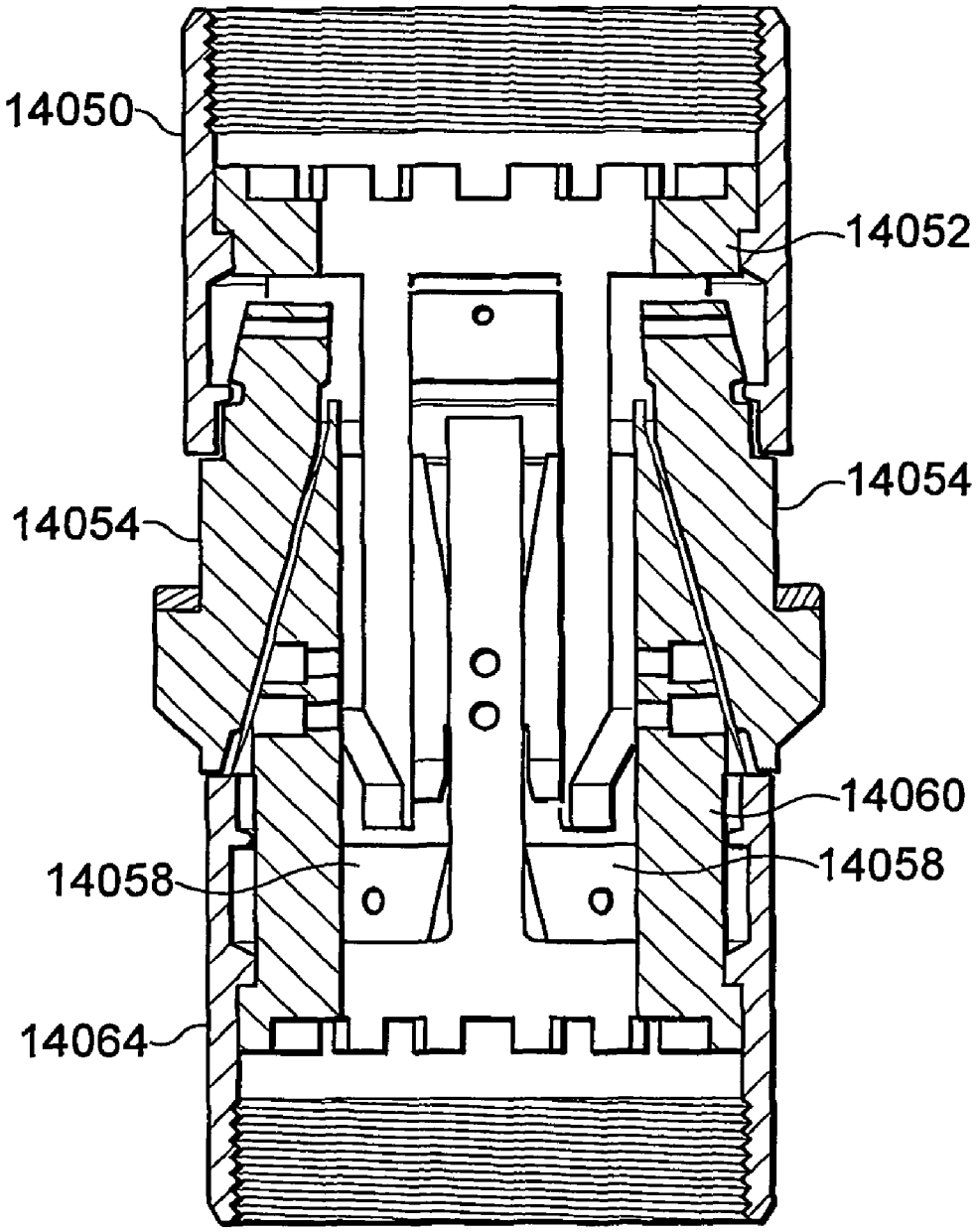
Figure 11R:
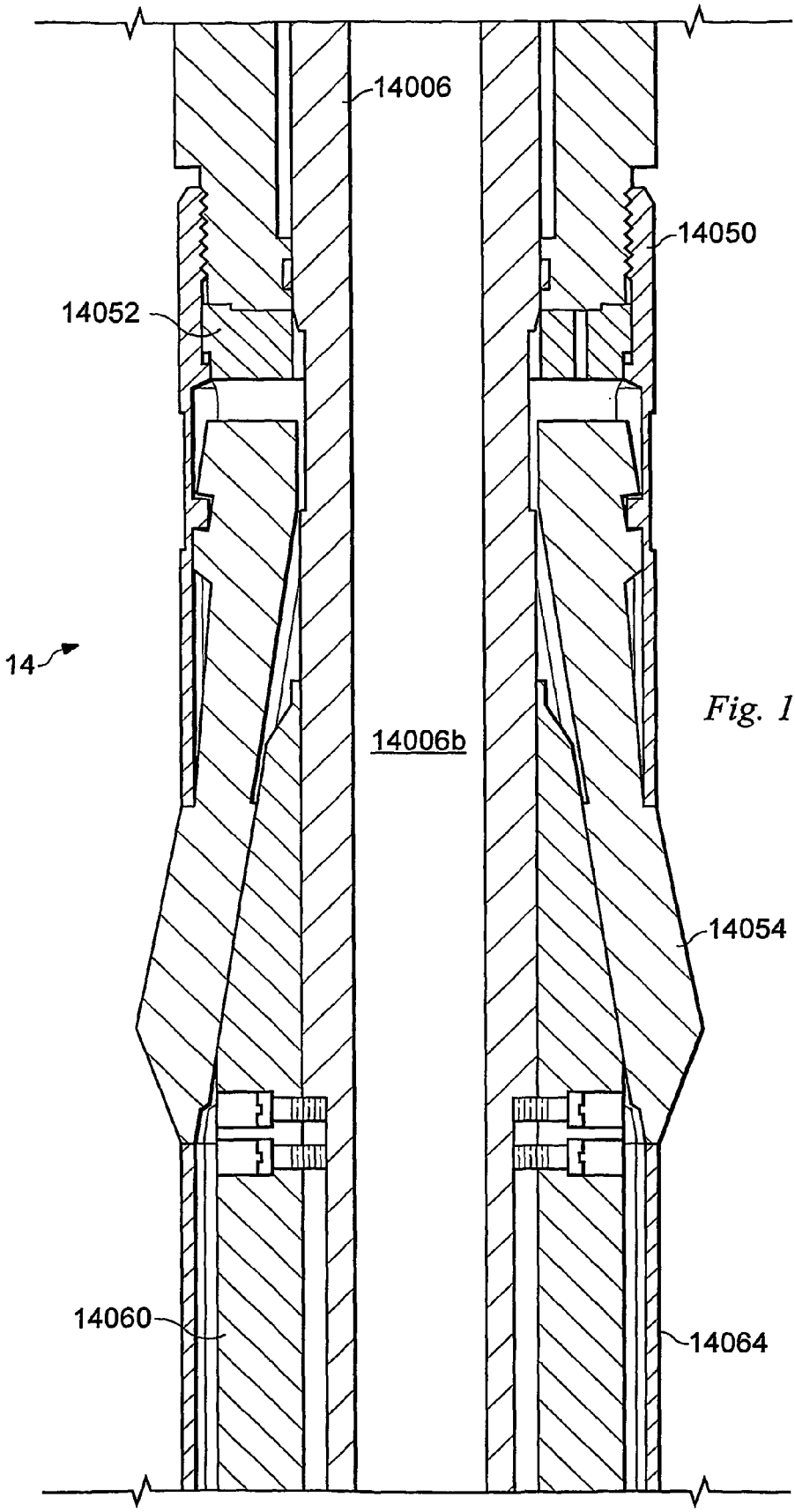
Figure 11S:
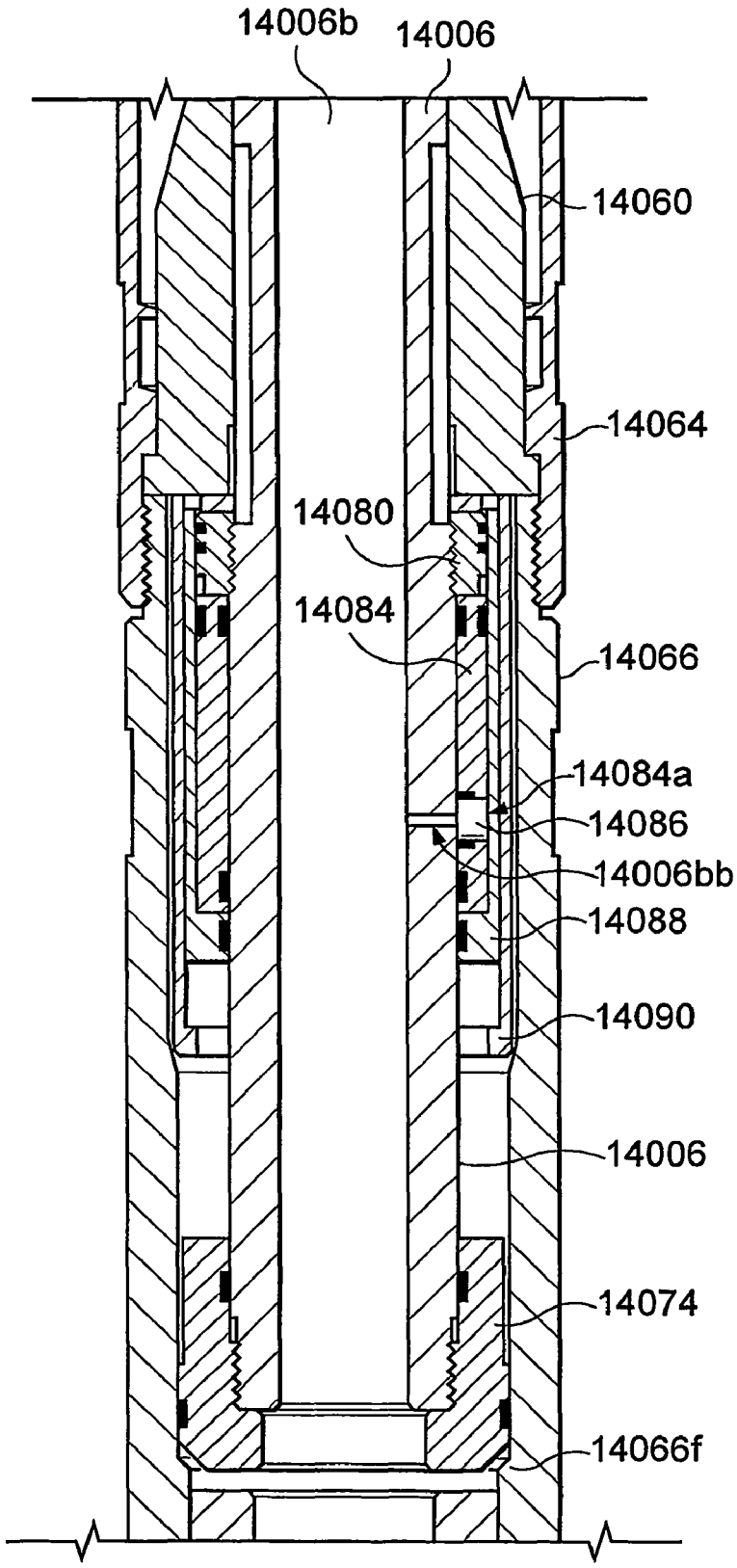

In an exemplary embodiment, as illustrated in FIGS. 11P, 11Q and 11R, the displacement of the upper cam assembly 14052 and upper casing cutter segments 14054 in the direction 14096 will cause the lower casing cutter segments 14058 to ride up the cam surfaces of the cam arms of the upper cam assembly 14052 while also pivoting about the lower tubular hinge segment 14064, and will also cause the upper casing cutter segments 14054 to ride up the cam surfaces of the cam arms of the lower cam assembly 14060 while also pivoting about the upper tubular hinge segment 14050.

In an exemplary embodiment, during the operation of the casing cutter assembly 14, when the upper and lower casing cutter segments, 14054 and 14058, brought into axial alignment in a radially expanded position, the casing cutter elements of the casing cutter segments are brought into intimate contact with the interior surface of a pre-selected portion of the expandable wellbore casing 100. The casing cutter assembly 14 may then be rotated to thereby cause the casing cutter elements to cut through the expandable wellbore casing. The portion of the expandable wellbore casing 100 cut away from the remaining portion on the expandable wellbore casing may then be carried out of the wellbore 102 with the cut away portion of the expandable wellbore casing supported by the casing cutter elements.

In an exemplary embodiment, the upper cam assembly 14052 and the upper casing cutter segments 14054 may be moved out of engagement with the lower casing cutter segments 14058 and the lower cam assembly 14060 by reducing the operating pressure within the annulus 14094.

Figure 11T:
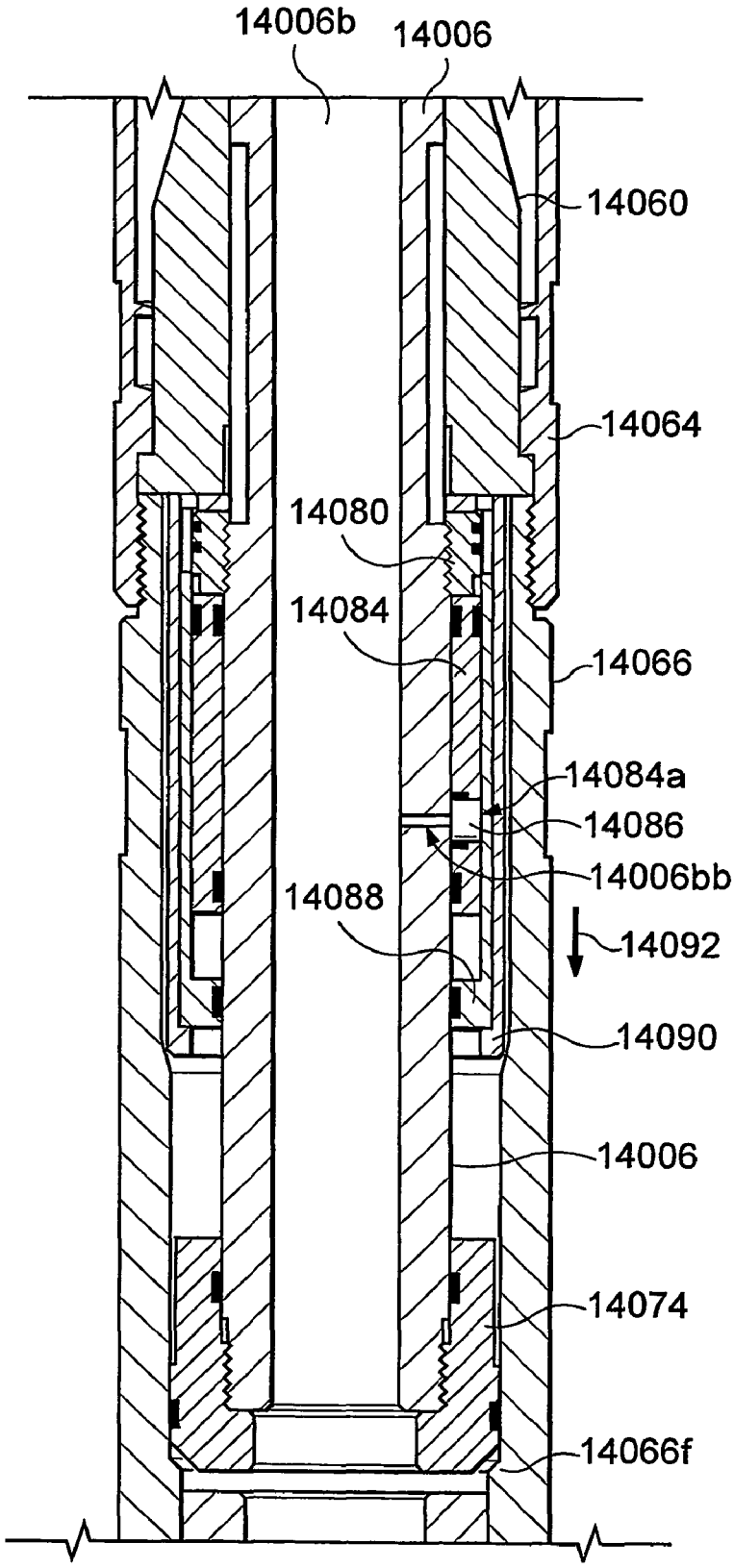

In an alternative embodiment, as illustrated in FIGS. 11S1, 11T, 11U and 11V, during operation of the casing cutter assembly 14, the upper cam assembly 14052 and the upper casing cutter segments 14054 may also be moved out of engagement with the lower casing cutter segments 14058 and the lower cam assembly 14060 by sensing the operating pressure within the longitudinal passage 14006*b* of the lower tubular mandrel 14006. In particular, as illustrated in FIG. 11T, if the operating pressure within the longitudinal passage 14006*b* and radial passage 14006*bb* of the lower tubular mandrel 14006 exceeds a predetermined value, the burst disc 14086 will open the passage 14084*a* thereby pressurizing the interior of the tubular release sleeve 14088 thereby displacing the tubular release sleeve 14088 downwardly in a direction 14092 away from engagement with the locking dogs 14080.

Figure 11U:
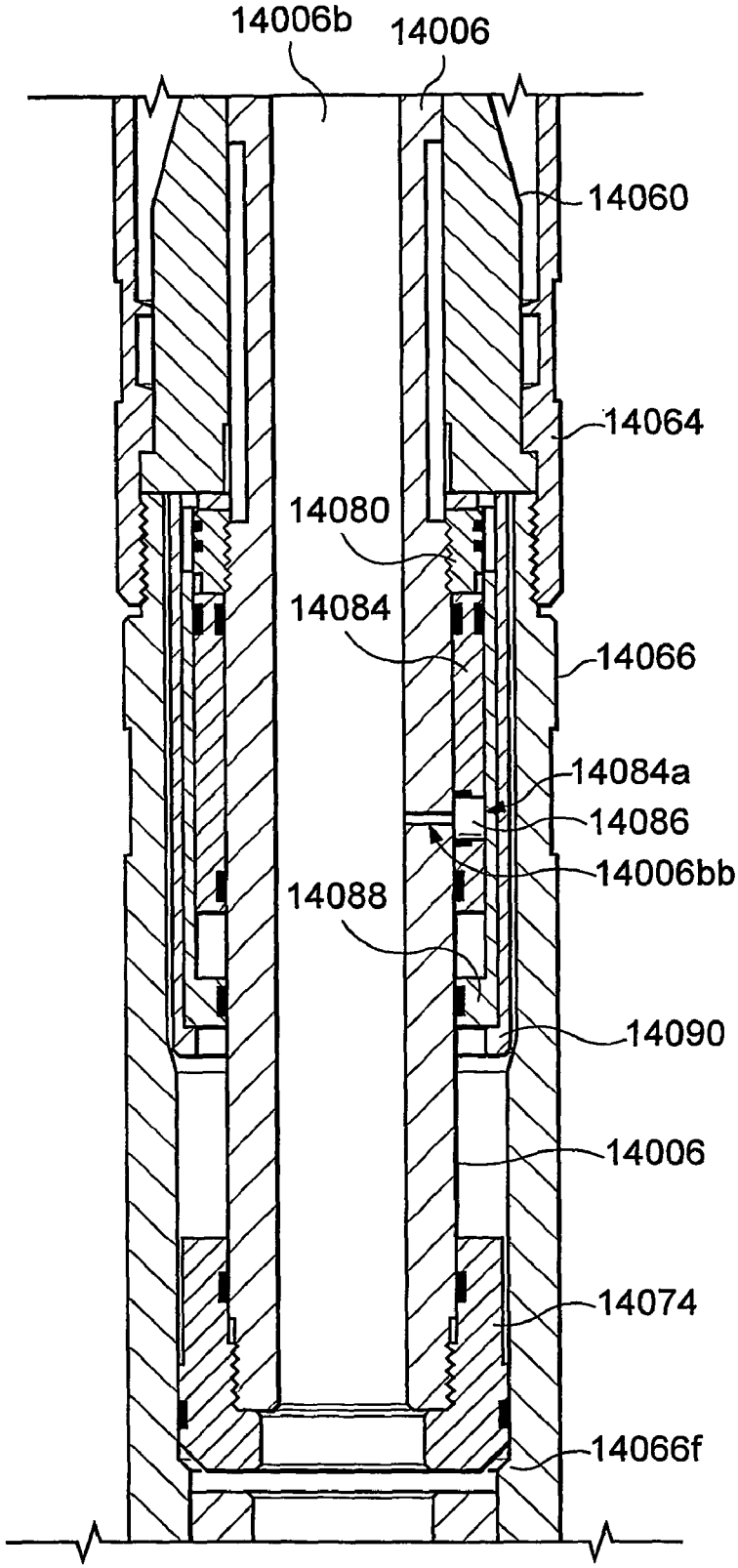

As a result, as illustrated in FIG. 11U, the locking dogs 14080 are displaced outwardly in the radial directed and thereby released from engagement with the lower tubular mandrel 14006 thereby permitting the lower casing cutter segments 14058 and the lower cam assembly 14060 to be displaced downwardly relative to the lower tubular mandrel.

Figure 11V:
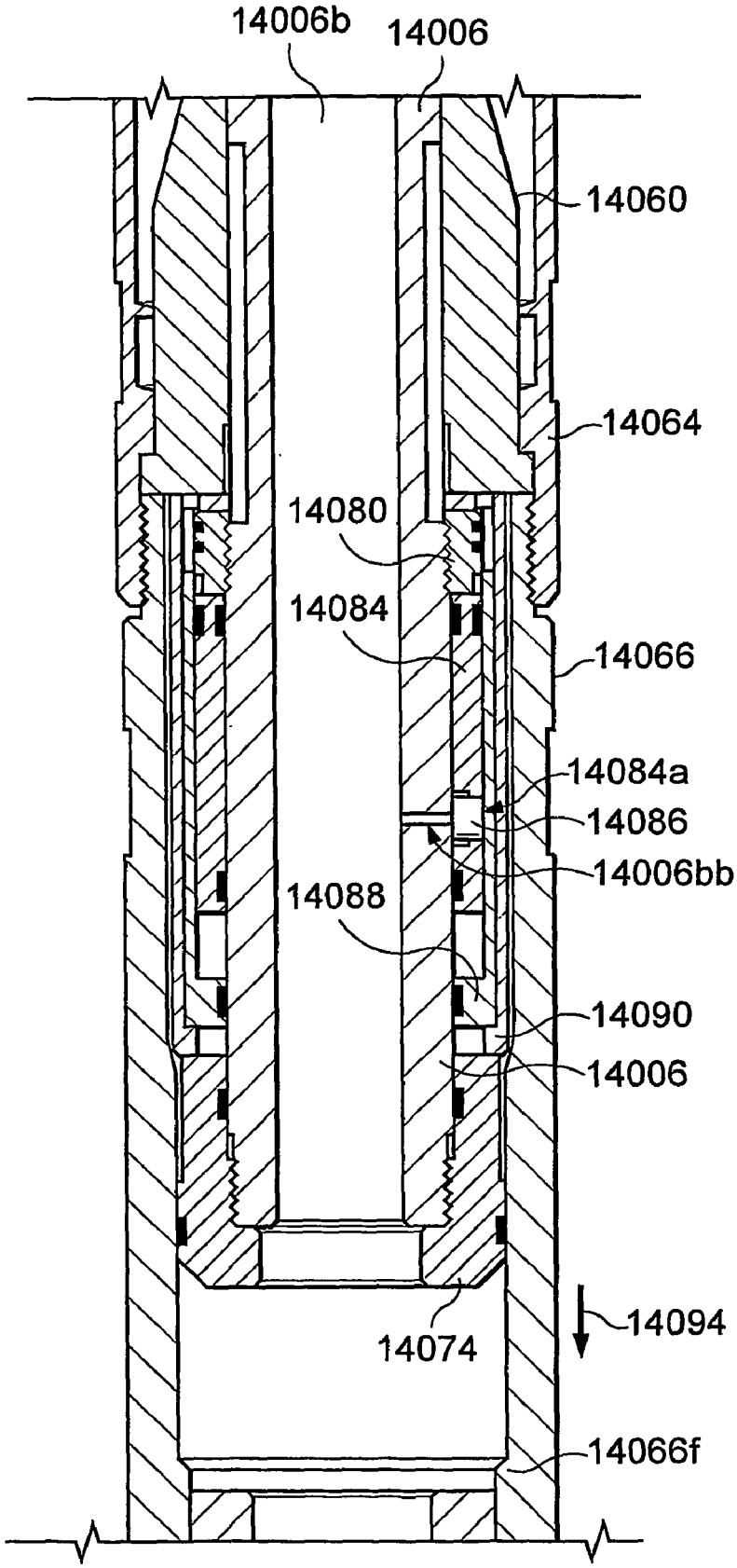

As a result, as illustrated in FIG. 11V, the operating pressure within the lower tubular mandrel 14066 may then cause the lower tubular mandrel to be displaced downwardly in the direction 14094 relative to the tubular lower mandrel 14006 and the retracting piston 14074. As a result, the lower tubular mandrel 14066, the lower casing cutter segments 14058, the lower cam assembly 14060, and tubular lower hinge sleeve 14064 are displaced downwardly in the direction 14094 relative to the tubular spring housing 14034 thereby moving the lower casing cutter segments 14058 and the lower cam assembly 14060 out of engagement with the upper cam assembly 14052 and the upper casing cutter segments 14054.

Figure 11W:
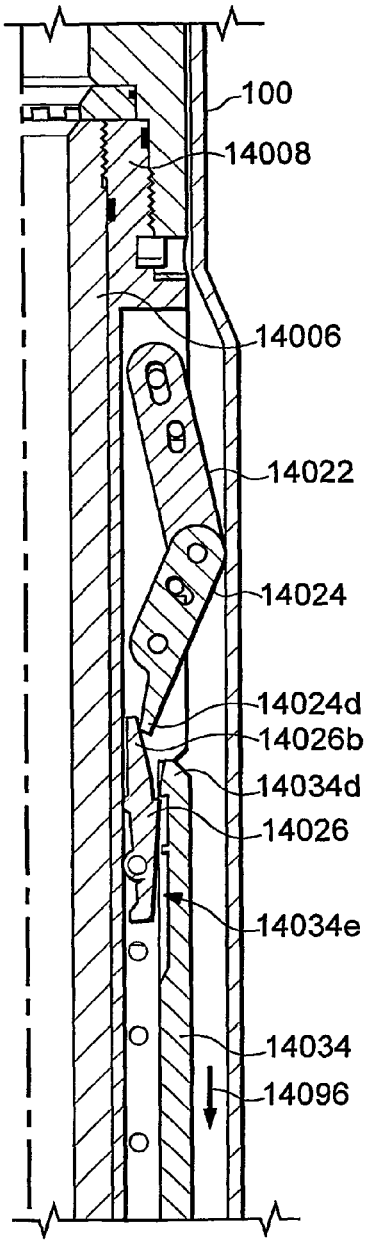
Figure 11X:
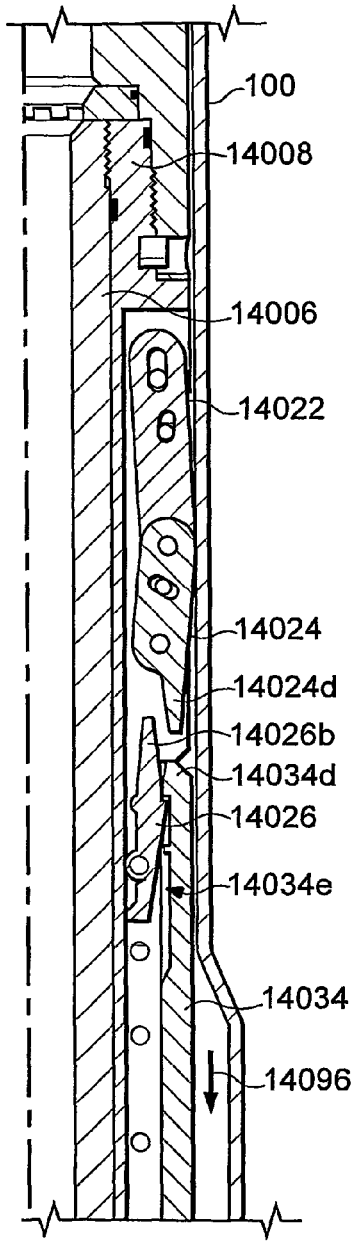
Figure 11Y:
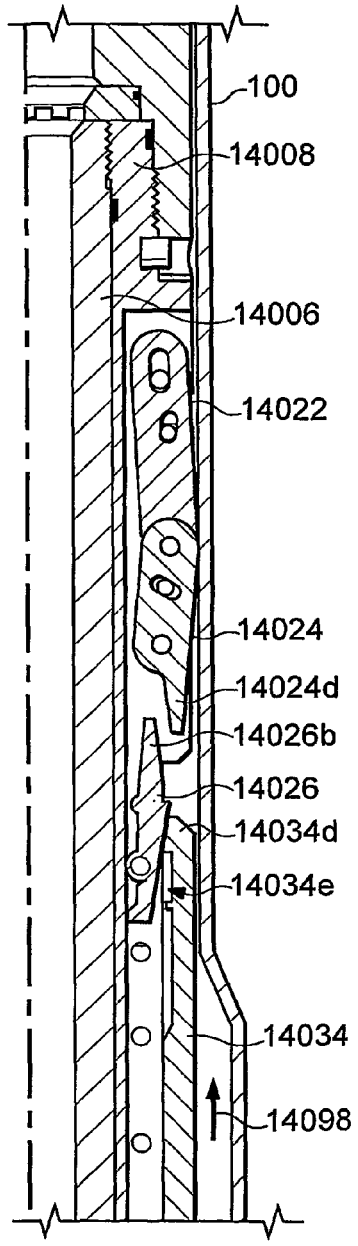

In an exemplary embodiment, as illustrated in FIGS. 11W, 11X, and 11Y, during operation of the casing cutter assembly 14, the casing cutter assembly 14 senses the diameter of the expandable wellbore casing 100 using the upper toggle links, 14022 and 14028, lower toggle links, 14024 and 14030, and triggers, 14026 and 14032, and then prevents the engagement of the upper cam assembly 14052 and the upper casing cutter segments 14054 with the lower casing cutter segments 14058 and the lower cam assembly 14060.

In particular, as illustrated in FIG. 11W, anytime the upper toggle links, 14022 and 14028, and lower toggle links, 14024 and 14030, are positioned within a portion of the expandable wellbore casing 100 that has been radially expanded and plastically deformed by the system 10, the triggers, 14026 and 14032, will be pivoted by the engagement arms, 14024*d* and 14030*d*, of the lower toggle links, 14024 and 14030, to a position in which the triggers will no longer engage the internal flange 14034*d* of the end of the tubular spring housing 14034 thereby permitting the displacement of the tubular spring housing in the direction 14096. As a result, the upper cam assembly 14052 and the upper casing cutter segments 14054 can be brought into engagement with the lower casing cutter segments 14058 and the lower cam assembly 14060. In an exemplary embodiment, the upper toggle links, 14022 and 14028, and the lower toggle links, 14024 and 14030, are spring biased towards the position illustrated in FIG. 11W.

Conversely, as illustrated in FIG. 11X, anytime the upper toggle links, 14022 and 14028, and lower toggle links, 14024 and 14030, are positioned within a portion of the expandable wellbore casing 100 that has not been radially expanded and plastically deformed by the system 10, the triggers, 14026 and 14032, will be maintained in a position in which the triggers will engage the internal flange 14034*d* of the end of the tubular spring housing 14034 thereby preventing the displacement of the tubular spring housing in the direction 14096. As a result, the upper cam assembly 14052 and the upper casing cutter segments 14054 cannot be brought into engagement with the lower casing cutter segments 14058 and the lower cam assembly 14060. In an exemplary embodiment, the triggers, 14026 and 14032, are spring biased towards the position illustrated in FIG. 11X.

In an exemplary embodiment, as illustrated in FIG. 11Y, the tubular spring housing 14034 may be displaced upwardly in the direction 14098 even if the upper toggle links, 14022 and 14028, and lower toggle links, 14024 and 14030, are positioned within a portion of the expandable wellbore casing 100 that has not been radially expanded and plastically deformed by the system 10.

In an exemplary embodiment, as illustrated in FIGS. 11Z1 to 11Z4, 11AA1 to 11AA4, 11AB1 to 11AB4, 11AC1 to 11AC4, 11AD, and 11AE, the tubular spring housing 14034 of the casing cutter assembly 14 defines internal annular recesses 14034*k* and 140341, spaced apart by an internal flange 14034*m*, the tubular toggle bushing 14008 defines an external annular recess 14008*ac*, and the casing cutter assembly further includes pins, 14100*a* and 14100*b* and 14102*a* and 14102*b*, mounted in holes 14008*j* and 14008*o* and 14008*k* and 14008*n*, respectively, of the tubular toggle bushing, and a one-shot deactivation device 14104 mounted on the tubular toggle bushing between the pins, 14100*a* and 14100*b* and 14102*a* and 14102*b*.

The one-shot deactivation device 14104 includes a tubular body 14104*a* that defines radial holes, 14104*b* and 14014*c*, and includes an external annular recess 14104*d* at one end, a centrally positioned external flange 14104*e*, a centrally positioned internal annular recess 14104*f*, and an external annular recess 14104*g* at another end. An engagement member 14106 that includes a base member 14106*a* having a tapered end 14106*b* and a key member 14106*c* having a tapered end 14106*d* is received within a portion of the internal annular recess 14104*f* of the tubular body 14104*a* and an engagement member 14108 that includes a base member 14108*a* having a tapered end 14108*b* and a key member 14108*c* having a tapered end 14108*d* is received within an opposite portion of the internal annular recess 14104*f* of the tubular body 14104*a*. Spring members, 14110 and 14112, are received within the annular recess 14104*f* of the tubular body 14104*a* for biasing the base members, base member 14106*a* and 14108*a*, of the engagement members, 14106 and 14108, respectively, radially inwardly relative to the tubular body 14104*a*.

In an exemplary embodiment, during operation of the casing cutter assembly 14, as illustrated in FIGS. 11Z1 to 11Z4, the one-shot deactivation device 14104 are positioned proximate and in intimate contact with the pins, 14102*a* and 14102*b*, with the tapered ends, 14106*b* and 14108*b*, of the base members, 14106*a* and 14108*a*, of the engagement members, 14106 and 14108, received within the external annular recess 14008*ac* of the tubular toggle bushing 14008. When the one-shot deactivation device 14104 is positioned as illustrated in FIG. 11Z, the external annular recess 14104*d* of the tubular body 14104*a* of the one-shot deactivation device is moved out of engagement with the engagement arms, 14026*d* and 14032*d*, of the triggers, 14026 and 14032, respectively. As a result, the triggers, 14026 and 14032, may operate normally as described above with reference to FIGS. 11W, 11X, and 11Y.

Figure 11A:
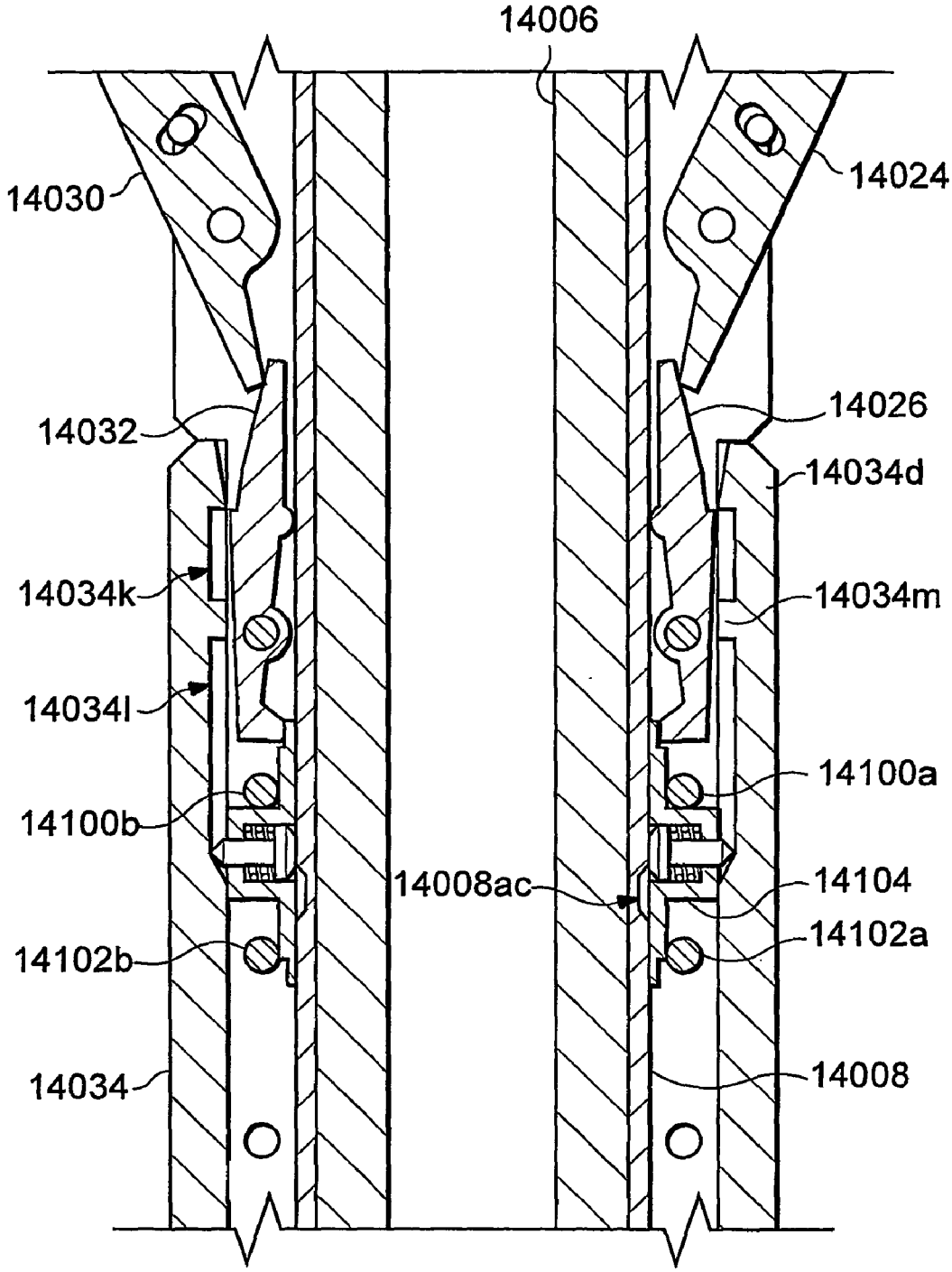
Figure 11A:
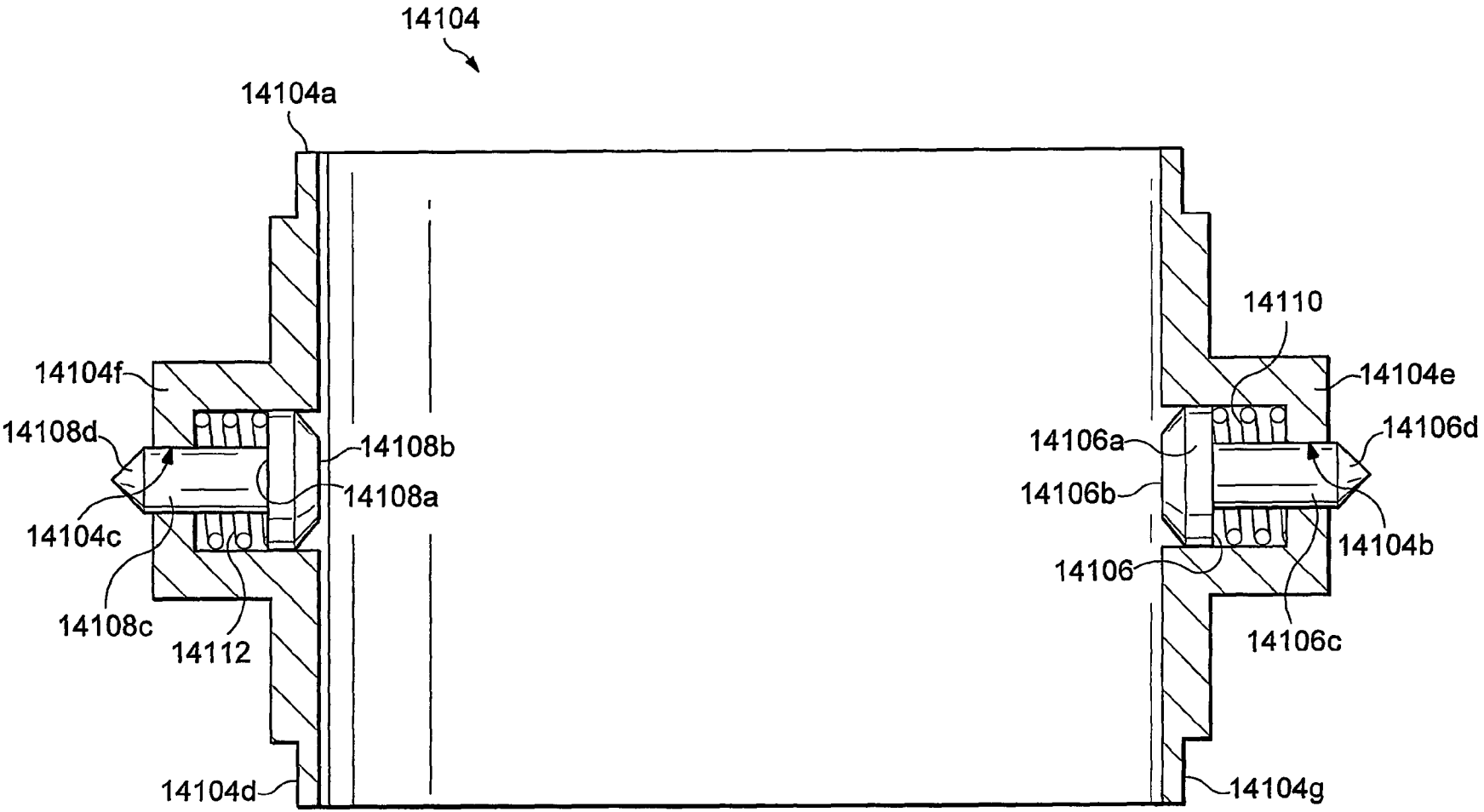

Conversely, in an exemplary embodiment, during operation of the casing cutter assembly 14, as illustrated in FIGS. 11AA1 to 11AA4, the one-shot deactivation device 14104 are positioned proximate and in intimate contact with the pins, 14100*a* and 14100*b*, with the tapered ends, 14106*b* and 14108*b*, of the base members, 14106*a* and 14108*a*, of the engagement members, 14106 and 14108, not received within the external annular recess 14008*ac* of the tubular toggle bushing 14008. When the one-shot deactivation device 14104 is positioned as illustrated in FIGS. 11AA1 to 11AA4, the external annular recess 14104*d* of the tubular body 14104*a* of the one-shot deactivation device is moved into engagement with the engagement arms, 14026*d* and 14032*d*, of the triggers, 14026 and 14032, respectively. As a result, the triggers, 14026 and 14032, are deactivated and may not operate normally as described above with reference to FIGS. 11W, 11X, and 11Y.

In an alternative embodiment, the elements of the casing cutter assembly 14 that sense the diameter of the expandable wellbore casing 100 may be disabled or omitted or adjusted to sense any pre-selected internal diameter of the expandable wellbore casing.

In an exemplary embodiment, the ball gripper assembly 16 is provided and operates substantially, at least in part, as disclosed in one or more of the following: (1) PCT patent application serial number PCT/US03/29859, filed on Sep. 22, 2003, (2) PCT patent application serial number PCT/US03/14153, filed on Nov. 13, 2003, and/or (3) PCT patent application serial number PCT/US04/07711, filed on Mar. 11, 2004, and/or (4) PCT patent application serial number PCT/US04/09434, filed on Mar. 26, 2004, and/or (5) PCT patent application serial number PCT/US04/10317, filed on Apr. 2, 2004, and/or (6) PCT patent application serial number PCT/US04/10712, filed on Apr. 7, 2004, and/or (7) PCT patent application serial number PCT/US04/10762, filed on Apr. 6, 2004, the disclosures of which are incorporated herein by reference.

In an exemplary embodiment, as illustrated in FIGS. 12A1 to 12A4, 12B and 12C1 to 12C4, the ball gripper assembly 16 includes an upper mandrel 1602 that defines a longitudinal passage 1602*a* and a radial passage 1602*b* and includes an internal threaded connection 1602*c* at one end, an external flange 1602*d* at an intermediate portion that includes an external annular recess 1602*e* having a shoulder 1602*f* and an external radial hole 1602*g*, an external annular recess 1602*h*, an external annular recess 1602*i*, an external annular recess 1602*j* having a tapered end 1602*k* including an external annular recess 1602*ka*, an external annular recess 1602*l*, and an external annular recess 1602*m*, and an external annular recess 1602*n*, an external radial hole 1602*o*, an external annular recess 1602*p*, and an external annular recess 1602*q* at another end.

An upper tubular bushing 1604 defines an internally threaded radial opening 1604*a* and includes an external flange 1604*b* having an external annular recess 1604*c* and an internal annular recess 1604*d* mates with and receives the external flange 1602*d* of the upper mandrel 1602. In particular, the internal annular recess 1604*d* of the upper tubular bushing 1604 mates with the shoulder 1602*f* of the external annular recess 1602*e* of the upper mandrel 1602. A screw 1606 that is threadably coupled to the internally threaded radial opening 1604*a* of the upper tubular bushing 1604 extends into the external radial hole 1602*g* of the external flange 1602*d* of the upper mandrel 1602.

A deactivation tubular sleeve 1608 defines a radial passage 1608*a* and includes an internal annular recess 1608*b* that mates with and receives an end of the external annular recess 1604*c* of the external flange 1604*b* of the upper tubular bushing 1604, an internal annular recess 1608*c* that mates with and receives the external flange 1602*d* of the upper mandrel 1602, an internal annular recess 1608*d*, an internal annular recess 1608*e*, and an internal annular recess 1608*f*. A deactivation spring 1610 is received within an annulus 1612 defined between the internal annular recess 1608*b* of the deactivation tubular sleeve 1608, an end face of the external annular recess 1604*c* of the external flange 1604*b* of the upper tubular bushing 1604, and the external annular recess 1602*h* of the external flange 1602*d* of the upper mandrel 1602.

A sealing member 1614 is received with the external annular recess 1602*i* of the external flange 1602*d* of the upper mandrel 1602 for sealing the interface between the upper mandrel and the deactivation tubular sleeve 1608. An annular spacer element 1616 is received within the external annular recess 1602*ka* of the tapered end 1602*k* of the external annular recess 1602*l* of the upper mandrel 1602.

One or more inner engagement elements 1618*a* of a tubular coglet 1618 engage and are received within the external annular recess 1602*ka* of the tapered end 1602*k* of the external annular recess 1602*j* of the upper mandrel 1602 and one or more outer engagement elements 1618*b* of the coglet engage and are received within the internal annular recess 1608*d* of the deactivation tubular sleeve 1608.

An external annular recess 1620*a* of an end of a tubular coglet prop 1620 that includes an inner flange 1620*b* receives and mates with the inner surfaces of the outer engagement elements 1618*b* of the coglet 1618. The end of the tubular coglet prop 1620 further receives and mates with the external annular recess 1602*j* of the external flange 1602*d* of the upper mandrel 1602. A sealing element 1622 is received within the external annular recess 16021 of the upper mandrel 1602 for sealing the interface between the upper mandrel and the tubular coglet prop 1620.

An end of a tubular bumper sleeve 1624 that includes internal and external flanges, 1624*a* and 1624*b*, and a hole 1624*c* at another end mates with and receives the external annular recess 1602*m* of the external flange 1602*d* of the upper mandrel 1602. A coglet spring 1626 is received within an annulus 1628 defined between the external annular recess 1602*m* of the external flange 1602*d* of the upper mandrel 1602, the tubular coglet prop 1620, the inner flange 1620*b* of the tubular coglet prop, an end face of the tubular bumper sleeve 1624, and the internal annular recess 1608*c* of the deactivation tubular sleeve 1608.

A tubular ball race 1628 that defines a plurality of tapered annular recesses 1628*a* and an internally threaded radial opening 1628*b* and includes one or more axial engagement elements 1628*c* at one end and one or more axial engagement elements 1628*d* at another end receives and mates with the other end of the upper mandrel 1602. In an exemplary embodiment, the axial engagement elements 1628*c* of the tubular ball race 1628 are received within and are coupled to the hole 1624*c* of the tubular bumper sleeve 1624. An end of a tubular activation sleeve 1630 that defines a plurality of radial openings 1630*a*, a radial opening 1630*b*, a radial opening 1630*c*, and includes an internal annular recess 1630*d* receives and mates with the tubular ball race 1628. In an exemplary embodiment, an end face of an end of the tubular activation sleeve 1630 is positioned proximate and in opposing relation to an end face of an end of the deactivation sleeve 1608. In an exemplary embodiment, the radial openings 1630*a* are aligned with and positioned in opposing relation to corresponding of tapered annular recesses 1628*a* of the tubular ball race 1628, and the radial openings are also narrowed in cross section in the radial direction for reasons to be described.

Balls 1632 are received within each of the of tapered annular recesses 1628*a* and corresponding radial openings 1630*a* of the tubular ball race 1628 and tubular activation sleeve 1630, respectively. In an exemplary embodiment, the narrowed cross sections of the radial openings 1630*a* of the tubular activation sleeve 1630 will permit the balls 1632 to be displaced outwardly in the radial direction until at least a portion of the balls extends beyond the outer perimeter of the tubular activation sleeve to thereby permit engagement of the balls with an outer structure such as, for example, a wellbore casing.

A lower mandrel 1634 that defines a longitudinal passage 1634*a* and an internally threaded radial passage 1634*b* at one end and includes internal annular recesses, 1634*c* and 1634*d*, for receiving and mating with the external annular recesses, 1602*p* and 1602*q*, of the upper mandrel 1602, an internal annular recess 1634*e*, an external flange 1634*f*, and an externally threaded connection 1634*g* at another end. In an exemplary embodiment, as illustrated in FIG. 12B, the end of the lower mandrel 1634 further includes longitudinal recesses 1634*h* for receiving and mating with corresponding axial engagement elements 1628*d* of the tubular ball race 1628. A sealing element 1635 is received within the internal annular recess 1634*d* of the lower mandrel 1634 for sealing an interface between the lower mandrel and the external annular recess 1602*p* of the upper mandrel 1602.

A tubular spring retainer 1636 that defines a radial passage 1636*a* and includes an external annular recess 1636*b* at one end mates with and receives the end of the lower mandrel 1634 and is positioned proximate an end face of the external flange 1634*f* of the lower mandrel. A tubular spring retainer 1638 receives and mates with the end of the lower mandrel 1634 and is received and mates with the internal annular recess 1630*d* of the tubular activation sleeve 1630.

An activation spring 1640 is received within an annulus 1642 defined an end face of the tubular spring retainer 1638, an end face of the spring retainer 1636, the internal annular recess 1630*d* of the tubular activation sleeve 1630, and the end of the lower mandrel 1634. A retainer screw 1642 is received within and is threadably coupled to the internally threaded radial opening 1634*b* of the lower mandrel 1634 that also extends into the external radial hole 1602*o* of the upper mandrel 1602.

During operation of the ball gripper assembly 16, in an exemplary embodiment, as illustrated in FIGS. 12A1 to 12A4, the ball gripper assembly may be positioned within the expandable wellbore casing 100 and the internally threaded connection 1602*c* of the upper mandrel 1602 may be coupled to an externally threaded connection 14*a* of an end of the casing cutter assembly 14 and the externally threaded connection 1634*g* of the lower mandrel 1634 may be coupled to an internally threaded connection 18*a* of an end of the tension actuator assembly 18.

In an alternative embodiment, the internally threaded connection 1602*c* of the upper mandrel 1602 may be coupled to an externally threaded connection of an end of the tension actuator assembly 18 and the externally threaded connection 1634*g* of the lower mandrel 1634 may be coupled to an internally threaded connection of an end of casing cutter assembly 14.

In an exemplary embodiment, the deactivation spring 1610 has a greater spring rate than the activation spring 1640. As a result, in an initial operating mode, as illustrated in FIGS. 12A1 to 12A4, a biasing spring force is applied to the deactivation sleeve 1608 and activation sleeve 1630 in a direction 1644 that maintains the activation sleeve in a position relative to the tubular ball race 1628 that maintains the balls 1632 within the radially inward portions of the corresponding tapered annular recesses 1628*a* of the tubular ball race such that the balls do not extend beyond the perimeter of the activation sleeve to engage the expandable wellbore casing 100.

As illustrated in FIGS. 12C1 to 12C4, in an exemplary embodiment, the ball gripper 16 may be operated to engage the interior surface of the expandable wellbore casing 100 by injecting a fluidic material 1650 into the ball gripper assembly through the longitudinal passages 1602*a* and 1634*aa*, of the upper and lower mandrels, 1602 and 1634, respectively.

In particular, when the longitudinal and radial passages, 1602*a* and 1602*b*, respectively, of the upper mandrel 1602 are pressurized by the injection of the fluidic material 1650, the internal annular recess 1608*c* of the deactivation tubular sleeve 1608 is pressurized. When the operating pressure of the fluidic material 1650 within the internal annular recess 1608*c* of the deactivation tubular sleeve 1608 is sufficient to overcome the biasing spring force of the deactivation spring 1610, the deactivation tubular sleeve is displaced in a direction 1652. As a result, the spring force provided by the activation spring 1640 then may displace the activation tubular sleeve 1630 in the direction 1652 thereby moving the balls 1632 on the corresponding tapered annular recesses 1628*a* of the tubular ball race 1628 outwardly in a radial direction into engagement with the interior surface of the expandable wellbore casing 100. In an exemplary embodiment, the operating pressure of the fluidic material 1650 sufficient to overcome the biasing spring force of the deactivation spring 1610 was about 100 psi.

In an exemplary embodiment, when the operating pressure of the fluidic material 1650 is reduced, the operating pressure of the fluidic material 1650 within the internal annular recess 1608*c* of the deactivation tubular sleeve 1608 is no longer sufficient to overcome the biasing spring force of the deactivation spring 1610, and the deactivation tubular sleeve and the activation tubular sleeve 1630 are displaced in a direction opposite to the direction 1652 thereby moving the balls 1632 radially inwardly and out of engagement with the interior surface of the expandable wellbore casing 100.

In an exemplary embodiment, the ball gripper assembly 16 is operated to engage the interior surface of the expandable wellbore casing 100 in combination with the operation of the tension actuator assembly 18 to apply an upward tensile force to one or more elements of the system 10 coupled to and positioned below the tension actuator assembly. As a result, a reaction force comprising a downward tensile force is applied to the lower mandrel 1634 of the ball gripper assembly 16 in a direction opposite to the direction 1652 during the operation of the tension actuator assembly 18. Consequently, due to the geometry of the tapered 1628*a* of the tubular ball race 1628, the balls 1632 are driven up the tapered annular recesses 1628*a* of the tubular ball race 1628 with increased force and the contact force between the balls 1632 and the interior surface of the expandable wellbore casing 100 is significantly increased thereby correspondingly increasing the gripping force and effect of the ball gripper assembly.

In an exemplary embodiment, the ball gripper assembly 16 may be operated to radially expand and plastically deform discrete portions of the expandable wellbore casing 100 by controlling the amount of contact force applied to the interior surface of the expandable wellbore casing by the balls 1632 of the ball gripper assembly. In an experimental test of an exemplary embodiment of the ball gripper assembly 16, an expandable wellbore casing was radially expanded and plastically deformed. This was an unexpected result.

In an exemplary embodiment, the tension actuator assembly 18 operates and is provided substantially, at least in part, as disclosed in one or more of the following: (1) PCT patent application serial number PCT/US02/36267, filed on Nov. 12, 2002, and/or (2) PCT patent application serial number PCT/US03/29859, filed on Sep. 22, 2003, and/or (3) PCT patent application serial number PCT/US03/14153, filed on Nov. 13, 2003, and/or (4) PCT patent application serial number PCT/US03/29460, filed on Sep. 23, 2003, and/or (5) PCT patent application serial number PCT/US04/07711, filed on Mar. 11, 2004, and/or (6) PCT patent application serial number PCT/US04/09434, filed on Mar. 26, 2004, and/or (7) PCT patent application serial number PCT/US04/10317, filed on Apr. 2, 2004, and/or (8) PCT patent application serial number PCT/US04/10712, filed on Apr. 7, 2004, and/or (9) PCT patent application serial number PCT/US04/10762, filed on Apr. 6, 2004, the disclosures of which are incorporated herein by reference.

In an exemplary embodiment, as illustrated in FIGS. 13A1 to 13A8 and 13B1 to 13B7, the tension actuator assembly 18 includes an upper tubular support member 18002 that defines a longitudinal passage 18002*a*, and external internally threaded radial openings, 18002*b* and 18002*c*, and an external annular recess 18002*d* and includes an internally threaded connection 18002*e* at one end and an external flange 18002*f*, an external annular recess 18002*g* having an externally threaded connection, and an internal annular recess 18002*h* having an internally threaded connection at another end. An end of a tubular actuator barrel 18004 that defines radial passages, 18004*a* and 18004*b*, at one end and radial passages, 18004*c* and 18004*d*, includes an internally threaded connection 18004*e* at one end that mates with, receives, and is threadably coupled to the external annular recess 18002*g* of the upper tubular support member 18002 and abuts and end face of the external flange 18002*f* of the upper tubular support member and an internally threaded connection 18004*f* at another end.

Torsional locking pins, 18006*a* and 18006*b*, are coupled to and mounted within the external radial mounting holes, 18002*b* and 18002*c*, respectively, of the upper tubular support member and received within the radial passages, 18004*a* and 18004*b*, of the end of the tubular actuator barrel 18004. The other end of the tubular actuator barrel 18004 receives and is threadably coupled to an end of a tubular barrel connector 18008 that defines an internal annular recess 18008*a*, external radial mounting holes, 18008*b* and 18008*c*, radial passages, 18008*d* and 18008*e*, and external radial mounting holes, 18008*f* and 18008*g* and includes circumferentially spaced apart teeth 18008*h* at one end. A sealing cartridge 18010 is received within and coupled to the internal annular recess 18008*a* of the tubular barrel connector 18008 for fluidicly sealing the interface between the tubular barrel connector and the sealing cartridge. Torsional locking pins, 18012*a* and 18012*b*, are coupled to and mounted within the external radial mounting holes, 18008*b* and 18008*c*, respectively, of the tubular barrel connector 18008 and received within the radial passages, 18004*c* and 18004*d*, of the tubular actuator barrel 18004.

A tubular member 18014 that defines a longitudinal passage 18014*a* having one or more internal splines 18014*b* at one end and circumferentially spaced apart teeth 18014*c* at another end for engaging the circumferentially spaced apart teeth 18008*h* of the tubular barrel connector 18008 mates with and is received within the actuator barrel 18004 and the one end of the tubular member abuts an end face of the other end of the upper tubular support member 18002 and at another end abuts and end face of the tubular barrel connector 18008. A tubular guide member 18016 that defines a longitudinal passage 18016*a* having a tapered opening 18016*aa*, and radial passages, 18016*b* and 18016*c*, includes an external flange 18016*d* having an externally threaded connection at one end that is received within and coupled to the internal annular recess 18002*h* of the upper tubular support member 18002.

The other end of the tubular barrel connector 18008 is threadably coupled to and is received within an end of a tubular actuator barrel 18018 that defines a longitudinal passage 18018*a*, radial passages, 18018*b* and 18018*c*, and radial passages, 18018*d* and 18018*e*. Torsional locking pins, 18020*a* and 18020*b*, are coupled to and mounted within the external radial mounting holes, 18008*f* and 18008*g*, respectively, of the tubular barrel connector 18008 and received within the radial passages, 18018*b* and 18018*c*, of the tubular actuator barrel 18018. The other end of the tubular actuator barrel 18018 receives and is threadably coupled to an end of a tubular barrel connector 18022 that defines an internal annular recess 18022*a*, external radial mounting holes, 18022*b* and 18022*c*, radial passages, 18022*d* and 18022*e*, and external radial mounting holes, 18022*f* and 18022*g*. A sealing cartridge 18024 is received within and coupled to the internal annular recess 18022*a* of the tubular barrel connector 18022 for fluidicly sealing the interface between the tubular barrel connector and the sealing cartridge. Torsional locking pins, 18024*a* and 18024*b*, are coupled to and mounted within the external radial mounting holes, 18022*b* and 18022*c*, respectively, of the barrel connector 18022 and received within the radial passages, 18018*d* and 18018*e*, of the tubular actuator barrel 18018.

The other end of the tubular barrel connector 18022 is threadably coupled to and is received within an end of a tubular actuator barrel 18026 that defines a longitudinal passage 18026*a*, radial passages, 18026*b* and 18026*c*, and radial passages, 18026*d* and 18026*e*. Torsional locking pins, 18028*a* and 18028*b*, are coupled to and mounted within the external radial mounting holes, 18022*f* and 18022*g*, respectively, of the tubular barrel connector 18022 and received within the radial passages, 18026*b* and 18026*c*, of the tubular actuator barrel 18026. The other end of the tubular actuator barrel 18026 receives and is threadably coupled to an end of a tubular barrel connector 18030 that defines an internal annular recess 18030*a*, external radial mounting holes, 18030*b* and 18030*c*, radial passages, 18030*d* and 18030*e*, and external radial mounting holes, 18030*f* and 18030*g*. A sealing cartridge 18032 is received within and coupled to the internal annular recess 18030*a* of the tubular barrel connector 18030 for fluidicly sealing the interface between the tubular barrel connector and the sealing cartridge. Torsional locking pins, 18034*a* and 18034*b*, are coupled to and mounted within the external radial mounting holes, 18030*b* and 18030*c*, respectively, of the tubular barrel connector 18030 and received within the radial passages, 18026*d* and 18026*e*, of the tubular actuator barrel 18026.

The other end of the tubular barrel connector 18030 is threadably coupled to and is received within an end of a tubular actuator barrel 18036 that defines a longitudinal passage 18036*a*, radial passages, 18036*b* and 18036*c*, and radial passages, 18036*d* and 18036*e*. Torsional locking pins, 18038*a* and 18038*b*, are coupled to and mounted within the external radial mounting holes, 18030*f* and 18030*g*, respectively, of the tubular barrel connector 18030 and received within the radial passages, 18036*b* and 18036*c*, of the tubular actuator barrel 18036. The other end of the tubular actuator barrel 18036 receives and is threadably coupled to an end of a tubular barrel connector 18040 that defines an internal annular recess 18040*a*, external radial mounting holes, 18040*b* and 18040*c*, radial passages, 18040*d* and 18040*e*, and external radial mounting holes, 18040*f* and 18040*g*. A sealing cartridge 18042 is received within and coupled to the internal annular recess 18040*a* of the tubular barrel connector 18040 for fluidicly sealing the interface between the tubular barrel connector and the sealing cartridge. Torsional locking pins, 18044*a* and 18044*b*, are coupled to and mounted within the external radial mounting holes, 18040*b* and 18040*c*, respectively, of the tubular barrel connector 18040 and received within the radial passages, 18036*d* and 18036*e*, of the tubular actuator barrel 18036.

The other end of the tubular barrel connector 18040 is threadably coupled to and is received within an end of a tubular actuator barrel 18046 that defines a longitudinal passage 18046*a*, radial passages, 18046*b* and 18046*c*, and radial passages, 18046*d* and 18046*e*. Torsional locking pins, 18048*a* and 18048*b*, are coupled to and mounted within the external radial mounting holes, 18040*f* and 18040*g*, respectively, of the tubular barrel connector 18040 and received within the radial passages, 18046*b* and 18046*c*, of the tubular actuator barrel 18046. The other end of the tubular actuator barrel 18046 receives and is threadably coupled to an end of a tubular barrel connector 18050 that defines an internal annular recess 18050*a*, external radial mounting holes, 18050*b* and 18050*c*, radial passages, 18050*d* and 18050*e*, and external radial mounting holes, 18050*f* and 18050*g*. A sealing cartridge 18052 is received within and coupled to the internal annular recess 18050*a* of the tubular barrel connector 18050 for fluidicly sealing the interface between the tubular barrel connector and the sealing cartridge. Torsional locking pins, 18054*a* and 18054*b*, are coupled to and mounted within the external radial mounting holes, 18050*b* and 18050*c*, respectively, of the tubular barrel connector 18050 and received within the radial passages, 18046*d* and 18046*e*, of the tubular actuator barrel 18046.

The other end of the tubular barrel connector 18050 is threadably coupled to and is received within an end of a tubular actuator barrel 18056 that defines a longitudinal passage 18056*a*, radial passages, 18056*b* and 18056*c*, and radial passages, 18056*d* and 18056*e*. Torsional locking pins, 18058*a* and 18058*b*, are coupled to and mounted within the external radial mounting holes, 18050*f* and 18050*g*, respectively, of the tubular barrel connector 18050 and received within the radial passages, 18056*b* and 18056*c*, of the tubular actuator barrel 18056. The other end of the tubular actuator barrel 18056 receives and is threadably coupled to an end of a tubular lower stop 18060 that defines an internal annular recess 18060*a*, external radial mounting holes, 18060*b* and 18060*c*, and an internal annular recess 18060*d* that includes one or more circumferentially spaced apart locking teeth 18060*e* at one end and one or more circumferentially spaced apart locking teeth 18060*f* at the other end. A sealing cartridge 18062 is received within and coupled to the internal annular recess 18060*a* of the tubular lower stop 18060 for fluidicly sealing the interface between the tubular lower stop and the sealing cartridge. Torsional locking pins, 18064*a* and 18064*b*, are coupled to and mounted within the external radial mounting holes, 18060*b* and 18060*c*, respectively, of the tubular lower stop 18060 and received within the radial passages, 18056*d* and 18056*e*, of the tubular actuator barrel 18056.

A connector tube 18066 that defines a longitudinal passage 18066*a* and radial mounting holes, 18066*b* and 18066*c*, and includes external splines 18066*d* at one end for engaging the internal splines 18014*b* of the tubular member 18014 and radial mounting holes, 18066*e* and 18066*f*, at another end is received within and sealingly and movably engages the interior surface of the sealing cartridge 18010 mounted within the annular recess 18008*a* of the tubular barrel connector 18008. In this manner, during longitudinal displacement of the connector tube 18066 relative to the tubular barrel connector 18008, a fluidic seal is maintained between the exterior surface of the connector tube and the interior surface of the tubular barrel connector. An end of the connector tube 18066 also receives and mates with the other end of the tubular guide member 18016. Mounting screws, 18068*a* and 18068*b*, are coupled to and received within the radial mounting holes, 18066*b* and 18066*c*, respectively of the connector tube 18066.

The other end of the connector tube 18066 is received within and threadably coupled to an end of a tubular piston 18070 that defines a longitudinal passage 18070*a*, radial mounting holes, 18070*b* and 18070*c*, radial passages, 18070*d* and 18070*e*, and radial mounting holes, 18070*f* and 18070*g*, that includes a flange 18070*h* at one end. A sealing cartridge 18072 is mounted onto and sealingly coupled to the exterior of the tubular piston 18070 proximate the flange 18070*h*. The sealing cartridge 18072 also mates with and sealingly engages the interior surface of the tubular actuator barrel 18018. In this manner, during longitudinal displacement of the tubular piston 18070 relative to the actuator barrel 18018, a fluidic seal is maintained between the exterior surface of the piston and the interior surface of the actuator barrel. Mounting screws, 18074*a* and 18074*b*, are coupled to and mounted within the external radial mounting holes, 18070*b* and 18070*c*, respectively, of the tubular piston 18070 and received within the radial passages, 18066*e* and 18066*f*, of the connector tube 18066.

The other end of the tubular piston 18070 receives and is threadably coupled to an end of a connector tube 18076 that defines a longitudinal passage 18076*a*, radial mounting holes, 18076*b* and 18076*c*, at one end and radial mounting holes, 18076*d* and 18076*e*, at another end. The connector tube 18076 is received within and sealingly and movably engages the interior surface of the sealing cartridge 18024 mounted within the annular recess 18022*a* of the tubular barrel connector 18022. In this manner, during longitudinal displacement of the connector tube 18076 relative to the tubular barrel connector 18022, a fluidic seal is maintained between the exterior surface of the connector tube and the interior surface of the barrel connector. Mounting screws, 18078*a* and 18078*b*, are coupled to and mounted within the external radial mounting holes, 18070*f* and 18070*g*, respectively, of the tubular piston 18070 and received within the radial passages, 18076*b* and 18076*c*, of the connector tube 18076.

The other end of the connector tube 18076 is received within and threadably coupled to an end of a tubular piston 18080 that defines a longitudinal passage 18080*a*, radial mounting holes, 18080*b* and 18080*c*, radial passages, 18080*d* and 18080*e*, and radial mounting holes, 18080*f* and 18080*g*, that includes a flange 18080*h* at one end. A sealing cartridge 18082 is mounted onto and sealingly coupled to the exterior of the tubular piston 18080 proximate the flange 18080*h*. The sealing cartridge 18082 also mates with and sealingly engages the interior surface of the tubular actuator barrel 18026. In this manner, during longitudinal displacement of the tubular piston 18080 relative to the tubular actuator barrel 18026, a fluidic seal is maintained between the exterior surface of the piston and the interior surface of the actuator barrel. Mounting screws, 18084*a* and 18084*b*, are coupled to and mounted within the external radial mounting holes, 18080*b* and 18080*c*, respectively, of the tubular piston 18080 and received within the radial passages, 18076*e* and 18076*f*, of the connector tube 18076.

The other end of the tubular piston 18080 receives and is threadably coupled to an end of a connector tube 18086 that defines a longitudinal passage 18086*a*, radial mounting holes, 18086*b* and 18086*c*, at one end and radial mounting holes, 18086*d* and 18086*e*, at another end. The connector tube 18086 is received within and sealingly and movably engages the interior surface of the sealing cartridge 18032 mounted within the annular recess 18030*a* of the tubular barrel connector 18030. In this manner, during longitudinal displacement of the connector tube 18086 relative to the tubular barrel connector 18030, a fluidic seal is maintained between the exterior surface of the connector tube and the interior surface of the barrel connector. Mounting screws, 18088*a* and 18088*b*, are coupled to and mounted within the external radial mounting holes, 18080*f* and 18080*g*, respectively, of the tubular piston 18080 and received within the radial passages, 18086*b* and 18086*c*, of the connector tube 18086.

The other end of the connector tube 18086 is received within and threadably coupled to an end of a tubular piston 18090 that defines a longitudinal passage 18090*a*, radial mounting holes, 18090*b* and 18090*c*, radial passages, 18090*d* and 18090*e*, and radial mounting holes, 18090*f* and 18090*g*, that includes a flange 18090*h* at one end. A sealing cartridge 18092 is mounted onto and sealingly coupled to the exterior of the tubular piston 18090 proximate the flange 18090*h*. The sealing cartridge 18092 also mates with and sealingly engages the interior surface of the tubular actuator barrel 18036. In this manner, during longitudinal displacement of the tubular piston 18090 relative to the tubular actuator barrel 18036, a fluidic seal is maintained between the exterior surface of the piston and the interior surface of the actuator barrel. Mounting screws, 18094*a* and 18094*b*, are coupled to and mounted within the external radial mounting holes, 18090*b* and 18090*c*, respectively, of the tubular piston 18090 and received within the radial passages, 18086*e* and 18086*f*, of the connector tube 18086.

The other end of the tubular piston 18090 receives and is threadably coupled to an end of a connector tube 18096 that defines a longitudinal passage 18096*a*, radial mounting holes, 18096*b* and 18096*c*, at one end and radial mounting holes, 18096*d* and 18096*e*, at another end. The connector tube 18096 is received within and sealingly and movably engages the interior surface of the sealing cartridge 18042 mounted within the annular recess 18040*a* of the tubular barrel connector 18040. In this manner, during longitudinal displacement of the connector tube 18096 relative to the tubular barrel connector 18040, a fluidic seal is maintained between the exterior surface of the connector tube and the interior surface of the barrel connector. Mounting screws, 18098*a* and 18098*b*, are coupled to and mounted within the external radial mounting holes, 18090*f* and 18090*g*, respectively, of the tubular piston 18090 and received within the radial passages, 18096*b* and 18096*c*, of the connector tube 18096.

The other end of the connector tube 18096 is received within and threadably coupled to an end of a tubular piston 18100 that defines a longitudinal passage 18100*a*, radial mounting holes, 18100*b* and 18100*c*, radial passages, 18100*d* and 18100*e*, and radial mounting holes, 18100*f* and 18100*g*, that includes a flange 18100*h* at one end. A sealing cartridge 18102 is mounted onto and sealingly coupled to the exterior of the tubular piston 18100 proximate the flange 18100*h*. The sealing cartridge 18102 also mates with and sealingly engages the interior surface of the tubular actuator barrel 18046. In this manner, during longitudinal displacement of the tubular piston 18100 relative to the tubular actuator barrel 18046, a fluidic seal is maintained between the exterior surface of the piston and the interior surface of the actuator barrel. Mounting screws, 18104*a* and 18104*b*, are coupled to and mounted within the external radial mounting holes,

18100*b* and 18100*c*, respectively, of the tubular piston 18100 and received within the radial passages, 18096*e* and 18096*f*, of the connector tube 18096.

The other end of the tubular piston 18100 receives and is threadably coupled to an end of a connector tube 18106 that defines a longitudinal passage 18106*a*, radial mounting holes, 18106*b* and 18106*c*, at one end and radial mounting holes, 18106*d* and 18106*e*, at another end. The connector tube 18106 is received within and sealingly and movably engages the interior surface of the sealing cartridge 18052 mounted within the annular recess 18050*a* of the tubular barrel connector 18050. In this manner, during longitudinal displacement of the connector tube 18106 relative to the tubular barrel connector 18050, a fluidic seal is maintained between the exterior surface of the connector tube and the interior surface of the barrel connector. Mounting screws, 18108*a* and 18108*b*, are coupled to and mounted within the external radial mounting holes, 18100*f* and 18100*g*, respectively, of the tubular piston 18100 and received within the radial passages, 18106*b* and 18106*c*, of the connector tube 18106.

The other end of the connector tube 18106 is received within and threadably coupled to an end of a tubular piston 18110 that defines a longitudinal passage 18110*a*, radial mounting holes, 18110*b* and 18110*c*, radial passages, 18110*d* and 18110*e*, radial mounting holes, 18110*f* and 18110*g*, that includes a flange 18110*h* at one end and circumferentially spaced teeth 18110*i* at another end for engaging the one or more circumferentially spaced apart locking teeth 18060*e* of the tubular lower stop 18060. A sealing cartridge 18112 is mounted onto and sealingly coupled to the exterior of the tubular piston 18110 proximate the flange 18110*h*. The sealing cartridge 18112 also mates with and sealingly engages the interior surface of the actuator barrel 18056. In this manner, during longitudinal displacement of the tubular piston 18110 relative to the actuator barrel 18056, a fluidic seal is maintained between the exterior surface of the piston and the interior surface of the actuator barrel. Mounting screws, 18114*a* and 18114*b*, are coupled to and mounted within the external radial mounting holes, 18110*b* and 18110*c*, respectively, of the tubular piston 18110 and received within the radial passages, 18106*d* and 18106*e*, of the connector tube 18106.

The other end of the tubular piston 18110 receives and is threadably coupled to an end of a connector tube 18116 that defines a longitudinal passage 18116*a*, radial mounting holes, 18116*b* and 18116*c*, at one end and radial mounting holes, 18116*d* and 18116*e*, at another end that includes an external flange 18116*f* that includes circumferentially spaced apart teeth 18116*g* that extend from an end face of the external flange for engaging the teeth 18060*f* of the tubular lower stop 18060, and an externally threaded connection 18116*h* at another end. The connector tube 18116 is received within and sealingly and movably engages the interior surface of the sealing cartridge 18062 mounted within the annular recess 18060*a* of the lower tubular stop 18060. In this manner, during longitudinal displacement of the connector tube 18116 relative to the lower tubular stop 18060, a fluidic seal is maintained between the exterior surface of the connector tube and the interior surface of the lower tubular stop. Mounting screws, 18118*a* and 18118*b*, are coupled to and mounted within the external radial mounting holes, 18110*f* and 18110*g*, respectively, of the tubular piston 18110 and received within the radial passages, 18116*b* and 18116*c*, of the connector tube 18116.

In an exemplary embodiment, as illustrated in FIGS. 13A1 to 13A8, the internally threaded connection 18002*e* of the upper tubular support member 18002 receives and is coupled to the externally threaded connection 1234*g* of the lower mandrel 1234 of the ball grabber assembly 16 and the externally threaded connection 18116*h* of the connector tube 18116 is received within and is coupled to an internally threaded connection 20*a* of an end of the safety sub assembly 20.

In an exemplary embodiment, as illustrated in FIGS. 13A1 to 13A8, during operation of the tension actuator assembly 18, the tension actuator assembly is positioned within the expandable wellbore casing 100 and fluidic material 18200 is injected into the tension actuator assembly through the passages 18002*a*, 18016*a*, 18066*a*, 18070*a*, 18076*a*, 18080*a*, 18086*a*, 18090*a*, 18096*a*, 18100*a*, 18106*a*, 18110*a*, and 18116*a*. The injected fluidic material 18200 will also pass through the radial passages, 18070*d* and 18070*e*, 18080*d* and 18080*e*, 18090*d* and 18090*e*, 18100*d* and 18100*e*, 18110*d* and 18110*e*, of the tubular pistons, 18070, 18080, 18090, 18100, and 18110, respectively, into annular piston chambers, 18202, 18204, 18206, 18208, 18208, and 18210.

As illustrated in FIGS. 13B1 to 13B7, the operating pressure of the fluidic material 18200 may then be increased by, for example, controllably blocking or limiting the flow of the fluidic material through the passage 18116*a* and/or increasing the operating pressure of the outlet of a pumping device for injecting the fluidic material 18200 into the tension actuator assembly 18. As a result, of the increased operating pressure of the fluidic material 18200 within the tension actuator assembly 18, the operating pressures of the annular piston chambers, 18202, 18204, 18206, 18208, 18208, and 18210, will be increased sufficiently to displace the tubular pistons, 18070, 18080, 18090, 18100, and 18110, upwardly in the direction 18212 thereby also displacing the connector tube 18116. As a result, a upward tensile force is applied to all elements of the system 10 coupled to and positioned below the connector tube 18116. In an exemplary embodiment, during the upward displacement of the tubular pistons, 18070, 18080, 18090, 18100, and 18110, fluidic materials displaced by the tubular pistons within discharge annular chambers, 18214, 18216, 18218, 18220, and 18222 are exhausted out of the tension actuator assembly 18 through the radial passages, 18008*d* and 18008*e*, 18022*d* and 18022*e*, 18030*d* and 18030*e*, 18040*d* and 18040*e*, 18050*d* and 18050*e*, respectively. Furthermore, in an exemplary embodiment, the upward displacement of the tubular pistons, 18070, 18080, 18090, 18100, and 18110, further causes the external splines 18066*d* of the connector tube 18066 to engage the internal splines 18014*b* of the tubular member 18014 and the circumferentially spaced apart teeth 18116*g* of the connector tube 18116 to engage the circumferentially spaced teeth 18060*f* of the tubular lower stop 18060. As a result of the interaction of the external splines 18066*d* of the connector tube 18066 to engage the internal splines 18014*b* of the tubular member 18014 and the circumferentially spaced apart teeth 18116*g* of the connector tube 18116 to engage the circumferentially spaced teeth 18060*f* of the tubular lower stop 18060, torsional loads may be transmitted through the tension actuator assembly 18.

Figure 14A:
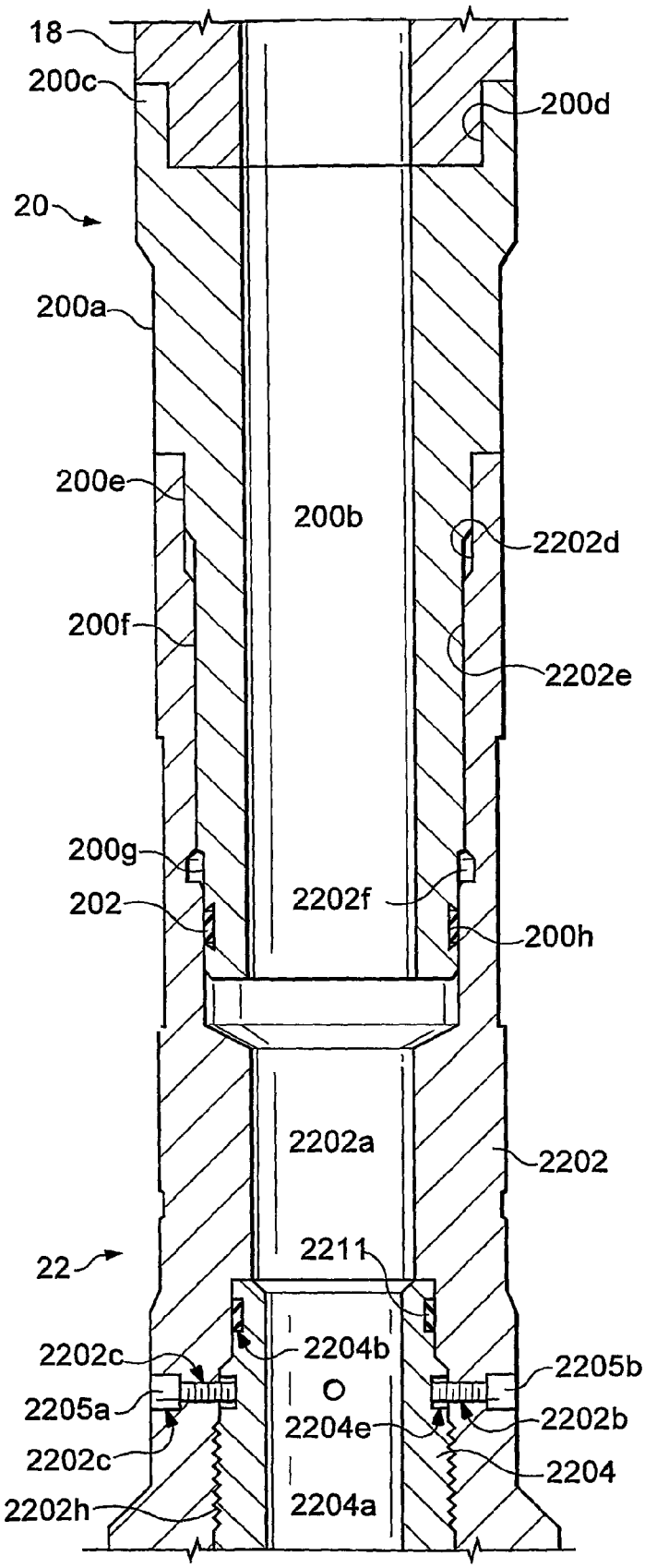
FIG. 14A is a fragmentary cross-sectional illustrations of an exemplary embodiment of a safety sub assembly.

In an exemplary embodiment, as illustrated in FIG. 14A, the safety sub assembly 20 includes a tubular body 200*a* that defines a longitudinal passage 200*b* and includes an external flange 200*c* and an internal annular recess 200*d* at one end, and external annular recesses, 200*e*, 200*f*, 200*g*, and 200*h* at another end. A sealing member 202 is positioned within the external annular recess 200*h* at the other end of the tubular body 200*a*.

Figure 14B:
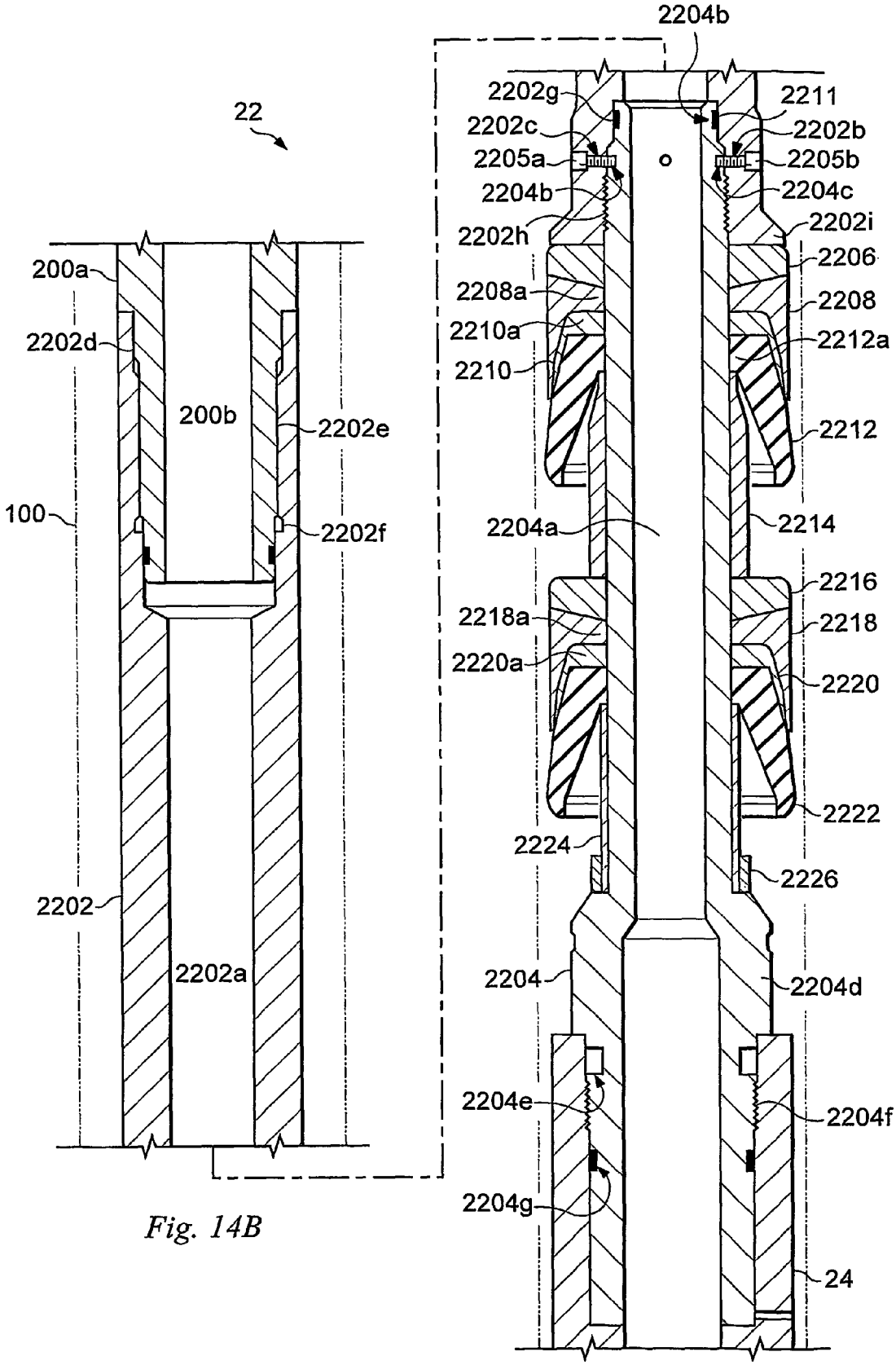
Figure 14C:
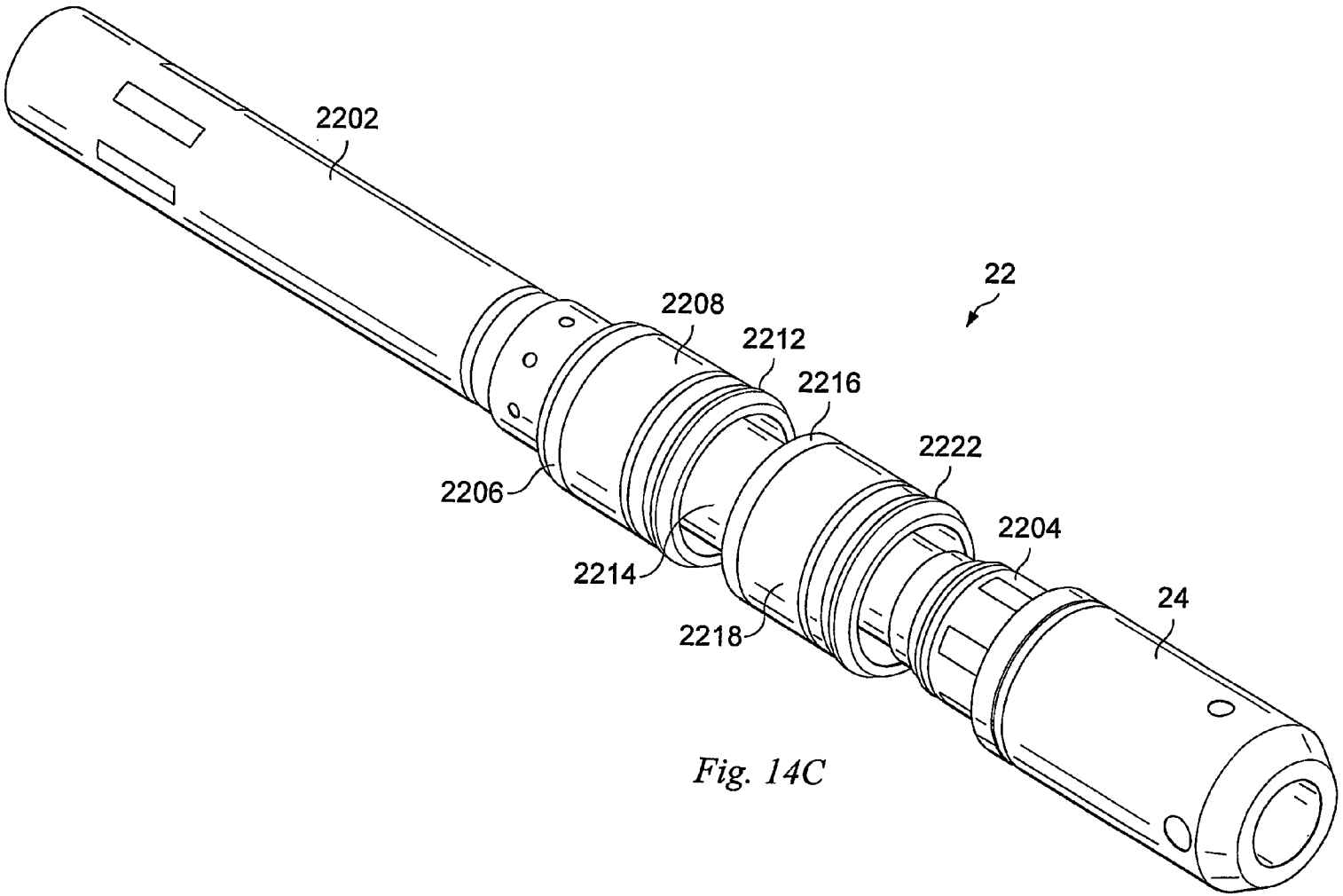
Figures 1, 15:
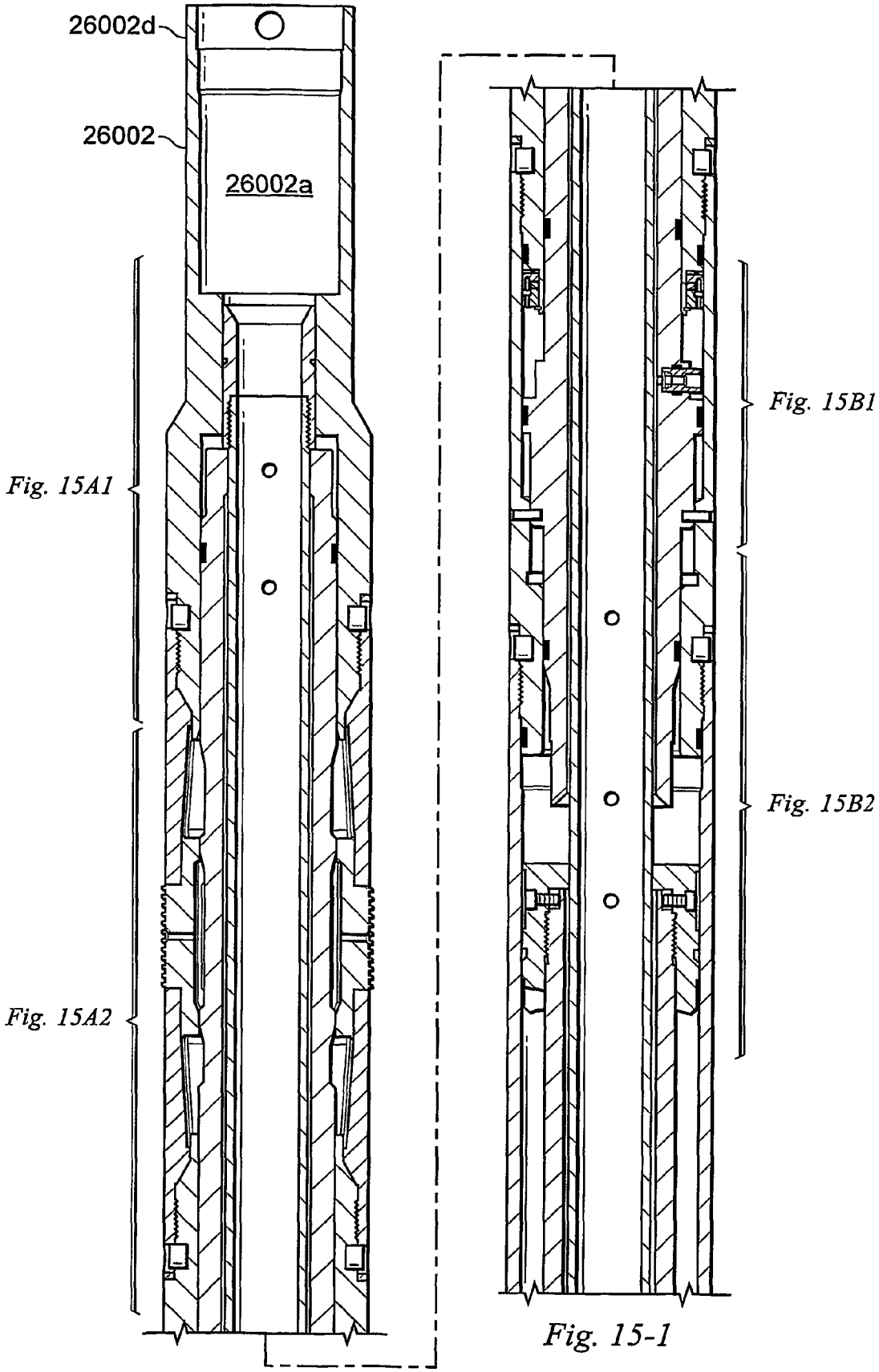
Figures 2, 15:
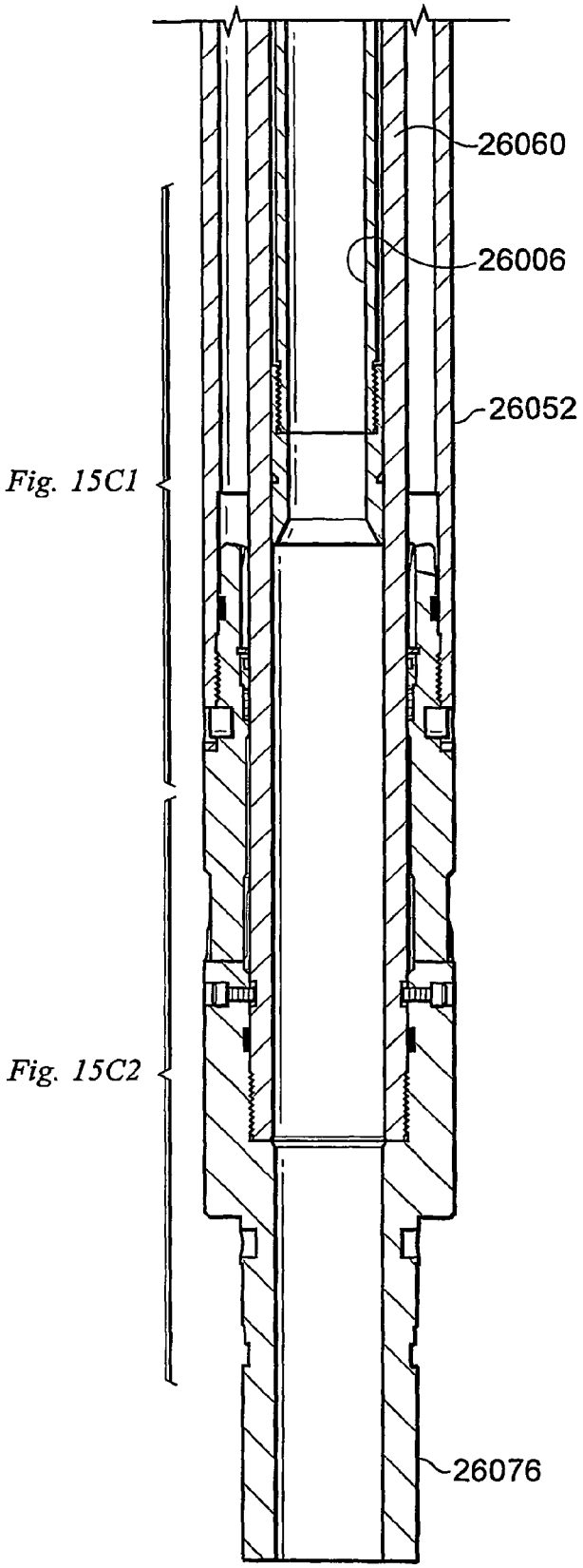
Figure 15D:
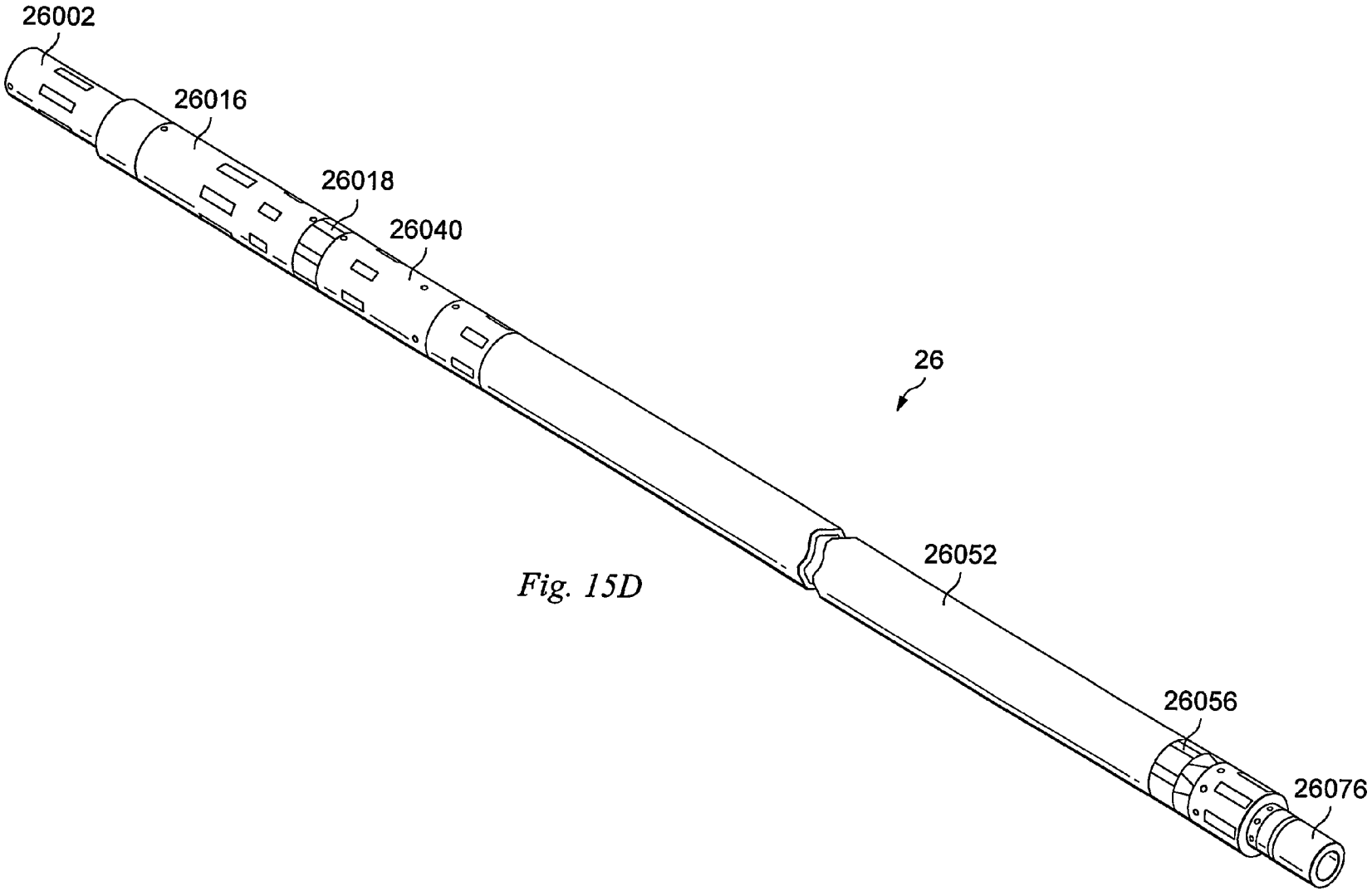

In an exemplary embodiment, as illustrated in FIGS. 14A, 14B and 14C, the sealing cup assembly 22 includes an upper tubular mandrel 2202 that defines a longitudinal passage 2202*a* and internally threaded radial mounting holes, 2202*b* and 2202*c*, and includes an internal annular recess 2202*d* at one end, an internal annular recess 2202*e*, an internal annular recess 2202*f*, an internal annular recess 2202*g*, and an internally threaded internal annular recess 2202*h* and an external flange 2202*i* at another end. The internal annular recesses, 2202*d*, 2202*e*, and 2202*f*, of the upper tubular mandrel 2202 of the sealing cup assembly 22 receive, mate with, and are coupled to the other end of the tubular body 200*a* of the safety sub assembly 20.

An externally threaded end of a lower tubular mandrel 2204 that defines a longitudinal passage 2204*a* and includes an external annular recess 2204*b* at one end, an external annular recess 2204*c*, an external flange 2204*d*, an external annular recess 2204*e*, an externally threaded external flange 2204*f*, and an external annular recess 2204*g* at another end mates with, is received within, and is coupled to the internal annular recesses, 2202*g* and 2202*h*, of the other end of the upper tubular mandrel 2202.

Mounting screws, 2250*a* and 2205*b*, are received within and coupled to the mounting holes, 2202*c* and 2202*b*, respectively, of the tubular mandrel 2202 that extend into and engage the external annular recess 2204*c* of the lower tubular mandrel 2204.

A tubular cup seal spacer 2206 receives and is mounted upon the lower tubular mandrel 2204 proximate the external flange 2202*i* of the upper tubular mandrel 2202. A tubular cup seal retainer 2208 that includes an internal flange 2208*a* at one end receives and is mounted upon the lower tubular mandrel 2204 proximate the tubular cup seal spacer 2206. A tubular cup seal retainer 2210 that includes an internal flange 2210*a* at one end receives and is mounted upon the lower tubular mandrel 2204 proximate the other end of the tubular cup seal retainer 2208. In an exemplary embodiment, the tubular cup seal retainer 2210 is nested within the other end of the tubular cup seal retainer 2208. A tubular cup seal 2212 that includes an internal flange 2212*a* at one end receives and is mounted upon the lower tubular mandrel 2204 proximate the other end of the tubular cup seal retainer 2210. In an exemplary embodiment, the tubular cup seal 2212 is nested within the other end of the tubular cup seal retainer 2210.

A sealing member 2211 is received within the external annular recess 2204*b* of the lower tubular mandrel 2204 for sealing the interface between the lower tubular mandrel and the upper tubular mandrel 2202.

A tubular spacer 2214 receives and is mounted upon the lower tubular mandrel 2204 proximate the other end of the tubular cup seal 2212.

A tubular cup seal spacer 2216 receives and is mounted upon the lower tubular mandrel 2204 proximate the other end of the tubular spacer 2214. A tubular cup seal retainer 2218 that includes an internal flange 2218*a* at one end receives and is mounted upon the lower tubular mandrel 2204 proximate the other end of the tubular cup seal spacer 2216. A tubular cup seal retainer 2220 that includes an internal flange 2220*a* at one end receives and is mounted upon the lower tubular mandrel 2204 proximate the other end of the tubular cup seal retainer 2218. In an exemplary embodiment, the tubular cup seal retainer 2220 is nested within the other end of the tubular cup seal retainer 2218. A tubular cup seal 2222 that includes an internal flange 2222*a* at one end receives and is mounted upon the lower tubular mandrel 2204 proximate the other end of the tubular cup seal retainer 2220. In an exemplary embodiment, the tubular cup seal 2222 is nested within the other end of the tubular cup seal retainer 2220.

A tubular spacer 2224 receives and is mounted upon the lower tubular mandrel 2204 proximate the other end of the tubular cup seal 2222 at one end and proximate the external flange 2204*d* of the lower tubular mandrel at another end. A retaining ring 2226 receives and is mounted upon the other end of the tubular spacer 2224 proximate the external flange 2204*d* of the lower tubular mandrel 2204.

In an exemplary embodiment, during operation of the system 10, the end of the tubular body 200*a* of the safety sub assembly 20 is coupled to and receives and is coupled to an end of the tension actuator assembly 18 and the other end of the lower tubular mandrel 2204 of the sealing cup assembly 22 is received within and is coupled to an end of the casing lock assembly 24.

In an exemplary embodiment, during operation of the system 10, the tubular cup seals, 2212 and/or 2222, sealingly engage the interior surface of the expandable tubular member 100. In this manner, when an annulus defined between the system 10 and the expandable wellbore casing 10, below the tubular cup seals, 2212 and/or 2222, is pressurized, the resulting pressure differential across the tubular cup seals applies an upward tensile force to the system thereby pulling the adjustable bell section expansion cone assembly 28 and/or the adjustable casing expansion cone assembly 30 through the expandable wellbore casing. In this manner, the adjustable bell section expansion cone assembly 28 and/or the adjustable casing expansion cone assembly 30, if either or both are adjusted to an outside diameter suitable for a radial expansion operation, may radially expand and plastically deform the expandable wellbore casing 100.

In an exemplary embodiment, the sealing cup assembly 22 operates and is provided substantially, at least in part, as disclosed in one or more of the following: (1) PCT patent application serial number PCT/US02/36157, filed on Nov. 12, 2002, and/or (2) PCT patent application serial number PCT/US02/36267, filed on Nov. 12, 2002, and/or (3) PCT patent application serial number PCT/US03/04837, filed on Feb. 29, 2003, and/or (4) PCT patent application serial number PCT/US03/29859, filed on Sep. 22, 2003, and/or (5) PCT patent application serial number PCT/US03/14153, filed on Nov. 13, 2003, and/or (6) PCT patent application serial number PCT/US03/18530, filed on Jun. 11, 2003, and/or (7) PCT patent application serial number PCT/US04/07711, filed on Mar. 11, 2004, and/or (8) PCT patent application serial number PCT/US04/09434, filed on Mar. 26, 2004, and/or (9) PCT patent application serial number PCT/US04/10317, filed on Apr. 2, 2004, and/or (10) PCT patent application serial number PCT/US04/10712, filed on Apr. 7, 2004, and/or (11) PCT patent application serial number PCT/US04/10762, filed on Apr. 6, 2004, the disclosures of which are incorporated herein by reference.

In an exemplary embodiment, the casing lock assembly 24 operates and is provided substantially, at least in part, as disclosed in one or more of the following: (1) PCT patent application serial number PCT/US02/36267, filed on Nov. 12, 2002, and/or (2) PCT patent application serial number PCT/US03/29859, filed on Sep. 22, 2003, and/or (3) PCT patent application serial number PCT/US03/14153, filed on Nov. 13, 2003, and/or (4) PCT patent application serial number PCT/US04/07711, filed on Mar. 11, 2004, and/or (5) PCT patent application serial number PCT/US04/09434, filed on Mar. 26, 2004, and/or (6) PCT patent application serial number PCT/US04/10317, filed on Apr. 2, 2004, and/or (7) PCT patent application serial number PCT/US04/10712, filed on Apr. 7, 2004, and/or (8) PCT patent application serial number PCT/US04/10762, filed on Apr. 6, 2004, the disclosures of which are incorporated herein by reference.

In an exemplary embodiment, the extension actuator assembly 26 operates and is provided substantially, at least in part, as disclosed in one or more of the following: (1) PCT patent application serial number PCT/US02/36267, filed on Nov. 12, 2002, and/or (2) PCT patent application serial number PCT/US03/29859, filed on Sep. 22, 2003, and/or (3) PCT patent application serial number PCT/US03/13787, filed on May 5, 2003, and/or (4) PCT patent application serial number PCT/US03/29460, filed on Sep. 22, 2003, and/or (5) PCT patent application serial number PCT/US04/07711, filed on Mar. 11, 2004, and/or (6) PCT patent application serial number PCT/US04/09434, filed on Mar. 26, 2004, and/or (7) PCT patent application serial number PCT/US04/10317, filed on Apr. 2, 2004, and/or (8) PCT patent application serial number PCT/US04/10712, filed on Apr. 7, 2003, and/or (9) PCT patent application serial number PCT/US04/10762, filed on Apr. 6, 2003, the disclosures of which are incorporated herein by reference.

In an exemplary embodiment, as illustrated in FIGS. 15-1, 15-2, 15A1, 15A2, 15B1, 15B2, 15C1, 15C2, 15D, 15E1 to 15E5, 15F1 to 15F5, and 15G1 to 15G5, the extension actuator assembly 26, combines the functionality of the casing lock assembly 24 with the functionality of the extension actuator assembly, and includes a tubular upper tool joint 26002 that defines a longitudinal passage 26002*a* and mounting holes, 26002*b* and 26002*c*, and includes an internal threaded connection 26002*d* at one end, an external flange 26002*e*, an external recess 26002*f* having an external threaded connection, a tapered recess 26002*g*, and an external recess 26002*h* and an internal recess 26002*i* at another end. An end of an upper pull-nut tube 26004 that defines a longitudinal passage 26004*a* and includes an external recess 26004*b* and an internally threaded internal recess 26004*c* at another end is received within and mates with the longitudinal passage 26002*a* of the tubular upper tool joint 26002.

An externally threaded end of a tubular inner mandrel 26006 that defines a longitudinal passage 26006*a* and radial passages, 26006*b*, 26006*c*, 26006*d*, and 26006*e*, and includes an externally threaded connection 26006*f* at another end mates with, is received within, and is coupled to the internally threaded recess 26004*c* of the upper pull-nut tube 26004. An internally threaded end of an lower pull-nut tube 26008 that defines a longitudinal passage 26008*a* and includes an external recess 26008*b* receives, mates with, and is coupled to externally threaded connection 26006*f* of the tubular inner mandrel 26006.

An internal flange 26010*a* of an end of a tubular lock mandrel 26010 that defines a longitudinal passage 26010*b*, radial passages, 26010*c* and 26010*d*, a radial passage 26010*e*, and a radial passage 26010*f* having an internal annular recess 26016*fa* and includes an external flange 26010*g* that mates with and is received within the internal recess 26002*i* of the tubular upper tool joint 26002, an external annular recess 26010*h*, an external flange 26010*i*, an external flange 26010*j*, an external flange 26010*k*, an external flange 26010*l*, an external flange 26010*m* that includes an external annular recess 26010*ma*, an external flange 26010*n* that defines mounting holes, 26010*o* and 26010*p*, an external annular recess 26010*q*, an external annular recess 26010*r*, and a tapered annular recess 26010*s* at another end receives and mates with the tubular inner mandrel 26006. Internal flanges, 26012*a* and 26012*b*, of a first locking dog 26012 that defines a radial passage 26012*c* and includes spring arms, 26012*d* and 26012*e*, and an external flange 26012*f* including external teeth 26012*g* are positioned upon the external flanges, 26010*i* and 26010*j*, of the tubular lock mandrel 26010. Internal flanges, 26014*a* and 26014*b*, of a second locking dog 26014 that defines a radial passage 26014*c* and includes spring arms, 26014*d* and 26014*e*, and an external flange 26014*f* including external teeth 26014*g* are positioned upon the external flanges, 26010*i* and 26010*j*, of the tubular lock mandrel 26010.

An internally threaded end of a tubular retainer sleeve 26016 that defines a longitudinal passage 26016*a*, radial passages, 26016*b* and 26016*c*, at one end, radial passages, 26016*d* and 26016*e*, for receiving and mating with the external flanges, 26012*f* and 26014*f*, respectively, of the first and second locking dogs, 26012 and 26014, respectively, and radial passages, 26016*f* and 26016*g*, at another end and includes a tapered internal flange 26016*h*, a tapered internal recess 26016*i* that receives and mates with the spring arms, 26012*d* and 26014*d*, and ends of the first and second locking dogs, respectively, a tapered internal recess 26016*j* that receives and mates with the springs arms, 26012*e* and 26014*e*, and other ends of the first and second locking dogs, respectively, a tapered internal flange 26016*k*, and an internal threaded connection 26016*l* at another end receives, mates with, and is coupled to the externally threaded connection 26002*f* of the end of the tubular upper tool joint 26002. The ends of the spring arms, 26012*d* and 26014*d*, of the first and second locking dogs, 26012 and 26014, respectively, are held between the internal surface of the end of the tapered internal recess 26016*i* of the tubular retainer sleeve 26016 and the external surface of the end of the tapered external annular recess 26002*h* of the tubular upper tool joint 26002.

An externally threaded connection 26018*a* of an end of a tubular connector 26018 that defines mounting holes, 26018*a* and 26018*b*, and mounting holes, 26018*c* and 26018*d*, and includes a tapered external annular recess 26018*e* at one end, an external annular recess 26018*f* and an external annular recess 26018*g* at another end is received within, mates with, and is coupled to the internal threaded connection 26016*l* of the end of the tubular retainer sleeve 26016. The ends of the spring arms, 26012*e* and 26014*e*, of the first and second locking dogs, 26012 and 26014, respectively, are held between the internal surface of the end of the tapered internal recess 26016*j* of the tubular retainer sleeve 26016 and the external surface of the end of the tapered external annular recess 26018*e* of the tubular connector 26018.

A sealing member 26020 is received within the external annular recess 26010*h* of the tubular lock mandrel 26010 for sealing the interface between the tubular lock mandrel and the tubular upper tool joint 26002. A sealing member 26022 is received within the external annular recess 26010*q* of the tubular lock mandrel 26010 for sealing the interface between the tubular lock mandrel and the tubular connector 26018.

A tubular face seal 26024, tubular face seal back-up 26026, a spring 26028, and a plunger 26030 are mounted upon and retained upon the external annular recess 26018*g* of the tubular connector 26018 by a snap ring 26032 that is coupled to the external annular recess of the tubular connector. A burst disk 26034 and tubular burst disk bushing 26036 are mounted within the radial passage 26010*f* of the tubular lock mandrel 26010, and a sealing member 26038 is received within the internal annular recess 26010*f* a of the radial passage of the tubular lock mandrel for sealing the interface between the tubular burst disk bushing and the tubular lock mandrel.

An internally threaded end 26040*a* of a tubular release body 26040 that defines a longitudinal passage 26040*b*, radial passages, 26040*c* and 26040*d*, radial mounting holes, 26040*e* and 26040*f*, radial mounting holes, 26040*g* and 26040*h*, and includes an internal flange 26040*i* that mates with and receives the external flange 26010*n* of the tubular lock mandrel 26010, an internal flange 26040*j* that mates with and receives the tubular lock mandrel receives, and an external annular recess 26040*k* mates with, and is coupled to an externally threaded end 26018*h* of the tubular connector 26018. A sealing member 26042 received within the external annular recess 26018*f* of the tubular connector 26018 seals the interface between the tubular connector and the tubular release body 26040. A sealing member 26044 received within the external annular recess 26010*ma* of the tubular lock mandrel 26010 seals the interface between the tubular lock mandrel and the tubular release body 26040. Shear pins, 26046*a* and 26046*b*, are received within and coupled to the radial mounting holes, 26010*o* and 26040*e*, and 26010*p* and 26040*f*, respectively, of the tubular lock mandrel 26010 and tubular release body 26040, respectively. Torque pins, 26048*a* and 26048*b*, are received within and coupled to the radial mounting holes, 26018*c* and 26018*d*, respectively, of the tubular connector 26018 that also extend into the radial passages, 26040*c* and 26040*d*, respectively, of the tubular release body 26040. A sealing member 26050 received within the external annular recess 26010*r* of the tubular lock mandrel 26010 seals the interface between the tubular lock mandrel and the internal flange 26040*j* of the tubular release body 26040.

An internally threaded end 26052*a* of a tubular extender barrel 26052 that defines a longitudinal passage 26052*b*, radial passages, 26052*c* and 26052*d*, and radial passages, 26052*e* and 26052*f*, and includes receives, mates with, and is coupled to an external threaded connection 26040*l* of the tubular release body 26040. A sealing member 26054 received within the external annular recess 26040*k* of the tubular release body 26040 seals the interface between the tubular release body and the tubular extender barrel 26052.

An external threaded connection 26056*a* of an end of a tubular lower bushing 26056 that defines a longitudinal passage 26056*b* and mounting holes, 26056*c* and 26056*d*, and includes an internal annular recess 26056*e*, an internal annular recess 26056*f*, a plurality of circumferentially spaced apart teeth 26056*g* at one end, a plurality of circumferentially spaced apart teeth 26056*h* at another end, and an external annular recess 26056*i* is received within, mates with, and is coupled to an internal threaded connection 26052*m* of the tubular extender barrel 26052. Torque pins, 26058*a* and 26058*b*, are mounted within and coupled to the mounting holes, 26056*c* and 26056*d*, respectively, of the tubular lower bushing 26056 that also extend into the radial passages, 26052*e* and 26052*f*, respectively, of the tubular extender barrel 26052.

A tubular connecting rod 26060 that defines a longitudinal passage 26060*a* that receives and mates with the lower pull-nut tube 26008, radial passages, 26060*b* and 26060*c*, and radial mounting holes, 26060*d* and 26060*e*, and includes an external threaded connection 26060*f* at one end, and an external threaded connection 26060*g* at another end is slidably received within the longitudinal passage 25056*b* of the tubular lower bushing 26056. An internal threaded connection 26062*a* of an inner mandrel tubular piston 26062 that defines mounting holes, 26062*b* and 26062*c*, and includes an internal flange 26062*d* at one end that receives and mates with the tubular inner mandrel 26006, an external annular recess 26062*e*, and a plurality of circumferentially spaced apart teeth 26062*f* at another end receives, mates with, and is coupled to the external threaded connection 26060*f* of the tubular connecting rod 26060.

Torque screws, 26064*a* and 26064*b*, are mounted within and coupled to the mounting holes, 26062*b* and 26062*c*, respectively, of the inner mandrel tubular piston 26062 that also extend into the radial passages, 26060*b* and 26060*c*, of the tubular connecting rod 26060. A sealing member 26066 positioned within the external annular recess 26062*e* of the inner mandrel tubular piston 26062 seals the interface between the inner tubular piston and the tubular extender barrel 26052. A sealing member 26068 positioned within the external annular recess 26056*i* of the tubular lower bushing 26056 seals the interface between the tubular lower bushing and the tubular extender barrel 26052.

A packing sealing element 26070 is received within the internal annular recess 25056*f* of the tubular lower bushing 26056, and a packing retainer 26072 is received within the internal annular recess 26056*e* of the tubular lower bushing for sealing the interface between the tubular lower bushing and the tubular connecting rod 26060. The packing sealing element 26070 and the packing retainer 26072 are retained within the internal annular recess 25056*f* of the tubular lower bushing 26056 and internal annular recess 26056*e* of the tubular lower bushing, respectively, by a snap ring 26074 that is coupled to the tubular connecting rod 26060.

An internally threaded connection 26076*a* of a tubular lower tool joint 26076 that defines a longitudinal passage 26076*b*, radial mounting holes, 26076*c* and 26076*d*, and radial mounting holes, 26076*e* and 26076*f*, and includes an internal annular recess 26076*g* and an external annular recess 26076*h* receives, mates with, and is coupled to an external threaded connection 26060*g* of the tubular connecting rod 26060. Torque screws, 26078*a* and 26078*b*, are mounted within and coupled to the mounting holes, 26076*c* and 26076*d*, respectively, of the tubular lower tool joint 26076 that also extend into the radial passages, 26060*d* and 26060*e*, of the tubular connecting rod 26060. A sealing member 26080 is received within the internal annular recess 26076*g* of the tubular lower tool joint 26076 for sealing the interface between the tubular lower tool joint and the tubular connecting rod 26060.

In an exemplary embodiment, during operation of the extension actuator assembly 26, as illustrated in FIGS. 15E1 to 15E5, the extension actuator assembly is positioned within the wellbore 102, the internal threaded connection 26002*d* of the tubular upper tool joint 26002 receives, mates with, and is coupled to an end of the sealing cup assembly 22, and the end of the tubular lower tool joint 26076 is received within, mates with, and is coupled to an end of the adjustable bell section expansion cone assembly 28. In an exemplary embodiment, a portion 100*a* of the expandable wellbore casing 100 includes internal teeth 100*b* that engage with, and are coupled to, the external teeth, 26012*g* and 26014*g*, of the first and second locking dogs, 26012 and 26014, respectively. In this manner, the expandable wellbore casing 100 is locked to the extension actuator assembly 26 of the system 10.

In an exemplary embodiment, during the operation of the extension actuator assembly 26, a fluidic material 26100 may then be injected into the extension actuator assembly through the longitudinal passages 26004*a*, 26006*a*, and 26008*a* of the upper pull-nut tube 26004, tubular inner mandrel 26006, and lower pull-nut tube 26008, respectively, thereby pressurizing the longitudinal passages of the upper pull-nut tube, tubular inner mandrel, and lower pull-nut tube. As a result, the fluidic material 26100 is also conveyed through the radial passage 26006*c* of the tubular inner mandrel 26006 into and through an annulus 26102 defined between the tubular inner mandrel and the tubular lock mandrel 26010. The fluidic material 26100 is then conveyed into an annulus 26104 defined between the tubular inner mandrel 26006 and the tubular extender barrel 26052 proximate an end face of the inner mandrel tubular piston 26062.

In an exemplary embodiment, as illustrated in FIGS. 15F1 to 15F5, the continued injection of the fluidic material 26100 into the extension actuator assembly 26 will then displace the inner mandrel tubular piston 26062 downwardly in a direction 26106. As a result, the tubular connecting rod 26060 and the tubular lower tool joint 26076 are also displaced downwardly in the direction 26106.

In an exemplary embodiment, as illustrated in FIGS. 15G1 to 15G5, the continued injection of the fluidic material 26100 into the extension actuator assembly 26 will then further displace the inner mandrel tubular piston 26062 downwardly in the direction 26106 until an end face of the inner flange 26062*d* of the inner mandrel tubular piston engages an end face of the lower pull-nut tube 26008. As a result, the lower pull-nut tube 26008, the tubular inner mandrel 26006, the upper pull-nut tube 26004, and the tubular lock mandrel 26010 are also displaced downwardly in the direction 26106 thereby shearing the shear pins, 26064*a* and 26064*b*, and disengaging the tubular lock mandrel from the tubular release body 26040.

The continued injection of the fluidic material 26100 into the extension actuator assembly 26 will then further displace the tubular lock mandrel 26010 downwardly in the direction 26106 thereby displacing the external flanges, 26010*i* and 26010*j*, of the tubular lock mandrel out of engagement with the internal flanges, 26012*a* and 26012*b*, and 26014*a* and 26014*b*, of the first and second locking dogs, 26012 and 26014, respectively. As a result, a spring bias force in an inner radial direction is applied by the spring arms, 26012*d* and 26012*e*, and 26014*d* and 26014*e*, of the first and second locking dogs, 26012 and 26014, respectively, to the first and second locking dogs thereby displacing the first and second locking dogs in an inner radial direction out of engagement with the portion 100*a* of the expandable wellbore casing 100. As a result, the expandable wellbore casing 100 is no longer locked to the first and second locking dogs, 26012 and 26014, of the extension actuator assembly 26.

In an exemplary embodiment, during operation of the extension actuator assembly 26, the expandable wellbore casing 100 may also be un-locked from engagement with the first and second locking dogs, 26012 and 26014, of the extension actuator assembly by increasing the operating pressure of the fluidic material 26100 above a predetermined level sufficient to rupture the burst disk 26034. As a result, the fluidic material 26100 will enter an annulus 26108 defined between the tubular lock mandrel 26010 and the tubular release body 26040. As a result, the tubular lock mandrel 26010 will be displaced downwardly in the direction 26106 thereby displacing the external flanges, 26010*i* and 26010*j*, of the tubular lock mandrel out of engagement with the internal flanges, 26012*a* and 26012*b*, and 26014*a* and 26014*b*, of the first and second locking dogs, 26012 and 26014, respectively. As a result, a spring bias force in an inner radial direction is applied by the spring arms, 26012*d* and 26012*e*, and 26014*d* and 26014*e*, of the first and second locking dogs, 26012 and 26014, respectively, to the first and second locking dogs thereby displacing the first and second locking dogs in an inner radial direction out of engagement with the portion 100*a* of the expandable wellbore casing 100. As a result, the expandable wellbore casing 100 is no longer locked to the first and second locking dogs, 26012 and 26014, of the extension actuator assembly 26. In an exemplary embodiment, the predetermined operating pressure of the fluidic material 26100 sufficient to rupture the burst disk 26034 is selected to provide a release of the expandable wellbore casing 100 from engagement with the first and second locking dogs, 26012 and 26104, in the event of an emergency operating condition during the operation of the system 10.

In an exemplary embodiment, the pressurization of the longitudinal passages 26004*a*, 26006*a*, and 26008*a* of the upper pull-nut tube 26004, tubular inner mandrel 26006, and lower pull-nut tube 26008, respectively, caused by the injection of the fluidic material 26100 may be further enhanced by blocking the flow of the fluidic material to those portions of the system 10 downstream from the extension actuator assembly 26 by, for example, blocking flow through a flow restriction defined in one or more of the elements of the system downstream of the extension actuator assembly by placing a ball or plug in one or more of those flow restrictions.

In an exemplary embodiment, the adjustable bell section expansion cone assembly 28 operates and is provided substantially, at least in part, as disclosed in one or more of the following: (1) PCT patent application serial number PCT/US02/36157, filed on Nov. 12, 2002, and/or (2) PCT patent application serial number PCT/US02/36267, filed on Nov. 12, 2002, and/or (3) PCT patent application serial number PCT/US03/04837, filed on Feb. 29, 2003, and/or (4) PCT patent application serial number PCT/US03/29859, filed on Sep. 22, 2003, and/or (5) PCT patent application serial number PCT/US03/14153, filed on Nov. 13, 2003, and/or (6) PCT patent application serial number PCT/US03/18530, filed on Jun. 11, 2003, and/or (7) PCT patent application serial number PCT/US04/07711, filed on Mar. 11, 2004, and/or (8) PCT patent application serial number PCT/US04/09434, filed on Mar. 26, 2004, and/or (9) PCT patent application serial number PCT/US04/10317, filed on Apr. 2, 2004, and/or (10) PCT patent application serial number PCT/US04/10712, filed on Apr. 7, 2004, and/or (11) PCT patent application serial number PCT/US04/10762, filed on Apr. 6, 2004, the disclosures of which are incorporated herein by reference.

In an exemplary embodiment, as illustrated in FIGS. 16-1 and 16-2, 16A1 to 16A2, 16B1 to 16B2, 16C, 16D, 16E, 16F, 16G, 16H, 16I, 16*j*, 16K, 16L, 16M, 16N, 160, 16P, 16R, 16S, 16T, 16U, 16V, 16W, 16*x*, 16Y, 16Z1 to 16Z4, 16AA1 to 16AA4, 16AB1 to 16AB4, 16AC1 to 16AC4, 16AD, and 16AE, the adjustable bell section expansion cone assembly 28 includes an upper tubular tool joint 28002 that defines a longitudinal passage 28002*a* and mounting holes, 28002*b* and 28002*c*, and includes an internal threaded connection 28002*d*, an inner annular recess 28002*e*, an inner annular recess 28002*f*, and an internal threaded connection 28002*g*. A tubular torque plate 28004 that defines a longitudinal passage 28004*a* and includes circumferentially spaced apart teeth 28004*b* is received within, mates with, and is coupled to the internal annular recess 28002*e* of the upper tubular tool joint 28002.

Circumferentially spaced apart teeth 28006*a* of an end of a tubular lower mandrel 28006 that defines a longitudinal passage 28006*b*, a radial passage 28006*ba*, and a radial passage 28006*bb* and includes an external threaded connection 28006*c*, an external flange 28006*d*, an external annular recess 28006*e* having a step 28006*f* at one end, an external annular recess 28006*g*, external teeth 28006*h*, an external threaded connection 28006*i*, and an external annular recess 28006*j* engage the circumferentially spaced apart teeth 28004*b* of the tubular torque plate 28004. An internal threaded connection 28008*a* of an end of a tubular toggle bushing 28008 that defines a longitudinal passage 28008*b*, an upper longitudinal slot 28008*c*, a lower longitudinal slot 28008*d*, mounting holes, 28008*e*, 28008*f*, 28008*g*, 28008*h*, 28008*i*, 28008*j*, 28008*k*, 28008*l*, 28008*m*, 28008*n*, 28008*o*, 28008*p*, 28008*q*, 28008*r*, 28008*s*, 28008*t*, 28008*u*, 28008*v*, 28008*w*, 28008*x*, 28008*xa*, and 28008*xb*, and includes an external annular recess 28008*y*, internal annular recess 28008*z*, external annular recess 28008*aa*, and an external annular recess 28008*ab* receives and is coupled to the external threaded connection 28006*c* of the tubular lower mandrel 28006.

A sealing element 28010 is received within the external annular recess 28008*y* of the tubular toggle bushing 28008 for sealing the interface between the tubular toggle bushing and the upper tubular tool joint 28002. A sealing element 28012 is received within the internal annular recess 28008*z* of the tubular toggle bushing 28008 for sealing the interface between the tubular toggle bushing and the tubular lower mandrel 28006.

Mounting screws, 28014*a* and 28014*b*, mounted within and coupled to the mounting holes, 28008*w* and 28008*x*, respectively, of the tubular toggle bushing 28008 are also received within the mounting holes, 28002*b* and 28002*c*, of the upper tubular tool joint 28002. Mounting pins, 28016*a*, 28016*b*, 28016*c*, 28016*d*, and 28016*e*, are mounted within the mounting holes, 28008*e*, 28008*f*, 28008*g*, 28008*h*, and 28008*i*, respectively. Mounting pins, 28018*a*, 28018*b*, 28018*c*, 28018*d*, and 28018*e*, are mounted within the mounting holes, 28008*t*, 28008*s*, 28008*r*, 28008*q*, and 28008*p*, respectively. Mounting screws, 28020*a* and 28020*b*, are mounted within the mounting holes, 28008*u* and 28008*v*, respectively.

A first upper toggle link 28022 defines mounting holes, 28022*a* and 28022*b*, for receiving the mounting pins, 28016*a* and 28016*b*, and includes a mounting pin 28022*c* at one end. A first lower toggle link 28024 defines mounting holes, 28024*a*, 28024*b*, and 28024*c*, for receiving the mounting pins, 28022*c*, 28016*c*, and 28016*d*, respectively and includes an engagement arm 28024*d*. A first trigger 28026 defines a mounting hole 28026*a* for receiving the mounting pin 28016*e* and includes an engagement arm 28026*b* at one end, an engagement member 28026*c*, and an engagement arm 28026*d* at another end.

A second upper toggle link 28028 defines mounting holes, 28028*a* and 28028*b*, for receiving the mounting pins, 28018*a* and 28018*b*, and includes a mounting pin 28028*c* at one end. A second lower toggle link 28030 defines mounting holes, 28030*a*, 28030*b*, and 28030*c*, for receiving the mounting pins, 28028*c*, 28018*c*, and 28018*d*, respectively and includes an engagement arm 28030*d*. A second trigger 28032 defines a mounting hole 28032*a* for receiving the mounting pin 28018*e* and includes an engagement arm 28032*b* at one end, an engagement member 28032*c*, and an engagement arm 28032*d* at another end.

An end of a tubular spring housing 28034 that defines a longitudinal passage 28034*a*, mounting holes, 28034*b* and 28034*c*, and mounting holes, 28034*ba* and 28034*ca*, and includes an internal flange 28034*d* and an internal annular recess 28034*e* at one end, and an internal flange 28034*f*, an internal annular recess 28034*g*, an internal annular recess 28034*h*, and an external threaded connection 28034*i* at another end receives and mates with the end of the tubular toggle bushing 28008. Mounting screws, 28035*a* and 28035*b*, are mounted within and coupled to the mounting holes, 28008*xb* and 28008*xa*, respectively, of the tubular toggle bushing 28008 and are received within the mounting holes, 28034*ba* and 28034*ca*, respectively, of the tubular spring housing 28034.

A tubular retracting spring ring 28036 that defines mounting holes, 28036*a* and 28036*b*, receives and mates with a portion of the tubular lower mandrel 28006 and is received within and mates with a portion of the tubular spring housing 28034. Mounting screws, 28038*a* and 28038*b*, are mounted within and coupled to the mounting holes, 28036*a* and 28036*b*, respectively, of the tubular retracting spring ring 28036 and extend into the mounting holes, 28034*b* and 28034*c*, respectively, of the tubular spring housing 28034.

Casing diameter sensor springs, 28040*a* and 28040*b*, are positioned within the longitudinal slots, 28008*c* and 2808*d*, respectively, of the tubular toggle bushing 28008 that engage the engagement members, 28026*c* and 28032*c*, and engagement arms, 28026*d* and 28032*d*, of the first and second triggers, 28026 and 28032, respectively. An inner flange 28042*a* of an end of a tubular spring washer 28042 mates with and receives a portion of the tubular lower mandrel 28006 and an end face of the inner flange of the tubular spring washer is positioned proximate and end face of the external flange 28006*d* of the tubular lower mandrel. The tubular spring washer 28042 is further received within the longitudinal passage 28034*a* of the tubular spring housing 28034.

An end of a retracting spring 28044 that receives the tubular lower mandrel 28006 is positioned within the tubular spring washer 28042 in contact with the internal flange 28042*a* of the tubular spring washer and the other end of the retracting spring is positioned in contact with an end face of the tubular retracting spring ring 28036.

A sealing element 28046 is received within the external annular recess 28006*j* of the tubular lower mandrel 28006 for sealing the interface between the tubular lower mandrel and the tubular spring housing 28034. A sealing element 28048 is received within the internal annular recess 28034*h* of the tubular spring housing 28034 for sealing the interface between the tubular spring housing and the tubular lower mandrel 28006.

An internal threaded connection 28050*a* of an end of a tubular upper hinge sleeve 28050 that includes an internal flange 28050*b* and an internal pivot 28050*c* receives and is coupled to the external threaded connection 28034*l* of the end of the tubular spring housing 28034.

An external flange 28052*a* of a base member 28052*b* of an upper cam assembly 28052, that is mounted upon and receives the lower tubular mandrel 28006, that includes an internal flange 28052*c* that is received within the external annular recess 28006*e* of the lower tubular mandrel 28006 and a plurality of circumferentially spaced apart tapered cam arms 28052*d* extending from the base member mates with and is received within the tubular upper hinge sleeve 28050. The base member 28052*b* of the upper cam assembly 28052 further includes a plurality of circumferentially spaced apart teeth 28052*f* that mate with and are received within a plurality of circumferentially spaced apart teeth 28034*j* provided on the end face of the tubular spring housing 28034 and an end face of the external flange 28052*a* of the base member of the upper cam assembly is positioned in opposing relation to an end face of the internal flange 28050*b* of the tubular upper hinge sleeve 28050. Each of the cam arms 28052*d* of the upper cam assembly 28052 include external cam surfaces 28052*e*. In an exemplary embodiment, the teeth 28052*f* of the base member 28052*b* of the upper cam assembly 28052 and the teeth 28034*j* provided on the end face of the tubular spring housing 28034 permit torsional loads to be transmitted between the tubular spring housing and the upper cam assembly.

A plurality of circumferentially spaced apart upper expansion segments 28054 are mounted upon and receive the lower tubular mandrel 28006 and each include an external pivot recess 28054*a* at one end for mating with and receiving the internal pivot 28050*c* of the tubular upper hinge sleeve 28050 and an external tapered expansion surface 28054*b* at another end and are pivotally mounted within the tubular upper hinge sleeve and are interleaved with the circumferentially spaced apart cam arms 28052*d* of the upper cam assembly 28052.

The upper expansion segments 28054 are interleaved among the cam arms 28052*d* of the upper cam assembly 28052.

A plurality of circumferentially spaced apart lower expansion segments 28058 are mounted upon and receive the lower tubular mandrel 28006, are interleaved among the upper expansion segments 28054, are oriented in the opposite direction to the upper expansion segments 28054, each include an external pivot recess 28058*a* at one end and an external tapered expansion surface 28054*b* at another end and are positioned in opposing relation to corresponding circumferentially spaced apart cam arms 28052*d* of the upper cam assembly 28052.

A lower cam assembly 28060 is mounted upon and receives the lower tubular mandrel 28006 that includes a base member 28060*a* having an external flange 28060*b*, a plurality of circumferentially spaced apart cam arms 28060*d* that extend from the base member that each include external cam surfaces 28060*e* and define mounting holes 28060*f* and 28060*g*. The base member 28060*a* of the lower cam assembly 28060 further includes a plurality of circumferentially spaced apart teeth 28060*h*. The circumferentially spaced apart cam arms 28060*d* of the lower cam assembly 28060 are interleaved among the lower expansion segments 28058 and the circumferentially spaced apart cam arms 28052*d* of the upper cam assembly 28052 and positioned in opposing relation to corresponding upper expansion segments 28054.

Mounting screws, 28062*a*, 28062*b*, 28062*c*, and 28062*e*, are mounted within the corresponding mounting holes, 28060*f* and 28060*g*, of the lower cam assembly 28060 and are received within the external annular recess 28006*g* of the lower cam assembly 28060.

A tubular lower hinge sleeve 28064 that receives the lower expansion segments 28058 and the lower cam assembly 28060 includes an internal flange 28064*a* for engaging the external flange 28060*b* of the base member of the lower cam assembly 28060, an internal pivot 28064*b* for engaging and receiving the external pivot recess 28058*a* of the lower expansion segments 28058 thereby pivotally mounting the lower expansion segments within the tubular lower hinge sleeve, and an internal threaded connection 28064*c*.

An external threaded connection 28066*a* of an end of a tubular sleeve 28066 that defines mounting holes, 28066*b* and 28066*c*, and includes an internal annular recess 28066*d* having a shoulder 28066*e*, an internal flange 28066*f*, and an internal threaded connection 28066*g* at another end is received within and coupled to the internal threaded connection 28064*c* of the tubular lower hinge sleeve 28064. An external threaded connection 28068*a* of an end of a tubular member 28068 that defines a longitudinal passage 28068*b* and mounting holes, 28068*c* and 28068*d*, and includes an external annular recess 28068*e*, and an external threaded connection 28068*f* at another end is received within and is coupled to the internal threaded connection 28066*g* of the tubular sleeve 28066.

Mounting screws, 28070*a* and 28070*b*, are mounted in and coupled to the mounting holes, 28068*c* and 28068*d*, respectively, of the tubular member 28068 that also extend into the mounting holes, 28066*b* and 28066*c*, respectively, of the tubular sleeve 28066. A sealing element 28072 is received within the external annular recess 28068*e* of the tubular member 28068 for sealing the interface between the tubular member and the tubular sleeve 28066.

An internal threaded connection 28074*a* of a tubular retracting piston 28074 that defines a longitudinal passage 28074*b* and includes an internal annular recess 28074*c* and an external annular recess 28074*d* receives and is coupled to the external threaded connection 28006*i* of the tubular lower mandrel 28006. A sealing element 28076 is received within the external annular recess 28074*d* of the tubular retracting piston 28074 for sealing the interface between the tubular retracting piston and the tubular sleeve 28066. A sealing element 28078 is received within the internal annular recess 28074*c* of the tubular retracting piston 28074 for sealing the interface between the tubular retracting piston and the tubular lower mandrel 28006.

Locking dogs 28080 mate with and receive the external teeth 28006*h* of the tubular lower mandrel 28006. A spacer ring 28082 is positioned between an end face of the locking dogs 28080 and an end face of the lower cam assembly 28060. A release piston 28084 mounted upon the tubular lower mandrel 28006 defines a radial passage 28084*a* for mounting a burst disk 28086 includes sealing elements, 28084*b*, 28084*c*, and 28084*d*. The sealing elements, 28084*b* and 28084*d*, sealing the interface between the release piston 28084 and the tubular lower mandrel 28006. An end face of the release piston 28084 is positioned in opposing relation to an end face of the locking dogs 28080.

A release sleeve 28088 that receives and is mounted upon the locking dogs 28080 and the release piston 28084 includes an internal flange 28088*a* at one end that sealingly engages the tubular lower mandrel 28006. A bypass sleeve 28090 that receives and is mounted upon the release sleeve 28088 includes an internal flange 28090*a* at one end.

In an exemplary embodiment, during operation of the adjustable bell section expansion cone assembly 28, the retracting spring 28044 is compressed and thereby applies a biasing spring force in a direction 28092 from the lower tubular mandrel 28006 to the tubular spring housing 28634 that, in the absence of other forces, moves and/or maintains the upper cam assembly 28052 and the upper expansion segments 28054 out of engagement with the lower expansion segments 28058 and the lower cam assembly 28060. In an exemplary embodiment, during operation of the adjustable bell section expansion cone assembly 28, an external threaded connection 26*a* of an end of the extension actuator assembly 26 is coupled to the internal threaded connection 28002*d* of the upper tubular tool joint 28002 and an internal threaded connection 30*a* of an end of the adjustable casing expansion cone assembly 30 is coupled to the external threaded connection 28068*f* of the tubular member 28068.

The upper cam assembly 28052 and the upper expansion segments 28054 may be brought into engagement with the lower expansion segments 28058 and the lower cam assembly 28060 by pressurizing an annulus 28094 defined between the lower tubular mandrel 28006 and the tubular spring housing 28034. In particular, injection of fluidic materials into the adjustable bell section expansion cone assembly 28 through the longitudinal passage 28006*b* of the lower tubular mandrel 28006 and into the radial passage 28006*ba* may pressurize the annulus 28094 thereby creating sufficient operating pressure to generate a force in a direction 28096 sufficient to overcome the biasing force of the retracting spring 28044. As a result, the spring housing 28034 may be displaced in the direction 28096 relative to the lower tubular mandrel 28006 thereby displacing the tubular upper hinge sleeve 28050, upper cam assembly 28052, and upper expansion segments 28054 in the direction 28096.

Figures 1, 16:
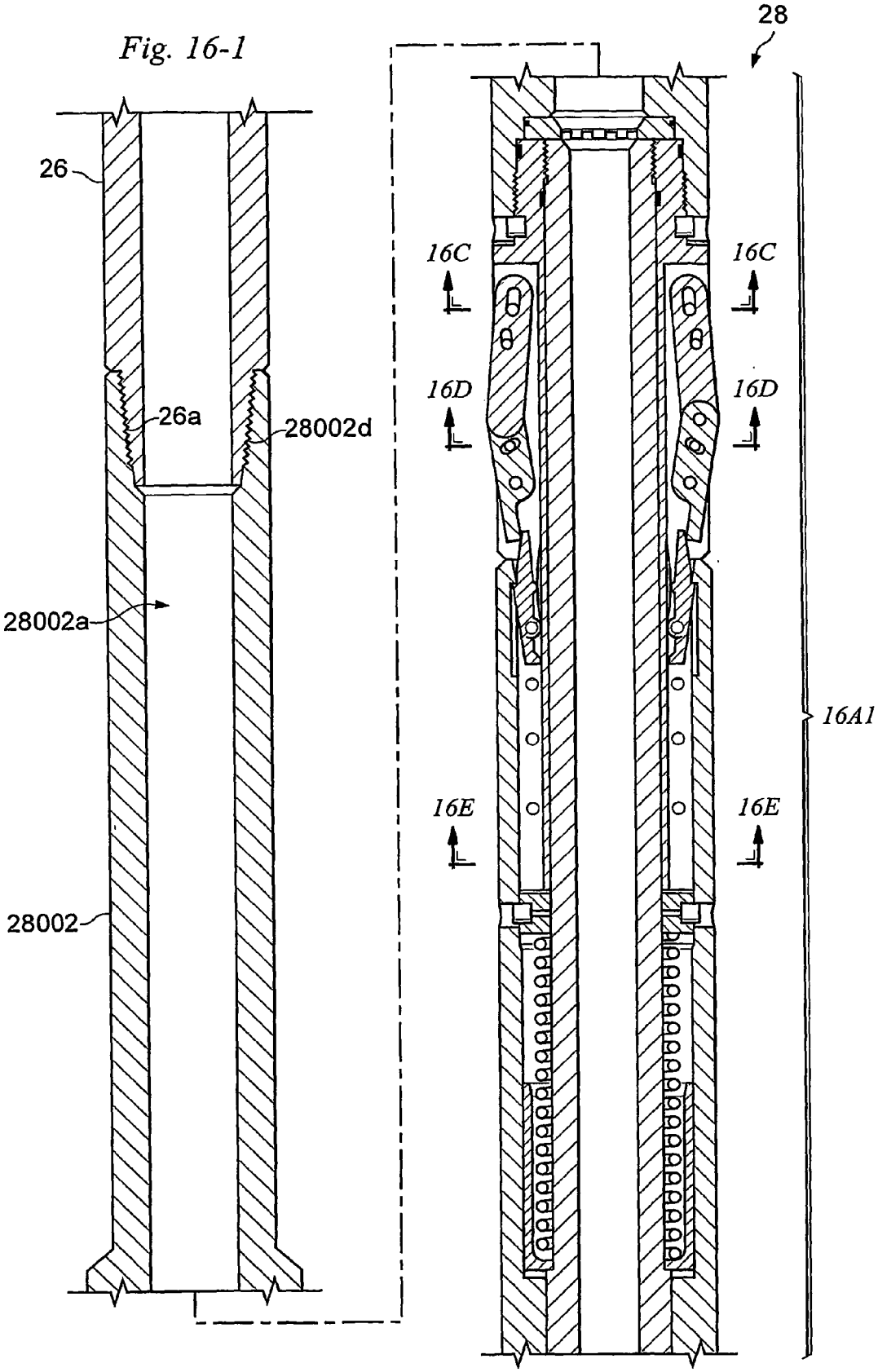
Figures 2, 16:
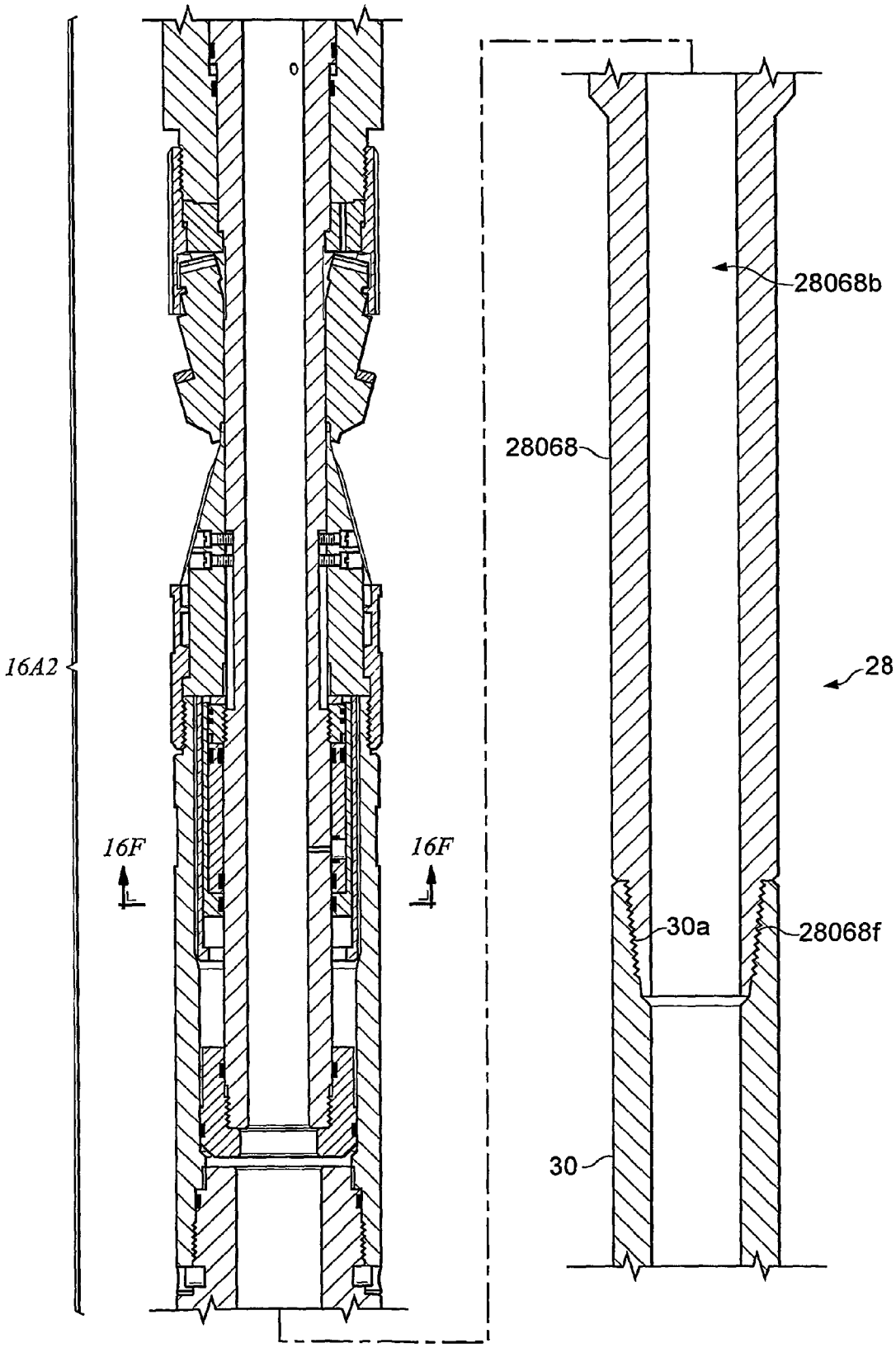
Figure 16C:
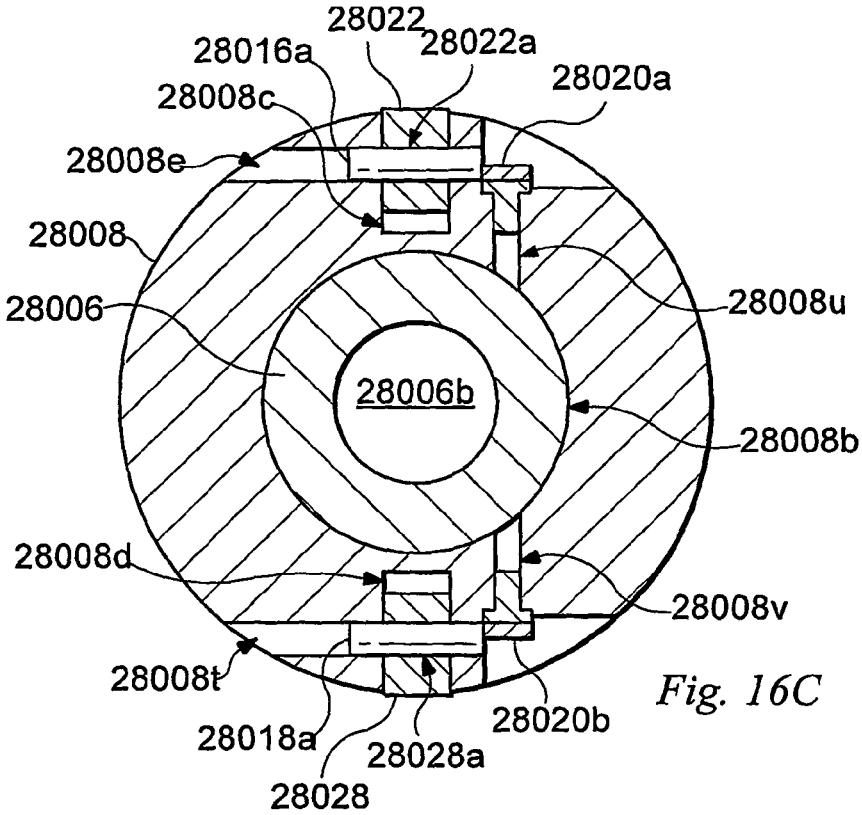
Figure 16D:
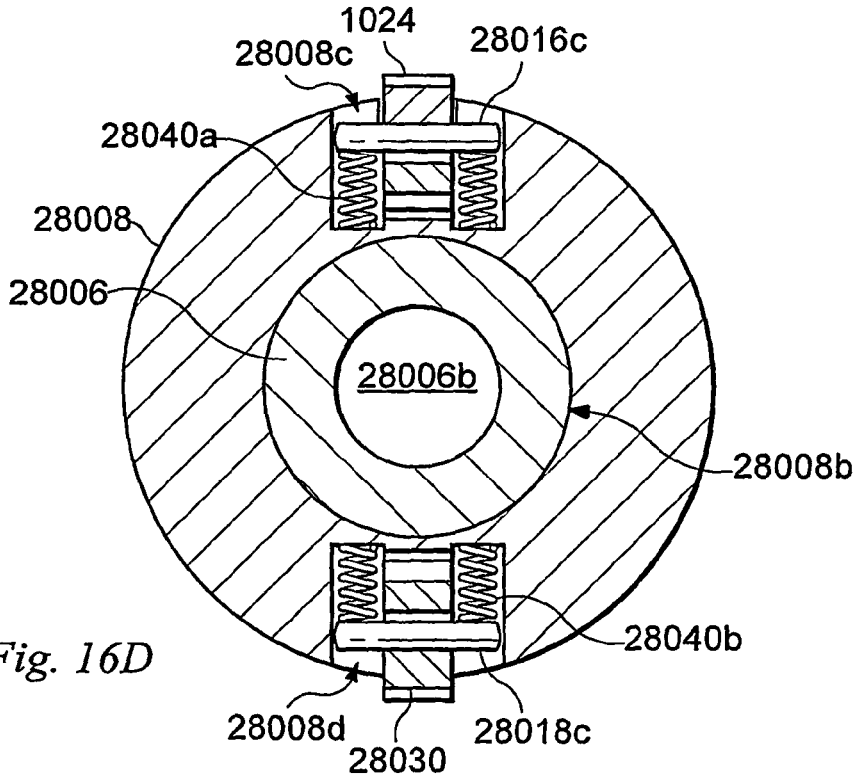
Figure 16E:
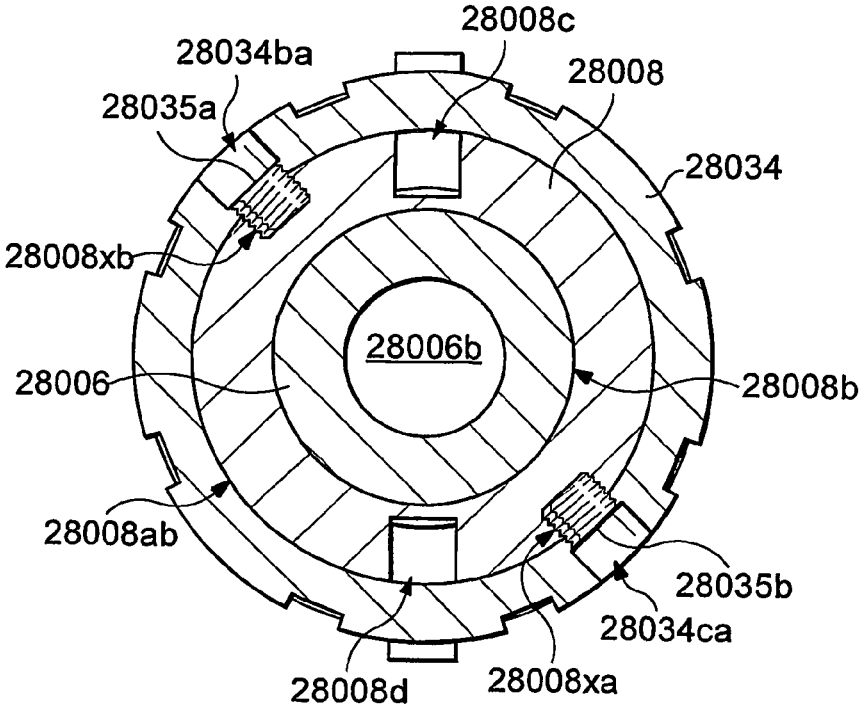
Figure 16F:
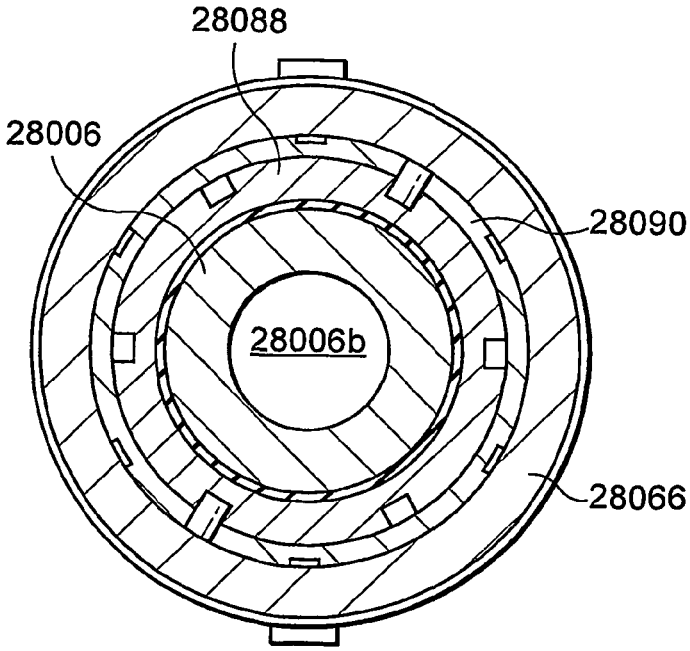
Figure 16G:
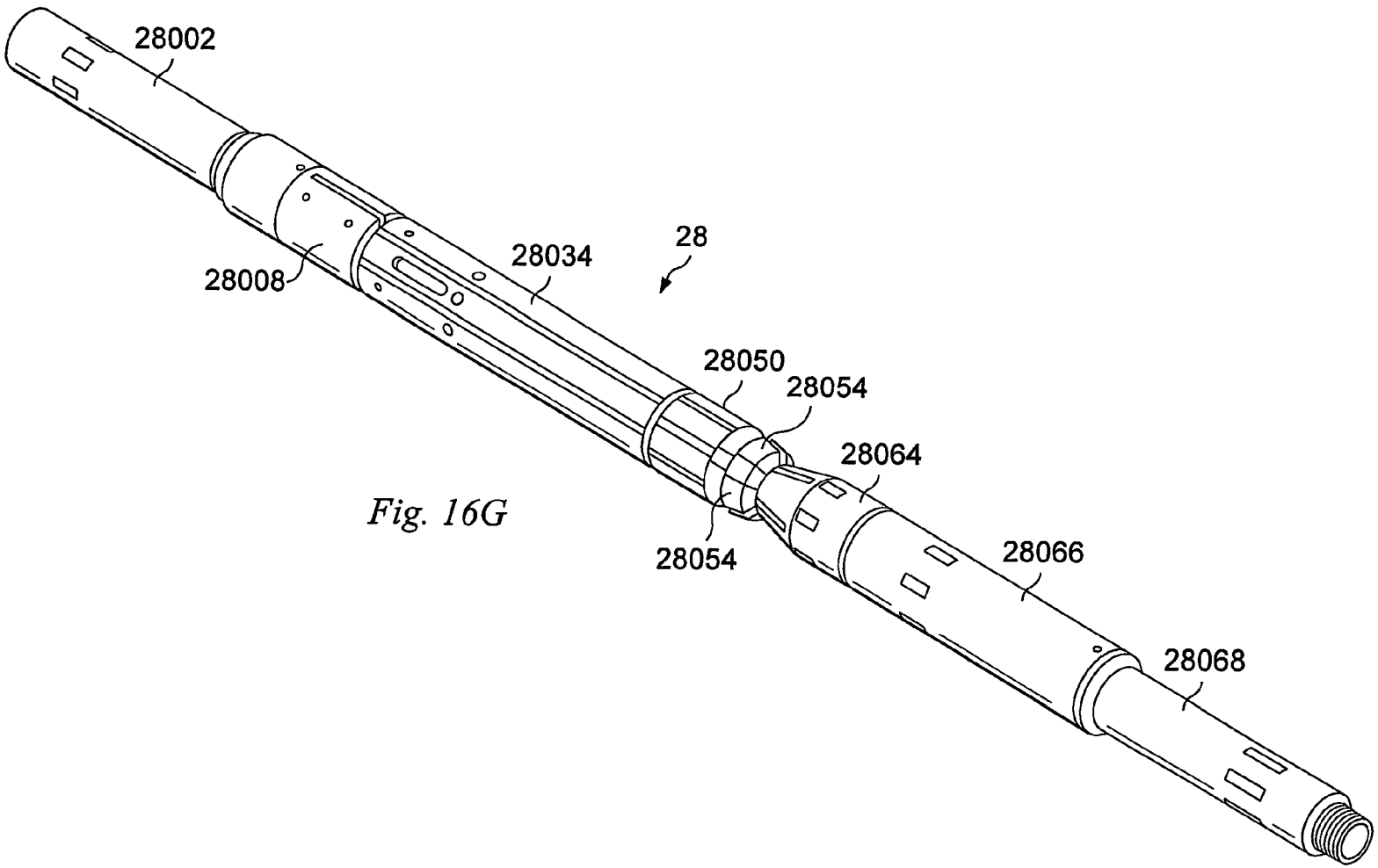
Figure 16H:
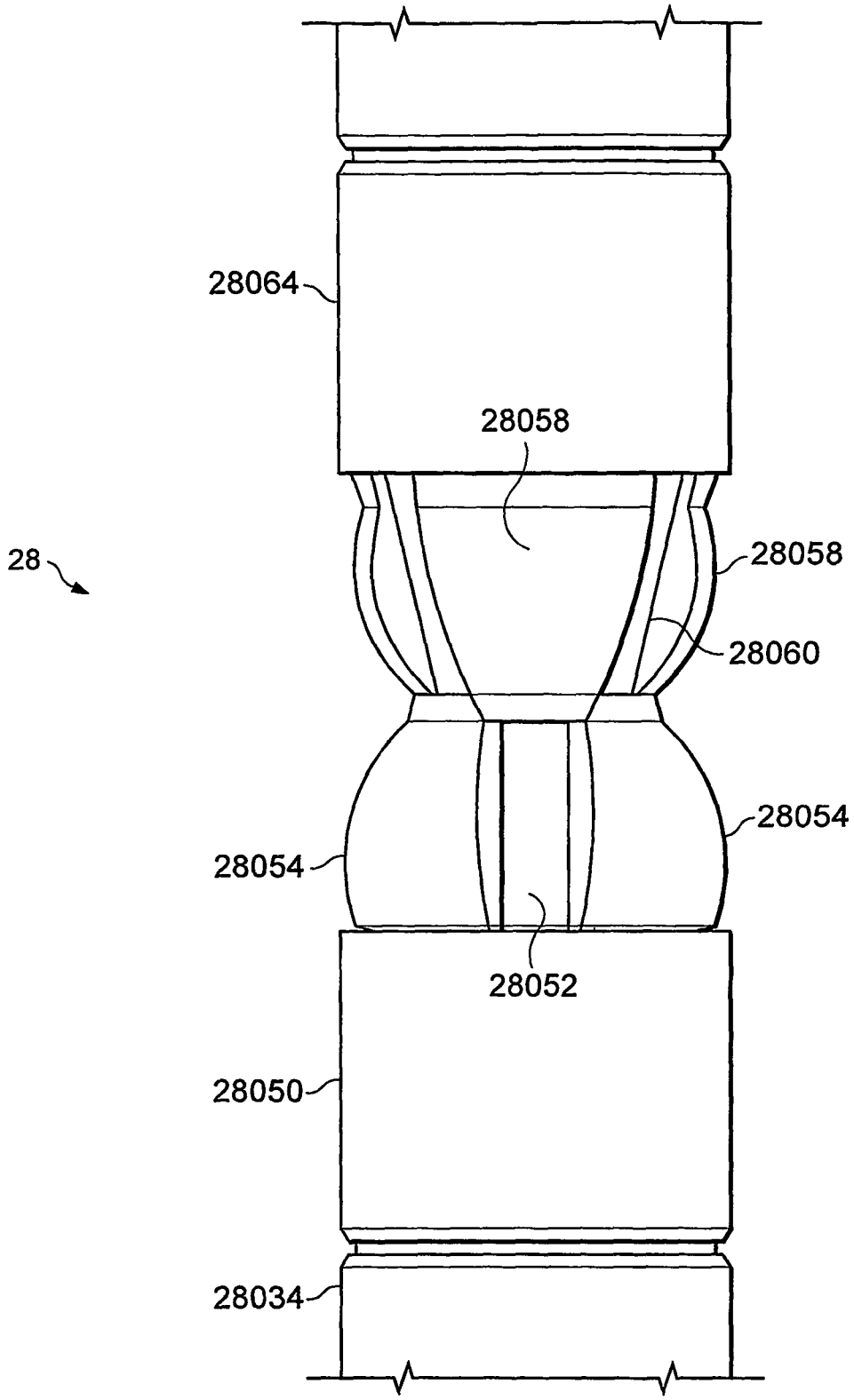
Figure 16I:
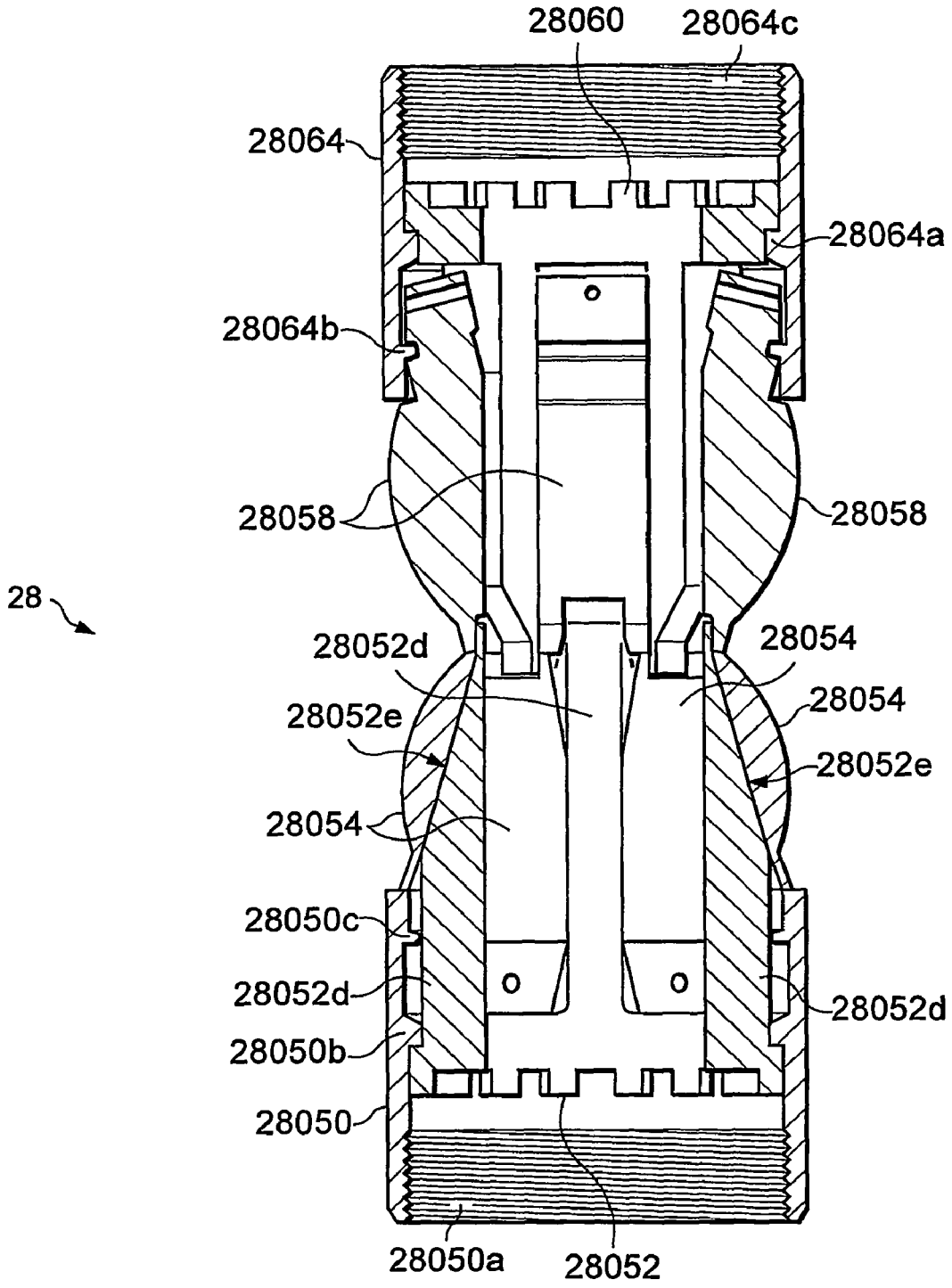
Figure 16J:
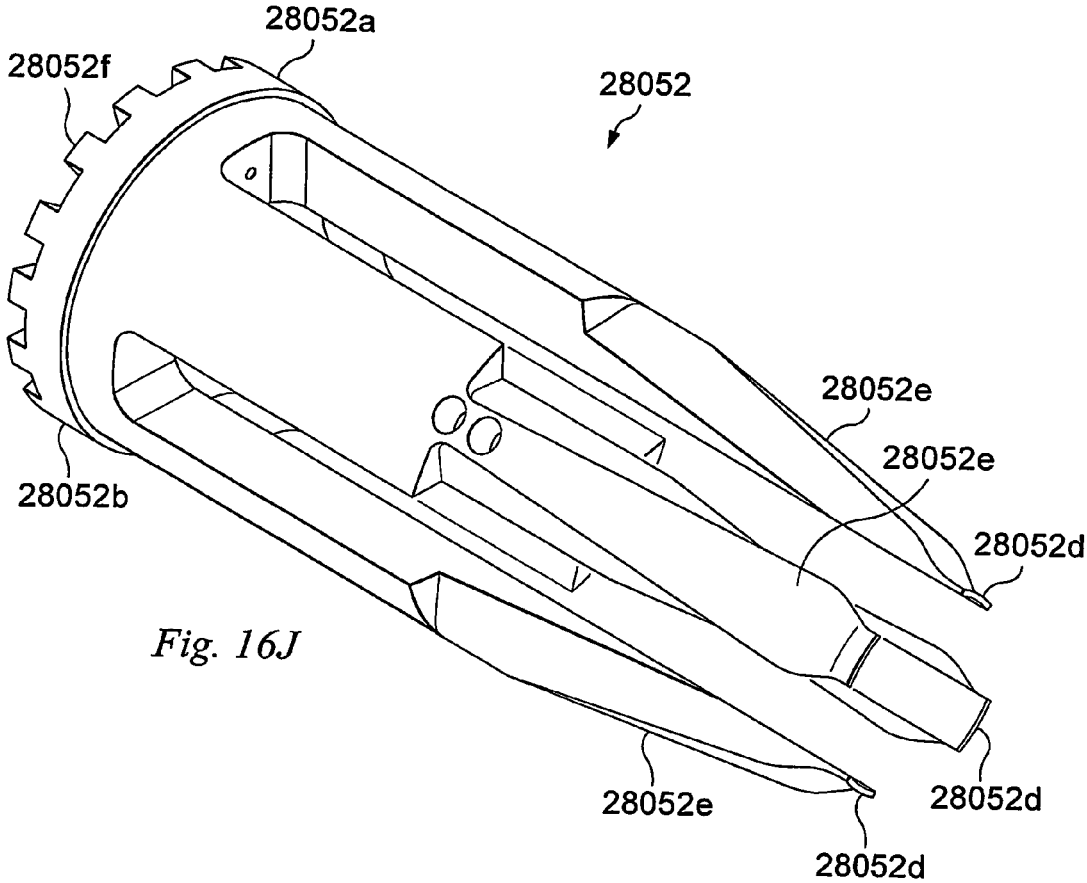
Figure 16K:
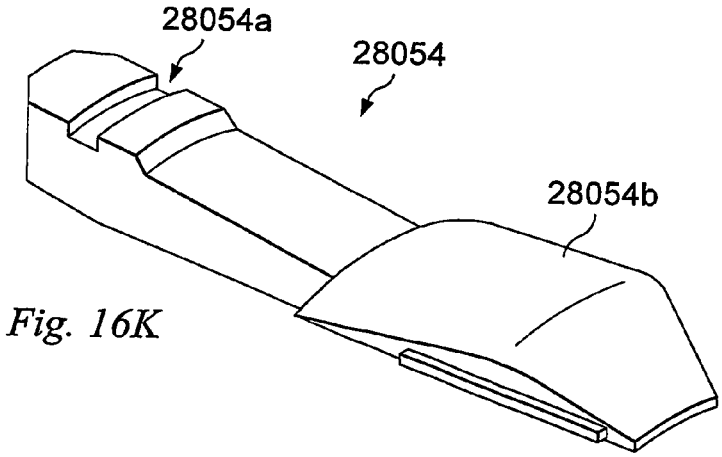
Figure 16L:
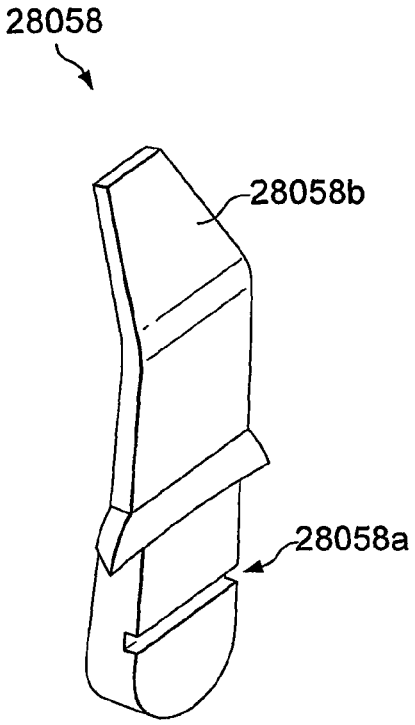
Figure 16M:
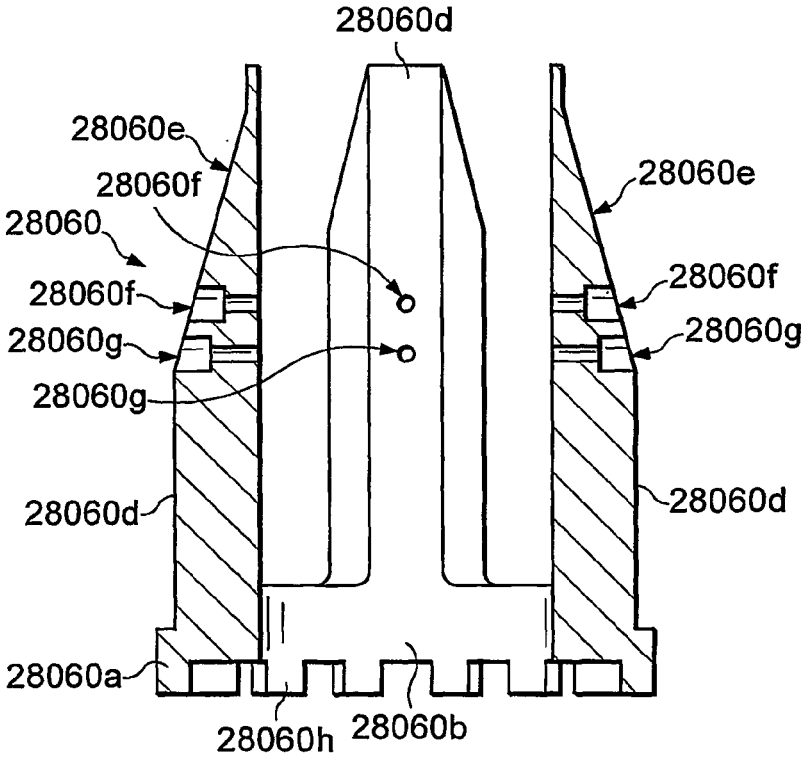
Figure 16N:
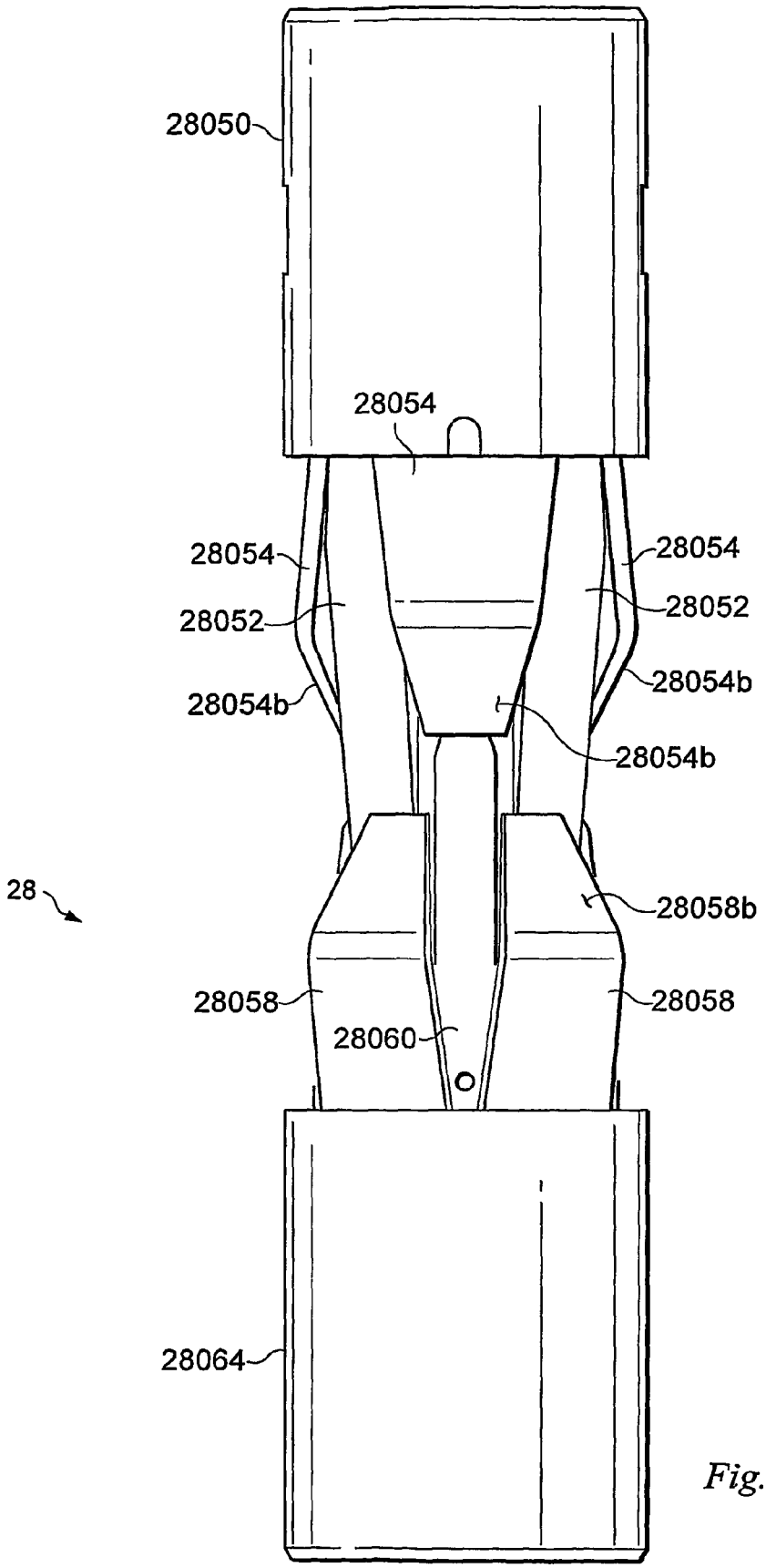
Figure 16O:
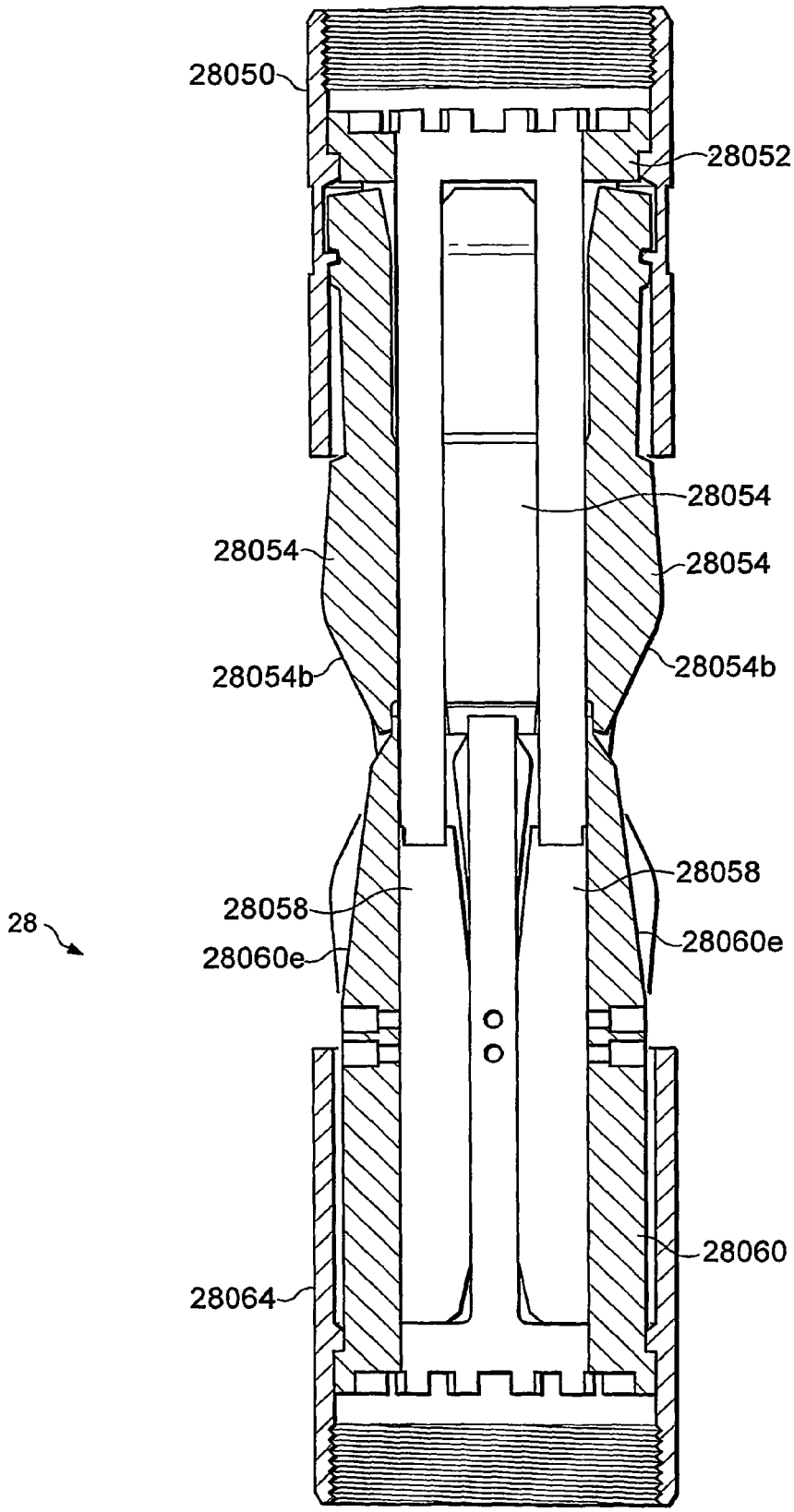
Figure 16P:
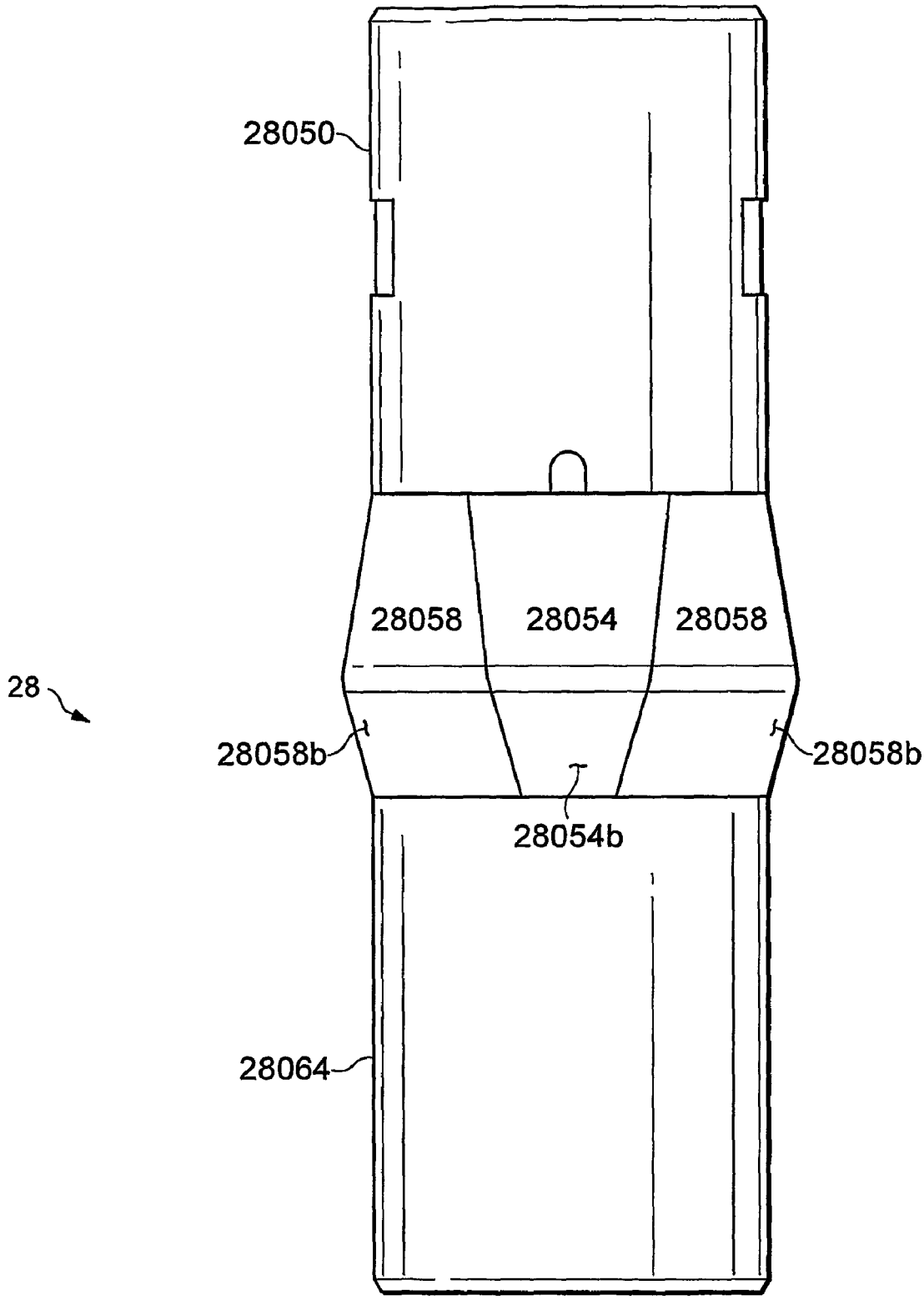
Figure 16R:
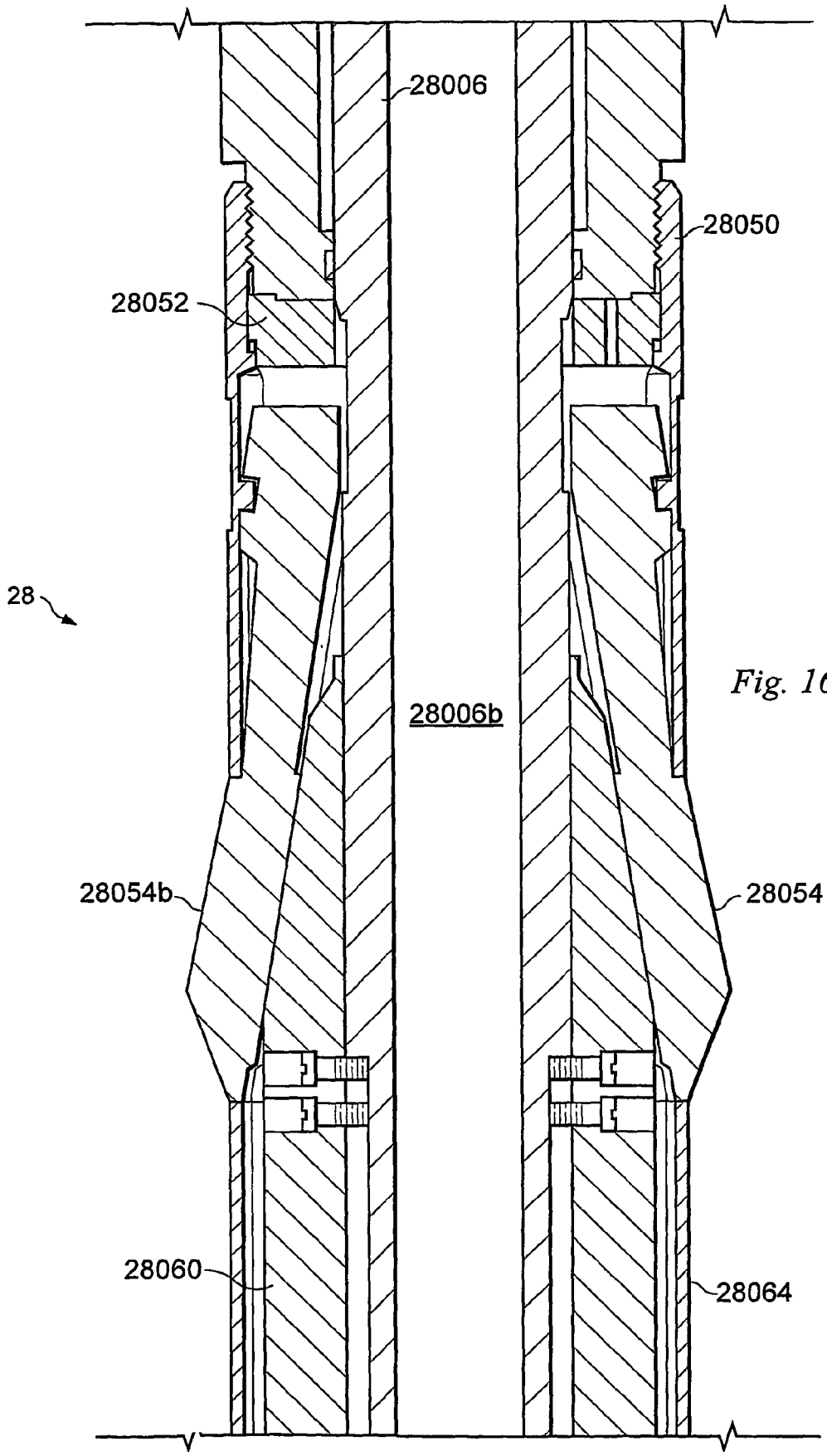
Figure 16S:
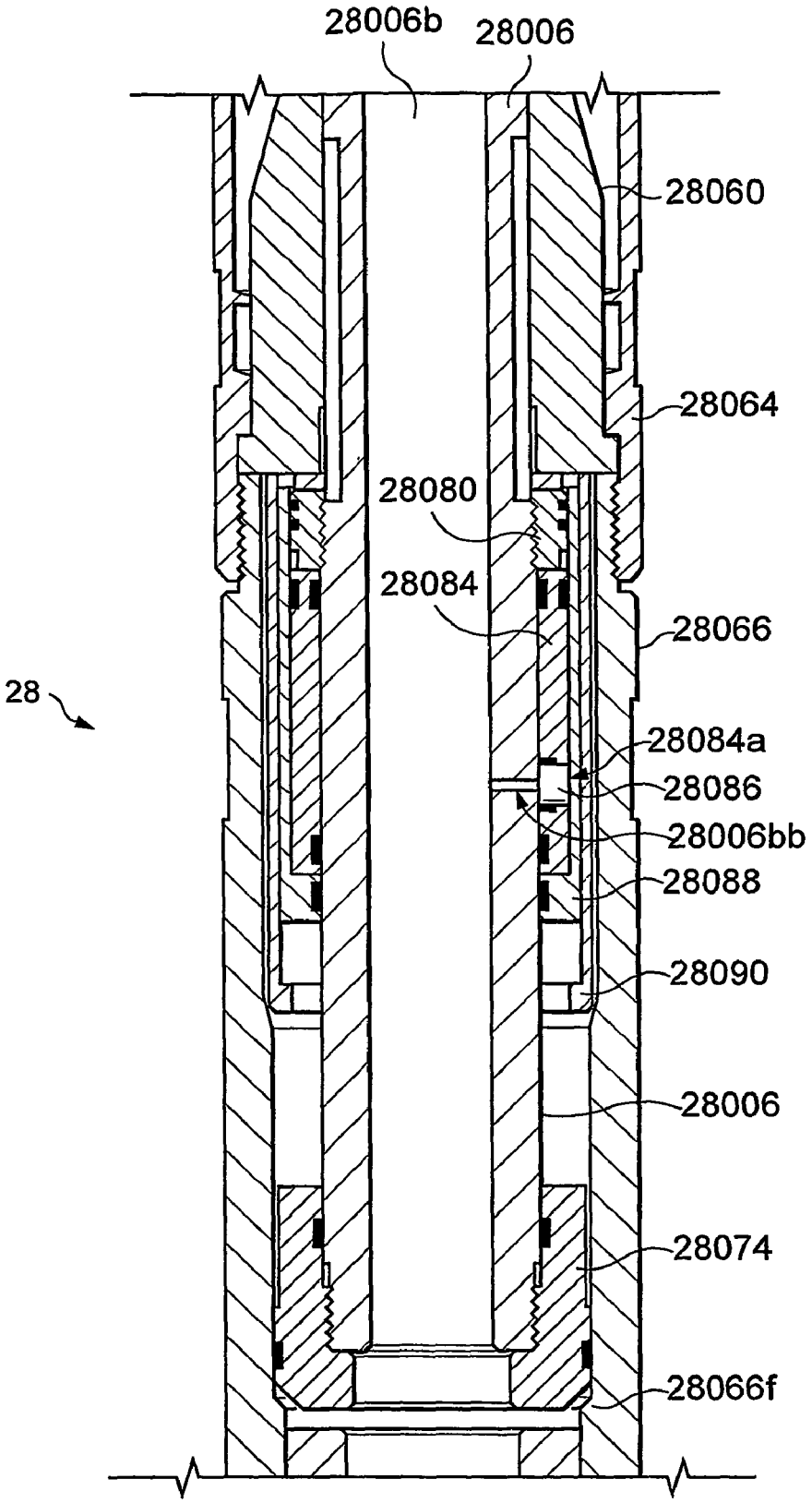

In an exemplary embodiment, as illustrated in FIGS. 16P and 16R, the displacement of the upper cam assembly 28052 and upper expansion segments 28054 in the direction 28096 will cause the lower expansion segments 28058 to ride up the cam surfaces 28052*e* of the cam arms 28052*d* of the upper cam assembly 28052 while also pivoting about the lower tubular hinge segment 28064, and will also cause the upper expansion segments 28054 to ride up the cam surfaces 28060*e* of the cam arms 28060*d* of the lower cam assembly 28060 while also pivoting about the upper tubular hinge segment 28050. In an exemplary embodiment, when the upper and lower expansion segments, 28054 and 28058, are brought into axial alignment, they define an outer expansion surface that is approximately contiguous in a circumferential direction and which provides an outer expansion surface that at least approximates a conical surface.

In an exemplary embodiment, during the operation of the adjustable bell section expansion cone assembly 28, when the upper and lower expansion segments, 28054 and 28058, brought into axial alignment into a radially expanded position, the upper and lower expansion segments, 28054 and 28058, are displaced relative to the expandable wellbore casing 100 to thereby radially expand and plastically deform at least a portion of the expandable wellbore casing. In an exemplary embodiment, during the radial expansion and plastic deformation of the expandable wellbore casing 100, the adjustable bell section expansion cone assembly 28 may then be rotated relative to the expandable wellbore casing to enhance and/or modify the rate at which the expandable wellbore casing is radially expanded and plastically deformed.

In an exemplary embodiment, the upper cam assembly 28052 and the upper expansion segments 28054 may be moved out of engagement with the lower expansion segments 28058 and the lower cam assembly 28060 by reducing the operating pressure within the annulus 28094.

Figure 16T:
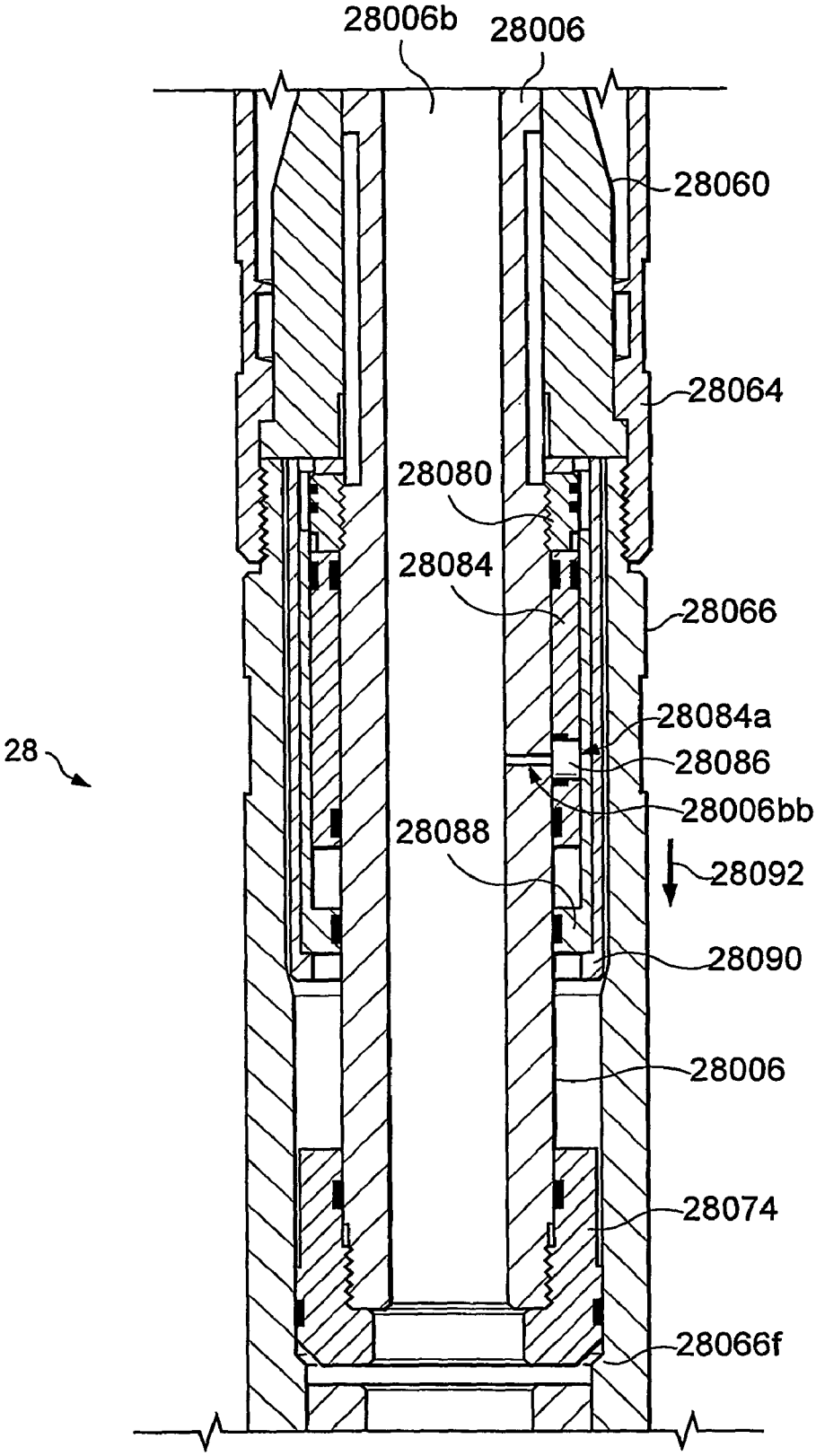

In an alternative embodiment, as illustrated in FIGS. 16S, 16T, 16U and 16V, during operation of the adjustable bell section expansion cone assembly 28, the upper cam assembly 28052 and the upper expansion segments 28054 may also be moved out of engagement with the lower expansion segments 28058 and the lower cam assembly 28060 by sensing the operating pressure within the longitudinal passage 28006*b* of the lower tubular mandrel 28006. In particular, as illustrated in FIG. 16T, if the operating pressure within the longitudinal passage 28006*b* and radial passage 28006*bb* of the lower tubular mandrel 28006 exceeds a predetermined value, the burst disc 28086 will open the passage 28084*a* thereby pressurizing the interior of the tubular release sleeve 28088 thereby displacing the tubular release sleeve 28088 downwardly in a direction 28092 away from engagement with the locking dogs 28080.

Figure 16U:
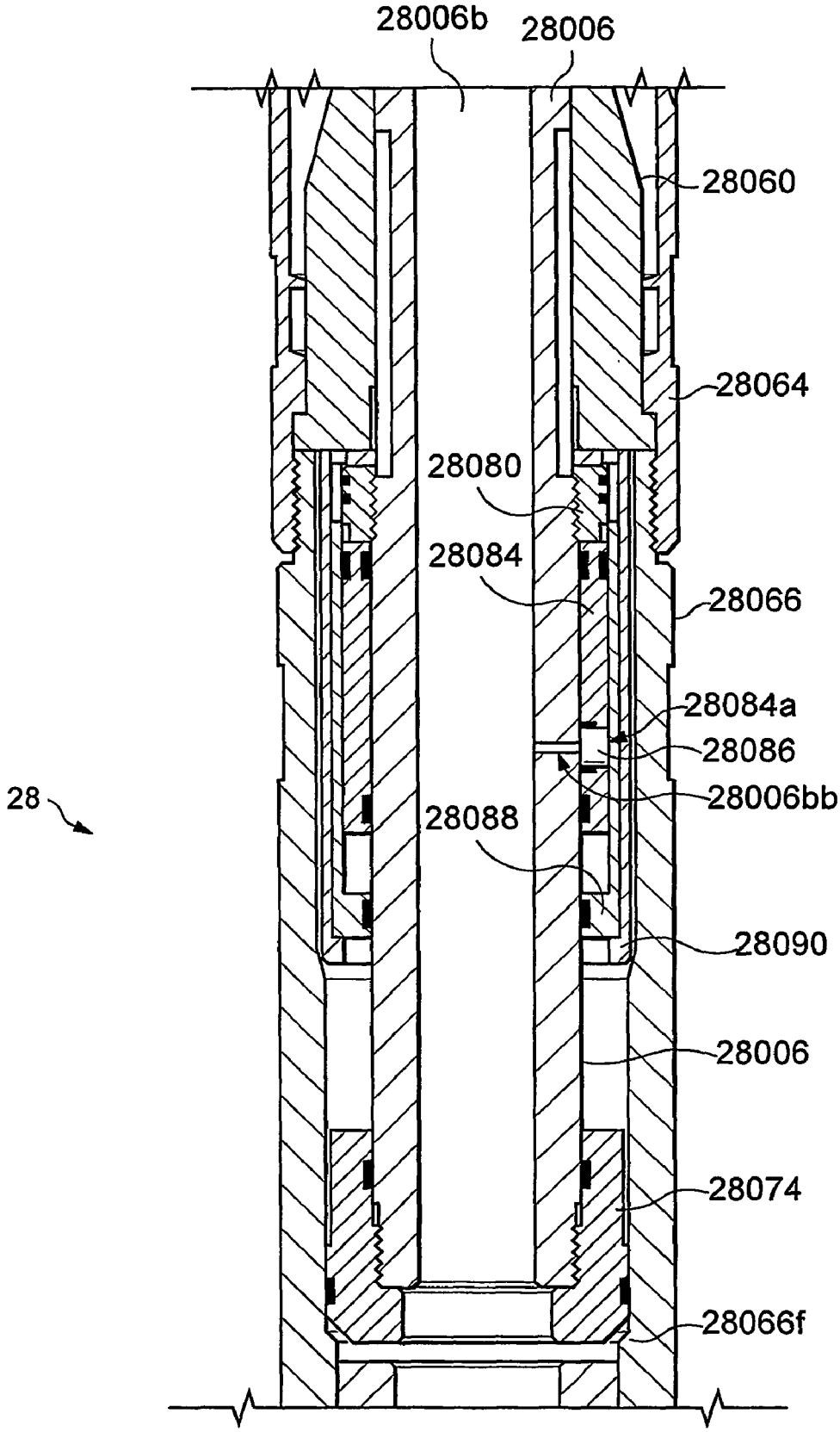

As a result, as illustrated in FIG. 16U, the locking dogs 28080 are displaced outwardly in the radial directed and thereby released from engagement with the lower tubular mandrel 28006 thereby permitting the lower expansion segments 28058 and the lower cam assembly 28060 to be displaced downwardly relative to the lower tubular mandrel.

Figure 16V:
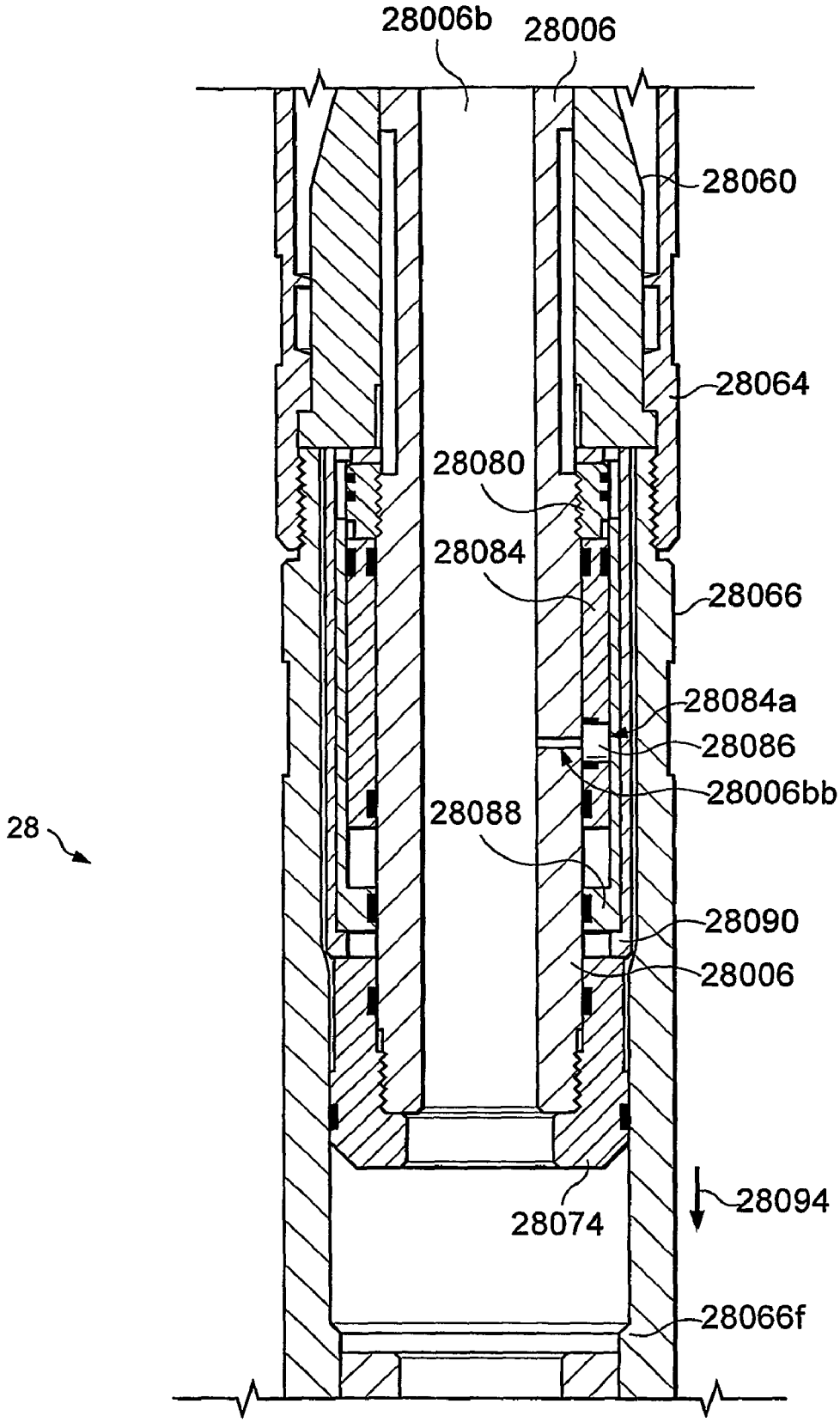

As a result, as illustrated in FIG. 16V, the operating pressure within the lower tubular mandrel 28066 may then cause the lower tubular mandrel to be displaced downwardly in the direction 28094 relative to the tubular lower mandrel 28006 and the retracting piston 28074. As a result, the lower tubular mandrel 28066, the lower expansion segments 28058, the lower cam assembly 28060, and tubular lower hinge sleeve 28064 are displaced downwardly in the direction 28094 relative to the tubular spring housing 28034 thereby moving the lower expansion segments 28058 and the lower cam assembly 28060 out of engagement with the upper cam assembly 28052 and the upper expansion segments 28054.

Figure 16W:
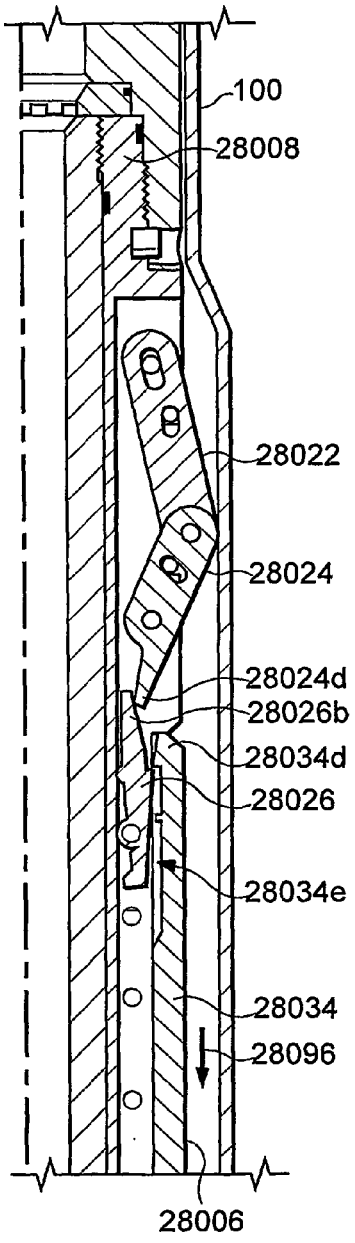
Figure 16X:
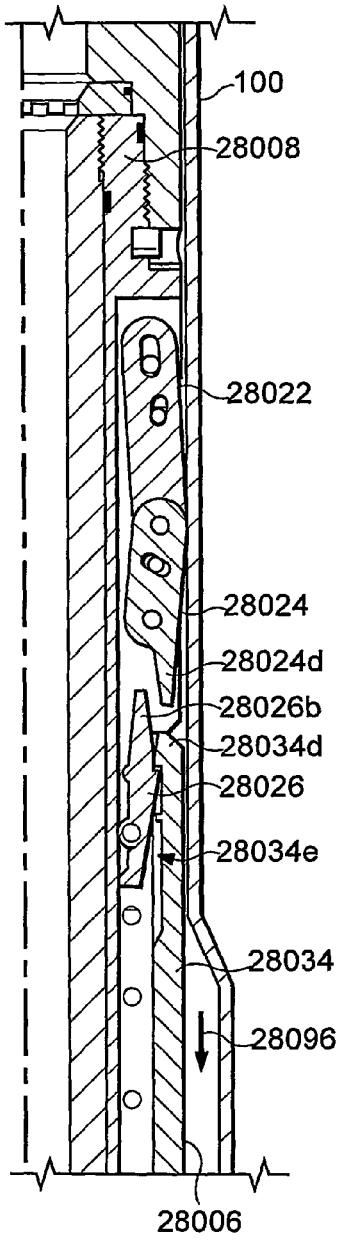
Figure 16Y:
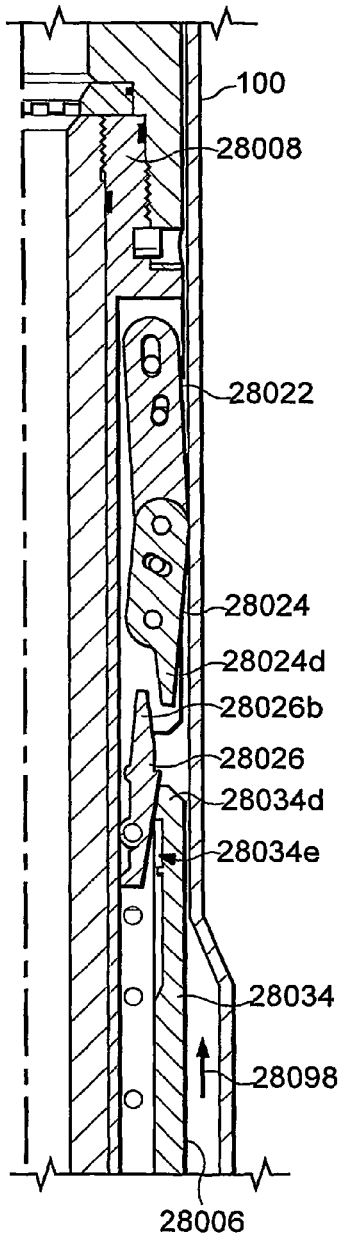

In an exemplary embodiment, as illustrated in FIGS. 16W, 16X, and 16Y, during operation of the adjustable bell section expansion cone assembly 28, the adjustable bell section expansion cone assembly senses the diameter of the expandable wellbore casing 100 using the upper toggle links, 28022 and 28028, lower toggle links, 28024 and 28030, and triggers, 28026 and 28032, and then prevents the engagement of the upper cam assembly 28052 and the upper expansion segments 28054 with the lower expansion segments 28058 and the lower cam assembly 28060.

In particular, as illustrated in FIG. 16W, anytime the upper toggle links, 28022 and 28028, and lower toggle links, 28024 and 28030, are positioned within a portion of the expandable wellbore casing 100 that has been radially expanded and plastically deformed by the system 10, the triggers, 28026 and 28032, will be pivoted by the engagement arms, 28024*d* and 28030*d*, of the lower toggle links, 28024 and 28030, to a position in which the triggers will no longer engage the internal flange 28034*d* of the end of the tubular spring housing 28034 thereby permitting the displacement of the tubular spring housing in the direction 28096. As a result, the upper cam assembly 28052 and the upper expansion segments 28054 can be brought into engagement with the lower expansion segments 28058 and the lower cam assembly 28060. In an exemplary embodiment, the upper toggle links, 28022 and 28028, and the lower toggle links, 28024 and 28030, are spring biased towards the position illustrated in FIG. 16W.

Conversely, as illustrated in FIG. 16X, anytime the upper toggle links, 28022 and 28028, and lower toggle links, 28024 and 28030, are positioned within a portion of the expandable wellbore casing 100 that has not been radially expanded and plastically deformed by the system 10, the triggers, 28026 and 28032, will be maintained in a position in which the triggers will engage the internal flange 28034*d* of the end of the tubular spring housing 28034 thereby preventing the displacement of the tubular spring housing in the direction 28096. As a result, the upper cam assembly 28052 and the upper expansion segments 28054 cannot be brought into engagement with the lower expansion segments 28058 and the lower cam assembly 28060. In an exemplary embodiment, the triggers, 28026 and 28032, are spring biased towards the position illustrated in FIG. 16X.

In an exemplary embodiment, as illustrated in FIG. 16Y, the tubular spring housing 28034 may be displaced upwardly in the direction 28098 even if the upper toggle links, 28022 and 28028, and lower toggle links, 28024 and 28030, are positioned within a portion of the expandable wellbore casing 100 that has not been radially expanded and plastically deformed by the system 10.

In an exemplary embodiment, as illustrated in FIGS. 16Z1 to 16Z4, 16AA1 to 16AA4, 16AB1 to 16AB4, 16AC1 to 16AC4, 16AD, and 16AE, the tubular spring housing 28034 of the adjustable bell section expansion cone assembly 28 defines internal annular recesses 28034*k* and 28034*l*, spaced apart by an internal flange 28034*m*, the tubular toggle bushing 28008 defines an external annular recess 28008*ac*, and the adjustable bell section expansion cone assembly further includes pins, 28100*a* and 28100*b* and 28102*a* and 28102*b*, mounted in holes 28008*j* and 28008*o* and 28008*k* and 28008*n*, respectively, of the tubular toggle bushing, and a one-shot deactivation device 28104 mounted on the tubular toggle bushing between the pins, 28100*a* and 28100*b* and 28102*a* and 28102*b*.

The one-shot deactivation device 28104 includes a tubular body 28104*a* that defines radial holes, 28104*b* and 28014*c*, and includes an external annular recess 28104*d* at one end, a centrally positioned external flange 28104*e*, a centrally positioned internal annular recess 28104*f*, and an external annular recess 28104*g* at another end. An engagement member 28106 that includes a base member 28106*a* having a tapered end 28106*b* and a key member 28106*c* having a tapered end 28106*d* is received within a portion of the internal annular recess 28104*f* of the tubular body 28104*a* and an engagement member 28108 that includes a base member 28108*a* having a tapered end 28108*b* and a key member 28108*c* having a tapered end 28108*d* is received within an opposite portion of the internal annular recess 28104*f* of the tubular body 28104*a*. Spring members, 28110 and 28112, are received within the annular recess 28104*f* of the tubular body 28104*a* for biasing the base members, base member 28106*a* and 28108*a*, of the engagement members, 28106 and 28108, respectively, radially inwardly relative to the tubular body 28104*a*.

In an exemplary embodiment, during operation of the adjustable bell section expansion cone assembly 28, as illustrated in FIGS. 16Z1 to 16Z4, the one-shot deactivation device 28104 are positioned proximate and in intimate contact with the pins, 28102*a* and 28102*b*, with the tapered ends, 28106*b* and 28108*b*, of the base members, 28106*a* and 28108*a*, of the engagement members, 28106 and 28108, received within the external annular recess 28008*ac* of the tubular toggle bushing 28008. When the one-shot deactivation device 28104 is positioned as illustrated in FIGS. 16Z1 to 16Z4, the external annular recess 28104*d* of the tubular body 28104*a* of the one-shot deactivation device is moved out of engagement with the engagement arms, 28026*d* and 28032*d*, of the triggers, 28026 and 28032, respectively. As a result, the triggers, 28026 and 28032, may operate normally as described above with reference to FIGS. 16W, 16X, and 16Y.

Figure 16A:
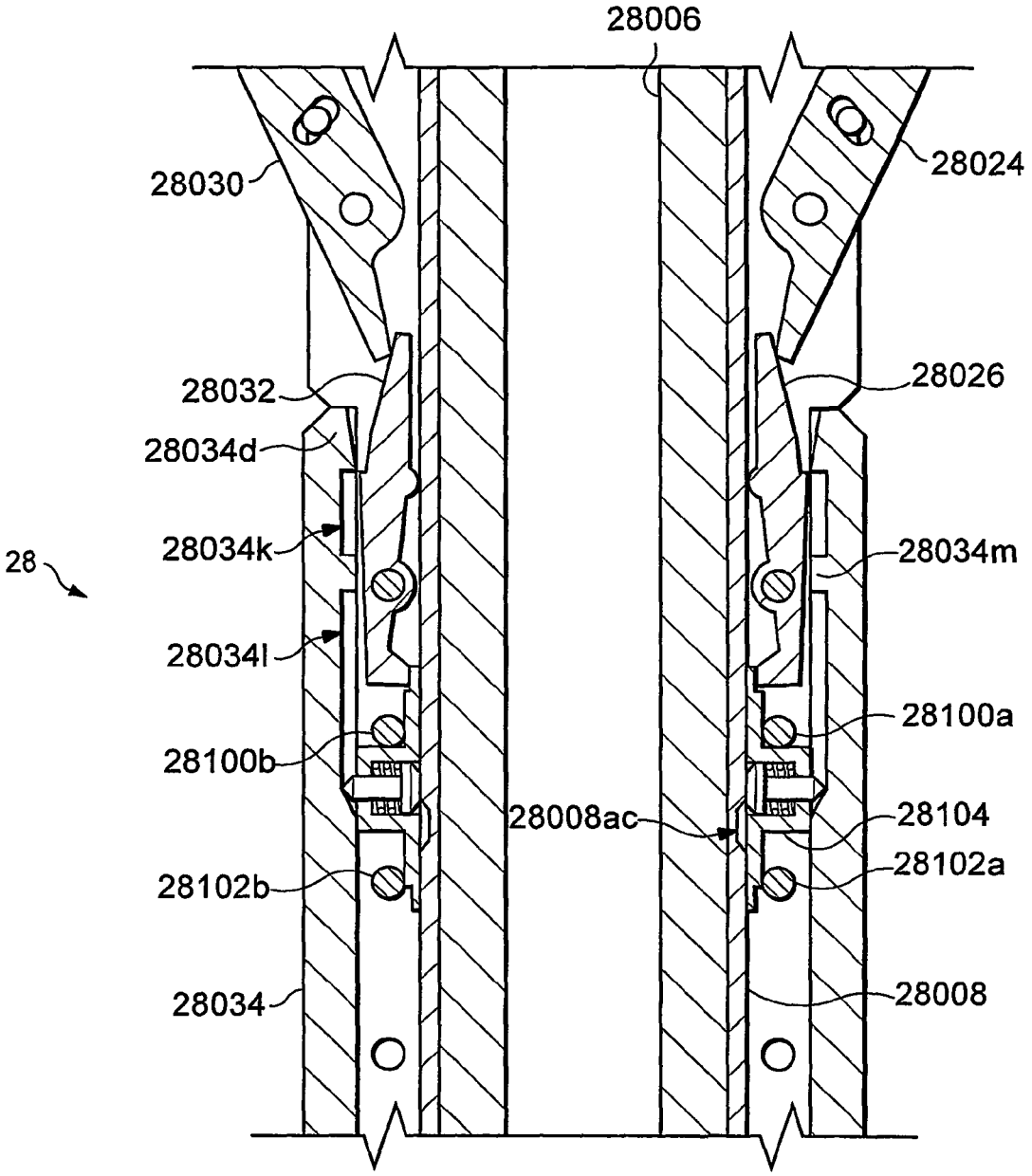
Figure 16A:
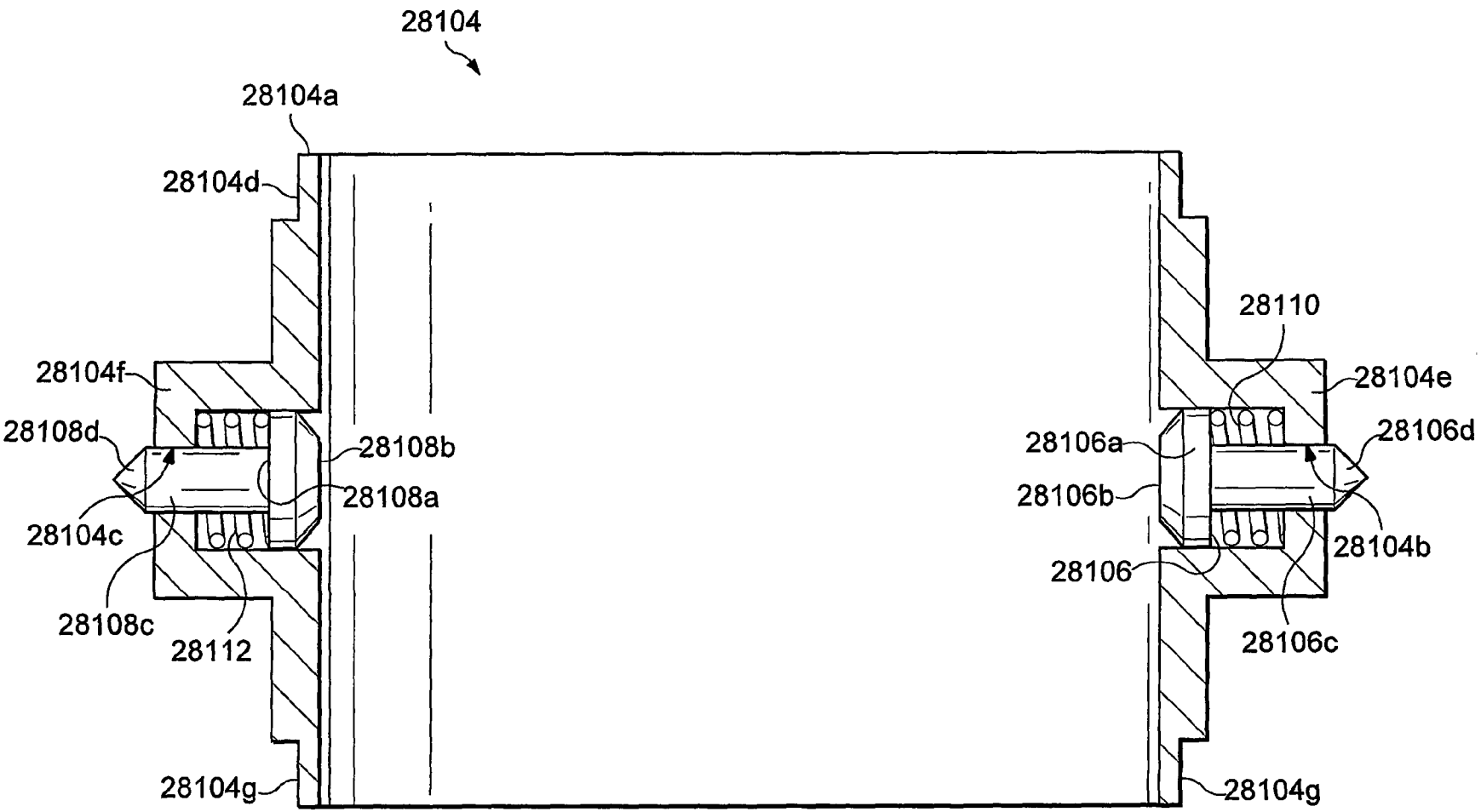

Conversely, in an exemplary embodiment, during operation of the adjustable bell section expansion cone assembly 28, as illustrated in FIGS. 16AA1 to 16AA4, the one-shot deactivation device 28104 are positioned proximate and in intimate contact with the pins, 28100*a* and 28100*b*, with the tapered ends, 28106*b* and 28108*b*, of the base members, 28106*a* and 28108*a*, of the engagement members, 28106 and 28108, not received within the external annular recess 28008*ac* of the tubular toggle bushing 28008. When the one-shot deactivation device 28104 is positioned as illustrated in FIG. 16AA, the external annular recess 28104*d* of the tubular body 28104*a* of the one-shot deactivation device is moved into engagement with the engagement arms, 28026*d* and 28032*d*, of the triggers, 28026 and 28032, respectively. As a result, the triggers, 28026 and 28032, are deactivated and may not operate normally as described above with reference to FIGS. 16W, 16X, and 16Y.

In an alternative embodiment, the elements of the adjustable bell section expansion cone assembly 28 that sense the diameter of the expandable wellbore casing 100 may be disabled or omitted or adjusted to sense any pre-selected internal diameter of the expandable wellbore casing.

In an exemplary embodiment, the adjustable casing expansion cone assembly 30 operates and is provided substantially, at least in part, as disclosed in one or more of the following: (1) PCT patent application serial number PCT/US02/36157, filed on Nov. 12, 2002, and/or (2) PCT patent application serial number PCT/US02/36267, filed on Nov. 12, 2002, and/or (3) PCT patent application serial number PCT/US03/04837, filed on Feb. 29, 2003, and/or (4) PCT patent application serial number PCT/US03/29859, filed on Sep. 22, 2003, and/or (5) PCT patent application serial number PCT/US03/14153, filed on Nov. 13, 2003, and/or (6) PCT patent application serial number PCT/US03/18530, filed on Jun. 11, 2003, and/or (7) PCT patent application serial number PCT/US04/07711, filed on Mar. 11, 2004, and/or (8) PCT patent application serial number PCT/US04/09434, filed on Mar. 26, 2004, and/or (9) PCT patent application serial number PCT/US04/10317, filed on Apr. 2, 2004, and/or (10) PCT patent application serial number PCT/US04/10712, filed on Apr. 7, 2004, and/or (10) PCT patent application serial number PCT/US04/10762, filed on Apr. 6, 2004, the disclosures of which are incorporated herein by reference.

In an exemplary embodiment, as illustrated in FIGS. 17-1 and 17-2, 17A1 to 17A2, 17B1 to 17B2, 17C, 17D, 17E, 17F, 17G, 17H, 17I, 17*j*, 17K, 17L, 17M, 17N, 170, 17P, 17R, 17S, 17T, 17U, 17V, 17W, 17*x*, 17Y, 17Z1-17Z4, 17AA1 to 17AA4, 17AB1 to 17AB4, 17AC1 to 17AC4, 17AD, and 17AE, the adjustable casing expansion cone assembly 30 includes an upper tubular tool joint 30002 that defines a longitudinal passage 30002*a* and mounting holes, 30002*b* and 30002*c*, and includes an internal threaded connection 30002*d*, an inner annular recess 30002*e*, an inner annular recess 30002*f*, and an internal threaded connection 30002*g*. A tubular torque plate 30004 that defines a longitudinal passage 30004*a* and includes circumferentially spaced apart teeth 30004*b* is received within, mates with, and is coupled to the internal annular recess 30002*e* of the upper tubular tool joint 30002.

Circumferentially spaced apart teeth 30006*a* of an end of a tubular lower mandrel 30006 that defines a longitudinal passage 30006*b*, a radial passage 30006*ba*, and a radial passage 30006*bb* and includes an external threaded connection 30006*c*, an external flange 30006*d*, an external annular recess 30006*e* having a step 30006*f* at one end, an external annular recess 30006*g*, external teeth 30006*h*, an external threaded connection 30006*i*, and an external annular recess 30006*j* engage the circumferentially spaced apart teeth 30004*b* of the tubular torque plate 30004. An internal threaded connection 30008*a* of an end of a tubular toggle bushing 30008 that defines a longitudinal passage 30008*b*, an upper longitudinal slot 30008*c*, a lower longitudinal slot 30008*d*, mounting holes, 30008*e*, 30008*f*, 30008*g*, 30008*h*, 30008*i*, 30008*j*, 30008*k*, 30008*l*, 30008*m*, 30008*n*, 30008*o*, 30008*p*, 30008*q*, 30008*r*, 30008*s*, 30008*t*, 30008*u*, 30008*v*, 30008*w*, 30008*x*, 30008*xa*, and 30008*xb*, and includes an external annular recess 30008*y*, internal annular recess 30008*z*, external annular recess 30008*aa*, and an external annular recess 30008*ab* receives and is coupled to the external threaded connection 30006*c* of the tubular lower mandrel 30006.

A sealing element 30010 is received within the external annular recess 30008*y* of the tubular toggle bushing 30008 for sealing the interface between the tubular toggle bushing and the upper tubular tool joint 30002. A sealing element 30012 is received within the internal annular recess 30008*z* of the tubular toggle bushing 30008 for sealing the interface between the tubular toggle bushing and the tubular lower mandrel 30006.

Mounting screws, 30014*a* and 30014*b*, mounted within and coupled to the mounting holes, 30008*w* and 30008*x*, respectively, of the tubular toggle bushing 30008 are also received within the mounting holes, 30002*b* and 30002*c*, of the upper tubular tool joint 30002. Mounting pins, 30016*a*, 30016*b*, 30016*c*, 30016*d*, and 30016*e*, are mounted within the mounting holes, 30008*e*, 30008*f*, 30008*g*, 30008*h*, and 30008*i*, respectively. Mounting pins, 30018*a*, 30018*b*, 30018*c*, 30018*d*, and 30018*e*, are mounted within the mounting holes, 30008*t*, 30008*s*, 30008*r*, 30008*q*, and 30008*p*, respectively. Mounting screws, 30020*a* and 30020*b*, are mounted within the mounting holes, 30008*u* and 30008*v*, respectively.

A first upper toggle link 30022 defines mounting holes, 30022*a* and 30022*b*, for receiving the mounting pins, 30016*a* and 30016*b*, and includes a mounting pin 30022*c* at one end. A first lower toggle link 30024 defines mounting holes, 30024*a*, 30024*b*, and 30024*c*, for receiving the mounting pins, 30022*c*, 30016*c*, and 30016*d*, respectively and includes an engagement arm 30024*d*. A first trigger 30026 defines a mounting hole 30026*a* for receiving the mounting pin 30016*e* and includes an engagement arm 30026*b* at one end, an engagement member 30026*c*, and an engagement arm 30026*d* at another end.

A second upper toggle link 30028 defines mounting holes, 30028*a* and 30028*b*, for receiving the mounting pins, 30018*a* and 30018*b*, and includes a mounting pin 30028*c* at one end. A second lower toggle link 30030 defines mounting holes, 30030*a*, 30030*b*, and 30030*c*, for receiving the mounting pins, 30028*c*, 30018*c*, and 30018*d*, respectively and includes an engagement arm 30030*d*. A second trigger 30032 defines a mounting hole 30032*a* for receiving the mounting pin 30018*e* and includes an engagement arm 30032*b* at one end, an engagement member 30032*c*, and an engagement arm 30032*d* at another end.

An end of a tubular spring housing 30034 that defines a longitudinal passage 30034*a*, mounting holes, 30034*b* and 30034*c*, and mounting holes, 30034*ba* and 30034*ca*, and includes an internal flange 30034*d* and an internal annular recess 30034*e* at one end, and an internal flange 30034*f*, an internal annular recess 30034*g*, an internal annular recess 30034*h*, and an external threaded connection 30034*i* at another end receives and mates with the end of the tubular toggle bushing 30008. Mounting screws, 30035*a* and 30035*b*, are mounted within and coupled to the mounting holes, 30008*xb* and 30008*xa*, respectively, of the tubular toggle bushing 30008 and are received within the mounting holes, 30034*ba* and 30034*ca*, respectively, of the tubular spring housing 30034.

A tubular retracting spring ring 30036 that defines mounting holes, 30036*a* and 30036*b*, receives and mates with a portion of the tubular lower mandrel 30006 and is received within and mates with a portion of the tubular spring housing 30034. Mounting screws, 30038*a* and 30038*b*, are mounted within and coupled to the mounting holes, 30036*a* and 30036*b*, respectively, of the tubular retracting spring ring 30036 and extend into the mounting holes, 30034*b* and 30034*c*, respectively, of the tubular spring housing 30034.

Casing diameter sensor springs, 30040*a* and 30040*b*, are positioned within the longitudinal slots, 30008*c* and 3008*d*, respectively, of the tubular toggle bushing 30008 that engage the engagement members, 30026*c* and 30032*c*, and engagement arms, 30026*d* and 30032*d*, of the first and second triggers, 30026 and 30032, respectively. An inner flange 30042*a* of an end of a tubular spring washer 30042 mates with and receives a portion of the tubular lower mandrel 30006 and an end face of the inner flange of the tubular spring washer is positioned proximate and end face of the external flange 30006*d* of the tubular lower mandrel. The tubular spring washer 30042 is further received within the longitudinal passage 30034*a* of the tubular spring housing 30034.

An end of a retracting spring 30044 that receives the tubular lower mandrel 30006 is positioned within the tubular spring washer 30042 in contact with the internal flange 30042*a* of the tubular spring washer and the other end of the retracting spring is positioned in contact with an end face of the tubular retracting spring ring 30036.

A sealing element 30046 is received within the external annular recess 30006*j* of the tubular lower mandrel 30006 for sealing the interface between the tubular lower mandrel and the tubular spring housing 30034. A sealing element 30048 is received within the internal annular recess 30034*h* of the tubular spring housing 30034 for sealing the interface between the tubular spring housing and the tubular lower mandrel 30006.

An internal threaded connection 30050*a* of an end of a tubular upper hinge sleeve 30050 that includes an internal flange 30050*b* and an internal pivot 30050*c* receives and is coupled to the external threaded connection 30034*i* of the end of the tubular spring housing 30034.

An external flange 30052*a* of a base member 30052*b* of an upper cam assembly 30052, that is mounted upon and receives the lower tubular mandrel 30006, that includes an internal flange 30052*c* that is received within the external annular recess 30006*e* of the lower tubular mandrel 30006 and a plurality of circumferentially spaced apart tapered cam arms 30052*d* extending from the base member mates with and is received within the tubular upper hinge sleeve 30050. The base member 30052*b* of the upper cam assembly 30052 further includes a plurality of circumferentially spaced apart teeth 30052*f* that mate with and are received within a plurality of circumferentially spaced apart teeth 30034*j* provided on the end face of the tubular spring housing 30034 and an end face of the external flange 30052*a* of the base member of the upper cam assembly is positioned in opposing relation to an end face of the internal flange 30050*b* of the tubular upper hinge sleeve 30050. Each of the cam arms 30052*d* of the upper cam assembly 30052 include external cam surfaces 30052*e*. In an exemplary embodiment, the teeth 30052*f* of the base member 30052*b* of the upper cam assembly 30052 and the teeth 30034*j* provided on the end face of the tubular spring housing 30034 permit torsional loads to be transmitted between the tubular spring housing and the upper cam assembly.

A plurality of circumferentially spaced apart upper expansion segments 30054 are mounted upon and receive the lower tubular mandrel 30006 and each include an external pivot recess 30054*a* at one end for mating with and receiving the internal pivot 30050*c* of the tubular upper hinge sleeve 30050 and an external tapered expansion surface 30054*b* at another end and are pivotally mounted within the tubular upper hinge sleeve and are interleaved with the circumferentially spaced apart cam arms 30052*d* of the upper cam assembly 30052. The upper expansion segments 30054 are interleaved among the cam arms 30052*d* of the upper cam assembly 30052.

A plurality of circumferentially spaced apart lower expansion segments 30058 are mounted upon and receive the lower tubular mandrel 30006, are interleaved among the upper expansion segments 30054, are oriented in the opposite direction to the upper expansion segments 30054, each include an external pivot recess 30058*a* at one end and an external tapered expansion surface 30054*b* at another end and are positioned in opposing relation to corresponding circumferentially spaced apart cam arms 30052*d* of the upper cam assembly 30052.

A lower cam assembly 30060 is mounted upon and receives the lower tubular mandrel 30006 that includes a base member 30060*a* having an external flange 30060*b*, a plurality of circumferentially spaced apart cam arms 30060*d* that extend from the base member that each include external cam surfaces 30060*e* and define mounting holes 30060*f* and 30060*g*. The base member 30060*a* of the lower cam assembly 30060 further includes a plurality of circumferentially spaced apart teeth 30060*h*. The circumferentially spaced apart cam arms 30060*d* of the lower cam assembly 30060 are interleaved among the lower expansion segments 30058 and the circumferentially spaced apart cam arms 30052*d* of the upper cam assembly 30052 and positioned in opposing relation to corresponding upper expansion segments 30054.

Mounting screws, 30062*a*, 30062*b*, 30062*c*, and 30062*e*, are mounted within the corresponding mounting holes, 30060*f* and 30060*g*, of the lower cam assembly 30060 and are received within the external annular recess 30006*g* of the lower cam assembly 30060.

A tubular lower hinge sleeve 30064 that receives the lower expansion segments 30058 and the lower cam assembly 30060 includes an internal flange 30064*a* for engaging the external flange 30060*b* of the base member of the lower cam assembly 30060, an internal pivot 30064*b* for engaging and receiving the external pivot recess 30058*a* of the lower expansion segments 30058 thereby pivotally mounting the lower expansion segments within the tubular lower hinge sleeve, and an internal threaded connection 30064*c*.

An external threaded connection 30066*a* of an end of a tubular sleeve 30066 that defines mounting holes, 30066*b* and 30066*c*, and includes an internal annular recess 30066*d* having a shoulder 30066*e*, an internal flange 30066*f*, and an internal threaded connection 30066*g* at another end is received within and coupled to the internal threaded connection 30064*c* of the tubular lower hinge sleeve 30064. An external threaded connection 30068*a* of an end of a tubular member 30068 that defines a longitudinal passage 30068*b* and mounting holes, 30068*c* and 30068*d*, and includes an external annular recess 30068*e*, and an external threaded connection 30068*f* at another end is received within and is coupled to the internal threaded connection 30066*g* of the tubular sleeve 30066.

Mounting screws, 30070*a* and 30070*b*, are mounted in and coupled to the mounting holes, 30068*c* and 30068*d*, respectively, of the tubular member 30068 that also extend into the mounting holes, 30066*b* and 30066*c*, respectively, of the tubular sleeve 30066. A sealing element 30072 is received within the external annular recess 30068*e* of the tubular member 30068 for sealing the interface between the tubular member and the tubular sleeve 30066.

An internal threaded connection 30074*a* of a tubular retracting piston 30074 that defines a longitudinal passage 30074*b* and includes an internal annular recess 30074*c* and an external annular recess 30074*d* receives and is coupled to the external threaded connection 30006*i* of the tubular lower mandrel 30006. A sealing element 30076 is received within the external annular recess 30074*d* of the tubular retracting piston 30074 for sealing the interface between the tubular retracting piston and the tubular sleeve 30066. A sealing element 30078 is received within the internal annular recess 30074*c* of the tubular retracting piston 30074 for sealing the interface between the tubular retracting piston and the tubular lower mandrel 30006.

Locking dogs 30080 mate with and receive the external teeth 30006*h* of the tubular lower mandrel 30006. A spacer ring 30082 is positioned between an end face of the locking dogs 30080 and an end face of the lower cam assembly 30060. A release piston 30084 mounted upon the tubular lower mandrel 30006 defines a radial passage 30084*a* for mounting a burst disk 30086 includes sealing elements, 30084*b*, 30084*c*, and 30084*d*. The sealing elements, 30084*b* and 30084*d*, sealing the interface between the release piston 30084 and the tubular lower mandrel 30006. An end face of the release piston 30084 is positioned in opposing relation to an end face of the locking dogs 30080.

A release sleeve 30088 that receives and is mounted upon the locking dogs 30080 and the release piston 30084 includes an internal flange 30088*a* at one end that sealingly engages the tubular lower mandrel 30006. A bypass sleeve 30090 that receives and is mounted upon the release sleeve 30088 includes an internal flange 30090*a* at one end.

In an exemplary embodiment, during operation of the adjustable casing expansion cone assembly 30, the retracting spring 30044 is compressed and thereby applies a biasing spring force in a direction 30092 from the lower tubular mandrel 30006 to the tubular spring housing 30034 that, in the absence of other forces, moves and/or maintains the upper cam assembly 30052 and the upper expansion segments 30054 out of engagement with the lower expansion segments 30058 and the lower cam assembly 30060. In an exemplary embodiment, during operation of the adjustable bell section expansion cone assembly 28, an external threaded connection 20*a* of an end of the sealing cup assembly 20 is coupled to the internal threaded connection 30002*d* of the upper tubular tool joint 30002 and an internal threaded connection 30*a* of an end of the adjustable casing expansion cone assembly 30 is coupled to the external threaded connection 30068*f* of the tubular member 30068.

The upper cam assembly 30052 and the upper expansion segments 30054 may be brought into engagement with the lower expansion segments 30058 and the lower cam assembly 30060 by pressurizing an annulus 30094 defined between the lower tubular mandrel 30006 and the tubular spring housing 30034. In particular, injection of fluidic materials into the adjustable casing expansion cone assembly 30 through the longitudinal passage 30006*b* of the lower tubular mandrel 30006 and into the radial passage 30006*ba* may pressurize the annulus 30094 thereby creating sufficient operating pressure to generate a force in a direction 30096 sufficient to overcome the biasing force of the retracting spring 30044. As a result, the spring housing 30034 may be displaced in the direction 30096 relative to the lower tubular mandrel 30006 thereby displacing the tubular upper hinge sleeve 30050, upper cam assembly 30052, and upper expansion segments 30054 in the direction 30096.

Figures 1, 17:
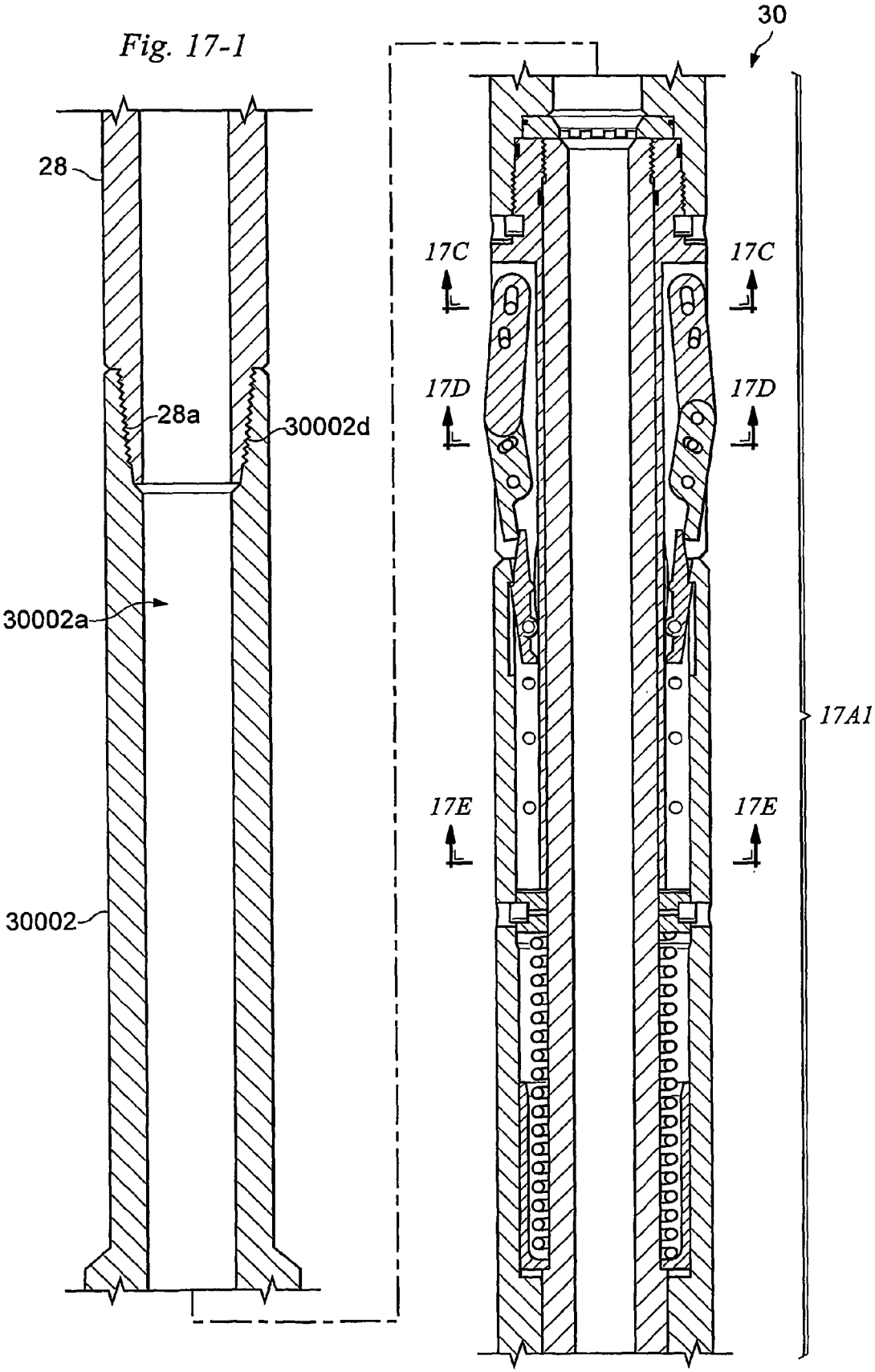
Figures 2, 17:
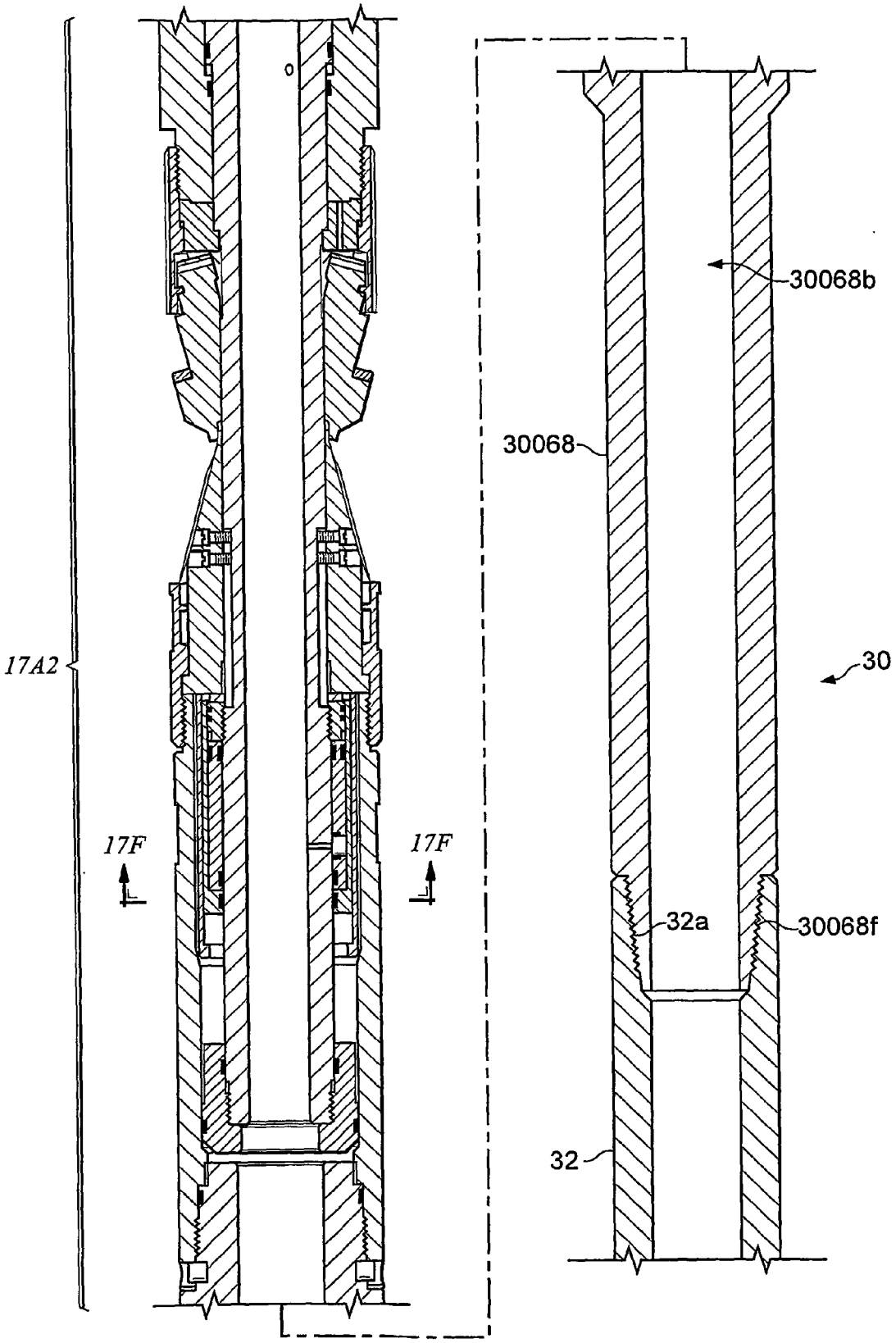
Figure 17C:
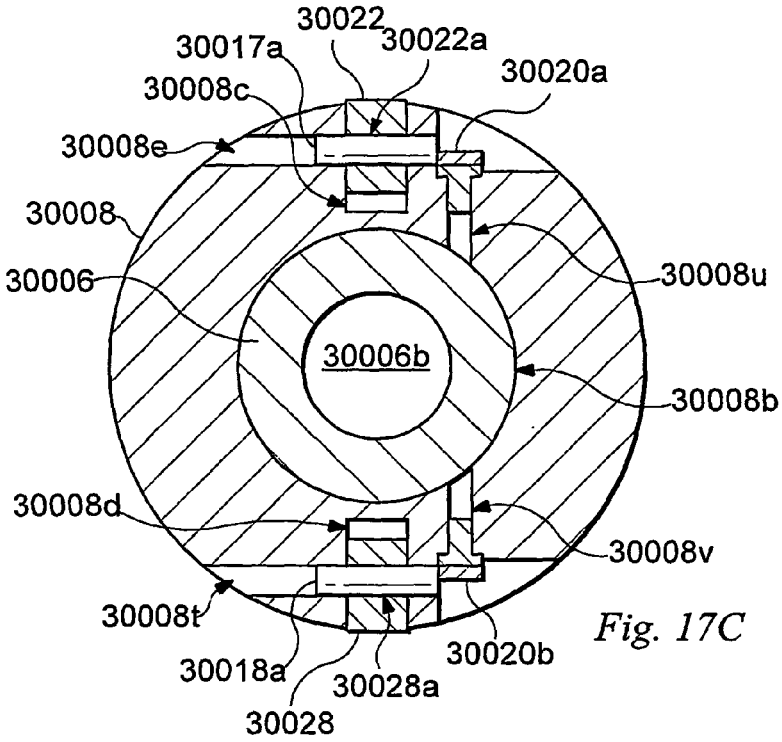
Figure 17D:
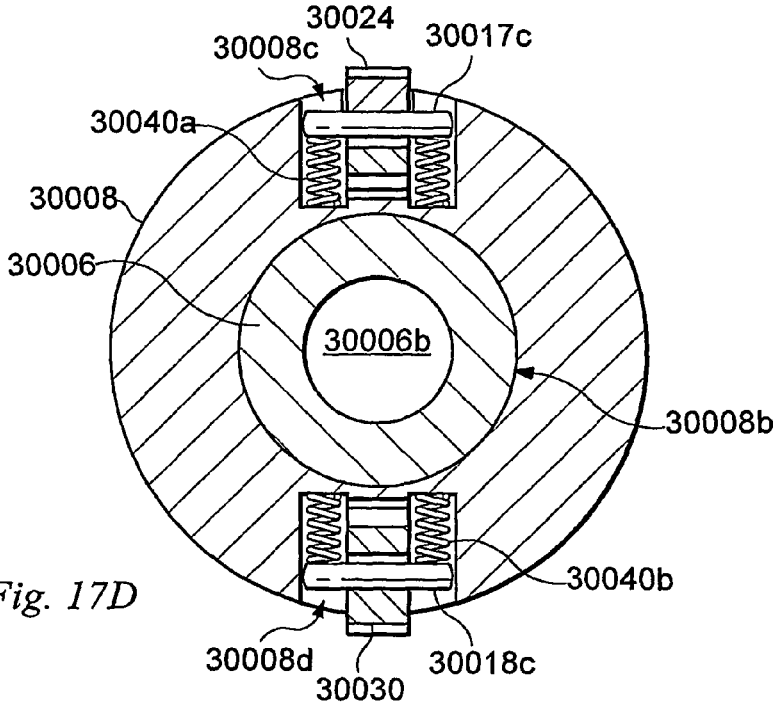
Figure 17E:
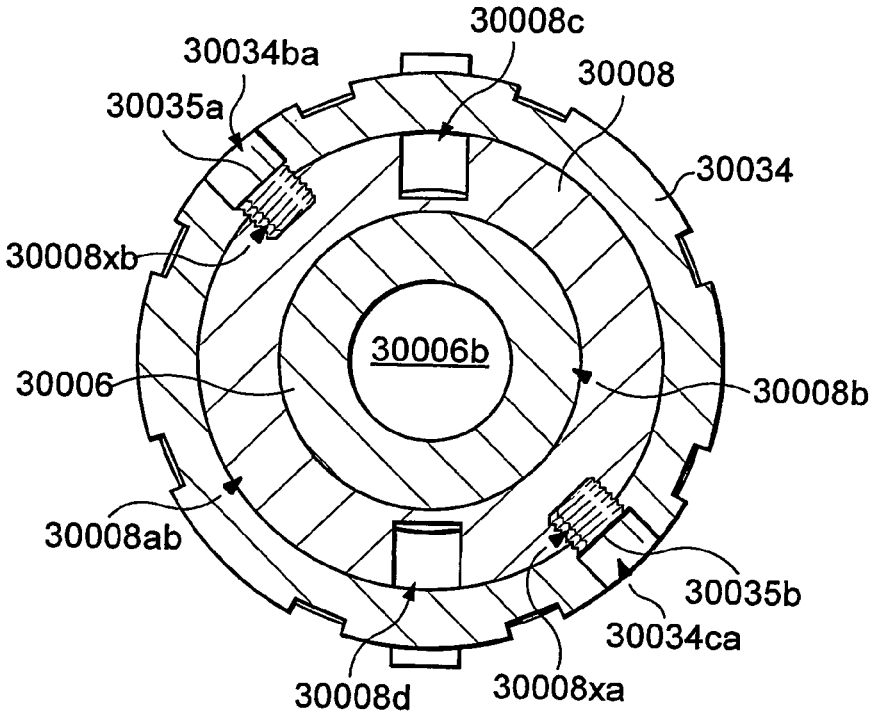
Figure 17F:
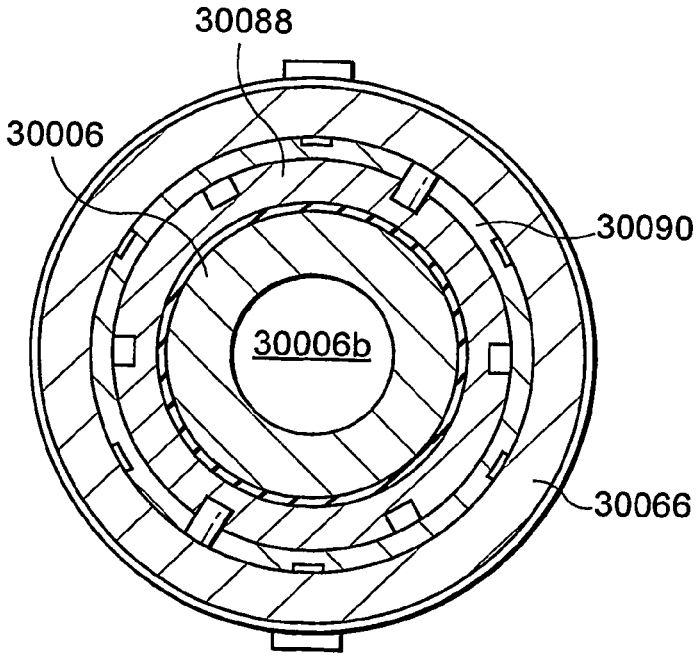
Figure 17G:
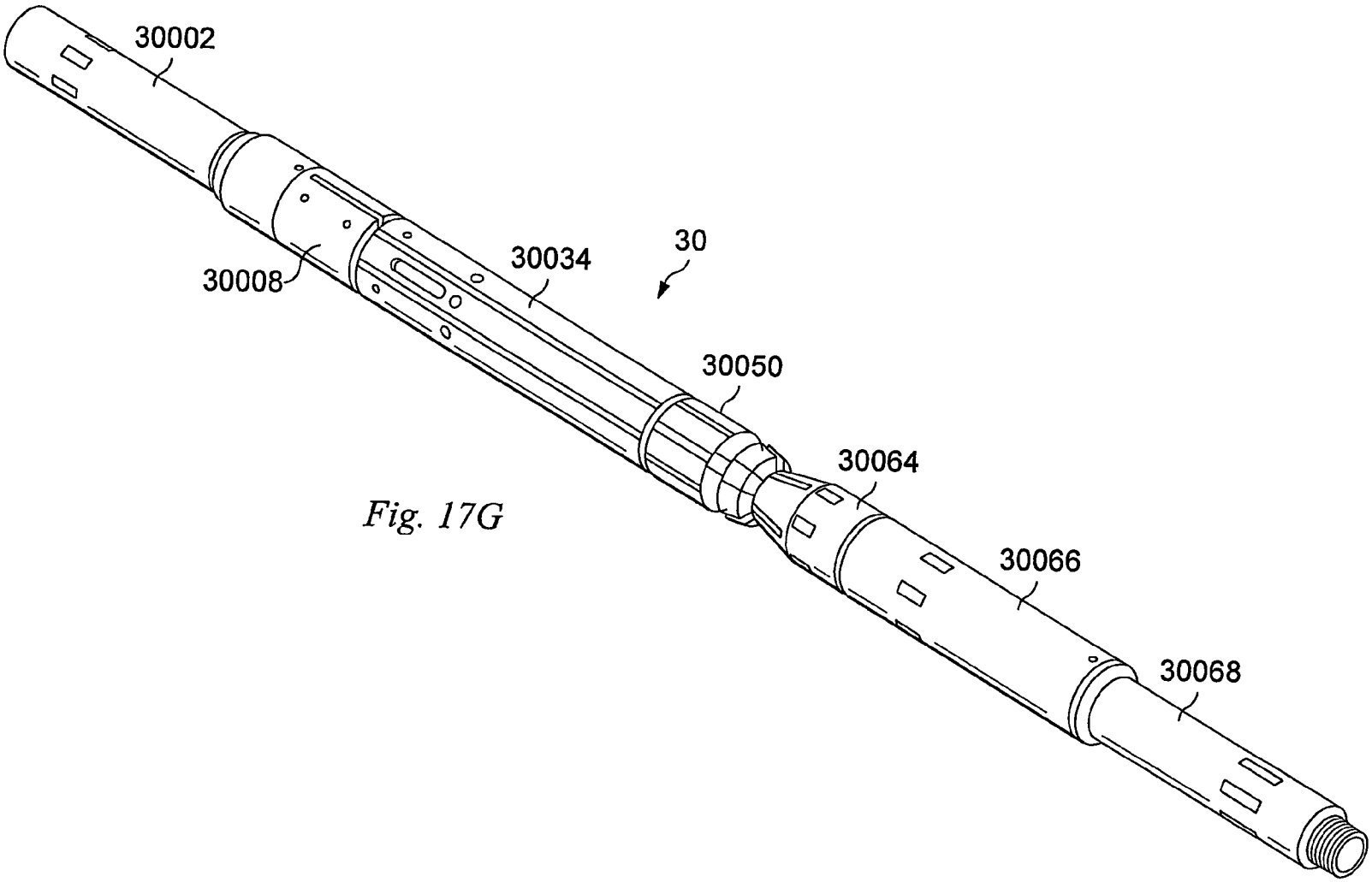
Figure 17H:
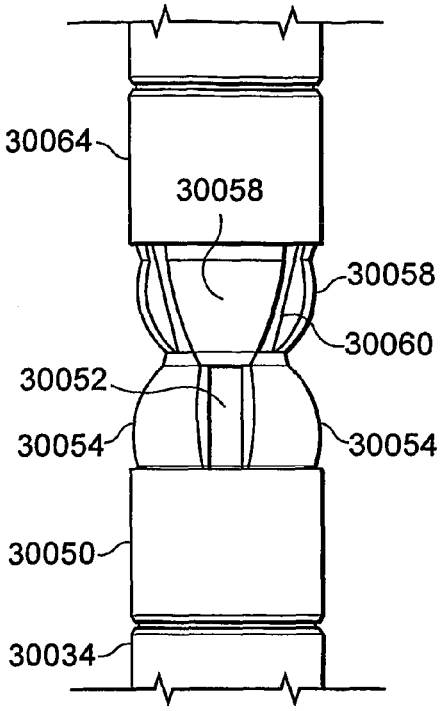
Figure 17I:
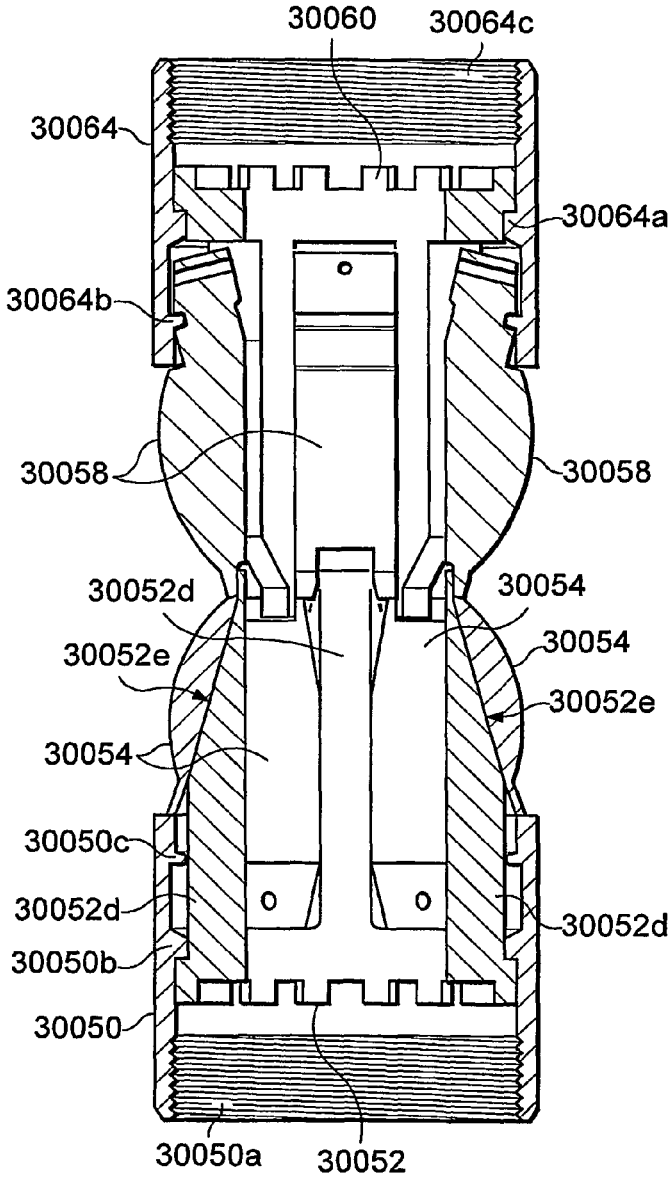
Figure 17J:
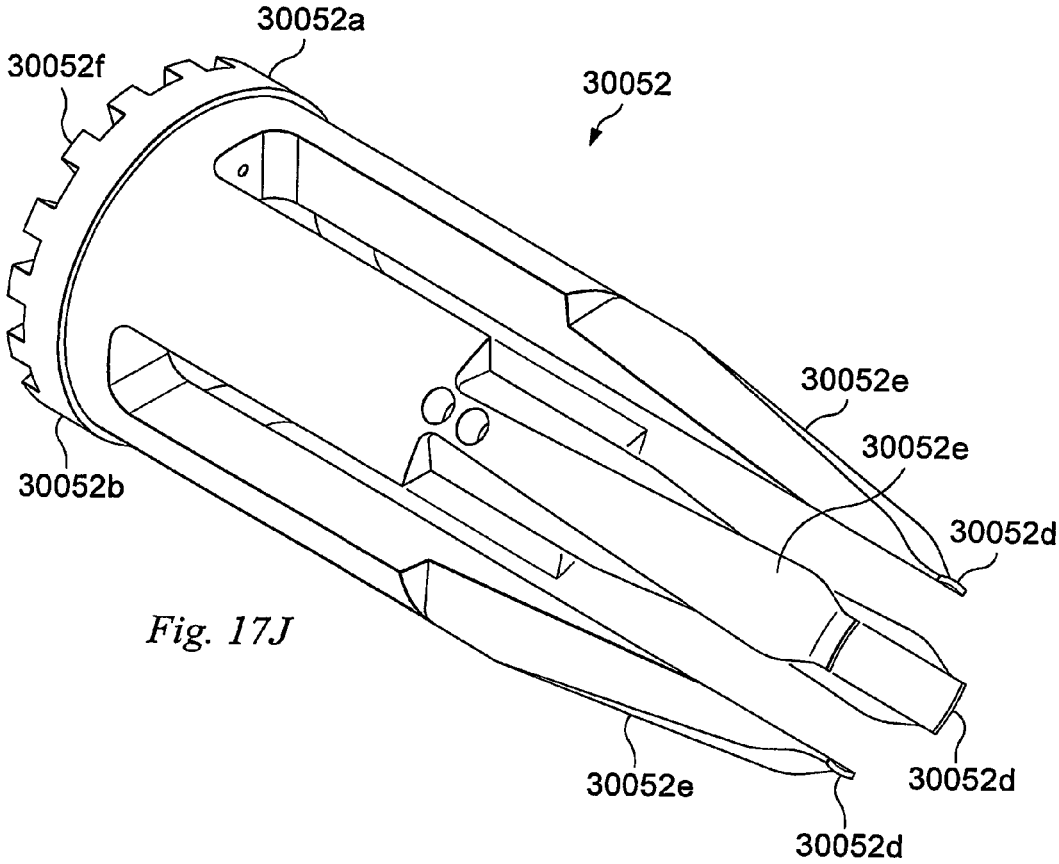
Figure 17K:
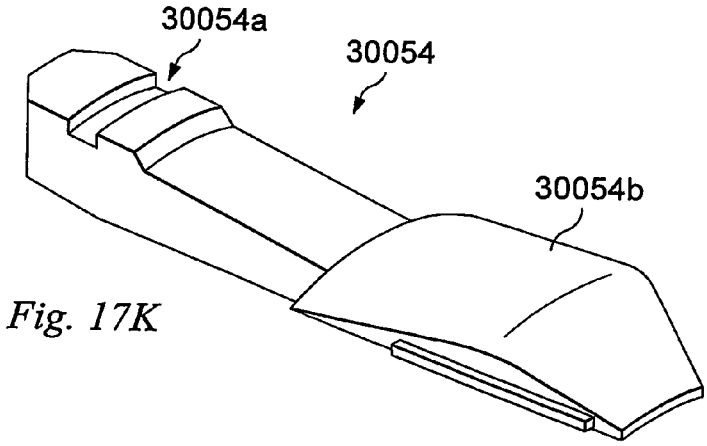
Figure 17L:
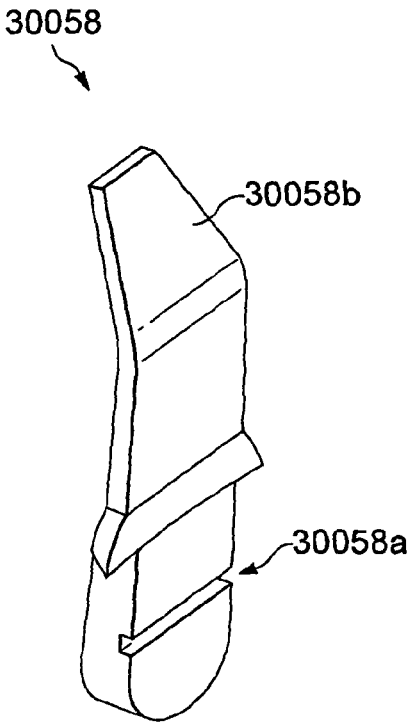
Figure 17M:
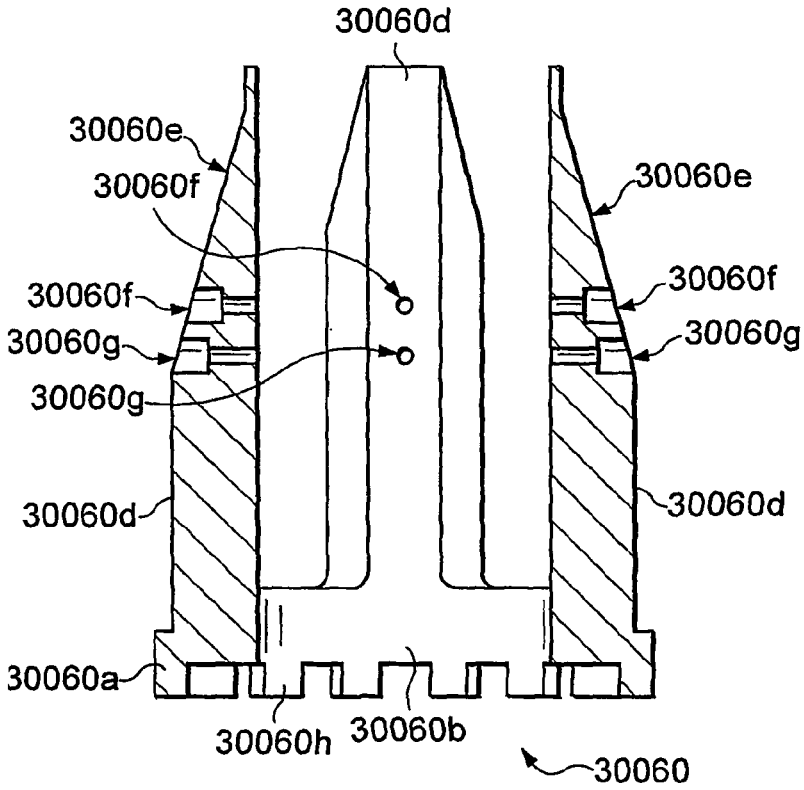
Figure 17N:
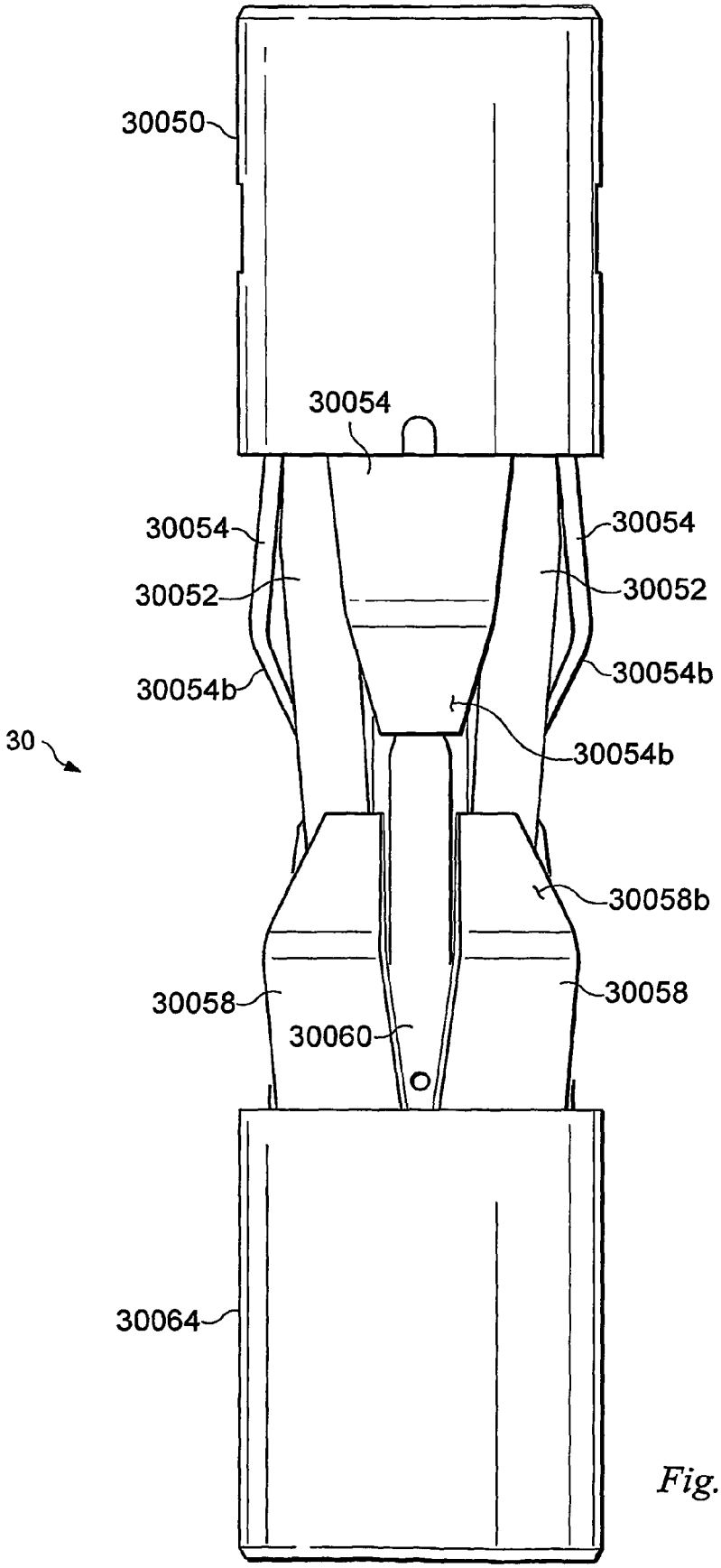
Figure 17O:
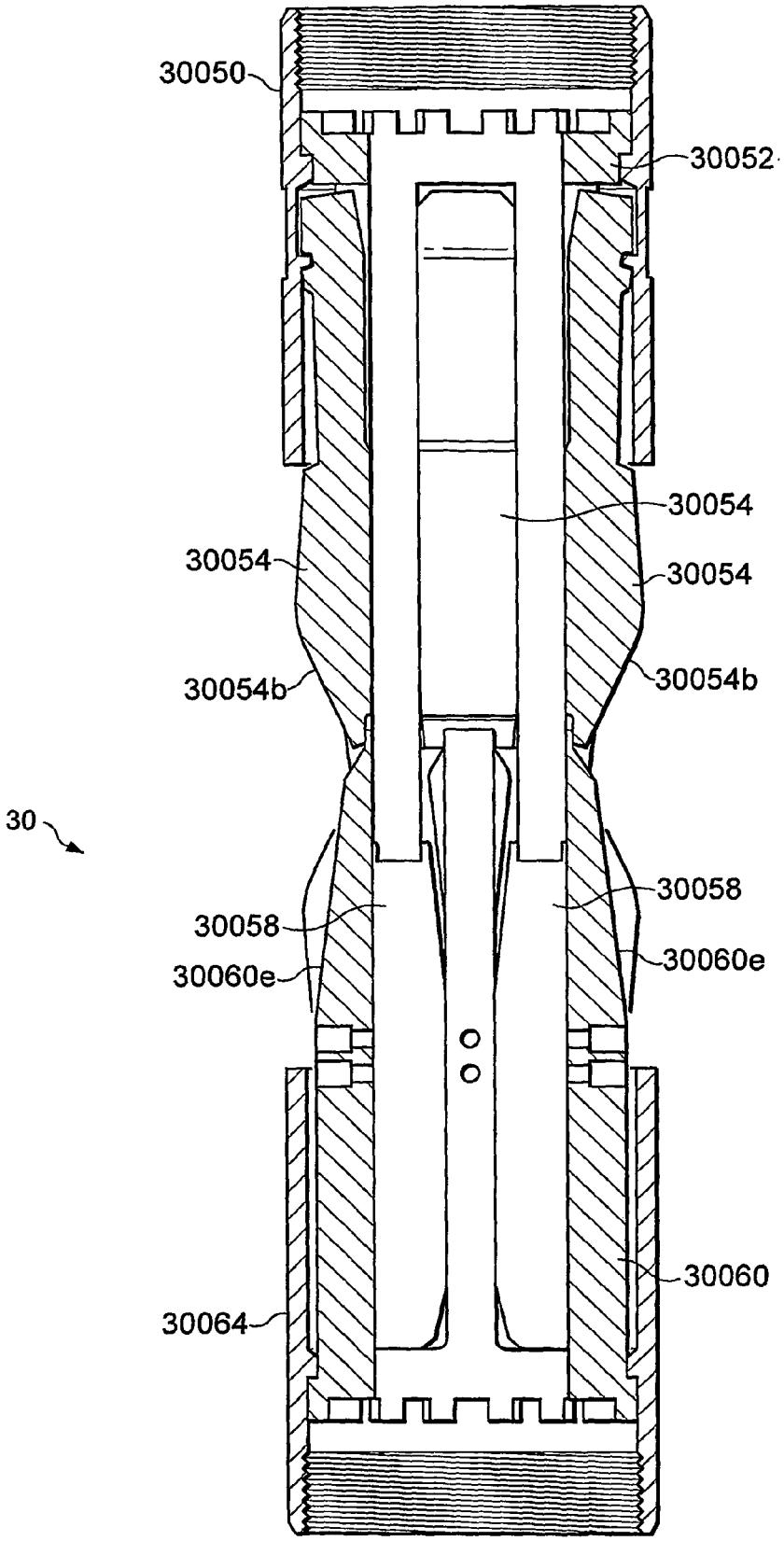
Figure 17P:
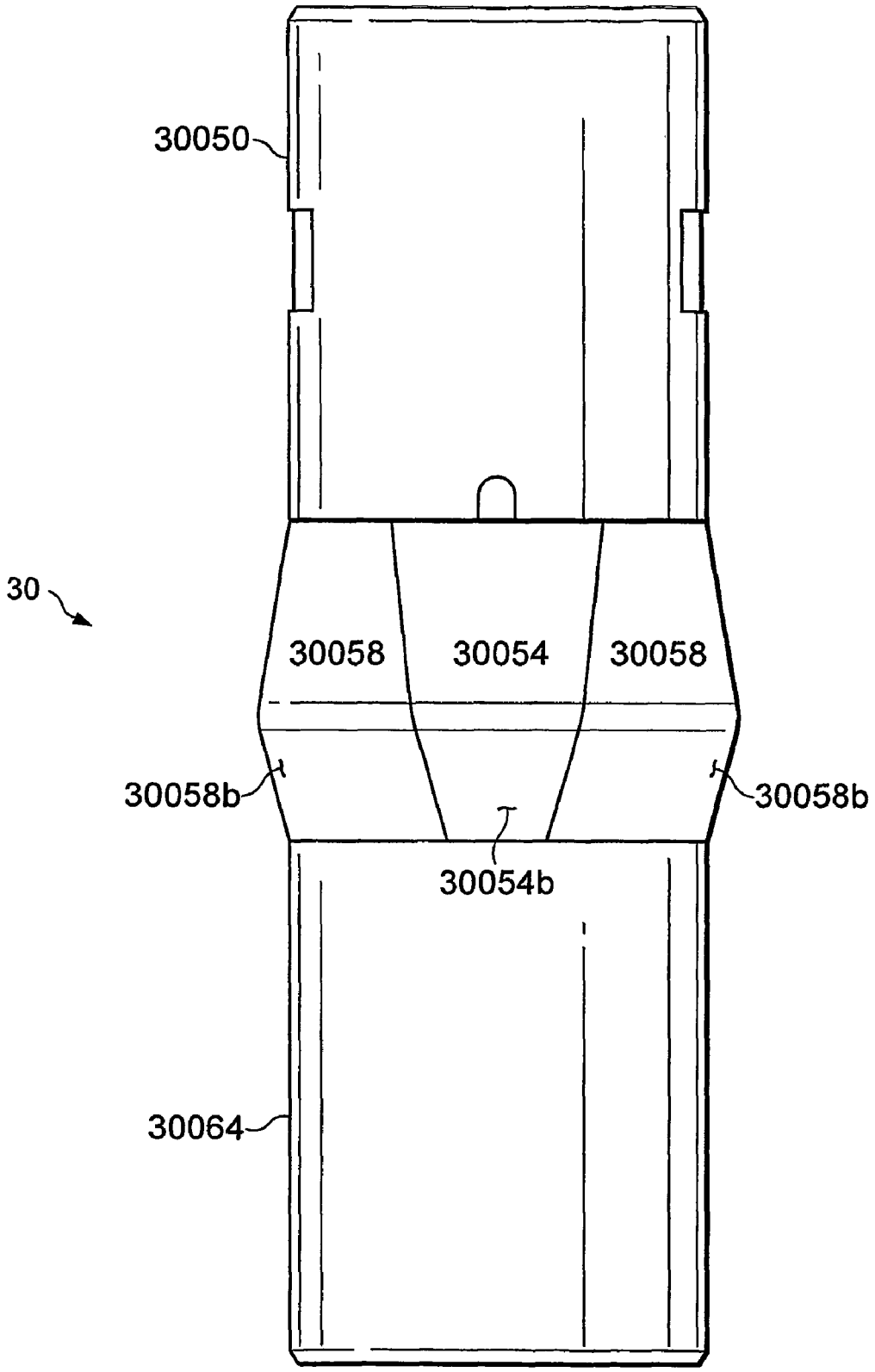
Figure 17R:
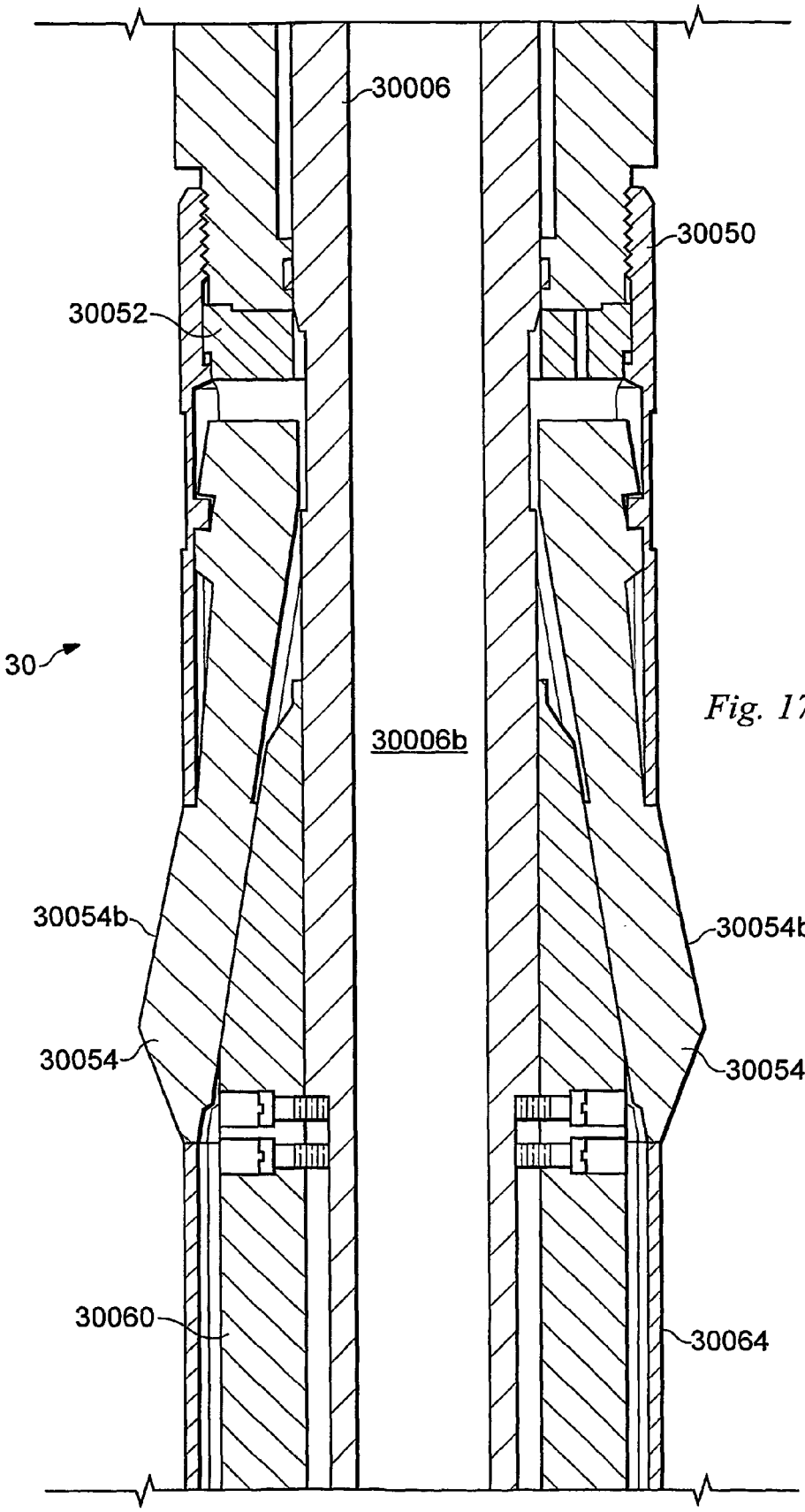
Figure 17S:
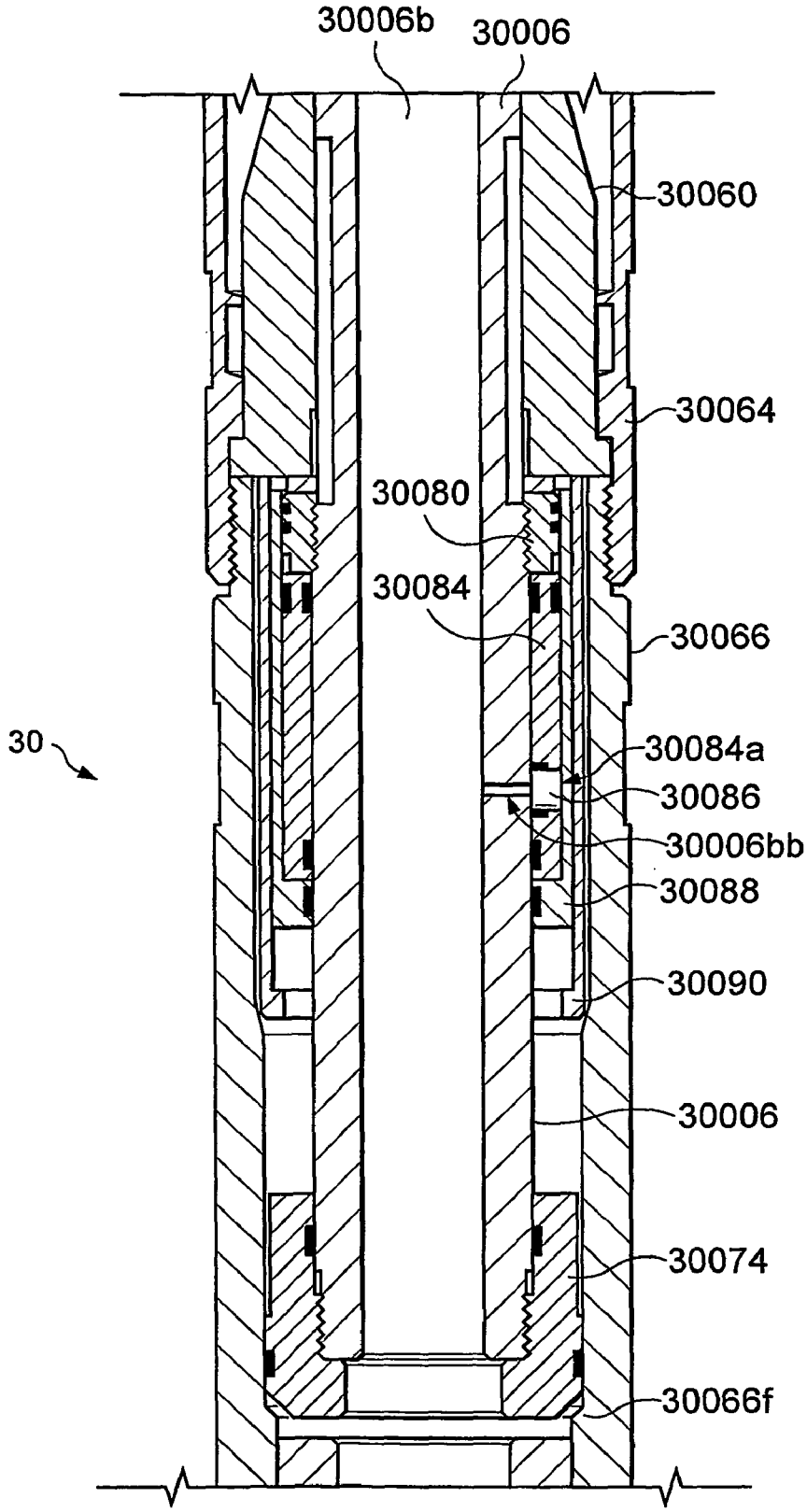

In an exemplary embodiment, as illustrated in FIGS. 17P, 17Q, and 17R, the displacement of the upper cam assembly 30052 and upper expansion segments 30054 in the direction 30096 will cause the lower expansion segments 30058 to ride up the cam surfaces 30052*e* of the cam arms 30052*d* of the upper cam assembly 30052 while also pivoting about the lower tubular hinge segment 30064, and will also cause the upper expansion segments 30054 to ride up the cam surfaces 30060*e* of the cam arms 30060*d* of the lower cam assembly 30060 while also pivoting about the upper tubular hinge segment 30050. In an exemplary embodiment, when the upper and lower expansion segments, 30054 and 30058, are brought into axial alignment, they define an outer expansion surface that is approximately contiguous in a circumferential direction and which provides an outer expansion surface that at least approximates a conical surface.

In an exemplary embodiment, during the operation of the adjustable casing expansion cone assembly 30, when the upper and lower expansion segments, 30054 and 30058, brought into axial alignment into a radially expanded position, the upper and lower expansion segments, 30054 and 30058, are displaced relative to the expandable wellbore casing 100 to thereby radially expand and plastically deform at least a portion of the expandable wellbore casing. In an exemplary embodiment, during the radial expansion and plastic deformation of the expandable wellbore casing 100, the adjustable casing expansion cone assembly 30 may then be rotated relative to the expandable wellbore casing to enhance and/or modify the rate at which the expandable wellbore casing is radially expanded and plastically deformed.

In an exemplary embodiment, the upper cam assembly 30052 and the upper expansion segments 30054 may be moved out of engagement with the lower expansion segments 30058 and the lower cam assembly 30060 by reducing the operating pressure within the annulus 30094.

Figure 17T:
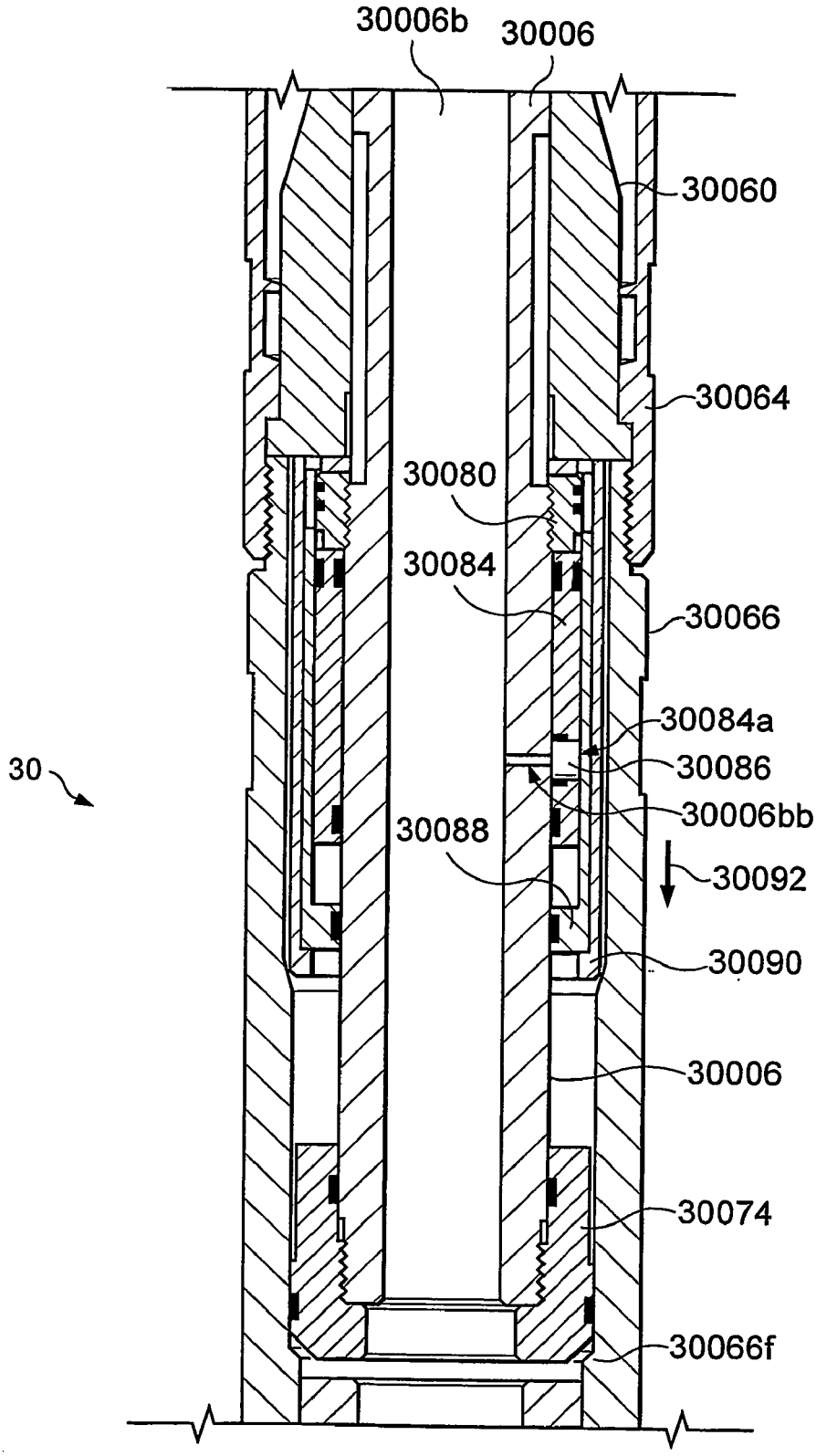

In an alternative embodiment, as illustrated in FIGS. 17S, 17T, 17U and 17V, during operation of the adjustable casing expansion cone assembly 30, the upper cam assembly 30052 and the upper expansion segments 30054 may also be moved out of engagement with the lower expansion segments 30058 and the lower cam assembly 30060 by sensing the operating pressure within the longitudinal passage 30006*b* of the lower tubular mandrel 30006. In particular, as illustrated in FIG. 17T, if the operating pressure within the longitudinal passage 30006*b* and radial passage 30006*bb* of the lower tubular mandrel 30006 exceeds a predetermined value, the burst disc 30086 will open the passage 30084*a* thereby pressurizing the interior of the tubular release sleeve 30088 thereby displacing the tubular release sleeve 30088 downwardly in a direction 30092 away from engagement with the locking dogs 30080.

Figure 17U:
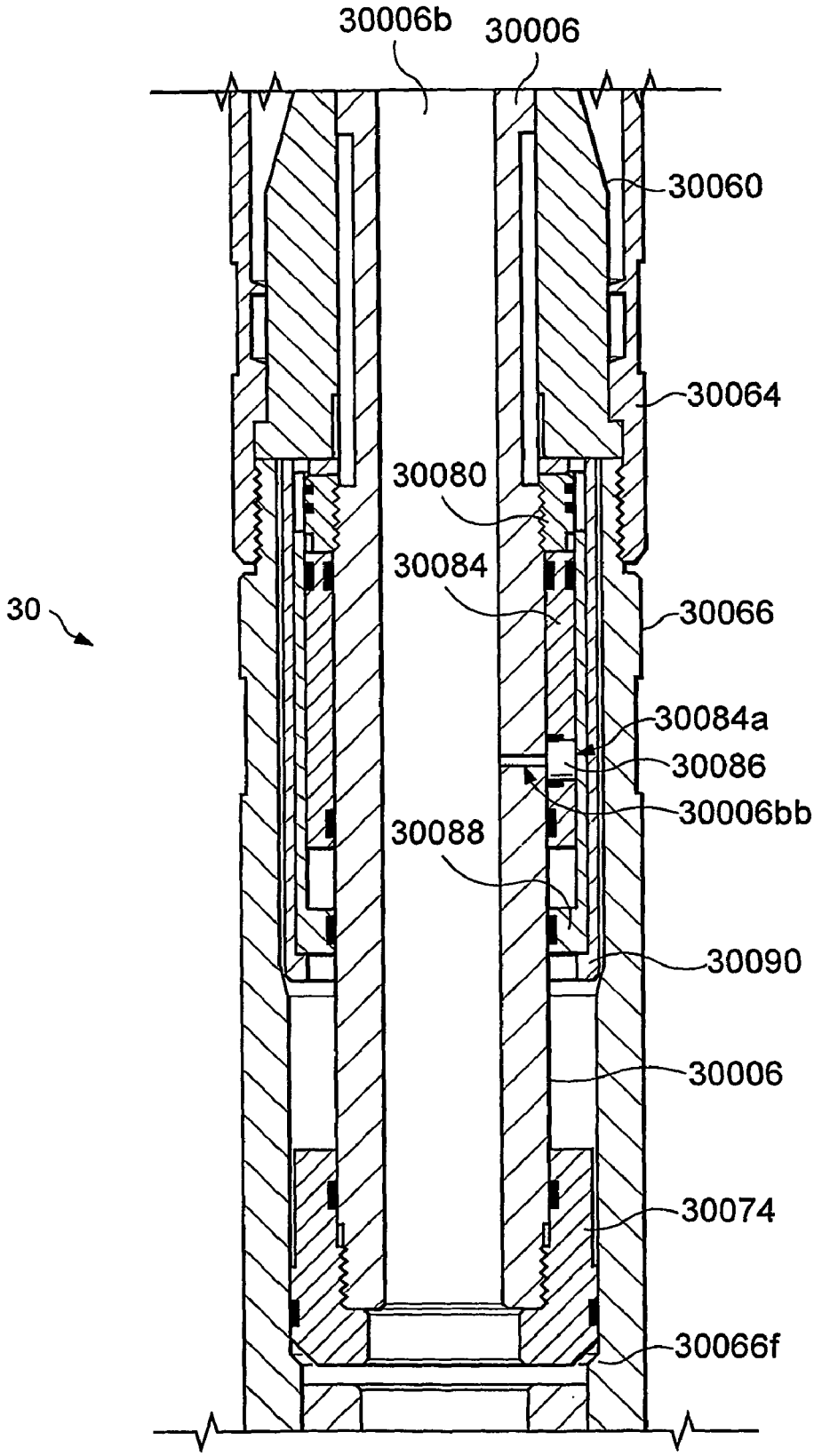

As a result, as illustrated in FIG. 17U, the locking dogs 30080 are displaced outwardly in the radial directed and thereby released from engagement with the lower tubular mandrel 30006 thereby permitting the lower expansion segments 30058 and the lower cam assembly 30060 to be displaced downwardly relative to the lower tubular mandrel.

Figure 17V:
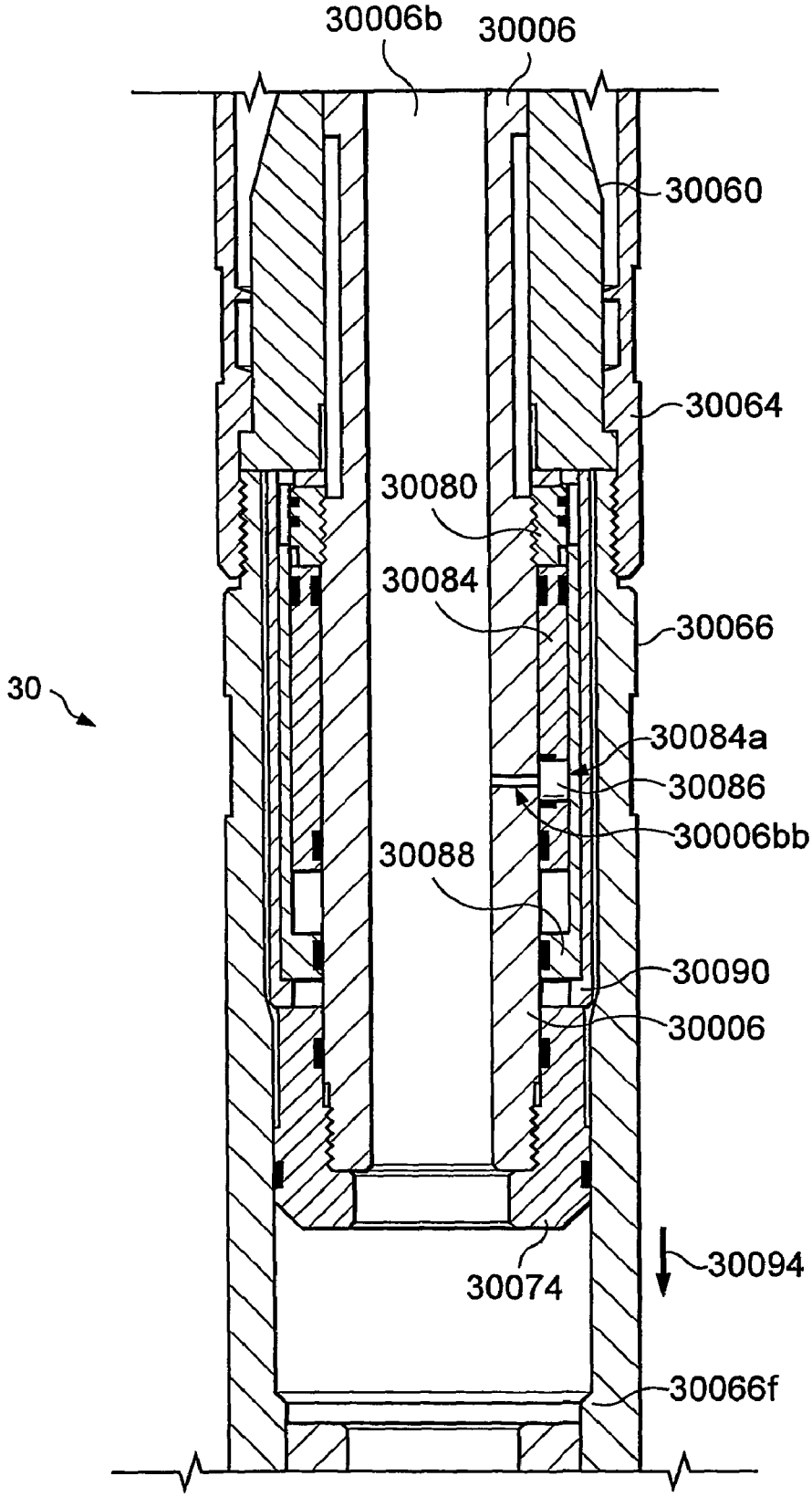

As a result, as illustrated in FIG. 17V, the operating pressure within the lower tubular mandrel 30066 may then cause the lower tubular mandrel to be displaced downwardly in the direction 30094 relative to the tubular lower mandrel 30006 and the retracting piston 30074. As a result, the lower tubular mandrel 30066, the lower expansion segments 30058, the lower cam assembly 30060, and tubular lower hinge sleeve 30064 are displaced downwardly in the direction 30094 relative to the tubular spring housing 30034 thereby moving the lower expansion segments 30058 and the lower cam assembly 30060 out of engagement with the upper cam assembly 30052 and the upper expansion segments 30054.

Figure 17W:
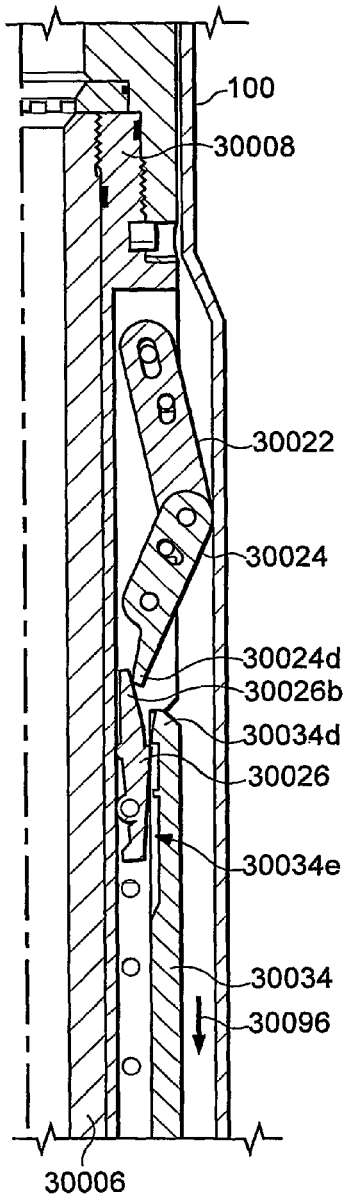
Figure 17X:
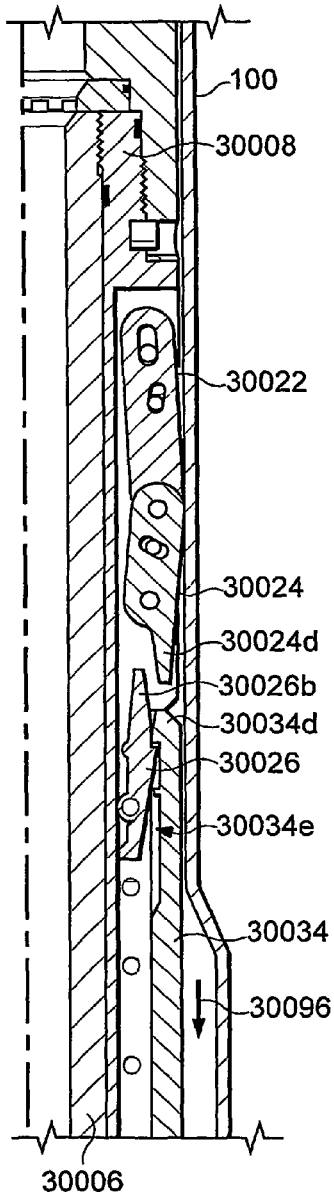
Figure 17Y:
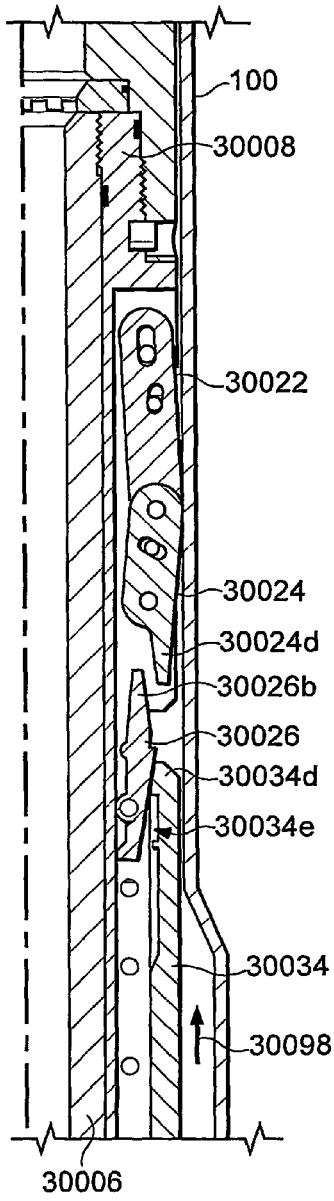

In an exemplary embodiment, as illustrated in FIGS. 17W, 17X, and 17Y, during operation of the adjustable casing expansion cone assembly 30, the adjustable casing expansion cone assembly senses the diameter of the expandable wellbore casing 100 using the upper toggle links, 30022 and 30028, lower toggle links, 30024 and 30030, and triggers, 30026 and 30032, and then prevents the engagement of the upper cam assembly 30052 and the upper expansion segments 30054 with the lower expansion segments 30058 and the lower cam assembly 30060.

In particular, as illustrated in FIG. 17W, anytime the upper toggle links, 30022 and 30028, and lower toggle links, 30024 and 30030, are positioned within a portion of the expandable wellbore casing 100 that has been radially expanded and plastically deformed by the system 10, the triggers, 30026 and 30032, will be pivoted by the engagement arms, 30024*d* and 30030*d*, of the lower toggle links, 30024 and 30030, to a position in which the triggers will no longer engage the internal flange 30034*d* of the end of the tubular spring housing 30034 thereby permitting the displacement of the tubular spring housing in the direction 30096. As a result, the upper cam assembly 30052 and the upper expansion segments 30054 can be brought into engagement with the lower expansion segments 30058 and the lower cam assembly 30060. In an exemplary embodiment, the upper toggle links, 30022 and 30028, and the lower toggle links, 30024 and 30030, are spring biased towards the position illustrated in FIG. 17W.

Conversely, as illustrated in FIG. 17X, anytime the upper toggle links, 30022 and 30028, and lower toggle links, 30024 and 30030, are positioned within a portion of the expandable wellbore casing 100 that has not been radially expanded and plastically deformed by the system 10, the triggers, 30026 and 30032, will be maintained in a position in which the triggers will engage the internal flange 30034*d* of the end of the tubular spring housing 30034 thereby preventing the displacement of the tubular spring housing in the direction 30096. As a result, the upper cam assembly 30052 and the upper expansion segments 30054 cannot be brought into engagement with the lower expansion segments 30058 and the lower cam assembly 30060. In an exemplary embodiment, the triggers, 30026 and 30032, are spring biased towards the position illustrated in FIG. 17X.

In an exemplary embodiment, as illustrated in FIG. 17Y, the tubular spring housing 30034 may be displaced upwardly in the direction 30098 even if the upper toggle links, 30022 and 30028, and lower toggle links, 30024 and 30030, are positioned within a portion of the expandable wellbore casing 100 that has not been radially expanded and plastically deformed by the system 10.

In an exemplary embodiment, as illustrated in FIGS. 17Z1 to 17Z4, 17AA1 to 17AA4, 17AB1 to 17AB4, 17AC1 to 17AC4, 17AD, and 17AE, the tubular spring housing 30034 of the adjustable casing expansion cone assembly 30 defines internal annular recesses 30034*k* and 30034*l*, spaced apart by an internal flange 30034*m*, the tubular toggle bushing 30008 defines an external annular recess 30008*ac*, and the adjustable casing expansion cone assembly further includes pins, 30100*a* and 30100*b* and 30102*a* and 30102*b*, mounted in holes 30008*j* and 30008*o* and 30008*k* and 30008*n*, respectively, of the tubular toggle bushing, and a one-shot deactivation device 30104 mounted on the tubular toggle bushing between the pins, 30100*a* and 30100*b* and 30102*a* and 30102*b*.

The one-shot deactivation device 30104 includes a tubular body 30104*a* that defines radial holes, 30104*b* and 30014*c*, and includes an external annular recess 30104*d* at one end, a centrally positioned external flange 30104*e*, a centrally positioned internal annular recess 30104*f*, and an external annular recess 30104*g* at another end. An engagement member 30106 that includes a base member 30106*a* having a tapered end 30106*b* and a key member 30106*c* having a tapered end 30106*d* is received within a portion of the internal annular recess 30104*f* of the tubular body 30104*a* and an engagement member 30108 that includes a base member 30108*a* having a tapered end 30108*b* and a key member 30108*c* having a tapered end 30108*d* is received within an opposite portion of the internal annular recess 30104*f* of the tubular body 30104*a*. Spring members, 30110 and 30112, are received within the annular recess 30104*f* of the tubular body 30104*a* for biasing the base members, base member 30106*a* and 30108*a*, of the engagement members, 30106 and 30108, respectively, radially inwardly relative to the tubular body 30104*a*.

In an exemplary embodiment, during operation of the adjustable bell section expansion cone assembly 28, as illustrated in FIG. 17Z, the one-shot deactivation device 30104 are positioned proximate and in intimate contact with the pins, 30102*a* and 30102*b*, with the tapered ends, 30106*b* and 30108*b*, of the base members, 30106*a* and 30108*a*, of the engagement members, 30106 and 30108, received within the external annular recess 30008*ac* of the tubular toggle bushing 30008. When the one-shot deactivation device 30104 is positioned as illustrated in FIG. 17Z, the external annular recess 30104*d* of the tubular body 30104*a* of the one-shot deactivation device is moved out of engagement with the engagement arms, 30026*d* and 30032*d*, of the triggers, 30026 and 30032, respectively. As a result, the triggers, 30026 and 30032, may operate normally as described above with reference to FIGS. 17W, 17X, and 17Y.

Figure 17A:
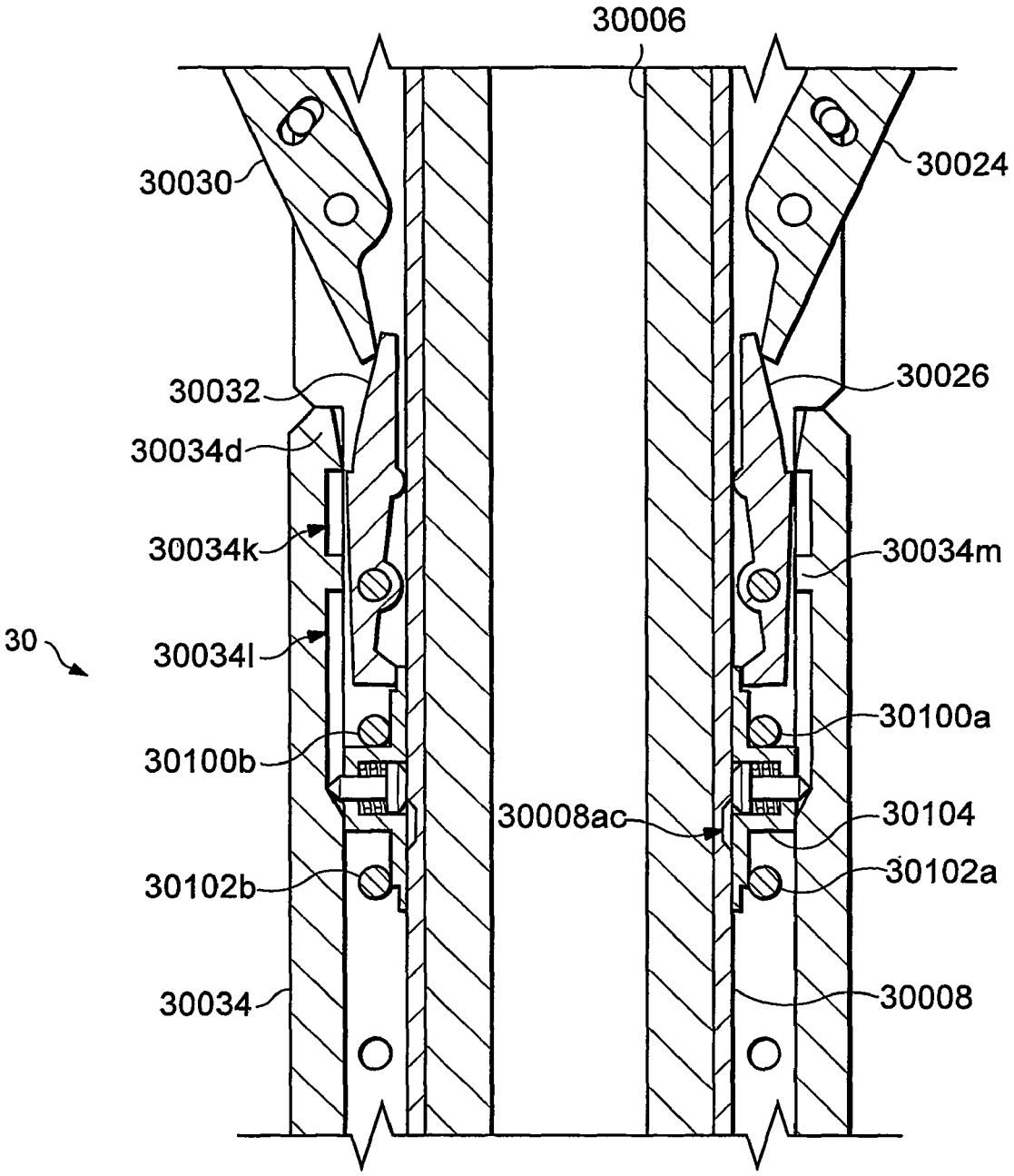
Figure 17A:
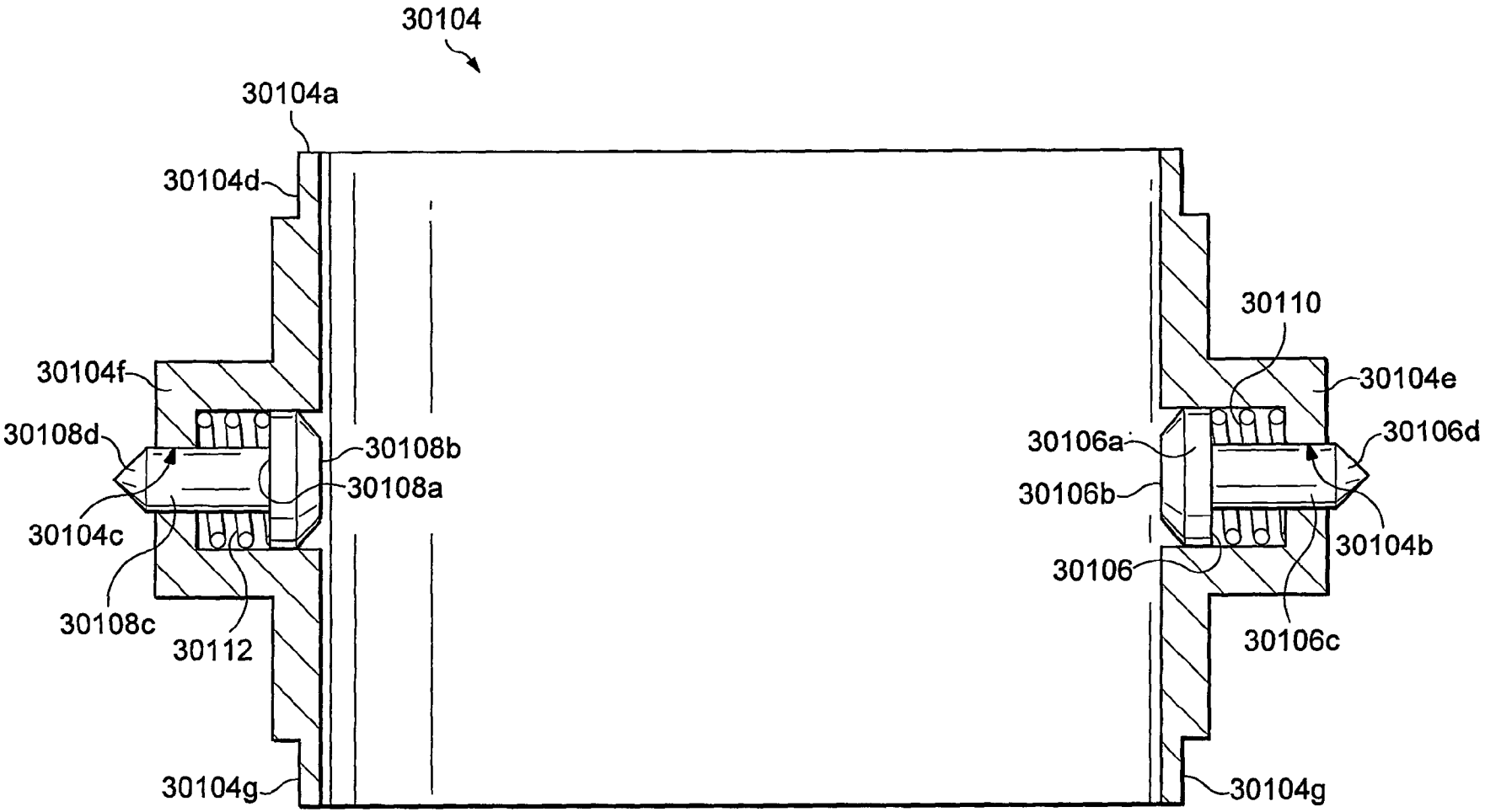
Figure 18A:
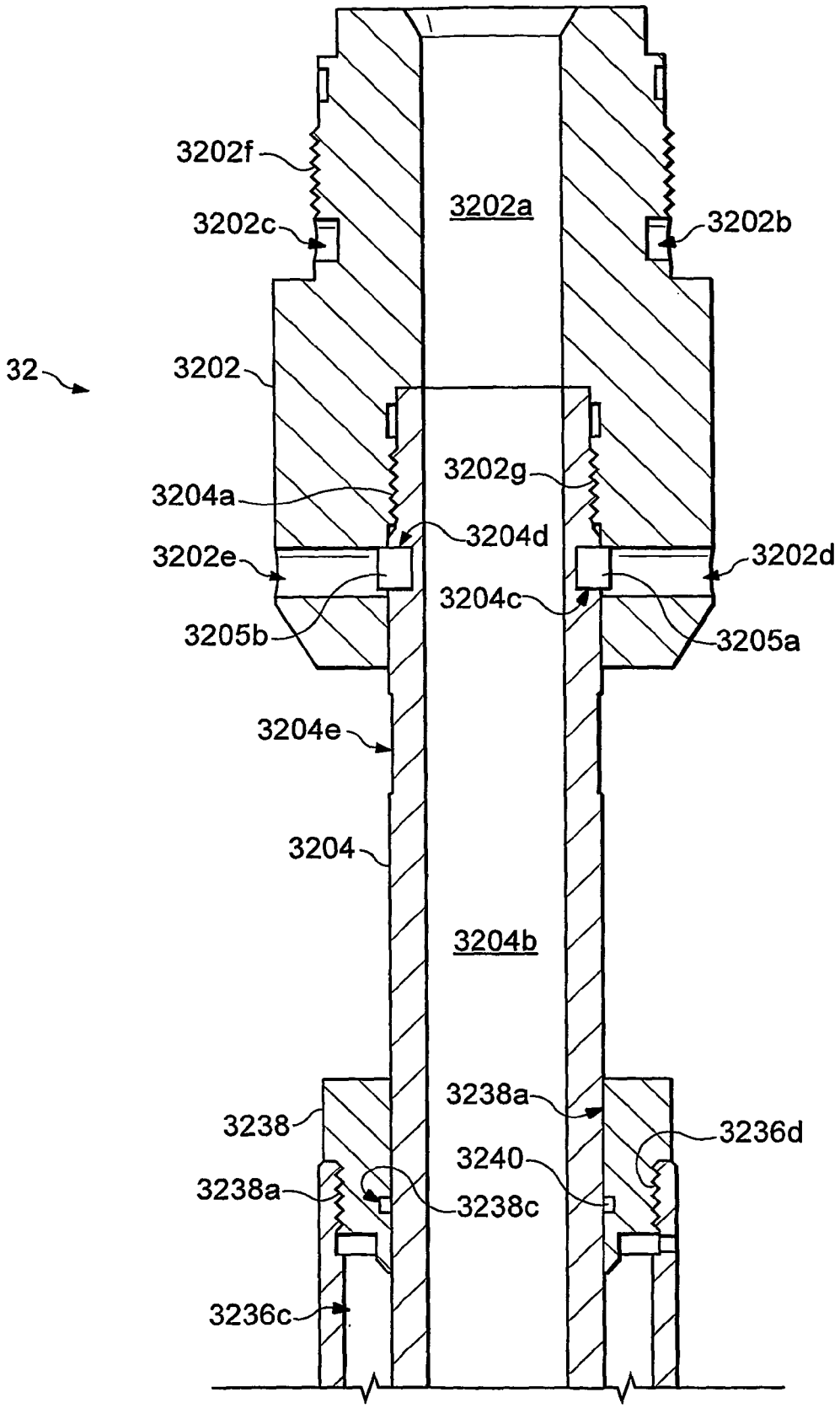
FIGS. 18A to 18C is a fragmentary cross-sectional illustration of an exemplary embodiment of a packer setting tool assembly.
Figure 18B:
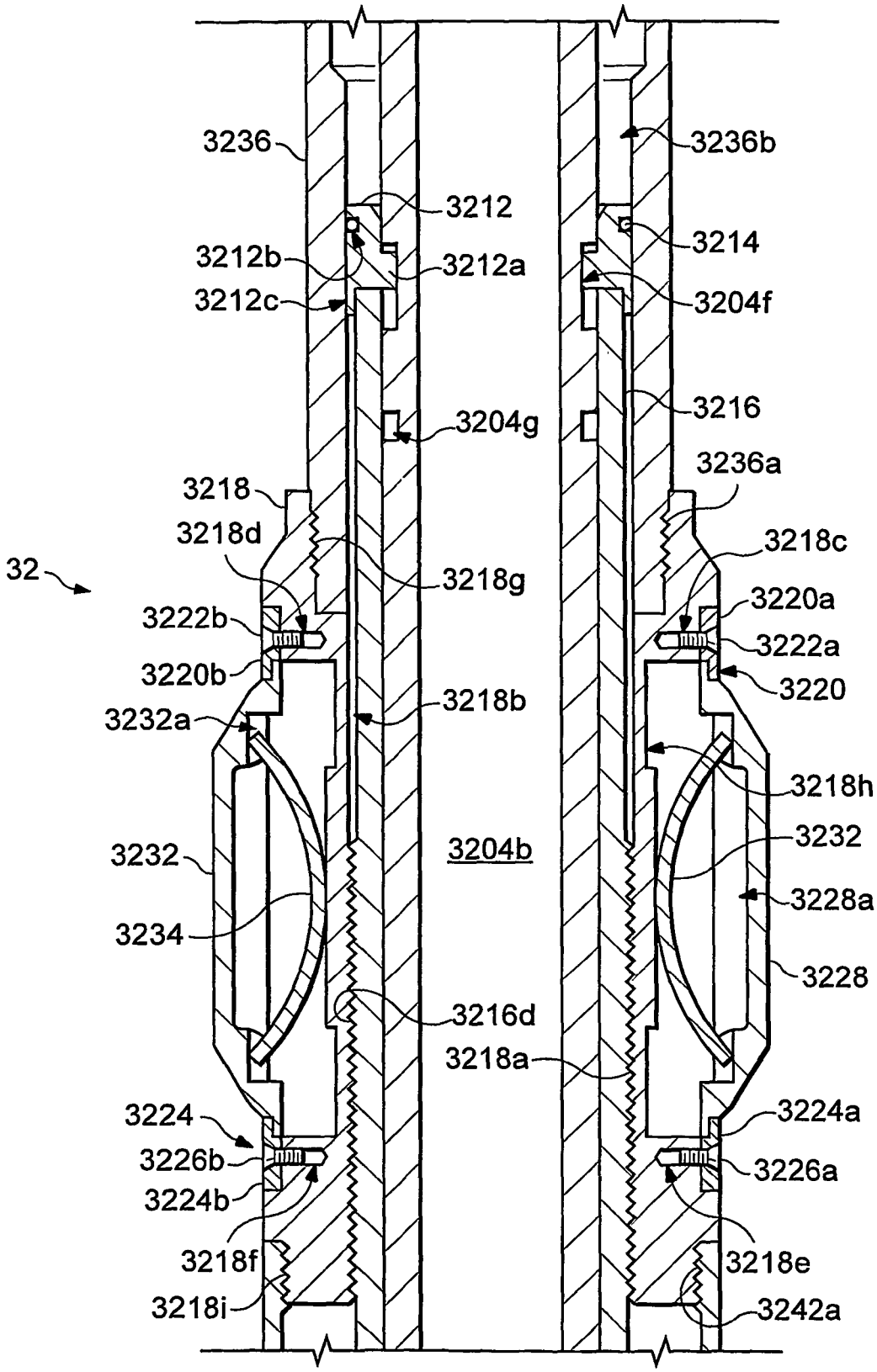
Figure 18C:
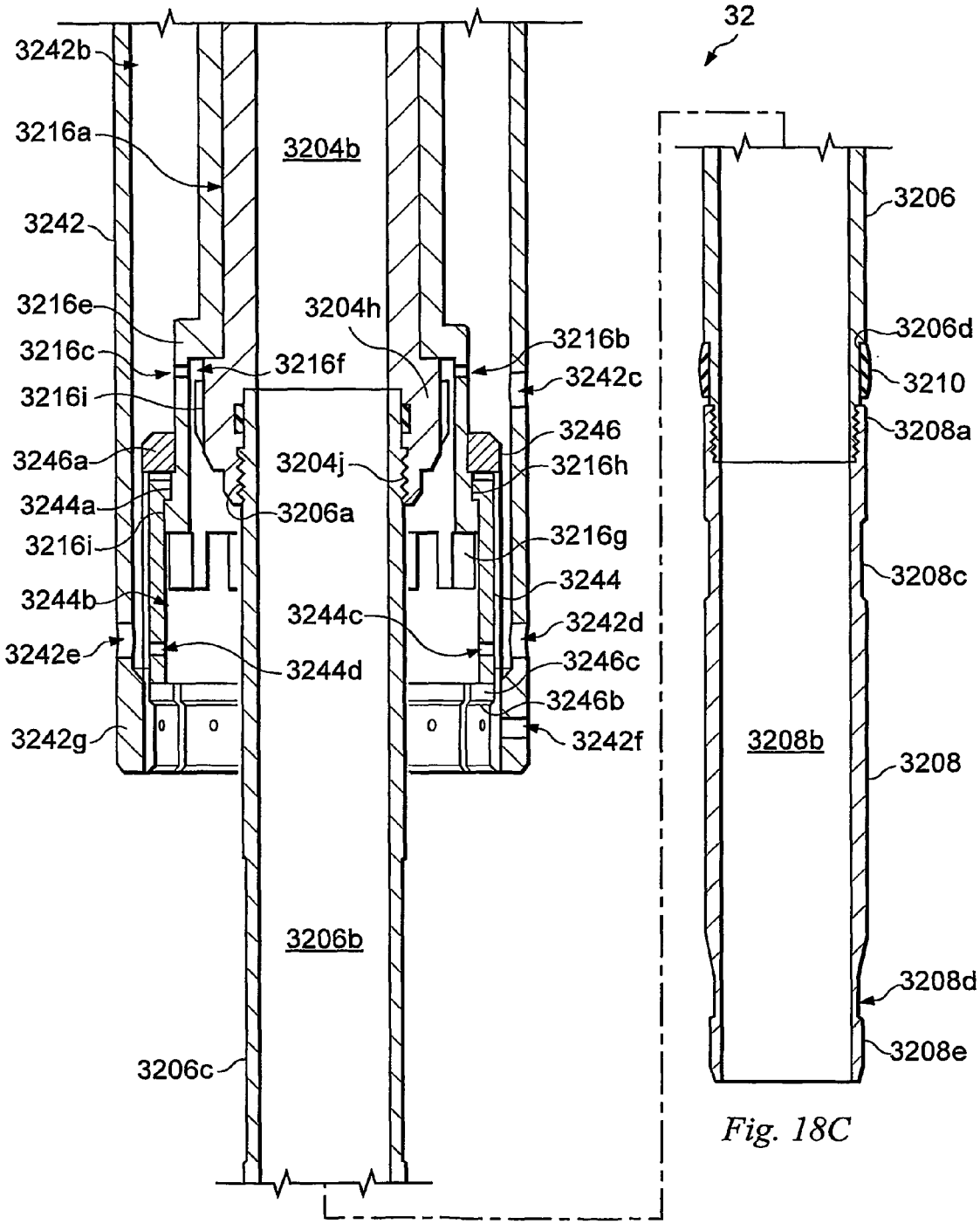

Conversely, in an exemplary embodiment, during operation of the adjustable casing expansion cone assembly 30, as illustrated in FIGS. 17AA1 to 17AA4, the one-shot deactivation device 30104 are positioned proximate and in intimate contact with the pins, 30100*a* and 30100*b*, with the tapered ends, 30106*b* and 30108*b*, of the base members, 30106*a* and

30108*a*, of the engagement members, 30106 and 30108, not received within the external annular recess 30008*ac* of the tubular toggle bushing 30008. When the one-shot deactivation device 30104 is positioned as illustrated in FIGS. 17AA1 to 17AA4, the external annular recess 30104*d* of the tubular body 30104*a* of the one-shot deactivation device is moved into engagement with the engagement arms, 30026*d* and 30032*d*, of the triggers, 30026 and 30032, respectively. As a result, the triggers, 30026 and 30032, are deactivated and may not operate normally as described above with reference to FIGS. 17W, 17X, and 17Y.

In an alternative embodiment, the elements of the adjustable casing expansion cone assembly 30 that sense the diameter of the expandable wellbore casing 100 may be disabled or omitted or adjusted to sense any pre-selected internal diameter of the expandable wellbore casing.

In an exemplary embodiment, as illustrated in 18A to 18C, the packer setting tool assembly 32 includes a tubular adaptor 3202 that defines a longitudinal passage 3202*a*, radial external mounting holes, 3202*b* and 3202*c*, radial passages, 3202*d* and 3202*e*, and includes an external threaded connection 3202*f* at one end and an internal annular recess 3202*g* having an internal threaded connection at another end. An external threaded connection 3204*a* of an end of a tubular upper mandrel 3204 that defines a longitudinal passage 3204*b*, internally threaded external mounting holes, 3204*c* and 3204*d*, and includes an external annular recess 3204*e*, external annular recess 3204*f*, external annular recess 3204*g*, external flange 3204*h*, external splines 3204*i*, and an internal threaded connection 3204*j* at another end is received within and is coupled to the internally threaded connection of the internal annular recess 3202*g* of the other end of the tubular adaptor 3202. Mounting screws, 3205*a* and 3205*b*, are received within and coupled to the mounting holes, 3204*c* and 3204*d*, of the tubular upper mandrel 3204 that also extend into the radial passages, 3202*d* and 3202*e*, of the tubular adaptor 3202.

An external threaded connection 3206*a* of an end of a mandrel 3206 that defines a longitudinal passage 3206*b* and includes an external annular recess 3206*c* and an external annular recess 3206*d* having an external threaded connection is received within and is coupled to the internal threaded connection 3204*j* of the tubular upper mandrel 3204. An internal threaded connection 3208*a* of a tubular stinger 3208 that defines a longitudinal passage 3208*b* and includes an external annular recess 3208*c*, and an external tapered annular recess 3208*d* and an engagement shoulder 3208*e* at another end receives and is coupled to the external threaded connection of the external annular recess 3206*d* of the mandrel 3206. A sealing member 3210 is mounted upon and coupled to the external annular recess 3206*d* of the mandrel 3206.

An internal flange 3212*a* of a tubular key 3212 that includes an external annular recess 3212*b* at one end and an internal annular recess 3212*c* at another end is movably received within and engages the external annular recess 3204*f* of the tubular upper mandrel 3204. A garter spring 3214 is received within and engages the external annular recess 3212*b* of the tubular key 3212.

An end of a tubular bushing 3216 that defines a longitudinal passage 3216*a* for receiving and mating with the upper mandrel 3204, and radial passages, 3216*b* and 3216*c*, and includes an external threaded connection 3216*d* at an intermediate portion, and an external flange 3216*e*, an internal annular recess 3216*f*, circumferentially spaced apart teeth 3216*g*, and external flanges, 3216*h* and 3216*i*, at another end is received within and mates with the internal annular recess 3212*c* of the tubular key 3212. An internal threaded connection 3218*a* of a tubular drag block body 3218 that defines a longitudinal passage 3218*b* for receiving the tubular bushing 3216, mounting holes, 3218*c* and 3218*d*, mounting holes, 3218*e* and 3218*f*, and includes an internal threaded connection 3218*g* at one end, a centrally positioned external annular recess 3218*h*, and an external threaded connection 3218*i* at another end is received within and coupled to the external threaded connection 3216*d* of the tubular bushing 3216.

A first tubular keeper 3220 that defines mounting holes, 3220*a* and 3220*b*, is coupled to an end of the tubular drag block body 3218 by mounting screws, 3222*a* and 3222*b*, that are received within and are coupled to the mounting holes, 3218*c* and 3218*d*, of the tubular drag block body. A second tubular keeper 3224 that defines mounting holes, 3224*a* and 3224*b*, is coupled to an end of the tubular drag block body 3218 by mounting screws, 3226*a* and 3226*b*, that are received within and are coupled to the mounting holes, 3218*e* and 3218*f*, of the tubular drag block body.

Drag blocks, 3228 and 3230, that are received within the external annular recess 3218*h* of the tubular drag block body 3218, include ends that mate with and are received within the end of the first tubular keeper 3220, and other ends that mate with and are received within the end of the second tubular keeper 3224. The drag blocks, 3228 and 3230, further include internal annular recesses, 3228*a* and 3230*a*, respectively, that receive and mate with ends of springs, 3232 and 3234, respectively. The springs, 3232 and 3234, also receive and mate with the external annular recess 3218*h* of the tubular drag block body 3218.

An external threaded connection 3236*a* of an end of a tubular releasing cap extension 3236 that defines a longitudinal passage 3236*b* and includes an internal annular recess 3236*c* and an internal threaded connection 3236*d* at another end is received within and is coupled to the internal threaded connection 3218*g* of the tubular drag block body 3218. An external threaded connection 3238*a* of an end of a tubular releasing cap 3238 that defines a longitudinal passage 3238*b* and includes an internal annular recess 3238*c* is received within and coupled to the internal threaded connection 3236*d* of the tubular releasing cap extension 3236. A sealing element 3240 is received within the internal annular recess 3238*c* of the tubular releasing cap 3238 for fluidicly sealing the interface between the tubular releasing cap and the upper mandrel 3204.

An internal threaded connection 3242*a* of an end of a tubular setting sleeve 3242 that defines a longitudinal passage 3242*b*, radial passage 3242*c*, radial passages, 3242*d* and 3242*e*, radial passage 3242*f*, and includes an internal flange 3242*g* at another end receives the external threaded connection 3218*i* of the tubular drag block body 3218. An internal flange 3244*a* of a tubular coupling ring 3244 that defines a longitudinal passage 3244*b* and radial passages, 3244*c* and 3244*d*, receives and mates with the external flange 3216*h* of the tubular bushing 3216 and an end face of the internal flange of the tubular coupling ring is positioned proximate and in opposing relation to an end face of the external flange 3216*i* of the tubular bushing.

An internal flange 3246*a* of a tubular retaining collet 3246 that includes a plurality of axially extending collet fingers 3246*b*, each having internal flanges 3246*c* at an end of each collet finger, for engaging and receiving the tubular coupling ring 3244 receives and mates with external flange 3216*e* of the tubular bushing 3216 and an end face of the internal flange of the tubular retaining collet is positioned proximate and in opposing relation to an end face of the external flange 3216*h* of the tubular bushing.

In an exemplary embodiment, the packer assembly 36 operates and is provided substantially, at least in part, as disclosed in one or more of the following: (1) PCT patent application serial number PCT/US03/14153, filed on Nov. 13, 2003, and/or (2) PCT patent application serial number PCT/US03/29460, filed on Sep. 23, 2003, and/or (3) PCT patent application serial number PCT/US04/07711, filed on Mar. 11, 2004, and/or (4) PCT patent application serial number PCT/US04/09434, filed on Mar. 26, 2004, and/or (5) PCT patent application serial number PCT/US04/10317, filed on Apr. 2, 2004, and/or (6) PCT patent application serial number PCT/US04/10712, filed on Apr. 7, 2004, and/or (7) PCT patent application serial number PCT/US04/10762, filed on Apr. 6, 2004, the disclosures of which are incorporated herein by reference.

Figures 1, 19:
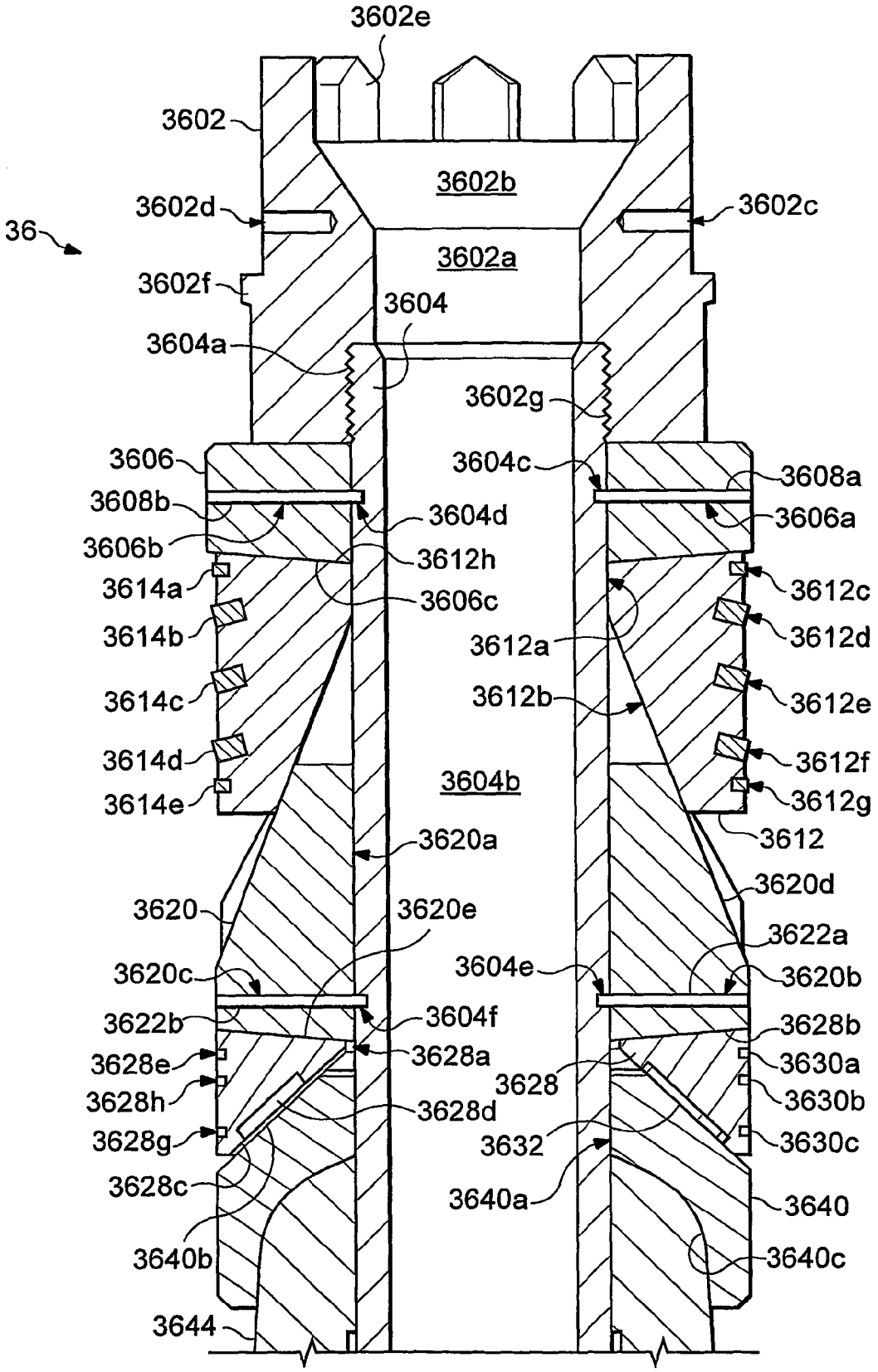
Figures 2, 19:
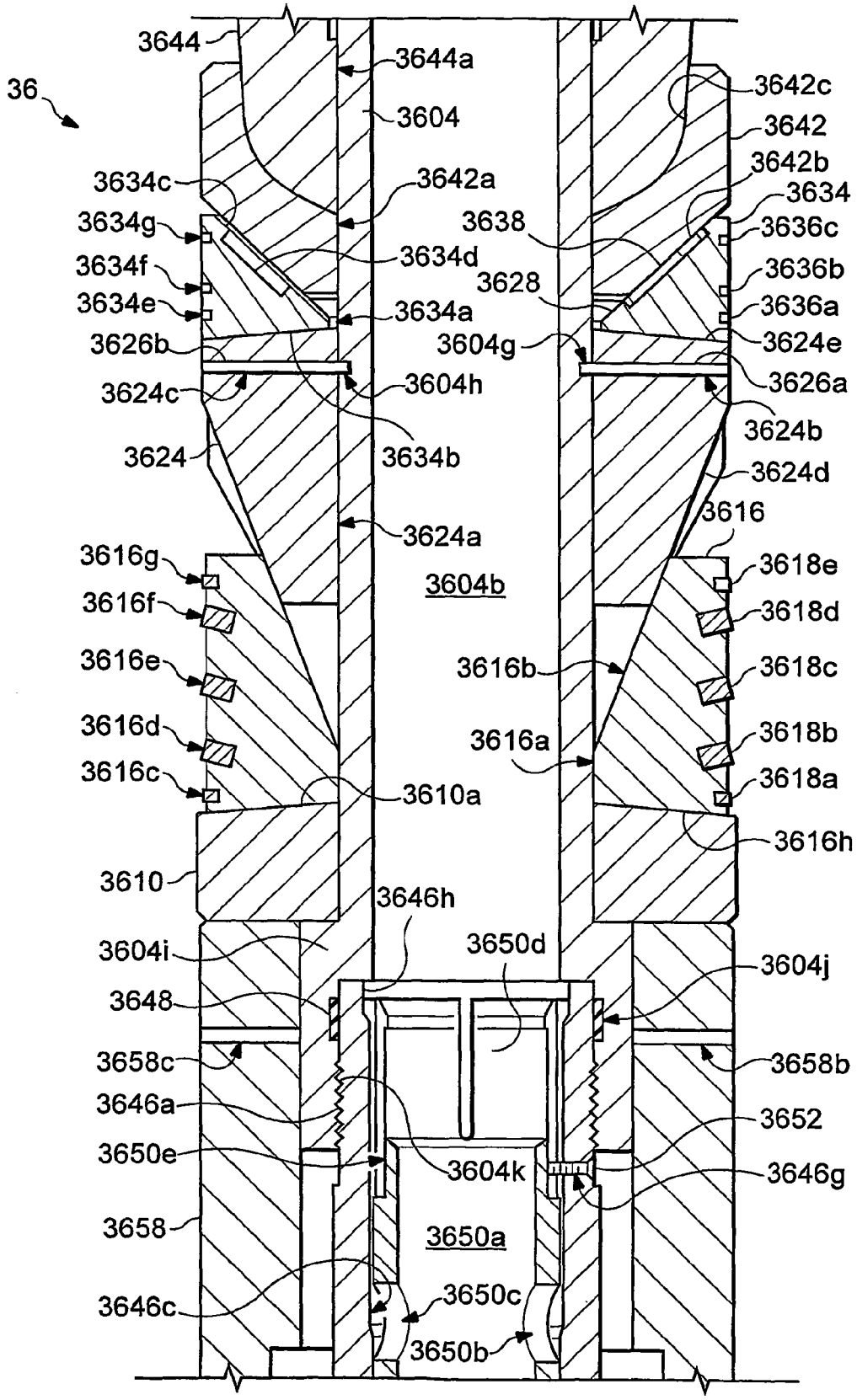
Figures 3, 19:
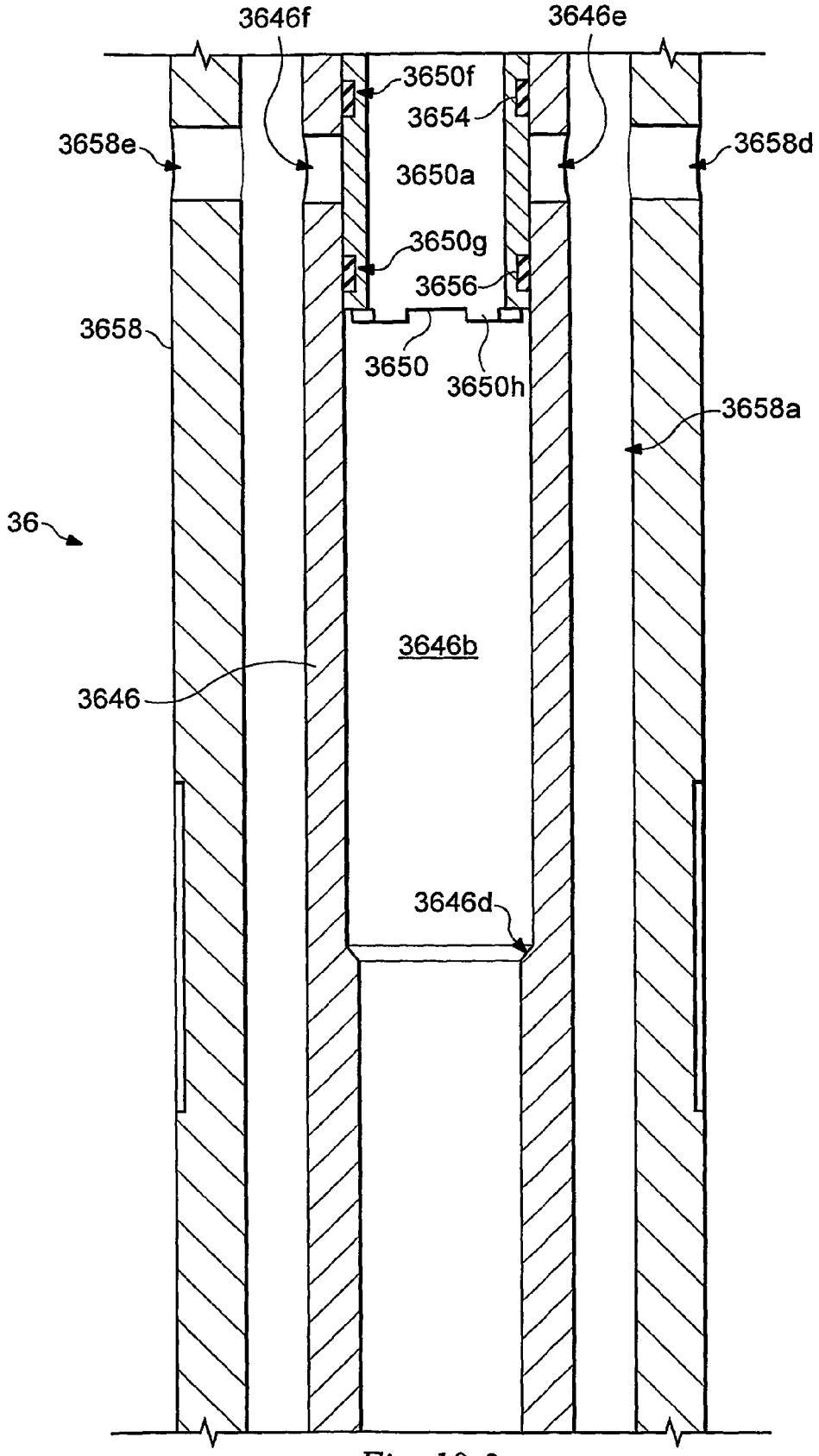
Figures 4, 19:
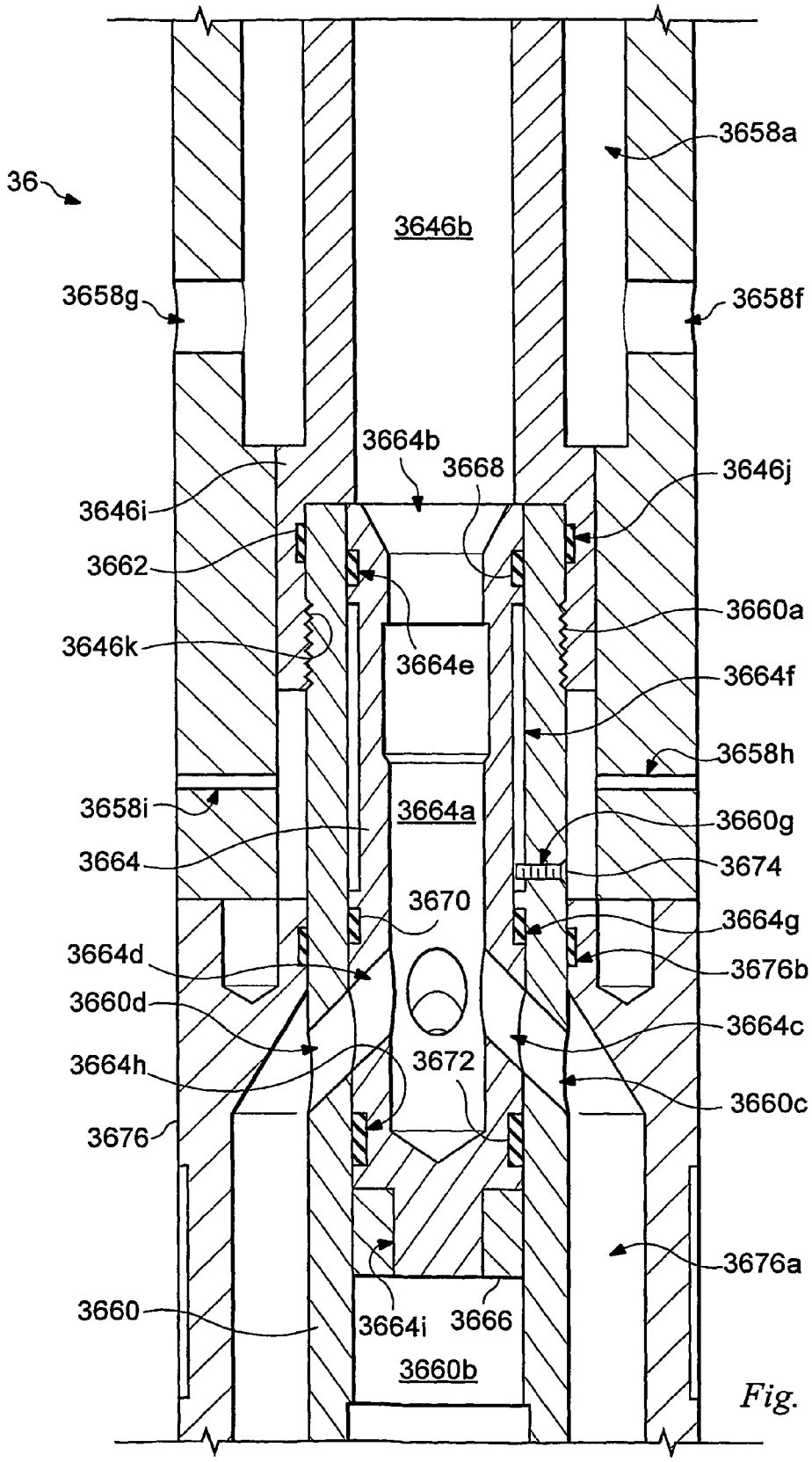
Figures 5, 19:
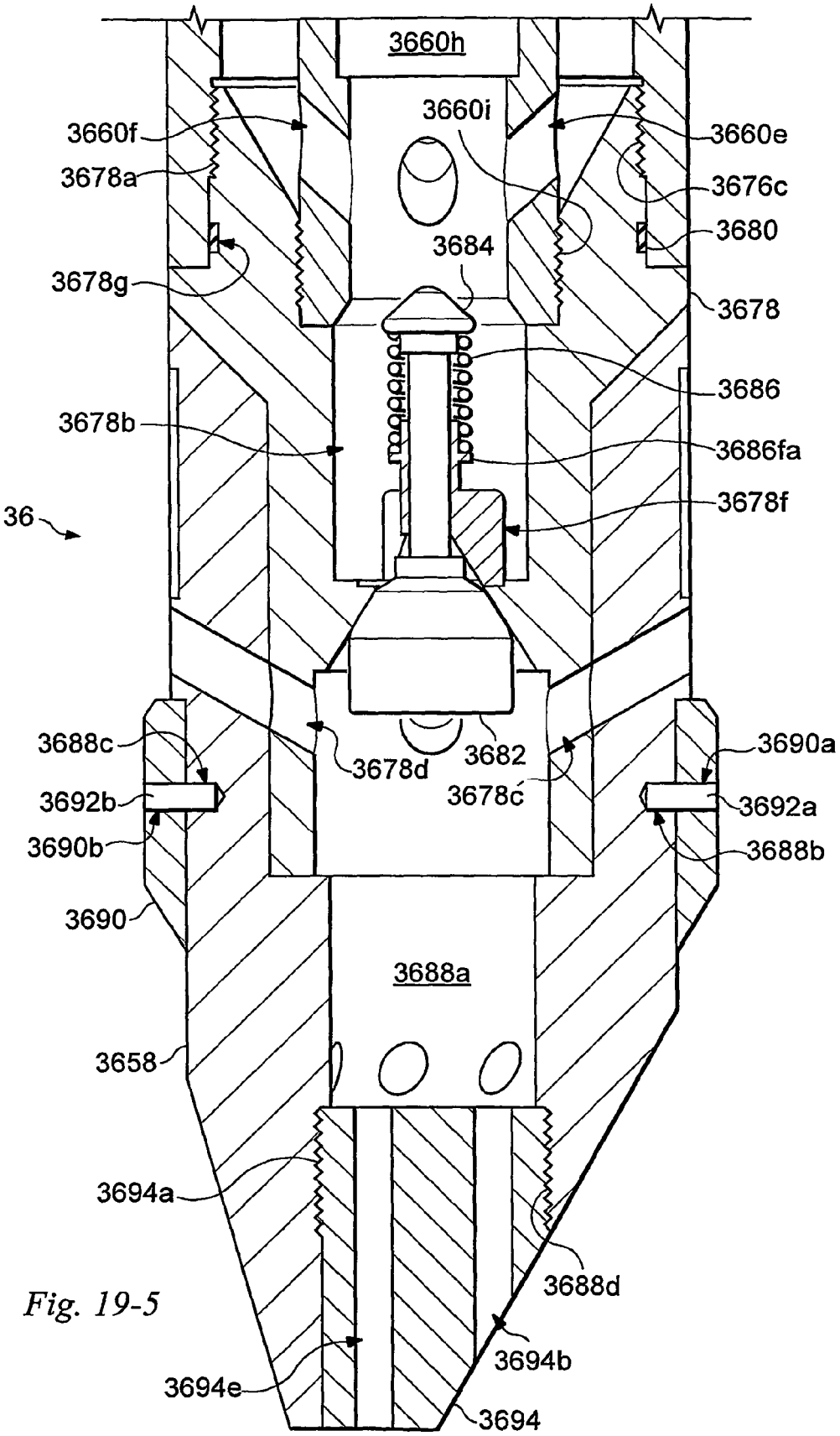

In an exemplary embodiment, as illustrated in FIGS. 19-1 to 19-5, the packer assembly 36 includes a tubular upper adaptor 3602 that defines a longitudinal passage 3602*a* having a tapered opening 3602*b* and mounting holes, 3602*c* and 3602*d*, that includes a plurality of circumferentially spaced apart teeth 3602*e* at one end, an external flange 3602*f*, and an internal threaded connection 3602*g* at another end. In an exemplary embodiment, the tubular upper adaptor 3602 is fabricated from aluminum. An external threaded connection 3604*a* of an end of a tubular upper mandrel 3604 that defines a longitudinal passage 3604*b*, mounting holes, 3604*c* and 3604*d*, mounting holes, 3604*e* and 3604*f*, and mounting holes, 3604*g* and 3604*h*, and includes an external flange 3604*i*, an internal annular recess 3604*j*, and an internal threaded connection 3604*k* at another end is received within and coupled to the internal threaded connection 3602*g* of the tubular upper adaptor 3602. In an exemplary embodiment, the tubular upper mandrel 3604 is fabricated from aluminum.

An upper tubular spacer ring 3606 that defines mounting holes, 3606*a* and 3606*b*, receives and mates with the end of the tubular upper mandrel 3604 and includes an angled end face 3606*c* and another end face that is positioned proximate to an end face of the tubular upper adaptor 3602 is coupled to the tubular upper mandrel by shear pins, 3608*a* and 3608*b*, that are mounted within and coupled to the mounting holes, 3604*c* and 3606*a*, and, 3604*d* and 3606*b*, respectively, of the tubular upper mandrel and upper tubular spacer ring, respectively. A lower tubular spacer ring 3610 that includes an angled end face 3610*a* receives, mates, and is coupled to the other end of the tubular upper mandrel 3604 and includes another end face that is positioned proximate to an end face of the external flange 3604*i* of the tubular upper mandrel 3604. In an exemplary embodiment, the upper and tubular spacer rings, 3606 and 3610, are fabricated from a composite material.

An upper tubular slip 3612 that receives and is movably mounted upon the tubular upper mandrel 3604 defines a longitudinal passage 3612*a* having a tapered opening 3612*b* and includes external annular recesses, 3612*c*, 3612*d*, 3612*e*, 3612*f*, and 3612*g*, and an angled end face 3612*h* that mates with and is positioned proximate the angled end face 3606*c* of the upper tubular spacer ring 3606. Slip retaining bands, 3614*a*, 3614*b*, 3614*c*, 3614*d*, and 3614*e*, are received within and coupled to the external annular recesses, 3612*c*, 3612*d*, 3612*e*, 3612*f*, and 3612*g*, of the upper tubular slip 3612. A lower tubular slip 3616 that receives and is movably mounted upon the tubular upper mandrel 3604 defines a longitudinal passage 3616*a* having a tapered opening 3616*b* and includes external annular recesses, 3616*c*, 3616*d*, 3616*e*, 3616*f*, and 3616*g*, and an angled end face 3616*h* that mates with and is positioned proximate the angled end face 3610*a* of the lower tubular spacer ring 3610. Slip retaining bands, 3618*a*, 3618*b*, 3618*c*, 3618*d*, and 3618*e*, are received within and coupled to the external annular recesses, 3616*c*, 3616*d*, 3616*e*, 3616*f*, and 3616*g*, of the lower tubular slip 3616. In an exemplary embodiment, the upper and lower tubular slips, 3612 and 3616, are fabricated from composite materials, and at least some of the slip retaining bands, 3614*a*, 3614*b*, 3614*c*, 3614*d*, 3614*e*, 3618*a*, 3618*b*, 3618*c*, 3618*d*, and 3618*e* are fabricated from carbide insert materials.

An upper tubular wedge 3620 that defines an longitudinal passage 3620*a* for receiving the tubular upper mandrel 3604 and mounting holes, 3620*b* and 3620*c*, and includes an angled end face 3620*d* at one end that is received within and mates with the tapered opening 3612*b* of the upper tubular slip 3612, and an angled end face 3620*e* at another end is coupled to the tubular upper mandrel by shear pins, 3622*a* and 3622*b*, mounted within and coupled to the mounting holes, 3604*e* and 3620*b*, and, 3604*f* and 3620*c*, respectively, of the tubular upper mandrel and upper tubular wedge, respectively. A lower tubular wedge 3624 that defines an longitudinal passage 3624*a* for receiving the tubular upper mandrel 3604 and mounting holes, 3624*b* and 3624*c*, and includes an angled end face 3624*d* at one end that is received within and mates with the tapered opening 3616*b* of the lower tubular slip 3616, and an angled end face 3624*e* at another end is coupled to the tubular upper mandrel by shear pins, 3626*a* and 3626*b*, mounted within and coupled to the mounting holes, 3604*g* and 3624*b*, and, 3604*h* and 3624*c*, respectively, of the tubular upper mandrel and lower tubular wedge, respectively. In an exemplary embodiment, the upper and lower tubular wedges, 3620 and 3624, are fabricated from composite materials.

An upper tubular extrusion limiter 3628 that defines a longitudinal passage 3628*a* for receiving the tubular upper mandrel 3604 includes an angled end face 3628*b* at one end that mates with the angled end face 3620*e* of the upper tubular wedge 3620, an angled end face 3628*c* at another end having recesses 3628*d*, and external annular recesses, 3628*e*, 3628*f* and 3628*g*. Retaining bands, 3630*a*, 3630*b*, and 3630*c*, are mounted within and coupled to the external annular recesses, 3628*e*, 3628*f* and 3628*g*, respectively, of the upper tubular extrusion limiter 3628. Circular disc-shaped extrusion preventers 3632 are coupled and mounted within the recesses 3628*d*. A lower tubular extrusion limiter 3634 that defines a longitudinal passage 3634*a* for receiving the tubular upper mandrel 3604 includes an angled end face 3634*b* at one end that mates with the angled end face 3624*e* of the lower tubular wedge 3624, an angled end face 3634*c* at another end having recesses 3634*d*, and external annular recesses, 3634*e*, 3634*f* and 3634*g*. Retaining bands, 3636*a*, 3636*b*, and 3636*c*, are mounted within and coupled to the external annular recesses, 3634*e*, 3634*f* and 3634*g*, respectively, of the lower tubular extrusion limiter 3634. Circular disc-shaped extrusion preventers 3638 are coupled and mounted within the recesses 3634*d*. In an exemplary embodiment, the upper and lower extrusion limiters, 3628 and 3634, are fabricated from composite materials.

An upper tubular elastomeric packer element 3640 that defines a longitudinal passage 3640*a* for receiving the tubular upper mandrel 3604 includes an angled end face 3640*b* at one end that mates with and is positioned proximate the angled end face 3628*c* of the upper tubular extrusion limiter 3628 and an curved end face 3640*c* at another end. A lower tubular elastomeric packer element 3642 that defines a longitudinal passage 3642*a* for receiving the tubular upper mandrel 3604 includes an angled end face 3642*b* at one end that mates with and is positioned proximate the angled end face 3634*c* of the lower tubular extrusion limiter 3634 and an curved end face 3642*c* at another end.

A central tubular elastomeric packer element 3644 that defines a longitudinal passage 3644*a* for receiving the tubular upper mandrel 3604 includes a curved outer surface 3644*b* for mating with and engaging the curved end faces, 3640*c* and 3642*c*, of the upper and lower tubular elastomeric packer elements, 3640 and 3642, respectively.

An external threaded connection 3646*a* of a tubular lower mandrel 3646 that defines a longitudinal passage 3646*b* having throat passages, 3646*c* and 3646*d*, and flow ports, 3646*e* and 3646*f*, and a mounting hole 3646*g*, and includes an internal annular recess 3646*h* at one end, and an external flange 3646*i*, internal annular recess 3646*j*, and internal threaded connection 3646*k* at another end. In an exemplary embodiment, the tubular lower mandrel 3646 is fabricated from aluminum. A, sealing element 3648 is received within the inner annular recess 3604*j* of the other end of the tubular upper mandrel 3604 for sealing an interface between the tubular upper mandrel and the tubular lower mandrel 3646.

A tubular sliding sleeve valve 3650 that defines a longitudinal passage 3650*a* and radial flow ports, 3650*b* and 3650*c*, and includes collet fingers 3650*d* at one end for engaging the internal annular recess 3646*h* of the lower tubular mandrel 3646, an external annular recess 3650*e*, an external annular recess 3650*f*, an external annular recess 3650*g*, and circumferentially spaced apart teeth 3650*h* at another end is received within and is slidably coupled to the longitudinal passage 3646*b* of the tubular lower mandrel 3646. In an exemplary embodiment, the tubular sliding sleeve valve 3650 is fabricated from aluminum. A set screw 3652 is mounted within and coupled to the mounting hole 3646*g* of the tubular lower mandrel 3646 that is received within the external annular recess 3650*e* of the tubular sliding sleeve 3650. Sealing elements, 3654 and 3656, are mounted within the external annular recesses, 3650*f* and 3650*g*, respectively, of the tubular sliding sleeve valve 3650 for sealing an interface between the tubular sliding sleeve valve and the tubular lower mandrel 3646.

An end of a tubular outer sleeve 3658 that defines a longitudinal passage 3658*a*, radial passages, 3658*b* and 3658*c*, upper flow ports, 3658*d* and 3658*e*, lower flow ports, 3658*f* and 3658*g*, and radial passages, 3658*h* and 36581, receives, mates with, and is coupled to the other end of the tubular upper mandrel 3604 and an end face of the end of the tubular outer sleeve is positioned proximate and end face of the lower tubular spacer ring 3610. The other end of the tubular outer sleeve 3658 receives, mates with, and is coupled to the other end of the tubular lower mandrel 3646.

An external threaded connection 3660*a* of an end of a tubular bypass mandrel 3660 that defines a longitudinal passage 3660*b*, upper flow ports, 3660*c* and 3660*d*, lower flow ports, 3660*e* and 3660*f*, and a mounting hole 3660*g* and includes an internal annular recess 3660*h* and an external threaded connection 3660*i* at another end is received within and coupled to the internal threaded connection 3646*k* of the tubular lower mandrel 3646. A sealing element 3662 is received within the internal annular recess 3646' of the tubular lower mandrel 3646 for sealing an interface between the tubular lower mandrel and the tubular bypass mandrel 3660.

A tubular plug seat 3664 that defines a longitudinal passage 3664*a* having a tapered opening 3664*b* at one end, and flow ports, 3664*c* and 3664*d*, and includes an external annular recess 3664*e*, an external annular recess 3664*f*, an external annular recess 3664*g*, an external annular recess 3664*h*, and an external annular recess 3664*i* having an external threaded connection at another end is received within and is movably coupled to the longitudinal passage 3660*b* of the tubular bypass mandrel 3660. A tubular nose 3666 is threadably coupled to and mounted upon the external annular recess 3664*i* of the tubular plug seat 3664. In an exemplary embodiment, the tubular plug seat 3664 is fabricated from aluminum. Sealing elements, 3668, 3670, and 3672, are received within the external annular recesses, 3664*e*, 3664*g*, and 3664*h*, respectively, of the tubular plug seat 3664 for sealing an interface between the tubular plug seat and the tubular bypass mandrel 3660. A set screw 3674 is mounted within and coupled to the mounting hole 3660*g* of the tubular bypass mandrel 3660 that is received within the external annular recess 3664*f* of the tubular plug seat 3664.

An end of a tubular bypass sleeve 3676 that defines a longitudinal passage 3676*a* and includes an internal annular recess 3676*b* at one end and an internal threaded connection 3676*c* at another end is coupled to the other end of the tubular outer sleeve 3658 and mates with and receives the tubular bypass mandrel 3660. In an exemplary embodiment, the tubular bypass sleeve 3676 is fabricated from aluminum.

An external threaded connection 3678*a* of a tubular valve seat 3678 that defines a longitudinal passage 3678*b* including a valve seat 3678*c* and up-jet flow ports, 3678*d* and 3678*e*, and includes a spring retainer 3678*f* and an external annular recess 3678*g* is received within and is coupled to the internal threaded connection 3676*c* of the tubular bypass sleeve 3676. In an exemplary embodiment, the tubular valve seat 3678 is fabricated from aluminum. A sealing element 3680 is received within the external annular recess 3678*g* of the tubular valve seat 3678 for fluidicly sealing an interface between the tubular valve seat and the tubular bypass sleeve 3676.

A poppet valve 3682 mates with and is positioned within the valve seat 3678*c* of the tubular valve seat 3678. An end of the poppet valve 3682 is coupled to an end of a stem bolt 3684 that is slidingly supported for longitudinal displacement by the spring retainer 3678*f* A valve spring 3686 that surrounds a portion of the stem bolt 3684 is positioned in opposing relation to the head of the stem bolt and a support 3678*fa* of the spring retainer 3678*f* for biasing the poppet valve 3682 into engagement with the valve seat 3678*c* of the tubular valve seat 3678.

An end of a composite nose 3688 that defines a longitudinal passage 3688*a* and mounting holes, 3688*b* and 3688*c*, and includes an internal threaded connection 3688*d* at another end receives, mates with, and is coupled to the other end of the tubular valve seat 3678. A tubular nose sleeve 3690 that defines mounting holes, 3690*a* and 3690*b*, is coupled to the composite nose 3688 by shear pins, 3692*a* and 3692*b*, that are mounted in and coupled to the mounting holes, 3688*b* and 3690*a*, and, 3688*c* and 3690*b*, respectively, of the composite nose and tubular nose sleeve, respectively.

An external threaded connection 3694*a* of a baffle nose 3694 that defines longitudinal passages, 3694*b* and 3694*c*, is received within and is coupled to the internal threaded connection internal threaded connection 3688*d* of the composite nose 3688.

In an exemplary embodiment, as illustrated in FIGS. 19A1 to 19A5, during the operation of the packer setting tool assembly 32 and packer assembly 36, the packer setting tool and packer assembly are coupled to one another by inserting the end of the tubular upper adaptor 3602 into the other end of the tubular coupling ring 3244, bringing the circumferentially spaced teeth 3216*g* of the other end of the tubular bushing 3216 into engagement with the circumferentially spaced teeth 3602*e* of the end of the tubular upper adaptor, and mounting shear pins, 36100*a* and 36100*b*, within the mounting holes,

3244*c* and 3602*c*, and, 3244*d* and 3602*d*, respectively, of the tubular coupling ring and tubular upper adaptor, respectively. As a result, the tubular mandrel 3206 and tubular stinger 3208 of the packer setting tool assembly 32 are thereby positioned within the longitudinal passage 3604*a* of the tubular upper mandrel 3604 with the 3208*e* of the tubular stinger positioned within the longitudinal passage 3646*b* of the tubular lower mandrel 3646 proximate the collet fingers 3650*d* of the tubular sliding sleeve valve 3650.

Furthermore, in an exemplary embodiment, during the operation of the packer setting tool 32 and packer assembly 36, as illustrated in FIGS. 20A1 to 20A5, the packer setting tool and packer assembly are positioned within the expandable wellbore casing 100 and an internal threaded connection 30*a* of an end of the adjustable casing expansion cone assembly 30 receives and is coupled to the external threaded connection 3202*f* of the end of the tubular adaptor 3202 of the packer setting tool assembly. Furthermore, shear pins, 36102*a* and 36102*b*, mounted within the mounting holes, 3658*b* and 3658*c*, of the tubular outer sleeve 3658 couple the tubular outer sleeve to the expandable wellbore casing. As a result, torsion loads may transferred between the tubular outer sleeve 3658 and the expandable wellbore casing 100.

In an exemplary embodiment, as illustrated in FIGS. 20B1 to 20B5, a conventional plug 36104 is then injected into the setting tool assembly 32 and packer assembly 36 by injecting a fluidic material 36106 into the setting tool assembly and packer assembly through the longitudinal passages, 3202*a*, 3204*b*, 3206*b*, 3208*b*, 3650*a*, 3646*a*, 3660*b*, and 3664*a* of the tubular adaptor 3202, tubular upper mandrel 3204, tubular mandrel 3206, tubular stinger 3208, tubular sliding sleeve valve 3650, tubular lower mandrel 3646, tubular bypass mandrel 3660, and tubular plug seat 3664, respectively. The plug 36104 is thereby positioned within the longitudinal passage 3664*a* of the tubular plug seat 3664. Continued injection of the fluidic material 36106 following the seating of the plug 1606 within the longitudinal passage 3664*a* of the tubular plug seat 3664 causes the plug and the tubular plug seat to be displaced downwardly in a direction 36108 until further movement of the tubular plug seat is prevented by interaction of the set screw 3674 with the external annular recess 3664*f* of the tubular plug seat. As a result, the flow ports, 3664*c* and 3664*d*, of the tubular plug seat 3664 are moved out of alignment with the upper flow ports, 3660*c* and 3660*d*, of the tubular bypass mandrel 3660.

In an exemplary embodiment, as illustrated in FIGS. 20C1 to 20C5, after the expandable wellbore casing 100 has been radially expanded and plastically deformed to form at least the bell section 112 of the expandable wellbore casing 100 thereby shearing the shear pins, 36102*a* and 36102*b*, the setting tool assembly 32 and packer assembly 36 are then moved upwardly to a position within the expandable wellbore casing 100 above the bell section. The tubular adaptor 3202 is then rotated, by rotating the tool string of the system 10 above the setting tool assembly 32, to displace and position the drag blocks, 3228 and 3230, into engagement with the interior surface of the expandable wellbore casing 100.

As a result of the engagement of the drag blocks, 3228 and 3230, with the interior surface of the expandable wellbore casing 100, further rotation of the drag blocks relative to the wellbore casing is prevented. Consequently, due to the operation and interaction of the threaded connections, 3216*d* and 3218*a*, of the tubular bushing 3216 and tubular drag block body 3218, respectively, further rotation of the tubular adaptor 3202 causes the tubular drag block body and setting sleeve 3242 to be displaced downwardly in a direction 36112 relative to the remaining elements of the setting tool assembly 32 and packer assembly 36. As a result, the setting sleeve 3242 engages and displaces the upper tubular spacer ring 3606 thereby shearing the shear pins, 3622*a* and 3622*b*, and driving the upper tubular slip 3612 onto and up the angled end face 3620*d* of the upper tubular wedge 3620 and into engagement with the interior surface of the expandable wellbore casing 100. As a result, longitudinal displacement of the upper tubular slip 3612 relative to the expandable wellbore casing 100 is prevented. Furthermore, as a result, the 3246*b* collet fingers of the tubular retaining collet 3246 are disengaged from the tubular upper adaptor 3602.

In an alternative embodiment, after the drag blocks, 3228 and 3230, engage the interior surface of the expandable wellbore casing 100, an upward tensile force is applied to the tubular support member 12, and the ball gripper assembly 16 is then operate to engage the interior surface of the expandable wellbore casing. The tension actuator assembly 18 is then operated to apply an upward tensile force to the tubular adaptor 3202 thereby pulling the upper tubular spacer ring 3606, lower tubular spacer ring 3610, upper tubular slip 3612, lower tubular slip 3616, upper tubular wedge 3620, lower tubular wedge 3624, upper tubular extrusion limiter 3628, lower tubular extrusion limiter 3634, and central tubular elastomeric element 3644 upwardly into contact with the 3242 thereby compressing the upper tubular spacer ring, lower tubular spacer ring, upper tubular slip, lower tubular slip, upper tubular wedge, lower tubular wedge, upper tubular extrusion limiter, lower tubular extrusion limiter, and central tubular elastomeric element. As a result, the upper tubular slip 3612, lower tubular slip 3616, and central tubular elastomeric element 3644 engage the interior surface of the expandable wellbore casing 100.

In an exemplary embodiment, as illustrated in FIGS. 20D1 to 20D5, an upward tensile force is then applied to the tubular adaptor 3202 thereby compressing the lower tubular slip 3616, lower tubular wedge 3624, central elastomeric packer element 3644, upper tubular extrusion limiter 3628, and upper tubular wedge 3620 between the lower tubular spacer ring 3610 and the stationary upper tubular slip 3612. As a result, the lower tubular slip 3616 is driven onto and up the angled end face 3624*d* of the lower tubular wedge 3624 and into engagement with the interior surface of the expandable wellbore casing 100, and the central elastomeric packer element 3644 is compressed radially outwardly into engagement with the interior surface of the expandable tubular member. As a result, further longitudinal displacement of the upper tubular slip 3612, lower tubular slip 3616, and central elastomeric packer element 3644 relative to the expandable wellbore casing 100 is prevented.

In an exemplary embodiment, as illustrated in FIGS. 20E1 to 20E6, continued application of the upward tensile force to tubular adaptor 3202 will then shear the shear pins, 1602*a* and 1602*b*, thereby disengaging the setting tool assembly 32 from the packer assembly 36.

In an exemplary embodiment, as illustrated in FIGS. 20F1 to 20F6, with the drag blocks, 3228 and 3230, in engagement with the interior surface of the expandable wellbore casing 100, the tubular adaptor 102 is further rotated thereby causing the tubular drag block body 3218 and setting sleeve 3242 to be displaced further downwardly in the direction 36113 until the tubular drag block body and setting sleeve are disengaged from the tubular stinger 3208. As a result, the tubular stinger 3208 of the setting tool assembly 32 may then be displaced downwardly into complete engagement with the tubular sliding sleeve valve 3650.

In an exemplary embodiment, as illustrated in FIGS. 20G1 to 20G6, a fluidic material 36114 is then injected into the setting tool assembly 32 and the packer assembly 36 through the longitudinal passages 3202*a*, 3204*b*, 3206*b*, 3208*b*, 3604*b*, 3650*a*, and 3646*b* of the tubular adaptor 3202, tubular upper mandrel 3204, tubular mandrel 3206, tubular stinger 3208, tubular upper mandrel 3604, tubular sliding sleeve valve 3650, and tubular lower mandrel 3646, respectively. Because, the plug 36104 is seated within and blocks the longitudinal passage 3664*a* of the tubular plug seat 3664, the longitudinal passages 3604*b*, 3650*a*, and 3646*b* of the tubular upper mandrel 3604, tubular sliding sleeve valve 3650, and tubular lower mandrel 3646 are pressurized thereby displacing the tubular upper adaptor 3602 and tubular upper mandrel 3604 downwardly until the end face of the tubular upper mandrel impacts the end face of the upper tubular spacer ring 3606.

In an exemplary embodiment, as illustrated in FIGS. 20H1 to 20H5, the setting tool assembly 32 is brought back into engagement with the packer assembly 36 until the engagement shoulder 3208*e* of the other end of the tubular stinger 3208 engages the collet fingers 3650*d* of the end of the tubular sliding sleeve valve 3650. As a result, further downward displacement of the tubular stinger 3208 displaces the tubular sliding sleeve valve 3650 downwardly until the radial flow ports, 3650*b* and 3650*c*, of the tubular sliding sleeve valve are aligned with the flow ports, 3646*e* and 3646*f*, of the tubular lower mandrel 3646. A hardenable fluidic sealing material 36116 may then be injected into the setting tool assembly 32 and the packer assembly 36 through the longitudinal passages 3202*a*, 3204*b*, 3206*b*, 3208*b*, and 3650*a* of the tubular adaptor 3202, tubular upper mandrel 3204, tubular mandrel 3206, tubular stinger 3208, and tubular sliding sleeve valve 3650, respectively. The hardenable fluidic sealing material may then flow out of the packer assembly 36 through the upper flow ports, 3658*d* and 3658*e*, into the annulus between the expandable wellbore casing 100 and the wellbore 102.

The tubular sliding sleeve valve 3650 may then be returned to its original position, with the radial flow ports, 3650*b* and 3650*c*, of the tubular sliding sleeve valve out of alignment with the flow ports, 3646*e* and 3646*f*, of the tubular lower mandrel 3646. The hardenable fluidic sealing material 36116 may then be allowed to cure before, during, or after the continued operation of the system 10 to further radially expand and plastically deform the expandable wellbore casing.

Figure 21:
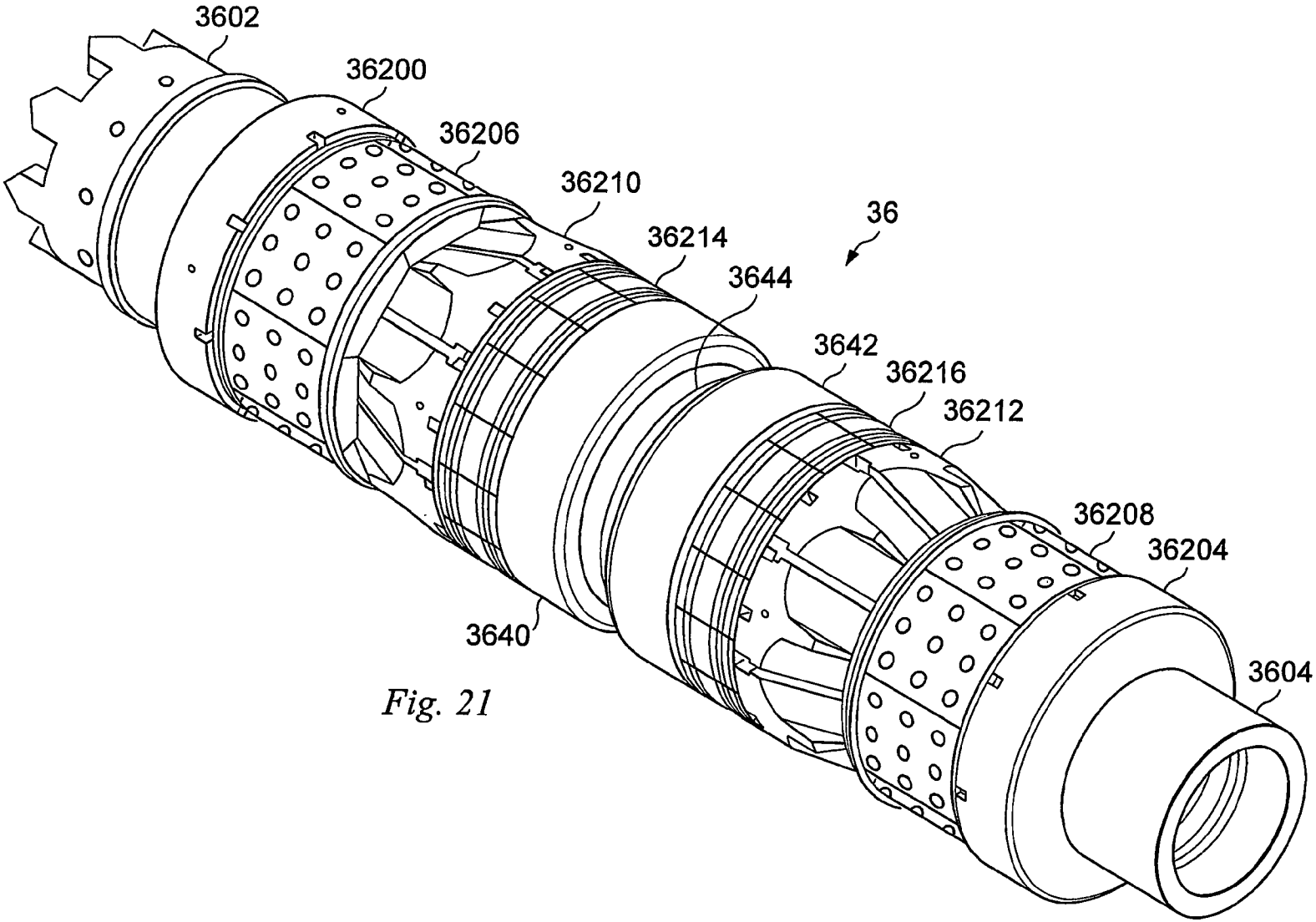
FIGS. 21 and 21A to 21AX are fragmentary perspective and cross-sectional illustrations of an alternative embodiment of the packer assembly.
Figure 21A:
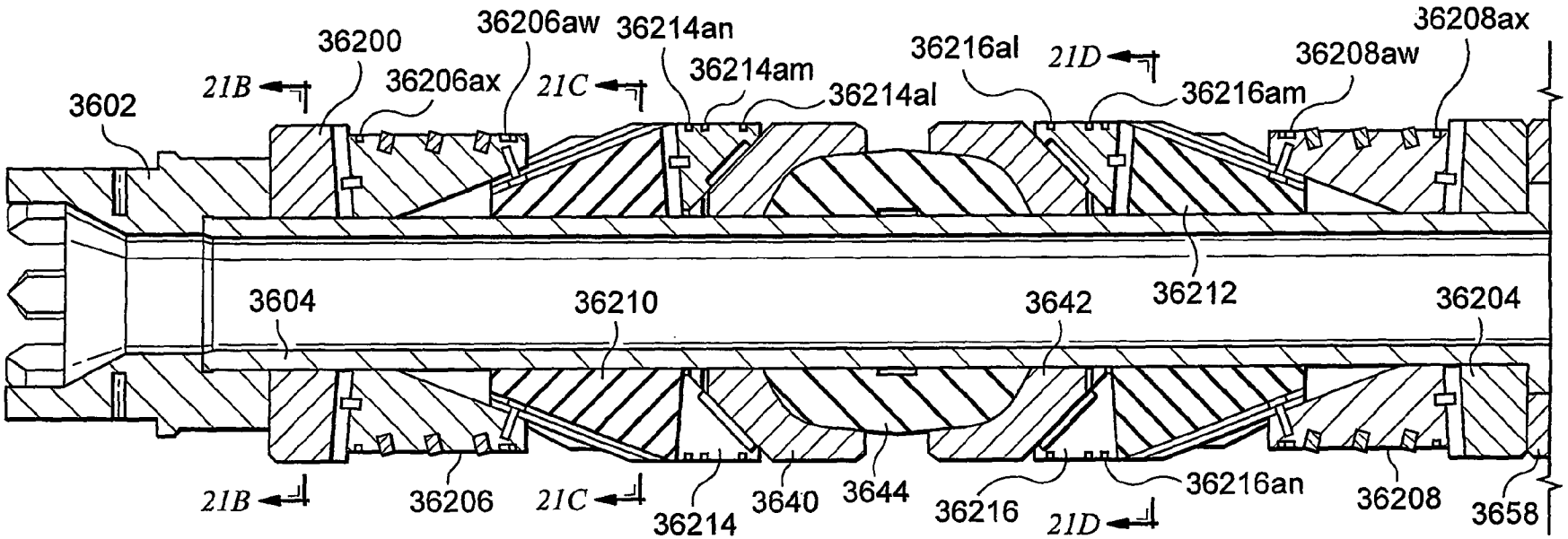
Figure 21B:
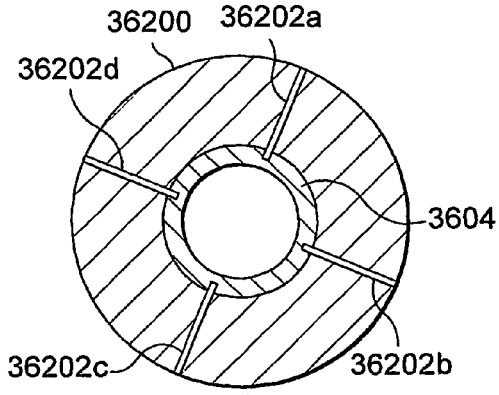
Figure 21C:
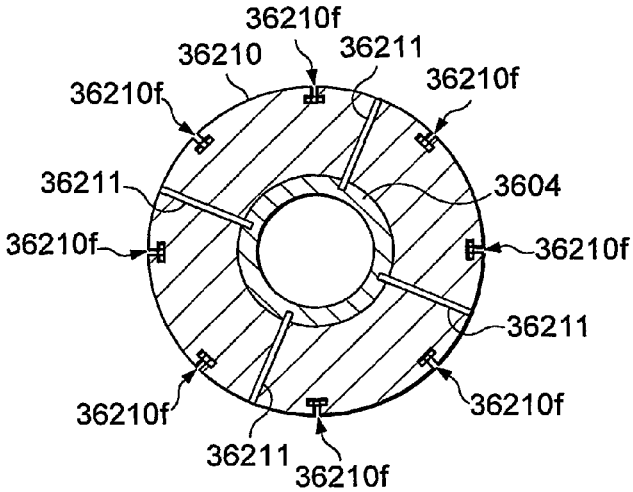
Figure 21D:
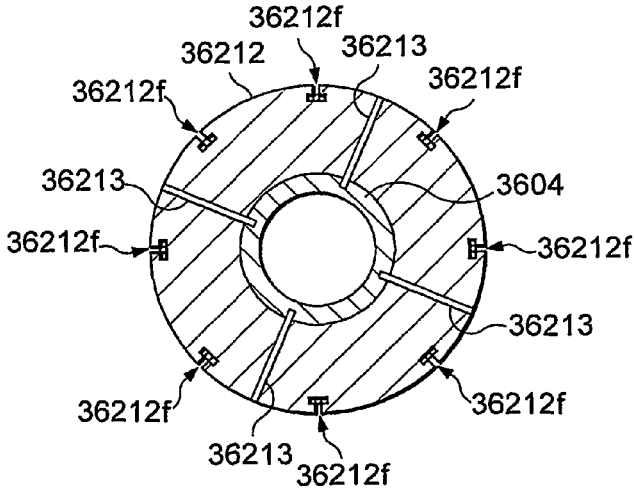
Figure 21E:
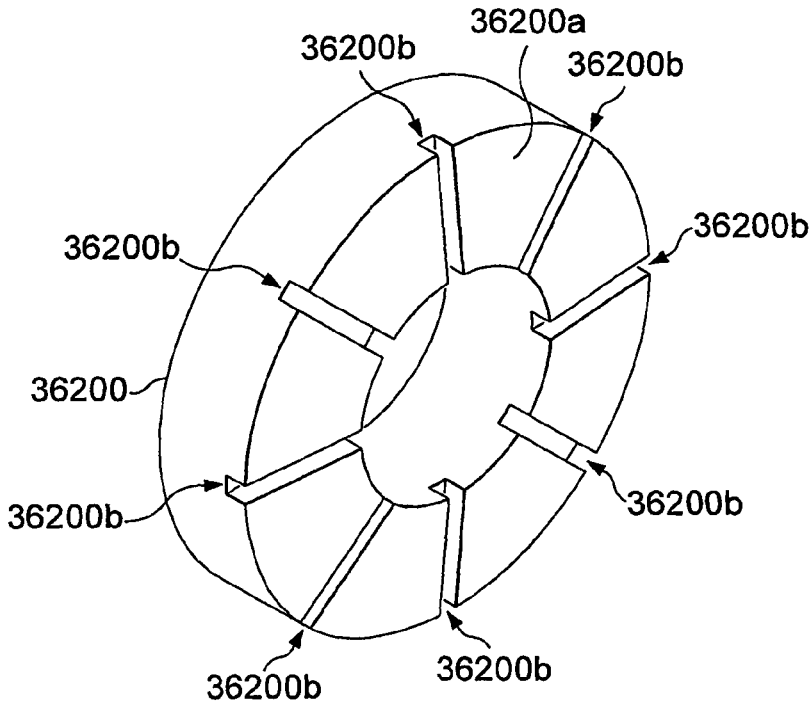
Figure 21H:
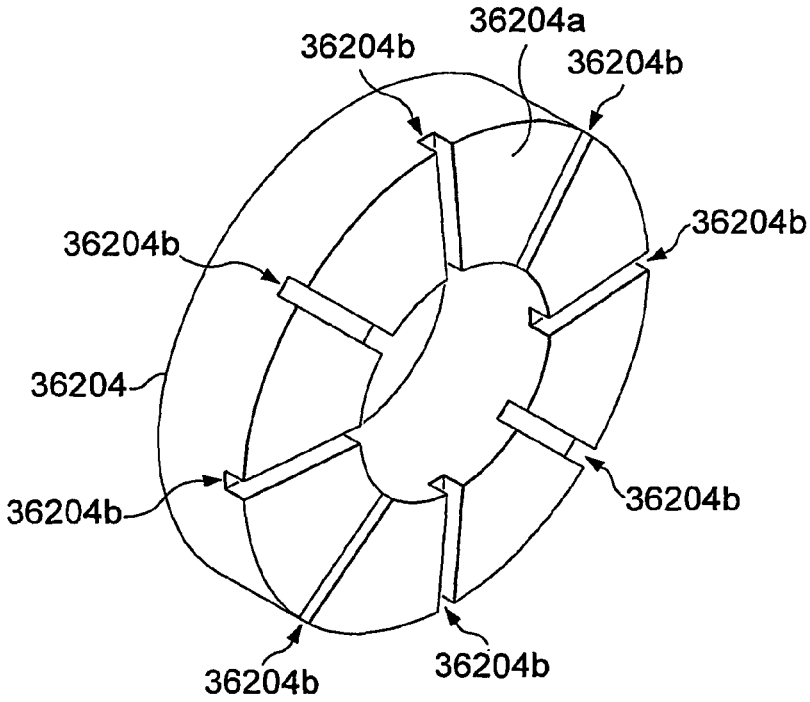
Figure 21G:
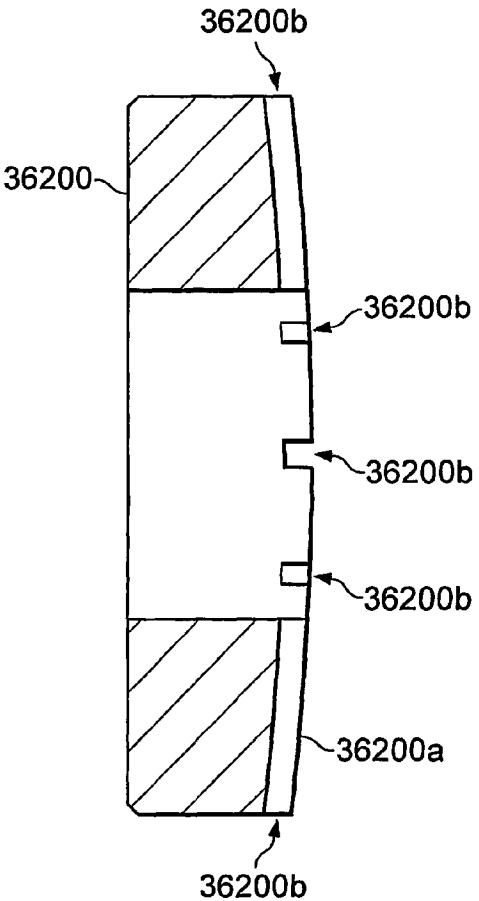
Figure 21F:
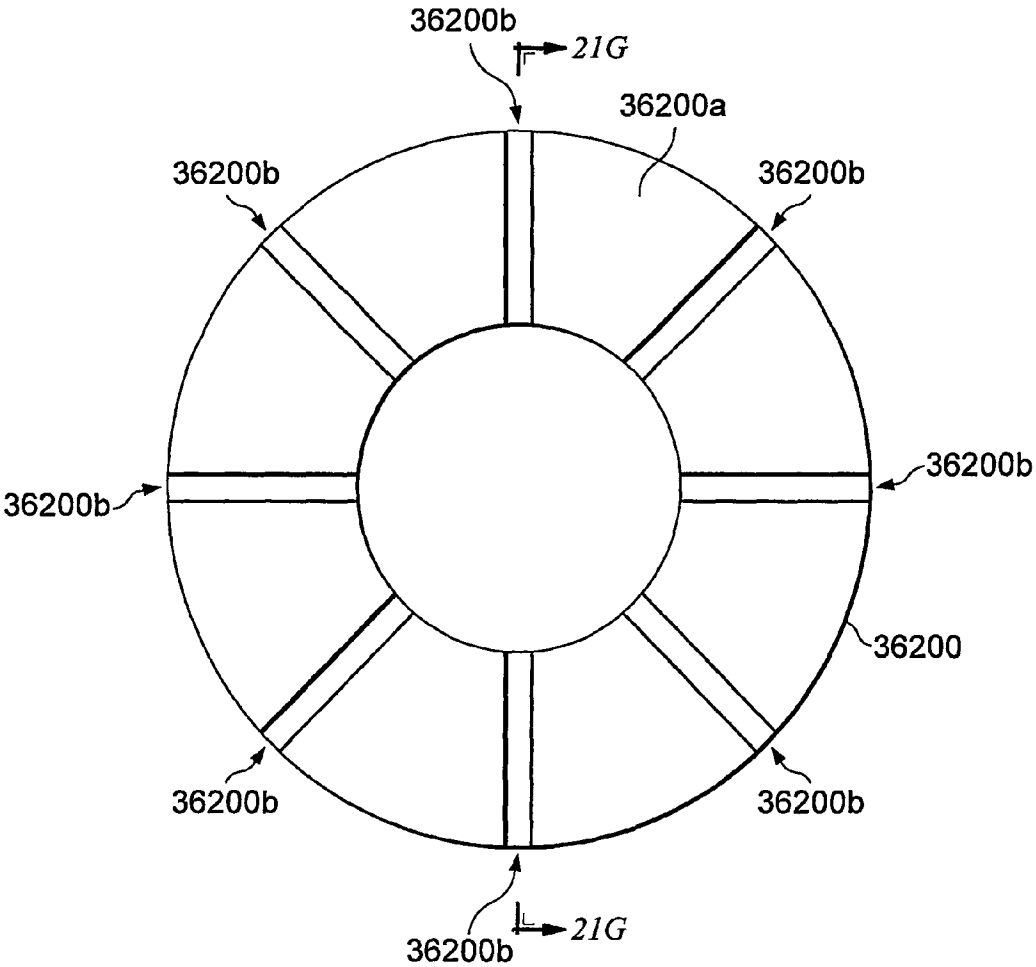
Figure 21J:
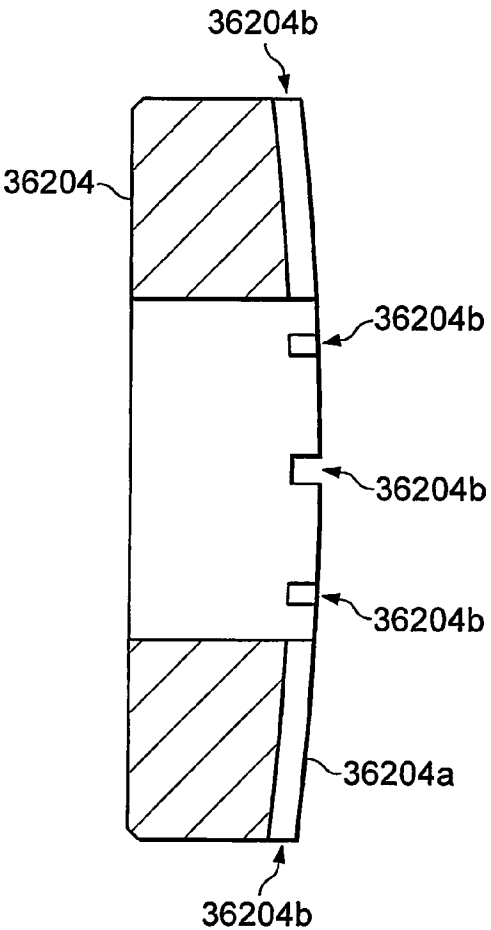
Figure 21I:
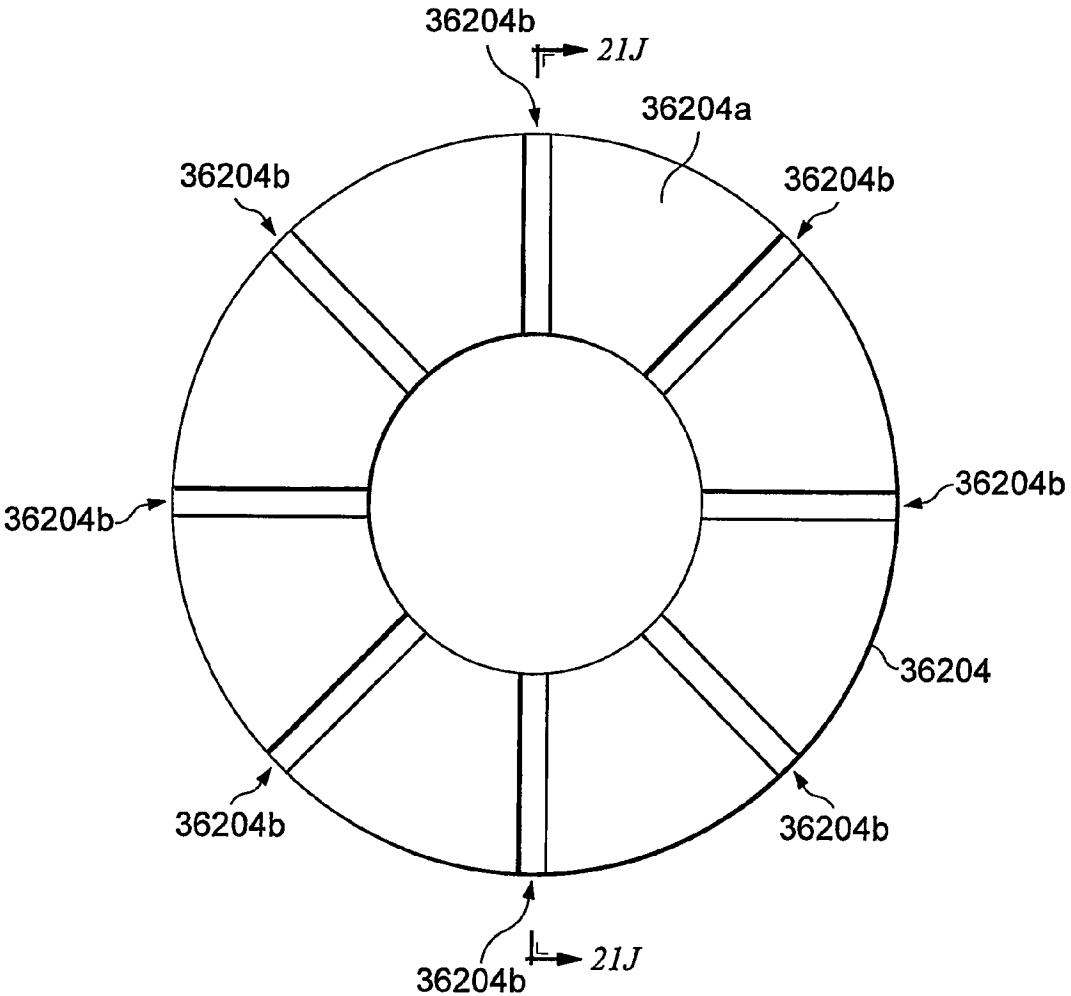
Figure 21K:
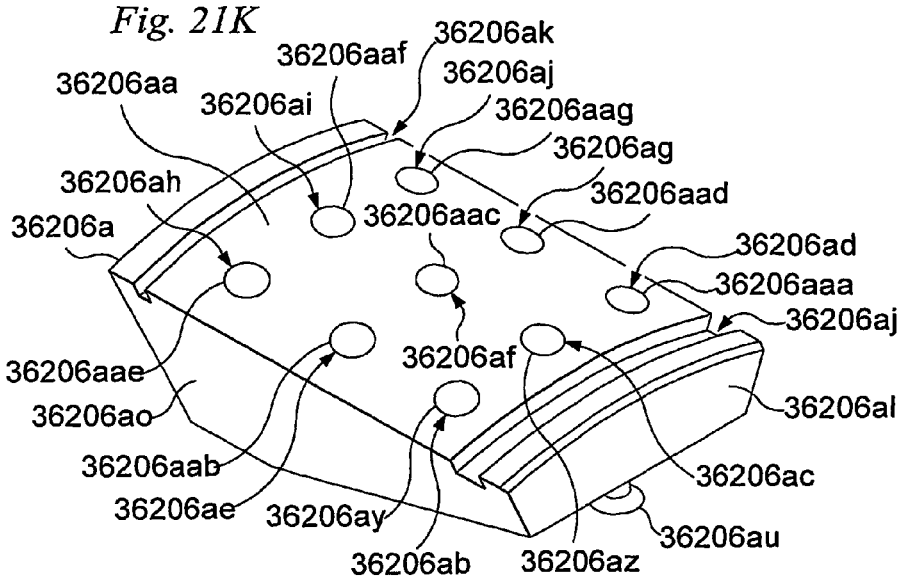
Figure 21L:
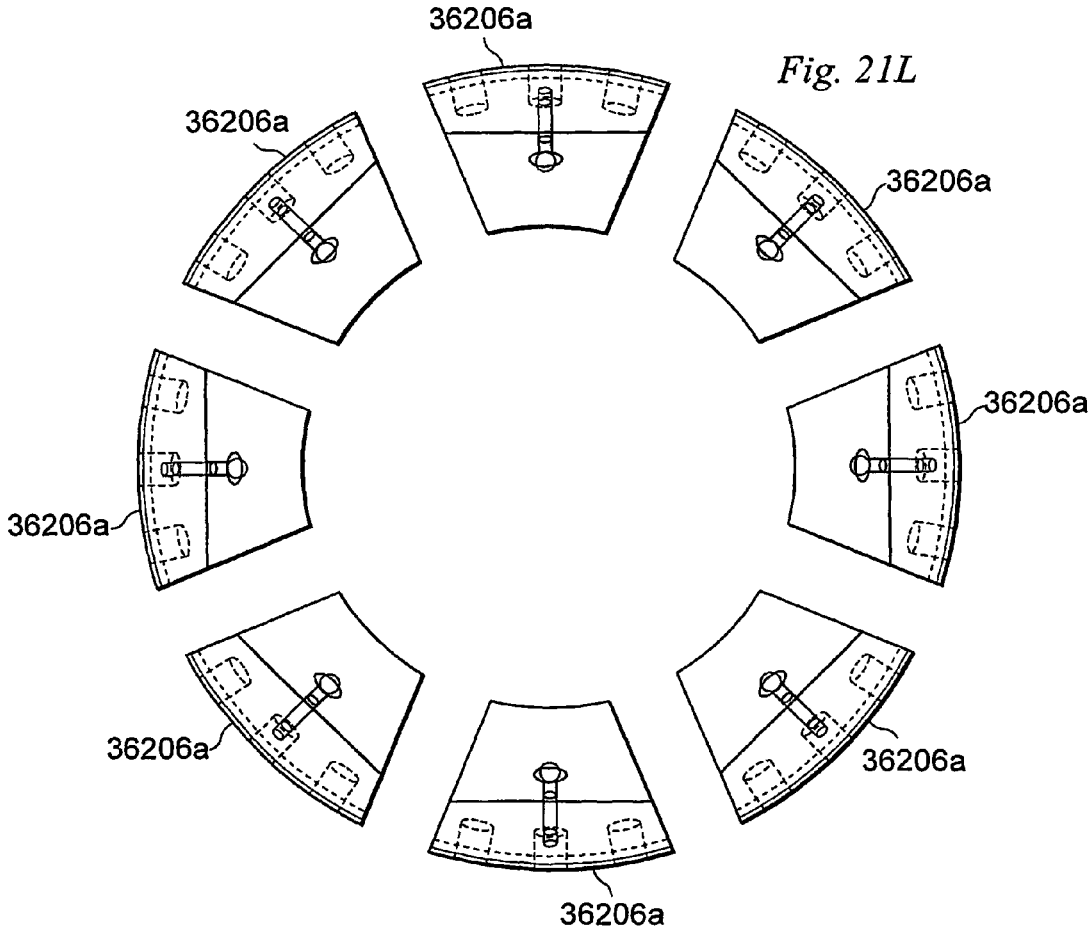
Figure 21M:
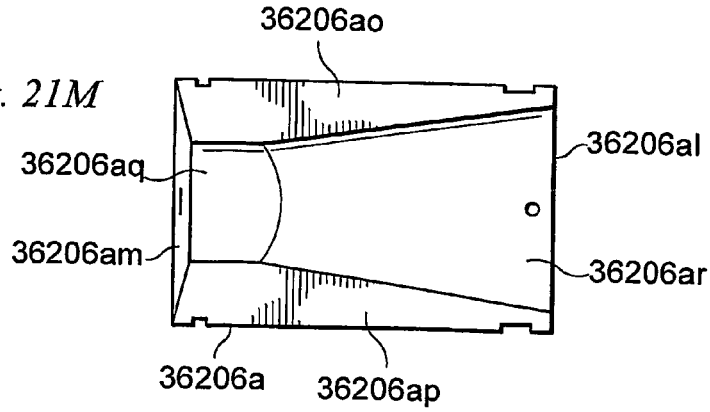
Figure 21N:
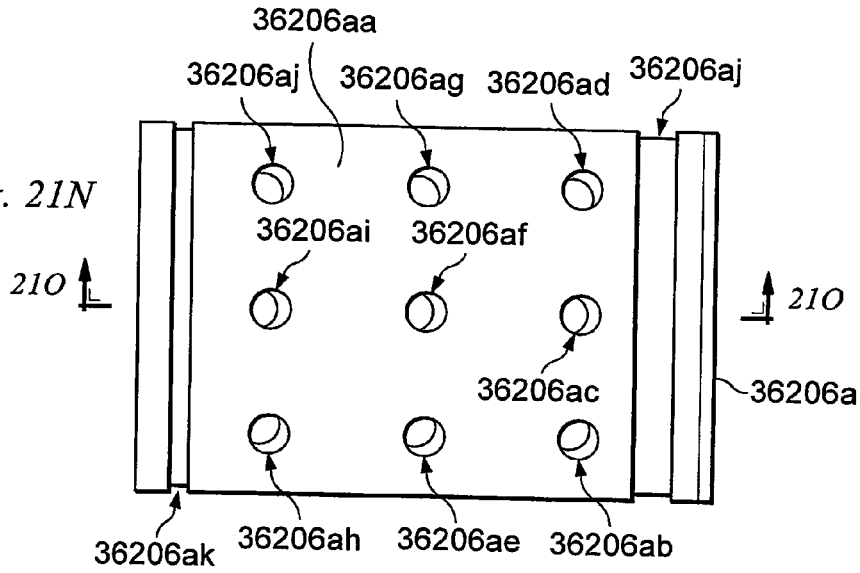
Figure 21O:
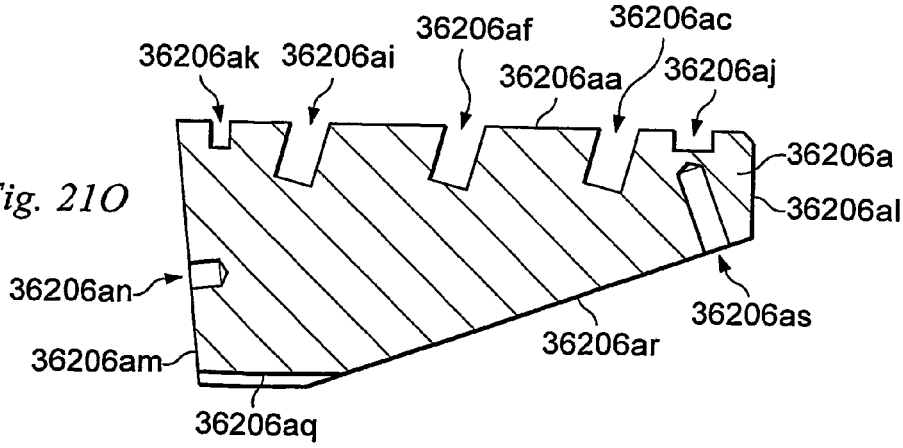
Figure 21P:
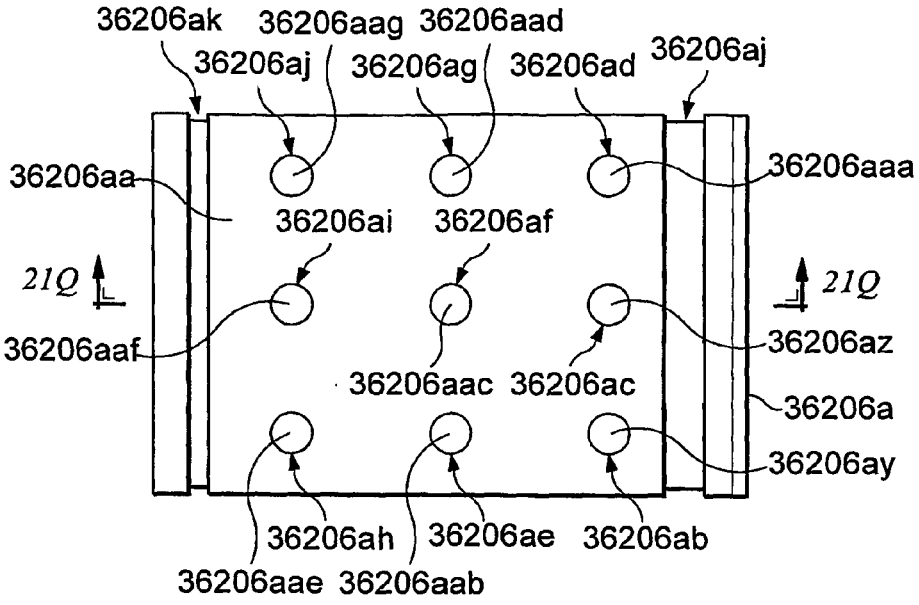
Figure 21Q:
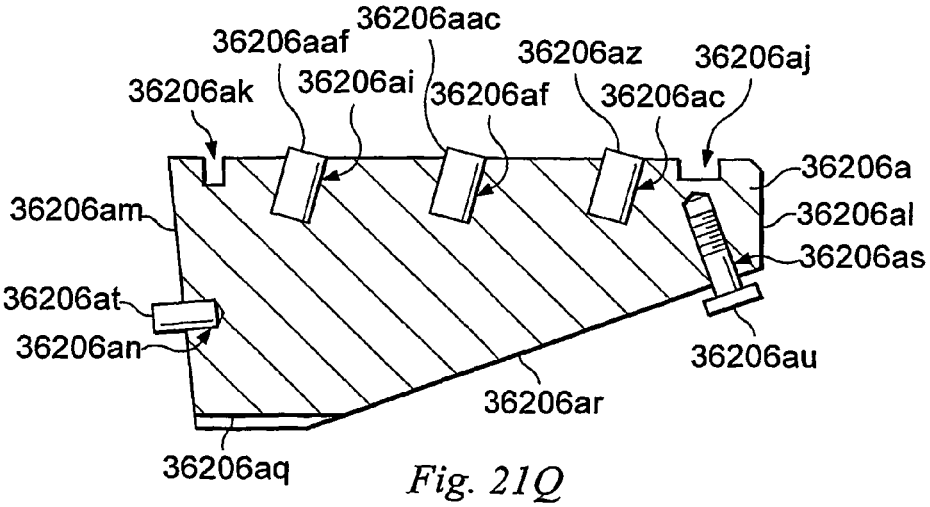
Figure 21R:
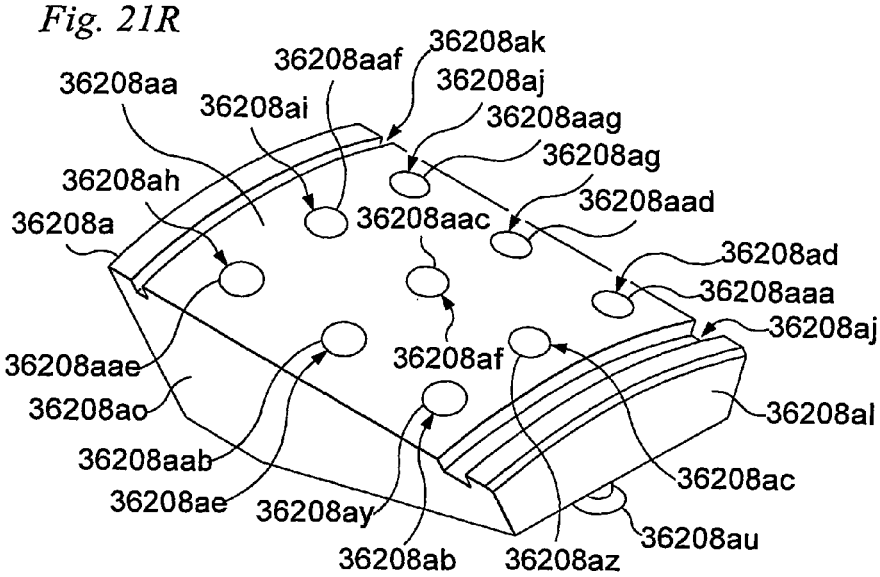
Figure 21S:
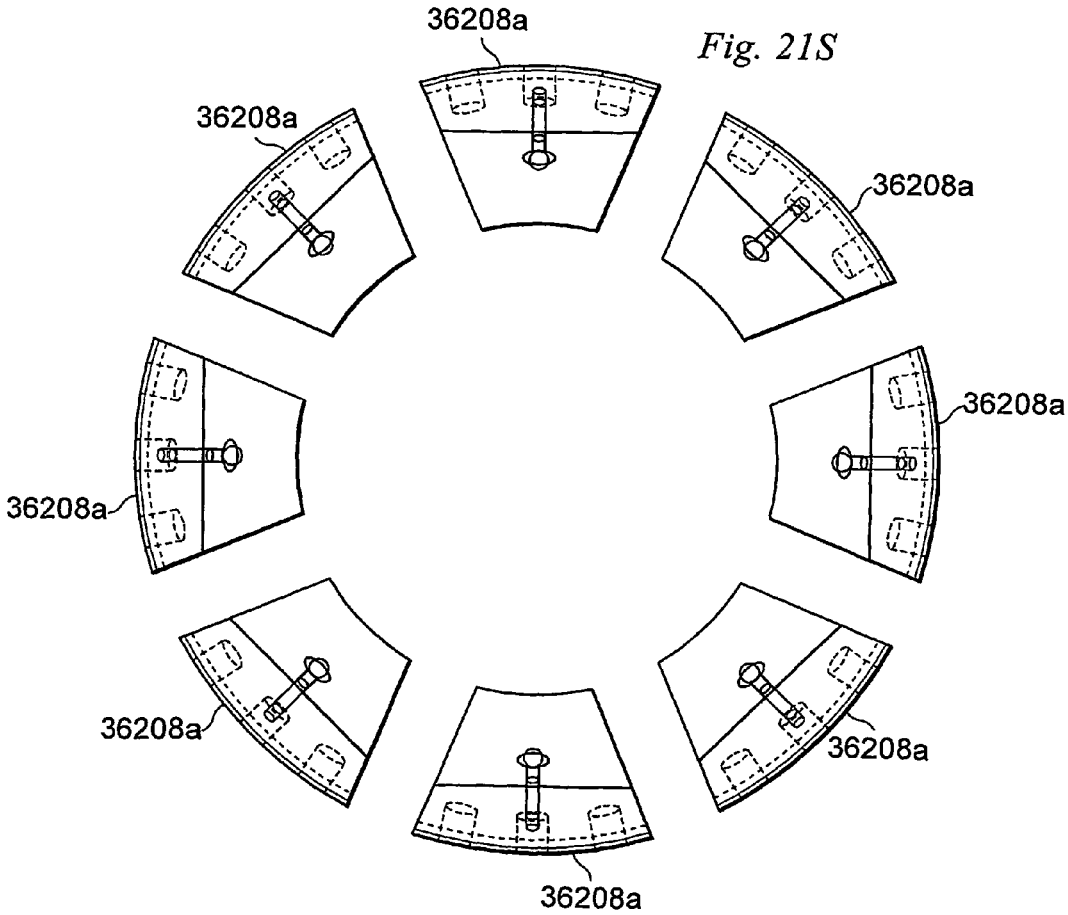
Figure 21T:
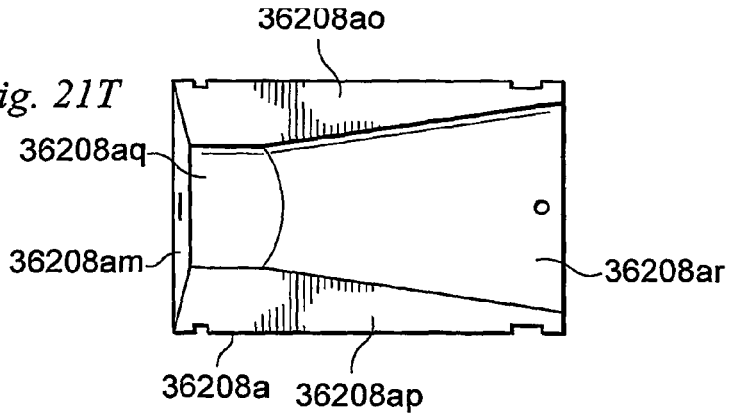
Figure 21U:
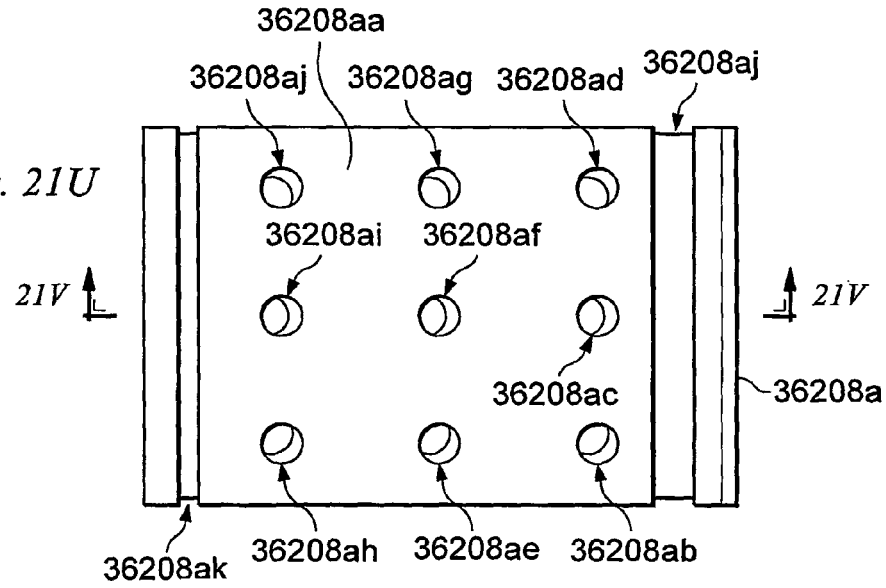
Figure 21V:
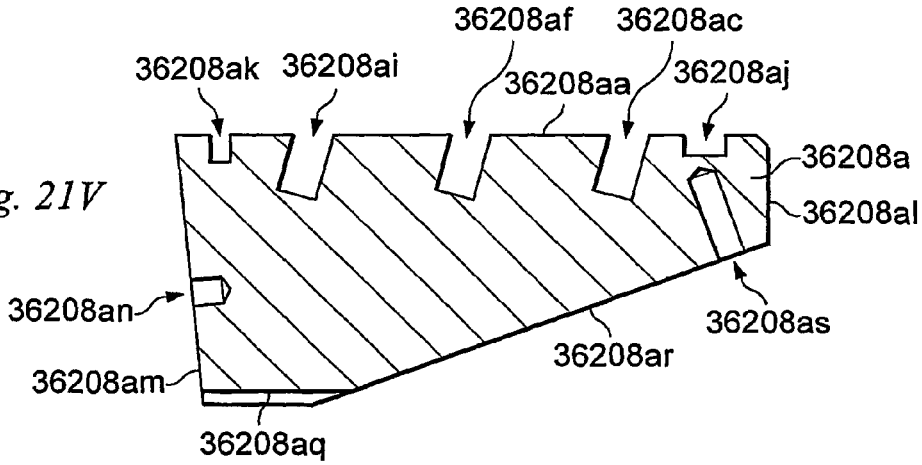
Figure 21W:
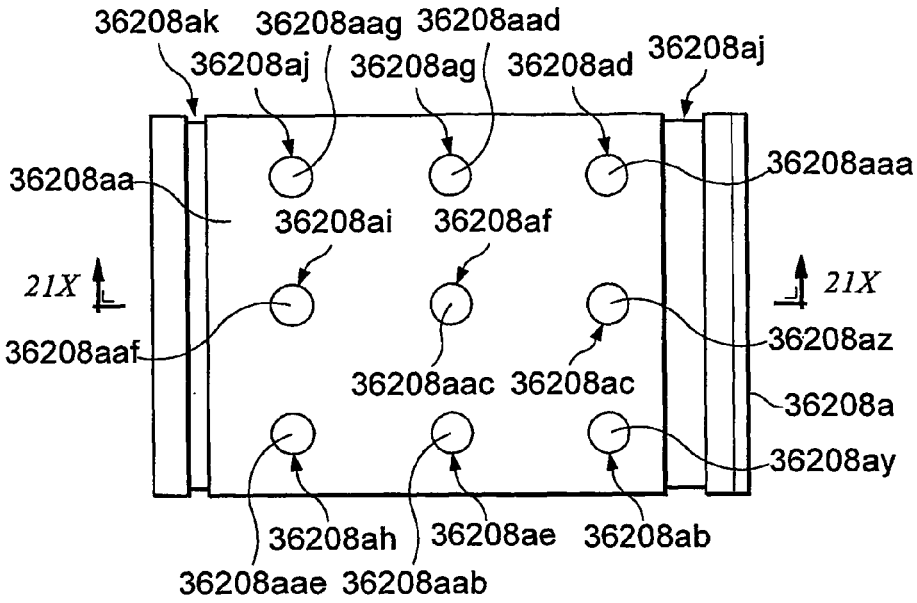
Figure 21X:
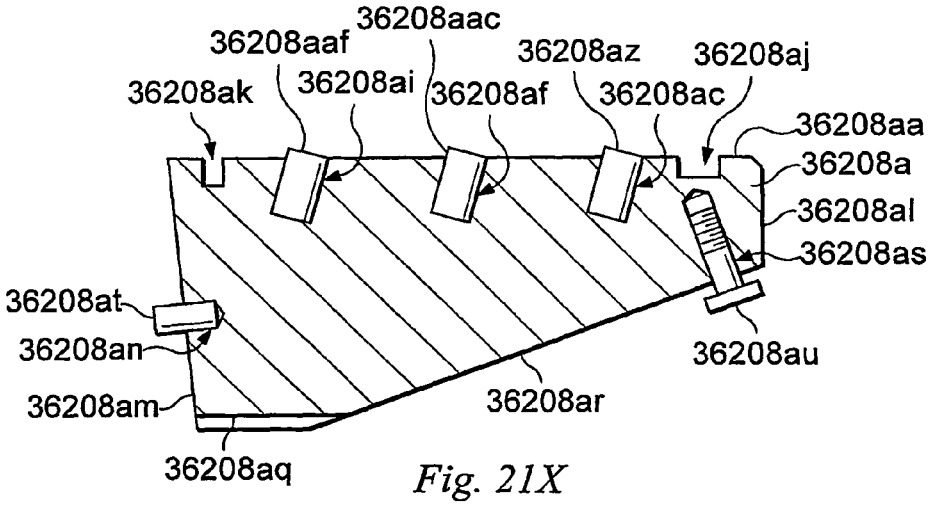
Figure 21Y:
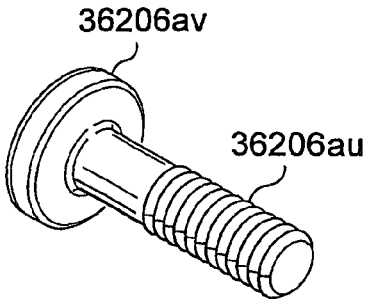
Figure 21Z:
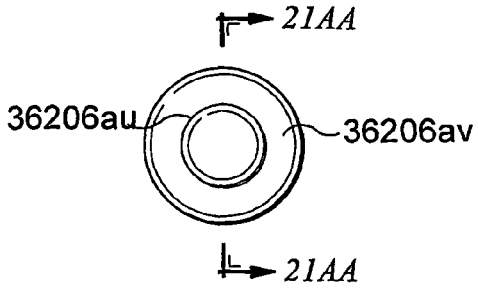
Figure 21A:
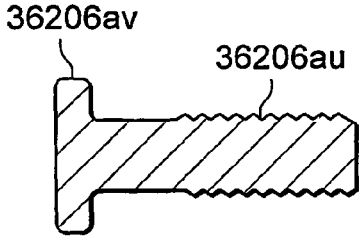
Figure 21A:
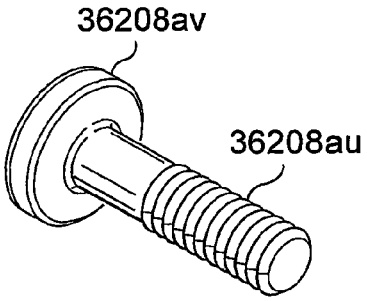
Figure 21A:
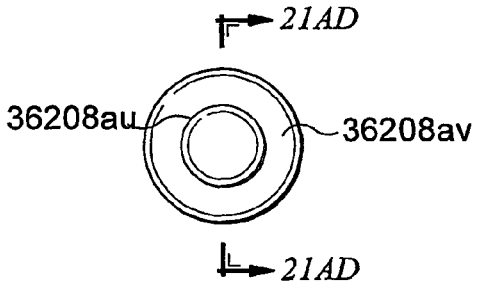
Figure 21A:
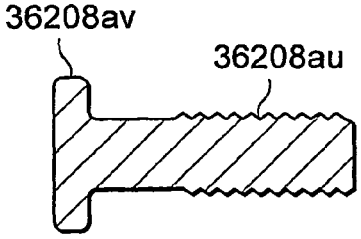
Figure 21A:
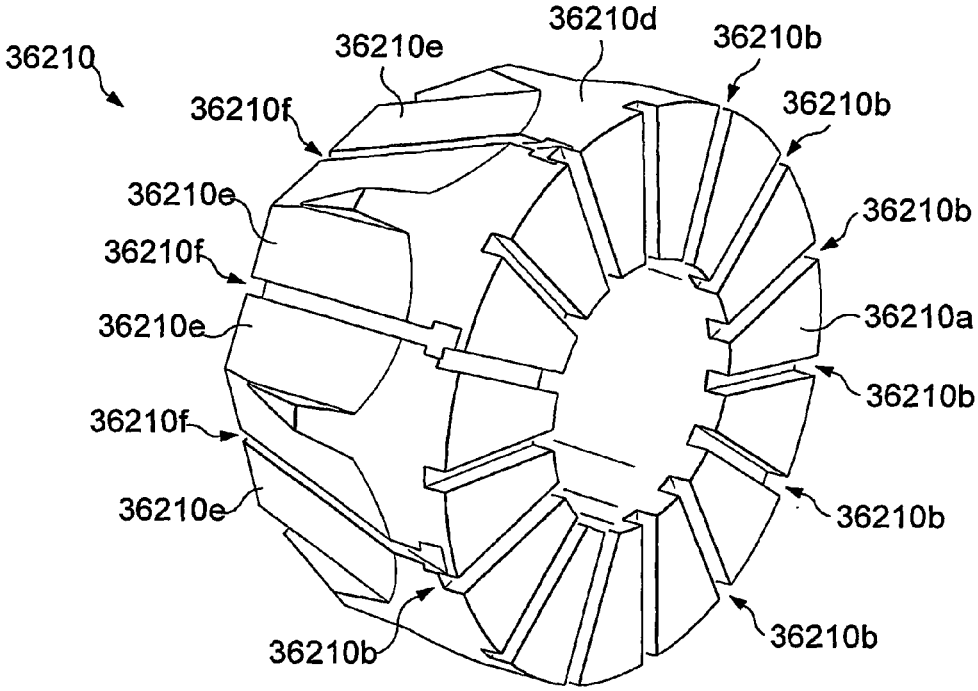
Figure 21A:
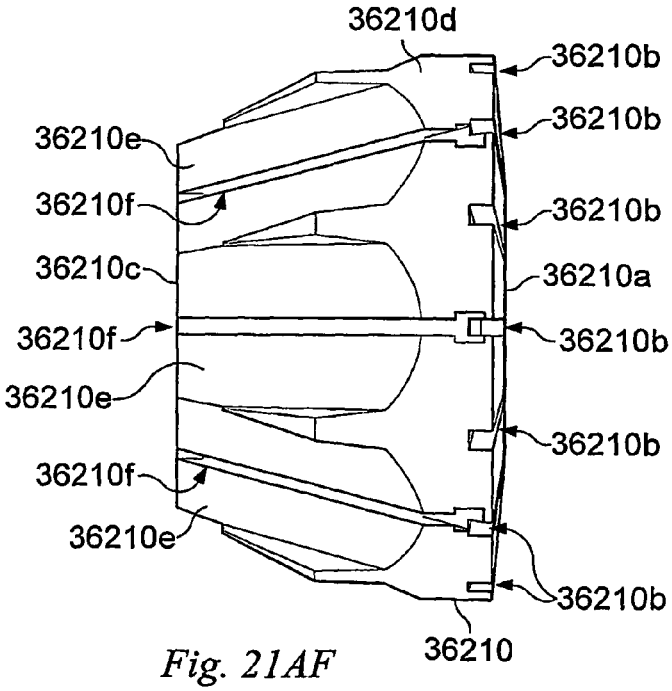
Figure 21A:
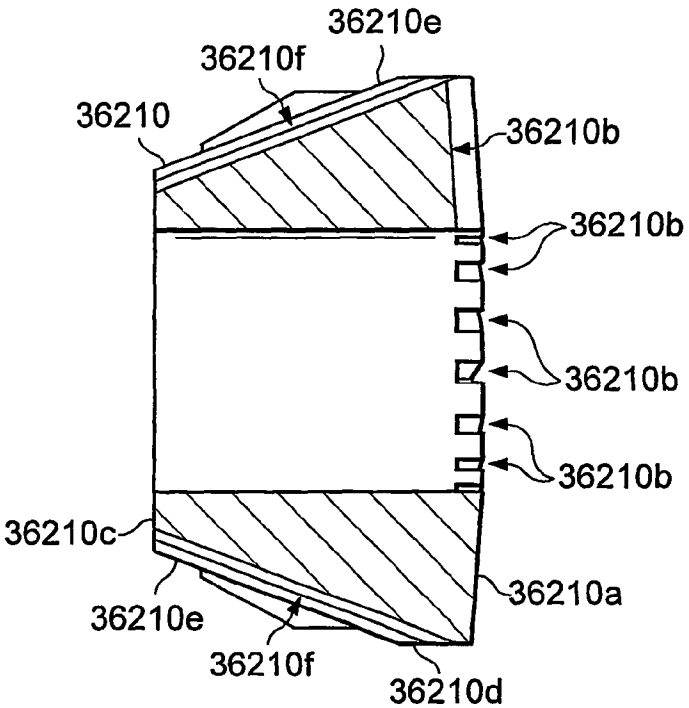
Figure 21A:
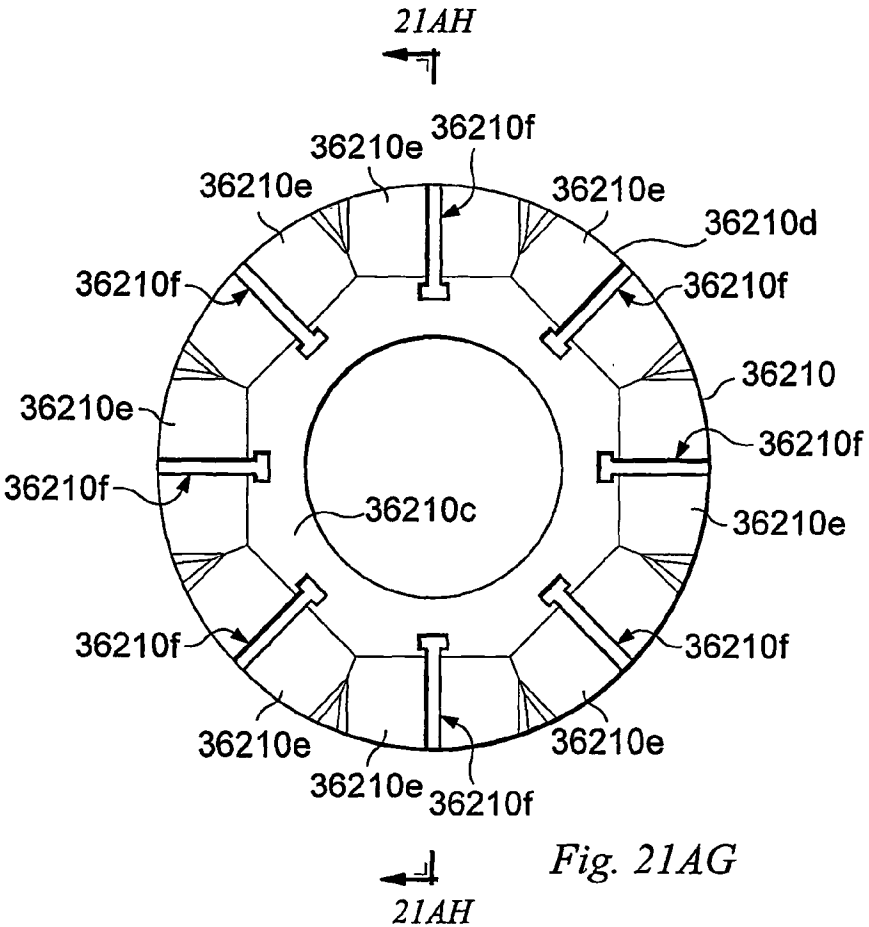
Figure 21A:
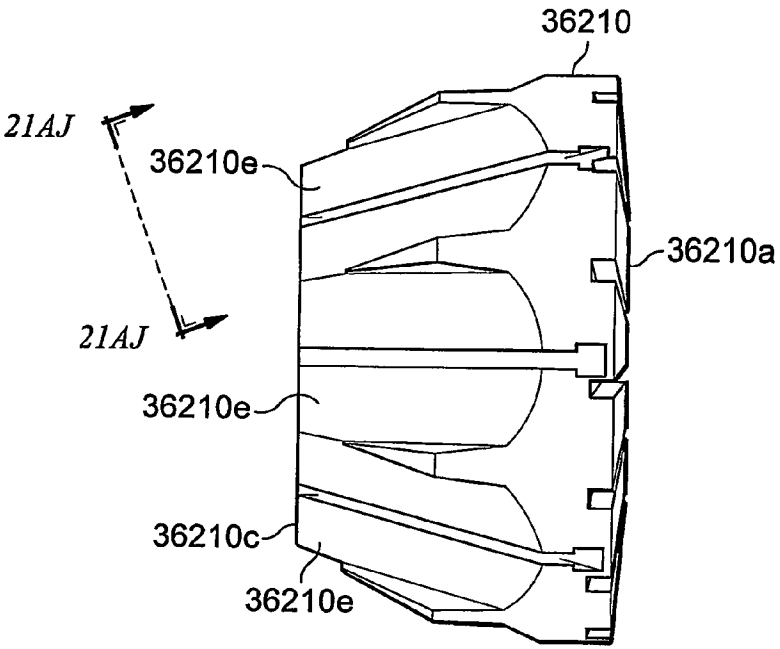
Figure 21A:
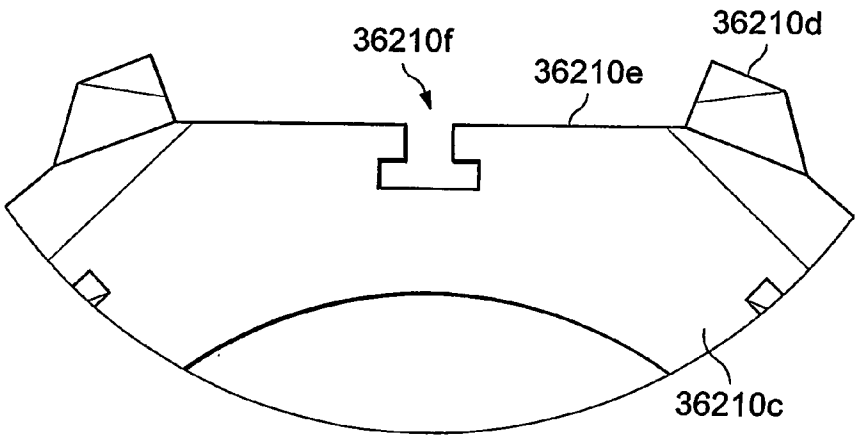
Figure 21A:
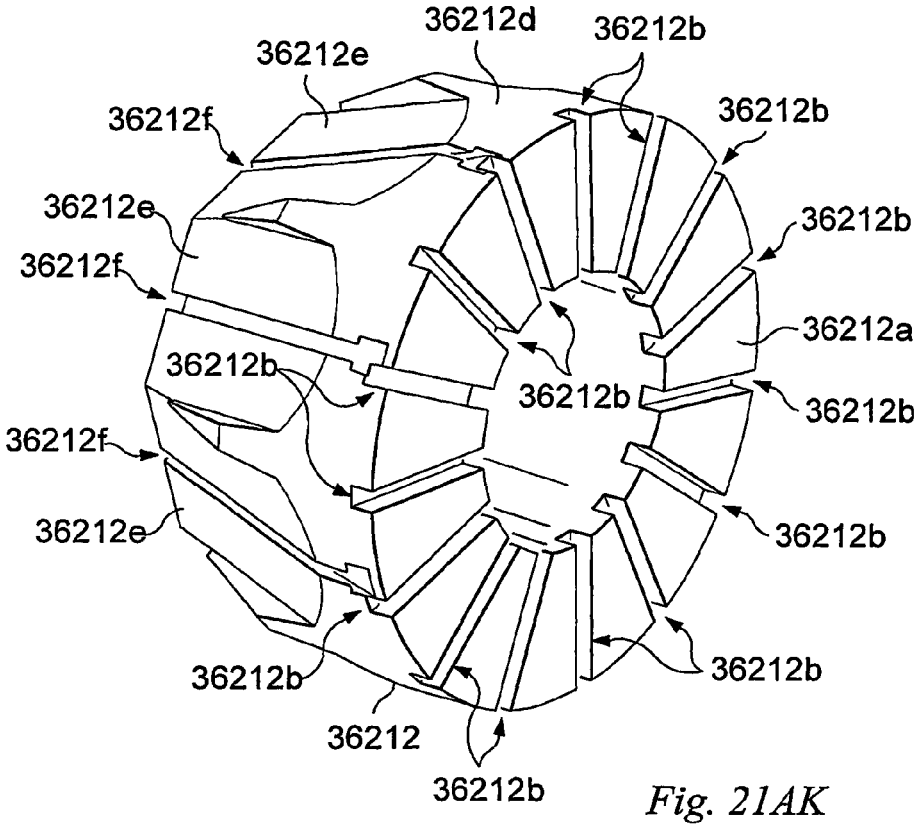
Figure 21A:
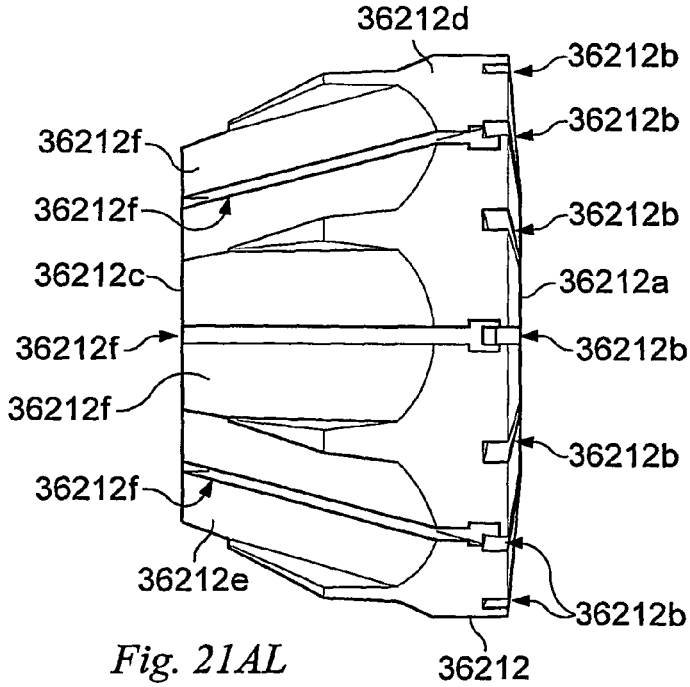
Figure 21A:
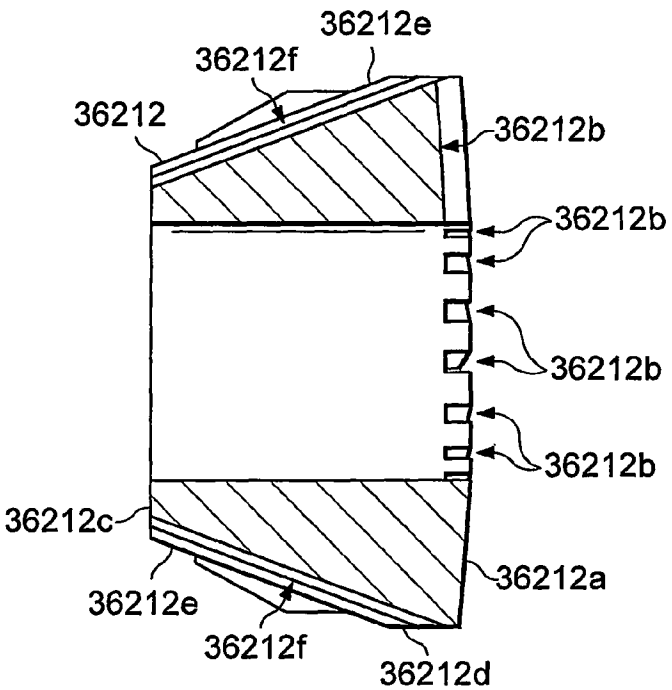
Figure 21A:
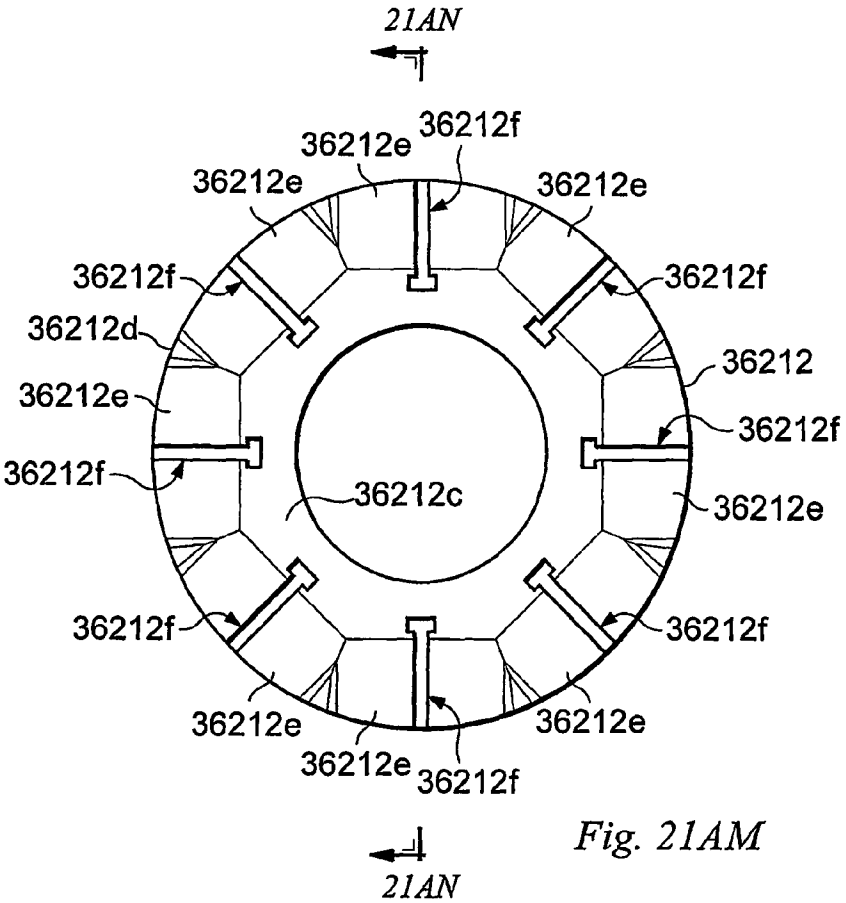
Figure 21A:
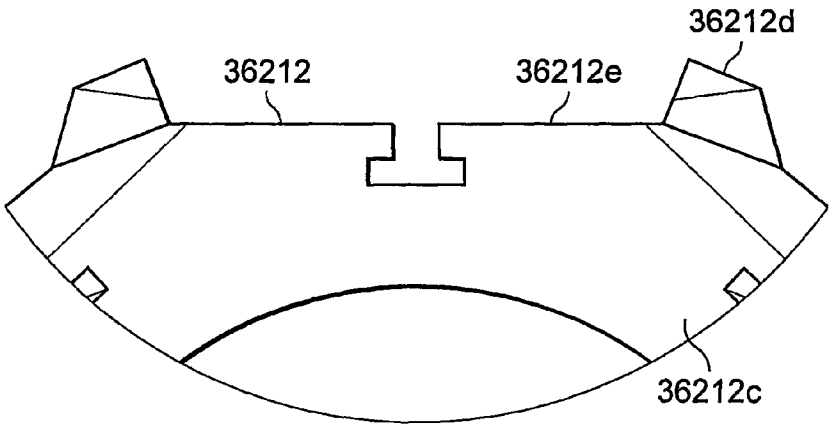
Figure 21A:
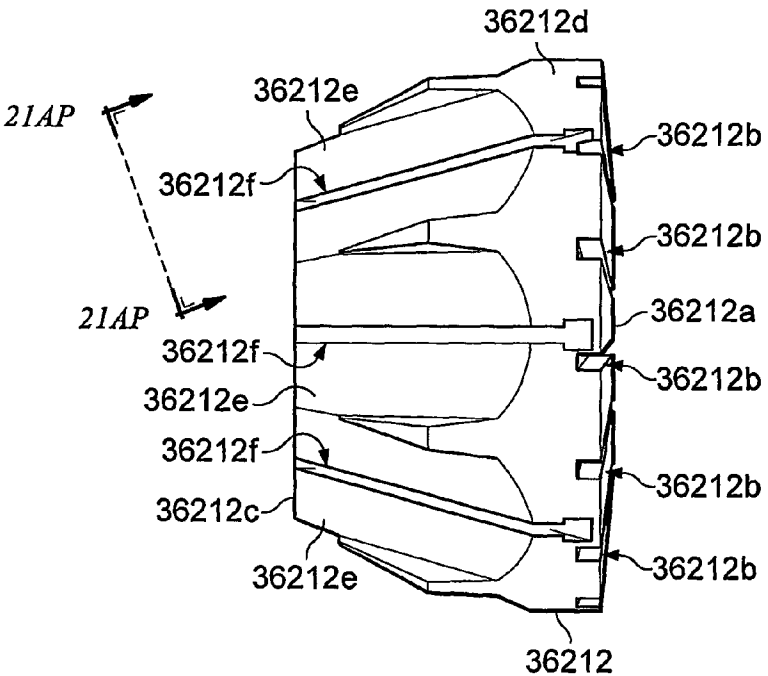
Figure 21A:
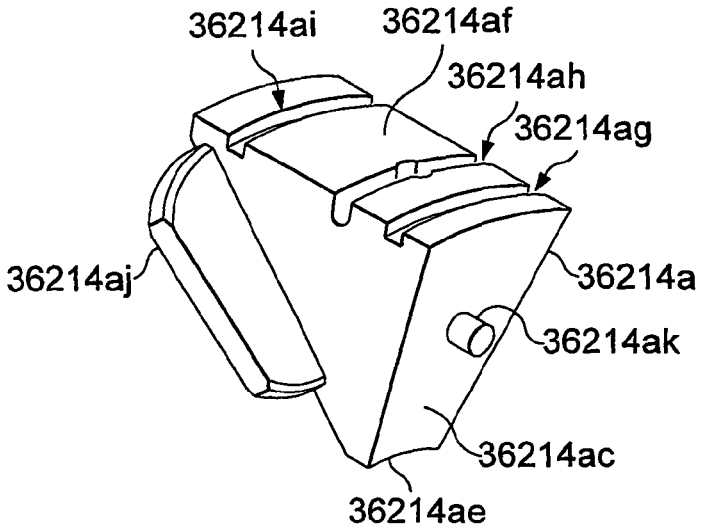
Figure 21A:
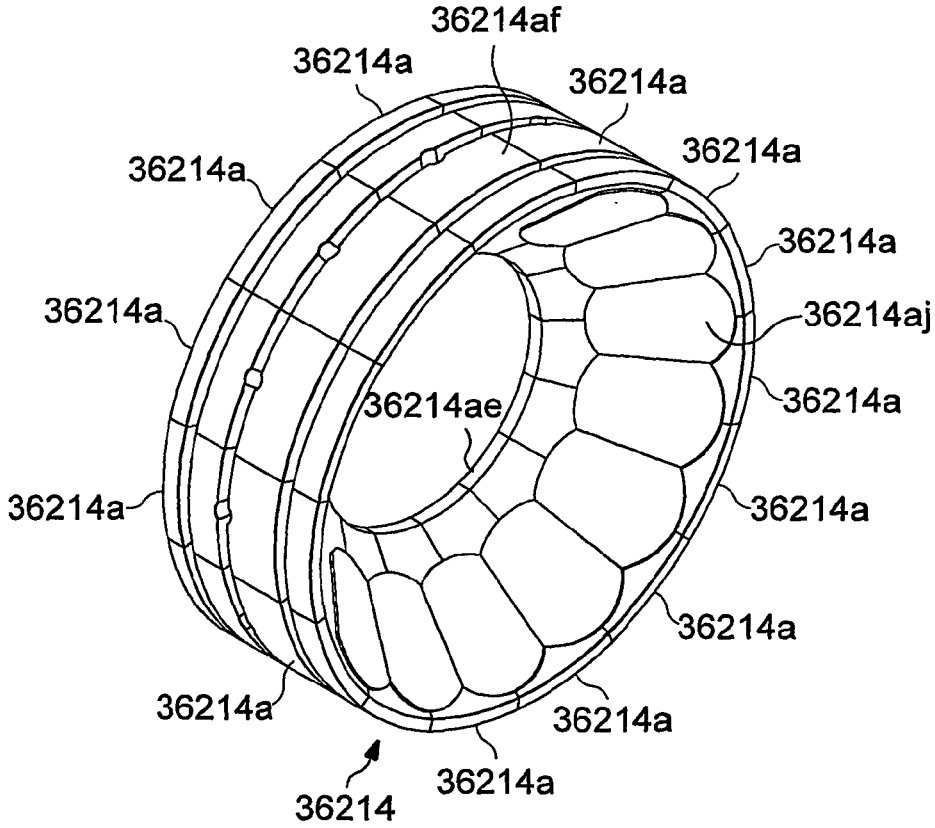
Figure 21A:
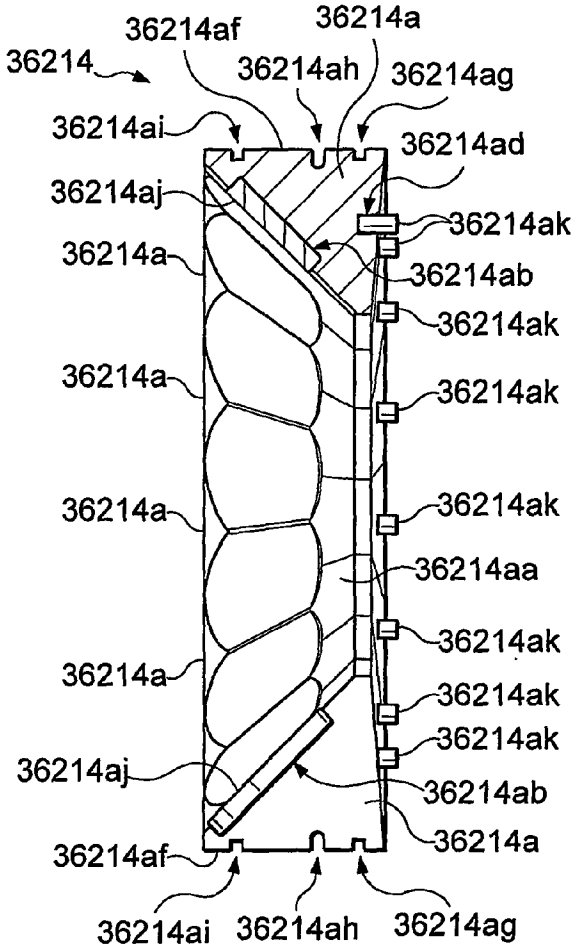
Figure 21A:
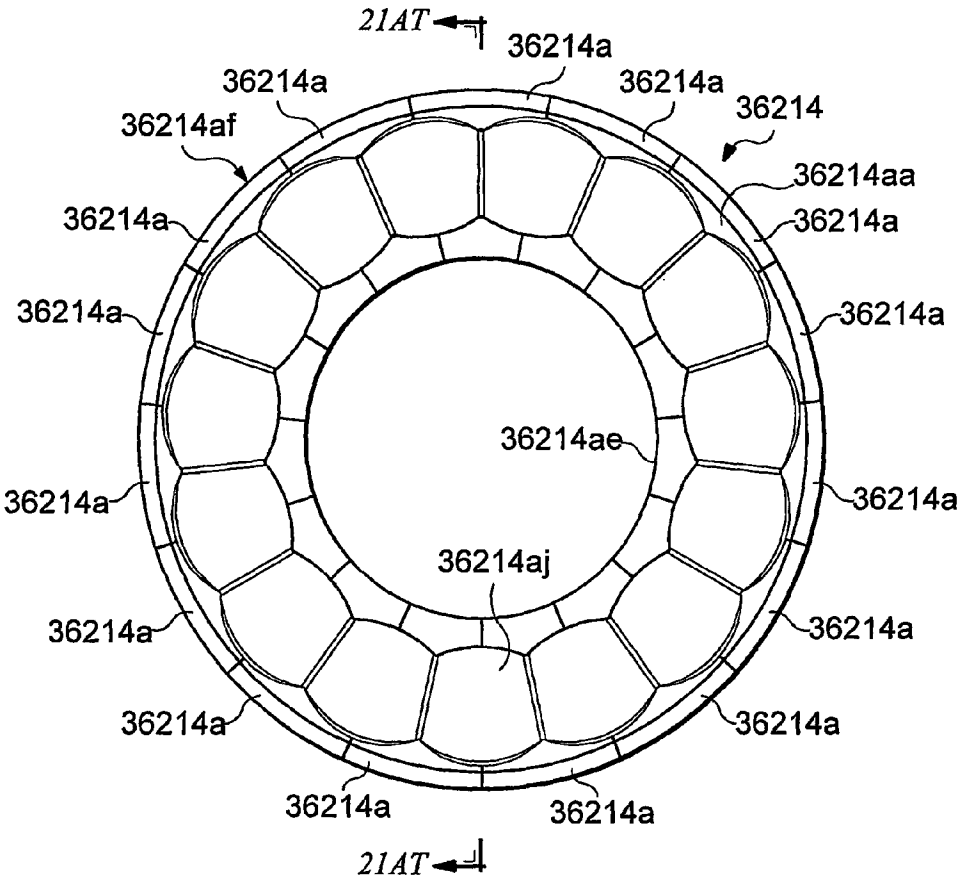
Figure 21A:
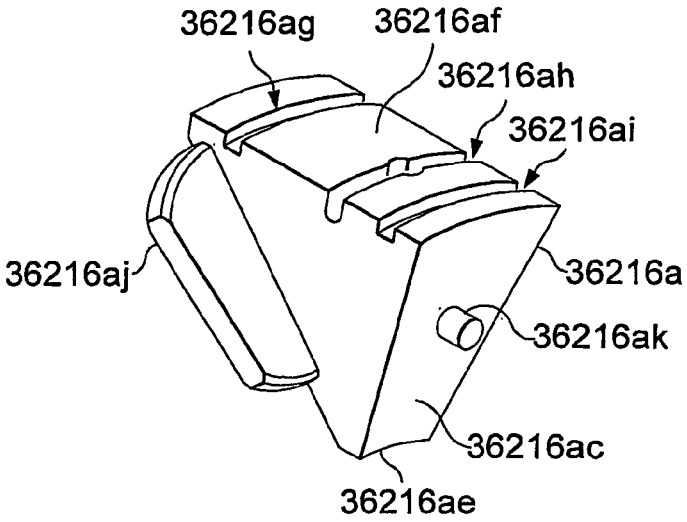
Figure 21A:
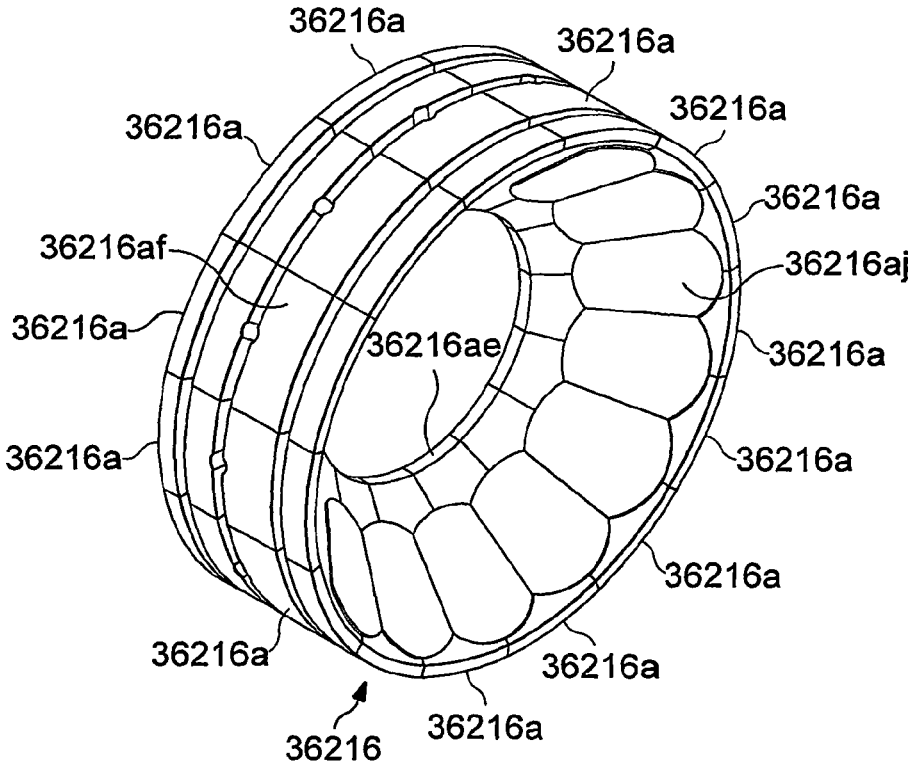
Figure 21A:
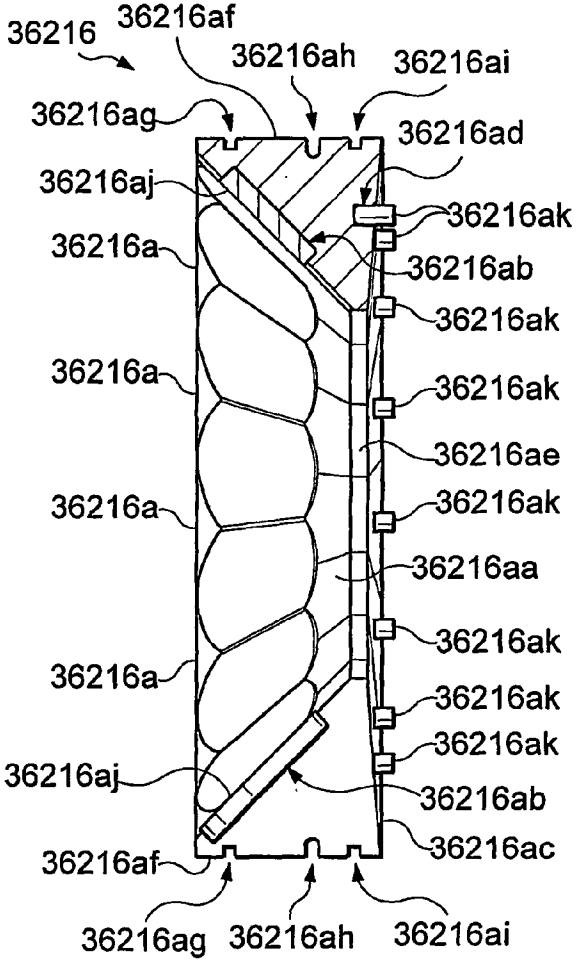
Figure 21A:
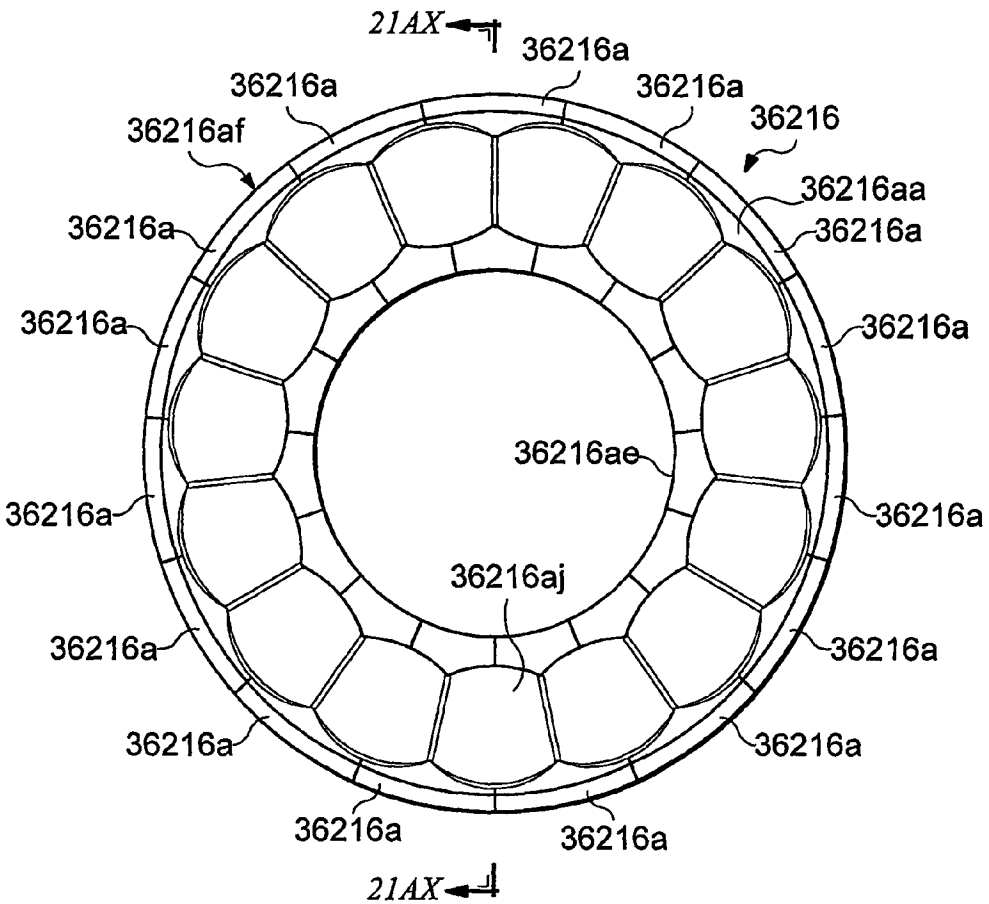

In an alternative embodiment, as illustrated in FIGS. 21 and 21A to 21AX, the packer assembly 36 includes an upper tubular spacer ring 36200 receives and mates with the end of the tubular upper mandrel 3604 and includes an angled end face 36200*a* that includes a plurality of spaced apart radial grooves 36200*b* and another end face that is positioned proximate to an end face of the tubular upper adaptor 3602 is coupled to the tubular upper mandrel by shear pins, 36202*a*, 36202*b*, 36202*c*, and 36202*d*. A lower tubular spacer ring 36204 that includes an angled end face 36204*a* that includes a plurality of spaced apart radial grooves 36204*b* receives, mates, and is coupled to the other end of the tubular upper mandrel 3604 and includes another end face that is positioned proximate to an end face of the external flange 3604*i* of the tubular upper mandrel 3604. In an exemplary embodiment, the upper and tubular spacer rings, 3606 and 3610, are fabricated from a composite material.

An upper tubular slip assembly 36206 that receives and is movably mounted upon the tubular upper mandrel 3604 includes a plurality of substantially identical slip elements 36206*a* that each include an exterior arcuate cylindrical surface 36206*aa* including mounting holes, 36206*ab*, 36206*ac*, 36206*ad*, 36206*ae*, 36206*af*, 36206*ag*, 36206*ah*, 36206*ai*, and 36206*aj*, and grooves, 36206*aj* and 36206*ak*, a front end face 36206*a*1, a rear end face 36206 am including a mounting hole 36206*an*, side faces, 36206*ao* and 36206*ap*, an interior arcuate cylindrical surface 36206*aq* that mates with the exterior surface of the tubular upper mandrel 3604, and an interior tapered surface 36206*ar* including a mounting hole 36206*as*. Mounting pins 36206*at* are received within and coupled to the mounting holes 36206*an* and are received within corresponding radial grooves 36200*b* of the angled end face 36200*a* of the upper tubular spacer ring 36200. Retaining pins 36206*au* are mounted within and coupled to the mounting holes 36206 as that include heads 36206*av*. Slip retaining bands, 36206*aw* and 36206*ax*, are received within and coupled to grooves, 36206*aj* and 36206*ak*, respectively, of the slip elements 36206*a*. Slip gripping elements, 36206*ay*, 36206*az*, 36206*aaa*, 36206*aab*, 36206*aac*, 36206*aad*, 36206*aae*, 36206*aaf*, and 36206*aag*, are mounted within, coupled to, and extend out of the mounting holes, 36206*ab*, 36206*ac*, 36206*ad*, 36206*ae*, 36206*af*, 36206*ag*, 36206*ah*, 36206*ai*, and 36206*aj*, respectively. In an exemplary embodiment, the adjacent exterior arcuate cylindrical surfaces 36206*aa* of the identical slip elements 36206*a* of the upper tubular slip assembly 36206 together define a substantially contiguous cylindrical surface.

A lower tubular slip assembly 36208 that receives and is movably mounted upon the tubular upper mandrel 3604 includes a plurality of substantially identical slip elements 36208*a* that each include an exterior arcuate cylindrical surface 36208*aa* including mounting holes, 36208*ab*, 36208*ac*, 36208*ad*, 36208*ae*, 36208*af*, 36208*ag*, 36208*ah*, 36208*ai*, and 36208*aj*, and grooves, 36208*aj* and 36208*ak*, a front end face 36208*a*1, a rear end face 36208*am* including a mounting hole 36208*an*, side faces, 36208*ao* and 36208*ap*, an interior arcuate cylindrical surface 36208*aq* that mates with the exterior surface of the tubular upper mandrel 3604, and an interior tapered surface 36208*ar* including a mounting hole 36208*as*. Mounting pins 36208*at* are received within and coupled to the mounting holes 36208*an* and are received within corresponding radial grooves 36204*b* of the angled end face 36204*a* of the lower tubular spacer ring 36204. Retaining pins 36208*au* are mounted within and coupled to the mounting holes 36208 as that include heads 36208*av*. Slip retaining bands, 36208*aw* and 36208*ax*, are received within and coupled to grooves, 36208*aj* and 36208*ak*, respectively, of the slip elements 36208*a*. Slip gripping elements, 36208*ay*, 36208*az*, 36208*aaa*, 36208*aab*, 36208*aac*, 36208*aad*, 36208*aae*, 36208*aaf*, and 36208*aag*, are mounted within, coupled to, and extend out of the mounting holes, 36208*ab*, 36208*ac*, 36208*ad*, 36208*ae*, 36208*af*, 36208*ag*, 36208*ah*, 36208*ai*, and 36208*aj*, respectively. In an exemplary embodiment, the adjacent exterior arcuate cylindrical surfaces 36208*aa* of the identical slip elements 36208*a* of the upper tubular slip assembly 36208 together define a substantially contiguous cylindrical surface.

An upper tubular wedge 36210 that receives the tubular upper mandrel 3604 includes an angled front end face 36210*a* including spaced apart radial grooves 36210*b*, a rear end face 36210*c*, an exterior cylindrical surface 36210*d*, a plurality of spaced apart faceted tapered exterior surface segments 36210*e* that mate with corresponding tapered internal surfaces 36206*ar* of corresponding slip elements 36206*a* of the upper tubular slip assembly 36206, and T-shaped exterior grooves 36210*f* aligned with the midline of corresponding faceted tapered exterior surface segments that extend from the angled end face to the rear end face that receive and mate with corresponding retaining pins 36206*au* of corresponding slip elements of the upper tubular slip assembly. The upper tubular wedge 36210 is releasably coupled to the tubular upper mandrel 3604 by shear pins 36211.

A lower tubular wedge 36212 that receives the tubular upper mandrel 3604 includes an angled front end face 36212*a* including spaced apart radial grooves 36212*b*, a rear end face 36212*c*, an exterior cylindrical surface 36212*d*, a plurality of spaced apart faceted tapered exterior surface segments 36212*e* that mate with corresponding tapered internal surfaces 36208*ar* of corresponding slip elements 36208*a* of the upper tubular slip assembly 36208, and T-shaped exterior grooves 36212*f* aligned with the midline of corresponding faceted tapered exterior surface segments that extend from the angled end face to the rear end face that receive and mate with corresponding retaining pins 36208*au* of corresponding slip elements of the lower tubular slip assembly. The lower tubular wedge 36212 is releasably coupled to the tubular upper mandrel 3604 by shear pins 36213.

An upper tubular extrusion limiter assembly 36214 that receives and is movably mounted upon the tubular upper mandrel 3604 includes a plurality of substantially identical extrusion limiter elements 36214*a* that each include an angled front end face 36214*aa* having a recessed portion 36214*ab*, an angled rear end face 36214*ac* that defines a mounting hole 36214*ad*, an interior arcuate cylindrical surface 36214*ae* that mates with the tubular upper mandrel, and an exterior arcuate cylindrical surface 36214*af* including grooves, 36214*ag*, 36214*ah*, and 36214*ai*. Disk extrusion preventers 36214*aj* are mounted within and coupled to the recessed portions 36214*ab* of adjacent extrusion limiter elements 36214*a*, and mounting pins 36214*ak* are mounted within and coupled to mounting holes 36214*ad* of corresponding extrusion limiter elements 36214*a* that are received within corresponding radial grooves 36210*b* of the front end face 36210*a* of the upper tubular wedge 36210. Retaining bands, 36214*a*1, 36214*am*, and 36214*an*, are positioned within and coupled to the grooves, 36214*ai*, 36214*ah*, and 36214*ag*, respectively, of the extrusion limiter elements 36214*a*.

A lower tubular extrusion limiter assembly 36216 that receives and is movably mounted upon the tubular upper mandrel 3604 includes a plurality of substantially identical extrusion limiter elements 36216*a* that each include an angled front end face 36216*aa* having a recessed portion 36216*ab*, an angled rear end face 36216*ac* that defines a mounting hole 36216*ad*, an interior arcuate cylindrical surface 36216*ae* that mates with the tubular upper mandrel, and an exterior arcuate cylindrical surface 36216*af* including grooves, 36216*ag*, 36216*ah*, and 36216*ai*. Disk extrusion preventers 36216*aj* are mounted within and coupled to the recessed portions 36216*ab* of adjacent extrusion limiter elements 36216*a*, and mounting pins 36216*ak* are mounted within and coupled to mounting holes 36216*ad* of corresponding extrusion limiter elements 36216*a* that are received within corresponding radial grooves 36212*b* of the front end face 36212*a* of the lower tubular wedge 36212. Retaining bands, 36216*a*1, 36216*am*, and 36216*an*, are positioned within and coupled to the grooves, 36216*ag*, 36216*ah*, and 36216*ai*, of the extrusion limiter elements 36216*a*.

The angled end face 3640*b* of the upper tubular elastomeric packer element 3640 mates with and is positioned proximate the angled end faces 36214*aa* and disk extrusion preventers 36214*aj* of the extrusion limiter elements 36214*a* of the upper tubular extrusion limiter assembly 36214, and the angled end face 3642*b* of the lower tubular elastomeric packer element 3642 mates with and is positioned proximate the angled end faces 36216*aa* and disk extrusion preventers 36216*aj* of the extrusion limiter elements 36216*a* of the lower tubular extrusion limiter assembly 36216.

During operation of the alternative embodiment of the packer assembly 36 described above with reference to FIGS. 21 and 21A to 21AX, the first step in setting the packer assembly 36 includes pushing the slip elements, 36206*a* and 36208*a*, of the upper and lower slip assemblies, 36206 and 36208, respectively, up the upper and lower tubular wedges, 36210 and 36212, respectively, which breaks the retaining rings, 36206*aw* and 36206*ax*, and 36208*aw* and 36208*ax*, respectively, and moves the slip elements outwardly against the interior surface of the expandable wellbore casing 100. In an exemplary embodiment, during the radial displacement of the slip elements, 36206*a* and 36208*a*, the retaining pins, 36206*au* and 36208*au*, respectively, and the mounting pins, 36206*at* and 36208*at*, respectively, maintain the slip elements in an evenly spaced apart configuration. In an exemplary embodiment, during the operation of the packer assembly 36, the mounting pins, 36214*ak* and 36216*ak*, maintain the extrusion limiter elements, 36214*a* and 36216*a*, of the upper and lower tubular extrusion limiter assemblies, 36214 and 36216, respectively, in an evenly spaced apart configuration. The operation of the alternative embodiment of the packer assembly 36 described above with reference to FIGS. 21 and 21A to 21AX is otherwise substantially identical to the operation of the packer assembly described above with reference to FIGS. 20A1 to 20A5, 20B1 to 20B5, 20C1 to 20C5, 20D1 to 20D5, 20E1 to 20E6, 20F1 to 20F6, 20G1 to 20G6, and 20H1 to 20H5.

In an exemplary embodiment, the system 10 is provided as illustrated in Appendix A to the present application which corresponds generally to the extension actuator assembly 26 described above with reference to FIGS. 15-1, 15-2, 15A1, 15A2, 15B1, 15B2, 15C1, 15C2, 15D, 15E1 to 15E5, 15F1 to 15F5, and 15G1 to 15G5.

An apparatus for radially expanding and plastically deforming an expandable tubular member has been described that includes a support member, a cutting device for cutting the tubular member coupled to the support member, and an expansion device for radially expanding and plastically deforming the tubular member coupled to the support member. In an exemplary embodiment, the apparatus further includes a gripping device for gripping the tubular member coupled to the support member. In an exemplary embodiment, the gripping device comprises a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes: a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes: a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements includes a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member, an expansion device for radially expanding and plastically deforming the tubular member coupled to the support member, and an actuator coupled to the support member for displacing the expansion device relative to the support member. In an exemplary embodiment, the apparatus further includes a cutting device coupled to the support member for cutting the tubular member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member, and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device comprises: a support member; one or more drag blocks releasably coupled to the support member; and a stinger coupled to the support member for engaging the sliding sleeve valve. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, the in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; an expansion device for radially expanding and plastically deforming the tubular member coupled to the support member; and a sealing assembly for sealing an annulus defined between the support member and the tubular member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, the if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators comprise means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements includes a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices includes an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; a first expansion device for radially expanding and plastically deforming the tubular member coupled to the support member; and a second expansion device for radially expanding and plastically deforming the tubular member coupled to the support member. In an exemplary embodiment, the apparatus further includes a gripping device for gripping the tubular member coupled to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the apparatus further includes a packer assembly coupled to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device comprises: a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the apparatus further includes a cutting device for cutting the tubular member coupled to the support member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, at least one of the first second expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, at least one of the first and second expansion devices comprise a plurality of expansion devices. In an exemplary embodiment, at least one of the first and second expansion device comprise an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; an expansion device for radially expanding and plastically deforming the tubular member coupled to the support member; and a packer coupled to the support member. In an exemplary embodiment, the apparatus further includes a gripping device for gripping the tubular member coupled to the support member. In an exemplary embodiment, the gripping device comprises a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the apparatus further includes a sealing device for sealing an interface with the tubular member coupled to the support member. In an exemplary embodiment, the sealing device seals an annulus defines between the support member and the tubular member. In an exemplary embodiment, the apparatus further includes a locking device for locking the position of the tubular member relative to the support member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the apparatus further includes an actuator for displacing the expansion device relative to the support member. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the apparatus further includes a cutting device coupled to the support member for cutting the tubular member. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, the expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, the expansion device includes an adjustable expansion device. In an exemplary embodiment, the expansion device includes a plurality of expansion devices. In an exemplary embodiment, at least one of the expansion devices comprises an adjustable expansion device. In an exemplary embodiment, the adjustable expansion device includes a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for radially expanding and plastically deforming an expandable tubular member has been described that includes a support member; a cutting device for cutting the tubular member coupled to the support member; a gripping device for gripping the tubular member coupled to the support member; a sealing device for sealing an interface with the tubular member coupled to the support member; a locking device for locking the position of the tubular member relative to the support member; a first adjustable expansion device for radially expanding and plastically deforming the tubular member coupled to the support member; a second adjustable expansion device for radially expanding and plastically deforming the tubular member coupled to the support member; a packer coupled to the support member; and an actuator for displacing one or more of the sealing assembly, first and second adjustable expansion devices, and packer relative to the support member. In an exemplary embodiment, the gripping device includes a plurality of movable gripping elements. In an exemplary embodiment, the gripping elements are moveable in a radial direction relative to the support member. In an exemplary embodiment, the gripping elements are moveable in an axial direction relative to the support member. In an exemplary embodiment, the gripping elements are moveable in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member. In an exemplary embodiment, if the tubular member is displaced in a first axial direction, the gripping device grips the tubular member; and wherein, if the tubular member is displaced in a second axial direction, the gripping device does not grip the tubular member. In an exemplary embodiment, the gripping elements are moveable from a first position to a second position; wherein in the first position, the gripping elements do not engage the tubular member; wherein in the second position, the gripping elements do engage the tubular member; and wherein, the gripping elements are biased to remain in the first position. In an exemplary embodiment, the gripping device further includes an actuator for moving the gripping elements from a first position to a second position; wherein in the first position, the gripping elements do not engage the tubular member; wherein in the second position, the gripping elements do engage the tubular member; and wherein the actuator is a fluid powered actuator. In an exemplary embodiment, the sealing device seals an annulus defines between the support member and the tubular member. In an exemplary embodiment, the packer assembly includes a packer; and a packer control device for controlling the operation of the packer coupled to the support member. In an exemplary embodiment, the packer includes a support member defining a passage; a shoe comprising a float valve coupled to an end of the support member; one or more compressible packer elements movably coupled to the support member; and a sliding sleeve valve movably positioned within the passage of the support member. In an exemplary embodiment, the packer control device includes a support member; one or more drag blocks releasably coupled to the support member; and a stinger coupled to the support member for engaging the packer. In an exemplary embodiment, the packer includes a support member defining a passage; a shoe comprising a float valve coupled to an end of the support member; one or more compressible packer elements movably coupled to the support member; and a sliding sleeve valve positioned within the passage of the support member; and wherein the packer control device includes a support member; one or more drag blocks releasably coupled to the support member; and a stinger coupled to the support member for engaging the sliding sleeve valve. In an exemplary embodiment, the actuator includes a first actuator for pulling the expansion device; and a second actuator for pushing the expansion device. In an exemplary embodiment, the actuator includes means for transferring torsional loads between the support member and the expansion device. In an exemplary embodiment, the first and second actuators include means for transferring torsional loads between the support member and the expansion device. In an exemplary embodiment, the actuator includes a plurality of pistons positioned within corresponding piston chambers. In an exemplary embodiment, the cutting device includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements. In an exemplary embodiment, at least one of the adjustable expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements. In an exemplary embodiment, at least one of the adjustable expansion devices comprise a plurality of expansion devices. In an exemplary embodiment, at least one of the adjustable expansion devices include a support member; and a plurality of movable expansion elements coupled to the support member. In an exemplary embodiment, the apparatus further includes an actuator coupled to the support member for moving the expansion elements between a first position and a second position; wherein in the first position, the expansion elements do not engage the tubular member; and wherein in the second position, the expansion elements engage the tubular member. In an exemplary embodiment, the apparatus further includes a sensor coupled to the support member for sensing the internal diameter of the tubular member. In an exemplary embodiment, the sensor prevents the expansion elements from being moved to the second position if the internal diameter of the tubular member is less than a predetermined value. In an exemplary embodiment, the expansion elements include a first set of expansion elements; and a second set of expansion elements; wherein the first set of expansion elements are interleaved with the second set of expansion elements. In an exemplary embodiment, in the first position, the first set of expansion elements are not axially aligned with the second set of expansion elements. In an exemplary embodiment, in the second position, the first set of expansion elements are axially aligned with the second set of expansion elements.

An apparatus for cutting a tubular member has been described that includes a support member; and a plurality of movable cutting elements coupled to the support member. In an exemplary embodiment, the apparatus further includes an actuator coupled to the support member for moving the cutting elements between a first position and a second position; wherein in the first position, the cutting elements do not engage the tubular member; and wherein in the second position, the cutting elements engage the tubular member. In an exemplary embodiment, the apparatus further includes a sensor coupled to the support member for sensing the internal diameter of the tubular member. In an exemplary embodiment, the sensor prevents the cutting elements from being moved to the second position if the internal diameter of the tubular member is less than a predetermined value. In an exemplary embodiment, the cutting elements include a first set of cutting elements; and a second set of cutting elements; wherein the first set of cutting elements are interleaved with the second set of cutting elements. In an exemplary embodiment, in the first position, the first set of cutting elements are not axially aligned with the second set of cutting elements. In an exemplary embodiment, in the second position, the first set of cutting elements are axially aligned with the second set of cutting elements.

An apparatus for engaging a tubular member has been described that includes a support member; and a plurality of movable elements coupled to the support member. In an exemplary embodiment, the apparatus further includes an actuator coupled to the support member for moving the elements between a first position and a second position; wherein in the first position, the elements do not engage the tubular member; and wherein in the second position, the elements engage the tubular member. In an exemplary embodiment, the apparatus further includes a sensor coupled to the support member for sensing the internal diameter of the tubular member. In an exemplary embodiment, the sensor prevents the elements from being moved to the second position if the internal diameter of the tubular member is less than a predetermined value. In an exemplary embodiment, the elements include a first set of elements; and a second set of elements; wherein the first set of elements are interleaved with the second set of elements. In an exemplary embodiment, in the first position, the first set of elements are not axially aligned with the second set of elements. In an exemplary embodiment, in the second position, the first set of elements are axially aligned with the second set of elements.

An apparatus for gripping a tubular member has been described that includes a plurality of movable gripping elements. In an exemplary embodiment, the gripping elements are moveable in a radial direction. In an exemplary embodiment, the gripping elements are moveable in an axial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction. In an exemplary embodiment, the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction. In an exemplary embodiment, in a first axial direction, the gripping device grips the tubular member; and wherein, in a second axial direction, the gripping device does not grip the tubular member. In an exemplary embodiment, the apparatus further includes an actuator for moving the gripping elements. In an exemplary embodiment, the gripping elements include a plurality of separate and distinct gripping elements.

An actuator has been described that includes a tubular housing; a tubular piston rod movably coupled to and at least partially positioned within the housing; a plurality of annular piston chambers defined by the tubular housing and the tubular piston rod; and a plurality of tubular pistons coupled to the tubular piston rod, each tubular piston movably positioned within a corresponding annular piston chamber. In an exemplary embodiment, the actuator further includes means for transmitting torsional loads between the tubular housing and the tubular piston rod.

An apparatus for controlling a packer has been described that includes a tubular support member; one or more drag blocks releasably coupled to the tubular support member; and a tubular stinger coupled to the tubular support member for engaging the packer. In an exemplary embodiment, the apparatus further includes a tubular sleeve coupled to the drag blocks. In an exemplary embodiment, the tubular support member includes one or more axially aligned teeth for engaging the packer.

A packer has been described that includes a support member defining a passage; a shoe comprising a float valve coupled to an end of the support member; one or more compressible packer elements movably coupled to the support member; and a sliding sleeve valve movably positioned within the passage of the support member.

A method of radially expanding and plastically deforming an expandable tubular member within a borehole having a preexisting wellbore casing has been described that includes positioning the tubular member within the borehole in overlapping relation to the wellbore casing; radially expanding and plastically deforming a portion of the tubular member to form a bell section; and radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section. In an exemplary embodiment, radially expanding and plastically deforming a portion of the tubular member to form a bell section includes positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device; and displacing the adjustable expansion device upwardly relative to the expandable tubular member n times to radially expand and plastically deform n portions of the expandable tubular member, wherein n is greater than or equal to 1.

A method for forming a mono diameter wellbore casing has been described that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; positioning the adjustable expansion device within a second expandable tubular member; supporting the second expandable tubular member and the adjustable expansion device within the borehole in overlapping relation to the first expandable tubular member; lowering the adjustable expansion device out of the second expandable tubular member; increasing the outside dimension of the adjustable expansion device; and displacing the adjustable expansion device upwardly relative to the second expandable tubular member n times to radially expand and plastically deform n portions of the second expandable tubular member within the borehole.

A method for radially expanding and plastically deforming an expandable tubular member within a borehole has been described that includes positioning an adjustable expansion device within the expandable tubular member; supporting the expandable tubular member and the adjustable expansion device within the borehole; lowering the adjustable expansion device out of the expandable tubular member; increasing the outside dimension of the adjustable expansion device; displacing the adjustable expansion mandrel upwardly relative to the expandable tubular member n times to radially expand and plastically deform n portions of the expandable tubular member within the borehole; and pressurizing an interior region of the expandable tubular member above the adjustable expansion device during the radial expansion and plastic deformation of the expandable tubular member within the borehole.

A method for forming a mono diameter wellbore casing has been described that includes positioning an adjustable expansion device within a first expandable tubular member; supporting the first expandable tubular member and the adjustable expansion device within a borehole; lowering the adjustable expansion device out of the first expandable tubular member; increasing the outside dimension of the adjustable expansion device; displacing the adjustable expansion device upwardly relative to the first expandable tubular member m times to radially expand and plastically deform m portions of the first expandable tubular member within the borehole; pressurizing an interior region of the first expandable tubular member above the adjustable expansion device during the radial expansion and plastic deformation of the first expandable tubular member within the borehole; positioning the adjustable expansion mandrel within a second expandable tubular member; supporting the second expandable tubular member and the adjustable expansion mandrel within the borehole in overlapping relation to the first expandable tubular member; lowering the adjustable expansion mandrel out of the second expandable tubular member; increasing the outside dimension of the adjustable expansion mandrel; displacing the adjustable expansion mandrel upwardly relative to the second expandable tubular member n times to radially expand and plastically deform n portions of the second expandable tubular member within the borehole; and pressurizing an interior region of the second expandable tubular member above the adjustable expansion mandrel during the radial expansion and plastic deformation of the second expandable tubular member within the borehole.

A method for radially expanding and plastically deforming an expandable tubular member within a borehole has been described that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

A method for forming a mono diameter wellbore casing has been described that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; displacing the first adjustable expansion device and the second adjustable expansion device downwardly relative to the second expandable tubular member; decreasing the outside dimension of the first adjustable expansion device and increasing the outside dimension of the second adjustable expansion device; and displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

A method for radially expanding and plastically deforming an expandable tubular member within a borehole has been described that includes positioning first and second adjustable expansion devices within the expandable tubular member; supporting the expandable tubular member and the first and second adjustable expansion devices within the borehole; lowering the first adjustable expansion device out of the expandable tubular member; increasing the outside dimension of the first adjustable expansion device; displacing the first adjustable expansion device upwardly relative to the expandable tubular member to radially expand and plastically deform a lower portion of the expandable tubular member; pressurizing an interior region of the expandable tubular member above the first adjustable expansion device during the radial expansion of the lower portion of the expandable tubular member by the first adjustable expansion device; displacing the first adjustable expansion device and the second adjustable expansion device downwardly relative to the expandable tubular member; decreasing the outside dimension of the first adjustable expansion device and increasing the outside dimension of the second adjustable expansion device; displacing the second adjustable expansion device upwardly relative to the expandable tubular member to radially expand and plastically deform portions of the expandable tubular member above the lower portion of the expandable tubular member; and pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

A method for forming a mono diameter wellbore casing has been described that includes positioning first and second adjustable expansion devices within a first expandable tubular member; supporting the first expandable tubular member and the first and second adjustable expansion devices within a borehole; lowering the first adjustable expansion device out of the first expandable tubular member; increasing the outside dimension of the first adjustable expansion device; displacing the first adjustable expansion device upwardly relative to the first expandable tubular member to radially expand and plastically deform a lower portion of the first expandable tubular member; pressurizing an interior region of the first expandable tubular member above the first adjustable expansion device during the radial expansion of the lower portion of the first expandable tubular member by the first adjustable expansion device; displacing the first adjustable expansion device and the second adjustable expansion device downwardly relative to the first expandable tubular member; decreasing the outside dimension of the first adjustable expansion device and increasing the outside dimension of the second adjustable expansion device; displacing the second adjustable expansion device upwardly relative to the first expandable tubular member to radially expand and plastically deform portions of the first expandable tubular member above the lower portion of the expandable tubular member; pressurizing an interior region of the first expandable tubular member above the second adjustable expansion device during the radial expansion of the portions of the first expandable tubular member above the lower portion of the first expandable tubular member by the second adjustable expansion device; positioning first and second adjustable expansion devices within a second expandable tubular member; supporting the first expandable tubular member and the first and second adjustable expansion devices within the borehole in overlapping relation to the first expandable tubular member; lowering the first adjustable expansion device out of the second expandable tubular member; increasing the outside dimension of the first adjustable expansion device; displacing the first adjustable expansion device upwardly relative to the second expandable tubular member to radially expand and plastically deform a lower portion of the second expandable tubular member; pressurizing an interior region of the second expandable tubular member above the first adjustable expansion device during the radial expansion of the lower portion of the second expandable tubular member by the first adjustable expansion device; displacing the first adjustable expansion device and the second adjustable expansion device downwardly relative to the second expandable tubular member; decreasing the outside dimension of the first adjustable expansion device and increasing the outside dimension of the second adjustable expansion device; displacing the second adjustable expansion device upwardly relative to the second expandable tubular member to radially expand and plastically deform portions of the second expandable tubular member above the lower portion of the second expandable tubular member; and pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

A method for radially expanding and plastically deforming an expandable tubular member within a borehole has been described that includes supporting the expandable tubular member, an hydraulic actuator, and an adjustable expansion device within the borehole; increasing the size of the adjustable expansion device; and displacing the adjustable expansion device upwardly relative to the expandable tubular member using the hydraulic actuator to radially expand and plastically deform a portion of the expandable tubular member. In an exemplary embodiment, the method further includes reducing the size of the adjustable expansion device after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion device. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and a preexisting structure after permitting the position of the expandable tubular member to float relative to the position of the hydraulic actuator. In an exemplary embodiment, the method further includes increasing the size of the adjustable expansion device after permitting the position of the expandable tubular member to float relative to the position of the hydraulic actuator. In an exemplary embodiment, the method further includes displacing the adjustable expansion cone upwardly relative to the expandable tubular member to radially expand and plastically deform another portion of the expandable tubular member. In an exemplary embodiment, the method further includes if the end of the other portion of the expandable tubular member overlaps with a preexisting structure, then not permitting the position of the expandable tubular member to float relative to the position of the hydraulic actuator; and displacing the adjustable expansion cone upwardly relative to the expandable tubular member using the hydraulic actuator to radially expand and plastically deform the end of the other portion of the expandable tubular member that overlaps with the preexisting structure.

A method for forming a mono diameter wellbore casing within a borehole that includes a preexisting wellbore casing has been described that includes supporting the expandable tubular member, an hydraulic actuator, and an adjustable expansion device within the borehole; increasing the size of the adjustable expansion device; displacing the adjustable expansion device upwardly relative to the expandable tubular member using the hydraulic actuator to radially expand and plastically deform a portion of the expandable tubular member; and displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member. In an exemplary embodiment, the method further includes reducing the size of the adjustable expansion device after the portion of the expandable tubular member has been radially expanded and plastically deformed. In an exemplary embodiment, the method further includes fluidicly sealing the radially expanded and plastically deformed end of the expandable tubular member after reducing the size of the adjustable expansion device. In an exemplary embodiment, the method further includes permitting the position of the expandable tubular member to float relative to the position of the hydraulic actuator after fluidicly sealing the radially expanded and plastically deformed end of the expandable tubular member. In an exemplary embodiment, the method further includes injecting a hardenable fluidic sealing material into an annulus between the expandable tubular member and the borehole after permitting the position of the expandable tubular member to float relative to the position of the hydraulic actuator. In an exemplary embodiment, the method further includes increasing the size of the adjustable expansion device after permitting the position of the expandable tubular member to float relative to the position of the hydraulic actuator. In an exemplary embodiment, the method further includes displacing the adjustable expansion cone upwardly relative to the expandable tubular member to radially expand and plastically deform the remaining portion of the expandable tubular member. In an exemplary embodiment, the method further includes not permitting the position of the expandable tubular member to float relative to the position of the hydraulic actuator; and displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

A method of radially expanding and plastically deforming a tubular member has been described that includes positioning the tubular member within a preexisting structure; radially expanding and plastically deforming a lower portion of the tubular member to form a bell section; and radially expanding and plastically deforming a portion of the tubular member above the bell section. In an exemplary embodiment, positioning the tubular member within a preexisting structure includes locking the tubular member to an expansion device. In an exemplary embodiment, the outside diameter of the expansion device is less than the inside diameter of the tubular member. In an exemplary embodiment, the expansion device is positioned within the tubular member. In an exemplary embodiment, the expansion device includes an adjustable expansion device. In an exemplary embodiment, the adjustable expansion device is adjustable to a plurality of sizes. In an exemplary embodiment, the expansion device includes a plurality of expansion devices. In an exemplary embodiment, at least one of the expansion devices includes an adjustable expansion device. In an exemplary embodiment, at least one of the adjustable expansion device is adjustable to a plurality of sizes. In an exemplary embodiment, radially expanding and plastically deforming a lower portion of the tubular member to form a bell section includes lowering an expansion device out of an end of the tubular member; and pulling the expansion device through the end of the tubular member. In an exemplary embodiment, lowering an expansion device out of an end of the tubular member includes lowering the expansion device out of the end of the tubular member; and adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, radially expanding and plastically deforming a portion of the tubular member above the bell section includes lowering an expansion device out of an end of the tubular member; and pulling the expansion device through the end of the tubular member. In an exemplary embodiment, lowering an expansion device out of an end of the tubular member includes lowering the expansion device out of the end of the tubular member; and adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, pulling the expansion device through the end of the tubular member includes pulling the expansion device through the end of the tubular member using fluid pressure. In an exemplary embodiment, pulling the expansion device through the end of the tubular member using fluid pressure includes pressurizing an annulus within the tubular member above the expansion device. In an exemplary embodiment, radially expanding and plastically deforming a portion of the tubular member above the bell section includes fluidicly sealing an end of the tubular member; and pulling the expansion device through the tubular member. In an exemplary embodiment, the expansion device is adjustable. In an exemplary embodiment, the expansion device is adjustable to a plurality of sizes. In an exemplary embodiment, the expansion device comprises a plurality of adjustable expansion devices. In an exemplary embodiment, at least one of the adjustable expansion devices is adjustable to a plurality of sizes. In an exemplary embodiment, pulling the expansion device through the end of the tubular member includes gripping the tubular member; and pulling an expansion device through an end of the tubular member. In an exemplary embodiment, gripping the tubular member includes permitting axial displacement of the tubular member in a first direction; and not permitting axial displacement of the tubular member in a second direction. In an exemplary embodiment, pulling the expansion device through the end of the tubular member includes pulling the expansion device through the end of the tubular member using an actuator. In an exemplary embodiment, pulling the expansion device through the end of the tubular member includes pulling the expansion device through the end of the tubular member using fluid pressure. In an exemplary embodiment, pulling the expansion device through the end of the tubular member using fluid pressure includes pressurizing an annulus within the tubular member above the expansion device. In an exemplary embodiment, radially expanding and plastically deforming a portion of the tubular member above the bell section includes overlapping the portion of the tubular member above the bell section with an end of a preexisting tubular member; and pulling an expansion device through the overlapping portions of the tubular member and the preexisting tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, pulling the expansion device through the overlapping portions of the tubular member and the preexisting tubular member includes gripping the tubular member; and pulling the expansion device through the overlapping portions of the tubular member and the preexisting tubular member. In an exemplary embodiment, gripping the tubular member includes permitting axial displacement of the tubular member in a first direction; and not permitting axial displacement of the tubular member in a second direction. In an exemplary embodiment, pulling the expansion device through the overlapping portions of the tubular member and the preexisting tubular member includes pulling the expansion device through the overlapping portions of the tubular member and the preexisting tubular member using an actuator. In an exemplary embodiment, pulling the expansion device through the overlapping portions of the tubular member and the preexisting tubular member includes pulling the expansion device through the overlapping portions of the tubular member and the preexisting tubular member using fluid pressure. In an exemplary embodiment, pulling the expansion device through the overlapping portions of the tubular member and the preexisting tubular member using fluid pressure includes pressurizing an annulus within the tubular member above the expansion device. In an exemplary embodiment, the method further includes cutting an end of the portion of the tubular member that overlaps with the preexisting tubular member. In an exemplary embodiment, the method further includes removing the cut off end of the expandable tubular member from the preexisting structure. In an exemplary embodiment, the method further includes injecting a hardenable fluidic sealing material into an annulus between the expandable tubular member and the preexisting structure. In an exemplary embodiment, the method further includes cutting off an end of the expandable tubular member. In an exemplary embodiment, the method further includes removing the cut off end of the expandable tubular member from the preexisting structure.

A method of radially expanding and plastically deforming a tubular member has been described that includes applying internal pressure to the inside surface of the tubular member at a plurality of discrete location separated from one another.

A system for radially expanding and plastically deforming an expandable tubular member within a borehole having a preexisting wellbore casing has been described that includes means for positioning the tubular member within the borehole in overlapping relation to the wellbore casing; means for radially expanding and plastically deforming a portion of the tubular member to form a bell section; and means for radially expanding and plastically deforming a portion of the tubular member above the bell section comprising a portion of the tubular member that overlaps with the wellbore casing; wherein the inside diameter of the bell section is greater than the inside diameter of the radially expanded and plastically deformed portion of the tubular member above the bell section. In an exemplary embodiment, means for radially expanding and plastically deforming a portion of the tubular member to form a bell section includes means for positioning an adjustable expansion device within the expandable tubular member; means for supporting the expandable tubular member and the adjustable expansion device within the borehole; means for lowering the adjustable expansion device out of the expandable tubular member; means for increasing the outside dimension of the adjustable expansion device; and means for displacing the adjustable expansion device upwardly relative to the expandable tubular member n times to radially expand and plastically deform n portions of the expandable tubular member, wherein n is greater than or equal to 1.

A system for forming a mono diameter wellbore casing has been described that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for positioning the adjustable expansion device within a second expandable tubular member; means for supporting the second expandable tubular member and the adjustable expansion device within the borehole in overlapping relation to the first expandable tubular member; means for lowering the adjustable expansion device out of the second expandable tubular member; means for increasing the outside dimension of the adjustable expansion device; and means for displacing the adjustable expansion device upwardly relative to the second expandable tubular member n times to radially expand and plastically deform n portions of the second expandable tubular member within the borehole.

A system for radially expanding and plastically deforming an expandable tubular member within a borehole has been described that includes means for positioning an adjustable expansion device within the expandable tubular member; means for supporting the expandable tubular member and the adjustable expansion device within the borehole; means for lowering the adjustable expansion device out of the expandable tubular member; means for increasing the outside dimension of the adjustable expansion device; means for displacing the adjustable expansion mandrel upwardly relative to the expandable tubular member n times to radially expand and plastically deform n portions of the expandable tubular member within the borehole; and means for pressurizing an interior region of the expandable tubular member above the adjustable expansion device during the radial expansion and plastic deformation of the expandable tubular member within the borehole.

A system for forming a mono diameter wellbore casing has been described that includes means for positioning an adjustable expansion device within a first expandable tubular member; means for supporting the first expandable tubular member and the adjustable expansion device within a borehole; means for lowering the adjustable expansion device out of the first expandable tubular member; means for increasing the outside dimension of the adjustable expansion device; means for displacing the adjustable expansion device upwardly relative to the first expandable tubular member m times to radially expand and plastically deform m portions of the first expandable tubular member within the borehole; means for pressurizing an interior region of the first expandable tubular member above the adjustable expansion device during the radial expansion and plastic deformation of the first expandable tubular member within the borehole; means for positioning the adjustable expansion mandrel within a second expandable tubular member; means for supporting the second expandable tubular member and the adjustable expansion mandrel within the borehole in overlapping relation to the first expandable tubular member; means for lowering the adjustable expansion mandrel out of the second expandable tubular member; means for increasing the outside dimension of the adjustable expansion mandrel; means for displacing the adjustable expansion mandrel upwardly relative to the second expandable tubular member n times to radially expand and plastically deform n portions of the second expandable tubular member within the borehole; and means for pressurizing an interior region of the second expandable tubular member above the adjustable expansion mandrel during the radial expansion and plastic deformation of the second expandable tubular member within the borehole.

A system for radially expanding and plastically deforming an expandable tubular member within a borehole has been described that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; wherein the outside dimension of the first adjustable expansion device is greater than the outside dimension of the second adjustable expansion device.

A system for forming a mono diameter wellbore casing has been described that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; displacing the first adjustable expansion device upwardly relative to the first expandable tubular member to radially expand and plastically deform a lower portion of the first expandable tubular member; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the adjustable expansion device upwardly relative to the second expandable tubular member to radially expand and plastically deform a lower portion of the second expandable tubular member; means for displacing the first adjustable expansion device and the second adjustable expansion device downwardly relative to the second expandable tubular member; means for decreasing the outside dimension of the first adjustable expansion device and increasing the outside dimension of the second adjustable expansion device; and means for displacing the second adjustable expansion device upwardly relative to the second expandable tubular member to radially expand and plastically deform portions of the second expandable tubular member above the lower portion of the second expandable tubular member; wherein the outside dimension of the first adjustable expansion device is greater than the outside dimension of the second adjustable expansion device.

A system for radially expanding and plastically deforming an expandable tubular member within a borehole has been described that includes means for positioning first and second adjustable expansion devices within the expandable tubular member; means for supporting the expandable tubular member and the first and second adjustable expansion devices within the borehole; means for lowering the first adjustable expansion device out of the expandable tubular member; means for increasing the outside dimension of the first adjustable expansion device; means for displacing the first adjustable expansion device upwardly relative to the expandable tubular member to radially expand and plastically deform a lower portion of the expandable tubular member; means for pressurizing an interior region of the expandable tubular member above the first adjustable expansion device during the radial expansion of the lower portion of the expandable tubular member by the first adjustable expansion device; means for displacing the first adjustable expansion device and the second adjustable expansion device downwardly relative to the expandable tubular member; means for decreasing the outside dimension of the first adjustable expansion device and increasing the outside dimension of the second adjustable expansion device; means for displacing the second adjustable expansion device upwardly relative to the expandable tubular member to radially expand and plastically deform portions of the expandable tubular member above the lower portion of the expandable tubular member; and means for pressurizing an interior region of the expandable tubular member above the second adjustable expansion device during the radial expansion of the portions of the expandable tubular member above the lower portion of the expandable tubular member by the second adjustable expansion device; wherein the outside dimension of the first adjustable expansion device is greater than the outside dimension of the second adjustable expansion device.

A system for forming a mono diameter wellbore casing has been described that includes means for positioning first and second adjustable expansion devices within a first expandable tubular member; means for supporting the first expandable tubular member and the first and second adjustable expansion devices within a borehole; means for lowering the first adjustable expansion device out of the first expandable tubular member; means for increasing the outside dimension of the first adjustable expansion device; means for displacing the first adjustable expansion device upwardly relative to the first expandable tubular member to radially expand and plastically deform a lower portion of the first expandable tubular member; means for pressurizing an interior region of the first expandable tubular member above the first adjustable expansion device during the radial expansion of the lower portion of the first expandable tubular member by the first adjustable expansion device; means for displacing the first adjustable expansion device and the second adjustable expansion device downwardly relative to the first expandable tubular member; means for decreasing the outside dimension of the first adjustable expansion device and increasing the outside dimension of the second adjustable expansion device; means for displacing the second adjustable expansion device upwardly relative to the first expandable tubular member to radially expand and plastically deform portions of the first expandable tubular member above the lower portion of the expandable tubular member; means for pressurizing an interior region of the first expandable tubular member above the second adjustable expansion device during the radial expansion of the portions of the first expandable tubular member above the lower portion of the first expandable tubular member by the second adjustable expansion device; means for positioning first and second adjustable expansion devices within a second expandable tubular member; means for supporting the first expandable tubular member and the first and second adjustable expansion devices within the borehole in overlapping relation to the first expandable tubular member; means for lowering the first adjustable expansion device out of the second expandable tubular member; means for increasing the outside dimension of the first adjustable expansion device; means for displacing the first adjustable expansion device upwardly relative to the second expandable tubular member to radially expand and plastically deform a lower portion of the second expandable tubular member; means for pressurizing an interior region of the second expandable tubular member above the first adjustable expansion device during the radial expansion of the lower portion of the second expandable tubular member by the first adjustable expansion device; means for displacing the first adjustable expansion device and the second adjustable expansion device downwardly relative to the second expandable tubular member; means for decreasing the outside dimension of the first adjustable expansion device and increasing the outside dimension of the second adjustable expansion device; means for displacing the second adjustable expansion device upwardly relative to the second expandable tubular member to radially expand and plastically deform portions of the second expandable tubular member above the lower portion of the second expandable tubular member; and means for pressurizing an interior region of the second expandable tubular member above the second adjustable expansion device during the radial expansion of the portions of the second expandable tubular member above the lower portion of the second expandable tubular member by the second adjustable expansion device; wherein the outside dimension of the first adjustable expansion device is greater than the outside dimension of the second adjustable expansion device.

A system for radially expanding and plastically deforming an expandable tubular member within a borehole has been described that includes means for supporting the expandable tubular member, an hydraulic actuator, and an adjustable expansion device within the borehole; means for increasing the size of the adjustable expansion device; and means for displacing the adjustable expansion device upwardly relative to the expandable tubular member using the hydraulic actuator to radially expand and plastically deform a portion of the expandable tubular member. In an exemplary embodiment, the system further includes means for reducing the size of the adjustable expansion device after the portion of the expandable tubular member has been radially expanded and plastically deformed. In an exemplary embodiment, the system further includes means for fluidicly sealing the radially expanded and plastically deformed end of the expandable tubular member after reducing the size of the adjustable expansion device. In an exemplary embodiment, the system further includes means for permitting the position of the expandable tubular member to float relative to the position of the hydraulic actuator after fluidicly sealing the radially expanded and plastically deformed end of the expandable tubular member. In an exemplary embodiment, the system further includes means for injecting a hardenable fluidic sealing material into an annulus between the expandable tubular member and a preexisting structure after permitting the position of the expandable tubular member to float relative to the position of the hydraulic actuator. In an exemplary embodiment, the system further includes means for increasing the size of the adjustable expansion device after permitting the position of the expandable tubular member to float relative to the position of the hydraulic actuator. In an exemplary embodiment, system further includes means for displacing the adjustable expansion cone upwardly relative to the expandable tubular member to radially expand and plastically deform another portion of the expandable tubular member. In an exemplary embodiment, the system further includes if the end of the other portion of the expandable tubular member overlaps with a preexisting structure, then means for not permitting the position of the expandable tubular member to float relative to the position of the hydraulic actuator; and means for displacing the adjustable expansion cone upwardly relative to the expandable tubular member using the hydraulic actuator to radially expand and plastically deform the end of the other portion of the expandable tubular member that overlaps with the preexisting structure.

A system for forming a mono diameter wellbore casing within a borehole that includes a preexisting wellbore casing has been described that includes means for supporting the expandable tubular member, an hydraulic actuator, and an adjustable expansion device within the borehole; means for increasing the size of the adjustable expansion device; means for displacing the adjustable expansion device upwardly relative to the expandable tubular member using the hydraulic actuator to radially expand and plastically deform a portion of the expandable tubular member; and means for displacing the adjustable expansion device upwardly relative to the expandable tubular member to radially expand and plastically deform the remaining portion of the expandable tubular member and a portion of the preexisting wellbore casing that overlaps with an end of the remaining portion of the expandable tubular member. In an exemplary embodiment, the system further includes means for reducing the size of the adjustable expansion device after the portion of the expandable tubular member has been radially expanded and plastically deformed. In an exemplary embodiment, the system further includes means for fluidicly sealing the radially expanded and plastically deformed end of the expandable tubular member after reducing the size of the adjustable expansion device. In an exemplary embodiment, the system further includes means for permitting the position of the expandable tubular member to float relative to the position of the hydraulic actuator after fluidicly sealing the radially expanded and plastically deformed end of the expandable tubular member. In an exemplary embodiment, the system further includes means for injecting a hardenable fluidic sealing material into an annulus between the expandable tubular member and the borehole after permitting the position of the expandable tubular member to float relative to the position of the hydraulic actuator. In an exemplary embodiment, the system further includes means for increasing the size of the adjustable expansion device after permitting the position of the expandable tubular member to float relative to the position of the hydraulic actuator. In an exemplary embodiment, the system further includes means for displacing the adjustable expansion cone upwardly relative to the expandable tubular member to radially expand and plastically deform the remaining portion of the expandable tubular member. In an exemplary embodiment, the system further includes means for not permitting the position of the expandable tubular member to float relative to the position of the hydraulic actuator; and means for displacing the adjustable expansion cone upwardly relative to the expandable tubular member using the hydraulic actuator to radially expand and plastically deform the end of the remaining portion of the expandable tubular member that overlaps with the preexisting wellbore casing after not permitting the position of the expandable tubular member to float relative to the position of the hydraulic actuator.

A system for radially expanding and plastically deforming a tubular member has been described that includes means for positioning the tubular member within a preexisting structure; means for radially expanding and plastically deforming a lower portion of the tubular member to form a bell section; and means for radially expanding and plastically deforming a portion of the tubular member above the bell section. In an exemplary embodiment, positioning the tubular member within a preexisting structure includes means for locking the tubular member to an expansion device. In an exemplary embodiment, the outside diameter of the expansion device is less than the inside diameter of the tubular member. In an exemplary embodiment, the expansion device is positioned within the tubular member. In an exemplary embodiment, the expansion device includes an adjustable expansion device. In an exemplary embodiment, the adjustable expansion device is adjustable to a plurality of sizes. In an exemplary embodiment, the expansion device includes a plurality of expansion devices. In an exemplary embodiment, at least one of the expansion devices includes an adjustable expansion device. In an exemplary embodiment, at least one of the adjustable expansion device is adjustable to a plurality of sizes. In an exemplary embodiment, means for radially expanding and plastically deforming a lower portion of the tubular member to form a bell section includes means for lowering an expansion device out of an end of the tubular member; and means for pulling the expansion device through the end of the tubular member. In an exemplary embodiment, means for lowering an expansion device out of an end of the tubular member includes means for lowering the expansion device out of the end of the tubular member; and means for adjusting the size of the expansion device. In an exemplary embodiment, the adjustable expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for radially expanding and plastically deforming a portion of the tubular member above the bell section includes means for lowering an expansion device out of an end of the tubular member; and means for pulling the expansion device through the end of the tubular member. In an exemplary embodiment, means for lowering an expansion device out of an end of the tubular member includes means for lowering the expansion device out of the end of the tubular member; and means for adjusting the size of the expansion device. In an exemplary embodiment, the adjustable expansion device is adjustable to a plurality of sizes. In an exemplary embodiment, the expansion device comprises a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for pulling the expansion device through the end of the tubular member includes means for pulling the expansion device through the end of the tubular member using fluid pressure. In an exemplary embodiment, means for pulling the expansion device through the end of the tubular member using fluid pressure includes means for pressurizing an annulus within the tubular member above the expansion device. In an exemplary embodiment, means for radially expanding and plastically deforming a portion of the tubular member above the bell section includes means for fluidicly sealing an end of the tubular member; and means for pulling the expansion device through the tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the end of the tubular member includes means for gripping the tubular member; and means for pulling an expansion device through an end of the tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the end of the tubular member includes means for pulling the expansion device through the end of the tubular member using an actuator. In an exemplary embodiment, means for pulling the expansion device through the end of the tubular member includes means for pulling the expansion device through the end of the tubular member using fluid pressure. In an exemplary embodiment, means for pulling the expansion device through the end of the tubular member using fluid pressure includes means for pressurizing an annulus within the tubular member above the expansion device. In an exemplary embodiment, means for radially expanding and plastically deforming a portion of the tubular member above the bell section includes means for overlapping the portion of the tubular member above the bell section with an end of a preexisting tubular member; and means for pulling an expansion device through the overlapping portions of the tubular member and the preexisting tubular member. In an exemplary embodiment, the expansion device is adjustable. In an exemplary embodiment, the expansion device is adjustable to a plurality of sizes. In an exemplary embodiment, the expansion device includes a plurality of adjustable expansion devices. In an exemplary embodiment, at least one of the adjustable expansion devices is adjustable to a plurality of sizes. In an exemplary embodiment, means for pulling the expansion device through the overlapping portions of the tubular member and the preexisting tubular member includes means for gripping the tubular member; and means for pulling the expansion device through the overlapping portions of the tubular member and the preexisting tubular member. In an exemplary embodiment, means for gripping the tubular member includes means for permitting axial displacement of the tubular member in a first direction; and means for not permitting axial displacement of the tubular member in a second direction. In an exemplary embodiment, means for pulling the expansion device through the overlapping portions of the tubular member and the preexisting tubular member includes means for pulling the expansion device through the overlapping portions of the tubular member and the preexisting tubular member using an actuator. In an exemplary embodiment, means for pulling the expansion device through the overlapping portions of the tubular member and the preexisting tubular member includes means for pulling the expansion device through the overlapping portions of the tubular member and the preexisting tubular member using fluid pressure. In an exemplary embodiment, means for pulling the expansion device through the overlapping portions of the tubular member and the preexisting tubular member using fluid pressure includes means for pressurizing an annulus within the tubular member above the expansion device. In an exemplary embodiment, the system further includes means for cutting an end of the portion of the tubular member that overlaps with the preexisting tubular member. In an exemplary embodiment, the system further includes means for removing the cut off end of the expandable tubular member from the preexisting structure. In an exemplary embodiment, the system further includes means for injecting a hardenable fluidic sealing material into an annulus between the expandable tubular member and the preexisting structure. In an exemplary embodiment, the system further includes means for cutting off an end of the expandable tubular member. In an exemplary embodiment, the system further includes means for removing the cut off end of the expandable tubular member from the preexisting structure.

A system of radially expanding and plastically deforming a tubular member has been described that includes a support member; and means for applying internal pressure to the inside surface of the tubular member at a plurality of discrete location separated from one another coupled to the support member.

A method of cutting a tubular member has been described that includes positioning a plurality of cutting elements within the tubular member; and bringing the cutting elements into engagement with the tubular member. In an exemplary embodiment, the cutting elements include a first group of cutting elements; and a second group of cutting elements; wherein the first group of cutting elements are interleaved with the second group of cutting elements. In an exemplary embodiment, bringing the cutting elements into engagement with the tubular member includes bringing the cutting elements into axial alignment. In an exemplary embodiment, bringing the cutting elements into engagement with the tubular member further includes pivoting the cutting elements. In an exemplary embodiment, bringing the cutting elements into engagement with the tubular member further includes translating the cutting elements. In an exemplary embodiment, bringing the cutting elements into engagement with the tubular member further includes pivoting the cutting elements; and translating the cutting elements. In an exemplary embodiment, bringing the cutting elements into engagement with the tubular member includes rotating the cutting elements about a common axis. In an exemplary embodiment, bringing the cutting elements into engagement with the tubular member includes pivoting the cutting elements about corresponding axes; translating the cutting elements; and rotating the cutting elements about a common axis. In an exemplary embodiment, the method further includes preventing the cutting elements from coming into engagement with the tubular member if the inside diameter of the tubular member is less than a predetermined value. In an exemplary embodiment, preventing the cutting elements from coming into engagement with the tubular member if the inside diameter of the tubular member is less than a predetermined value includes sensing the inside diameter of the tubular member.

A method of gripping a tubular member has been described that includes positioning a plurality of gripping elements within the tubular member; bringing the gripping elements into engagement with the tubular member. In an exemplary embodiment, bringing the gripping elements into engagement with the tubular member includes displacing the gripping elements in an axial direction; and displacing the gripping elements in a radial direction. In an exemplary embodiment, the method further includes biasing the gripping elements against engagement with the tubular member.

A method of operating an actuator has been described that includes pressurizing a plurality of pressure chamber. In an exemplary embodiment, the method further includes transmitting torsional loads.

A method of injecting a hardenable fluidic sealing material into an annulus between a tubular member and a preexisting structure has been described that includes positioning the tubular member into the preexisting structure; sealing off an end of the tubular member; operating a valve within the end of the tubular member; and injecting a hardenable fluidic sealing material through the valve into the annulus between the tubular member and the preexisting structure.

A system for cutting a tubular member has been described that includes means for positioning a plurality of cutting elements within the tubular member; and means for bringing the cutting elements into engagement with the tubular member. In an exemplary embodiment, the cutting elements include a first group of cutting elements; and a second group of cutting elements; wherein the first group of cutting elements are interleaved with the second group of cutting elements. In an exemplary embodiment, means for bringing the cutting elements into engagement with the tubular member includes means for bringing the cutting elements into axial alignment. In an exemplary embodiment, means for bringing the cutting elements into engagement with the tubular member further includes means for pivoting the cutting elements. In an exemplary embodiment, means for bringing the cutting elements into engagement with the tubular member further includes means for translating the cutting elements. In an exemplary embodiment, means for bringing the cutting elements into engagement with the tubular member further includes means for pivoting the cutting elements; and means for translating the cutting elements. In an exemplary embodiment, means for bringing the cutting elements into engagement with the tubular member includes means for rotating the cutting elements about a common axis. In an exemplary embodiment, means for bringing the cutting elements into engagement with the tubular member includes means for pivoting the cutting elements about corresponding axes; means for translating the cutting elements; and means for rotating the cutting elements about a common axis. In an exemplary embodiment, the system further includes means for preventing the cutting elements from coming into engagement with the tubular member if the inside diameter of the tubular member is less than a predetermined value. In an exemplary embodiment, means for preventing the cutting elements from coming into engagement with the tubular member if the inside diameter of the tubular member is less than a predetermined value includes means for sensing the inside diameter of the tubular member.

A system for gripping a tubular member has been described that includes means for positioning a plurality of gripping elements within the tubular member; and means for bringing the gripping elements into engagement with the tubular member. In an exemplary embodiment, means for bringing the gripping elements into engagement with the tubular member includes means for displacing the gripping elements in an axial direction; and means for displacing the gripping elements in a radial direction. In an exemplary embodiment, the system further includes means for biasing the gripping elements against engagement with the tubular member.

An actuator system has been described that includes a support member; and means for pressurizing a plurality of pressure chambers coupled to the support member. In an exemplary embodiment, the system further includes means for transmitting torsional loads.

A system for injecting a hardenable fluidic sealing material into an annulus between a tubular member and a preexisting structure has been described that includes means for positioning the tubular member into the preexisting structure; means for sealing off an end of the tubular member; means for operating a valve within the end of the tubular member; and means for injecting a hardenable fluidic sealing material through the valve into the annulus between the tubular member and the preexisting structure.

A method of engaging a tubular member has been described that includes positioning a plurality of elements within the tubular member; and bringing the elements into engagement with the tubular member. In an exemplary embodiment, the elements include a first group of elements; and a second group of elements; wherein the first group of elements are interleaved with the second group of elements. In an exemplary embodiment, bringing the elements into engagement with the tubular member includes bringing the elements into axial alignment. In an exemplary embodiment, bringing the elements into engagement with the tubular member further includes pivoting the elements. In an exemplary embodiment, bringing the elements into engagement with the tubular member further includes translating the elements. In an exemplary embodiment, bringing the elements into engagement with the tubular member further includes pivoting the elements; and translating the elements. In an exemplary embodiment, bringing the elements into engagement with the tubular member includes rotating the elements about a common axis. In an exemplary embodiment, bringing the elements into engagement with the tubular member includes pivoting the elements about corresponding axes; translating the elements; and rotating the elements about a common axis. In an exemplary embodiment, the method further includes preventing the elements from coming into engagement with the tubular member if the inside diameter of the tubular member is less than a predetermined value. In an exemplary embodiment, preventing the elements from coming into engagement with the tubular member if the inside diameter of the tubular member is less than a predetermined value includes sensing the inside diameter of the tubular member.

A system for engaging a tubular member has been described that includes means for positioning a plurality of elements within the tubular member; and means for bringing the elements into engagement with the tubular member. In an exemplary embodiment, the elements include a first group of elements; and a second group of elements; wherein the first group of elements are interleaved with the second group of elements. In an exemplary embodiment, means for bringing the elements into engagement with the tubular member includes means for bringing the elements into axial alignment. In an exemplary embodiment, means for bringing the elements into engagement with the tubular member further includes means for pivoting the elements. In an exemplary embodiment, means for bringing the elements into engagement with the tubular member further includes means for translating the elements. In an exemplary embodiment, means for bringing the elements into engagement with the tubular member further includes means for pivoting the elements; and means for translating the elements. In an exemplary embodiment, means for bringing the elements into engagement with the tubular member includes means for rotating the elements about a common axis. In an exemplary embodiment, means for bringing the elements into engagement with the tubular member includes means for pivoting the elements about corresponding axes; means for translating the elements; and means for rotating the elements about a common axis. In an exemplary embodiment, the system further includes means for preventing the elements from coming into engagement with the tubular member if the inside diameter of the tubular member is less than a predetermined value. In an exemplary embodiment, means for preventing the elements from coming into engagement with the tubular member if the inside diameter of the tubular member is less than a predetermined value includes means for sensing the inside diameter of the tubular member.

A locking device for locking a tubular member to a support member has been described that includes a plurality of circumferentially spaced apart locking elements coupled to the support member for engaging an interior surface of the tubular member; a plurality of spring elements coupled to the support member for biasing corresponding locking elements out of engagement with the interior surface of the tubular member; a releasable retaining element releasably coupled to the support member for releasably retaining the locking elements in engagement with the interior surface of the tubular member; an actuator coupled to the support member for controllably displacing the retaining element relative to the locking elements; and a sensor coupled to the support member for sensing an operating condition within the tubular member for controllably displacing the retaining element relative to the locking elements.

A method of locking a tubular member to a support member has been described that includes engaging the interior surface of the tubular member at a plurality of circumferentially spaced apart locations using one or more engagement members; and disengaging the engagement members from the interior surface of the tubular member if an operating condition within the tubular member exceeds a predetermined amount; wherein the engagement members are biased out of engagement with the tubular member.

A system for locking a tubular member to a support member has been described that includes means for engaging the interior surface of the tubular member at a plurality of circumferentially spaced apart locations using one or more engagement members; and means for disengaging the engagement members from the interior surface of the tubular member if an operating condition within the tubular member exceeds a predetermined amount; wherein the engagement members are biased out of engagement with the tubular member.

It is understood that variations may be made in the foregoing without departing from the scope of the invention. For example, the teachings of the present illustrative embodiments may be used to provide a wellbore casing, a pipeline, or a structural support. Furthermore, the elements and teachings of the various illustrative embodiments may be combined in whole or in part in some or all of the illustrative embodiments. In addition, one or more of the elements and teachings of the various illustrative embodiments may be omitted, at least in part, and/or combined, at least in part, with one or more of the other elements and teachings of the various illustrative embodiments.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for radially expanding and plastically deforming an expandable tubular member, comprising:

a support member;

a cutting device for cutting the tubular member coupled to the support member;

an expansion device for radially expanding and plastically deforming the tubular member coupled to the support member;

a locking device for locking the position of the tubular member relative to the support member; and an actuator for displacing the expansion device relative to the support member;

wherein the actuator comprises:

a first actuator for pulling the expansion device; and a second actuator for pushing the expansion device.

2. An apparatus for radially expanding and plastically deforming an expandable tubular member, comprising:

a support member;

an expansion device for radially expanding and plastically deforming the tubular member coupled to the support member;

a sealing assembly for sealing an annulus defined between the support member and the tubular member;

a locking device for locking the position of the tubular member relative to the support member; and an actuator for displacing the expansion device relative to the support member;

wherein the actuator comprises:

a first actuator for pulling the expansion device; and a second actuator for pushing the expansion device.

3. An apparatus for radially expanding and plastically deforming an expandable tubular member, comprising:

a support member;

a first expansion device for radially expanding and plastically deforming the tubular member coupled to the support member;

a second expansion device for radially expanding and plastically deforming the tubular member coupled to the support member;

a locking device for locking the position of the tubular member relative to the support member; and an actuator for displacing the expansion device relative to the support member;

wherein the actuator comprises:

a first actuator for pulling the expansion device; and a second actuator for pushing the expansion device.

4. An apparatus for radially expanding and plastically deforming an expandable tubular member, comprising:

a support member;

an expansion device for radially expanding and plastically deforming the tubular member coupled to the support member;

a packer coupled to the support member;

a locking device for locking the position of the tubular member relative to the support member; and an actuator for displacing the expansion device relative to the support member;

wherein the actuator comprises:

a first actuator for pulling the expansion device; and a second actuator for pushing the expansion device.

5. A method of radially expanding and plastically deforming a tubular member, comprising:

positioning the tubular member within a preexisting structure;

radially expanding and plastically deforming a lower portion of the tubular member to form a bell section;

radially expanding and plastically deforming a portion of the tubular member above the bell section;

wherein positioning the tubular member within a preexisting structure comprises locking the tubular member to an expansion device; and wherein the radially expanding and plastically deforming the tubular member comprises pulling an expansion device through the tubular member with a first actuator and pushing the expansion device through the tubular member with a second actuator.

6. The apparatus of claim 1, wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

7. The apparatus of claim 6, wherein the locking device further comprises:

a fluid powered actuator coupled to the housing for displacing the locking element retainer relative to the locking elements.

8. The apparatus of claim 6, wherein the locking device further comprises:

a pressure sensor coupled to the locking element retainer for displacing the locking element retainer relative to the locking elements if a sensed operating condition exceeds a predetermined value.

9. The apparatus of claim 1, wherein at least one of the first and second actuators comprise:

a locking device for locking the position of the tubular member relative to the support member.

10. The apparatus of claim 9, wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

11. The apparatus of claim 10, wherein the locking device further comprises:

a fluid powered actuator coupled to the housing for displacing the locking element retainer relative to the locking elements.

12. The apparatus of claim 10, wherein the locking device further comprises:

a pressure sensor coupled to the locking element retainer for displacing the locking element retainer relative to the locking elements if a sensed operating condition exceeds a predetermined value.

13. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member; and a locking device for locking the position of the tubular member relative to the support member comprising one or more locking elements for engaging an interior surface of the expandable tubular member;

wherein the actuator comprises:

a locking device assembly for locking the position of the tubular member relative to the support member;

wherein the locking device assembly comprises:

one or more locking elements for engaging an interior surface of the expandable tubular member; and one or more spring elements for biasing corresponding locking elements out of engagement with the interior surface of the expandable tubular member.

14. The apparatus of claim 13, wherein the locking device assembly further comprises:

a fluid powered actuator for displacing a locking element retainer relative to the locking elements.

15. The apparatus of claim 13, wherein the locking device assembly further comprises:

a pressure sensor for displacing the locking element retainer relative to the locking elements if a sensed operating condition exceeds a predetermined value.

16. The apparatus of claim 13, wherein the locking device assembly comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

17. The apparatus of claim 16, wherein the locking device assembly further comprises:

a fluid powered actuator coupled to the housing for displacing a locking element retainer relative to the locking elements.

18. The apparatus of claim 16, wherein the locking device assembly further comprises:

a pressure sensor coupled to the locking element retainer for displacing the locking element retainer relative to the locking elements if a sensed operating condition exceeds a predetermined value.

19. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member; and a locking device for locking the position of the tubular member relative to the support member comprising one or more locking elements for engaging an interior surface of the expandable tubular member;

wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

20. The apparatus of claim 19, wherein the locking device further comprises:

a fluid powered actuator coupled to the housing for displacing the locking element retainer relative to the locking elements.

21. The apparatus of claim 19, wherein the locking device further comprises:

a pressure sensor coupled to the locking element retainer for displacing the locking element retainer relative to the locking elements if a sensed operating condition exceeds a predetermined value.

22. The apparatus of claim 2, wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

23. The apparatus of claim 22, wherein the locking device further comprises:

a fluid powered actuator coupled to the housing for displacing the locking element retainer relative to the locking elements.

24. The apparatus of claim 22, wherein the locking device further comprises:

a pressure sensor coupled to the locking element retainer for displacing the locking element retainer relative to the locking elements if a sensed operating condition exceeds a predetermined value.

25. The apparatus of claim 2, wherein at least one of the first and second actuators comprise:

a locking device for locking the position of the tubular member relative to the support member;

wherein the locking device comprises:

one or more locking elements for engaging an interior surface of the expandable tubular member; and one or more spring elements for biasing corresponding locking elements out of engagement with the interior surface of the expandable tubular member.

26. The apparatus of claim 25, wherein the locking device further comprises:

a fluid powered actuator for displacing the locking element retainer relative to the locking elements.

27. The apparatus of claim 25, wherein the locking device further comprises:

a pressure sensor for displacing the locking element retainer relative to the locking elements if a sensed operating condition exceeds a predetermined value.

28. The apparatus of claim 25, wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

29. The apparatus of claim 28, wherein the locking device further comprises:

a fluid powered actuator coupled to the housing for displacing the locking element retainer relative to the locking elements.

30. The apparatus of claim 28, wherein the locking device further comprises:

a pressure sensor coupled to the locking element retainer for displacing the locking element retainer relative to the locking elements if a sensed operating condition exceeds a predetermined value.

31. The apparatus of claim 3, wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

32. The apparatus of claim 31, wherein the locking device further comprises:

a fluid powered actuator coupled to the housing for displacing the locking element retainer relative to the locking elements.

33. The apparatus of claim 31, wherein the locking device further comprises:

a pressure sensor coupled to the locking element retainer for displacing the locking element retainer relative to the locking elements if a sensed operating condition exceeds a predetermined value.

34. The apparatus of claim 3, wherein at least one of the first and second actuators comprise:

a locking device for locking the position of the tubular member relative to the support member;

wherein the locking device comprises:

one or more locking elements for engaging an interior surface of the expandable tubular member; and one or more spring elements for biasing corresponding locking elements out of engagement with the interior surface of the expandable tubular member.

35. The apparatus of claim 34, wherein the locking device further comprises:

a fluid powered actuator for, displacing the locking element retainer relative to the locking elements.

36. The apparatus of claim 34, wherein the locking device further comprises:

a pressure sensor for displacing the locking element retainer relative to the locking elements if a sensed operating condition exceeds a predetermined value.

37. The apparatus of claim 34, wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

38. The apparatus of claim 37, wherein the locking device further comprises:

a fluid powered actuator coupled to the housing for displacing the locking element retainer relative to the locking elements.

39. The apparatus of claim 37, wherein the locking device further comprises:

a pressure sensor coupled to the locking element retainer for displacing the locking element retainer relative to the locking elements if a sensed operating condition exceeds a predetermined value.

40. The apparatus of claim 4, wherein the locking device comprises:

one or more locking elements for engaging an interior surface of the expandable tubular member; and one or more spring elements for biasing corresponding locking elements out of engagement with the interior surface of the expandable tubular member.

41. The apparatus of claim 40, wherein the locking device further comprises:

a fluid powered actuator for displacing the locking element retainer relative to the locking elements.

42. The apparatus of claim 40, wherein the locking device further comprises:

a pressure sensor for displacing the locking element retainer relative to the locking elements if a sensed operating condition exceeds a predetermined value.

43. The apparatus of claim 4, wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

44. The apparatus of claim 43, wherein the locking device further comprises:

a fluid powered actuator coupled to the housing for displacing the locking element retainer relative to the locking elements.

45. The apparatus of claim 43, wherein the locking device further comprises:

a pressure sensor coupled to the locking element retainer for displacing the locking element retainer relative to the locking elements if a sensed operating condition exceeds a predetermined value.

46. The apparatus of claim 4, wherein at least one of the first and second actuators comprise:

a locking device for locking the position of the tubular member relative to the support member;

wherein the locking device comprises:

one or more locking elements for engaging an interior surface of the expandable tubular member; and one or more spring elements for biasing corresponding locking elements out of engagement with the interior surface of the expandable tubular member.

47. The apparatus of claim 46, wherein the locking device further comprises:

a fluid powered actuator for displacing the locking element retainer relative to the locking elements.

48. The apparatus of claim 46, wherein the locking device further comprises:

a pressure sensor for displacing the locking element retainer relative to the locking elements if a sensed operating condition exceeds a predetermined value.

49. The apparatus of claim 46, wherein the locking device comprises:

a housing defining a plurality of circumferentially spaced apart openings;

a plurality of circumferentially spaced apart locking elements coupled to the housing that extend into corresponding openings of the housing for engaging an interior surface of the expandable tubular member; and a plurality of spring elements coupled to the housing for biasing corresponding locking elements out of engagement with the interior surface of the expandable tubular member.

50. The apparatus of claim 49, wherein the locking device further comprises:

a pressure sensor coupled to the locking element retainer for displacing the locking element retainer relative to the locking elements if a sensed operating condition exceeds a predetermined value.

51. The method of claim 5, wherein locking the tubular member to an expansion device comprises:

locking the position of the tubular member relative to a support member.

52. The method of claim 51, wherein locking the position of the tubular member relative to a support member comprises:

engaging the interior surface of the tubular member at a plurality of circumferentially spaced apart locations.

53. The method of claim 52, wherein engaging the interior surface of the tubular member at a plurality of circumferentially spaced apart locations comprises:

engaging the interior surface of the tubular member at a plurality of circumferentially spaced apart locations using one or more engagement members.

54. The method of claim 53, wherein the engagement members are biased out of engagement with the tubular member.

55. The method of claim 51, wherein locking the position of the tubular member relative to a support member comprises:

unlocking the position of the tubular member relative to the support member if an operating condition exceeds a predetermined amount.

56. The method of claim 55, wherein locking the position of the tubular member relative to a support member comprises:

unlocking the position of the tubular member relative to the support member if an operating condition within the tubular member exceeds a predetermined amount.

57. The method of claim 53, wherein locking the position of the tubular member relative to a support member comprises:

releasing the engagement members from engagement with the tubular member relative to the support member if an operating condition exceeds a predetermined amount.

58. An apparatus for radially expanding and plastically deforming an expandable tubular member, comprising:

a support member;

a cutting device for cutting the tubular member coupled to the support member;

an expansion device for radially expanding and plastically deforming the tubular member coupled to the support member; and a gripping device for gripping the tubular member coupled to the support member.

59. The apparatus of claim 58, wherein the gripping device comprises a plurality of movable gripping elements.

60. The apparatus of claim 59, wherein the gripping elements are moveable in a radial direction relative to the support member.

61. The apparatus of claim 59, wherein the gripping elements are moveable in an axial direction relative to the support member.

62. The apparatus of claim 59, wherein the gripping elements are moveable in a radial and an axial direction relative to the support member.

63. The apparatus of claim 59, wherein the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial and an axial direction relative to the support member.

64. The apparatus of claim 59, wherein the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in a radial direction relative to the support member.

65. The apparatus of claim 59, wherein the gripping elements are moveable from a first position to a second position; wherein in the first position, the gripping elements do not engage the tubular member; wherein in the second position, the gripping elements do engage the tubular member; and wherein, during the movement from the first position to the second position, the gripping elements move in an axial direction relative to the support member.

66. The apparatus of claim 59, wherein, if the tubular member is displaced in a first axial direction, the gripping device grips the tubular member; and wherein, if the tubular member is displaced in a second axial direction, the gripping device does not grip the tubular member.

67. The apparatus of claim 59, wherein the gripping elements are moveable from a first position to a second position; wherein in the first position, the gripping elements do not engage the tubular member; wherein in the second position, the gripping elements do engage the tubular member; and wherein, the gripping elements are biased to remain in the first position.

68. The apparatus of claim 59, wherein the gripping device further comprises:

an actuator for moving the gripping elements from a first position to a second position;

wherein in the first position, the gripping elements do not engage the tubular member;

wherein in the second position, the gripping elements do engage the tubular member; and wherein the actuator is a fluid powered actuator.

69. An apparatus for radially expanding and plastically deforming an expandable tubular member, comprising:

a support member;

a cutting device for cutting the tubular member coupled to the support member;

an expansion device for radially expanding and plastically deforming the tubular member coupled to the support member;

a sealing device for sealing an interface with the tubular member coupled to the support member;

wherein the sealing device seals an annulus defines between the support member and the tubular member; and an actuator for displacing the expansion device relative to the support member, wherein the actuator comprises:
a first actuator for pulling the expansion device; and
a second actuator for pushing the expansion device.

70. An apparatus for radially expanding and plastically deforming an expandable tubular member, comprising:
a support member;
a cutting device for cutting the tubular member coupled to the support member;
an expansion device for radially expanding and plastically deforming the tubular member coupled to the support member;
a locking device for locking the position of the tubular member relative to the support member; and
an actuator for displacing the expansion device relative to the support member, wherein the actuator comprises:
a first actuator for pulling the expansion device; and
a second actuator for pushing the expansion device.

71. An apparatus for radially expanding and plastically deforming an expandable tubular member, comprising:
a support member;
a cutting device for cutting the tubular member coupled to the support member;
an expansion device for radially expanding and plastically deforming the tubular member coupled to the support member; and
a packer assembly coupled to the support member, wherein the packer assembly comprises:
a packer; and
a packer control device for controlling the operation of the packer coupled to the support member.

72. The apparatus of claim 71, wherein the packer comprises:
a support member defining a passage;
a shoe comprising a float valve coupled to an end of the support member;
one or more compressible packer elements movably coupled to the support member; and
a sliding sleeve valve movably positioned within the passage of the support member.

73. The apparatus of claim 71, wherein the packer control device comprises:
a support member;
one or more drag blocks releasably coupled to the support member; and
a stinger coupled to the support member for engaging the packer.

74. The apparatus of claim 71, wherein the packer comprises:
a support member defining a passage;
a shoe comprising a float valve coupled to an end of the support member;
one or more compressible packer elements movably coupled to the support member; and
a sliding sleeve valve positioned within the passage of the support member; and
wherein the packer control device comprises:
a support member;
one or more drag blocks releasably coupled to the support member; and
a stinger coupled to the support member for engaging the sliding sleeve valve.

75. An apparatus for radially expanding and plastically deforming an expandable tubular member, comprising:
a support member;
a cutting device for cutting the tubular member coupled to the support member;
an expansion device for radially expanding and plastically deforming the tubular member coupled to the support member; and
an actuator for displacing the expansion device relative to the support member, wherein the actuator comprises:
a first actuator for pulling the expansion device; and
a second actuator for pushing the expansion device.

76. The apparatus of claim 75, wherein at least one of the first actuator and the second actuator comprises means for transferring torsional loads between the support member and the expansion device.

77. The apparatus of claim 75, wherein at least one of the first actuator and the second actuator comprises a plurality of pistons positioned within corresponding piston chambers.

78. An apparatus for radially expanding and plastically deforming an expandable tubular member, comprising:
a support member;
a cutting device for cutting the tubular member coupled to the support member;
an expansion device for radially expanding and plastically deforming the tubular member coupled to the support member;
wherein the cutting device comprises:
a support member; and
a plurality of movable cutting elements coupled to the support member;
an actuator coupled to the support member for moving the cutting elements between a first position and a second position;
wherein in the first position, the cutting elements do not engage the tubular member; and
wherein in the second position, the cutting elements engage the tubular member; and
a sensor coupled to the support member for sensing the internal diameter of the tubular member.

79. The apparatus of claim 78, wherein the sensor prevents the cutting elements from being moved to the second position if the internal diameter of the tubular member is less than a predetermined value.

80. The apparatus of claim 78, wherein the cutting elements comprise:
a first set of cutting elements; and
a second set of cutting elements;
wherein the first set of cutting elements are interleaved with the second set of cutting elements.

81. The apparatus of claim 80, wherein in the first position, the first set of cutting elements are not axially aligned with the second set of cutting elements.

82. The apparatus of claim 80, wherein in the second position, the first set of cutting elements are axially aligned with the second set of cutting elements.

83. An apparatus for radially expanding and plastically deforming an expandable tubular member, comprising:
a support member;
a cutting device for cutting the tubular member coupled to the support member;
an expansion device for radially expanding and plastically deforming the tubular member coupled to the support member;
wherein the expansion device comprises:
a support member; and
a plurality of movable expansion elements coupled to the support member; and
an actuator coupled to the support member for moving the expansion elements between a first position and a second position;

wherein in the first position, the expansion elements do not engage the tubular member; and wherein in the second position, the expansion elements engage the tubular member.

84. The apparatus of claim 83, further comprising:

a sensor coupled to the support member for sensing the internal diameter of the tubular member.

85. The apparatus of claim 84, wherein the sensor prevents the expansion elements from being moved to the second position if the internal diameter of the tubular member is less than a predetermined value.

86. The apparatus of claim 83, wherein the expansion elements comprise:

a first set of expansion elements; and a second set of expansion elements;

wherein the first set of expansion elements are interleaved with the second set of expansion elements.

87. The apparatus of claim 86, wherein in the first position, the first set of expansion elements are not axially aligned with the second set of expansion elements.

88. The apparatus of claim 86, wherein in the second position, the first set of expansion elements are axially aligned with the second set of expansion elements.

89. The apparatus of claim 75, wherein the expansion device comprises an adjustable expansion device.

90. The apparatus of claim 75, wherein the expansion device comprises a plurality of expansion devices.

91. The apparatus of claim 90, wherein at least one of the expansion devices comprises an adjustable expansion device.

92. The apparatus of claim 91, wherein the adjustable expansion device comprises:

a support member; and a plurality of movable expansion elements coupled to the support member.

93. The apparatus of claim 92, further comprising:

an actuator coupled to the support member for moving the expansion elements between a first position and a second position;

wherein in the first position, the expansion elements do not engage the tubular member; and wherein in the second position, the expansion elements engage the tubular member.

94. The apparatus of claim 93, further comprising:

a sensor coupled to the support member for sensing the internal diameter of the tubular member.

95. The apparatus of claim 94, wherein the sensor prevents the expansion elements from being moved to the second position if the internal diameter of the tubular member is less than a predetermined value.

96. The apparatus of claim 93, wherein the expansion elements comprise:

a first set of expansion elements; and a second set of expansion elements;

wherein the first set of expansion elements are interleaved with the second set of expansion elements.

97. The apparatus of claim 96, wherein in the first position, the first set of expansion elements are not axially aligned with the second set of expansion elements.

98. The apparatus of claim 96, wherein in the second position, the first set of expansion elements are axially aligned with the second set of expansion elements.

99. An apparatus for radially expanding and plastically deforming an expandable tubular member, comprising:

a support member;

a cutting device for cutting the tubular member coupled to the support member;

an expansion device for radially expanding and plastically deforming the tubular member coupled to the support member; and a gripping device for gripping the tubular member coupled to the support member, wherein the gripping device comprises a plurality of movable gripping elements;

wherein the gripping elements are moveable from a first position to a second position; wherein in the first position, the gripping elements do not engage the tubular member; wherein in the second position, the gripping elements do engage the tubular member; and wherein, the gripping elements are biased to remain in the first position.

100. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member, wherein the actuator comprises:

a first actuator for pulling the expansion device; and a second actuator for pushing the expansion device; and a sealing device for sealing an interface with the tubular member coupled to the support member;

wherein the sealing device seals an annulus defines between the support member and the tubular member.

101. An apparatus for radially expanding and plastically deforming an expandable tubular member, comprising:

a support member;

an expansion device for radially expanding and plastically deforming the tubular member coupled to the support member;

an actuator coupled to the support member for displacing the expansion device relative to the support member; and a packer assembly coupled to the support member, wherein the packer assembly comprises:

a packer; and a packer control device for controlling the operation of the packer coupled to the support member.

102. The apparatus of claim 101, wherein the packer comprises:

a support member defining a passage;

a shoe comprising a float valve coupled to an end of the support member;

one or more compressible packer elements movably coupled to the support member; and a sliding sleeve valve movably positioned within the passage of the support member.

103. The apparatus of claim 49, wherein the locking device further comprises:

a fluid powered actuator coupled to the housing for displacing the locking element retainer relative to the locking elements.

* * * * *